US012714919B2

(12) United States Patent
Potter et al.

(10) Patent No.: US 12,714,919 B2
(45) Date of Patent: Aug. 25, 2026

(54) PUTTER-TYPE GOLF CLUB HEAD

(71) Applicant: Taylor Made Golf Company, Inc., Carlsbad, CA (US)

(72) Inventors: Reed Potter, Carlsbad, CA (US); Jonathan Dreitlein, Carlsbad, CA (US); Paul Demkowski, Cardiff, CA (US); John Benjamin Harle, Carlsbad, CA (US); Bill Price, Santa Ana, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

(21) Appl. No.: 19/421,270

(22) Filed: Dec. 16, 2025

(65) Prior Publication Data

US 2026/0102663 A1 Apr. 16, 2026

Related U.S. Application Data

(63) Continuation of application No. 18/827,140, filed on Sep. 6, 2024, now Pat. No. 12,502,581, which is a continuation-in-part of application No. 18/323,935, filed on May 25, 2023, now Pat. No. 12,257,484.

(60) Provisional application No. 63/345,875, filed on May 25, 2022.

(51) Int. Cl.
*A63B 53/04* (2015.01)
*A63B 53/00* (2015.01)

(52) U.S. Cl.
CPC ..... *A63B 53/0437* (2020.08); *A63B 53/007* (2013.01); *A63B 53/0466* (2013.01)

(58) Field of Classification Search
CPC ..... A63B 53/0487
USPC ..... 473/328, 332, 340
See application file for complete search history.

(56) References Cited

U.S. PATENT DOCUMENTS 3,387,844 A * 6/1968 Shippce ..... A63B 53/0466 473/332
3,841,640 A * 10/1974 Gaulocher ..... A63B 69/3685 473/341
4,113,249 A * 9/1978 Beery ..... A63B 60/00 473/332
5,299,807 A * 4/1994 Hutin ..... A63B 53/04 473/329
5,346,219 A * 9/1994 Pehoski ..... A63B 53/0487 473/340

(Continued)

FOREIGN PATENT DOCUMENTS

FR 3121048 A1 * 9/2022 ..... A63B 60/54
GB 2388791 A * 11/2003 ..... A63B 53/08

(Continued)

OTHER PUBLICATIONS

U.S. Appl. No. 10/293,225, filed May 21, 2019, Nathan T. Sargent.

(Continued)

*Primary Examiner* — Alvin A Hunter
(74) *Attorney, Agent, or Firm* — Dawsey Co., LPA; David J. Dawsey

(57) ABSTRACT

A putter-type golf club head having a thin wall crown region and a crown damping member attached to thin wall crown region. The thin wall crown region has a TWCR thickness of 0.6-1.2 mm, a TWCR length, a TWCR width, and a TWCR area of at least 600 $mm^2$.

23 Claims, 85 Drawing Sheets

(56) References Cited

U.S. PATENT DOCUMENTS 5,464,212 A * 11/1995 Cook ..... A63B 53/0487 473/340
5,692,972 A * 12/1997 Langslet ..... A63B 60/00 473/340
6,159,109 A * 12/2000 Langslet ..... A63B 53/047 473/340
6,533,679 B1 * 3/2003 McCabe ..... A63B 60/02 473/335
6,648,772 B2 11/2003 Vincent
6,679,782 B2 * 1/2004 Tang ..... A63B 53/04 473/340
6,692,378 B2 * 2/2004 Shmoldas ..... A63B 53/0466 473/340
6,746,344 B1 * 6/2004 Long ..... A63B 53/0487 473/332
6,793,588 B2 * 9/2004 Tang ..... A63B 60/00 473/340
6,905,420 B2 * 6/2005 Tang ..... A63B 53/0487 473/340
6,929,564 B2 8/2005 Olsavsky
6,958,019 B2 10/2005 Rohrer
6,984,181 B2 1/2006 Hettinger
6,986,716 B2 * 1/2006 Lukasiewicz, Jr. ..... A63B 53/0487 473/340
7,004,849 B2 * 2/2006 Cameron ..... A63B 53/065 473/340
7,134,971 B2 * 11/2006 Franklin ..... A63B 53/06 473/340
7,354,356 B2 * 4/2008 Yamanaka ..... A63B 53/0487 473/340
7,396,295 B1 * 7/2008 Frame ..... A63B 60/02 473/340
7,435,188 B2 * 10/2008 Tateno ..... A63B 53/0487 473/340
7,455,599 B2 * 11/2008 Jones ..... A63B 53/0487 473/340
7,465,240 B2 12/2008 Frame
7,491,135 B1 * 2/2009 Rollinson ..... A63B 60/54 473/342
7,621,822 B2 * 11/2009 Roach ..... A63B 53/047 473/332
7,717,806 B2 * 5/2010 Kubota ..... A63B 60/02 473/340
7,798,919 B2 * 9/2010 Kubota ..... A63B 60/02 473/340
7,806,779 B2 * 10/2010 Franklin ..... A63B 60/00 473/331
7,815,520 B2 10/2010 Frame
7,854,665 B2 * 12/2010 Dewhurst ..... A63B 53/0466 473/340
7,867,103 B2 * 1/2011 Salmon ..... A63B 60/02 473/221
8,043,167 B2 10/2011 Boyd
8,083,611 B2 12/2011 Kuan
8,152,651 B2 * 4/2012 Roach ..... A63B 60/02 473/332
8,328,654 B2 * 12/2012 Demkowski ..... A63B 60/02 473/340
8,480,513 B2 * 7/2013 Kuan ..... A63B 60/54 473/340
8,523,698 B2 * 9/2013 Hotaling ..... A63B 53/04 473/340
8,641,556 B2 2/2014 Kuan
9,044,662 B2 * 6/2015 Demkowski ..... A63B 60/02
9,168,438 B2 10/2015 Boyd
9,522,313 B2 12/2016 Betts
9,757,630 B2 9/2017 Mata
9,839,822 B2 * 12/2017 Becktor ..... A63B 53/0487
10,835,788 B1 * 11/2020 Rice ..... A63B 53/0416
11,311,783 B1 * 4/2022 DeMille ..... A63B 53/045
11,826,621 B2 * 11/2023 Pedraza ..... A63B 53/0412
12,502,581 B2 * 12/2025 Potter ..... A63B 53/0437
2002/0065144 A1 * 5/2002 Helmstetter ..... C08G 18/10 473/340
2003/0004009 A1 1/2003 Hoffman
2003/0022730 A1 * 1/2003 Nelson ..... A63B 60/54 473/340
2003/0036438 A1 * 2/2003 Tang ..... A63B 60/00 473/340
2003/0130059 A1 * 7/2003 Billings ..... A63B 53/04 473/332
2003/0216191 A1 * 11/2003 Wright ..... A63B 53/0487 473/332
2003/0228925 A1 * 12/2003 Rohrer ..... A63B 60/02 473/340
2004/0033846 A1 * 2/2004 Caldwell ..... A63B 53/0466 473/345
2004/0058743 A1 * 3/2004 Hettinger ..... A63B 53/0487 473/340
2004/0063516 A1 * 4/2004 Cameron ..... A63B 53/0487 473/340
2004/0127305 A1 * 7/2004 Tang ..... A63B 53/0487 473/340
2004/0173964 A1 * 9/2004 Pollman ..... A63B 53/0487 473/340
2004/0242342 A1 * 12/2004 Patten ..... A63B 53/0487 473/313
2005/0014575 A1 1/2005 Tang
2005/0037858 A1 * 2/2005 Lukasiewicz, Jr. ..... A63B 53/0487 473/340
2005/0049078 A1 * 3/2005 Yamanaka ..... A63B 53/0487 473/340
2005/0233828 A1 * 10/2005 Bonneau ..... A63B 53/0487 473/340
2005/0239574 A1 * 10/2005 Rohrer ..... A63B 60/02 473/340
2005/0245323 A1 * 11/2005 Byrne ..... A63B 53/0487 473/340
2006/0019766 A1 * 1/2006 Kubota ..... A63B 53/0487 473/340
2006/0068933 A1 * 3/2006 Dewanjee ..... A63B 53/0466 473/340
2006/0094535 A1 * 5/2006 Cameron ..... A63B 60/02 473/340
2006/0229140 A1 * 10/2006 Kubica ..... A63B 53/0487 473/340
2007/0049401 A1 * 3/2007 Tateno ..... A63B 53/0487 473/340
2007/0149317 A1 6/2007 Kubota
2007/0178988 A1 * 8/2007 Tavares ..... A63B 60/02 473/340
2007/0293346 A1 * 12/2007 Rollinson ..... A63B 53/12 473/340
2008/0058117 A1 * 3/2008 Roach ..... A63B 53/047 473/332
2008/0146369 A1 6/2008 Wahl
2008/0146371 A1 6/2008 Wahl
2008/0200282 A1 * 8/2008 Frame ..... A63B 53/0487 473/340
2009/0082131 A1 * 3/2009 Best ..... A63B 60/00 473/340
2009/0105008 A1 * 4/2009 Kuan ..... A63B 53/04 473/340
2009/0149274 A1 * 6/2009 Rollinson ..... A63B 53/04 473/340
2010/0069172 A1 * 3/2010 Roach ..... A63B 53/047 473/332
2010/0184527 A1 * 7/2010 Demkowski ..... A63B 60/02 473/340
2012/0184393 A1 * 7/2012 Franklin ..... A63B 53/0487 473/340
2012/0289360 A1 * 11/2012 Breier ..... A63B 53/047 473/335
2013/0095942 A1 * 4/2013 Demkowski ..... A63B 60/02 473/242

(56) References Cited

U.S. PATENT DOCUMENTS

| | | | | |
|---|---|---|---|---|
| 2013/0274029 | A1* | 10/2013 | Kuan | A63B 60/54 473/329 |
| 2013/0303296 | A1 | 11/2013 | Demkowski | |
| 2014/0038746 | A1 | 2/2014 | Beach | |
| 2014/0066226 | A1 | 3/2014 | Ines | |
| 2015/0105179 | A1* | 4/2015 | Becktor | A63B 53/0487 473/341 |
| 2017/0340932 | A1 | 11/2017 | Morales | |
| 2018/0345093 | A1 | 12/2018 | Harbert | |
| 2019/0038944 | A1 | 2/2019 | Nielson | |
| 2020/0038721 | A1 | 2/2020 | Greensmith | |
| 2020/0139208 | A1 | 5/2020 | Johnson | |
| 2020/0324177 | A1 | 10/2020 | Harbert | |
| 2022/0152464 | A1* | 5/2022 | Pedraza | A63B 53/007 |
| 2022/0161108 | A1* | 5/2022 | Higdon | A63B 53/0429 |
| 2022/0219054 | A1* | 7/2022 | Andrews | A63B 53/065 |
| 2022/0347529 | A1 | 11/2022 | Carter | |
| 2023/0119368 | A1 | 4/2023 | Greaney | |
| 2024/0058662 | A1* | 2/2024 | Parsons | A63B 53/0487 |
| 2024/0075359 | A1* | 3/2024 | Higdon | A63B 53/0429 |
| 2024/0149121 | A1 | 5/2024 | Means | |
| 2024/0424356 | A1 | 12/2024 | Potter | |
| 2025/0229145 | A1* | 7/2025 | Demkowski | A63B 53/065 |

FOREIGN PATENT DOCUMENTS

| | | | | | |
|---|---|---|---|---|---|
| JP | S6250671 | U | * | 3/1987 | |
| JP | H0731804 | Y2 | * | 7/1995 | |
| JP | H10507383 | A | * | 7/1998 | A63B 53/0487 |
| JP | 2005137913 | A | * | 6/2005 | A63B 53/0416 |
| JP | 2006075267 | A | * | 3/2006 | |
| JP | 2007054167 | A | * | 3/2007 | A63B 53/0487 |
| JP | 4339073 | B2 | * | 10/2009 | |
| JP | 4522775 | B2 | * | 8/2010 | A63B 53/0487 |
| JP | 2024096110 | A | * | 7/2024 | A63B 53/042 |
| KR | 20080082768 | A | * | 9/2008 | A63B 53/0445 |
| KR | 20130096554 | A | * | 8/2013 | A63B 60/002 |
| KR | 20170110522 | A | * | 10/2017 | A63B 69/3635 |
| KR | 20230117146 | A | * | 8/2023 | A63B 53/0487 |
| KR | 20230119239 | A | * | 8/2023 | A63B 53/0429 |
| KR | 20230168800 | A | * | 12/2023 | A63B 53/065 |
| TW | M412790 | U | * | 10/2011 | |
| TW | M418712 | U | * | 12/2011 | |

OTHER PUBLICATIONS

U.S. Appl. No. 11/278,777, filed Mar. 22, 2022, Kraig Alan Willett.
U.S. Appl. No. 11/305,163, filed Apr. 19, 2022, Matthew David Johnson.
U.S. Appl. No. 11/331,548, filed May 17, 2022, Matthew Johnson.
U.S. Appl. No. 11/964,192, filed Apr. 23, 2024, Joseph Henry Hoffman.
U.S. Appl. No. 12/496,500, filed Dec. 16, 2025, Paul M. Demkowski.

* cited by examiner 27100
27102
27102
27102
27108
27100
27106
27106
27106

H
$T_i$
27018
27028
27028
27028

PUTTER-TYPE GOLF CLUB HEAD

CROSS-REFERENCE TO RELATED APPLICATIONS

This application is a continuation of U.S. Ser. No. 18/827,140, filed Sep. 6, 2024, which is a continuation-in-part of U.S. Ser. No. 18/323,935, filed May 25, 2023, now U.S. Pat. No. 12,257,484, which claims the benefit of U.S. Provisional Patent Application No. 63/345,875, filed on May 25, 2022, which is herein incorporated by reference in its entirety.

FIELD

This disclosure relates generally to golf clubs, and more particularly to a putter-type golf club head having a thin wall crown region.

BACKGROUND

Putter-type golf club heads having traditional large unitary construction metallic frames are often associated with reduced cost, but are also traditionally associated with poor performance attributable both undesirable mass properties, as well as the sound and feel of the club head upon impact with a golf ball. The undesirable sound and feel has often led golf club designers to further thicken the walls of such large unitary construction metallic frame putter heads, which often makes mass properties worse or involves creating aesthetic designs that are unappealing to modern golfers in light of modern aesthetic preferences.

Most golf putters are provided with a smooth ball-striking face, with greater or lesser degree of loft in order to control the distance and direction that a struck golf ball travels. Generally, a golf ball struck by a lofted putter initially travels slightly upwards while spinning backwards, which causes the golf ball to skid or slide across the putting surface for a short distance after impact. Friction between the ball and the putting surface results in a forward moment opposing the backspin which eventually imparts a forward roll to the ball. When a golf ball is rolling forwards rather than skidding or sliding over the putting surface, the ball is less influenced by surface irregularities and the rotational inertia of the ball will cause it to have more of a tendency to continue in the true direction of the putting stroke. Thus, it is desirable to get a ball "rolling" as early after impact as possible.

Various attempts have been made to provide an improved putter that aids in imparting forward roll or topspin to a golf ball. For example, it is known to provide the front face of a putter with upwardly angled, V-shaped projections that are elongated in the direction from the heel to the toe of the putter. The sharp edges of the projections purportedly enhance friction between the putter face and the ball, creating a gripping effect as the putter comes in contact with the ball, which promotes the transfer of topspin to the ball.

There is also a demand for putters that transfer sufficient momentum to the golf ball while providing an improved "feel" for the player. The "feel" of a club generally relates to the sensory feedback that the player receives when the club head strikes the golf ball. In other words, an improved "feel" gives the player a greater sense that the putter head is an extension of the player's hands and the perception that the player is more able to guide the ball along the desired path to the hole. The feel of the putter head is primarily a function of the spring constant (k) of the putter face. The spring constant is generally determined by the Young's modulus of the material, as well as the contact area (i.e., the amount of surface area on the putter face that actually contacts the ball during the putting stroke).

When projections have been used in connection with putters, the projections unfortunately have lacked the proper structure to effectively improve the feel and control of the putter. For example, the projections typically have sharp tips, which collectively form the contact face of the putter. Because the contact area is relatively small, the ball trajectory tends to be less controllable. The lack of sufficient contact area can also result in inconsistencies between putting strokes, since the impact of the club on the ball varies significantly depending upon the location and the angle of the putter face relative to the ball. Additionally, the sharp ends of the projections increase the friction between the club face and the ball, which can result in the club conferring too much spin to the ball so that ball trajectories can be unusual and unpredictable.

To improve the feel of the putter, golf club manufacturers have designed putter heads with soft plastic inserts that are mounted on the face of the putter head. The plastic inserts are mainly directed toward improving the feel of the putter through the use of low modulus material. The plastic inserts generally have a low Young's modulus to improve the feel of the putter, but unfortunately also present certain disadvantages. In particular, plastic inserts have a tendency to lower the sound when the club impacts the ball which causes a lack of acoustic feedback to the player. Additionally, such inserts do not promote the transfer of topspin to the ball to improve control.

Accordingly, there is a need for a golf putter that promotes the transfer of topspin to the ball to improve accuracy while providing improved feel.

SUMMARY

The subject matter of the present application has been developed in response to the present state of the art, and in particular, in response to the shortcomings of golf club heads with a multi-piece construction, that have not yet been fully solved. Accordingly, the subject matter of the present application has been developed to provide a golf club head that overcomes at least some of the above-discussed shortcomings of conventional golf club heads.

One embodiment includes a putter-type golf club head comprises a unitary construction metallic frame having a thin wall crown region, and a crown damping member attached to thin wall crown region. The unitary construction metallic frame has a frame mass of 250-370 grams, a frame density of at least 2.5 g/cc, a frame length of 40-130 mm, a frame width of 75-130 mm, a frame height of 17-30 mm, a frame front forming a portion of a striking face, a frame rear, a frame top, and a frame bottom, wherein the frame top includes a thin wall crown region having a TWCR thickness of 0.6-1.2 mm, a TWCR length, a TWCR width, and a TWCR area of at least 600 $mm^2$. The crown damping member is attached to thin wall crown region and has a CDM length, a CDM width, a CDM thickness of no more than 400% of a maximum TWCR thickness, a CDM area of at least 400 $mm^2$, a CDM density of no more than 2 g/cc, and a CDM areal weight of no more than 3000 $g/m^2$. The striking face has a loft of 2-10 degrees and a geometric center defining an origin for a club head origin X-axis, a club head origin Y-axis, and a club head origin Z-axis. The putter-type golf club head has a club head center of gravity CG located at a head origin x-axis CGx coordinate, a head origin y-axis CGy coordinate, a Zup distance above a ground plane, and defining a head center-of-gravity coordinate system having a CG X-axis, a CG Y-axis, and a CG Z-axis. The putter-type golf club head has a Ixx moment of inertia about the CG X-axis, a Iyy moment of inertia about the CG Y-axis, and a Izz moment of inertia about the CG Z-axis. The frame has a frame center of gravity CGf located at a head origin x-axis CGx-f coordinate and a head origin y-axis CGy-f coordinate, and a Zup-f distance above the ground plane. The frame has a Ixx-f moment of inertia about the CG X-axis of at least 220 kg·mm$^2$, a Iyy-f moment of inertia about the CG Y-axis of at least 200 kg·mm$^2$, and a Izz-f moment of inertia about the CG Z-axis of at least of at least 400 kg·mm$^2$. The putter-type golf club head has a total club head mass of 330-400 grams, a frame mass ratio of the frame mass to the total club head mass is 0.650-0.975, a frame Ixx ratio of the Ixx-f to the Ixx is 0.750-0.975, a frame Iyy ratio of the Iyy-f to the Iyy is 0.800-0.970, and a frame Izz ratio of the Izz-f to the Izz is 0.750-0.950.

To such ends, the present disclosure provides a putter head with a front surface having a plurality of deflectable beams or projections formed therein. The end surfaces of the beams collectively define a compliant striking face for striking a golf ball. Upon impact with the ball, the beams deflect and rebound to impart topspin on the ball, thereby resulting in earlier forward rotation of the ball after impact. Early forward rotation of the ball helps to minimize or eliminate the adverse effects of backspin induced skipping and sliding, such as the tendency of the ball to follow the grain of the putting green or to be knocked off line by other surface irregularities in the putting green.

Additionally, in particular embodiments, the beams are effective to impart a launch angle to the ball. The deflection of the beams also increases dwell time of the ball on the putter head, which improves the feel of the putter head when striking a golf ball.

In certain embodiments, the striking surface of the putter is comprised of a plurality of generally parallel, vertically spaced, deflectable beams extending horizontally across a front surface of the putter head. Each beam extends downwardly from a fixed end to a free end that can contact the ball. Upon impact with the ball, the beams deflect downwardly and inwardly, and then rebound upwardly and outwardly against the ball, thereby imparting topspin and providing an initial lift to the ball.

In one specific implementation, the beams can be formed directly in the front surface of the putter head. In another implementation, the beams are formed in an insert that is mounted to the front surface of the putter head. Desirably, the insert is mounted in a recess formed in the front surface. The insert can be permanently attached to the putter head, or alternatively, the insert can be removably attached to the putter head such that the insert may be replaced with another insert having different performance characteristics. In this manner, a golfer can select an insert that best suits the golfer's level of play or particular course conditions.

In particular embodiments, each beam has substantially parallel, opposed upper and lower surfaces and a substantially flat end surface. The end surfaces of the beams collectively define a striking face for contacting the ball. Each beam desirably has a substantially constant thickness measured between the upper and lower surfaces, although in other embodiments the beams can be tapered.

The described features, structures, advantages, and/or characteristics of the subject matter of the present disclosure may be combined in any suitable manner in one or more embodiments and/or implementations. In the following description, numerous specific details are provided to impart a thorough understanding of embodiments of the subject matter of the present disclosure. One skilled in the relevant art will recognize that the subject matter of the present disclosure may be practiced without one or more of the specific features, details, components, materials, and/or methods of a particular embodiment or implementation. In other examples, additional features and advantages may be recognized in certain embodiments and/or implementations that may not be present in all embodiments or implementations. Further, in some examples, well-known structures, materials, or operations are not shown or described in detail to avoid obscuring aspects of the subject matter of the present disclosure. The features and advantages of the subject matter of the present disclosure will become more fully apparent from the following description and appended claims, or may be learned by the practice of the subject matter as set forth hereinafter.

BRIEF DESCRIPTION OF THE DRAWINGS

In order that the advantages of the subject matter may be more readily understood, a more particular description of the subject matter briefly described above will be rendered by reference to specific embodiments that are illustrated in the appended drawings. Understanding that these drawings depict only typical embodiments of the subject matter and are not therefore to be considered to be limiting of its scope, the subject matter will be described and explained with additional specificity and detail through the use of the drawings, in which:

FIG. 113 is a front elevation view of the insert of FIG. 111, shown removed from the putter head;

FIG. 114 is a plan view showing the top edge of the insert shown in FIG. 113;

FIG. 115 is an enlarged, elevation view showing the side edge of the insert shown in FIG. 113;

FIG. 116 is a front elevation view of an insert that can be mounted to the front surface of a putter head, according to another embodiment;

FIG. 117 is a plan view showing the top edge of the insert shown in FIG. 116;

FIG. 118 is an elevation view showing the side edge of the insert shown in FIG. 116;

FIG. 119 is an enlarged, partial side elevation view of an insert, according to another embodiment;

FIG. 120 is a front elevation view of another embodiment of an insert;

FIG. 121 is a front elevation view of a putter head having a plurality of beams formed directly in the front surface of the putter head, according to one embodiment; and FIG. 122 is cross-sectional view of the putter head of FIG. 121 taken along line 122-122 of FIG. 121.

DETAILED DESCRIPTION

Figure 1:
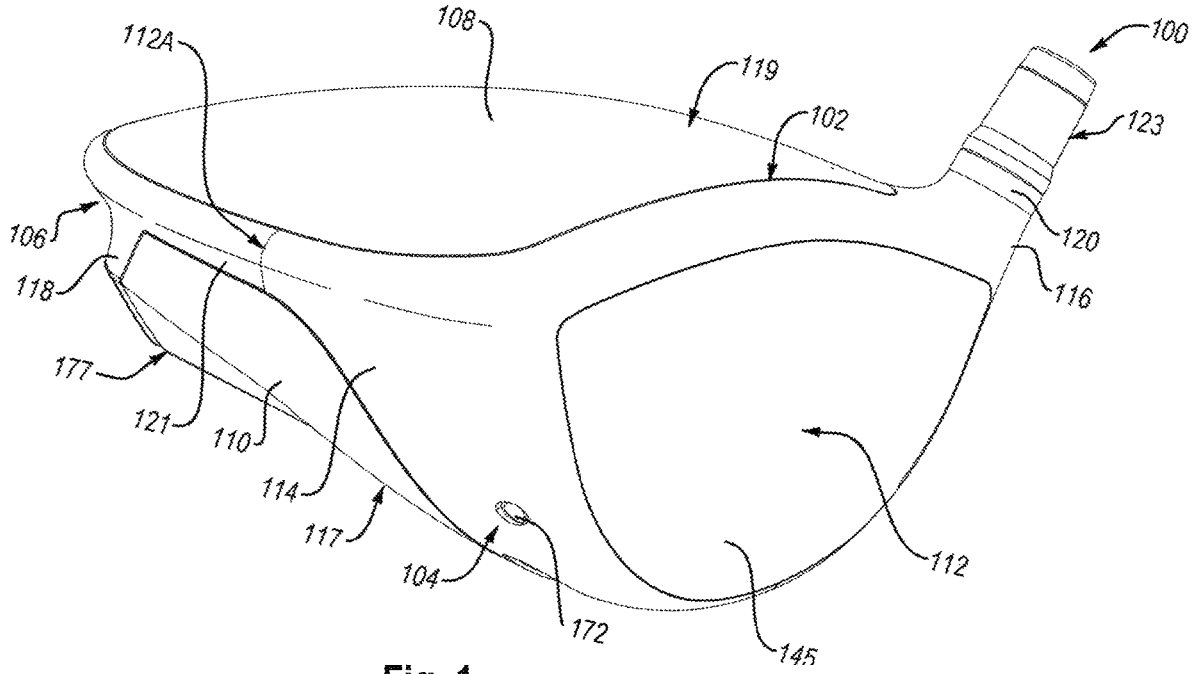
FIG. 1 is a schematic, perspective view of a golf club head, according to one or more examples of the present disclosure.

For purposes of this description, certain aspects, advantages, and novel features of the embodiments of this disclosure are described herein. The described methods, systems, and apparatus should not be construed as limiting in any way. Instead, the present disclosure is directed toward all novel and non-obvious features and aspects of the various disclosed embodiments, alone and in various combinations and sub-combinations with one another. The disclosed methods, systems, and apparatus are not limited to any specific aspect, feature, or combination thereof, nor do the disclosed methods, systems, and apparatus require that any one or more specific advantages be present, or problems be solved.

Features, properties, characteristics, materials, values, ranges, or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract, and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract, and drawings), or to any novel one, or any novel combination, of the steps of any method or process so disclosed.

Although the operations of some of the disclosed methods are described in a particular, sequential order for convenient presentation, this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed methods, systems, and apparatus can be used in conjunction with other systems, methods, and apparatus.

As used herein, the terms "a," "an," and "at least one" encompass one or more of the specified element. That is, if two of a particular element are present, one of these elements is also present and thus "an" element is present. The terms "a plurality of" and "plural" mean two or more of the specified element. As used herein, the term "and/or" used between the last two of a list of elements means any one or more of the listed elements. For example, the phrase "A, B, and/or C" means "A," "B," "C," "A and B," "A and C," "B and C," or "A, B, and C." As used herein, the term "coupled" generally means physically coupled or linked and does not exclude the presence of intermediate elements between the coupled items absent specific contrary language. The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." Any use of terminology such as "at least one of A and B" shall be interpreted to mean "at least one of A or B," and is not meant to exclude having both A and B, unless noted otherwise.

Directions and other relative references (e.g., inner, outer, upper, lower, etc.) may be used to facilitate discussion of the drawings and principles herein, but are not intended to be limiting. For example, certain terms may be used such as "inside," "outside,", "top," "down," "interior," "exterior," and the like. Such terms are used, where applicable, to provide some clarity of description when dealing with relative relationships, particularly with respect to the illustrated embodiments. Such terms are not, however, intended to imply absolute relationships, positions, and/or orientations. For example, with respect to an object, an "upper" part can become a "lower" part simply by turning the object over. Nevertheless, it is still the same part and the object remains the same. As used herein, "and/or" means "and" or "or," as well as "and" and "or."

The following describes examples of golf club heads in the context of a driver-type golf club head having a multi-piece construction, but the principles, methods and designs described may be applicable, in whole or in part, to fairway wood golf club heads, utility golf club heads (also known as hybrid golf club heads), iron-type golf club heads, putter-type golf club heads, and the like, because such golf club heads can also be made to have a multi-piece construction.

In some examples disclosed herein, the golf club head has a strike face formed of a non-metallic material, such as a fiber-reinforced polymeric material. A breakdown of the adhesive joint formed between a body of the golf club head and a non-metallic strike plate can cause characteristic time (CT) creep. USGA regulations require the CT of a golf club head to remain within the regulated limit regardless of the number of impacts the golf club head has with a golf ball. The CT of conventional driver-type golf club heads tends to increase after multiple impacts with a golf ball. The increase of CT due to impacts with a golf ball is known as CT creep. In certain examples disclosed herein, the golf club heads are configured to strengthen the adhesive joint formed between the body of the golf club heads and the non-metallic strike plate, such as by optimizing the surface structure of the golf club head for stronger adhesive bonds.

U.S. Patent Application Publication No. 2014/0302946 A1 ('946 App), published Oct. 9, 2014, which is incorporated herein by reference in its entirety, describes a "reference position" similar to the address position used to measure the various parameters discussed throughout this application. The address or reference position is based on the procedures described in the United States Golf Association and R&A Rules Limited, "Procedure for Measuring the Club Head Size of Wood Clubs," Revision 1.0.0, (Nov. 21, 2003). Unless otherwise indicated, all parameters are specified with the club head in the reference position.

Figure 7:
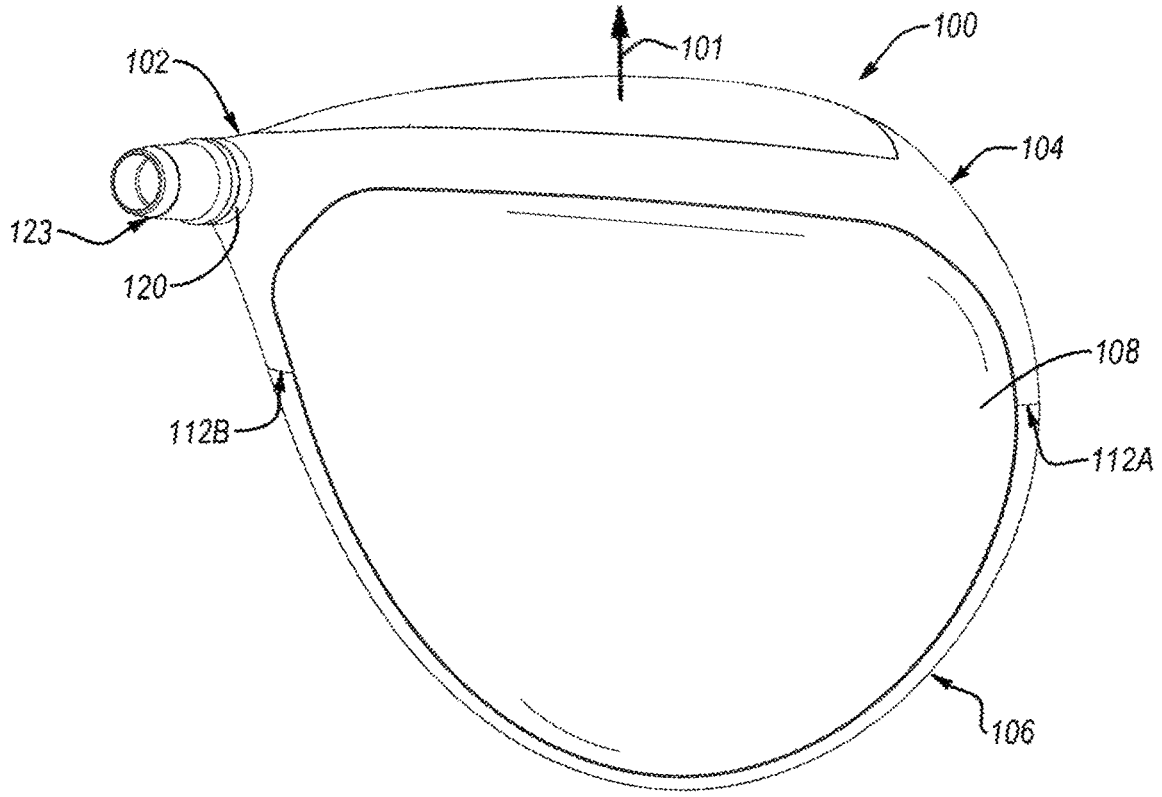
FIG. 7 is a schematic, top plan view of the golf club head of FIG. 1, according to one or more examples of the present disclosure.
Figure 8:
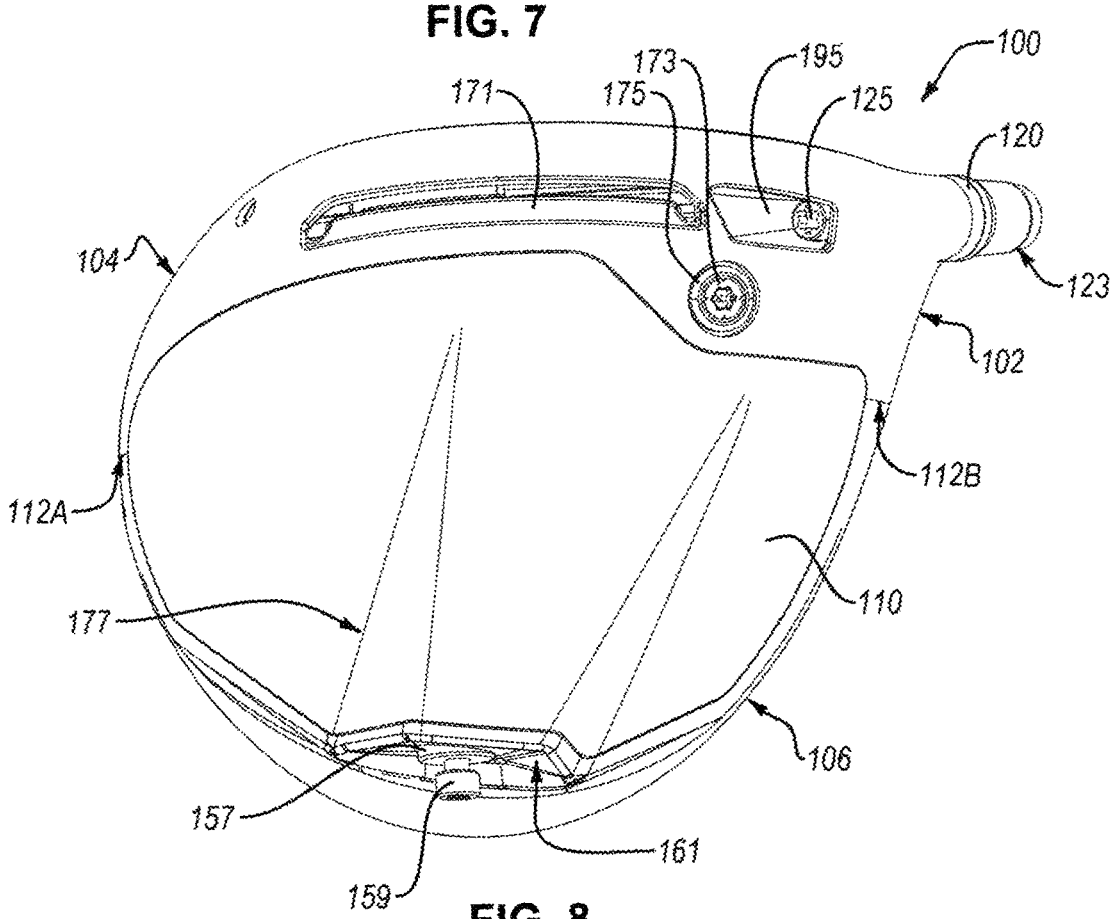
FIG. 8 is a schematic, bottom plan view of the golf club head of FIG. 1, according to one or more examples of the present disclosure.

FIGS. 3, 4, 5, and 9A are examples that show a golf club head 100 in the address or reference position. The golf club head 100 is in the address or reference position when a hosel axis 191 of the golf club head 100 is at a lie angle θ of 60-degrees relative to a ground plane 181 (see, e.g., FIG. 5) and a strike face 145 of the golf club head 100 is square relative to an imaginary target line 101 (see, e.g., FIG. 7). As shown in FIGS. 3, 4, 5, and 9A, positioning the golf club head 100 in the address or reference position lends itself to using a club head origin coordinate system 185, centered at a geometric center (e.g., center face 183) of the strike face 145, for making various measurements. With the golf club head in the address or reference position, using the USGA methodology, various parameters described throughout this application including head height, club head center of gravity (CG) location, and moments of inertia (MOI), can be measured relative to the club head origin coordinate system 185 or relative to another reference or references.

For further details or clarity, the reader is advised to refer to the measurement methods described in the '946 App and the USGA procedure. Notably, however, the origin and axes associated with the club head origin coordinate system 185 used in this application may not necessarily be aligned or oriented in the same manner as those described in the '946 App or the USGA procedure. Further details are provided below on locating the club head origin coordinate system 185.

In some examples, the golf club heads described herein include driver-type golf club heads, which can be identified, at least partially, as golf club heads with strike faces that have a total surface area of at least 3,500 mm^2, preferably at least 3,800 mm^2, and even more preferably at least 3,900 mm^2 (e.g., between 3,500 $mm^2$ and 5,000 $mm^2$ in one example, less than 5,000 $mm^2$ in various examples, and between 3,700 $mm^2$ and 4,300 $mm^2$ in another example). In some examples, such as when the strike face is defined by a non-metal material, the total surface area of the strike face is no more than 4,300 $mm^2$ and no less than 3,300 $mm^2$. The total surface area of the strike face is the outermost area of the striking face, which can be the outermost area of a face insert in some examples. In certain examples, the total surface area of the strike face is the surface area of the surface of the striking face that is bounded on its periphery by all points where the face transitions from a substantially uniform bulge radius (i.e., face heel-to-toe radius of curvature) and a substantially uniform roll radius (i.e., face crown-to-sole radius of curvature) to the body of the golf club head. In certain examples, the strike face of the golf club head disclosed herein is defined in the same manner as in one or more of U.S. Patent Application Publication No. 2020/0139208, filed Oct. 22, 2019, U.S. Pat. No. 8,801,541, issued Aug. 12, 2014, and U.S. Pat. No. 8,012,039, issued Sep. 6, 2011, all of which are incorporated herein by reference in their entirety. In yet some examples, the strike face has a uniform bulge radius and a uniform roll radius, except for portions that have a higher lofted toe and a lower lofted heel, such as described in U.S. patent application Ser. No. 17/006,561, filed Aug. 28, 2020, U.S. Pat. No. 9,814,944, issued Nov. 14, 2017, U.S. Pat. No. 10,265,586, issued Apr. 23, 2019, and U.S. Patent Application Publication No. 2019/0076705, filed Oct. 15, 2018, which are incorporated herein by reference in their entirety.

Additionally, in certain examples, driver-type golf club heads include a center-of-gravity (CG) projection, parallel to a horizontal (y-axis), which is, in one example, at most 3 mm above or below a center face of the strike face, and preferably at most 1 mm above or below the center face, as measured along a vertical axis (z-axis), or in another example, at most 5 mm below a center face of the strike face, and preferably at most 4 mm below the center face, as measured along a vertical axis (z-axis). In some examples, the CG projection is toe-ward of the geometric center of the strike face. Moreover, in some examples, driver-type golf club heads have a relatively high moment of inertia about a vertical axis (e.g., a CG z-axis passing through the CG and parallel with the z-axis of the club head origin coordinate system 185) (e.g. Izz>400 kg-mm^2 and preferably Izz>450 kg-mm^2, and more preferably Izz>500 kg-mm^2, but less than 590 kg-mm^2 in certain implementations), a relatively high moment of inertia about a horizontal axis (e.g., a CG x-axis passing through the CG and parallel with the x-axis of the club head origin coordinate system 185) (e.g. Ixx>250 kg-mm^2 and preferably Ixx>300 kg-mm^2 or 320 kg-mm^2, and more preferably Ixx>350 kg-mm^2, more preferably Ixx>375 kg-mm^2, more preferably Ixx>385 kg-mm^2, more preferably Ixx>400 kg-mm^2, more preferably Ixx>415 kg-mm^2, more preferably Ixx>430 kg-mm^2, more preferably Ixx>450 kg-mm^2, but no more than 590 kg·mm$^2$ in some examples), and preferably a ratio of Ixx/Izz>0.70. More details about inertia Izz and Ixx can be found in U.S. Patent Application Publication No. 2020/0139208, Published May 7, 2020, which is incorporate herein by reference in its entirety.

According to certain examples, a summation of Ixx and Izz is greater than 780 kg-mm^2, 800 kg-mm^2, 820 kg-mm^2, 825 kg-mm^2, 850 kg-mm^2, 860 kg-mm^2, 875 kg-mm^2, 900 kg-mm^2, 925 kg-mm^2, 950 kg-mm^2, 975 kg-mm^2, or 1000 kg-mm^2, but less than 1,100 kg-mm^2. For example, the summation of Ixx and Izz can be between 740 kg-mm^2 and 1,100 kg-mm^2, such as around 869 kg-mm^2. Ixx is at least 65% of Izz in some examples, even more preferably Ixx is at least 68% of Izz in some examples. In some example, a golf club head mass may range from 190 grams to 210 grams, preferably between 195 grams and 205 grams, even more preferably no more than 203 grams. The golf club head mass includes the mass of any FCT system and fastener to tighten the FCT system, but not the shaft of the golf club head or the grip of the golf club head. A maximum distance from a leading edge to a trailing edge of the club head as measured parallel to the y-axis is preferably is between 112 mm and 127 mm, preferably between 115 mm and 127 mm, even more preferably between 119 mm and 127 mm.

The larger inertia values and lower CG projection e.g. no more than 3 mm above center face can be achieved by including a forward weight and a rearward weight as discussed in more detail below. The forward weight can be a single forward weight or two or more forward weights. The forward weight can be located proximate to an imaginary vertical plane passing through the y-axis, or the forward weight can be offset to either a toe or a heel side of the imaginary vertical plane passing through the y-axis or both a toe and a heel side of the imaginary vertical plane passing through the y-axis of the golf club head. The forward weight can be separately formed and threadedly attached, welded, or bonded to the golf club head, or the forward weight can be a thickened region of the golf club head or in some cases the forwarded weight could be molded or over-molded into a forward portion of a golf club head. See below and U.S. Pat. No. 10,220,270, issued Mar. 5, 2019, which is incorporated herein by reference in its entirety, for further discussion on the various locations of forward and rearward weights. A forward weight is forward of a center of gravity of the golf club head and a rearward weight is rearward of a center of gravity of the golf club head.

In some examples, the golf club heads described herein have a delta-1 value that is no more than 25 mm, preferably between 20 mm and 25 mm. The delta-1 of the driver-type golf club head is a distance, along the y-axis of the head center face origin coordinate system 185, between the CG of the golf club head and an XZ plane, passing through the x-axis and the z-axis of the head center face origin coordinate system 185 and passing through the hosel axis 191. In certain examples, the Ixx of the golf club head is at least 335 kg·mm$^2$ and the delta 1 is no more than 25 mm, the Ixx of the golf club head is at least 345 kg·mm$^2$ and the delta 1 is no more than 25 mm, the Ixx of the golf club head is at least 355 kg·mm$^2$ and the delta 1 is no more than 25 mm, the Ixx of the golf club head is at least 365 kg·mm$^2$ and the delta 1 is no more than 25 mm, or the Ixx of the golf club head is at least 375 kg·mm$^2$ and the delta 1 is no more than 25 mm.

In some examples, the golf club heads described herein have a delta-1 value that is between 20 mm and 35 mm. In certain examples, the Ixx of the golf club head is at least 335 kg·mm$^2$ and the delta 1 is between 22 mm and 32 mm, the Ixx of the golf club head is at least 345 kg·mm$^2$ and the delta 1 is between 22 mm and 32 mm, the Ixx of the golf club head is at least 355 kg·mm$^2$ and the delta 1 is between 22 mm and 32 mm, the Ixx of the golf club head is at least 365 kg·mm$^2$ and the delta 1 is between 22 mm and 32 mm, the Ixx of the golf club head is at least 375 kg·mm$^2$ and the delta 1 is between 23 mm and 32 mm, the Ixx of the golf club head is at least 385 kg·mm$^2$ and the delta 1 is between 24 mm and 32 mm, the Ixx of the golf club head is at least 395 kg·mm$^2$ and the delta 1 is between 25 mm and 32 mm, or the Ixx of the golf club head is at least 405 kg·mm$^2$ and the delta 1 is between 27 mm and 32 mm.

Figure 2:
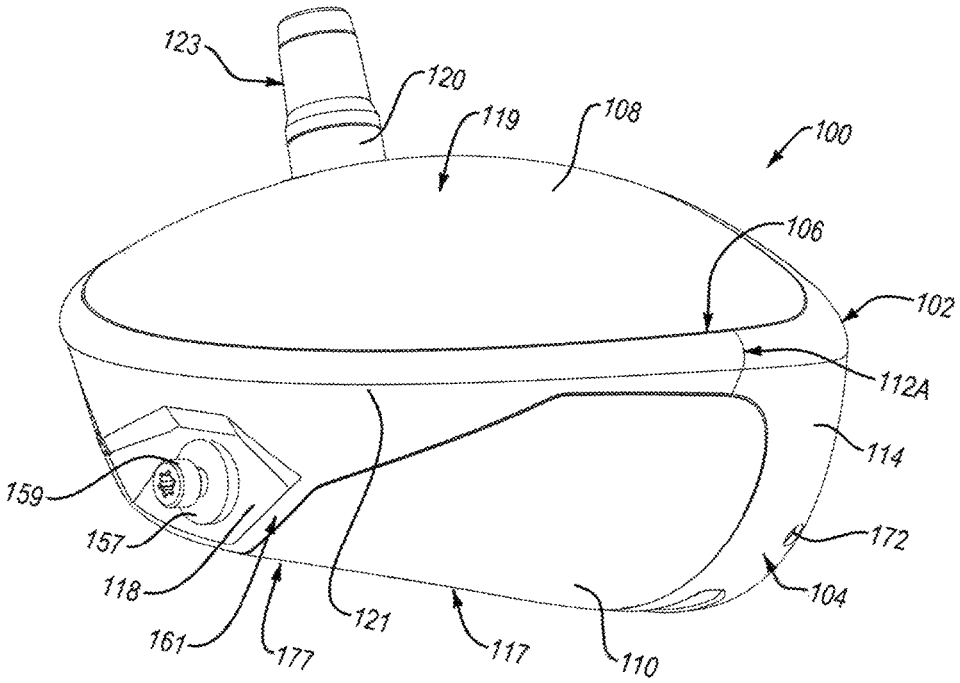
FIG. 2 is a schematic, perspective view of the golf club head of FIG. 1, according to one or more examples of the present disclosure.
Figure 9A:
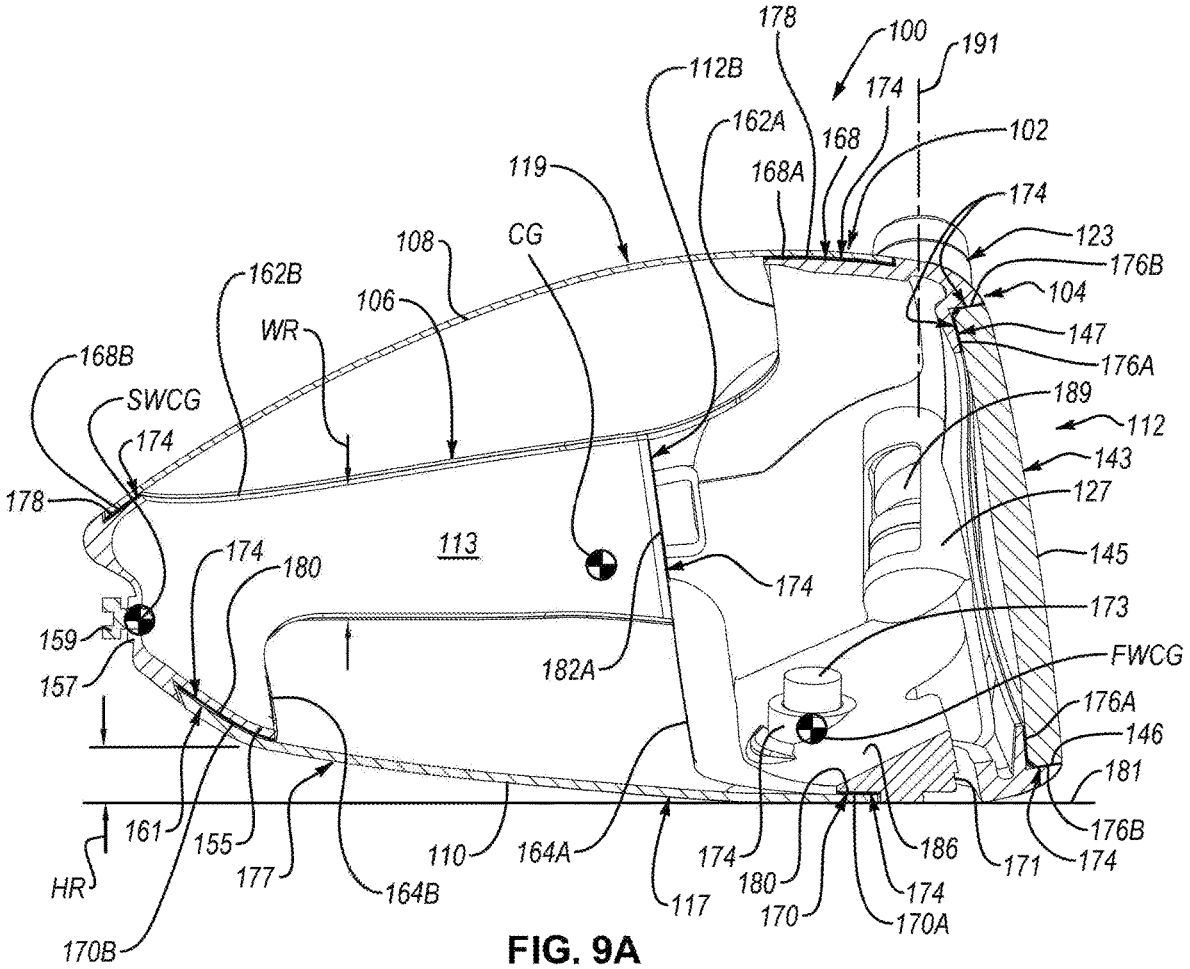
FIG. 9A is a schematic, cross-sectional, side elevation view of the golf club head of FIG. 1, taken along the line 9-9 of FIG. 5, according to one or more examples of the present disclosure.

Referring to FIGS. 1 and 2, according to some examples, the golf club head 100 of the present disclosure includes a toe portion 114 and a heel portion 116, opposite the toe portion 114. Additionally, the golf club head 100 includes a forward portion 112 (e.g., face portion) and a rearward portion 118, opposite the forward portion 112. The golf club head 100 additionally includes a sole portion 117, at a bottom region of the golf club head 100, and a crown portion 119, opposite the sole portion 117 and at a top region of the golf club head 100. Also, the golf club head 100 includes a skirt portion 121 that defines a transition region where the golf club head 100 transitions between the crown portion 119 and the sole portion 117. Accordingly, the skirt portion 121 is located between the crown portion 119 and the sole portion 117 and extends about a periphery of the golf club head 100. Referring to FIG. 9A, the golf club head 100 further includes an interior cavity 113 that is collectively defined and enclosed by the forward portion 112, the rearward portion 118, the crown portion 119, the sole portion 117, the heel portion 116, the toe portion 114, and the skirt portion 121.

The strike face 145 extends along the forward portion 112 from the sole portion 117 to the crown portion 119, and from the toe portion 114 to the heel portion 116. Moreover, the strike face 145, and at least a portion of an interior surface 166 of the forward portion 112, opposite the strike face 145, is planar in a top-to-bottom direction. As further defined, the strike face 145 faces in the generally forward direction. In some examples, the strike face 145 is co-formed with the body 102. In such examples, a minimum thickness of the forward portion 112 at the strike face 145 is between 1.5 mm and 2.5 mm and a maximum thickness of the forward portion 112 at the strike face 145 is less than 3.7 mm. An interior surface 166 of the forward portion 112, opposite the strike face 145, is not chemically etched and has an alpha case thickness of no more than 0.30 mm, in some examples.

Referring to FIGS. 9A, 9B, and 38-41, in some examples, the golf club head 100 includes a strike plate 143 that is not co-formed with the body 102. The strike plate 143 is formed separately from the body 102 and bonded to the body 102. As shown, the strike plate 143 defines the strike face 145 of the golf club head 100. In these examples, the body 102 includes a plate opening 149 at the forward portion 112 of the golf club head 100 and a plate-opening recessed ledge 147 that extends continuously about the plate opening 149. The plate opening recessed ledge 147 is non-planar or curved in some examples. An inner periphery of the plate-opening recessed ledge 147 defines the plate opening 149. The plate-opening recessed ledge 147 is divided into at least a top plate-opening recessed ledge 147A, that extends adjacently along the crown portion 119 of the golf club head 100 in a heel-to-toe direction, and a bottom plate-opening recessed ledge 147B, that extends adjacently along the sole portion 117 of the golf club head 100 in a heel-to-toe direction. Although not shown, the plate-opening recessed ledge is further divided into toe and heel plate-opening recessed ledges. Some properties of a plate-opening recessed ledge can be found in U.S. Pat. No. 9,278,267, issued Mar. 8, 2016, which is incorporated herein by reference in its entirety.

Figure 9B:
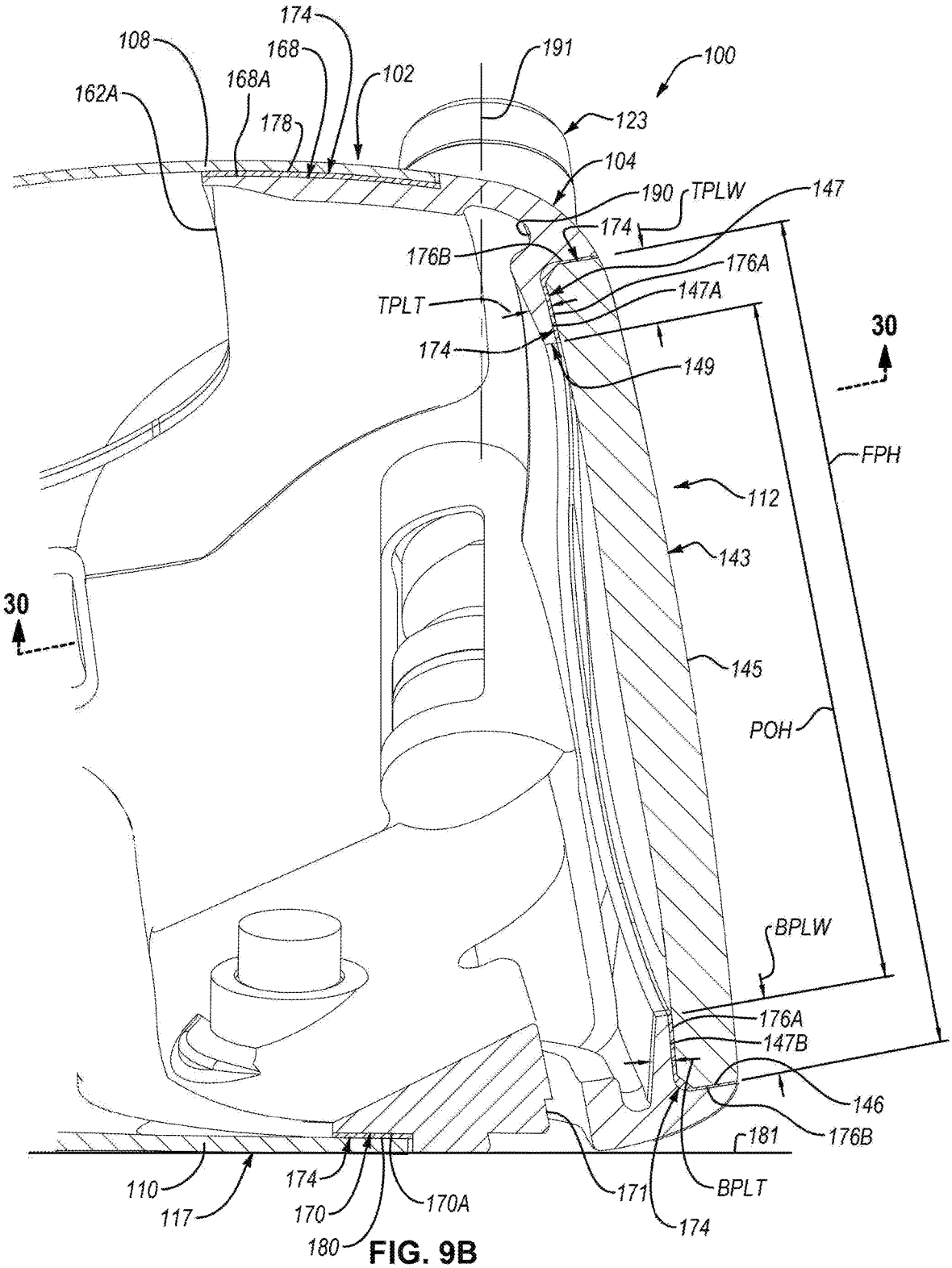
FIG. 9B is a schematic, cross-sectional, side elevation view of a detail of the golf club head of FIG. 9A, according to one or more examples of the present disclosure.

As shown in FIG. 9B, the top plate-opening recessed ledge 147A has a width (TPLW) and a thickness (TPLT). The width TPLW is defined as the distance from the inner periphery of the ledge 147A defining the plate opening 149 to the furthest extent of the adhering surface of the ledge 147A away from the inner periphery. The thickness TPLT is defined as the thickness of the material defining the adhering surface of the ledge 147A. In some examples, a recess 190 (e.g., an internal recess) is formed in an internal surface of the body 102 and has depth that extends in a back-to-front direction such that in a sole-to-crown direction, the recess 190 is between the top plate-opening recessed ledge 147A and a top of the golf club head 100. In other words, the recess 190 overlaps the top plate-opening recessed ledge 147A in a crown-to-sole direction. Notably, rearward of the recess 190 the thickness of the crown may increase locally such that the thickness of the crown portion proximate to where the crown insert joins the club head is thicker than at the recess 190. This may be done to stiffen the overall structure of the crown joint and mitigate stress in the composite crown joint.

Figure 30:
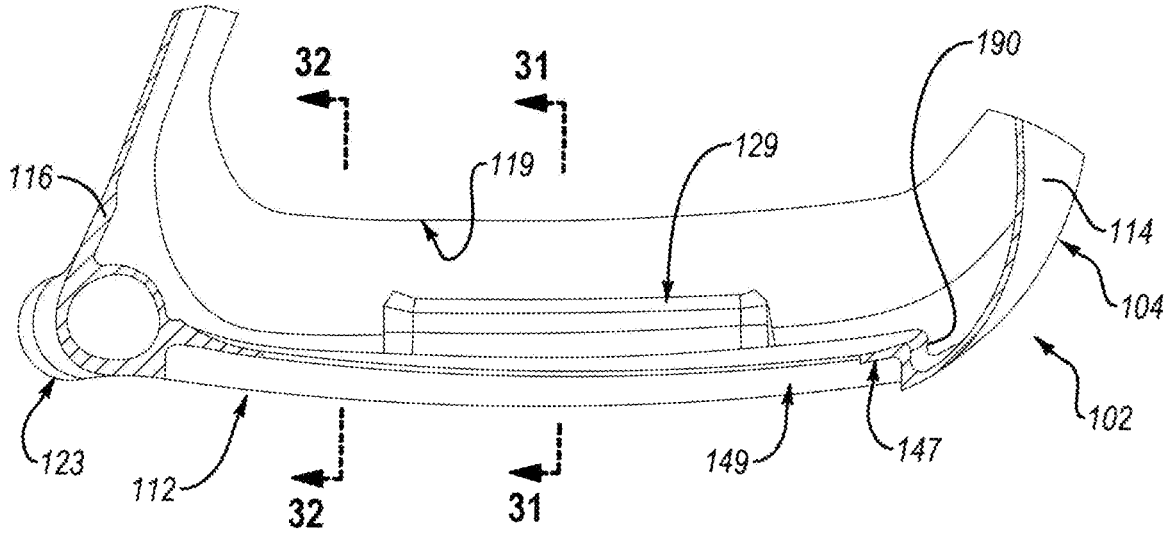
FIG. 30 is a schematic, sectional, bottom plan view of a golf club head, taken along a line similar to the line 30-30 of FIG. 9B, according to one or more examples of the present disclosure.
Figure 31:
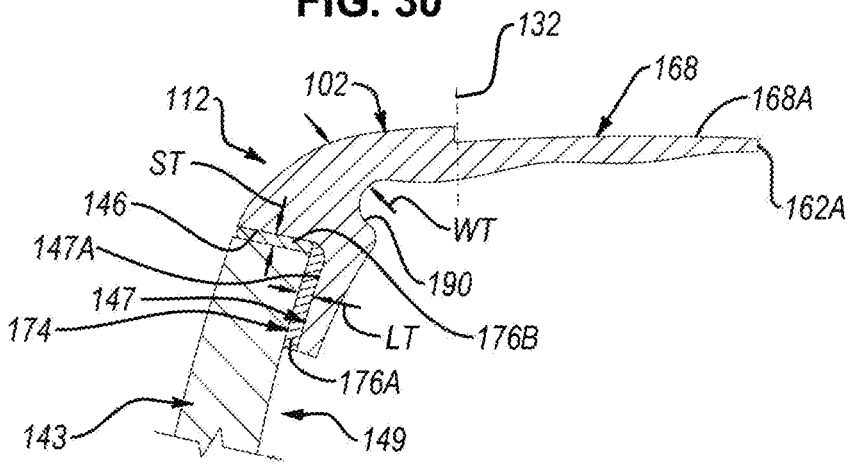
FIG. 31 is a schematic, sectional, side elevation view of a forward portion and a crown portion of the golf club head of FIG. 30, taken along the line 31-31 of FIG. 30, according to one or more examples of the present disclosure.
Figure 32:
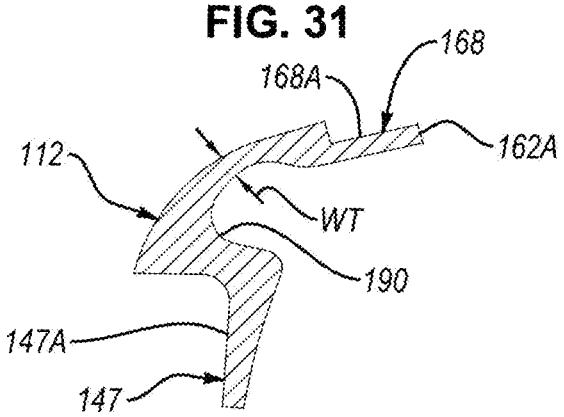
FIG. 32 is a schematic, sectional, side elevation view of a forward portion and a crown portion of the golf club head of FIG. 30, taken along the line 32-32 of FIG. 30, according to one or more examples of the present disclosure.

Referring to FIGS. 30-32, in some examples, the golf club head 100 further includes an interior mass pad 129 formed in the crown portion 119 at a location adjacent a top plate-opening recessed ledge 147A. The interior mass pad 129 is also located between and offset (e.g., spaced apart) from the heel portion 116 and the toe portion 114 of the golf club head 100. A portion of the recess 190 is formed in the interior mass pad 129 in some examples. The interior mass pad 129 extends along only a portion of a length of the top plate-opening recessed ledge 147A. The length of the top plate-opening recessed ledge 147A extends in a heel-to-toe direction. Moreover, in some examples, the top plate-opening recessed ledge 147A is non-planar or curved. According to some examples, a thickness (WT) of the crown portion at the recess 190 is thicker at the interior mass pad 129 (see, e.g., FIG. 31) than away from the interior mass pad 129 (see, e.g., FIG. 32).

In certain examples, the width TPLW of the top plate-opening recessed ledge 147A is greater than 4.5 mm (e.g., greater than 5.0 mm in some examples and greater than 5.5 mm in other examples, but less than 8.0 mm, preferably less than 7.0 mm in some examples). In some examples, a ratio of the width TPLW to a maximum height of the strike plate 143 is between 0.08 and 0.15. In the same or different examples, a ratio of the width TPLW to a maximum height of the plate opening 149 is between 0.07 and 0.15, such as 0.1, where in some examples the maximum height of the plate opening 149 is between 50-60 mm, such as 53 mm.

According to some examples, the thickness TPLT of the top plate-opening recessed ledge 147A is between a minimum value of 0.8 mm and a maximum value of 1.7 mm (e.g., between 0.9 mm and 1.6 mm in some examples and between 0.95 mm and 1.5 mm in other examples). As shown, the thickness TPLT is greater away from the inner periphery of the ledge 147A than at the inner periphery of the ledge 147A. Accordingly, the thickness TPLT varies along the width TPLW of the ledge 147A in some examples. For example, as shown, the thickness TPLT tapers or decreases in a crown-to-sole direction (e.g., toward a center of the plate opening 149). In some examples, the top ledge thickness TPLT of the top plate-opening recessed ledge 147A varies such that a maximum value of the top ledge thickness TPLT is between 30% and 60% greater than a minimum value of the top ledge thickness TPLT. In certain examples, a ratio of the thickness TPLT to a thickness of the strike plate is between 0.2 and 1.2. According to certain examples, a ratio of the width TPLW to the thickness TPLT is between 2.6 and 10.

The bottom plate-opening recessed ledge 147B has a width (BPLW) and a thickness (BPLT). The width BPLW is defined as the distance from the inner periphery of the ledge 147B defining the plate opening 149 to the furthest extent of the adhering surface of the ledge 147B away from the inner periphery. The thickness BPLT is defined as the thickness of the material defining the adhering surface of the ledge 147B.

In certain examples, the width BPLW of the bottom plate-opening recessed ledge 147B is greater than 4.5 mm (e.g., greater than 5.0 mm in some examples and greater than 5.5 mm in other examples, but less than 8.0 mm, preferably less than 7.0 mm in some examples). In some examples, a ratio of the width BPLW to a maximum height of the strike plate 143 is between 0.08 and 0.15. In the same or different examples, a ratio of the width BPLW to a maximum height of the plate opening 149 is between 0.07 and 0.15, such as 0.1, where in some examples the maximum height of the plate opening 149 is between 50-60 mm, such as 53 mm.

According to some examples, the thickness BPLT of the bottom plate-opening recessed ledge 147B is between 0.8 mm and 1.7 mm (e.g., between 0.9 mm and 1.6 mm in some examples and between 0.95 mm and 1.5 mm in other examples). As shown, the thickness BPLT is greater away from the inner periphery of the ledge 147B than at the inner periphery of the ledge 147B. Accordingly, the thickness BPLT varies along the width BPLW of the ledge 147B in some examples. For example, as shown, the thickness BPLT decreases in a sole-to-crown direction (e.g., toward a center of the plate opening 149). In some examples, the bottom ledge thickness BPLT of the bottom plate-opening recessed ledge 147B varies such that a maximum value of the bottom ledge thickness BPLT is between 30% and 60% greater than a minimum value of the bottom ledge thickness BPLT. In certain examples, a ratio of the thickness BPLT to a thickness of the strike plate is between 0.2 and 1.2. According to certain examples, a ratio of the width BPLW to the thickness BPLT is between 2.6 and 10.

As shown, the strike plate 143 is attached to the body 102 by fixing the strike plate 143 in seated engagement with at least the top plate-opening recessed ledge 147A and the bottom plate-opening recessed ledge 147B. When joined to the top plate-opening recessed ledge 147A and the bottom plate-opening recessed ledge 147B in this manner, the strike plate 143 covers or encloses the plate opening 149. Moreover, in some examples, the top plate-opening recessed ledge 147A and the strike plate 143 are sized, shaped, and positioned relative to the crown portion 119 of the golf club head 100 such that the strike plate 143 abuts the crown portion 119 when seatably engaged with the top plate-opening recessed ledge 147A. The strike plate 143, abutting the crown portion 119, defines a topline of the golf club head 100. Moreover, in some examples, the visible appearance of the strike plate 143 contrasts enough with that of the crown portion 119 of the golf club head 100 that the topline of the golf club head 100 is visibly enhanced. Because the strike plate 143 is formed separately from the body 102, the strike plate 143 can be made of a material that is different than that of the body 102. In one example, the strike plate 143 is made of a fiber-reinforced polymeric material, such as described hereafter.

Notably, the TPLW, TPLT, BPLW, and BPLT dimensions help to control the local stiffness of the club head and to ensure sufficient bonding area to bond the strike plate to the body 102. The modulus of the strike plate if formed from a fiber-reinforced polymeric material will be much different than the modulus of the body if formed from a metal material such that the stiffness or compliance of the two are different, and during impact the strike plate and the body will move at different rates due to the different moduli unless precautions are taken in the design to account for the stiffness differences. The recess 190, and the TPLW, TPLT, BPLW, and BPLT dimensions, all play a role in controlling the overall compliance and rate with which the face and body move during impact. Additionally, TPLW and BPLW contribute to ensuring sufficient bond area and face performance. Too little bond area and the bonded joint will fail, too much bond area and the face will not perform i.e. the coefficient of restitution will not be optimized, and in some examples too much bond area will result in the face peeling away from the club head due to the differences in stiffness. Thus, TPLW, TPLT, BPLW, and BPLT dimensions contribute to the overall performance of the club head and to the avoidance of bonded joint failure. In some examples, the bond area will range from 850 $mm^2$ to 1800 $mm^2$, preferably between 1,300 $mm^2$ to 1,500 $mm^2$. In some examples, a ratio of the bond area to the inner surface area of the strike plate (rear surface area of the strike plate) will range from 21% to 45%. In some examples, a total bond area of the strike plate will be less than a total bond area of the crown insert. In some examples, a ledge width TPLW and/or BPLW will be less than a ledge width of the forward crown-opening recessed ledge 168A (front-back as measured along the y-axis).

The forward portion 112 includes a sidewall 146 that defines a depth of the plate-opening recessed ledge 147 and defines a radially outer periphery of the plate-opening recessed ledge 147 away from a center of the plate opening 149. The sidewall 146 is angled (e.g., acute, obtuse, or perpendicular) relative to the plate-opening recessed ledge 147. In some examples, the angle defined between the sidewall 146 and the plate-opening recessed ledge 147 is between 70° and 120°. In certain examples, the angle defined between the sidewall 146 and the plate-opening recessed ledge 147 is greater than 90°. The body 102 further includes a transition portion between the plate-opening recessed ledge 147 and the sidewall 146. In some examples, the transition portion defines a radiused surface, which couples together the surfaces of the plate-opening recessed ledge 147 and the sidewall 146.

Referring to FIGS. 9A, 9B, and 31, bonding tape 174 adhesively bonds the strike plate 143 to the body 102. In some examples, the bonding tape 174 is interposed between the plate-opening recessed ledge 147 and the strike plate 143 and interposed between the sidewall 146 and the strike plate 143. For example, a strike-plate ledge strip 176A of the bonding tape 174 is between the plate-opening recessed ledge 147 and the strike plate 143, and a strike-plate sidewall strip 176B of the bonding tape 174 is interposed between the sidewall 146 and the strike plate 143. However, in other examples, the strike-plate ledge strip 176A of the bonding tape 174 is interposed between the plate-opening recessed ledge 147 and the strike plate 143, but the strike-plate sidewall strip 176B of the bonding tape 174 is not interposed between the sidewall 146 and the strike plate 143. Referring to FIG. 31, a thickness (LT) of the strike-plate ledge strip 176A between the plate-opening recessed ledge 147 and the strike plate 143 is greater than a thickness (ST) of the strike-plate sidewall strip 176B between the sidewall 146 and the strike plate 143, in some examples. According to one particular example, the thickness (LT) of the strike-plate ledge strip 176A between the plate-opening recessed ledge 147 and the strike plate 143 is between 0.25 mm and 0.45 mm, and the thickness (ST) of the strike-plate sidewall strip 176B between the sidewall 146 and the strike plate 143 is between 0.15 mm and 0.25 mm. The thickness of the bonding tape 174 of a fully formed golf club head 100 (e.g., after the bonding tape 174 has been compressed and cured (i.e., thermally activated)) can be different than the thickness of the bonding tape 174 prior to fully forming the golf club head 100 (e.g., prior to the bonding tape 174 being compressed and cured). The above-presented values for the thickness of the bonding tape 174 is prior to compressing and curing the bonding tape 174.

In some examples, the strike plate may have a maximum face plate height of no more than 55 mm as measured along the z-axis through the club head origin, preferably no more than 55 mm and no less than 40 mm, even more preferably between 49 mm and 54 mm. In some instance, the strike plate formed of fiber-reinforced polymeric material may have a front surface area of no more than 4,180 $mm^2$, and preferably between 3,200 $mm^2$ and 4,180 $mm^2$, more preferably between 3,500 $mm^2$ and 4,180 $mm^2$. According to certain examples, the strike face 145 has a first bulge radius of at least 300 mm and a first roll radius of at least 250 mm. Generally, a bulge radius greater than 300 mm has a better CT creep rate and club heads with a bulge no less 300 mm bulge radius and a roll radius within 30-50 mm of the bulge radius performed well.

Figure 10:
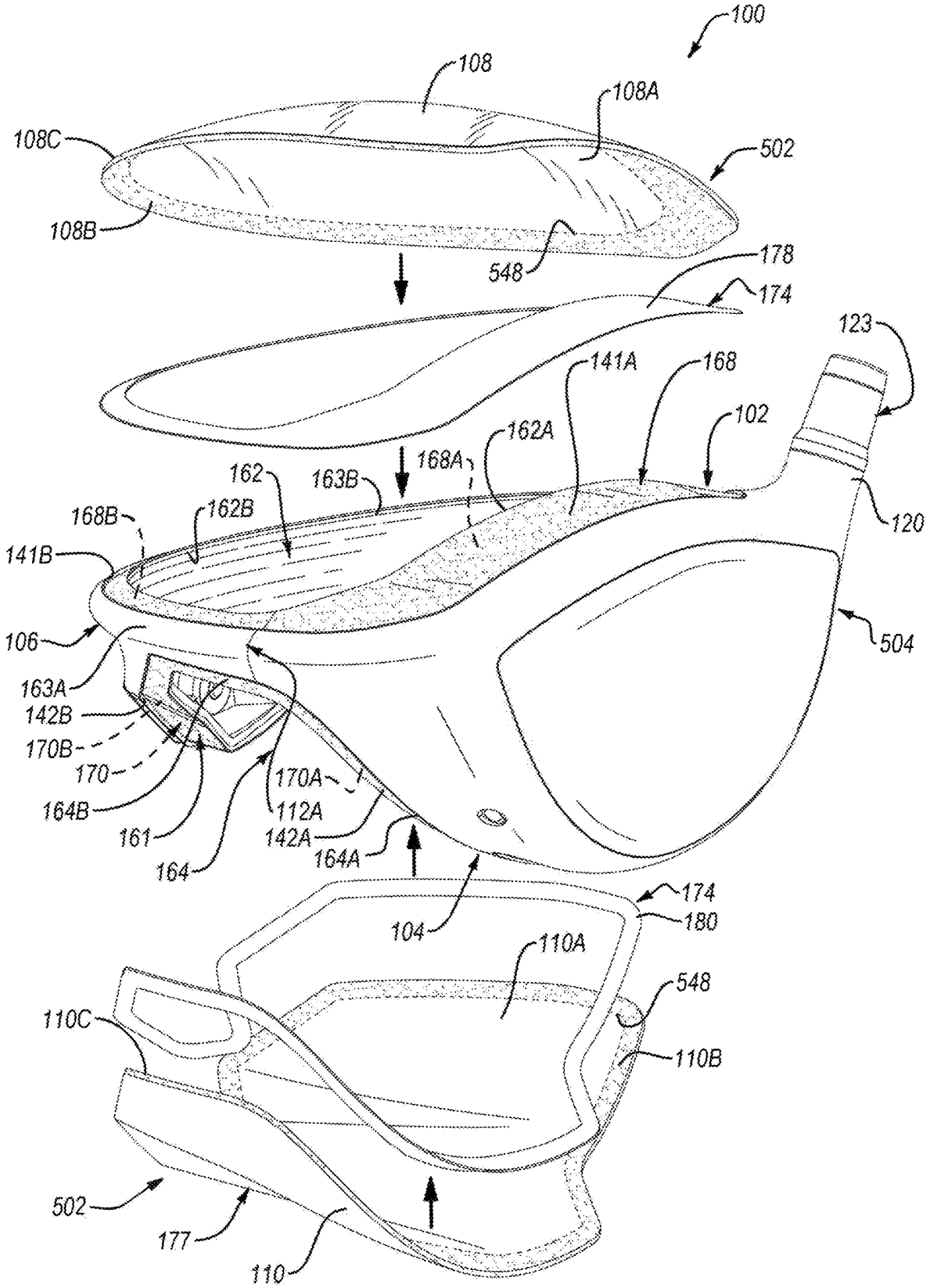
FIG. 10 is a schematic, exploded, perspective view of the golf club head of FIG. 1, according to one or more examples of the present disclosure.
Figure 11:
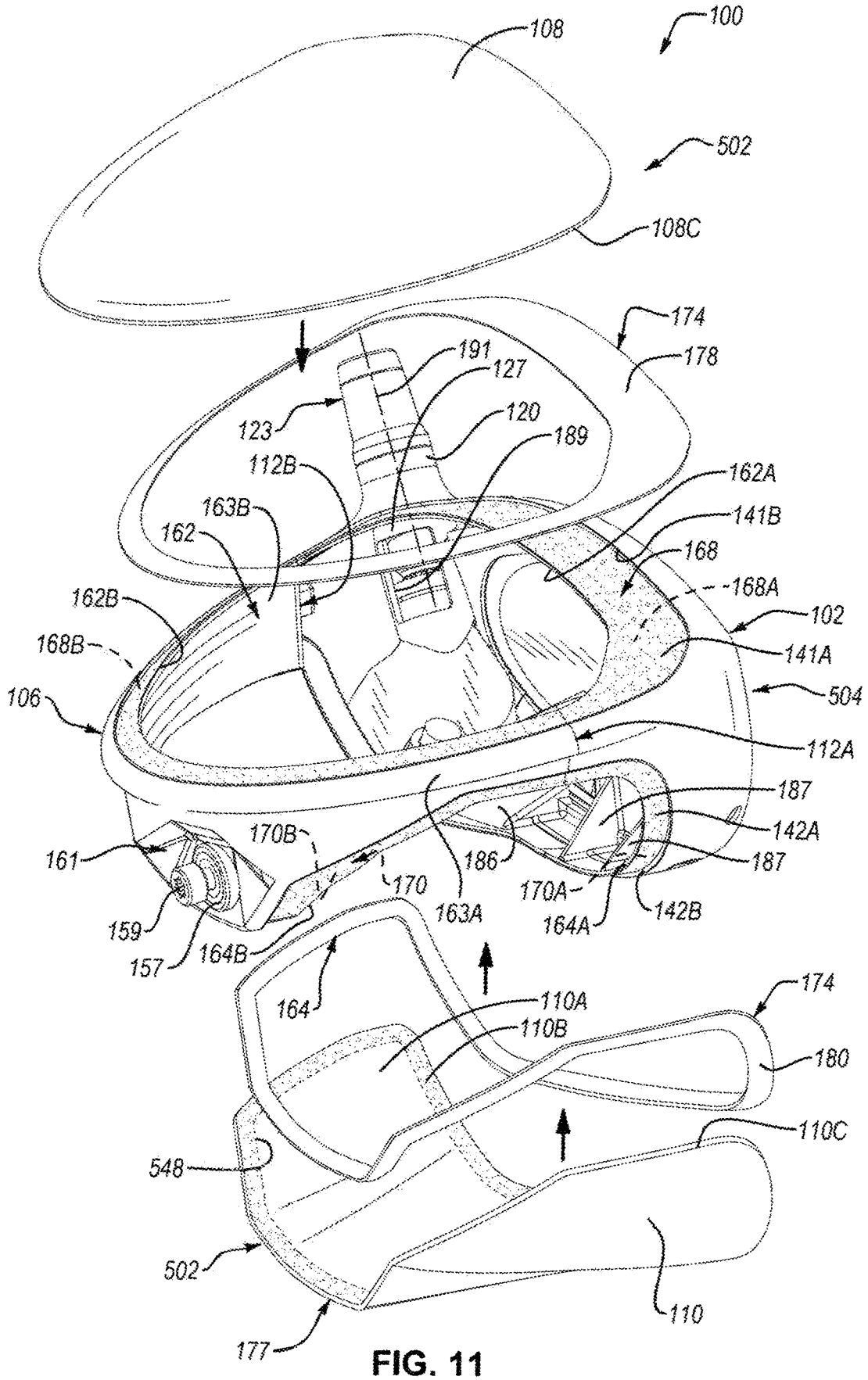
FIG. 11 is another schematic, exploded, perspective view of the golf club head of FIG. 1, according to one or more examples of the present disclosure.
Figure 12:
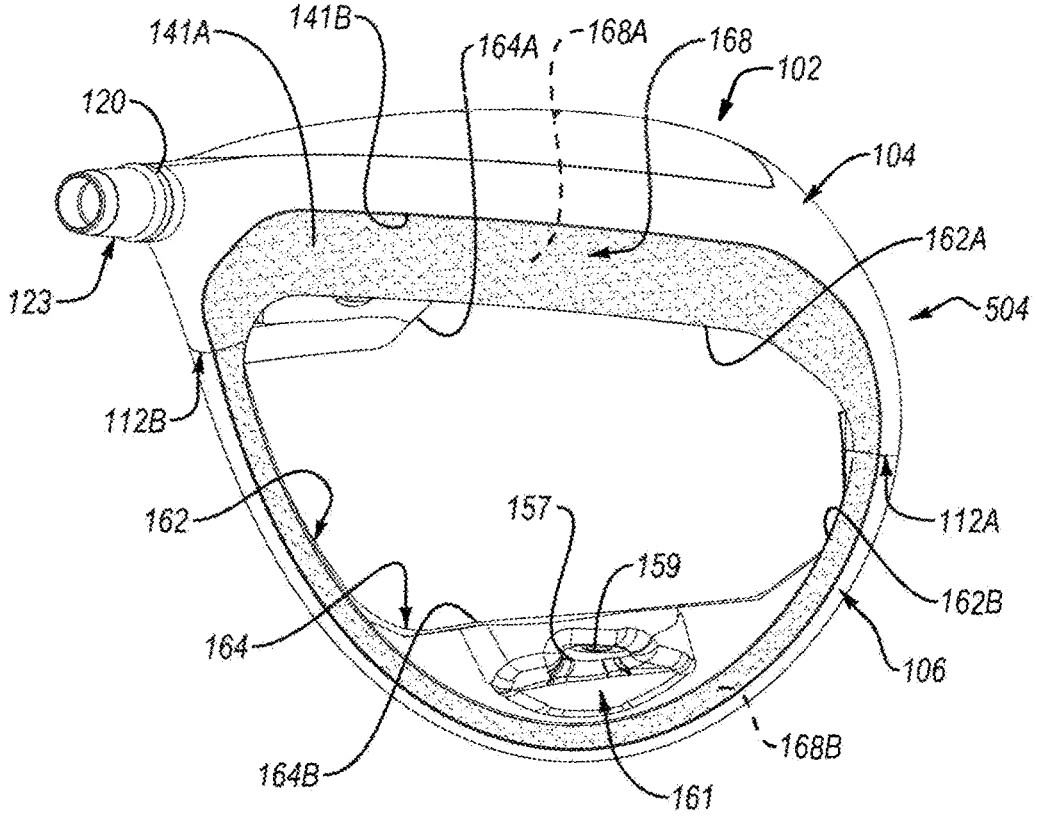
FIG. 12 is a schematic, top plan view of a body of the golf club head of FIG. 1, according to one or more examples of the present disclosure.
Figure 13:
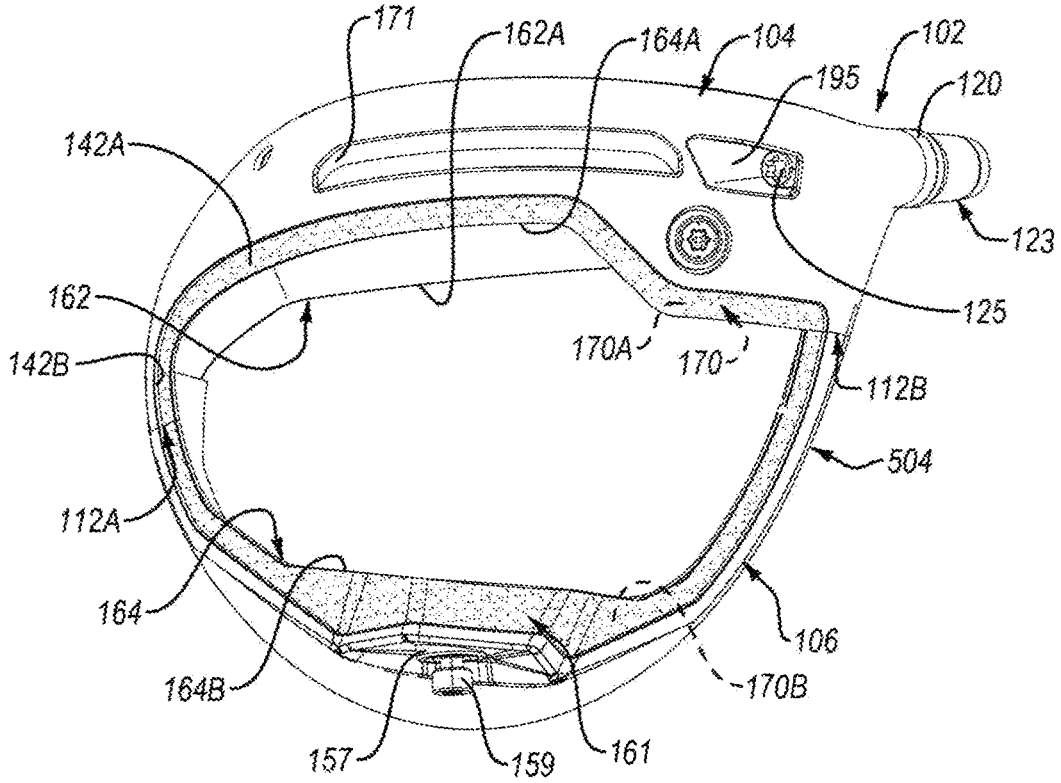
FIG. 13 is a schematic, bottom plan view of the body of the golf club head of FIG. 1, according to one or more examples of the present disclosure.

The golf club head **1*r*00 includes a body 102, a crown insert 108 (or crown panel) attached to the body 102 at a top of the golf club head 100, and a sole insert 110 (or sole panel) attached to the body 102 at a bottom of the golf club head 100 (see, e.g. FIGS. 10 and 11). Accordingly, the body 102 effectually provides a frame to which one or more inserts, panels, or plates are attached. The body 102 includes a cast cup 104 and a ring 106 (e.g., a rear ring). The ring 106 is joined to the cast cup 104 at a toe-side joint 112A and a heel-side joint 112B. The cast cup 104 defines at least part of the forward portion 112 of the golf club head 100. The ring 106 defines at least part of the rearward portion 118 of the golf club head 100. Additionally, the cast cup 104 defines part of the crown portion 119, the sole portion 117, the heel portion 116, the toe portion 114, and the skirt portion 121. Similarly, the ring 106 defines part of the heel portion 116, the toe portion 114, and the skirt portion 121**.

Figure 14:
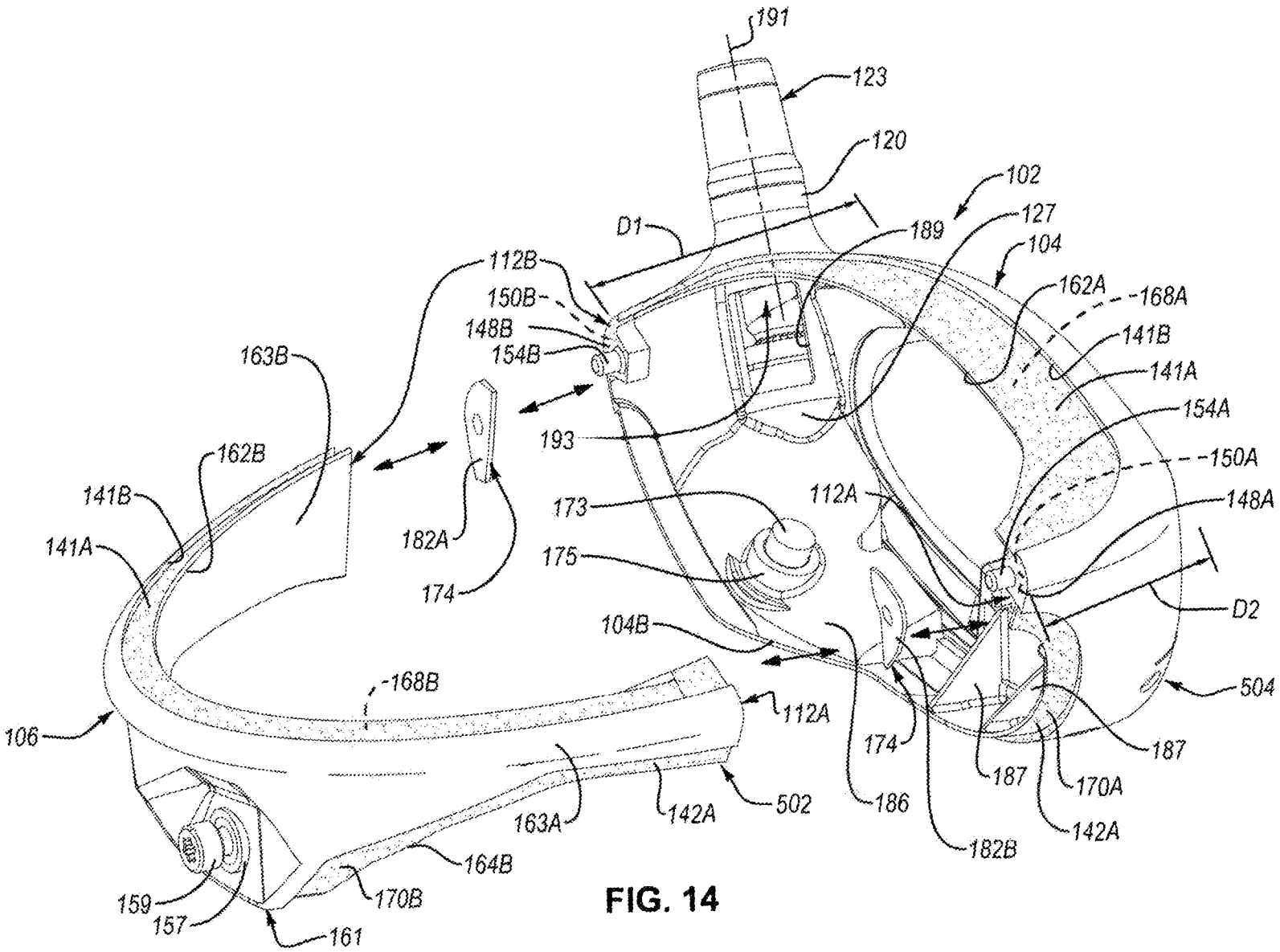
FIG. 14 is a schematic, exploded, perspective view of the body of the golf club head of FIG. 1, according to one or more examples of the present disclosure.

The cast cup 104 (or just cup) is cup-shaped. More specifically, as shown in FIG. 14, the cast cup 104, including the strike face 145, is enclosed on one end by the strike face 145, enclosed on four sides (e.g., by the crown portion 119, the sole portion 117, the toe portion 114, and the heel portion 116), which extend substantially transversely from the strike face 145, and open on an end opposite the strike face 145. Accordingly, the cast cup 104, when coupled with the strike face 145, resembles a cup or a cup-like unit.

The ring 106 is not circumferentially closed or does not form a continuous annular or circular shape. Instead, the ring 106 is circumferentially open and defines a substantially semi-circular shape. Thus, as defined herein, the ring 106 is termed a ring because it has a ring-like, semi-circular shape, and, when joined to the cast cup 104, forms a circumferentially closed or annular shape with the cast cup 104.

The cast cup 104 is formed separately from the ring 106 and the ring 106 is subsequently joined to the cast cup 104. Accordingly, the body 102 has at least a two-piece construction where the cast cup 104 defines one piece of the body 102 and the ring 106 define another piece of the body 102. Accordingly, a seam is defined at each of the toe-side joint 112A and the heel-side joint 112B where the cast cup 104 and the ring 106 are adjoined. The cast cup 104 and the ring 106 are separately formed using any of various manufacturing techniques. In one example, the cast cup 104 and the ring 106 are formed using a casting process. Because the cast cup 104 and the ring 106 are formed separately, the cast cup 104 and the ring 106 can be made of different materials. For example, the cast cup 104 can be made of a first material and the ring 106 can be made of a second material where the second material is different than the first material.

Figure 15:
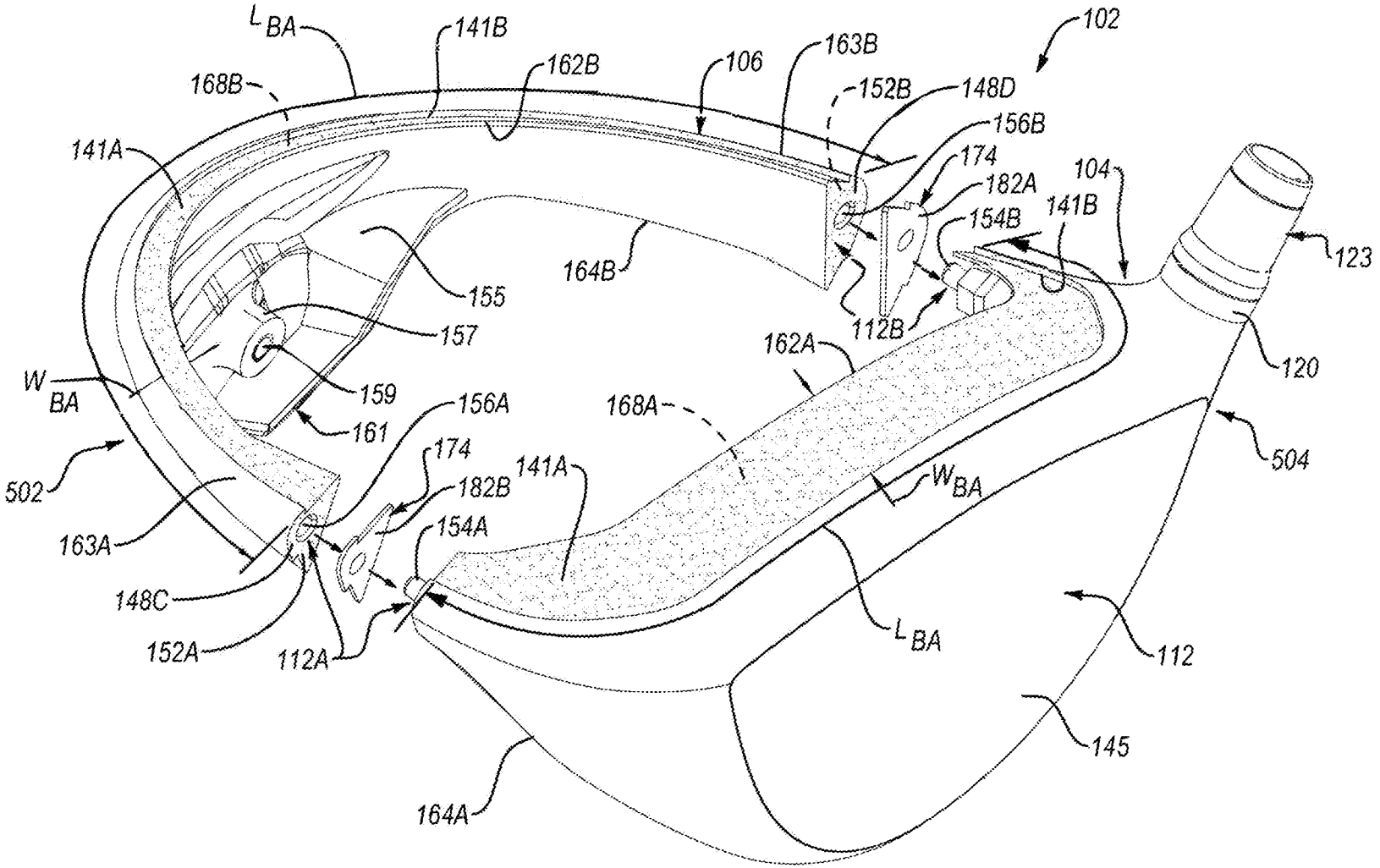
FIG. 15 is another schematic, exploded, perspective view of the body of the golf club head of FIG. 1, according to one or more examples of the present disclosure.

Referring to FIGS. 14 and 15, the cast cup 104 includes a toe ring-engagement surface 150A and a heel ring-engagement surface 150B. Similarly, the ring 106 includes a toe cup-engagement surface 152A and a heel cup-engagement surface 152B. The toe-side joint 112A is formed by abutting and securing together the toe ring-engagement surface 150A of the cast cup 104 and the toe cup-engagement surface 152A of the ring 106 and abutting and securing together the heel ring-engagement surface 150B of the cast cup 104 and the heel cup-engagement surface 152B of the ring 106. The engagement surfaces are secured together via any suitable securing techniques, such as welding, brazing, adhesives, mechanical fasteners, and the like. In the illustrated example, as shown in FIGS. 9A, 14, and 15, the engagement surfaces are bonded together via the bonding tape 174.

To help strengthen and stiffen the toe-side joint 112A and the heel-side joint 112B, complementary mating elements can be incorporated into or coupled to the engagement surfaces. In the illustrated example, the cast cup 104 includes a toe projection 154A protruding from the toe ring-engagement surface 150A and a heel projection 154B protruding from the heel ring-engagement surface 150B. In contrast, in the illustrated example, the ring 106 includes a toe receptacle 156A formed in the toe cup-engagement surface 152A and a heel receptacle 156B formed in the heel cup-engagement surface 152B. The toe projection 154A mates with (e.g., is received within) the toe receptacle 156A and the heel projection 154B mates with (e.g., is received within) the heel receptacle 156B as the engagement surfaces abut each other to form the joints. Although in the illustrated example, the toe projection 154A and the heel projection 154B form part of the cast cup 104 and the toe receptacle and the heel receptacle 156B form part of the ring 106, in other examples, the mating elements can be reversed such that the toe projection 154A and the heel projection 154B form part of the ring 106 and the toe receptacle and the heel receptacle 156B form part of the cast cup 104. Additionally, different types of complementary mating elements, such as tabs and notches, can be used in addition to or in place of the projections and receptacles.

In some examples, the toe-side joint 112A and the heel-side joint 112B are located a sufficient distance from the strike face 145 to avoid potential failures due to severe impacts undergone by the golf club head 100 when striking a golf ball. For example, each one of the toe-side joint 112A and the heel-side joint 112B can be spaced at least 20 mm, at least 30 mm, at least 40 mm, at least 50 mm, at least 60 mm, and/or from 20 mm to 70 mm rearward of the center face 183 of the strike face 145, as measured along a y-axis (front-to-back direction) of the club head origin coordinate system 185. Referring to FIG. 14, according to certain examples, a first distance D1, from the strike face 145 to the heel ring-engagement surface 150B, is less than a second distance D2, from the strike face 145 to the toe ring-engagement surface 150A. In other words, in some examples, the cast cup 104 extends rearwardly from the strike face 145 a shorter distance at the heel portion 116 than at the toe portion 114.

Referring to FIGS. 10-13, the body 102 comprises a crown opening 162 and a sole opening 164. The crown opening 162 is located at the crown portion 119 of the golf club head 100 and when open provides access into the interior cavity 113 of the golf club head 100 from a top of the golf club head 100. In contrast, the sole opening 164 is located at the sole portion 117 of the golf club head 100 and when open provides access into the interior cavity 113 of the golf club head 100 from a bottom of the golf club head 100. Corresponding sections of the crown opening 162 and the sole opening 164 are defined by the cast cup 104 and the ring 106. More specifically, referring to FIGS. 10-15, a forward section 162A of the crown opening 162 and a forward section 164A of the sole opening 164 are defined by the cast cup 104, and a rearward section 162B of the crown opening 162 and a rearward section 164B of the sole opening 164 are defined by the ring 106. Accordingly, when the cast cup 104 and the ring 106 are joined together, the forward section 162A and the rearward section 162B collectively define the crown opening 162, and the forward section 164A and the rearward section 164B collectively define the sole opening 164.

The cast cup 104 additionally includes a forward crown-opening recessed ledge 168A and a forward sole-opening recessed ledge 170A. The ring 106 includes a rearward crown-opening recessed ledge 168B and a rearward sole-opening recessed ledge 170B. The forward sole-opening recessed ledge 170A and the rearward sole-opening recessed ledge 170B form a sole-opening recessed ledge 170 of the golf club head 100. Moreover, in some examples, the sole-opening recessed ledge 170 is non-planar or curved. The ledges are offset inwardly, toward the interior cavity 113, from the exterior surfaces of the body 102 surrounding the ledges by distances corresponding with the thicknesses of the crown insert 108 and the sole insert 110. In some examples, the offset of the ledges from the exterior surfaces of the body 102 is approximately equal to the corresponding thicknesses of the crown insert 108 and the sole insert 110, such that the inserts are flush with the corresponding surrounding exterior surfaces of the body 102 when attached to the ledges. However, in some examples, the crown insert 108 and the sole insert 110 need not be flush with (e.g., can be raised or recessed relative to) the surrounding exterior surface of the body 102 when seatably engaged with the corresponding ledges. In some examples, a thickness of the sole insert 110 is greater than a thickness of the crown insert 108. Moreover, the sole insert 110 is made up of a first quantity of stacked plies, each made of a fiber-reinforced polymeric material, and the crown insert 108 is made up of a second quantity of stacked plies, each made of a fiber-reinforced polymeric material. In some examples, the first quantity of stacked plies is greater than the second quantity of stacked plies.

When the cast cup 104 and the ring 106 are joined, the forward crown-opening recessed ledge 168A and the rearward crown-opening recessed ledge 168B collectively define a crown-opening recessed ledge 168 of the body 102, and the forward sole-opening recessed ledge 170A and the rearward sole-opening recessed ledge 170B collectively define a sole-opening recessed ledge 170 of the body 102. The inner periphery of the forward crown-opening recessed ledge 168A defines the forward section 162A of the crown opening 162 and the inner periphery of the rearward crown-opening recessed ledge 168B defines the rearward section 162B of the crown opening 162. Likewise, the inner periphery of the forward sole-opening recessed ledge 170A defines the periphery of the forward section 164A of the sole opening 164 and the inner periphery of the rearward sole-opening recessed ledge 170B defines the periphery of the rearward section 164B of the sole opening 164. Accordingly, the inner periphery of the crown-opening recessed ledge 168 defines the periphery of the crown opening 162 and the inner periphery of the sole-opening recessed ledge 170 defines the periphery of the sole opening 164.

Referring to FIG. 31, a thickness of the body 102 at the crown portion 119 decreases in a rearward-to-forward direction from a forward extent 132 of the crown-opening recessed ledge 168, and decreases in a forward-to-rearward direction from the forward extent 132 of the crown-opening recessed ledge 168. This results in a localized increase in thickness at the forward extent 132, which helps to strengthen and stiffen the joint between the body 102 and the crown insert 108.

The crown insert 108 and the sole insert 110 are formed separately from each other and separately from the body 102. Accordingly, the crown insert 108 and the sole insert 110 are attached to the body 102 as shown in FIGS. 10 and 11. In the illustrated examples, the crown insert 108 is seated on and bonded to, such as with the bonding tape 174, the crown-opening recessed ledge 168. For example, a crown-insert strip 178 of the bonding tape 174 is between the crown-opening recessed ledge 168 and the crown insert 108. Furthermore, in the illustrated examples, the sole insert 110 is seated on and bonded to, such as with the bonding tape 174, the sole-opening recessed ledge 170. For example, a sole-insert strip 180 of the bonding tape 174 is between the sole-opening recessed ledge 170 and the sole insert 110. In this manner, the crown insert 108 encloses or covers the crown opening 162 and defines, at least in part, the crown portion 119 of the golf club head 100, and the sole insert 110 encloses or covers the sole opening 164 and defines, at least in part, the sole portion 117 of the golf club head 100.

Figure 4:
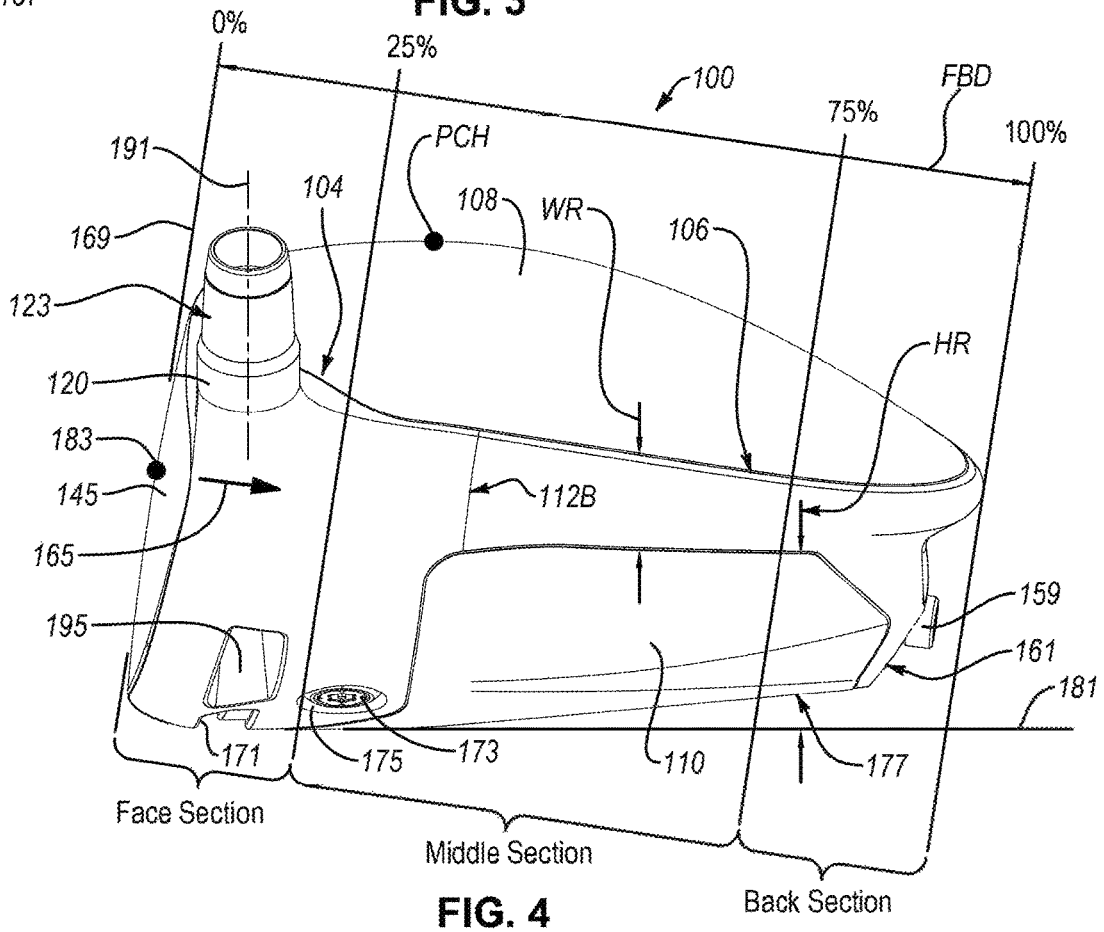
FIG. 4 is another schematic, side elevation view of the golf club head of FIG. 1, according to one or more examples of the present disclosure.

The crown insert 108 and the sole insert 110 can have any of various shapes. Referring to FIG. 4, in one example, the crown insert 108 is shaped such that a location (PCH), corresponding with the peak crown height of the golf club head 100, is rearward of a hosel 120 of the golf club head 100 and rearward of the hosel axis 191 of the hosel 120 of the golf club head 100. The peak crown height is the maximum crown height of a golf club head where the crown height at a given location along the golf club head is the distance from the ground plane 181, when the golf club head is in the address position on the ground plane, to an uppermost point on the crown portion at the given location. In some examples, the crown height of the golf club head 100 increases and then decreases in a front-to-rear direction away from the strike face 145. In certain examples, the portion or exterior surface of the crown portion that defines the peak crown height is made of the at least one first material. According to some examples, a first crown height is defined at a face-to-crown transition region in the forward crown area where the club face connects to the crown portion of the club head, a second crown height is defined at a crown-to-skirt transition region where the crown portion connects to a skirt of the golf club head near a rear end of the golf club head, and a maximum crown height is defined rearward of the first crown height and forward of the second crown height, where the maximum crown height is greater than both the first and second crown heights. In some examples, the maximum crown height occurs toeward of a geometric center of the strike face. According to certain examples, the maximum crown height is formed by a non-metal composite crown insert.

Figure 3:
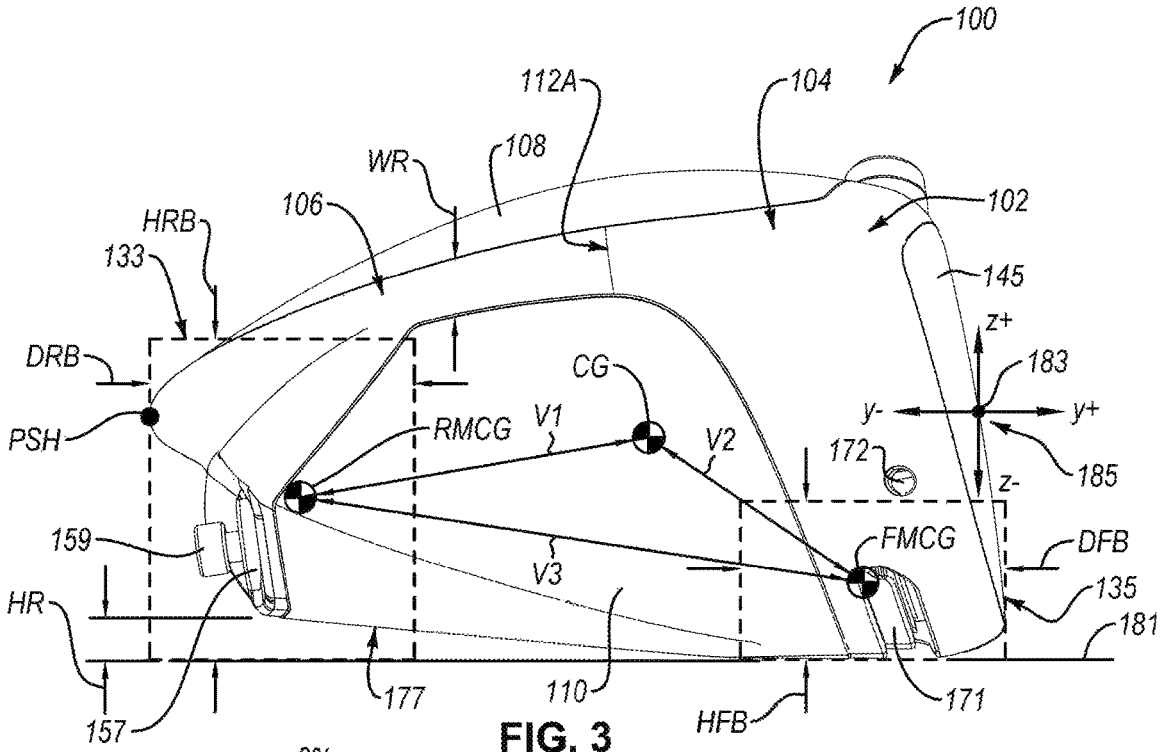
FIG. 3 is a schematic, side elevation view of the golf club head of FIG. 1, according to one or more examples of the present disclosure.

Referring to FIG. 3, a peak skirt height (shown associated with a location (PSH)) is the maximum skirt height of a golf club head, where the skirt height at a given location along the golf club head is the distance from the ground plane, when the golf club head is in the address position on the ground plane, to an uppermost point on the skirt portion at the rearwardmost point of the skirt portion on the golf club head.

According to some examples, a ratio of a peak crown height of the crown portion 119 to a peak skirt height of the skirt portion 121 ranges between about 0.45 to 0.59, preferably 0.49-0.55, and in one example the skirt height is about 34 mm and the peak crown height is about 65 mm, which results in a ratio of peak skirt height to peak crown height of about 0.52. A peak skirt height typically ranges between 28 mm and 38 mm, preferably between 31 mm and 36 mm. A peak crown height typically ranges between 60 mm and 70 mm, preferably between 62 mm and 67 mm. It is desirable to limit a difference between the peak crown height and the peak skirt height to no more than 40 mm, preferably between 27 mm and 35 mm. It is desirable for the peak skirt height to be the same as or greater than a Z-up value for the golf club head i.e. the vertical distance along a z-axis from the ground plane 181 to the center of gravity. It is desirable for the peak crown height to be two times (2×) larger than a Z-up value for the golf club head. A greater peak skirt height may help with better aerodynamics and better air flow attachment especially for faster swing speeds. Likewise, if the difference between the peak crown height and peak skirt height is too great there will be a greater likelihood of the flow separating early from the golf club head i.e. increased likelihood of turbulent flow.

The construction and material diversity of the golf club head 100 enables the golf club head 100 to have a desirable center-of-gravity (CG) location and peak crown height location. In one example, a y-axis coordinate, on the y-axis of the club head origin coordinate system 185, of the location (PCH) of the peak crown height is between about 26 mm and about 42 mm. In the same or a different example, a distance parallel to the z-axis of the club head origin coordinate system 185, from the ground plane 181, when the golf club head 100 is in the address position, of the location (PCH) of the peak crown height ranges between 60 mm and 70 mm, preferably between 62 mm and 67 mm as described above. According to some examples, a y-axis coordinate, on the y-axis of the head origin coordinate system 185, of the center-of-gravity (CG) of the golf club head 100 ranges between 25 mm and 50 mm, preferably between 32 mm and 38 mm, more preferably between 36.5 mm and 42 mm, an x-axis coordinate, on the x-axis of the head origin coordinate system 185, of the center-of-gravity (CG) of the golf club head 100 ranges between −10 mm and 10 mm, preferably between −6 mm and 6 mm, and more preferably between −7 mm and 7 mm, and a z-axis coordinate, on the z-axis of the head origin coordinate system 185, of the center-of-gravity (CG) of the golf club head 100 is less than 2 mm, such as ranges between −10 mm and 2 mm, preferably between −7 mm and −2 mm.

Figure 5:
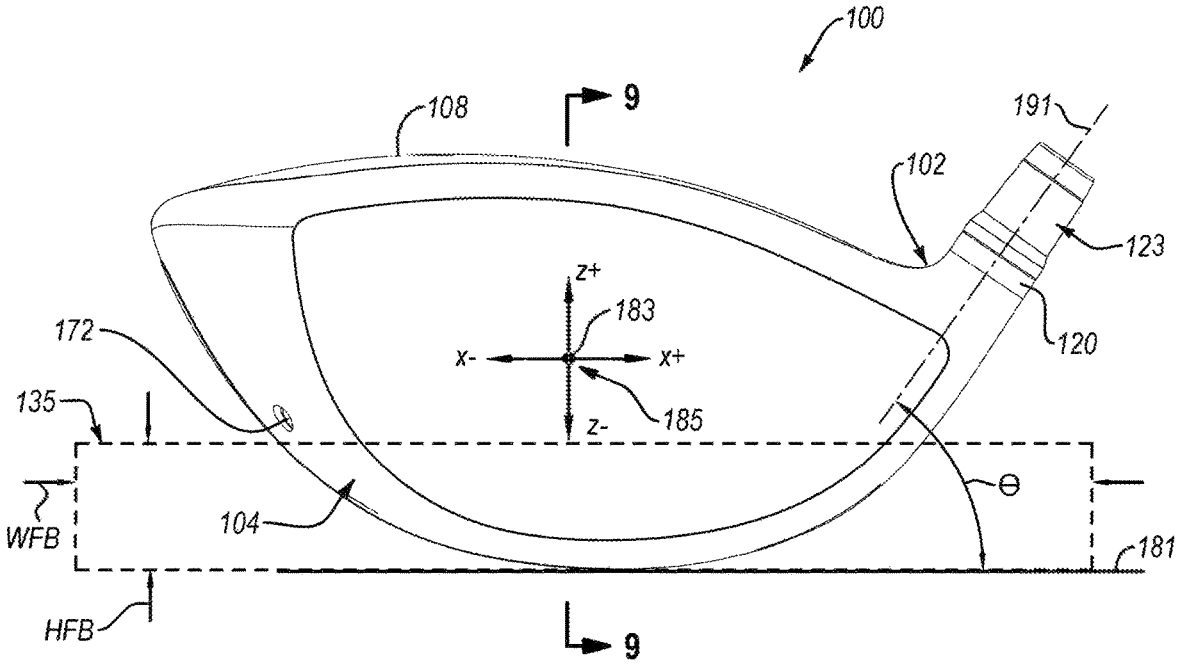
FIG. 5 is a schematic, front view of the golf club head of FIG. 1, according to one or more examples of the present disclosure.
Figure 6:
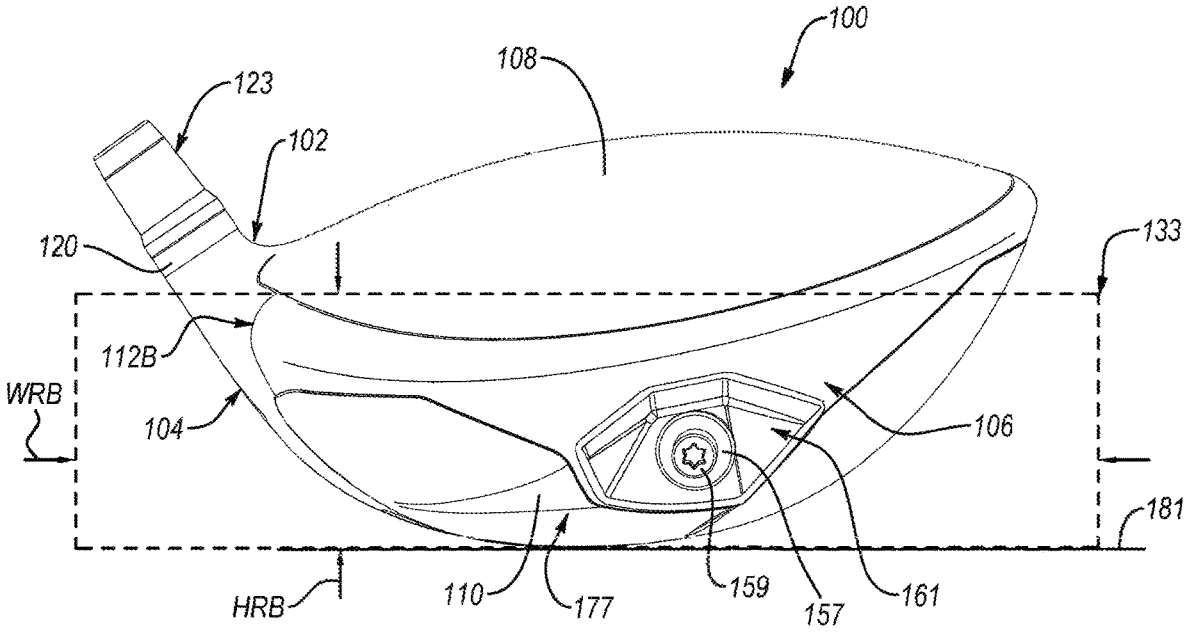
FIG. 6 is a schematic, rear view of the golf club head of FIG. 1, according to one or more examples of the present disclosure.

Additionally, the construction and material diversity of the golf club head 100 enables the golf club head 100 to have desirable mass distribution properties. Referring to FIGS. 3, 5, and 6, the golf club head 100 includes a rearward mass and a forward mass. The rearward mass of the golf club head 100 is defined as the mass of the golf club head 100 within an imaginary rearward box 133 having a height (HRB), parallel to a crown-to-sole direction (parallel to z-axis of golf club head origin coordinate system 185), of 35 mm, a depth (DRB), in a front-to-rear direction (parallel to y-axis of golf club head origin coordinate system 185), of 35 mm, and a width (WRB), in a toe-to-heel direction (parallel to x-axis of golf club head origin coordinate system 185), greater than a maximum width of the golf club head 100. As shown, a rear side of the imaginary rearward box 133 is coextensive with a rearmost end of the golf club head 100 and a bottom side of the imaginary rearward box 133 is coextensive with the ground plane 181 when the golf club head 100 is in the address position on the ground plane 181. The forward mass of the golf club head 100 is defined as the mass of the golf club head 100 within an imaginary forward box 135 having a height (HFB), parallel to the crown-to-sole direction, of 20 mm, a depth (DFB), in the front-to-rear direction, of 35 mm, and a width (WFB), in the toe-to-heel direction, greater than a maximum width of the golf club head 100. As shown, a forward side of the imaginary forward box 135 is coextensive with a forwardmost end of the golf club head 100 and a bottom side of the imaginary forward box 135 is coextensive with the ground plane 181 when the golf club head 100 is in the address position on the ground plane 181.

According to some examples, a first vector distance (V1) from a center-of-gravity of the rearward mass (RMCG) to a CG of the driver-type golf club head is between 49 mm and 64 mm (e.g., 55.7 mm), a second vector distance (V2) from a center-of-gravity of the forward mass (FMCG) to the CG of the driver-type golf club head is between 22 mm and 34 mm (e.g., 29.0 mm), and a third vector distance (V3) from the CG of the rearward mass (RMCG) to the CG of the forward mass (FMCG) is between 75 mm and 82 mm (e.g., 79.75 mm). In certain examples, V1 is no more than 56.3 mm. In some examples, V2 is no less than 23.7 mm, preferably no less than 25 mm, or even more preferably no less than 27 mm. Some additional values of V1 and V2 relative to Zup and CGy values for various examples of the golf club head 100 are provided in Table 1 below. As defined herein, Zup measures the center-of-gravity of the golf club head 100 relative to the ground plane 181 along a vertical axis (e.g., parallel to the z-axis of the club head origin coordinate system 185) when the golf club head 100 is in the proper address position on the ground plane 181. CGy is the coordinate of the center-of-gravity of the golf club head 100 on the y-axis of the club head origin coordinate system 185.

TABLE 1

| Example | Zup | CGy | V1 | V2 |
|---|---|---|---|---|
| 1 | 26 mm | 37 mm | 55.7 mm | 29.0 mm |
| 2 | 30 mm | 37 mm | 56.3 mm | 31.8 mm |
| 3 | 22 mm | 37 mm | 55.2 mm | 27.3 mm |
| 4 | 25 mm | 32 mm | 61.0 mm | 23.7 mm |
| 5 | 25 mm | 40 mm | 52.7 mm | 30.76 mm |

The crown insert 108 has a crown-insert outer surface that defines an outward-facing surface or exterior surface of the crown portion 119. Similarly, the sole insert 110 has a sole-insert outer surface that defines an outward-facing surface or exterior surface of the sole portion 117. As defined herein, the crown-insert outer surface and the sole-inert outer surface includes the combined outer surfaces of multiple crown inserts and multiple sole inserts, respectively, if multiple crown inserts or multiple sole inserts are used. In one example, a total surface area of the sole-insert outer surface is smaller than a total surface area of the crown-insert outer surface. According to one example, the total surface area of the crown-insert outer surface is at least 9,482 $mm^2$. In one example, the total surface area of the sole-insert outer surface is at least 8,750 $mm^2$ and the sole insert has a maximum width, parallel to a heel-to-toe direction, of at least between 80 mm and 120 mm. The total surface area of the crown-insert outer surface can range between 5,300 mm^2 to 11,000 mm^2, preferably between 9,200 mm^2 and 10,300 mm^2, preferably between 5,300 mm^2 and 7,000 mm^2. The total surface area of the sole-insert outer surface can range between 4,300 mm^2 to 10,200 mm^2, preferably between 7,700 mm^2 and 9,900 mm^2, preferably between 4,300 mm^2 and 6,600 mm^2.

Preferably the total surface area of the sole-insert outer surface is greater than the total surface area of the sole-insert outer surface in the instance when at least a portion of the sole is formed of a composite material. A ratio of total surface area of the crown-insert outer surface formed of composite material to the total surface area of the sole-insert outer surface formed of composite material may be at least 2:1 in some examples, in other instance the ratio may be between 0.95 and 1.5, more preferably between 1.03 and 1.4, even more preferably between 1.05 and 1.3. In this instance a composite material will generally have a density between about 1 g/cc and about 2 g/cc, and preferably between about 1.3 g/cc and about 1.7 g/cc.

In some embodiments, the total exposed composite surface area in square centimeters multiplied by the CGy in centimeters and the resultant divided by the volume in cubic centimeters may range from 1.22 to 2.1, preferably between 1.24 and 1.65, even more preferably between 1.49 and 2.1, and even more preferably 1.7 and 2.1.

Moreover, the total mass of the crown insert 108 is less than a total mass of the sole insert 110 in some examples. According to some examples, where the crown insert 108 and the sole insert 110 are made of a fiber-reinforced polymeric material and the body 102 is made of a metallic material, a ratio of a total exposed surface area of the body 102 to a total exposed surface area (e.g., the surface area of the outward-facing surfaces) of the crown insert 108 and the sole insert 110 is between 0.95 and 1.25 (e.g., 1.08). The crown insert 108, whether a single piece or split into multiple pieces, has a mass of 9 grams and the sole insert 110, whether a single piece or split into multiple pieces, has a mass of 13 grams, in some examples. Moreover, in certain examples, the crown insert 108 is about 0.65 mm thick and the sole insert 110 is about 1.0 mm thick. However, in certain examples, the minimum thickness of the crown portion 119 is less than 0.6 mm. According to some examples, an areal weight of the crown portion 119 of the golf club head 100 is less than 0.35 g/cm$^2$ over more than 50% of an entire surface area of the crown portion 119 and/or at least part of the crown portion 119 is formed of a non-metal material with a density between about 1 g/cm$^3$ to about 2 g/cm$^3$. These and other properties of the crown insert 108 and the sole insert 110 can be found in U.S. Patent Application Publication No. 2020/0121994, published Apr. 23, 2020, which is incorporated herein by reference in its entirety. In certain examples, an areal weight of the sole portion 117 is less than about 0.35 g/cm$^2$ over more than about 50% of an entire surface area of the sole portion 117. In certain examples, an areal weight of the crown insert 108 is less than an areal weight of the sole insert 110. At least 50% of the crown portion 119 has a variable thickness that changes at least 25% along at least 50% of the crown portion 119, in certain examples.

The cast cup 104 of the body 102 also includes the hosel 120, which defines the hosel axis 191 extending coaxially through a bore 193 of the hosel 120 (see, e.g., FIG. 14). The hosel 120 is configured to be attached to a shaft of a golf club. In some examples, the hosel 120 facilitates the inclusion of a flight control technology (FCT) system 123 between the hosel 120 and the shaft to control the positioning of the golf club head 100 relative to the shaft.

The FCT system 123 may include a fastener 125 that is accessible through a lower opening 195 formed in a sole region of the cast cup 104. An additional example of the FCT system 123 is shown in association with the golf club head 400 of FIGS. 19 and 20, which has a hosel 420 and a lower opening 495 to facilitate attachment of the FCT system 123 to the body 102. The FCT system 123 includes multiple movable parts that fit within the and extend from the hosel 120. The fastener 125 facilitates adjustability of the FCT system 123 system by loosening the fastener 125 and maintaining an adjustable position of the golf club head relative to the shaft by tightening the fastener 125. The lower opening 195 is open to the bore 193 of the hosel 120. To promote an increase in discretionary mass, an internal portion 127 of the hosel 120 (i.e., a portion of the hosel 120 that is within the interior cavity 113) includes a lateral opening 189 that is open to the interior cavity 113. Because of the lateral opening 189, the internal portion 127 of the hosel 120 only partially surrounds FCT components extending through the bore 193 of the hosel 120. In some examples a height of the lateral opening 189, in a direction parallel to the hosel axis 191, is between 10 mm and 15 mm, a width of the lateral opening 189, in a direction perpendicular to the hosel axis 191, is at least 1 radian, and/or a projected area of the lateral opening 189 is at least 75 mm$^2$.

Referring to FIG. 15, in some examples, the cast cup 104 includes the strike face 145. In other words, in some examples, the strike face 145 is co-formed (e.g., co-cast) with all other portions of the cast cup 104. Accordingly, in these examples, the strike face 145 is made of the same material as the rest of the cast cup 104. However, in other examples, similar to those associated with the golf club heads of FIGS. 9A, 9B, 17 and 18, the strike face 145 is defined by a strike plate that is formed separate from the cast cup 104 and separately attached to the cast cup 104. According to certain examples, the portion of the golf club head 100 defining the strike face 145 or the strike plate defining the strike face 145 includes variable thickness features similar to those described in more detail in U.S. patent application Ser. No. 12/006,060; and U.S. Pat. Nos. 6,997,820; 6,800,038; and 6,824,475, which are incorporated herein by reference in their entirety.

Figure 21:
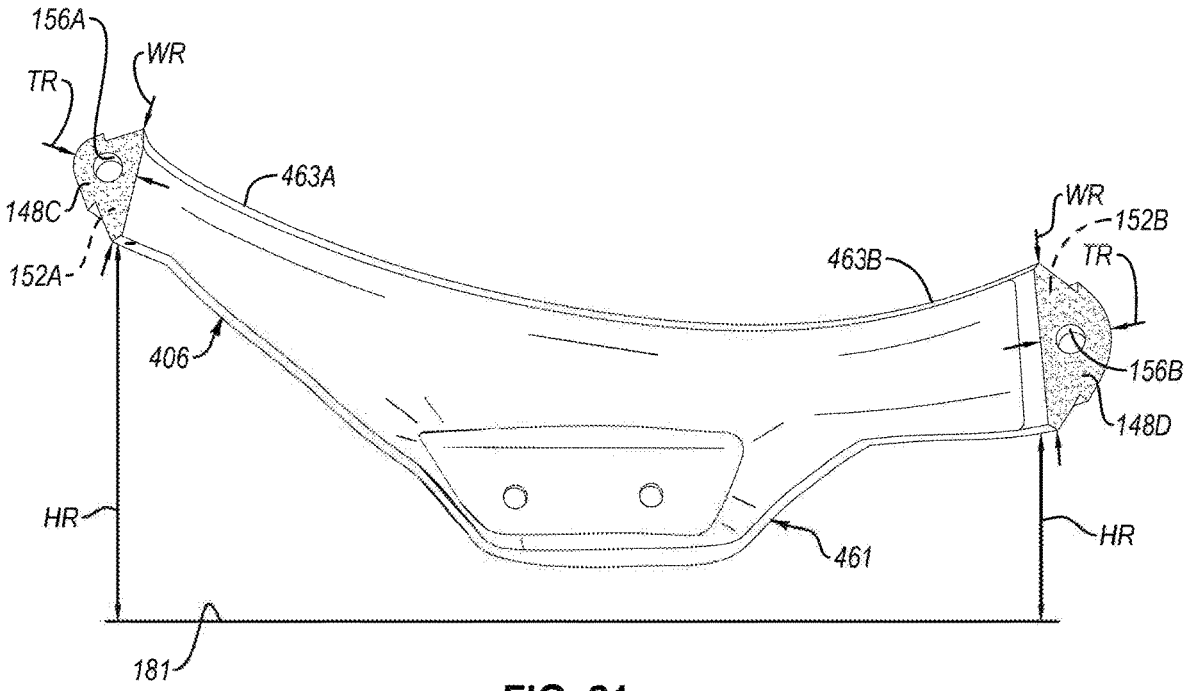
FIG. 21 is a schematic, front elevation view of a ring of the golf club head of FIG. 19, according to one or more examples of the present disclosure.
Figure 22:
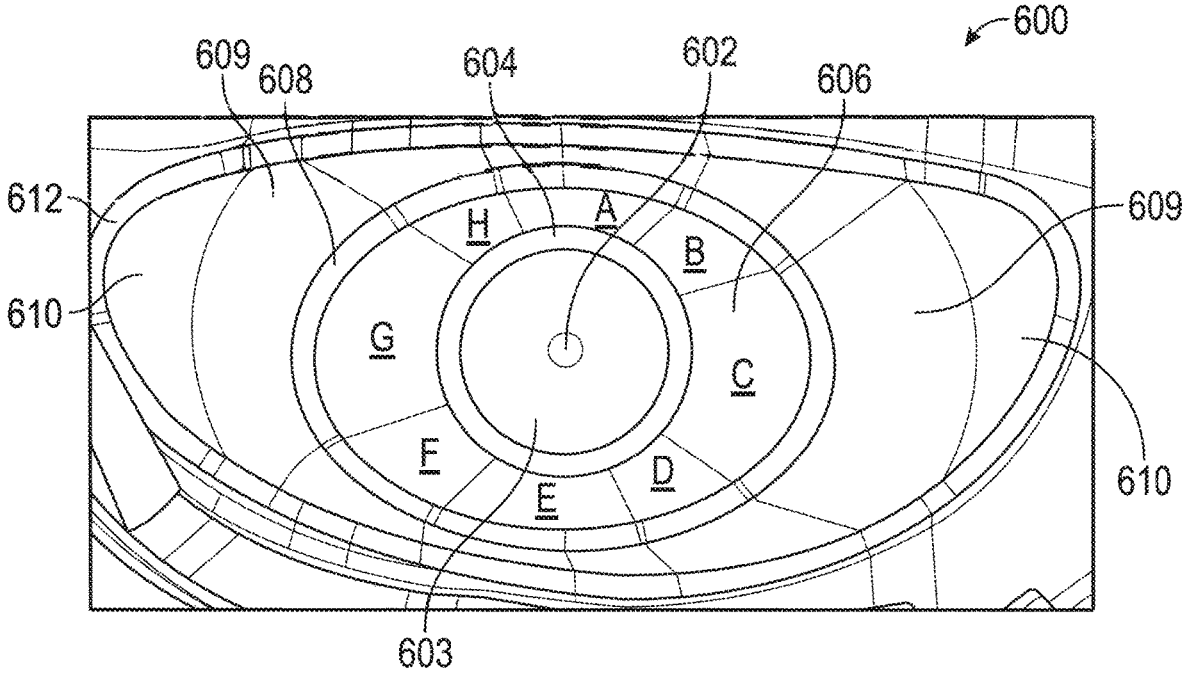
FIG. 22 is a schematic, rear view of a face portion of a golf club head, according to one or more examples of the present disclosure.
Figure 23:
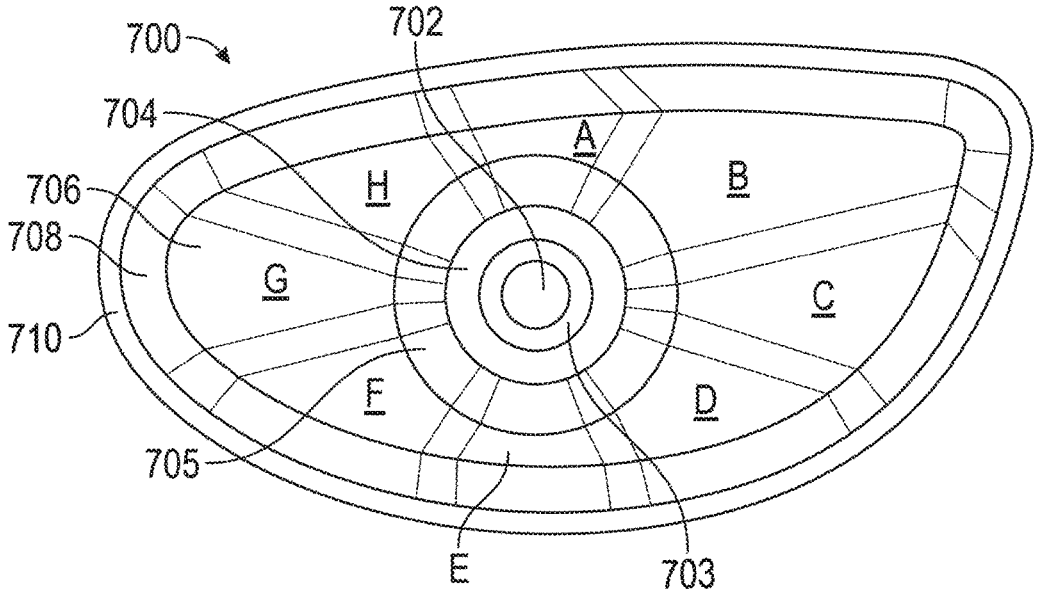
FIG. 23 is a schematic, rear view of a face portion of a golf club head, according to one or more examples of the present disclosure.
Figure 24:
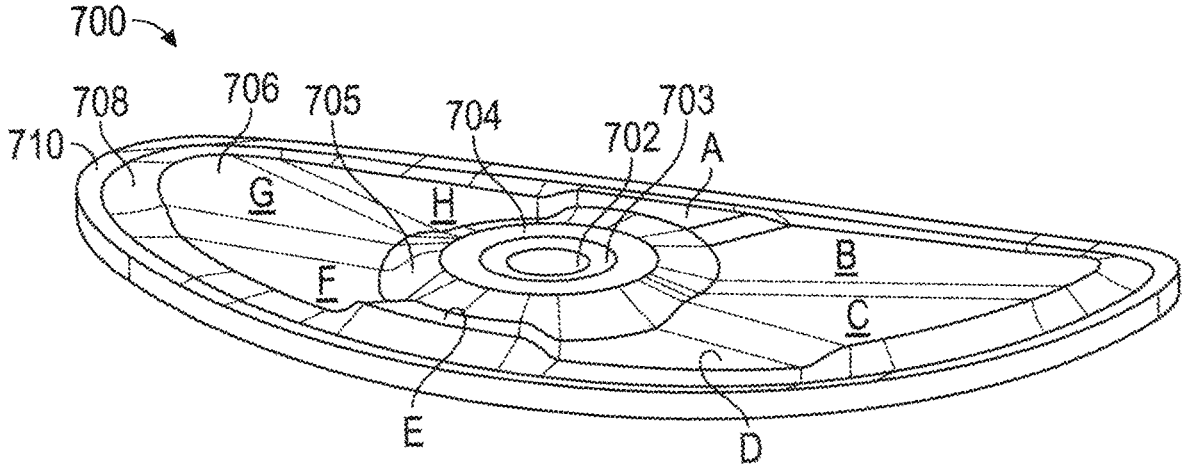
FIG. 24 is a schematic, perspective view of the face portion of FIG. 56, according to one or more examples of the present disclosure.

FIG. 21 illustrates an exemplary rear surface of a face portion 600 of one or more of the golf club heads disclosed herein. In FIG. 21, the rear surface is viewed from the rear with the hosel/heel to the left and the toe to the right. FIGS. 22 and 23 illustrate another exemplary face portion 700 having a variable thickness profile, and FIG. 24 illustrates yet another exemplary face portion 800 having a variable thickness profile. The variable thickness profile of the face portion 700 is formed by a cone-shaped projection, which can have a geometric center that is toeward of a geometric center of the strike face in some examples. The face portions disclosed herein can be formed as a result of a casting process and optional post-casting modifications to the face portions. Accordingly, the face portion can have a great variety of novel thickness profiles. For example, in one examples, a thickness of the forward portion, at the strike face, changes at least 25% along the strike face. By casting the face into a desired geometry, rather than forming the face plate from a flat rolled sheet of metal in a traditional process, the face can be created with greater variety of geometries and can have different material properties, such as different grain direction and chemical impurity content, which can provide advantages for a golf performance and manufacturing.

In a traditional process, the face plate is formed from a flat sheet of metal having a uniform thickness. Such a sheet of metal is typically rolled along one axis to reduce the thickness to a certain uniform thickness across the sheet. This rolling process can impart a grain direction in the sheet that creates a different material properties in the rolling axis direction compared to the direction perpendicular to the rolling direction. This variation in material properties can be undesirable and can be avoided by using the disclosed casting methods instead to create face portion.

Furthermore, because a conventional face plate starts off as a flat sheet of uniform thickness, the thickness of the whole sheet has to be at least as great as the maximum thickness of the desired end product face plate, meaning much of the starting sheet material has to be removed and wasted, increasing material cost. By contrast, in the disclosed casting methods, the face portion is initially formed much closer to the final shape and mass, and much less material has to be removed and wasted. This saves time and cost.

Still further, in a conventional process, the initial flat sheet of metal has to be bent in a special process to impart a desired bulge and roll curvature to the face plate. Such a bending process is not needed when using the disclosed casting methods.

The unique thickness profiles illustrated in FIGS. 22-25 are made possible using casting methods, such as those disclosed in U.S. Pat. No. 10,874,915 issued Dec. 29, 2020, which is incorporated by reference in its entirety, and were previously not possible to achieve using conventional processes, such as starting from a sheet of metal having a uniform thickness, mounting the sheet in a lathe or similar machine and turning the sheet to produce a variable thickness profile across the rear of the face plate. In such a turning process, the imparted thickness profile must be symmetrical about the central turning axis, which limits the thickness profile to a composition of concentric circular ring shapes each having a uniform thickness at any given radius from the center point. In contrast, no such limitations are imposed using the disclosed casting methods, and more complex face geometries can be created.

By using casting methods, large numbers of the disclosed club heads can be manufacture faster and more efficiently. For example, 50 or more heads can be cast at the same time on a single casting tree, whereas it would take much longer and require more resources to create the novel face thickness profiles on face plates using a conventional milling methods using a lathe, one at a time.

In FIG. 22, the rear face surface or interior surface of the face portion 600 includes a non-symmetrical variable thickness profile, illustrating just one example of the wide variety of variable thickness profiles made possible using the disclosed casting methods. The center 602 of the face can have a center thickness, and the face thickness can gradually increase moving radially outwardly from the center across an inner blend zone 603 to a maximum thickness ring 604, which can be circular. The face thickness can gradually decrease moving radially outwardly from the maximum thickness ring 604 across an variable blend zone 606 to a second ring 608, which can be non-circular, such as elliptical. The face thickness can gradually decrease moving radially outwardly from the second ring 608 across an outer blend zone 609 to heel and toe zones 610 of constant thicknesses (e.g., minimum thickness of the face portion) and/or to a radial perimeter zone 612 defining the extent of the face portion 600 where the face transitions to the rest of the golf club head 100.

The second ring 608 can itself have a variable thickness profile, such that the thickness of the second ring 608 varies as a function of the circumferential position around the center 602. Similarly, the variable blend zone 606 can have a thickness profile that varies as a function of the circumferential position around the center 602 and provides a transition in thickness from the maximum thickness ring 604 to the variable and less thicknesses of the second ring 608. For example, the variable blend zone 606 to a second ring 608 can be divided into eight sectors that are labeled A-H in FIG. 22, including top zone A, top-toe zone B, toe zone C, bottom-toe zone D, bottom zone E, bottom-heel zone F, heel zone G, and top-heel zone H. These eight zones can have differing angular widths as shown, or can each have the same angular width (e.g., one eighth of 360 degrees). Each of the eight zones can have its own thickness variance, each ranging from a common maximum thickness adjacent the ring 604 to a different minimum thickness at the second ring 608. For example, the second ring can be thicker in zones A and E, and thinner in zones C and G, with intermediate thicknesses in zones B, D, F, and H. In this example, the zones B, D, F, and H can vary in thickness both along a radial direction (thinning moving radially outwardly) and along a circumferential direction (thinning moving from zones A and E toward zones C and G).

One example of the face portion 600 can have the following thicknesses: 3.1 mm at center 602, 3.3 mm at ring 604, the second ring 608 can vary from 2.8 mm in zone A to 2.2 mm in zone C to 2.4 mm in zone E to 2.0 mm in zone G, and 1.8 mm in the heel and toe zones 610.

According to one example, the ring 604 can be about 8 mm away from the center 602 and the ring 608 can be about 19 mm away from the center 602. The thickness of the face portion 600 at the center 602 can be between 2.8 mm and 3.0 mm. The thickness of the face portion 600 along the ring 604 can be between 2.9 mm and 3.1 mm. The thickness of the face portion 600 along the ring 608 proximate zone A can be between 2.35 mm and 2.55 mm, proximate zone C can be between 2.3 mm and 2.5 mm, proximate zone E can be between 2.1 mm and 2.3 mm, and proximate zone G can be between 2.6 mm and 2.8 mm. The thickness of the face portion 600 at approximately 35 mm away from the center 602 can be between 1.7 mm and 1.9 mm.

According to yet another example, the thickness of the face portion 600 at the center 602 is between 2.95 mm and 3.35 mm, at about 9 mm away from the center 602 is between 3.3 mm and 3.65 mm, at about 16 mm away from the center 602 is between 2.95 mm and 3.36 mm, and at about 28 mm away from the center 602 is between 2.03 mm and 2.27 mm. The thickness of the face portion 600 greater than 28 mm away from the center 602 can be between 1.8 mm and 1.95 mm on a toe side of the face portion 600 and between 1.83 mm and 1.98 mm on a heel side of the face portion 600.

FIGS. 23 and 24 show the rear face surface of another exemplary face portion 700 that includes a non-symmetrical variable thickness profile. The center 702 of the face can have a center thickness, and the face thickness can gradually increase moving radially outwardly from the center across an inner blend zone 703 to a maximum thickness ring 704, which can be circular. The face thickness can gradually decrease moving radially outwardly from the maximum thickness ring 704 across a variable blend zone 705 to an outer zone 706 comprised of a plurality of wedge shaped sectors A-H having varying thicknesses. As best shown in FIG. 24, sectors A, C, E, and G can be relatively thicker, while sectors B, D, F, and H can be relatively thinner. An outer blend zone 708 surrounding the outer zone 706 transitions in thickness from the variable sectors down to a perimeter ring 710 having a relatively small yet constant thickness. The outer zone 706 can also include blend zones between each of the sectors A-H that gradually transition in thickness from one sector to an adjacent sector.

One example of the face portion 700 can have the following thicknesses: 3.9 mm at center 702, 4.05 mm at ring 704, 3.6 mm in zone A, 3.2 mm in zone B, 3.25 mm in zone C, 2.05 mm in zone D, 3.35 mm in zone E, 2.05 mm in zone F, 3.00 mm in zone G, 2.65 mm in zone H, and 1.9 mm at perimeter ring 710.

Figure 25:
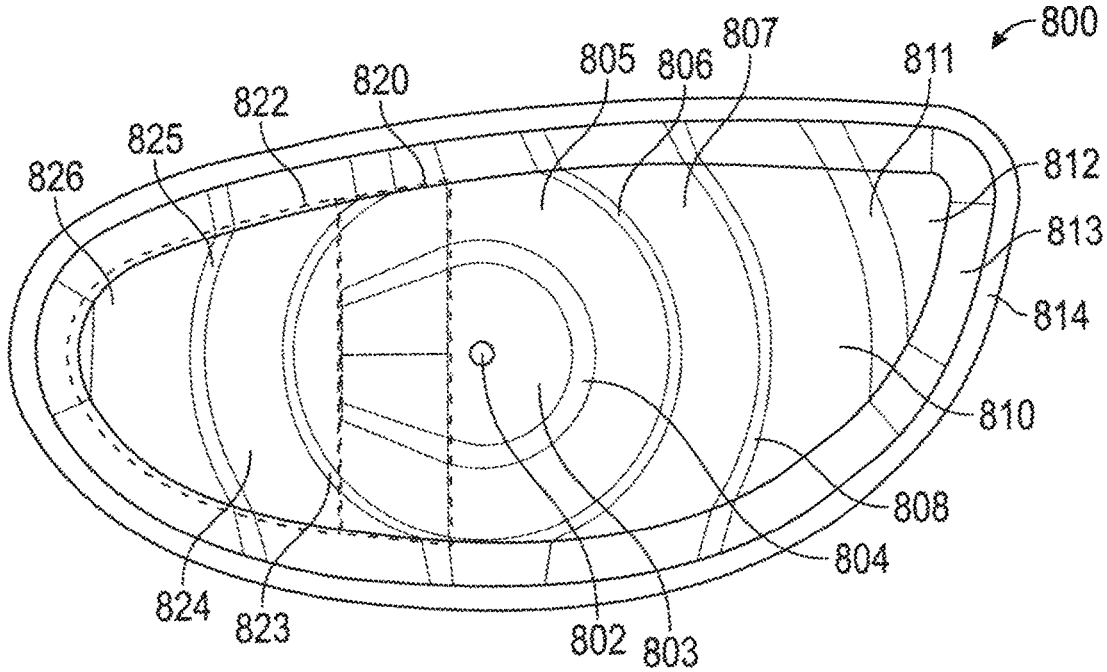
FIG. 25 is a schematic, rear view of a face portion of a golf club head, according to one or more examples of the present disclosure.

FIG. 25 shows the rear face of another exemplary face portion 800 that includes a non-symmetrical variable thickness profile having a targeted thickness offset toward the heel side (left side). The center 802 of the face has a center thickness, and to the toe/top/bottom the thickness gradually increases across an inner blend zone 803 to inner ring 804 having a greater thickness than at the center 802. The thickness then decreases moving radially outwardly across a second blend zone 805 to a second ring 806 having a thickness less than that of the inner ring 804. The thickness then decreases moving radially outwardly across a third blend zone 807 to a third ring 808 having a thickness less than that of the second ring 806. The thickness then decreases moving radially outwardly across a fourth blend zone 810 to a fourth ring 811 having a thickness less than that of the third ring 808. A toe end zone 812 blends across an outer blend zone 813 to an outer perimeter 814 having a relatively small thickness.

To the heel side, the thicknesses are offset by set amount (e.g., 0.15 mm) to be slightly thicker relative to their counterpart areas on the toe side. A thickening zone 820 (dashed lines) provides a transition where all thicknesses gradually step up toward the thicker offset zone 822 (dashed lines) at the heel side. In the offset zone 822, the ring 823 is thicker than the ring 806 on the heel side by a set amount (e.g., 0.15 mm), and the ring 825 is thicker that the ring 808 by the same set amount. Blend zones 824 and 826 gradually decrease in thickness moving radially outwardly, and are each thicker than their counterpart blend zones 807 and 810 on the toe side. In the thickening zone 820, the inner ring 804 gradually increases in thickness moving toward the heel.

One example of the face portion 800 can have the following thicknesses: 3.8 mm at the center 802, 4.0 mm at the inner ring 804 and thickening to 4.15 mm across the thickening zone 820, 3.5 mm at the second ring 806 and 3.65 mm at the ring 823, 2.4 mm at the third ring 808 and 2.55 mm at the ring 825, 2.0 mm at the fourth ring 811, and 1.8 mm at the outer perimeter 814.

The targeted offset thickness profile shown in FIG. 25 can help provide a desirable CT profile across the face. Thickening the heel side can help avoid having a CT spike at the heel side of the face, for example, which can help avoid having a non-conforming CT profile across the face. Such an offset thickness profile can similarly be applied to the toe side of the face, or to both the toe side and the heel side of the face to avoid CT spikes at both the heel and toe sides of the face. In other embodiments, an offset thickness profile can be applied to the upper side of the face and/or toward the bottom side of the face.

As shown in FIGS. 2, 4, 8, 9A, and 13, in some examples, the cast cup 104 further includes a slot 171 located in the sole portion 117 of the golf club head 100. The slot 171 is open to an exterior of the golf club head 100 and extends lengthwise from the heel portion 116 to the toe portion 114. More specifically, the slot 171 is elongate in a lengthwise direction substantially parallel to, but offset from, the strike face 145. Generally, the slot 171 is a groove or channel formed in the cast cup 104 at the sole portion 117 of the golf club head 100. In some implementations, the slot 171 is a through-slot, or a slot that is open to the interior cavity 113 from outside of the golf club head 100. However, in other implementations, the slot 171 is not a through-slot, but rather is closed on an interior cavity side or interior side of the slot 171. For example, the slot 171 can be defined by a portion of the side wall of the sole portion 117 of the body 102 that protrudes into the interior cavity 113 and has a concave exterior surface having any of various cross-sectional shapes, such as a substantially U-shape, V-shape, and the like.

In some examples, the slot 171 is offset from the strike face 145 by an offset distance, which is the minimum distance between a first vertical plane passing through a center of the strike face 145 and the slot at the same x-axis coordinate as the center of the strike face 145, between about 5 mm and about 50 mm, such as between about 5 mm and about 35 mm, such as between about 5 mm and about 30 mm, such as between about 5 mm and about 20 mm, or such as between about 5 mm and about 15 mm.

Although not shown, the cast cup 104 and/or the ring 106 may include a rearward slot, with a configuration similar to the slot 171, but oriented in a forward-to-rearward direction, as opposed to a heel-to-toe direction. The cast cup 104 includes a rearward slot, but no slot 171 in some examples, and both a rearward slot and the slot 171 in other examples. In one example, the rearward slot is positioned rearwardly of the slot 171. The rearward slot can act as a weight track in some implementations. Moreover, the rearward track can be offset from the strike face 145 by an offset distance, which is the minimum distance between a first vertical plane passing through the center of the strike face 145 and the rearward track at the same x-axis coordinate as the center of the strike face 145, between about 5 mm and about 50 mm, such as between about 5 mm and about 40 mm, such as between about 5 mm and about 30 mm, or such as between about 10 mm and about 30 mm.

In certain embodiments, the slot 171, as well as the rearward slot if present, has a certain slot width, which is measured as a horizontal distance between a first slot wall and a second slot wall. For the slot 171, as well as the rearward slot, the slot width may be between about 5 mm and about 20 mm, such as between about 10 mm and about 18 mm, or such as between about 12 mm and about 16 mm. According to some embodiments, a depth of the slot 171 (i.e., the vertical distance between a bottom slot wall and an imaginary plane containing the regions of the sole portion 117 adjacent opposing slot walls of the slot 171) may be between about 6 mm and about 20 mm, such as between about 8 mm and about 18 mm, or such as between about 10 mm and about 16 mm.

Additionally, the slot 171, as well as the rearward slot if present, has a certain slot length, which can be measured as the horizontal distance between a slot end wall and another slot end wall. For both the slot 171 and rearward slot, their lengths may be between about 30 mm and about 120 mm, such as between about 50 mm and about 100 mm, or such as between about 60 mm and about 90 mm. Additionally, or alternatively, the length of the slot 171 may be represented as a percentage of a total length of the strike face 145. For example, the slot 171 may be between about 30% and about 100% of the length of the strike face 145, such as between about 50% and about 90%, or such as between about 60% and about 80% mm of the length of the strike face 145.

In some examples, the slot 171 is a feature to improve and/or increase the coefficient of restitution (COR) across the strike face 145. With regards to a COR feature, the slot 171 may take on various forms such as a channel or through slot. The COR of the golf club head 100 is a measurement of the energy loss or retention between the golf club head 100 and a golf ball when the golf ball is struck by the golf club head 100. Desirably, the COR of the golf club head 100 is high to promote the efficient transfer of energy from the golf club head 100 to the ball during impact with the ball. Accordingly, the COR feature of the golf club head 100 promotes an increase in the COR of the golf club head 100. Generally, the slot 171 increases the COR of the golf club head 100 by increasing or enhancing the flexibility of the strike face 145. In some examples of the golf club heads disclosed herein, the COR is at least 0.8 for at least 25% of the strike face within the central region, as defined below.

Further details concerning the slot 171 as a COR feature of the golf club head 100 can be found in U.S. patent application Ser. Nos. 13/338,197, 13/469,031, 13/828,675, filed Dec. 27, 2011, May 10, 2012, and Mar. 14, 2013, respectively, U.S. patent application Ser. No. 13/839,727, filed Mar. 15, 2013, U.S. Pat. No. 8,235,844, filed Jun. 1, 2010, U.S. Pat. No. 8,241,143, filed Dec. 13, 2011, U.S. Pat. No. 8,241,144, filed Dec. 14, 2011, all of which are incorporated herein by reference.

The slot 171 can be any of various flexible boundary structures (FBS) as described in U.S. Pat. No. 9,044,653, filed Mar. 14, 2013, which is incorporated by reference herein in its entirety. Additionally, or alternatively, the golf club head 100 can include one or more other FBS at any of various other locations on the golf club head 100. The slot 171 may be made up of curved sections, or several segments that may be a combination of curved and straight segments. Furthermore, the slot 171 may be machined or cast into the golf club head 100. Although shown in the sole portion 117 of the golf club head 100, the slot 171 may, alternatively or additionally, be incorporated into the crown portion 119 of the golf club head 100.

In some examples, the slot 171 is filled with a filler material. However, in other examples, the slot 171 is not filled with a filler material, but rather maintains an open, vacant, space within the slot 171. The filler material can be made from a non-metal, such as a thermoplastic material, thermoset material, and the like, in some implementations. The slot 171 may be filled with a material to prevent dirt and other debris from entering the slot and possibly the interior cavity 113 of the golf club head 100 when the slot 171 is a through-slot. The filler material may be any relatively low modulus materials including polyurethane, elastomeric rubber, polymer, various rubbers, foams, and fillers. The filler material should not substantially prevent deformation of the golf club head 100 when in use as this would counteract the flexibility of the golf club head 100.

According to one embodiment, the filler material is initially a viscous material that is injected or otherwise inserted into the slot 171. Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd. In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

Referring to FIGS. 4, 8, 9A, and 14, in some examples, the golf club head 100 further includes a weight 173 attached to the cast cup 104. The cast cup 104 includes a threaded port 175 that receives and retains the weight 173. The threaded port 175 is open to an exterior and the interior cavity 113 of the golf club head 100 and includes internal threads in certain examples. In other examples, the threaded port 175 is closed to the interior cavity 113. The weight 173 includes external threads that threadably engage with the internal threads of the threaded port 175 to retain the weight 173 within the threaded port 175. When the threaded port 175 is open to the interior cavity 113, the weight 173 effectually closes the threaded port 175 to prevent access to the interior cavity 113 when threadably attached to the cast cup 104 within the threaded port 175. As shown, when the threaded port 175 is open to the interior cavity 113, a portion of the weight 173 is located external to the interior cavity 113 and another portion is located within the interior cavity 113. In contrast, in other examples, such as when the threaded port 175 is closed to the interior cavity 113, an entirety of the weight 173 is located external to the interior cavity 113. Although not shown, in one example, the threaded port 175 can be open to the interior cavity 113 and closed to an exterior of the golf club head 100 (e.g., the threaded port 175 faces inwardly as opposed to outwardly). In such an example, the entirety of the weight 173 would be located internally within the interior cavity 113. As defined herein, when any portion of the weight 173 is internal relative to or within the interior cavity 113, the weight 173 is considered internal to the interior cavity 113 and when any portion of the weight 173 is external relative to the interior cavity 113, the weight 173 is alternatively, or also, considered external to the interior cavity 113.

In some examples, as shown, the threaded port 175, and thus the weight 173, is located in the sole portion 117 of the golf club head 100. Moreover, according to certain examples, the threaded port 175 and the weight 173 are located closer to the heel portion 116 than the toe portion 114. In one example, the threaded port 175 and the weight are located closer to the heel portion 116 than the slot 171. The weight 173 has a mass between about 3 g and about 23 g (e.g., 6 g) in some examples.

Referring to FIGS. 9A, 11, and 14, the cast cup 104 further comprises a mass pad 186 attached to or co-formed with the rest of the cast cup 104. The mass pad 186 has a thickness greater than any other portion of the cast cup 104. In the illustrated example, the mass pad 186 is located proximate the sole portion 117 of the golf club head 100, and thus a sole region of the cast cup 104. Additionally, in certain examples, a portion of the mass pad 186 is located proximate the heel portion 116 of the golf club head 100, and thus a heel region of the cast cup 104. As defined herein, when located at the sole portion 117 of the golf club head 100, the mass pad 186 is considered a sole mass pad, and when located at the heel portion 116 of the golf club head 100, the mass pad 186 is considered a heel mass pad. It is recognized that when the mass pad 186 is located at both the sole portion 117 and the heel portion 116, the mass pad 186 is considered to be a sole mass pad and a heel mass pad.

Referring to FIGS. 11 and 14, in some examples, the cast cup 104 further includes internal ribs 187 co-formed with other portions of the cast cup 104. The internal ribs 187 can be in any of various locations within the cast cup 104. In the illustrated example, the internal ribs 187 are located (e.g., formed in) a sole region of the cast cup 104 closer to a toe region of the cast cup 104 than a heel region of the cast cup 104. The internal ribs 187 help to stiffen and promote desirable acoustic properties of the golf club head 100.

Referring to FIGS. 11, 14, and 15, the ring 106 includes a cantilevered portion 161, and a toe arm portion 163A and a heel arm portion 163B extending from the cantilevered portion 161. The toe arm portion 163A and the heel arm portion 163B are on opposite sides of the golf club head 100, initiate at the cantilevered portion 161, and terminate at a corresponding one of the toe cup-engagement surface 152A and the heel cup-engagement surface 152B. The cantilevered portion 161 defines at least part of the rearward portion 118 of the golf club head 100 and further defines a rearmost end of the golf club head 100. Moreover, in the illustrated examples, the cantilevered portion 161 extends from the crown portion 119 to the sole portion 117. Accordingly, the cantilevered portion 161 defines part of the sole portion 117 of the golf club head 100 in some examples, such as defining an outwardly-facing surface of the sole portion 117 of the golf club head 100.

In some examples, the cantilevered portion 161 is close to the ground plane 181 when the golf club head 100 is in the address position. According to certain examples, a ratio of the peak crown height to a vertical distance from the peak crown height to a lowest surface of the cantilevered portion 161 of the ring 106 is at least 6.0, at least 5.0, at least 4.0, or more preferably at least 3.0. Alternatively, or additionally, in some examples, a vertical distance from the peak skirt height of the skirt portion to a lowermost surface of the cantilevered portion 161 of the ring 106, when the golf club head 100 is in the address position, is no less than between 20 mm and 30 mm.

The toe arm portion 163A and the heel arm portion 163B define a toe side of the skirt portion 121 and a heel side of the skirt portion 121, respectively, as well as part of the toe portion 114 and heel portion 116, respectively, of the golf club head 100. The cantilevered portion 161 extends downwardly away from the toe arm portion 163A and the heel arm portion 163B, while the toe arm portion 163A and the heel arm portion 163B extend forwardly away from the cantilevered portion 161. Accordingly, the cantilevered portion 161 is closer to the ground plane 181 than the toe arm portion 163A and the heel arm portion 163B when the golf club head 100 is in the address position. In other words, referring to FIGS. 3, 4, and 9A, a height (HR) of the lowest surface of the ring 106 above the ground plane 181, in a vertical direction when the golf club head 100 is in the address position, at any location along the cantilevered portion 161 is less than at any location along the toe arm portion 163A and the heel arm portion 163B.

In some examples, the height HR of the lowest surface of the toe arm portion 163A at the toe portion 114 of the golf club head 100 is different than the height HR of the lowest surface of the heel arm portion 163B at the heel portion 116 of the golf club head 100. More specifically, in one example, the height HR of the lowest surface of the toe arm portion 163A at the toe portion 114 of the golf club head 100 is greater than the height HR of the lowest surface of the heel arm portion 163B at the heel portion 116 of the golf club head 100.

According to certain examples, as shown in FIGS. 3, 4, and 9A, a width (WR) of the of the ring 106, as measured in a vertical direction when the golf club head 100 is in the address position, varies in a forward-to-rearward direction (e.g., along a length of the ring 106). In one example, the width WR increases from a minimum width to a maximum width in the forward-to-rearward direction. In other words, the width WR of the ring 106 varies in the forward-to-rearward direction in certain examples. In some examples, the maximum width WR of the ring 106 is at the rearmost end of the golf club head 100. In one example, the maximum width WR of the ring 106 is as least 20 mm. According to certain examples, as shown in FIG. 14, the width WR of the ring 106 at the toe portion 114 is less than the width WR of the ring 106 at the heel portion 116. According to some additional examples, a thickness of the ring 106 can vary along the ring 106 in a forward-to-rearward direction.

Referring to FIGS. 2-4, 6, 8, 9A, and 11-15, in some examples, the golf club head 100 further includes a mass element 159 attached to the cantilevered portion 161 of the ring 106, such as at a rearmost end of the golf club head 100. The mass element 159 can be selectively removable from (e.g., interchangeable with differently weighted mass elements) or permanently attached to the cantilevered portion 161. According to one example, the mass element 159 and the weight 173 are interchangeably coupleable to the cast cup 104 and the cantilevered portion 161 of the ring 106. Accordingly, in some examples, the flight control technology component of the golf club head 100, the mass element 159, and the weight 173 are adjustable relative to the golf club head 100. In certain examples, the flight control technology component of the golf club head 100, the mass element 159, and the weight 173 are configured to be adjustable via a single or the same tool.

In one example, the mass element 159 includes external threads. The golf club head 100 can additionally include a mass receptacle 157 attached to the cantilevered portion 161 of the ring 106. The mass receptacle 157 can include a threaded aperture, with internal threads, that threadably engages the mass element 159 to secure the mass element 159 to the cantilevered portion 161. The mass receptacle 157 is welded to the cantilevered portion 161 in some examples and adhered to the cantilevered portion 161 in other examples. In certain examples, the mass receptacle 157 is co-formed with the cantilevered portion 161. The cantilevered portion 161 also includes a mass pad 155 (see, e.g., FIGS. 9A, 12, and 15) or a portion of the cantilevered portion 161 with a localized increase in thickness and thus mass. The mass receptacle 157 can be formed in the mass pad 155 of the cantilevered portion 161. The mass element 159 has a mass between about 15 g and about 35 g (e.g., 24 g) in some examples.

Figure 16:
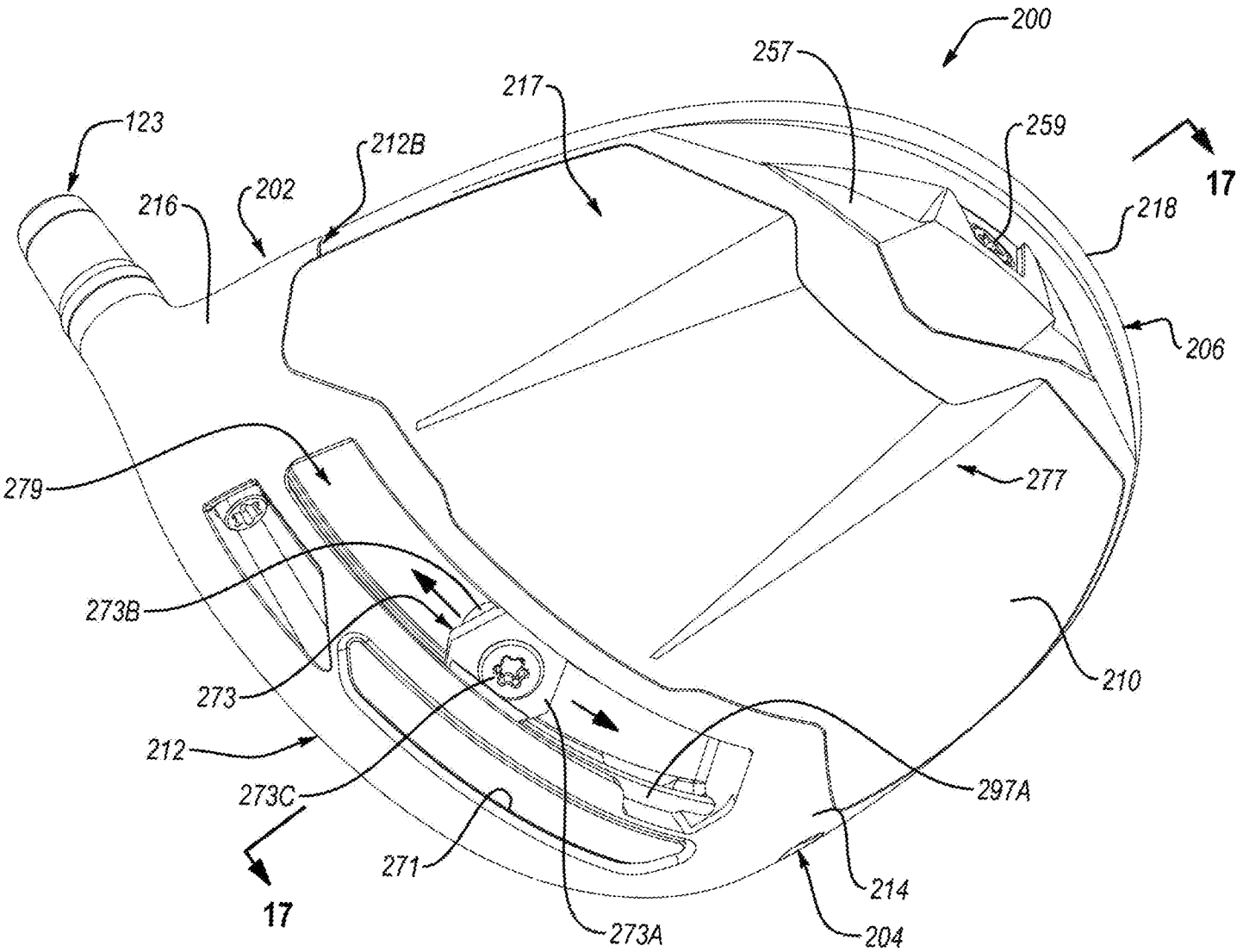
FIG. 16 is a schematic, perspective view of another golf club head, according to one or more examples of the present disclosure.

The outer peripheral shape of one or both of the mass element 159 and the weight 173 in the illustrated examples is circular. Accordingly, an orientation of one or both of the mass element 159 and the weight 173 is rotatable about a central axis of the mass element 159 and the weight 173, respectively, in any of various orientations between 0-degrees and 360-degrees. However, in other examples, the outer peripheral shape of at least one or both of the mass element 159 and the weight 173 is non-circular, such as ovular, triangular, trapezoidal, square, and the like. For example, as shown in FIG. 16, the weight 273 has an outer peripheral shape that is trapezoidal or rectangular. In certain examples, the mass element 159 and/or the weight 173, having a non-circular outer peripheral shape, is rotatable about the central axis of the mass element 159 and the weight 173, respectively, in any of various orientations between 0-degrees and at least 90-degrees in certain implementations and 0-degrees and at least 180-degrees in other implementations.

The construction and material diversity of the golf club head 100 enables flexibility of the position of the weight 173 (e.g., first weight or forward weight) relative to the position of the mass element 159 (e.g., second weight or rearward weight). In some examples, the relative positions of the weight 173 and the mass element 159 can be similar to those disclosed in U.S. patent application Ser. No. 16/752,397, filed Jan. 24, 2020. Referring to FIG. 9A, according to one example, a z-axis coordinate of the CG of the first weight (FWCG), on the z-axis of the head origin coordinate system 185, is between −30 mm and −10 mm (e.g., −21 mm), a y-axis coordinate of the CG of the first weight (FWCG), on the y-axis of the head origin coordinate system 185 is between 10 mm and 30 mm (e.g., 23 mm), and an x-axis coordinate of the CG of the first weight (FWCG), on the x-axis of the head origin coordinate system 185 is between 15 mm and 35 mm (e.g., 22 mm). According to the same, or a different, example, a z-axis coordinate of the CG of the second weight (SWCG), on the z-axis of the head origin coordinate system 185, is between −30 mm and 10 mm (e.g., −11 mm), a y-axis coordinate of the CG of the second weight (SWCG), on the y-axis of the head origin coordinate system 185 is between 90 mm and 120 mm (e.g., 110 mm), and an x-axis coordinate of the CG of the second weight (SWCG), on the x-axis of the head origin coordinate system 185 is between −20 mm and 10 mm (e.g., −7 mm).

In certain examples, the sole portion 117 of the golf club head 100 includes an inertia generating feature 177 that is elongated in a lengthwise direction. The lengthwise direction is perpendicular or oblique to the strike face 145. According to some examples, the inertia generating feature 177 includes the same features and provides the same advantages as the inertia generator disclosed in U.S. patent application Ser. No. 16/660,561, filed Oct. 22, 2019, which is incorporated herein by reference in its entirety. In the illustrated examples, the sole insert 110 forms at least a portion of the inertia generating feature 177. More specifically, in some examples, the sole insert 110 forms all or a majority of the inertia generating feature 177. The cantilevered portion 161 of the ring 106 also forms part, such as a rearmost part, of the inertia generating feature 177 in certain examples. The inertia generating feature 177 helps to increase the inertia of the golf club head 100 and lower the center-of-gravity (CG) of the golf club head 100.

The inertia generating feature 177 includes a raised or elevate platform that extends from a location rearwardly of the hosel 120 to a location proximate the rearward portion 118 of the golf club head 100. The inertia generating feature 177 includes a substantially flat or planar surface that is raised above (or protrudes from, depending on the orientation of the golf club head 100) the surrounding external surface of the sole portion 117. In certain examples, at least a portion of the inertia generating feature 177 is raised above the surrounding external surface of the sole portion 117 by at least 1.5 mm, at least 1.8 mm, at least 2.1 mm, or at least 3.0 mm. The inertia generating feature 177 also has a width that is less than an entire width (e.g., less than half the entire width) of the sole portion 117. In view of the foregoing, the inertia generating feature 177 has a complex curved geometry with multiple inflection points. Accordingly, the sole insert 110, which defines the inertia generating feature 177, has a complex curved surface that has multiple inflection points.

Referring to FIGS. 1-3 and 5, in some examples, the golf club head 100 includes a through-aperture 172 in the body 102 at the toe portion 114. The through-aperture 172 extends entirely through the wall of the body 102 such that the interior cavity 113 is accessible through the aperture 172. The aperture 172 can be used to insert a stiffener into the interior cavity 113 against an interior surface of the forward portion 112 to help set the CT of the strike face 145. Further details of the stiffener, the insertion process, and the effect of the stiffener on the CT of the strike face 145 can be found in U.S. Patent Application Publication No. 2019/0201754, published Jul. 4, 2019, which is incorporated herein by reference in its entirety. As shown, the through-aperture 172 is not located in the forward portion 112 (e.g., the strike face 145). Accordingly, in some examples, the strike face 145 is void of through-apertures open to the interior cavity 113 or the hollow interior region of the golf club head 100. Moreover, in some examples, no material having a shore D value greater than 10, greater than 5, or greater than 1 contacts an interior surface 166 of the forward portion 112, opposite the strike face 145 and open to the hollow interior region, at a location toeward and/or heelward of the geometric center of the strike face 145. In yet other examples, no material, regardless of hardness, contacts an interior surface 166 of the forward portion 112, opposite the strike face 145 and open to the hollow interior region.

The CT properties of the golf club heads disclosed herein can be defined as CT values within a central region of the strike face 145. The central region, is forty millimeter by twenty millimeter rectangular area centered on a center of the strike face and elongated in a heel-to-toe direction. The center of the strike face 145 can be a geometric center of the strike face 145 in some examples. Within the central region, the strike face 145 has a characteristic time (CT) of no more than 257 microseconds. In some examples, the CT of at least 60% of the strike face, within the central region, is at least 235 microseconds. According to some examples, the CT of at least 35% of the strike face, within the central region, is at least 240 microseconds.

The CT of the strike face 145, at the geometric center of the strike face, has an initial CT value. The initial CT value is the CT value of the strike face 145 before any impacts with a standard golf ball. As defined herein, an impact with the standard golf ball is an impact of the standard golf ball when the golf ball is traveling at a velocity of 52 meters per second. According to some examples, the initial CT value is at least 244 microseconds. In certain examples, the driver-type golf club heads disclosed herein, including the golf club head 100, are configured such that after 500 impacts of a standard golf ball at the geometric center of the strike face 145, the CT of the strike face at any point within the central region is less than 256 microseconds and the CT at the geometric center of the strike face is no more than five microseconds different than (e.g., greater than) the initial CT value.

In certain examples, the driver-type golf club heads disclosed herein, including the golf club head 100, are configured such that after 1,000, 1,500, 2,000, 2,500, or 3,000 impacts of the standard golf ball at the geometric center of the strike face, the CT of the strike face at any point within the central region is less than 256 microseconds. According to some examples, after 2,000 impacts of the standard golf ball at the geometric center of the strike face, the CT of the strike face 145 at any point within the central region is no more than seven microseconds or nine microseconds different that the initial CT value. Moreover, in certain examples, after 2,000 impacts of the standard golf ball at the geometric center of the strike face, the CT of the strike face 145 at the geometric center of the strike face is no less than 249 microseconds and no more than ten microseconds different than the initial CT value. According to some examples, after 3,000 impacts of the standard golf ball at the geometric center of the strike face, the CT of the strike face 145 at any point within the central region is no more than nine microseconds or thirteen microseconds different that the initial CT value. In certain examples, such as those where the strike face 145 is made of a metallic material, an inward face progression of the strike face 145 is less than 0.01 inches after 500 impacts of the standard golf ball at the geometric center of the strike face.

Figure 17:
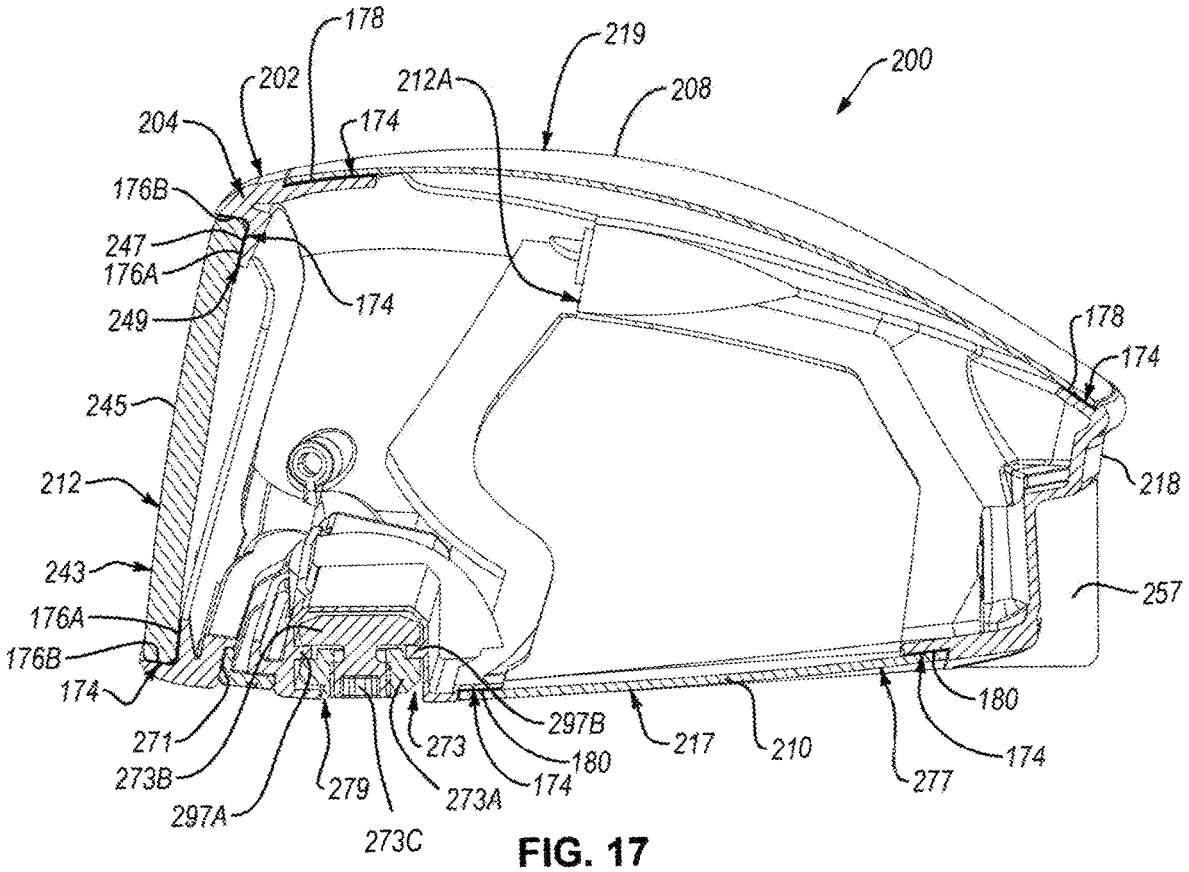
FIG. 17 is a schematic, cross-sectional, side elevation view of the golf club head of FIG. 16, taken along the line 16-16 of FIG. 16, according to one or more examples of the present disclosure.

Referring to FIGS. 16 and 17, and according to another example of a golf club head disclosed herein, a golf club head 200 is shown. The golf club head 200 includes features similar to the features of the golf club head 100, with like numbers (e.g., same numbers but in 200-series) referring to like features. For example, like the golf club head 100, the golf club head 200 includes a toe portion 214 and a heel portion 216, opposite the toe portion 214. Additionally, the golf club head 200 includes a forward portion 212 and a rearward portion 218, opposite the forward portion 212. The golf club head 200 additionally includes a sole portion 217, at a bottom region of the golf club head 200, and a crown portion 219, opposite the sole portion 217 and at a top region of the golf club head 200. Also, the golf club head 200 includes a skirt portion 221 that defines a transition region where the golf club head 200 transitions between the crown portion 219 and the sole portion 217. The golf club head 200 further includes an interior cavity 213 that is collectively defined and enclosed by the forward portion 212, the rearward portion 218, the crown portion 219, the sole portion 217, the heel portion 216, the toe portion 214, and the skirt portion 221. Additionally, the forward portion 212 includes a strike face 245 that extends along the forward portion 212 from the sole portion 217 to the crown portion 219, and from the toe portion 214 to the heel portion 216. Additionally, the golf club head 200 further includes a body 202, a crown insert 208 attached to the body 202 at a top of the golf club head 200, and a sole insert 210 attached to the body 202 at a bottom of the golf club head 200. The body 202 includes a cast cup 204 and a ring 206. The ring 206 is joined to the cast cup 204 at a toe-side joint 212A and a heel-side joint 212B. The cast cup 204 of the body 202 also includes a slot 271 in the sole portion 217 of the golf club head 200. Further, the golf club head 200 additionally includes a mass element 259 and a mass receptacle 257 attached to the ring 206 of the body 202, as well as a weight 273 attached to the cast cup 204. Accordingly, in view of the foregoing, the golf club head 200 shares some similarities with the golf club head 100.

Unlike the golf club head 100, however, the strike face 245 of the golf club head 200 in FIGS. 16 and 17 is not co-formed with the cast cup 204. Rather, the strike face 245 forms part of a strike plate 243 that is formed separately from the cast cup 204 and bonded to the cast cup 204 by the bonding tape 174. Accordingly, the strike plate 243 defines the strike face 245. The cast cup 204 includes a plate opening 249 at the forward portion 212 of the golf club head 200 and a plate-opening recessed ledge 247 that extends continuously about the plate opening 249. An inner periphery of the plate-opening recessed ledge 247 defines the plate opening 249. The strike plate 243 is attached to the cast cup 204 by fixing the strike plate 243 in seated engagement with the plate-opening recessed ledge 247. When joined to the plate-opening recessed ledge 247 in this manner, the strike plate 243 covers or encloses the plate opening 249. Moreover, the plate-opening recessed ledge 247 and the strike plate 243 are sized, shaped, and positioned relative to the crown portion 219 of the golf club head 200 such that the strike plate 243 abuts the crown portion 219 when seatably engaged with the plate-opening recessed ledge 247. The strike plate 243, abutting the crown portion 219, defines a topline of the golf club head 200. Moreover, in some examples, the visible appearance of the strike plate 243 contrasts enough with that of the crown portion 219 of the golf club head 200, which is partially defined by the cast cup 204, that the topline of the golf club head 200 is visibly enhanced. Because the strike plate 243 is formed separately from the cast cup 204, the strike plate 243 can be made of a material that is different than that of the cast cup 204. In one example, the strike plate 243 is made of a fiber-reinforced polymeric material. In yet another example, the strike plate 243 is made of a metallic material, such as a titanium alloy (e.g., Ti 6-4, Ti 9-1-1, and ZA 1300).

Additionally, unlike the golf club head 100, the cast cup 204 includes a weight track 279 in the sole portion 217 of the golf club head 200. The weight track 279 extends lengthwise in a heel-to-toe direction along the sole portion 217. In examples where the cast cup 204 also includes the slot 271, such as shown, the weight track 279 is substantially parallel to the slot 271 and offset from the slot 271 in a front-to-rear direction. The weight track 279 includes at least one ledge that extends lengthwise along the length of the weight track 279. In the illustrated example, the weight track 279 includes a forward ledge 297A and a rearward ledge 297B, which are spaced apart from each other in the front-to-rear direction. The weight 273, which positioned within the weight track 279, is selectively clampable to the ledge or ledges of the weight track 279 to releasably fix the weight 273 to the weight track 279. In the illustrated example, the weight 273 is selectively clampable to both the forward ledge 297A and the rearward ledge 297B. When unclamped to the one or more ledges of the weight track 279, the weight 273 is slidable along the one or more ledges, as shown by directional arrows in FIG. 16, to change a position of the weight 273 relative to the weight track 279 and, when re-clamped to the one or more ledges, adjust the mass distribution, center-of-gravity (CG), and other performance characteristics of the golf club head 200.

According to one example, the weight 273 includes a washer 273A, a nut 273B, and a fastening bolt 273C that interconnects with the washer 273A and the nut 273B to clamp down on the ledges 297A, 297B of the weight track 279. The washer 273A has a non-threaded aperture and the nut 273B has a threaded aperture. The fastening bolt 273C is threaded and passes through the non-threaded aperture of the washer 273A to threadably engage the threaded aperture of the nut 273B. Threadable engagement between the fastening bolt 273C and the nut 273B allows a gap between the washer 273A and the nut 273B to be narrowed, which facilitates the clamping of the ledge or ledges between the washer 273A and the nut 273B, or widened, which facilitates the un-clamping of the ledge or ledges from between the washer 273A and the nut 273B. The fastening bolt 273C can be rotatable relative to both the washer 273A and the nut 273B or form a one-piece monolithic construction and be co-rotatable with one of the washer 273A and the nut 273B.

To reduce the weight of the golf club head 200 and the depth of the weight track 279, the fastening bolt 273C is short. For example, the length of the fastening bolt 273C, when the weight 273 is clamped on the ledges 297A, 297B, extends no more than 3 mm past the nut 273B (or the washer 273A if the position of the nut 273B and the washer 273A are reversed). In some examples, the entire length of the fastening bolt 273C is no more than 15% greater than the combined thicknesses of the washer 273A, the nut 273B, and one of the ledges 297A, 297B.

As shown, an outer peripheral shape of the washer 273A is non-circular, such as trapezoidal or rectangular. Similarly, the outer peripheral shape of the nut 273B can be non-circular, such as trapezoidal or rectangular. Alternatively, as shown, the outer peripheral shape of the nut 273B is circular and the outer peripheral shape of the washer 273A is non-circular.

Figure 18:
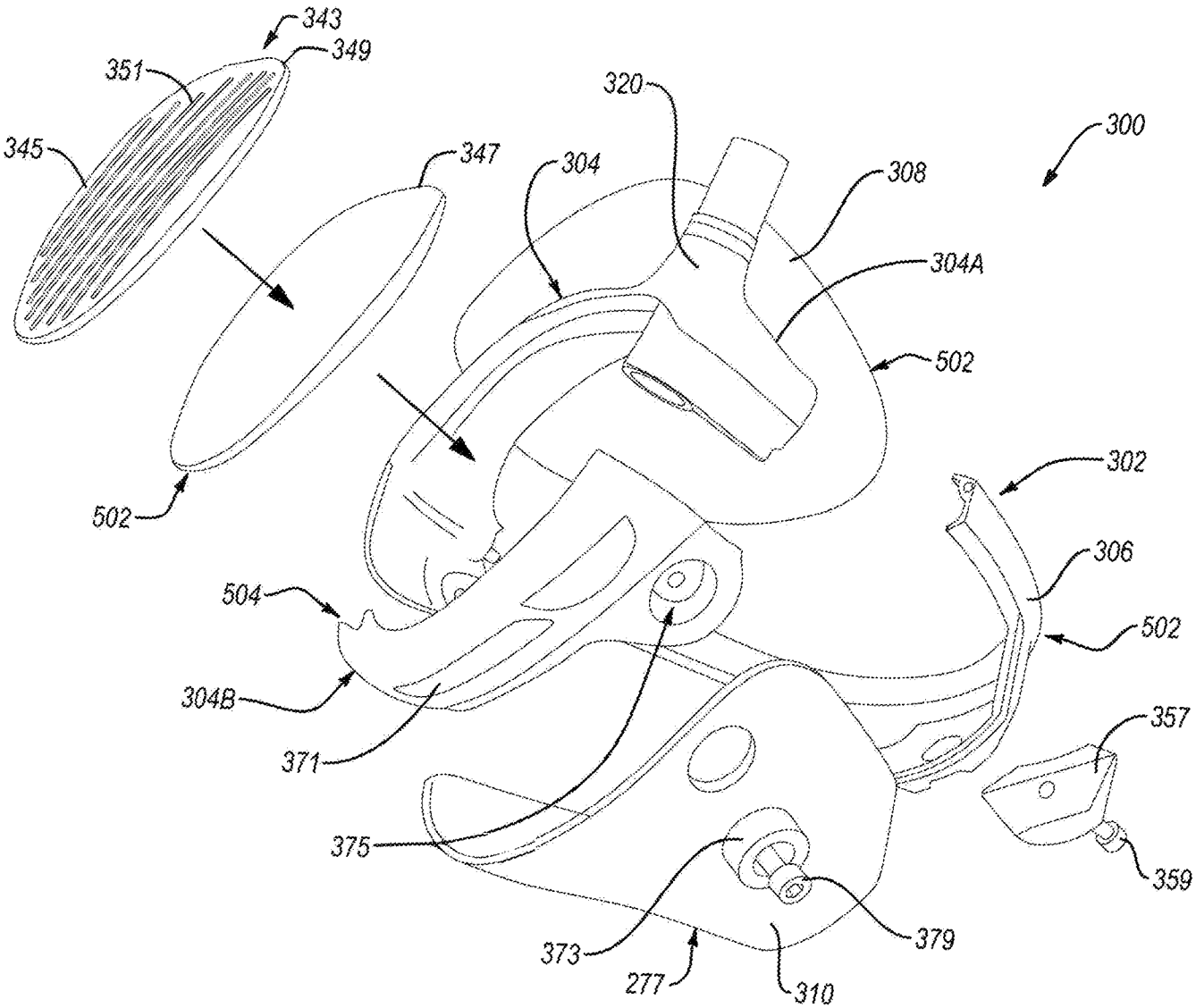
FIG. 18 is a schematic, exploded, perspective view of another golf club head, according to one or more examples of the present disclosure.

Referring to FIG. 18, and according to another example of a golf club head disclosed herein, a golf club head 300 is shown. The golf club head 300 includes features similar to the features of the golf club head 100 and the golf club head 200, with like numbers (e.g., same numbers but in 300-series) referring to like features. For example, like the golf club head 100 and the golf club head 200 includes a body 302, a crown insert 308 attached to the body 302 at a top of the golf club head 300, and a sole insert 310 attached to the body 302 at a bottom of the golf club head 300. The body 302 includes a cast cup 304 and a ring 306. The ring 306 is joined to the cast cup 304 at a toe-side joint and a heel-side joint. The cast cup 304 of the body 302 also includes a slot 371 in the sole portion of the golf club head 300. Further, the golf club head 300 additionally includes a mass element 359 and a mass receptacle 357 attached to the ring 306 of the body 302, as well as a weight 373 attached to the cast cup 304 via a fastener 379.

Additionally, like the golf club head 200, the golf club head 300 includes a strike plate 343, defining a strike face 145, that is formed separate from and attached to the cast cup 304. The strike plate 343 is made of a fiber-reinforced polymer in some examples and includes a base portion 347 and a cover 349 applied onto the base portion 347. The base portion 347 is thicker compared to the cover 349, the base portion 347 is made of a fiber-reinforced polymer, and the cover 349 is made of a fiber-less polymer in some examples. The cover 349 is made of polyurethane in certain examples. Also, the cover 349 includes grooves 351 or scorelines formed in the fiber-less polymer. The surface roughness of the portion of the cover 349 that defines the strike face 345 is greater than the surface roughness of the body 302. Accordingly, in view of the foregoing, the golf club head 300 shares some similarities with the golf club head 100 and the golf club head 200.

Unlike the illustrated examples of the cast cup 104 of the golf club head 100 and the cast cup 204 of the golf club head 200, however, the cast cup 304 has a multi-piece construction. More specifically, the cast cup 304 includes an upper cup piece 304A and a lower cup piece 304B. The upper cup piece 304A is formed separately from the lower cup piece 304B. Accordingly, the upper cup piece 304A and the lower cup piece 304B are joined or attached together to form the cast cup 304. Because the upper cup piece 304A and the lower cup piece 304B are formed separately, the upper cup piece 304A can be made of a material that is different than that of the lower cup piece 304B. The cast cup 304 includes a hosel 320 where a portion of the hosel 320 is formed into the upper cup piece 304A and another portion of the hosel 320 is formed into the lower cup piece 304B.

According to some examples, the upper cup piece 304A is made of a material that is different than that of the lower cup piece 304B. For example, the upper cup piece 304A can be made of a material with a density that is lower than the material of the lower cup piece 304B. In one example, the upper cup piece 304A is made of a titanium alloy and the lower cup piece 304B is made of a steel alloy. According to another example, the upper cup piece 304A is made of an aluminum alloy and the lower cup piece 304B is made of a steel alloy or a tungsten alloy, such as 10-17 density tungsten. Such configurations help to increase the mass of the cast cup 304 and lower the center-of-gravity (CG) of the cast cup 304 and the golf club head 300 compared to the single-piece cast cup 104 of the golf club head 100. In alternative configurations, according to some examples, the upper cup piece 304A is made of an aluminum alloy and the lower cup piece 304B is made of a titanium alloy. These later configurations help to lower the overall mass of the cast cup 304. According to some examples, the upper cup piece 304A and the lower cup piece 304B are made using different manufacturing techniques. For example, the upper cup piece 304A can be made by stamping, forging, and/or metal-injection-molding (MIM) and the lower cup piece 304B can be made by another one or a different combination of stamping, forging, and/or metal-injection-molding (MIM). Various examples of combinations of materials and mass properties for the upper cup piece 304A and the lower cup piece 304B are shown in Table 2 below.

TABLE 2

| | Material | | Density (g/cc) | | Mass (g) | | CG (z-axis) (mm) | | Mass (g) | Delta-CG | Delta-CG |
|---|---|---|---|---|---|---|---|---|---|---|---|
| Example | Upper | Lower | Upper | Lower | Upper | Lower | Upper | Lower | Combined | Combined | Total Head |
| 1 | Ti-64 | Ti-64 | 4.4 | 4.4 | 37.5 | 37.5 | 15 | −15 | 75 | 0 | 0 |
| 2 | Ti-64 | Steel | 4.4 | 7.8 | 37.5 | 66.5 | 15 | −15 | 104.0 | −4.2 | −2.2 |
| 3 | Al-7075 | Steel | 2.8 | 7.8 | 23.9 | 66.5 | 15 | −15 | 90.3 | −7.1 | −3.2 |
| 4 | Al-7075 | W-10 | 2.8 | 10 | 23.9 | 85.2 | 15 | −15 | 109.1 | −8.4 | −4.6 |
| 5 | Al-7075 | Ti-64 | 2.8 | 4.4 | 23.9 | 37.5 | 15 | −15 | 61.4 | −3.3 | −1.0 |
| 6 | Al-7075 | Al-7075 | 2.8 | 2.8 | 23.9 | 23.9 | 15 | −15 | 47.7 | 0.0 | 0.0 |

As shown, the cast cup 304 includes a port 375 that receives and retains the weight 373. The port 375 is configured to retain the weight 373 in a fixed location on the sole portion of the golf club head 300. However, in other examples, the port 375 can be replaced with a weight track, similar to the weight track 279 of the golf club head 200, such that the weight 373 can be selectively adjustable and moved into any of various positions along the weight track. In this manner, a weight track, and a corresponding ledge or ledges of the weight track, can form part of one piece of a multi-piece cast cup.

Although the cast cup 304 is shown to have a two-piece construction, in other examples, the cast cup 304 has a three-piece construction or constructed with more than three pieces. According to one instance, the cast cup 304 has a crown-toe piece, a crown-heel piece, and a sole piece. The crown-toe piece and the crown-heel piece are made of titanium alloys and the sole piece is made of a steel alloy in certain implementations. The titanium alloy of the crown-toe piece can be the same as or different than the titanium alloy of the crown-heel piece.

Figure 19:
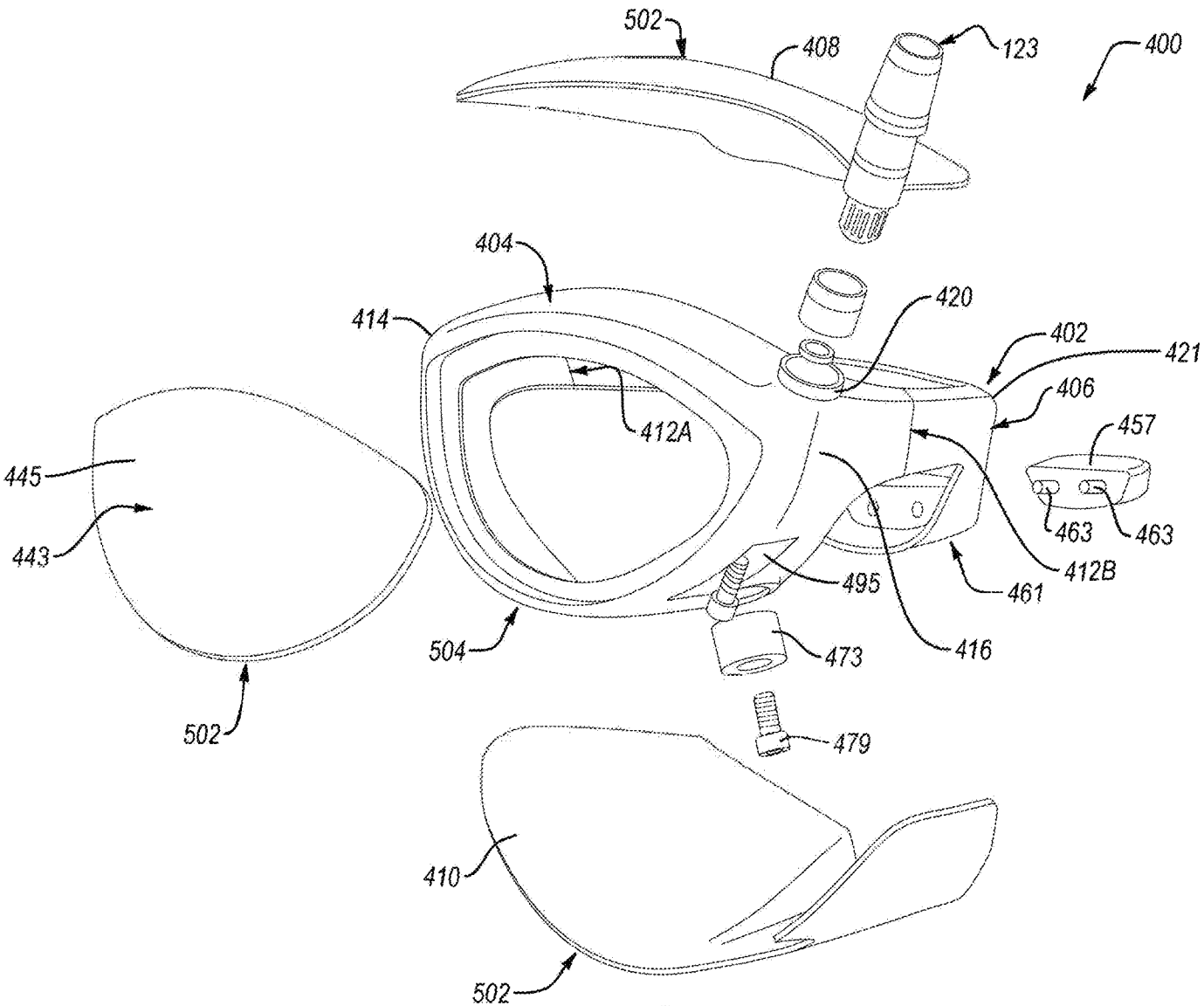
FIG. 19 is a schematic, exploded, perspective view of yet another golf club head, according to one or more examples of the present disclosure.
Figure 20:
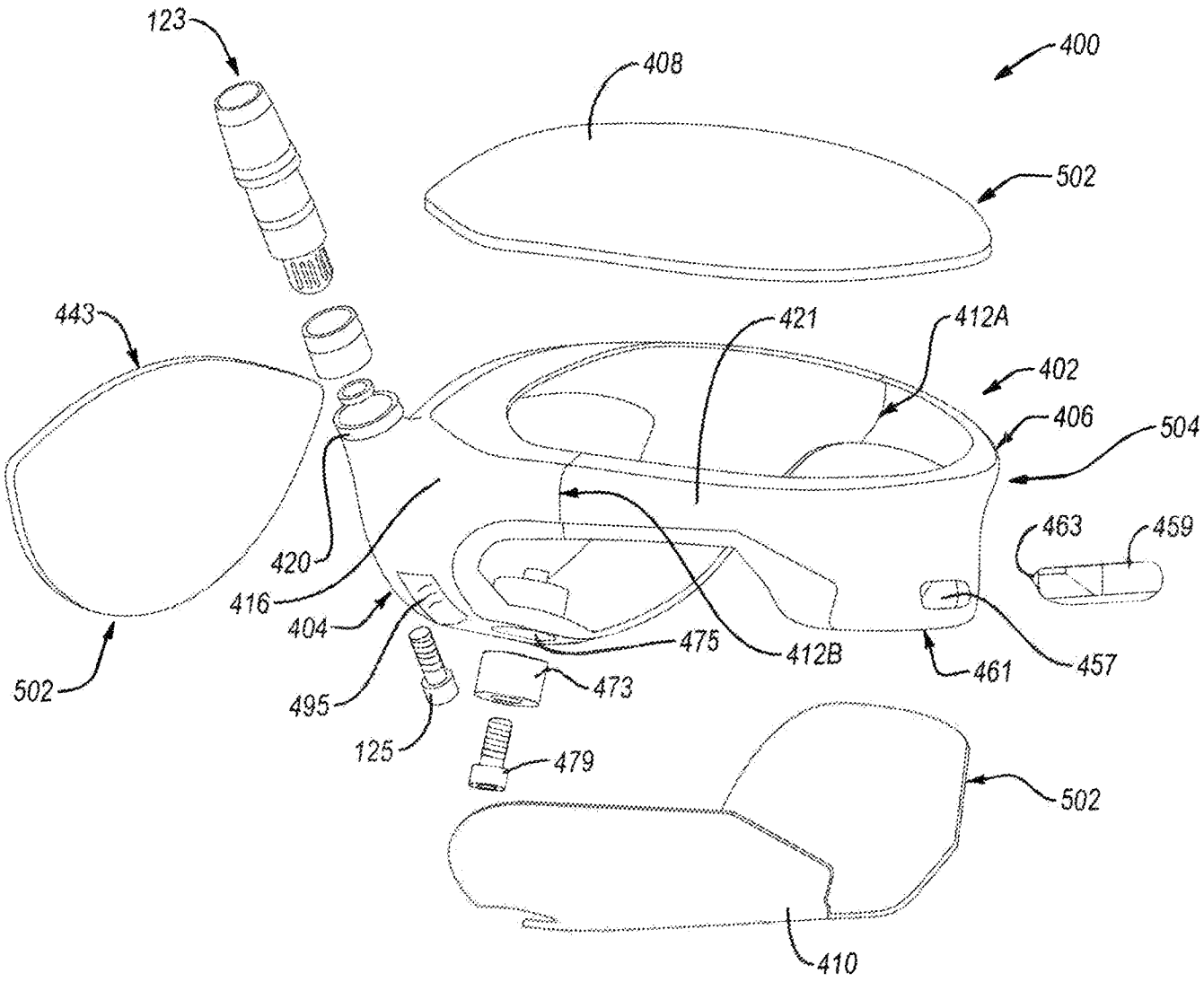
FIG. 20 is a schematic, exploded, perspective view of the golf club head of FIG. 19, according to one or more examples of the present disclosure.

Referring to FIGS. 19 and 20, and according to another example of a golf club head disclosed herein, a golf club head 400 is shown. The golf club head 400 includes features similar to the features of the golf club head 100, the golf club head 200, and the golf club head 300, with like numbers (e.g., same numbers but in 400-series) referring to like features. For example, like the golf club head 100, the golf club head 200, and the golf club head 300, the golf club head 400 includes a body 402, a crown insert 408 attached to the body 402 at a top of the golf club head 400, and a sole insert 410 attached to the body 402 at a bottom of the golf club head 400. The body 402 includes a cast cup 404 and a ring 406. The ring 406 is joined to the cast cup 404 at a toe-side joint 412A and a heel-side joint 412B. Additionally, like the golf club head 200 and the golf club head 300, the golf club head 400 includes a strike plate 443, defining a strike face 445, that is formed separate from and attached to the cast cup 404. Accordingly, in view of the foregoing, the golf club head 400 shares some similarities with the golf club head 100, the golf club head 200, and the golf club head 300.

Furthermore, the golf club head 400 additionally includes a weight 473 attached to the cast cup 404 via a fastener 479. As shown, the cast cup 404 includes a port 475 that receives and retains the weight 473. The port 475 is configured to retain the weight 473 in a fixed location on the sole portion of the golf club head 400. However, in other examples, the port 475 can be replaced with a weight track, similar to the weight track 279 of the golf club head 200, such that the weight 473 can be selectively adjustable and moved into any of various positions along the weight track. In this manner, a weight track, and a corresponding ledge or ledges of the weight track, can form part of the cast cup 404.

Also, like the golf club head 100, the golf club head 200, and the golf club head 300, the golf club head 400 additionally includes a mass element 459 and a mass receptacle 457. However, unlike some examples, of the receptacles of the previously discussed golf club heads, the mass receptacle 457 of the golf club head 400 forms a one-piece monolithic construction with a cantilevered portion 461 of the ring 406. Accordingly, in certain examples, the mass receptacle 457 is co-cast with the ring 406. The mass receptacle 457 includes an opening or recess that is configured to nestably receive the mass element 459. The mass element 459 can be made of a material, such as tungsten, that is different (e.g., denser) than the material of the ring 406. The mass element 459 is bonded, such as via an adhesive, to the ring 406 to secure the mass element 459 within the mass receptacle 457. In some examples, the mass element 459 includes prongs 463 that engage corresponding apertures in the mass receptacle 457 when bonded to the ring 406. Engagement between the prongs 463 and the corresponding apertures of the mass receptacle 457 help to strengthen and stiffen the coupling between the mass element 459 and the ring 406.

Referring to FIG. 21, the ring 406 includes a toe arm portion 463A that defines a toe side of a skirt portion 421 of the golf club head 400 and a heel arm portion 463B that defines a heel side of the skirt portion 421. Moreover, the toe arm portion 463A and the heel arm portion 463B define part of a toe portion 414 and a heel portion 416, respectively, of the golf club head 400 (see, e.g., FIGS. 19 and 20). The cantilevered portion 461 extends downwardly away from the toe arm portion 463A and the heel arm portion 463B, while the toe arm portion 463A and the heel arm portion 463B extend forwardly away from the cantilevered portion 461. Accordingly, the cantilevered portion 461 is closer to the ground plane 181 than the toe arm portion 463A and the heel arm portion 463B when the golf club head 400 is in the address position. In FIG. 21, the ring 406 is shown in a position corresponding with the position of the ring 406 when the golf club head 400 is in the address position relative to the ground plane 181.

In some examples, the height HR of the lowest surface (and in some examples, an entirety) of the toe arm portion 463A at the toe portion 414 of the golf club head 400 is different than the height HR of the lowest surface (and in some examples, an entirety) of the heel arm portion 463B at the heel portion 416 of the golf club head 400. More specifically, in one example, the height HR of the lowest surface of the toe arm portion 463A at the toe portion 414 of the golf club head 400 is greater than the height HR of the lowest surface of the heel arm portion 463B at the heel portion 416 of the golf club head 100.

According to certain examples, the width WR of the toe arm portion 463A of the ring 406 at the toe portion 414 is less than the width WR of the heel arm portion 463B of the ring 406 at the heel portion 416. According to some additional examples, a thickness (TR) of the ring 406 can vary along the ring 406 in a forward-to-rearward direction. For example, in some examples, the thickness TR of the ring 406 varies from a minimum thickness to a maximum thickness in a forward-to-rearward direction. In certain examples, as shown, the thickness TR of the toe arm portion 463A of the ring 406 at the toe portion 414 is less than the thickness TR of the heel arm portion 463B of the ring 406 at the heel portion 416.

The golf club heads disclosed herein, including the golf club head 100, the golf club head 200, and the golf club head 300, each has a volume, equal to the volumetric displacement of the golf club head, that is between 390 cubic centimeters ($cm^3$ or cc) and about 600 $cm^3$. In more particular examples, the volume of each one of the golf club heads disclosed herein is between about 350 $cm^3$ and about 500 $cm^3$ or between about 420 $cm^3$ and about 500 $cm^3$. The total mass of each one of the golf club heads disclosed herein is between about 145 g and about 245 g, in some examples, and between 185 g and 210 g in other examples.

The golf club heads disclosed herein have a multi-piece construction. For example, with regards to the golf club head 100, the cast cup 104, the ring 106, the crown insert 108, and the sole insert 110 each comprises one piece of the multi-piece construction. Because each piece of the multi-piece construction is separately formed and attached together, each piece can be made of a material different than at least one other of the pieces. Such a multi-material construction allows for flexibility of the material composition, and thus the mass composition and distribution, of the golf club heads.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the third material, the ring 106 is made of the second material, and the crown insert 108 and the sole insert 110 are made of the first material. In this first example, according to one instance, the cast cup 104 is made of a steel alloy, the ring 106 is made of a titanium alloy, and the crown insert 108 and the sole insert 110 are made of a fiber-reinforced polymeric material. In a second example, the cast cup 104 is made of the second and third material, the ring 106 is made of the first or the second material, and the crown insert 108 and the sole insert 110 are made of the first material. In this second example, according to one instance, the cast cup 104 is made of a steel alloy and a titanium alloy, the ring 106 is made of a titanium alloy, aluminum alloy, or plastic, and the crown insert 108 and the sole insert 110 are made of a fiber-reinforced polymeric material.

According to some examples, the at least one first material has a first mass no more than 55% of the total mass of the golf club head 100 and no less than 25% of the total mass of the golf club head 100 (e.g., between 50 g and 110 g). In certain examples, the first mass of the at least one first material is no more than 45% of the total mass of the golf club head 100 and no less than 30% of the total mass of the golf club head 100. The first mass of the at least one first material can be greater than the second mass of the at least one second material. Alternatively, or additionally, the first mass of the at least one first material can be within 10 g of the second mass of the at least one second material.

In some examples, the at least one second material has a second mass no more than 65% of the total mass of the golf club head 100 and no less than 20% of the total mass of the golf club head 100 (e.g., between 40 g and 130 g). According to certain examples, the second mass of the at least one second material is no more than 50% of the total mass of the golf club head 100. The second mass of the at least one second material is less than two times the first mass of the at least one first material in certain examples. The second mass of the at least one second material is between 0.9 times and 1.8 times the first mass of the at least one first material in some examples. In one example, the second mass of the at least one second material is less than 0.9 times, or less than 1.8 times, the first mass of the at least one first material.

The at least one third material has a third mass equal to the total mass of the golf club head 100 less the first mass of the at least one first material and the second mass of the at least one second material. In one example, the third mass of the at least one third material is no less than 5% of the total mass of the golf club head 100 and no more than 50% of the total mass of the golf club head 100 (e.g., between 10 g and 100 g). According to another example, the third mass of the at least one third material is no less than 10% of the total mass of the golf club head 100 and no more than 20% of the total mass of the golf club head 100.

According to one example, the cast cup 104 of the body 102 of the golf club head 100 is made from the at least one first material and the at least one first material is a first metal material that has a density between 4.0 g/cc and 8.0 g/cc. In this example, the ring 106 of the body 102 of the golf club head 100 is made of a material that has a density between 0.5 g/cc and 4.0 g/cc. According to certain implementations, the first metal material of the cast cup 104 is a titanium alloy and/or a steel alloy and the material of the ring 106 is an aluminum alloy and/or a magnesium alloy. In some implementations, the first metal material of the cast cup 104 is a titanium alloy and/or a steel alloy and the material of the ring 106 is a non-metal material, such as a plastic or polymeric material. Accordingly, in some examples, the ring 106 is made of any of various materials, such as titanium alloys, aluminum alloys, and fiber-reinforced polymeric materials.

The ring 106, in some examples, is made of one of 6000-series, 7000-series, or 8000-series aluminum, which can be anodized to have a particular color the same as or different than the cast cup 104. According to some examples, the ring 106 can be anodized to have any one of an array of colors, including blue, red, orange, green, purple, etc. Contrasting colors between the ring 105 and the cast cup 104 may help with alignment or suit a user's preferences. In one example, the ring 106 is made of 7075 aluminum. According to some examples, the ring 106 is made of a fiber-reinforced polycarbonate material. The ring 106 can be made from a plastic with a non-conductive vacuum metallizing coating, which may also have any of various colors. Accordingly, in certain examples, the ring 106 is made of a titanium alloy, a steel alloy, a boron-infused steel alloy, a copper alloy, a beryllium alloy, composite material, hard plastic, resilient elastomeric material, carbon-fiber reinforced thermoplastic with short or long fibers. The ring 106 can be made via an injection molded, cast molded, physical vapor deposition, or CNC milled technique.

As described herein, the ring (e.g., the ring 106) of any of the club heads disclosed herein can comprise various different materials and features, and be made of different materials and have different properties than the cast cup (e.g., the cast cup 104), which is formed separately and later coupled to the ring. In addition to or alternative to other materials described herein, the ring can comprise metallic materials, polymeric materials, and/or composite materials, and can include various external coatings.

In some embodiments, the ring comprises anodized aluminum, such as 6000, 7000, and 8000 series aluminum. In one specific example, the ring comprises 7075 grade aluminum. The anodized aluminum can be colored, such as red, green, blue, gray, white, orange, purple, pink, fuchsia, black, clear, yellow, gold, silver, or metallic colors. In some embodiments, the ring can have a color that contrasts from a majority color located on other parts of the club head (e.g., the crown insert, the sole insert, the cup, the rear weight, etc.).

In some embodiments, the ring can comprise any combination of metals, metal alloys (e.g., Ti alloys, steel, boron infused steel, aluminum, copper, beryllium), composite materials (e.g., carbon fiber reinforced polymer, with short or long fibers), hard plastics, resilient elastomers, other polymeric materials, and/or other suitable materials. Any material selection for the ring can also be combined with any of various formation methods, such as any combination of the following: casting, injection molding, sintering, machining, milling, forging, extruding, stamping, and rolling.

A plastic ring (fiber reinforced polycarbonate ring) may offer both mass savings e.g. about 5 grams compared to an aluminum ring, cost savings as well, give greater design flexibility due to processes used to form the ring e.g. injection molded thermoplastic, and perform similarly to an aluminum ring in abuse testing e.g. slamming the club head into a concrete cart path (extreme abuse) or shaking it in a bag where other metal clubs can repeatedly impact it (normal abuse).

In some embodiments, the ring can comprise a polymeric material (e.g., plastic) with a non-conductive vacuum metallizing (NCVM) coating. For example, in some embodiments, the ring may include a primer layer having an average thickness of about 5-11 micrometers (μm) or about 8.5 μm, and under coating layer on top of the primer layer having an average thickness of about 5-11 μm or about 8.5 μm, a NCVM layer on top of under coating layer having an average thickness of about 1.1-3.5 μm or about 2.5 μm, a color coating layer on top of the NCVM layer having an average thickness of about 25-35 μm or about 29 μm, and a top coating (UV protection coat) outer layer on top of the color coating layer having an average thickness of about 20-35 μm or about 26 μm. In general, for a NCVM coated part or ring the NCVM layer will be the thinnest and the color coating layer and the top coating layers will be the thickest and generally about 8-15 times thicker than NCVM layer. Generally, all the layers will combine to have a total average thickness of about 60-90 μm or about 75 μm. The described layers and NCVM coating could be applied to other parts other than the ring, such as the crown, sole, forward cup, and removable weights, and it can be applied prior to assembly.

In some embodiments, the ring can comprise a physical vapor deposition (PVD) coating or film layer. In some embodiments, the ring can include a paint layer, or other outer coloring layer. Conventionally, painting a golf club heads is all done by hand and requires masking various components to prevent unwanted spray on unwanted surfaces. Hand painting, however, can lead to great inconsistency from club to club. Separately forming the ring not only allows for greater access to the rearward portion of the face for milling operations to remove unwanted alpha case and allows for machining in various face patterns, but it also eliminates the need for masking off various components. The ring can be painted in isolation prior to assembly. Or in the case of anodized aluminum, no painting may be necessary, eliminating a step in the process such that the ring can simply be bonded or attached to a cup that may also be fully finished. Similarly if the ring is coated using PVD or NCVM, this coating can be applied to the ring prior to assembly, again eliminating several steps. This also allows for attachment of various color rings that may be selectable by an end user to provide an alignment or aesthetic benefit to the user. Whether the ring is a NCVM coated ring or a PVD coated ring, as mentioned above, it can be colored an array of colors, such as red, green, blue, gray, white, orange, purple, pink, fuchsia, black, clear, yellow, gold, silver, or metallic colors.

The following properties of the golf club heads disclosed herein proceeds with reference to the golf club head 100. However, unless otherwise noted, the properties described with reference to the golf club head 100 also apply to the golf club head 200, the golf club head 300, and the golf club head 400. The golf club head 100 is made from two of at least one first material, having a density between 0.9 g/cc and 3.5 g/cc, at least one second material, having a density between 3.6 g/cc and 5.5 g/cc, and at least one third material, having a density between 5.6 g/cc and 20.0 g/cc. In a first example, the cast cup 104 is made of the second material and the ring 106, the crown insert 108, and the sole insert 110 are made of the first material. In this first example, according to one instance, the cast cup 104 is made of a titanium alloy, the ring 106 is made of an aluminum alloy, and the crown insert 108 and the sole insert 110 are made of a fiber-reinforced polymeric material. In this first example, according to another instance, the cast cup 104 is made of a titanium alloy, the ring 106 is made of plastic, and the crown insert 108 and the sole insert 110 are made of a fiber-reinforced polymeric material. According to a second example, the cast cup 104 is made of the second material, the ring 106 is made of the second material, and the crown insert 108 and the sole insert 110 are made of the first material. In this second example, according to one instance, the cast cup 104 and the ring 106 are made of a titanium alloy and the crown insert 108 and the sole insert 110 are made of a fiber-reinforced polymeric material.

In some examples, the at least one first material is a fiber-reinforced polymeric material that includes continuous fibers embedded in a polymeric matrix (e.g., epoxy or resin), which is a thermoset polymer is certain examples. The continuous fibers are considered continuous because each one of the fibers is continuous across a length, width, or diagonal of the part formed by the fiber-reinforced polymeric material. The continuous fibers can be long fibers having a length of at least 3 millimeters, 10 millimeters, or even 50 millimeters. In other embodiments, shorter fibers can be used having a length of between 0.5 and 2.0 millimeters. Incorporation of the fiber reinforcement increases the tensile strength, however it may also reduce elongation to break therefore a careful balance can be struck to maintain sufficient elongation. Therefore, one embodiment includes 35-55% long fiber reinforcement, while in an even further embodiment has 40-50% long fiber reinforcement. The continuous fibers, as well as the fiber-reinforced polymeric material in general, can be the same or similar to that described in Paragraph 295 of U.S. Patent Application Publication No. 2016/0184662, published Jun. 30, 2016, now U.S. Pat. No. 9,468,816, issued Oct. 18, 2016, which is incorporated herein by reference in its entirety. In several examples, the crown insert 108 and the sole insert 110 are made of the fiber-reinforced polymeric material. Accordingly, in some examples, each one of the continuous fibers of the fiber-reinforced polymeric material does not extend from the crown portion 119 to the sole portion 117 of the golf club head 100. Alternatively, or additionally, in certain examples, each one of the continuous fibers of the fiber-reinforced polymeric material does not extend from the crown portion 119 to the forward portion 112 of the golf club head 100. The crown insert 108 is made of a material that has a density between 0.5 g/cc and 4.0 g/cc in one example. The sole insert 110 is made of a material that has a density between 0.5 g/cc and 4.0 g/cc in one example.

In certain examples, the first material is a fiber-reinforced polymeric material as described in U.S. patent application Ser. No. 17/006,561, filed Aug. 28, 2020. Composite materials that are useful for making club-head components comprise a fiber portion and a resin portion. In general the resin portion serves as a "matrix" in which the fibers are embedded in a defined manner. In a composite for club-heads, the fiber portion is configured as multiple fibrous layers or plies that are impregnated with the resin component. The fibers in each layer have a respective orientation, which is typically different from one layer to the next and precisely controlled. The usual number of layers for a striking face is substantial, e.g., forty or more. However for a sole or crown, the number of layers can be substantially decreased to, e.g., three or more, four or more, five or more, six or more, examples of which will be provided below. During fabrication of the composite material, the layers (each comprising respectively oriented fibers impregnated in uncured or partially cured resin; each such layer being called a "prepreg" layer) are placed superimposed on each other in a "lay-up" manner. After forming the prepreg lay-up, the resin is cured to a rigid condition. If interested, a specific strength may be calculated by dividing the tensile strength by the density of the material. This is also known as the strength-to-weight ratio or strength/weight ratio.

In tests involving certain club-head configurations, composite portions formed of prepreg plies having a relatively low fiber areal weight (FAW) have been found to provide superior attributes in several areas, such as impact resistance, durability, and overall club performance. FAW is the weight of the fiber portion of a given quantity of prepreg, in units of $g/m^2$. FAW values below 100 $g/m^2$, and more desirably below 70 $g/m^2$, can be particularly effective. A particularly suitable fibrous material for use in making prepreg plies is carbon fiber, as noted. More than one fibrous material can be used. In other embodiments, however, prepreg plies having FAW values below 70 $g/m^2$ and above 100 $g/m^2$ may be used. Generally, cost is the primary prohibitive factor in prepreg plies having FAW values below 70 $g/m^2$.

In particular embodiments, multiple low-FAW prepreg plies can be stacked and still have a relatively uniform distribution of fiber across the thickness of the stacked plies. In contrast, at comparable resin-content (R/C, in units of percent) levels, stacked plies of prepreg materials having a higher FAW tend to have more significant resin-rich regions, particularly at the interfaces of adjacent plies, than stacked plies of low-FAW materials. Resin-rich regions tend to reduce the efficacy of the fiber reinforcement, particularly since the force resulting from golf-ball impact is generally transverse to the orientation of the fibers of the fiber reinforcement. The prepreg plies used to form the panels desirably comprise carbon fibers impregnated with a suitable resin, such as epoxy.

Figure 26:
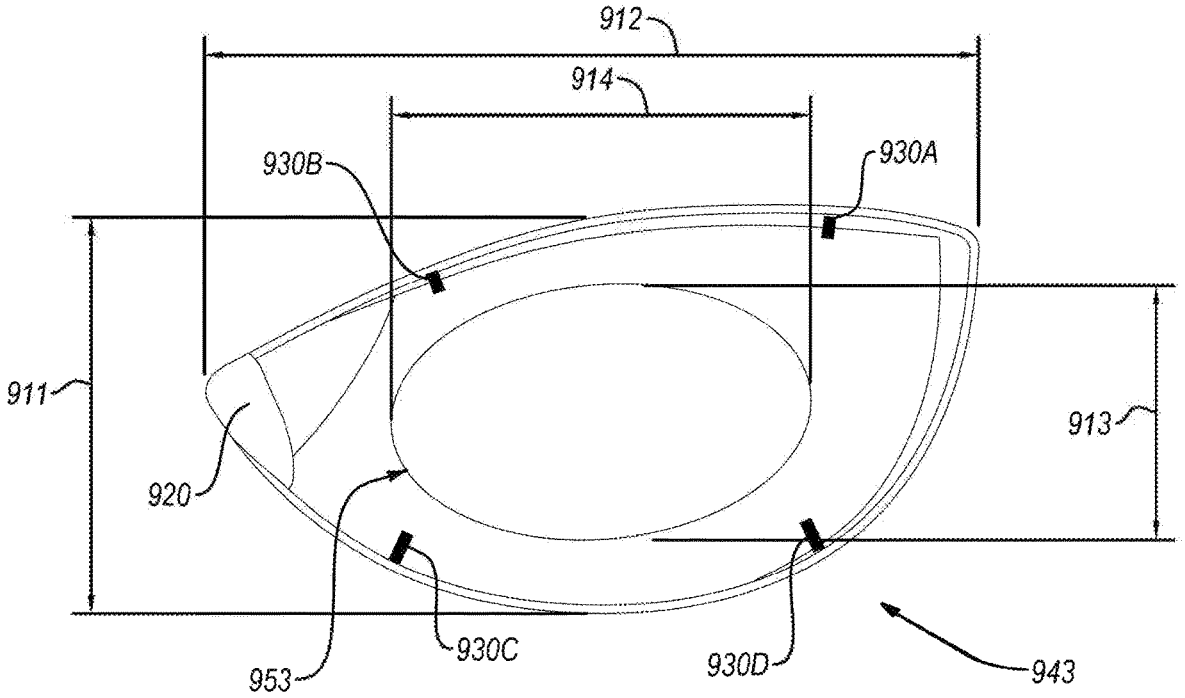
FIG. 26 is a schematic, front elevation view of a strike plate of a golf club head, according to one or more examples of the present disclosure.

FIG. 26 is a front elevation view of a strike plate 943, which can replace any one of the strike plates disclosed herein. The strike plate 943 is made of composite materials, and can be termed a composite strike plate in some examples. The non-metal or composite material of the strike plate 943 comprises a fiber-reinforced polymer comprising fibers embedded in a resin. A percent composition of the resin in the fiber-reinforced polymer is between 38% and 44%. Further details concerning the construction and manufacturing processes for the composite strike plate 943 are described in U.S. Pat. No. 7,871,340 and U.S. Published Patent Application Nos. 2011/0275451, 2012/0083361, and 2012/0199282, which are incorporated herein by reference. The composite strike plate 943 is attached to an insert support structure located at the opening at the front portion of a golf club head, such as one disclosed herein.

In some examples, the strike plate 943 can be machined from a composite plaque. In an example, the composite plaque can be substantially rectangular with a length between about 90 mm and about 130 mm or between about 100 mm and about 120 mm, preferably about 110 mm+1.0 mm, and a width between about 50 mm and about 90 mm or between about 6 mm and about 80 mm, preferably about 70 mm+1.0 mm plaque size and dimensions. The strike plate 943 is then machined from the plaque to create a desired face profile. For example, the face profile length 912 can be between about 80 mm and about 120 mm or between about 90 mm and about 110 mm, preferably about 102 mm. The face profile width 911 can be between about 40 mm and about 65 mm or between about 45 mm and about 60 mm, preferably about 53 mm. The height 913 of a preferred impact zone 953 on the strike face, defined by the strike plate 943 and centered on a geometric center of the strike face, can be between about 25 mm and about 50 mm, between about 30 mm and about 40 mm, or between about 17 mm and about 45 mm, such as preferably about 34 mm. The length 914 of the preferred impact zone 953 can be between about 40 mm and about 70 mm, between about 28 mm and about 65 mm, or between about 45 mm and about 65 mm, preferably about 55.5 mm or 56 mm. In certain examples, the preferred impact zone 953 of the strike face defined by the strike plate 943 has an area between 500 $mm^2$ and 1,800 $mm^2$. Alternatively, the strike plate 943 can be molded to provide the desired face dimensions and profile.

Figure 27:
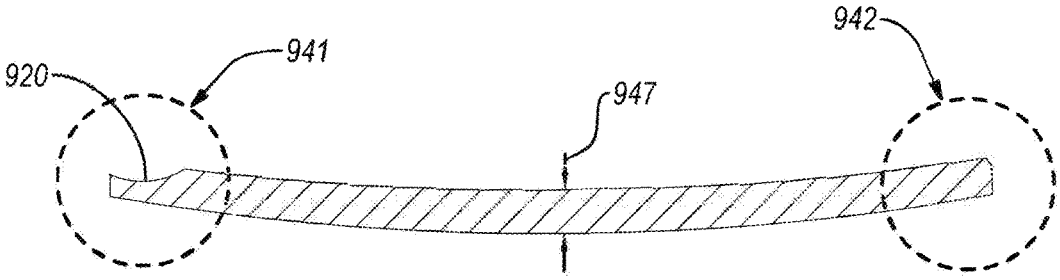
FIG. 27 is a schematic, bottom view of a strike plate of a golf club head, according to one or more examples of the present disclosure.

Additional features can be machined or molded into face the strike plate 943 to create the desired face profile. For example, as shown in FIG. 27, a notch 920 can be machined or molded into the backside of a heel portion of the strike plate 943. The notch 920 in the back of the strike plate 943 allows for the golf club head to utilize flight control technology (FCT) in the hosel, in some examples. The notch 920 can be configured to accept at least a portion of the hosel within the strike plate 943. Alternatively or additionally, the notch 920 can be configured to accept at least a portion of the club head body within the strike plate 943. The notch may allow for the reduction of center-face y-axis location (CFY) by accommodating at least a portion of the hosel and/or at least a portion of the club body within the strike plate 943, allowing the preferred impact zone 953 of the strike plate 943 to be closer to a plane passing through a center point location of the hosel. The strike plate 943 can be configured to provide a CFY no more than about 18 mm and no less than about 9 mm, preferably between about 11.0 mm and about 16.0 mm, and more preferably no more than about 15.5 mm and no less than about 11.5 mm. The strike plate 943 can be configured to provide face progression no more than about 21 mm and no less than about 12 mm, preferably no more than about 19.5 mm and no less than about 13 mm and more preferably no more than about 18 mm and no less than about 14.5 mm. In some embodiments, a difference between CFY and face progression is at least 3 mm and no more than 12 mm.

In another example, backside bumps 4230A, 4230B, 4230C, 4230D may be machined or molded into the backside of the strike plate 943. The backside bumps 4230A, 4230B, 4230C, 4230D can be configured to provide for a bond gap. A bond gap is an empty space between the club head body and the strike plate 943 that is filled with adhesive during manufacturing. The backside bumps 4230A, 4230B, 4230C, 4230D protrude to separate the face from the club head body when bonding the strike plate 943 to the club head body during manufacturing. In some examples, too large or too small of a bond gap may lead to durability issues of the club head, the strike plate 943, or both. Further, too large of a bond gap can allow too much adhesive to be used during manufacturing, adding unwanted additional mass to the club head. The backside bumps 4230A, 4230B, 4230C, 4230D can protrude between about 0.1 mm and 0.5 mm, preferably about 0.25 mm. In some embodiments, the backside bumps are configured to provide for a minimum bond gap, such as a minimum bond gap of about 0.25 mm and a maximum bond gap of about 0.45 mm.

Further, one or more of the edges of the strike plate 943 can be machined or molded with a chamfer. In an example, the strike plate 943 includes a chamfer substantially around the inside perimeter edge of the strike plate 943, such as a chamfer between about 0.5 mm and about 1.1 mm, preferably 0.8 mm.

FIG. 27 is a is a bottom perspective view of the strike plate 943. The strike plate 943 has a heel portion 941 and a toe portion 942. The notch 920 is machined or molded into the heel portion 941. In this example, the strike plate 943 has a variable thickness, such as with a peak thickness 947 within the preferred impact zone 953. The peak thickness 947 can be between about 2 mm and about 7.5 mm, between about 4.3 mm and 5.15 mm, between about 4.0 mm and about 5.15 or 5.5 mm, or between about 3.8 mm and about 4.8 mm, preferably 4.1 mm+0.1 mm, 4.25 mm+0.1 mm, or 4.5 mm+0.1 mm. The peak thickness 947 can be located at the geometric center of the strike face defines by the strike plate 943. A minimum thickness of the strike plate 943 is between 3.0 mm and 4.0 mm in some examples.

Additionally, in certain examples, the preferred impact zone 953 is off-center or offset relative to the geometric center of the strike face, and can be thicker toeward of the geometric center of the strike face. In some examples, the thickness of the strike plate 943 within the preferred impact zone 953 is variable (e.g., between about 3.5 mm and about 5.0 mm) and the thickness of the strike plate 943 outside of the preferred impact zone 953 is constant (e.g., between 3.5 mm and 4.2 mm) and less than within preferred impact zone 953. In some examples, the strike plate 943 have a thickness between 3.5 mm and 6.0 mm.

The strike plate 943 has a toe edge region and a heel edge region outside of the preferred impact zone 953 such that the preferred impact zone is between the toe edge region and the heel edge region. The toe edge region is closer to the toe portion than the heel edge region. The heel edge region is closer to the heel portion than the toe edge region. The toe edge region thickness is less than the maximum thickness. A thickness of the strike plate 943 transitions from the maximum thickness, within the preferred impact zone 953, to a toe edge region thickness, within the toe edge region, between 3.85 mm and 4.5 mm.

In some embodiments, the strike plate 943 is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike plate 943 with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike plate 943 in a localized area, such as in the center face at the preferred impact zone. Some Q's and C's can have additional or fewer plies (e.g., three-ply rather than four-ply), such as to fine tune the thickness, mass, localized thickness, and provide for other properties of the strike plate 943, such as to increase or decrease COR of the strike plate 943.

In some embodiments, the strike face, such as the strike plate 243, of some examples of the golf club head disclosed herein is manufactured from multiple layers of composite materials. Exemplary composite materials and methods for making the same are described in U.S. patent application Ser. No. 13/452,370 (published as U.S. Pat. App. Pub. No. 2012/0199282), which is incorporated by reference. In some embodiments, an inner and outer surface of the composite face can include a scrim layer, such as to reinforce the strike face with glass fibers making up a scrim weave. Multiple quasi-isotropic panels (Q's) can also be included, with each Q panel using multiple plies of unidirectional composite panels offset from each other. In an exemplary four-ply Q panel, the unidirectional composite panels are oriented at 90°, −45°, 0°, and 45°, which provide for structural stability in each direction. Clusters of unidirectional strips (C's) can also be included, with each C using multiple unidirectional composite strips. In an exemplary four-strip C, four 27 mm strips are oriented at 0°, 125°, 90°, and 55°. C's can be provided to increase thickness of the strike face, or other composite features, in a localized area, such as in the center face at the preferred impact zone. Some Q's and C's can have additional or fewer plies (e.g., three-ply rather than four-ply), such as to fine tune the thickness, mass, localized thickness, and provide for other properties of the strike face, such as to increase or decrease COR of the strike face.

Additional composite materials and methods for making the same are described in U.S. Pat. Nos. 8,163,119 and 10,046,212, which is incorporated by reference. For example, the usual number of layers for a strike plate is substantial, e.g., fifty or more. However, improvements have been made in the art such that the layers may be decreased to between 30 and 50 layers. According to one example, the strike plate, according to any of the various examples disclosed herein, when made of a fiber-reinforced polymeric material, can be made in a manner the same as, or similar to, that described in U.S. patent application Ser. No. 17/321,315, filed May 14, 2021, and U.S. Provisional Patent Application No. 63/312,771, filed Feb. 22, 2022, which are incorporated herein by reference in their entireties.

Table 3 below provide examples of possible layups of one or more of the composite parts of the golf club head disclosed herein. These layups show possible unidirectional plies unless noted as woven plies. The construction shown is for a quasi-isotropic layup. A single layer ply has a thickness of ranging from about 0.065 mm to about 0.080 mm for a standard FAW of 70 gsm with about 36% to about 40% resin content. The thickness of each individual ply may be altered by adjusting either the FAW or the resin content, and therefore the thickness of the entire layup may be altered by adjusting these parameters.

TABLE 3

| ply 1 | ply 2 | ply 3 | ply 4 | ply 5 | ply 6 | ply 7 | ply 8 | AW g/m$^2$ |
|---|---|---|---|---|---|---|---|---|
| 0 | −60 | +60 | | | | | | 290-360 |
| 0 | −45 | +45 | 90 | | | | | 390-480 |
| 0 | +60 | 90 | 60 | 0 | | | | 490-600 |
| 0 | +45 | 90 | −45 | 0 | | | | 490-600 |
| 90 | +45 | 0 | −45 | 90 | | | | 490-600 |
| +45 | 90 | 0 | 90 | −45 | | | | 490-600 |
| +45 | 0 | 90 | 0 | −45 | | | | 490-600 |
| −60 | −30 | 0 | +30 | 60 | 90 | | | 590-720 |
| 0 | 90 | +45 | −45 | 90 | 0 | | | 590-720 |
| 90 | 0 | +45 | −45 | 0 | 90 | | | 590-720 |
| 0 | 90 | 45 | −45 | −45 | 45 | 0/90 woven | | 680-840 |
| 90 | 0 | 45 | −45 | −45 | 45 | 90/0 woven | | 680-840 |
| +45 | −45 | 90 | 0 | 0 | 90 | −45/45 woven | | 680-840 |
| 0 | 90 | 45 | −45 | −45 | 45 | 90 UD | | 680-840 |
| 0 | 90 | 45 | −45 | 0 | −45 | 45 | 0/90 woven | 780-960 |
| 90 | 0 | 45 | −45 | 0 | −45 | 45 | 90/0 woven | 780-960 |

The Area Weight (AW) is calculated by multiplying the density times the thickness. For the plies shown above made from composite material the density is about 1.5 g/cm$^3$ and for titanium the density is about 4.5 g/cm$^3$.

In general, a composite face plate or composite face insert may have a peak thickness that varies between about 3.8 mm and 5.15 mm. In general, the composite face plate is formed from multiple composite plies or layers. The usual number of layers for a composite striking face is substantial, e.g., forty or more, preferably between 30 to 75 plies, more preferably, 50 to 70 plies, even more preferably 55 to 65 plies.

In an example, a first composite face insert can have a peak thickness of 4.1 mm and an edge thickness of 3.65 mm, including 12 Q's and 2 C's, resulting in a mass of 24.7 g. In another example, a second composite face insert can have a peak thickness of 4.25 mm and an edge thickness of 3.8 mm, including 12 Q's and 2 C's, resulting in a mass of 25.6 g. The additional thickness and mass is provided by including additional plies in one or more of the Q's or C's, such as by using two 4-ply Q's instead of two 3-ply Q's. In yet another example, a third composite face insert can have a peak thickness of 4.5 mm and an edge thickness of 3.9 mm, including 12 Q's and 3 C's, resulting in a mass of 26.2 g. Additional and different combinations of Q's and C's can be provided for a composite strike plate (e.g., face insert) with a mass between about 20 g and about 30 g, or between about 15 g and about 35 g. In some examples, wherein the strike plate, such as the strike plate 943, has a total mass between 22 grams and 28 grams.

Figure 28A:
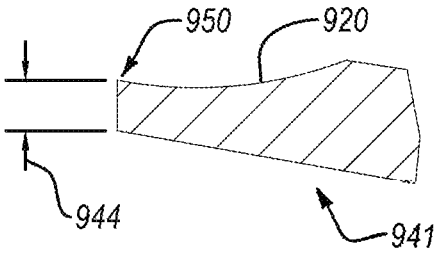
FIG. 28A is a schematic, bottom sectional view of a heel portion of a strike plate of a golf club head, according to one or more examples of the present disclosure.

FIG. 28A is a section view of a heel portion 941 of the strike plate 943. The heel portion 941 can include a notch 920. In embodiments with a chamfer on an inside edge of the strike plate 943, no chamfer 950 is provided on the notch 920. The notch 920 can have a notch edge thickness 944 less than the edge thickness 945 of the strike plate 943 (see, e.g., FIG. 28B). For example, the notch edge thickness 944 can be between 1.5 mm and 2.1 mm, preferably 1.8 mm.

Figure 28B:
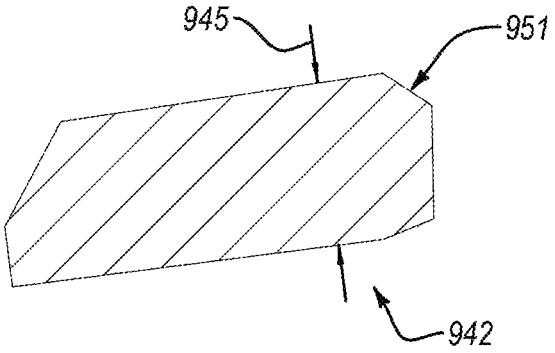
FIG. 28B a schematic, bottom sectional view of a toe portion of a strike plate of a golf club head, according to one or more examples of the present disclosure.

FIG. 28B is a section view of a toe portion 942 of the strike plate 943. The toe portion 942 includes a chamfer 951 on the inside edge of the strike plate 943. In some embodiments, the edge thickness 945 can be between about 3.35 mm and about 4.2 mm, preferably 3.65 mm+0.1 mm, 3.8 mm+0.1 mm, or 3.9 mm+0.1 mm.

Figure 29:
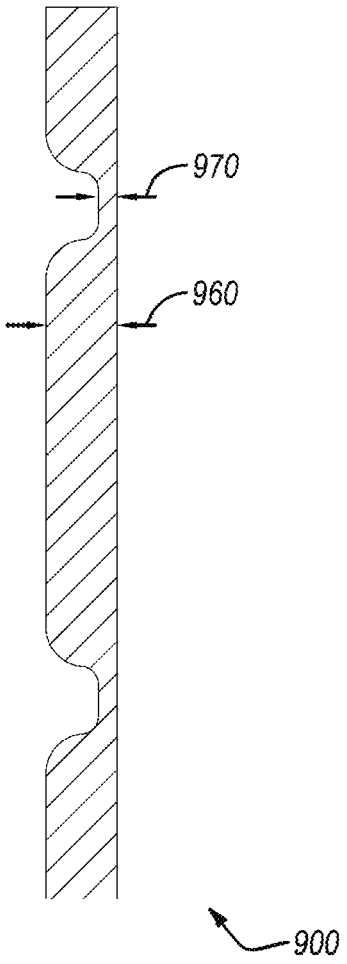
FIG. 29 is a schematic, sectional view of a polymer layer of a strike plate of a golf club head, according to one or more examples of the present disclosure.

FIG. 29 is a section view of a polymer layer 900 of the strike plate 943. The polymer layer 900 can be provided on the outer surface of the strike plate 943 to provide for better performance of the strike plate 943, such as in wet conditions. Exemplary polymer layers are described in U.S. patent application Ser. No. 13/330,486 (patented as U.S. Pat. No. 8,979,669), which is incorporated by reference. The polymer layer 900 may include polyurethane and/or other polymer materials. The polymer layer may have a polymer maximum thickness 960 between about 0.2 mm and 0.7 mm or about 0.3 mm and about 0.5 mm, preferably 0.40 mm+0.05 mm. The polymer layer may have a polymer minimum thickness 970 between about 0.05 mm and 0.15 mm, preferably 0.09 mm+0.02 mm. The polymer layer can be configured with alternating maximum thicknesses 960 and minimum thicknesses 970 to create score lines on the strike plate 943. Further, in some embodiments, teeth and/or another texture may be provided on the thicker areas of the polymer layer 900 between the score lines.

In some examples, the crown insert, such as the crown insert 108, and the sole insert, such as the sole insert 110, are made of a carbon-fiber reinforced polymeric material. In one example, the crown insert is made of layers of unidirectional tape, woven cloth, and composite plies.

Referring to FIG. 4, the golf club head 100 has a face-back dimension (FBD) defined as the distance between a hypothetical plane 169, passing through the center face 183 of the strike face 145 and parallel to the strike face 145, and a rearmost point on the golf club head 100 in a face-back direction 165 perpendicular to the hypothetical plane 169. As defined herein, the center face 183 is located at 0% of the face-back dimension (FBD) and the rearmost point is located at 100% of the face-back dimension (FBD). Under this definition, the golf club head 100 can be divided into a face section that extends, in the face-back direction 165, from 0% of the face-back dimension (FBD) to 25% of the face-back dimension (FBD), a middle section that extends, in the face-back direction 165, from 25% to 75% of the face-back dimension (FBD), and a back section that extends, in the face-back direction 165, from 75% to 100% of the face-back dimension (FBD). According to some examples, at least 95% by weight of the middle section is made of a material having a density between 0.9 g/cc and 4.0 g/cc. In certain examples, at least 95% by weight of the middle section is made of material having a density between 0.9 g/cc and 2.0 g/cc. In some examples, at least 95% by weight of the middle section and at least 95% by weight of the back section are made of a material having a density between 0.9 g/cc and 2.0 g/cc, excluding any attached weights and any housings for the attached weights. No more than 20% by weight of the middle section and no more than 20% by weight of the back section are made of a material having a density between 4.0 g/cc and 20.0 g/cc, according to various examples.

In some examples, the golf club head 100 includes one or more of the following materials: carbon steel, stainless steel (e.g. 17-4 PH stainless steel), alloy steel, Fe—Mn—Al alloy, nickel-based ferroalloy, cast iron, super alloy steel, aluminum alloy (including but not limited to 3000 series alloys, 5000 series alloys, 6000 series alloys, such as 6061-T6, and 7000 series alloys, such as 7075), magnesium alloy, copper alloy, titanium alloy (including but not limited to 6-4 titanium, 3-2.5, 6-4, SP700, 15-3-3-3, 10-2-3, Ti 9-1-1, ZA 1300, or other alpha/near alpha, alpha-beta, and beta/near beta titanium alloys) or mixtures thereof.

In one example, when forming part of the golf club heads disclosed herein, such as when forming part of the strike plate, the titanium alloy is a 9-1-1 titanium alloy. Titanium alloys comprising aluminum (e.g., 8.5-9.5% Al), vanadium (e.g., 0.9-1.3% V), and molybdenum (e.g., 0.8-1.1% Mo), optionally with other minor alloying elements and impurities, herein collectively referred to a "9-1-1 Ti", can have less significant alpha case, which renders HF acid etching unnecessary or at least less necessary compared to faces made from conventional 6-4 Ti and other titanium alloys. Further, 9-1-1 Ti can have minimum mechanical properties of 820 MPa yield strength, 958 MPa tensile strength, and 10.2% elongation. These minimum properties can be significantly superior to typical cast titanium alloys, such as 6-4 Ti, which can have minimum mechanical properties of 812 MPa yield strength, 936 MPa tensile strength, and ~6% elongation. In certain examples, the titanium alloy is 8-1-1 Ti.

In another example, when forming part of the golf club heads disclosed herein, such as when forming part of the strike plate, the titanium alloy is an alpha-beta titanium alloy comprising 6.5% to 10% Al by weight, 0.5% to 3.25% Mo by weight, 1.0% to 3.0% Cr by weight, 0.25% to 1.75% V by weight, and/or 0.25% to 1% Fe by weight, with the balance comprising Ti (one example is sometimes referred to as "1300" or "ZA1300" titanium alloy). The alpha-beta titanium alloy or ZA1300 titanium alloy has a first ultimate tensile strength of at least 1,000 MPa in some examples and at least 1,100 MPa in other examples. An ultimate tensile strength of the material forming the body 102, other than the strike face 145, can be less than the first ultimate tensile strength by at least 10%. In another representative example, the alloy may comprise 6.75% to 9.75% Al by weight, 0.75% to 3.25% or 2.75% Mo by weight, 1.0% to 3.0% Cr by weight, 0.25% to 1.75% V by weight, and/or 0.25% to 1% Fe by weight, with the balance comprising Ti. In yet another representative example, the alloy may comprise 7% to 9% Al by weight, 1.75% to 3.25% Mo by weight, 1.25% to 2.75% Cr by weight, 0.5% to 1.5% V by weight, and/or 0.25% to 0.75% Fe by weight, with the balance comprising Ti. In a further representative example, the alloy may comprise 7.5% to 8.5% Al by weight, 2.0% to 3.0% Mo by weight, 1.5% to 2.5% Cr by weight, 0.75% to 1.25% V by weight, and/or 0.375% to 0.625% Fe by weight, with the balance comprising Ti. In another representative example, the alloy may comprise 8% Al by weight, 2.5% Mo by weight, 2% Cr by weight, 1% V by weight, and/or 0.5% Fe by weight, with the balance comprising Ti (such titanium alloys can have the formula Ti-8Al-2.5Mo-2Cr-1V-0.5Fe). As used herein, reference to "Ti-8Al-2.5Mo-2Cr-1V-0.5Fe" refers to a titanium alloy including the referenced elements in any of the proportions given above. Certain examples may also comprise trace quantities of K, Mn, and/or Zr, and/or various impurities.

Ti-8Al-2.5Mo-2Cr-1V-0.5Fe can have minimum mechanical properties of 1150 MPa yield strength, 1180 MPa ultimate tensile strength, and 8% elongation. These minimum properties can be significantly superior to other cast titanium alloys, including 6-4 Ti and 9-1-1 Ti, which can have the minimum mechanical properties noted above. In some examples, Ti-8Al-2.5Mo-2Cr-1V-0.5Fe can have a tensile strength of from about 1180 MPa to about 1460 MPa, a yield strength of from about 1150 MPa to about 1415 MPa, an elongation of from about 8% to about 12%, a modulus of elasticity of about 110 GPa, a density of about 4.45 g/cm$^3$, and a hardness of about 43 on the Rockwell C scale (43 HRC). In particular examples, the Ti-8Al-2.5Mo-2Cr-1V-0.5Fe alloy can have a tensile strength of about 1320 MPa, a yield strength of about 1284 MPa, and an elongation of about 10%. The Ti-8Al-2.5Mo-2Cr-1V-0.5Fe alloy, particularly when used to cast golf club head bodies, promotes less deflection for the same thickness due to a higher ultimate tensile strength compared to other materials. In some implementations, providing less deflection with the same thickness benefits golfers with higher swing speeds because over time the face of the golf club head will maintain its original shape over time.

In yet certain examples, the golf club head 100 is made of a non-metal material with a density less than about 2 g/cm$^3$, such as between about 1 g/cm$^3$ to about 2 g/cm$^3$. The non-metal material may include a polymer, such as fiber-reinforced polymeric material. The polymer can be either thermoset or thermoplastic, and can be amorphous, crystalline and/or a semi-crystalline structure. The polymer may also be formed of an engineering plastic such as a crystalline or semi-crystalline engineering plastic or an amorphous engineering plastic. Potential engineering plastic candidates include polyphenylene sulfide ether (PPS), polyethelipide (PEI), polycarbonate (PC), polypropylene (PP), acrylonitrile-butadience styrene plastics (ABS), polyoxymethylene plastic (POM), nylon 6, nylon 6-6, nylon 12, polymethyl methacrylate (PMMA), polypheylene oxide (PPO), polybothlene terephthalate (PBT), polysulfone (PSU), polyether sulfone (PES), polyether ether ketone (PEEK) or mixtures thereof. Organic fibers, such as fiberglass, carbon fiber, or metallic fiber, can be added into the engineering plastic, so as to enhance structural strength. The reinforcing fibers can be continuous long fibers or short fibers. One of the advantages of PSU is that it is relatively stiff with relatively low damping which produces a better sounding or more metallic sounding golf club compared to other polymers which may be overdamped. Additionally, PSU requires less post processing in that it does not require a finish or paint to achieve a final finished golf club head.

One exemplary material from which any one or more of the sole insert 110, the crown insert 108, the cast cup 104, the ring 106, and/or the strike face, such as the strike plate 243, can be made from is a thermoplastic continuous carbon fiber composite laminate material having long, aligned carbon fibers in a PPS (polyphenylene sulfide) matrix or base. A commercial example of a fiber-reinforced polymer, from which the sole insert 110, the crown insert 108, and/or the strike face can be made, is TEPEX® DYNALITE 207 manufactured by Lanxess®. TEPEX® DYNALITE 207 is a high strength, lightweight material, arranged in sheets, having multiple layers of continuous carbon fiber reinforcement in a PPS thermoplastic matrix or polymer to embed the fibers. The material may have a 54% fiber volume, but can have other fiber volumes (such as a volume of 42% to 57%). According to one example, the material weighs 200 g/m$^2$. Another commercial example of a fiber-reinforced polymer, from which the sole insert 110, crown insert 108, and/or the strike face is made, is TEPEX® DYNALITE 208. This material also has a carbon fiber volume range of 42 to 57%, including a 45% volume in one example, and a weight of 200 g/m$^2$. DYNALITE 208 differs from DYNALITE 207 in that it has a TPU (thermoplastic polyurethane) matrix or base rather than a polyphenylene sulfide (PPS) matrix.

By way of example, the fibers of each sheet of TEPEX® DYNALITE 207 sheet (or other fiber-reinforced polymer material, such as DYNALITE 208) are oriented in the same direction with the sheets being oriented in different directions relative to each other, and the sheets are placed in a two-piece (male/female) matched die, heated past the melt temperature, and formed to shape when the die is closed. This process may be referred to as thermoforming and is especially well-suited for forming the sole insert 110, the crown insert 108, and/or the strike face. After the sole insert 110, the crown insert 108, and/or the strike face are formed (separately, in some implementations) by the thermoforming process, each is cooled and removed from the matched die. In some implementations, the sole insert 110, the crown insert 108, and/or the strike face has a uniform thickness, which facilitates use of the thermoforming process and ease of manufacture. However, in other implementations, the sole insert 110, the crown insert 108, and/or the strike face may have a variable thickness to strengthen select local areas of the insert by, for example, adding additional plies in select areas to enhance durability, acoustic properties, or other properties of the respective inserts.

In some examples, any one or more of the sole insert 110, the crown insert 108, the cast cup 104, the ring 106, and/or the strike face, such as the strike plate 243, can be made by a process other than thermoforming, such as injection molding or thermosetting. In a thermoset process, any one or more of the sole insert 110, the crown insert 108, the cast cup 104, the ring 106, and/or the strike face, such as the strike plate 243, may be made from "prepreg" plies of woven or unidirectional composite fiber fabric (such as carbon fiber composite fabric) that is preimpregnated with resin and hardener formulations that activate when heated. The prepreg plies are placed in a mold suitable for a thermosetting process, such as a bladder mold or compression mold, and stacked/oriented with the carbon or other fibers oriented in different directions. The plies are heated to activate the chemical reaction and form the crown insert 108 and/or a sole insert. Each insert is cooled and removed from its respective mold.

The carbon fiber reinforcement material for any one or more of the sole insert 110, the crown insert 108, the cast cup 104, the ring 106, and/or the strike face, such as the strike plate 243, made by the thermoset manufacturing process, may be a carbon fiber known as "34-700" fiber, available from Grafil, Inc., of Sacramento, California, which has a tensile modulus of 234 Gpa (34 Msi) and a tensile strength of 4500 Mpa (650 Ksi). Another suitable fiber, also available from Grafil, Inc., is a carbon fiber known as "TR50S" fiber which has a tensile modulus of 240 Gpa (35 Msi) and a tensile strength of 4900 Mpa (710 Ksi). Exemplary epoxy resins for the prepreg plies used to form the thermoset crown and sole inserts include Newport 301 and 350 and are available from Newport Adhesives & Composites, Inc., of Irvine, California. In one example, the prepreg sheets have a quasi-isotropic fiber reinforcement of 34-700 fiber having an areal weight between about 20 g/m^2 to about 200 g/m^2 preferably about 70 g/m^2 and impregnated with an epoxy resin (e.g., Newport 301), resulting in a resin content (R/C) of about 40%. For convenience of reference, the plipary composition of a prepreg sheet can be specified in abbreviated form by identifying its fiber areal weight, type of fiber, e.g., 70 FAW 34-700. The abbreviated form can further identify the resin system and resin content, e.g., 70 FAW 34-700/301, R/C 40%.

In some examples, polymers used in the manufacturing of the golf club head 100 may include without limitation, synthetic and natural rubbers, thermoset polymers such as thermoset polyurethanes or thermoset polyureas, as well as thermoplastic polymers including thermoplastic elastomers such as thermoplastic polyurethanes, thermoplastic polyureas, metallocene catalyzed polymer, unimodalethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, polyamides (PA), polyketones (PK), copolyamides, polyesters, copolyesters, polycarbonates, polyphenylene sulfide (PPS), cyclic olefin copolymers (COC), polyolefins, halogenated polyolefins [e.g. chlorinated polyethylene (CPE)], halogenated polyalkylene compounds, polyalkenamer, polyphenylene oxides, polyphenylene sulfides, diallylphthalate polymers, polyimides, polyvinyl chlorides, polyamide-ionomers, polyurethane ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference), ethylene vinyl acetates, polyureas, and polysiloxanes and any and all combinations thereof.

Of these preferred are polyamides (PA), polyphthalimide (PPA), polyketones (PK), copolyamides, polyesters, copolyesters, polycarbonates, polyphenylene sulfide (PPS), cyclic olefin copolymers (COC), polyphenylene oxides, diallylphthalate polymers, polyarylates, polyacrylates, polyphenylene ethers, and impact-modified polyphenylene ethers. Especially preferred polymers for use in the golf club heads of the present invention are the family of so called high performance engineering thermoplastics which are known for their toughness and stability at high temperatures. These polymers include the polysulfones, the polyethelipides, and the polyamide-imides. Of these, the most preferred are the polysufones.

Aromatic polysulfones are a family of polymers produced from the condensation polymerization of 4,4'-dichlorodiphenylsulfone with itself or one or more dihydric phenols. The aromatic polysulfones include the thermoplastics sometimes called polyether sulfones, and the general structure of their repeating unit has a diaryl sulfone structure which may be represented as -arylene-SO2-arylene-. These units may be linked to one another by carbon-to-carbon bonds, carbon-oxygen-carbon bonds, carbon-sulfur-carbon bonds, or via a short alkylene linkage, so as to form a thermally stable thermoplastic polymer. Polymers in this family are completely amorphous, exhibit high glass-transition temperatures, and offer high strength and stiffness properties even at high temperatures, making them useful for demanding engineering applications. The polymers also possess good ductility and toughness and are transparent in their natural state by virtue of their fully amorphous nature. Additional key attributes include resistance to hydrolysis by hot water/steam and excellent resistance to acids and bases. The polysulfones are fully thermoplastic, allowing fabrication by most standard methods such as injection molding, extrusion, and thermoforming. They also enjoy a broad range of high temperature engineering uses.

Three commercially important polysulfones are a) polysulfone (PSU); b) Polyethersulfone (PES also referred to as PESU); and c) Polyphenylene sulfoner (PPSU).

Particularly important and preferred aromatic polysulfones are those comprised of repeating units of the structure —C6H4SO2-C6H4-O— where C6H4 represents a m- or p-phenylene structure. The polymer chain can also comprise repeating units such as —C6H4-, C6H4-O—, —C6H4-(lower-alkylene)-C6H4-O—, —C6H4-O—C6H4-O—, —C6H4-S—C6H4-O—, and other thermally stable substantially-aromatic difunctional groups known in the art of engineering thermoplastics. Also included are the so called modified polysulfones where the individual aromatic rings are further substituted in one or substituents including or

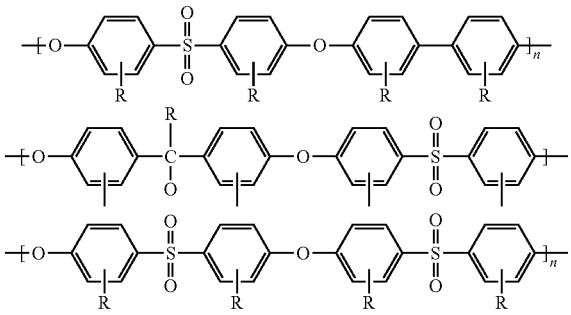

or wherein R is independently at each occurrence, a hydrogen atom, a halogen atom or a hydrocarbon group or a combination thereof. The halogen atom includes fluorine, chlorine, bromine and iodine atoms. The hydrocarbon group includes, for example, a C1-C20 alkyl group, a C2-C20 alkenyl group, a C3-C20 cycloalkyl group, a C3-C20 cycloalkenyl group, and a C6-C20 aromatic hydrocarbon group. These hydrocarbon groups may be partly substituted by a halogen atom or atoms, or may be partly substituted by a polar group or groups other than the halogen atom or atoms. As specific examples of the C1-C20 alkyl group, there can be mentioned methyl, ethyl, propyl, isopropyl, amyl, hexyl, octyl, decyl and dodecyl groups. As specific examples of the C2-C20 alkenyl group, there can be mentioned propenyl, isopropepyl, butenyl, isobutenyl, pentenyl and hexenyl groups. As specific examples of the C3-C20 cycloalkyl group, there can be mentioned cyclopentyl and cyclohexyl groups. As specific examples of the C3-C20 cycloalkenyl group, there can be mentioned cyclopentenyl and cyclohexenyl groups. As specific examples of the aromatic hydrocarbon group, there can be mentioned phenyl and naphthyl groups or a combination thereof.

Individual preferred polymers include (a) the polysulfone made by condensation polymerization of bisphenol A and 4,4'-dichlorodiphenyl sulfone in the presence of base, and having the main repeating structure

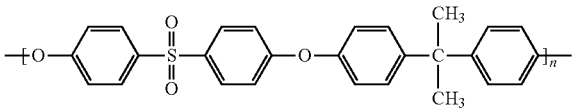

and the abbreviation PSF and sold under the tradenames Udel®, Ultrason® S, Eviva®, RTP PSU, (b) the polysulfone made by condensation polymerization of 4,4'-dihydroxydiphenyl and 4,4'-dichlorodiphenyl sulfone in the presence of base, and having the main repeating structure and the abbreviation PPSF and sold under the tradenames RADEL® resin; and (c) a condensation polymer made from 4,4'-dichlorodiphenyl sulfone in the presence of base and having the principle repeating

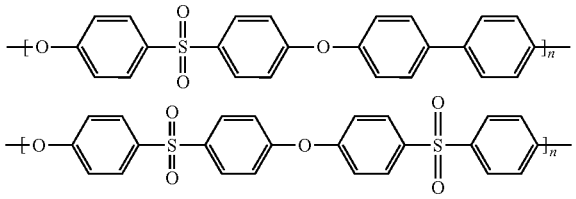

structure and the abbreviation PPSF and sometimes called a "polyether sulfone" and sold under the tradenames Ultrason® E, LNP™, VeradelRPESU, Sumikaexce, and VICTREX® resin," and any and all combinations thereof.

In some examples, one exemplary material from which any one or more of the sole insert 110, the crown insert 108, the cast cup 104, the ring 106, and/or the strike face, such as the strike plate 243, can be made from is a composite material, such as a carbon fiber reinforced polymeric material, made of a composite including multiple plies or layers of a fibrous material (e.g., graphite, or carbon fiber including turbostratic or graphitic carbon fiber or a hybrid structure with both graphitic and turbostratic parts present). Examples of some of these composite materials for use in the and their fabrication procedures are described in U.S. patents application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12/004,387, 11/960,609, 11/960,610, and 12/156,947, which are incorporated herein by reference in their entirety. The composite material may be manufactured according to the methods described at least in U.S. patent application Ser. No. 11/825,138, the entire contents of which are herein incorporated by reference.

Alternatively, short or long fiber-reinforced formulations of the previously referenced polymers can be used. Exemplary formulations include a Nylon 6/6 polyamide formulation, which is 30% Carbon Fiber Filled and available commercially from RTP Company under the trade name RTP 285. This material has a Tensile Strength of 35000 psi (241 MPa) as measured by ASTM D 638; a Tensile Elongation of 2.0-3.0% as measured by ASTM D 638; a Tensile Modulus of 3.30×106 psi (22754 MPa) as measured by ASTM D 638; a Flexural Strength of 50000 psi (345 MPa) as measured by ASTM D 790; and a Flexural Modulus of 2.60×106 psi (17927 MPa) as measured by ASTM D 790.

Other materials also include is a polyphthalamide (PPA) formulation which is 40% Carbon Fiber Filled and available commercially from RTP Company under the trade name RTP 4087 UP. This material has a Tensile Strength of 360 MPa as measured by ISO 527; a Tensile Elongation of 1.4% as measured by ISO 527; a Tensile Modulus of 41500 MPa as measured by ISO 527; a Flexural Strength of 580 MPa as measured by ISO 178; and a Flexural Modulus of 34500 MPa as measured by ISO 178.

Yet other materials include is a polyphenylene sulfide (PPS) formulation which is 30% Carbon Fiber Filled and available commercially from RTP Company under the trade name RTP 1385 UP. This material has a Tensile Strength of 255 MPa as measured by ISO 527; a Tensile Elongation of 1.3% as measured by ISO 527; a Tensile Modulus of 28500 MPa as measured by ISO 527; a Flexural Strength of 385 MPa as measured by ISO 178; and a Flexural Modulus of 23,000 MPa as measured by ISO 178.

Especially preferred materials include a polysulfone (PSU) formulation which is 20% Carbon Fiber Filled and available commercially from RTP Company under the trade name RTP 983. This material has a Tensile Strength of 124 MPa as measured by ISO 527; a Tensile Elongation of 2% as measured by ISO 527; a Tensile Modulus of 11032 MPa as measured by ISO 527; a Flexural Strength of 186 MPa as measured by ISO 178; and a Flexural Modulus of 9653 MPa as measured by ISO 178.

Also, preferred materials may include a polysulfone (PSU) formulation which is 30% Carbon Fiber Filled and available commercially from RTP Company under the trade name RTP 985. This material has a Tensile Strength of 138 MPa as measured by ISO 527; a Tensile Elongation of 1.2% as measured by ISO 527; a Tensile Modulus of 20685 MPa as measured by ISO 527; a Flexural Strength of 193 MPa as measured by ISO 178; and a Flexural Modulus of 12411 MPa as measured by ISO 178.

Further preferred materials include a polysulfone (PSU) formulation which is 40% Carbon Fiber Filled and available commercially from RTP Company under the trade name RTP 987. This material has a Tensile Strength of 155 MPa as measured by ISO 527; a Tensile Elongation of 1% as measured by ISO 527; a Tensile Modulus of 24132 MPa as measured by ISO 527; a Flexural Strength of 241 MPa as measured by ISO 178; and a Flexural Modulus of 19306 MPa as measured by ISO 178.

Any one or more of the sole insert 110, the crown insert 108, the cast cup 104, the ring 106, and/or the strike face, such as the strike plate 243, can have a complex three-dimensional shape and curvature corresponding generally to a desired shape and curvature of the golf club head 100. It will be appreciated that other types of club heads, such as fairway wood-type club heads, hybrid club heads, iron-type club heads, and putter-type golf club heads, may be manufactured using one or more of the principles, methods, and materials described herein.

Figure 33:
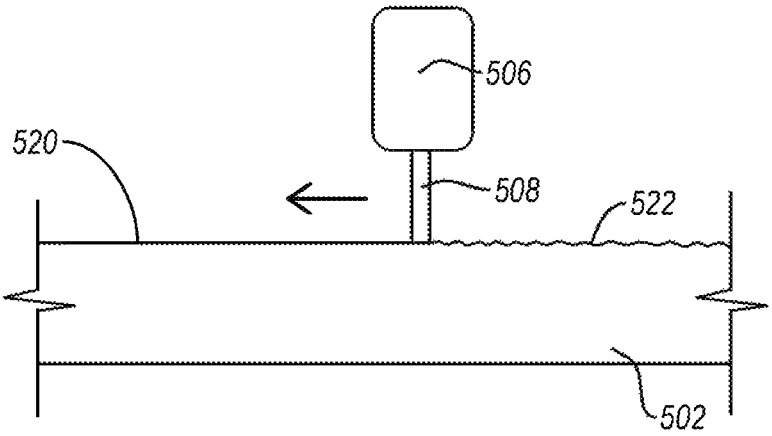
FIG. 33 is a schematic, side elevation view of a first part of a golf club head being laser ablated by a first laser, according to one or more examples of the present disclosure.
Figure 34:
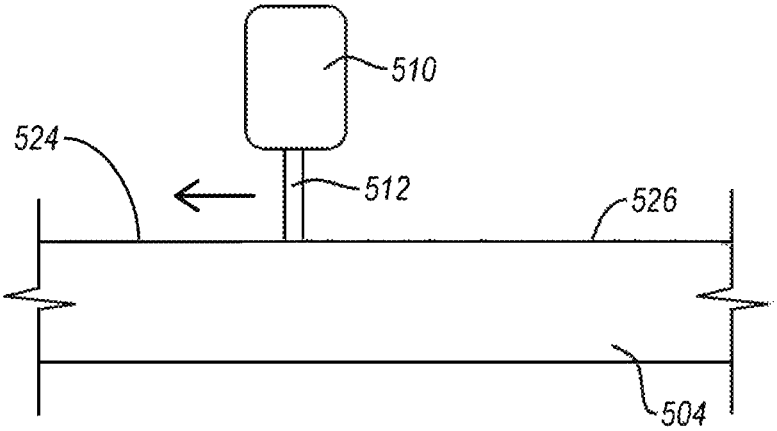
FIG. 34 is a schematic, side elevation view of a second part of a golf club head being laser ablated by a second laser, according to one or more examples of the present disclosure.
Figure 42:
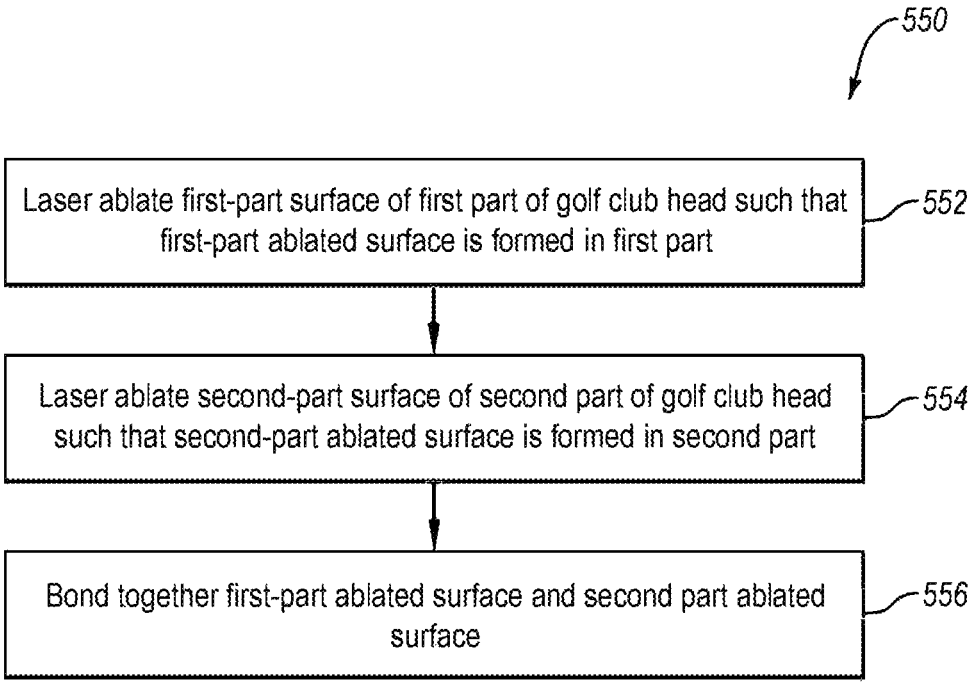
FIG. 42 is a schematic flow diagram of a method of making a golf club head, according to one or more examples of the present disclosure.

Referring to FIGS. 33, 34, and 42, according to some examples, a method 550 of making the golf club heads of the present disclosure, such as the golf club head 100, includes (block 552) laser ablating a first-part surface 520 of a first part 502 of a golf club head such that a first-part ablated surface 522 is formed in the first part 502. The method 550 also includes (block 554) laser ablating a second-part surface 524 of a second part 504 of the golf club head 100 such that a second-part ablated surface 526 is formed in the second part 504. The method 550 additionally includes (block 556) bonding together the first-part ablated surface 522 and the second-part ablated surface 526. Generally, the method 550 helps to produce bonding surfaces (i.e., faying surfaces) of a golf club head with features that promote strong and reliable bonds between the bonding surfaces. More specifically, the features formed by ablating the bonding surfaces of the golf club head with a laser promote an increase in the pattern uniformity and surface energy of the bonding surfaces, which helps to strengthen the bond between the bonding surfaces and increase the overall reliability and performance of the golf club head. Also, ablating the bonding surfaces with a laser enables the repeatability of surface characteristics across multiple parts and batches of parts. As defined herein, each one of the first-part ablated surface 522 and/or the second-part ablated surface 526 can be a single continuous surface or multiple spaced apart (e.g., intermittent) surfaces.

Conventional processes for bonding together surfaces of a golf club head, including surface preparation via non-laser ablation methods, may not provide a sufficient pattern uniformity and surface energy for producing strong and reliable bonds. For example, chemical ablation and media-blast ablation processes are unable to achieve pattern uniformities and surface energies of bonding surfaces that are achievable by the laser ablation of the present disclosure. The patterns of peaks and valleys on bonding surfaces ablated via a chemical ablation process or a media-blast ablation process are irregular and inconsistent, which leads to lower and non-uniform bonding strength across a bond between the bonding surfaces.

As shown in FIG. 33, a first-part laser 506 is configured to generate a first-part laser beam 508 and direct the first-part laser beam 508 at the first-part surface 520 of the first part 502. The first-part laser beam 508 impacts the first-part surface 520, which sublimates a portion of the first-part surface 520 up to a desired depth. More specifically, the energy of the first-part laser beam 508 is sufficient to transition the portion of the first-part surface 520 from a solid state directly to a gas state. In some examples, the desired depth is between 5 micrometers and 100 micrometers, between 20 micrometers and 50 micrometers, or approximately 30 micrometers. The gas sublimated from the first-part surface 520 can be suctioned away, such as by a vacuum pump (not shown).

The depth of the portion of the first-part surface 520 that is sublimated (e.g., removed) is dependent on the material of the first-part surface 520 and the characteristics of the first-part laser beam 508. The characteristics of the first-part laser beam 508 include the intensity (e.g., optical power per unit area) of, the pulse frequency of, and the duration of the impact on the first-part surface 520 by the first-part laser beam 508. After the portion of the first-part surface 520 is removed, the first-part ablated surface 522 is exposed. Accordingly, generally speaking, the first-part laser beam 508 removes a top surface of the first part 502 so that a fresh surface of the first part 502 is exposed. The first-part ablated surface 522 (e.g., fresh surface or exposed surface) is relatively free of contaminants (e.g., oxides, moisture, etc.) present on the first-part surface 520.

Similarly, as shown in FIG. 34, a second-part laser 510 is configured to generate a second-part laser beam 510 and direct the second-part laser beam 512 at the second-part surface 524 of the second part 504. The second-part laser beam 512 impacts the second-part surface 524, which sublimates a portion of the second-part surface 524 up to a desired depth. More specifically, the energy of the second-part laser beam 512 is sufficient to transition the portion of the second-part surface 524 from a solid state directly to a gas state. The gas sublimated from the second-part surface 524 can be suctioned away, such as by a vacuum pump (not shown). The depth of the portion of the second-part surface 524 that is sublimated is dependent on the material of the second-part surface 524 and the characteristics of the second-part laser beam 512. Like the first-part laser beam 508, the characteristics of the second-part laser beam 512 include the intensity (e.g., optical power per unit area) of, the pulse frequency of, and the duration of the impact on the second-part surface 524 by the second-part laser beam 512. Generally, the first-part laser beam 508 and the second-part laser beam 512 are highly focused beams of laser radiation. After the portion of the second-part surface 524 is removed, the second-part ablated surface 526 is exposed. Accordingly, generally speaking, the second-part laser beam 512 removes a top surface of the second part 504 so that a fresh surface of the second part 504 is exposed. The second-part ablated surface 526 is relatively free of contaminants present on the second-part surface 524.

In certain examples of the method 550, the first-part laser beam 508 is moved along the first-part surface 520 at a first-part rate to form the first-part ablated surface 522 in the first part 502. Similarly, in some examples, the second-part laser beam 510 is moved along the second-part surface 524 at a second-part rate to form the second-part ablated surface 526 in the second part 504. In this manner, a laser beam with a relatively small footprint can be used to form an ablated surface with a relatively larger surface area. Moreover, in various examples, a laser beam can be split into separate sub-beams, using optics, to move along and form separate portions of an ablated surface. Also, according to some examples, multiple laser beams generated from multiple lasers can be used to form an ablated surface in a single part. The rate at which a laser beam moves along a corresponding part is dependent on the type of material of the part. For example, a given laser beam may need to be moved along a given part at a faster rate, compared to another part, when the material of the given part sublimates faster than the material of the other part. In contrast, a given laser beam may need to be moved along a given part at a slower rate, compared to another part, when the material of the given part sublimates slower than the material of the other part.

The rate of sublimation, and thus the rate of movement of a laser beam along a part, is dependent on the type of laser generating the laser beam and the characteristics of the generated laser beam. Different types of lasers generate different types of laser beams. For example, a carbon-dioxide laser generates a laser beam that is different than the one generated by a fiber laser. Likewise, an Nd-YAG (neodymium-dopped yttrium aluminum garnet) laser generates a laser beam that is different than the ones generated by a carbon-dioxide laser and fiber laser, respectively. Additionally, in some examples, a laser can be selectively controlled to adjust characteristics of the generated laser. For example, a laser can be selectively controlled to adjust one or both of an intensity or pulse frequency of the generated laser. Generally, the higher the intensity of the laser beam or the higher the pulse frequency of the laser beam, the higher the rate of sublimation.

Figure 35:
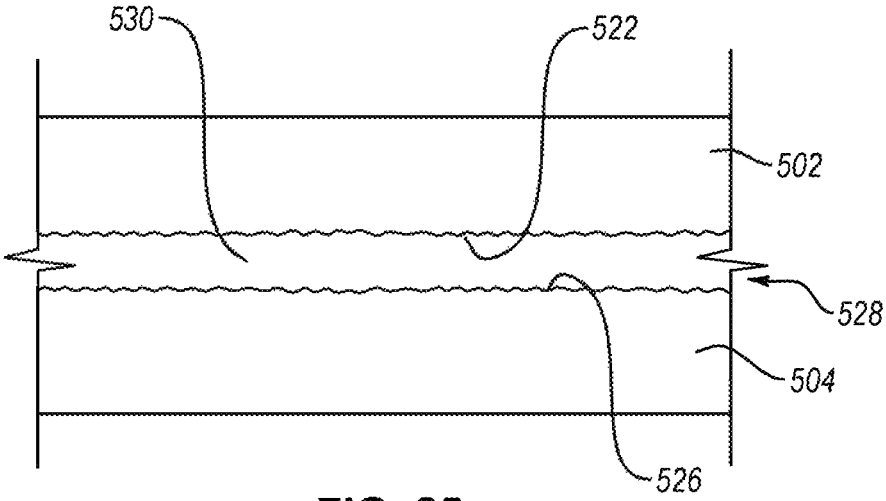
FIG. 35 is a schematic, side elevation view of a first part, of a golf club head, bonded to a second part, of the golf club head, according to one or more examples of the present disclosure.

After the first part 502 is laser ablated, to form the first-part ablated surface 522, and the second part 504 is laser ablated, to form the second-part ablated surface 526, the first-part ablated surface 522 and the second-part ablated surface 526 are bonded together. Referring to FIG. 35, the first-part ablated surface 522 and the second-part ablated surface 526, when facing each other, are bonded together along a bondline 528 to form a bonded joint. The bondline 528 is defined as the structure, including, but not limited to, the material, between the first-part ablated surface 522 and the second-part ablated surface 526. Accordingly, in certain examples, the first-part ablated surface 522 and the second-part ablated surface 526 are directly bonded together along the bondline 528. In other words, in such examples, other than the material of the bondline 528, no other intervening layer is interposed between the first-part ablated surface 522 and the second-part ablated surface 526. In some examples, the bondline 528 includes the bonding tape 174 when the first-part ablated surface 522 and the second-part ablated surface 526 are adhesively bonded. The bonding tape 174 has a maximum thickness and a minimum thickness, or alternatively an average thickness, along the bondline 528.

In some examples, the type of the first-part laser 506, the rate of movement of the first laser beam 508 (i.e., first-part rate), and/or the characteristics of the first-part laser beam 508 is dependent on the type of material of the first part 502. Similarly, in some examples, the type of the second-part laser 510, the rate of movement of the second-part laser beam 512 (i.e., second-part rate), and/or the characteristics of the second-part laser beam 512 is dependent on the type of material of the second part 504.

According to certain examples, the first part 502 is made of a first material and the second part is made of a second material, where the first material is different than the second material. In one example, the first part 502 is made of a first type of metallic material and the second part 504 is made of a second type of metallic material. In another example, the first part 502 is made of a first type of non-metallic material and the second part 504 is made of a second type of non-metallic material. In yet a further example, the first part 502 is made of a non-metallic material and the second part 504 is made of a metallic material. In the above examples, at least one of the type of the first-part laser 506, the rate of movement of the first-part laser beam 508, or the characteristics of the first-part laser beam 508 is different than the type of the second-part laser 510, the rate of movement of the second-part laser beam 512, or the characteristics of the second-part laser beam 512, respectively. According to some examples, the type of the first-part laser 506 is different than that of the second-part laser 510 (e.g., such that the first-part laser 506 is different than and separate from the second-part laser 510). In some examples, the first-part rate is different than the second-part rate. In one example, the intensity of the first-part laser beam 508 is different than the second-part laser beam 512. Additionally, or alternatively, according to certain examples, the pulse frequency of the first-part laser beam 508 is different than the pulse frequency of the second-part laser beam 512.

According to some examples, the first material is a fiber-reinforced polymeric material and the second material is a metallic material. In one example, the fiber-reinforced polymeric material is at least one of a glass-fiber-reinforced polymeric material or a carbon-fiber-reinforced polymeric material, such as one of those described above, and the metallic material is a titanium alloy, such as a cast titanium material. In these examples, at least one of: the first-part laser 506 is a carbon dioxide laser and the second-part laser 510 is a fiber laser; the first-part rate is slower than the second-part rate; the intensity of the first-part laser beam 508 is less than the intensity of the second-part laser beam 512; or the pulse frequency of the first-part laser beam 508 is less than the pulse frequency of the second-part laser beam 512. When the first-part rate is slower than the second-part rate, in some examples, the first-part rate is between 600 mm/s and 800 mm/s (e.g., 700 mm/s), and the second-part rate is between 600 mm/s and 800 mm/s (e.g., 700 mm/s). When the intensity of the first-part laser beam 508 is less than the intensity of the second-part laser beam 512, in certain examples, the intensity of the first-part laser beam 508 is between 40 watts and 60 watts, and the intensity of the second-part laser beam 512 is between 40 watts and 60 watts. When the pulse frequency of the first-part laser beam 508 is less than the pulse frequency of the second-part laser beam 512, in some examples, the pulse frequency of the first-part laser beam 508 is between 40 kHz and 60 kHz, and the pulse frequency of the second-part laser beam 512 is between 40 kHz and 60 kHz.

When either the first material of the first part 502 or the second material of the second part 504 is a fiber-reinforced polymeric material, which includes a plurality of reinforcement fibers embedded in a resin or epoxy matrix, the corresponding first-part surface 520 or the second-part surface 524 is defined entirely by the resin or epoxy matrix of the fiber-reinforced polymeric material. Accordingly, the first-part laser beam 508 or the second-part laser beam 512 impacts and ablates only the resin or epoxy matrix, without ablating the reinforcement fibers embedded therein. Moreover, in some examples, the first part 502 or the second part 504 is made of plies of a carbon-fiber-reinforced polymeric material sandwiched between opposing outer plies of a glass-fiber-reinforced polymeric material. In such examples, the corresponding laser beam impacts and ablates only the resin or epoxy matrix of the glass-fiber-reinforced polymeric material.

As presented previously, due the ability to precisely control the energy, pulse frequency, and directionality of a laser, laser ablation of a surface can result in a fresh (e.g., relatively uncontaminated) surface having a high uniformity of peaks and valleys, and a high surface energy. Generally, each pulse of the laser beam sublimates and removes a localized portion of the surface being ablated. The removed portion of the surface defines a valley (e.g., dimple or depression) that has a shape that corresponds with a cross-sectional shape of the laser beam and a depth that corresponds with the intensity and frequency of the laser beam. Because the laser beam is moved relative to the surface being ablated, each pulse of the laser beam contacts a different portion of the surface, which results in disparate and spaced apart valleys corresponding with the removed portions. Because the portions of the surface between the removed portions are not removed, the unremoved portions of the surface define peaks between diagonal ones of the valleys. In this manner, as the laser beam is moved relative to the surface, a pattern of peaks and valleys in the surface is formed.

Referring to FIG. 33, sublimation of the first-part surface 520 results in a first-part ablated surface 522 having a first-part ablation pattern of peaks and valleys. Similarly, referring to FIG. 34, sublimation of the second-part surface 524 results in a second-part ablated surface 526 having a second-part ablation pattern of peaks and valleys. Example of an ablation pattern of peaks of valleys, which can be representative of the first-part ablation pattern and the second-part ablation pattern, are shown in FIGS. 36, 37, 45, and 46.

Figure 36:
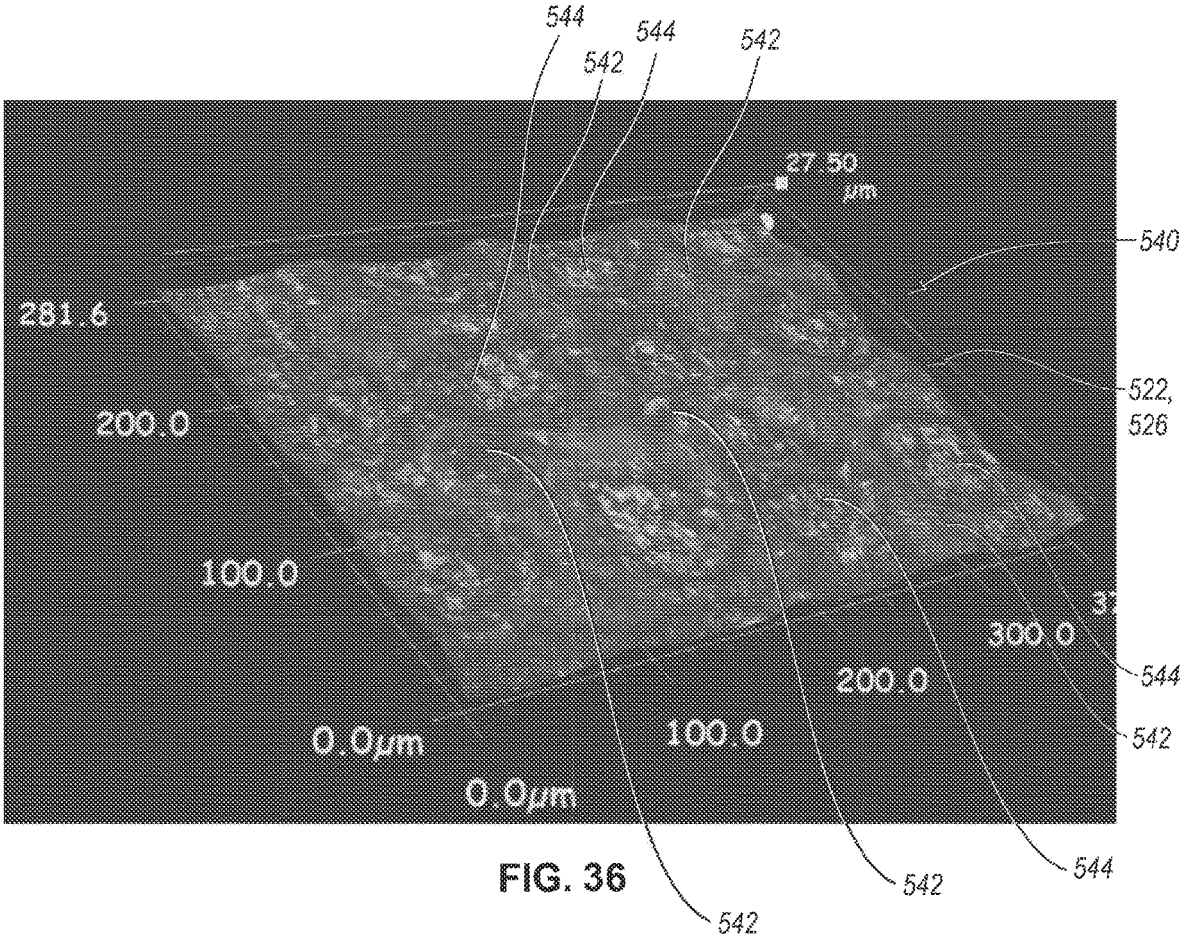
FIG. 36 is a schematic, perspective view of an ablation pattern, of peaks and valleys, of an ablated surface of a part of a golf club head, according to one or more examples of the present disclosure.
Figure 37:
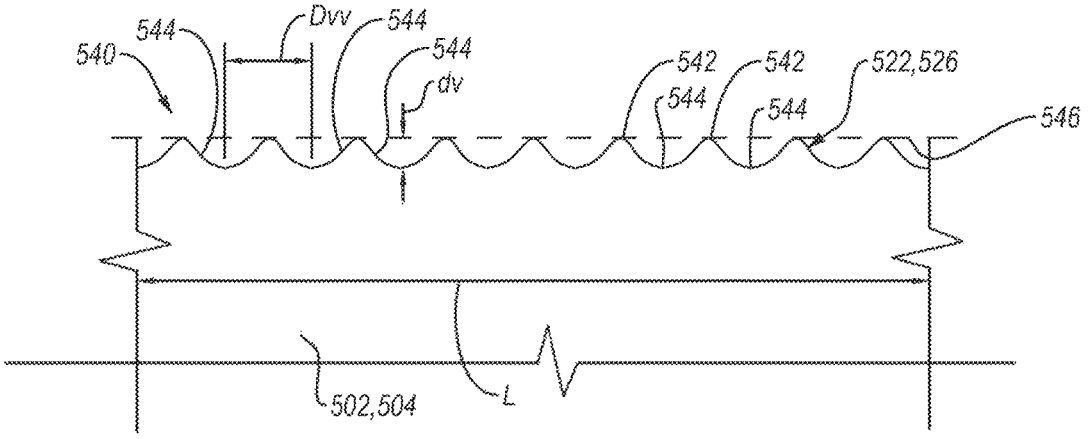
FIG. 37 is a schematic, side elevation view of an ablation pattern, of peaks and valleys, of an ablated surface of a part of a golf club head, according to one or more examples of the present disclosure.
Figure 45:
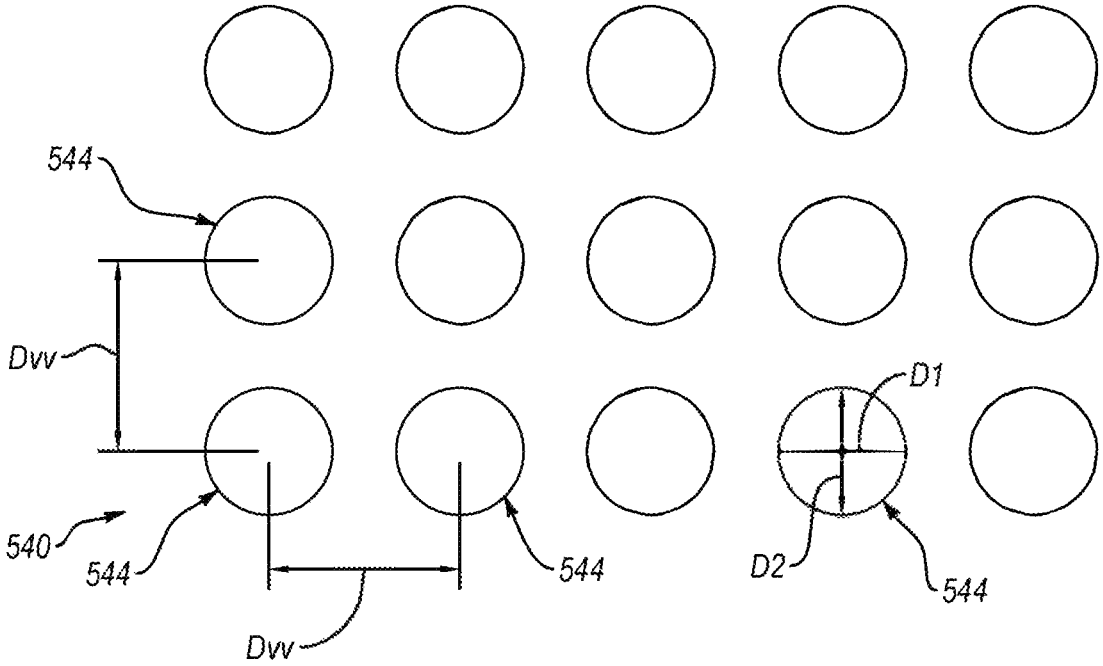
FIG. 45 is a schematic, top plan view of an ablation pattern on a part of a golf club head, according to one or more examples of the present disclosure.
Figure 46:
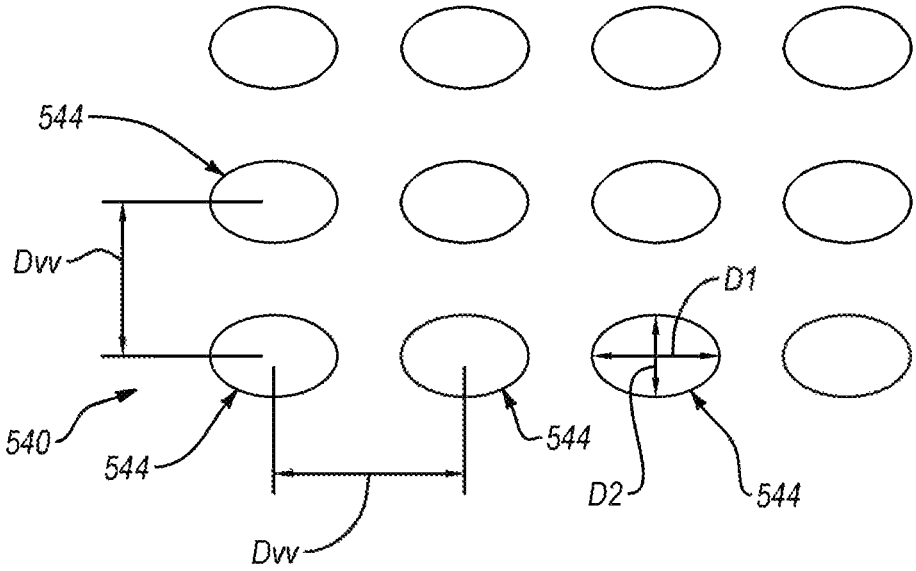
FIG. 46 is a schematic, top plan view of an ablation pattern on a part of a golf club head, according to one or more examples of the present disclosure.

An ablation pattern 540 includes a plurality of peaks 542 spaced apart by a plurality of valleys 544. Generally, the laser beam is moved and pulsed such that the valleys are located relative to each other to form a desired pattern. The pattern of valleys can be symmetrical or non-symmetrical. Moreover, the spacing between valleys can be uniform or non-uniform. In one example, such as shown in FIGS. 36, 45, and 46, the ablation pattern 540 is symmetrical and the spacing between the valleys of the ablation pattern 540 is uniform. As shown in FIG. 36, in one example of a symmetrical pattern, the valleys of the ablation pattern 540 are uniformly spaced and closely spaced together, which means each valley is contiguous with at least one adjacent valley and at least one adjacent peak of the pattern of peaks and valleys. In the illustrated example of FIG. 36, some valleys, of the ablation pattern 540 of peaks and valleys, are contiguous with four adjacent valleys and four adjacent peaks. Likewise, in the illustrated example of FIG. 36, some peaks, of the ablation pattern 540 of peaks and valleys, are contiguous with four adjacent peaks and four adjacent valleys.

In some examples, each one of the valleys 544 is separated from an adjacent one of the valleys 544, across one of the peaks 542 and along a length L (or width) of the part, by a valley-to-valley distance Dvv. The valley-to-valley distance Dvv is defined as the distance from a center point of one of the valleys 544 and the center point of an adjacent one of the valleys 544. Moreover, each one of the valleys 544 has a valley depth dv measured from a hypothetical boundary 546 that is generally co-planar with the surface prior to being laser ablated. Referring to FIGS. 45 and 46, each one of the valleys 544 has a major dimension D1 (e.g., maximum dimension) and a minor dimension D2 (e.g., minimum dimension). The major dimension D1 is equal to or less than the minor dimension D2. For example, with reference to FIG. 45, when each one of the valleys 544 is substantially circular, the major dimension D1 is equal to the minor dimension D2. However, in other examples, as shown in FIG. 46, each one of the valleys 544 has a non-circular shape (e.g., an oval shape) such that the major dimension D1 is greater than the minor dimension D2. In some examples, such as when the surface, ablated by the laser beam, is flat, the resulting ablation pattern includes valleys 544 that are circular. However, according to certain examples, such as when the surface, ablated by the laser beam, is curved or contoured, the curvature of the surfaces causes the valleys 544 of the resulting ablation pattern to have an oval shape.

In some examples, the major dimension D1 of at least one of the valleys 544 is between 40 micrometers and 80 micrometers, and the minor dimension D2 is equal to the major dimension D1 or may vary by as much as 10% or 20% or by 10-20 micrometers. Additionally, or alternatively, the valley-to-valley distance Dvv between two valleys 544 can range from 80%-200% (preferably at least 120%) of the major dimension D1 of any one of the two valleys 544. As defined herein, in relation to the valleys 544, a first valley is adjacent a second valley when the second valley is the nearest neighbor to the first valley. Moreover, in some examples, such as those with uniform spacing between valleys, a given valley can be considered to be adjacent to multiple valleys. The center point of a valley 544 is defined as the location of greatest depth of the valley 544, which will typically be half of the major dimension inwards from an outer perimeter of the valley 544. The outer perimeter (e.g., perimeter) of a valley 544 is defined as the transition region where a change in the valley depth dv of the valley 544, versus an unablated surface, is no more than 5 micrometers, preferably between 0 to 2 micrometers versus an unablated surface.

According to one example, the uniformity of an ablation pattern of peaks and valleys, as used herein, can be defined in terms of the variation of the size of the valleys of the ablation pattern. As previously mentioned, the substantially non-controllable ablation pattern left behind by some ablation process, such as media-blast ablation processes, include valleys of widely disparate sizes, shapes, and spacing. The ability to precisely control the energy, pulse frequency, and directionality of the laser results in an ablation pattern where all the valleys of the pattern have a uniform size. The uniformity of the sizes of the valleys of the ablation pattern formed by the laser beam can be expressed by the percent difference in the size of one valley of the ablation pattern relative to any other one (e.g., all other ones) of the valleys of the ablation pattern. The percent difference, as pertaining to the size of the valleys, is equal to the ratio (expressed as a percentage) of the size of one valley in the pattern and the size of any other one of the valleys in the pattern. The lower the percent difference in the size of the valleys of the ablation pattern, the higher the uniformity of the ablation pattern. In some examples, the percent difference of the size of one valley of a given pattern and the size of any other one of the valleys of the given pattern is no more than 20%. In other words, the size of one valley is within 20% of the size of any other one, or all other ones, of the valleys. In other examples, the percent difference of the size of one valley of a given pattern and the size of any other one of the valleys of the given pattern is no more than 10%.

The size of a valley can be expressed as a cross-sectional area, the major dimension D1, the minor dimension D2, the depth dv, or other characteristic of the size of the valley. In certain examples, the major dimension D1 or the minor dimension D2 of one valley is within 20% of the corresponding major dimension D1 or the minor dimension D2 of any other one, or all other ones, of the valleys. According to one example, the major dimension D1 of one valley is within 20% of the major dimension D1 of any other one, or all other ones, of the valleys, and the minor dimension D2 of the one valley is within 20% of the minor dimension D2 of any other one, or all other ones, of the valleys. In certain examples, the major dimension D1 or the minor dimension D2 of one valley is within 10% of the corresponding major dimension D1 or the minor dimension D2 of any other one, or all other ones, of the valleys. According to one example, the major dimension D1 of one valley is within 10% of the major dimension D1 of any other one, or all other ones, of the valleys, and the minor dimension D2 of the one valley is within 10% of the minor dimension D2 of any other one, or all other ones, of the valleys. Although the above examples reference the major dimension D1 and the minor dimension D2 of the valleys, other characteristics of the size of the valleys, such as cross-sectional area and depth, can be interchanged with the major dimension D1 and the minor dimension D2.

Additionally, or alternatively, in some examples, the uniformity of an ablation pattern of peaks and valleys, as used herein, can be defined in terms of the variation of the distance between adjacent valleys of the ablation pattern. The ability to precisely control the energy, pulse frequency, and directionality of the laser results in an ablation pattern where all the valleys of the pattern are uniformly spaced apart from each other. The uniformity of the distance between the valleys of the ablation pattern formed by the laser beam can be expressed by the percent difference in the distance between two adjacent valleys of the ablation pattern relative to the distance between any other two adjacent valleys (e.g., all adjacent valleys) of the ablation pattern. The percent difference, as pertaining to the distances between valleys, is equal to the ratio (expressed as a percentage) of the distance between two adjacent valleys in the pattern and the distance between any other two adjacent valleys in the pattern. The lower the percent difference in the distances between the valleys of the ablation pattern, the higher the uniformity of the ablation pattern. In some examples, the percent difference of the distances between two adjacent valleys of a given pattern and the difference between any other two adjacent valleys of the given pattern is no more than 20%. In other words, the distance between two adjacent valleys is within 20% of the distance between any other two adjacent valleys. In other examples, the percent difference of the distances between two adjacent valleys of a given pattern and the difference between any other two adjacent valleys of the given pattern is no more than 10%.

Corresponding with the uniformity of the peaks and valleys of the ablation pattern on the ablated surfaces of the parts disclosed herein, laser ablating a surface of a part of the golf club head also promotes a higher surface energy compared to surfaces treated using other types of ablation processes. As presented above, a higher surface energy of surfaces to be bonded enables a stronger and more reliable bond between the surfaces. The surface energy of a surface is inversely proportional to the water contact angle of the surface. In other words, the lower the water contact angle of the surface, the higher the surface energy of that surface. The water contact angle is defined as the angle (through the water) a drop of water, on a surface, makes with the surface. The lower the water contact angle, the higher the wettability of the surface, which promotes the adhesiveness of the adhesive and the ability of the adhesive to bond to the surface. Accordingly, the lower the water contact angle, the better the bond, and the higher the strength of the bond. In some examples, the water contact angle can be measured by using a goniometer or other measuring device. According to Table 4 below, the water contact angle for various laser ablated surfaces of several examples of a golf club head, prior to forming a bonded joint, are shown.

TABLE 4

| | Crown-Hosel | Crown-Toe | Sole-Hosel | Sole-Toe |
|---|---|---|---|---|
| Example 1 | 14° | 6° | 10° | 5° |
| Example 2 | 16° | 12° | 10° | 6° |
| Example 3 | 14° | 13° | 10° | 10° |
| Example 4 | 11° | 13° | 10° | 2° |
| Example 5 | 16° | 13° | 10° | 12° |
| Example 6 | 14° | 21° | 10° | 6° |
| Example 7 | 14° | 14° | 10° | 6° |
| Example 8 | 15° | 15° | 16° | 15° |
| Example 9 | 18° | 18° | 9° | 10° |
| Example 10 | 18° | 17° | 8° | 2° |

In Table 4, the crown-hosel surface is a portion of the front-ledge ablated surface 179A of the body 102 that is closer to the crown portion 119 than the sole portion 117, and closer to the hosel 120 than the toe portion 114; the crown-toe surface is a portion of the front-ledge ablated surface 179A of the body 102 that is closer to the crown portion 119 than the sole portion 117, and closer to the toe portion 114 than the hosel 120; the sole-hosel surface is a portion of the front-ledge ablated surface 179A of the body 102 that is closer to the sole portion 117 than the crown portion 119, and closer to the hosel 120 than the toe portion 114; and the sole-toe surface is a portion of the front-ledge ablated surface 179A of the body 102 that is closer to the sole portion 117 than the crown portion 119, and closer to the toe portion 114 than the hosel 120. Accordingly, with reference to Table 4, in some examples, the second-part ablated surface 526, or any laser ablated surface of the golf club head 100, has a water contact angle between 2° and 25°, or between 5° and 18°. According to yet certain examples, the water contact angle of an ablated surface of the golf club head 100 is less than 50°, less than 45°, less than 40°, less than 35°, less than 30°, less than 25°, or less than 20°. In some examples, the water contact angle of an ablated surface of the golf club head 100 is greater than zero degrees and less than 30° or greater than zero degrees and less than 25°. In certain examples, the water contact angle of an ablated surface of the golf club head 100 is between 1° and 18°.

Figure 38:
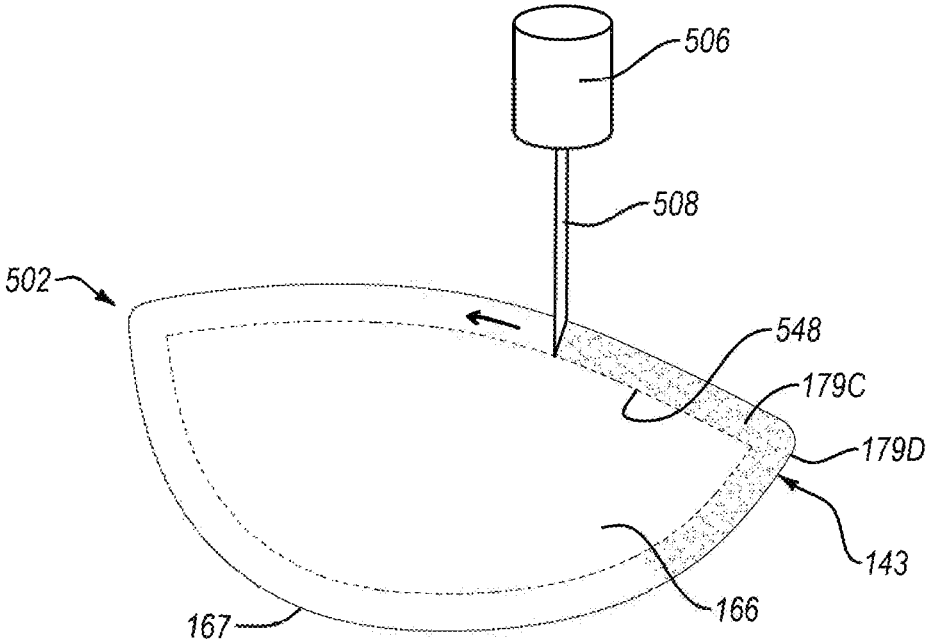
FIG. 38 is a schematic, perspective view of a strike plate of a golf club head being laser ablated by a laser, according to one or more examples of the present disclosure.
Figure 40:
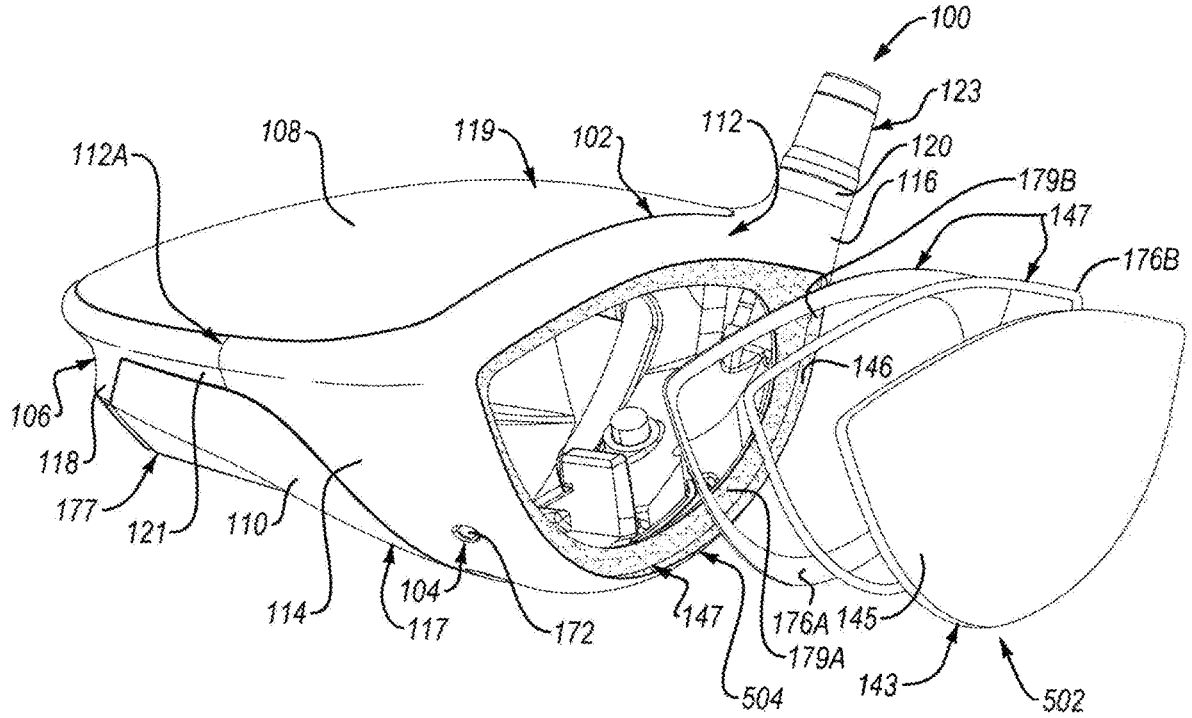
FIG. 40 is a schematic, perspective, exploded view of a strike plate and a body of a golf club head, according to one or more examples of the present disclosure.
Figure 41:
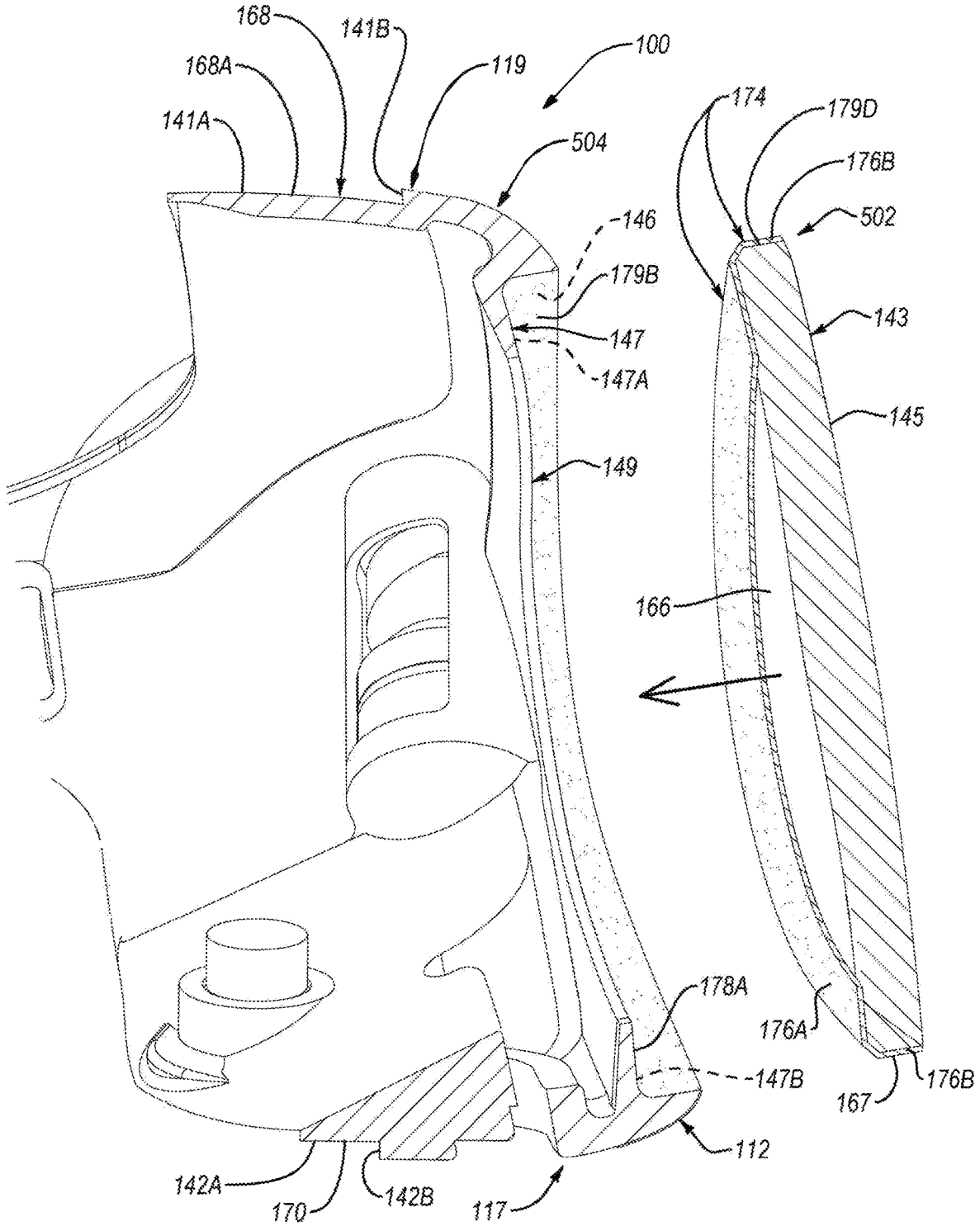
FIG. 41 is a schematic, perspective, exploded view of a strike plate and a body of a golf club head, according to one or more examples of the present disclosure.

Referring to FIGS. 38, 40, and 41, in some examples, the first part 502 is the strike plate 143 of the golf club head 100 and the second part 504 is the body 102 of the golf club head 100. In certain examples, the strike plate 143 can be made of a fiber-reinforced polymeric material and the body 102 can be made of a different material, such as a cast titanium material, non-cast titanium material, an aluminum material, a steel material, a tungsten material, a plastic material, and/or the like. The strike plate 143 is made of a plurality of stacked plies of fiber-reinforced polymeric material in certain examples. In one example, the strike plate 143 is made of between 35-70 stacked plies of fiber-reinforced polymeric material (each having continuous fibers at a given angle) and has a thickness between 3.5 mm and 6.0 mm, inclusive. The angle of the fibers of the plies can vary from ply-to-ply. Alternatively, the strike plate 143 can be made of a metallic material, such as a titanium alloy, and the body 102 can be made of the same metallic material or a different metallic material, such as a different titanium alloy. Also, the body 102, as presented above, can be made of multiple, separately formed and subsequently attached, pieces where each piece is made of a different material.

When the first part 502 is the strike plate 143 of the golf club head 100, the first-part surface 520 includes the interior surface 166 or rear surface of the strike plate 143, which is opposite the strike face 145 of the strike plate 143. Accordingly, as shown in FIG. 38, the first laser 506 generates the first-part laser beam 508 and directs the first-part laser beam 508 to impact the interior surface 166 within and along a designated first-part bond area 548, at least partially on the interior surface 166, to form a strike-plate-interior ablated surface 179C. Accordingly, only a portion (e.g., outer peripheral portion) of the entire interior surface 166 of the strike plate 143 is laser ablated, with the remaining portion of the interior surface 166 being non-ablated. The first-part ablated surface 522 includes, at least partially, the strike-plate-interior ablated surface 179C. In some examples, the first-part surface 520 also includes a peripheral edge surface 167 of the strike plate 145 and the first laser 506 generates the first-part laser beam 508 and directs the first-part laser beam 508 to impact (e.g., an entirety of) the peripheral edge surface 167 such that a strike-plate-edge ablated surface 179D is formed. Accordingly, the first-part ablated surface 522 can further include the strike-plate-edge ablated surface 179D and the designated first-part bond area 548 can further include the peripheral edge surface 167. The strike-plate-interior ablated surface 179C and the strike-plate-edge ablated surface 179D have the same ablation pattern in certain examples. In some examples, an orientation of the strike plate 143 relative to the first-part laser 506 is adjusted when laser ablating the peripheral edge surface 167, compared to when laser ablating the interior surface 166, because of the angle of the peripheral edge surface 167 relative to the interior surface 166.

Figure 39:
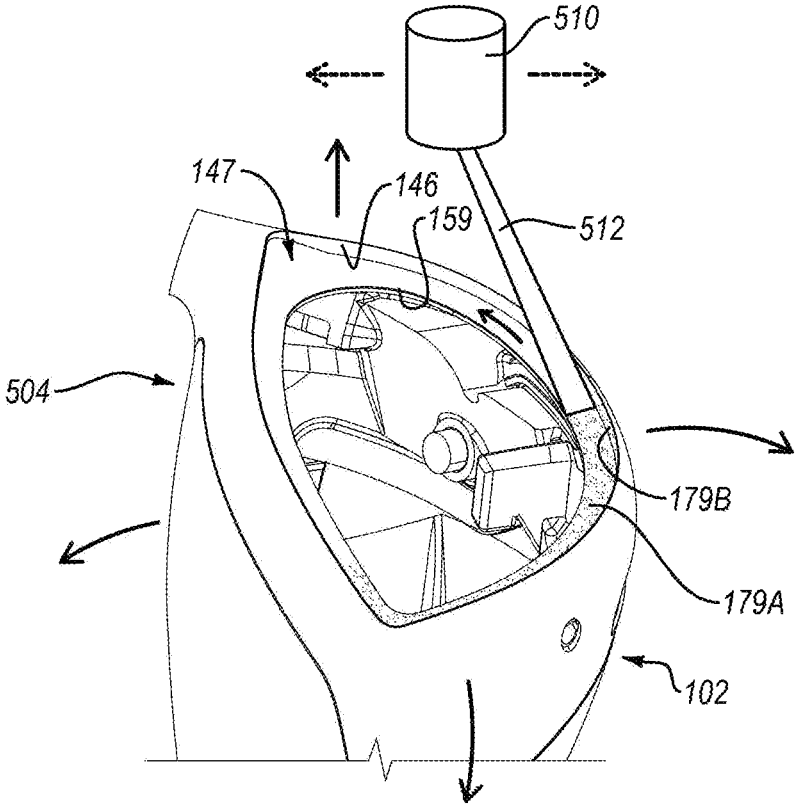
FIG. 39 is a schematic, perspective view of a body of a golf club head being laser ablated by a laser, according to one or more examples of the present disclosure.

When the second part 504 is the body 102, the second-part surface 524 includes the plate-opening recessed ledge 147 of the body 102. Accordingly, as shown in FIG. 39, the second laser 510 generates the second-part laser beam 512 and directs the second-part laser beam 512 to impact the plate-opening recessed ledge 147, within and along a designated second-part bond area, to form a front-ledge ablated surface 179A. The second-part ablated surface 526 includes, at least partially, the front-ledge ablated surface 179A. In some examples, the second-part surface 524 also includes the sidewall 146, extending about the plate-opening recessed ledge 147, and the second laser 510 generates the second-part laser beam 512 and directs the second-part laser beam 512 to impact (e.g., an entirety of) the sidewall 146 such that a front-sidewall ablated surface 179B is formed. Accordingly, the second-part ablated surface 526 can further include the front-sidewall ablated surface 179B and the designated second-part bond area can further include the sidewall 146. The front-ledge ablated surface 179A and the front-sidewall ablated surface 179B have the same ablation pattern in certain examples. In some examples, an orientation of the body 102 relative to the second-part laser 510 is adjusted when laser ablating the sidewall 146, compared to when laser ablating the plate-opening recessed ledge 147, because of the angle of the sidewall 146 relative to the plate-opening recessed ledge 147.

In view of the foregoing, according to some examples, such as with the golf club head 300 of FIG. 18, the second-part ablated surface 526 is defined by the ablated surfaces of two sub-components (e.g., the upper cup piece 304A and the lower cup piece 304B) made of different materials. Therefore, when the second-part ablated surface 526 is laser ablated, the different materials defining the second-part ablated surface 526 can be laser ablated in a single, continuous step. A first material of the different materials can define a first surface area of the second-part ablated surface 526 and the second material of the different materials can define a second surface area of the second-part ablated surface. The first surface area and the second surface area can be different in some examples. According to certain examples, the first surface area is greater than the second surface area, and the first material, defining the first surface area, has a lower density than the second material, defining the second surface area. Both the upper cup piece 304A and the lower cup piece 304B include a front ledge and a sidewall (similar to the plate opening recessed ledge 147 and the sidewall 146), which can be laser ablated to define the second-part ablated surface 526.

Referring to FIGS. 10-13, in some examples, the first part 502 is one of the crown insert 108 or the sole insert 110, and the second part 504 is the body 102. In certain examples, the crown insert 108 and/or the sole insert 110 can be made of a fiber-reinforced polymeric material and the body 102 can be made of a different material, such as a cast titanium material, non-cast titanium material, an aluminum material, a steel material, a tungsten material, a plastic material, and/or the like. Alternatively, the crown insert 108 and/or the sole insert 110 can be made of a metallic material, such as a titanium alloy, and the body 102 can be made of the same metallic material or a different metallic material, such as a different titanium alloy.

When the first part 502 is the crown insert 108, the first-part surface 520 includes an interior surface 108A of the crown insert 108. Accordingly, the first laser 506 generates the first-part laser beam 508 and directs the first-part laser beam 508 to impact the interior surface 108A of the crown insert 108 within and along a designated first-part bond area 548, at least partially on the interior surface 108A of the crown insert 108, to form a crown-insert ablated surface 108B. The first-part ablated surface 522 includes, at least partially, the crown-insert ablated surface 108B. Accordingly, only a portion (e.g., outer peripheral portion) of the entire interior surface of the crown insert 108 is laser ablated, with the remaining portion of the interior surface of the crown insert 108 being non-ablated. In some examples, the bond area on the interior surface 108A of the crown insert 108 will range from 2,000 $mm^2$ to 2,500 $mm^2$, such as at least 2,248 $mm^2$. Moreover, in certain examples, a total surface area of the interior surface 108A of the crown insert 108 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 9,379 $mm^2$ and 10,366 $mm^2$ (e.g., around 9,873 $mm^2$). In some examples, a percentage of the total surface area of the interior surface 108A occupied by the bond area on the interior surface 108A of the crown insert 108 is no more than 25%, 30%, 35%, or 40% and no less than 10%, 15%, 20%, or 25%. According to certain examples, the percentage of the total surface area of the interior surface 108A occupied by the bond area on the interior surface 108A of the crown insert 108 is between 20% and 25%, such as 22%, between 20% and 27%, or between 22% and 25%.

In some examples, the bond area on the interior surface 110A of the sole insert 110 will range from 1,800 $mm^2$ to 2,200 $mm^2$, such as at least 2,076 $mm^2$. Moreover, in certain examples, a total surface area of the interior surface 110A of the sole insert 110 is between 7,000 $mm^2$ and 12,000 $mm^2$ or between 9,000 $mm^2$ and 11,000 $mm^2$ (e.g., a minimum surface area between 7,000 $mm^2$ and 9,000 $mm^2$), such as between 8,182 $mm^2$ and 9,043 $mm^2$ (e.g., around 8,613 $mm^2$). In some examples, a percentage of the total surface area of the interior surface 110A occupied by the bond area on the interior surface 110A of the sole insert 110 is no more than 25%, 30%, 35%, or 40% and no less than 10%, 15%, 20%, or 25%. According to certain examples, the percentage of the total surface area of the interior surface 110A occupied by the bond area on the interior surface 110A of the sole insert 110 is between 20% and 27%, between 22% and 25%, or between 21% and 26%, such as 24%.

In some examples, the bond area on the interior surface of the strike plate 143 will range from 1,770 $mm^2$ to 2,170 $mm^2$, such as at least 1,976 $mm^2$. Moreover, in certain examples, a total surface area of the interior surface of the strike plate 143 is less than 7,000 $mm^2$, such as between 1,500 $mm^2$ and 7,000 $mm^2$, between 3,200 $mm^2$ and 4,700 $mm^2$, or between 3,572 $mm^2$ and 3,949 $mm^2$ (e.g., around 3,761 $mm^2$). In some examples, a percentage of the total surface area of the interior surface of the strike plate 143 occupied by the bond area on the interior surface of the strike plate 143 is no more than 55%, 60%, 65%, or 70% and no less than 30%, 35%, 40%, or 45%. According to certain examples, the percentage of the total surface area of the interior surface of the strike plate 143 occupied by the bond area on the interior surface of the strike plate 143 is between 47% and 58%, such as 52%.

In some examples, the first-part surface 520 also includes a peripheral edge surface of the crown insert 108 and the first laser 506 generates the first-part laser beam 508 and directs the first-part laser beam 508 to impact (e.g., an entirety of) the peripheral edge surface of the crown insert 108 such that a crown-insert-edge ablated surface 108C is formed. Accordingly, the first-part ablated surface 522 can further include the crown-insert-edge ablated surface 108C and the designated first-part bond area 548 can further include the peripheral edge surface of the crown insert 108. The crown-insert ablated surface 108B and the crown-insert-edge ablated surface 108C can have the same ablation pattern in certain examples. In some examples, an orientation of the crown insert 108 relative to the first-part laser 506 is adjusted when laser ablating the peripheral edge surface of the crown insert 108, compared to when laser ablating the interior surface 108A, because of the angle of the peripheral edge surface relative to the interior surface 108A.

When the first part 502 is the crown insert 108, the second-part surface 524 includes the crown-opening recessed ledge 168. Accordingly, the second laser 510 generates the second-part laser beam 512 and directs the second-part laser beam 512 to impact the crown-opening recessed ledge 168 within and along a designated second-part bond area, at least partially on the crown-opening recessed ledge 168, to form a top-ledge ablated surface 141A. The second-part ablated surface 526 includes, at least partially, the top-ledge ablated surface 141A. In some examples, the second-part surface 524 also includes a top recessed-ledge sidewall, circumferentially surrounding and defining a depth of the crown-opening recessed ledge 168, and the second laser 510 generates the second-part laser beam 512 and directs the second-part laser beam 512 to impact (e.g., an entirety of) the top recessed-ledge sidewall such that a top-sidewall ablated surface 141B is formed. Accordingly, the second-part ablated surface 526 can further include the top-sidewall ablated surface 141B and a designated second-part bond area can further include the top recessed-ledge sidewall. The top-ledge ablated surface 141A and the top-sidewall ablated surface 141B can have the same ablation pattern in certain examples. In some examples, an orientation of the body 102 relative to the second-part laser 510 is adjusted when laser ablating the top recessed-ledge sidewall, compared to when laser ablating the crown-opening recessed ledge 168, because of the angle of the top recessed-ledge sidewall relative to the crown-opening recessed ledge 168.

In view of the foregoing, according to some examples, the second-part ablated surface 526 is defined by the ablated surfaces of two sub-components (e.g., the cast cup 104 and the ring 106) made of different materials. Therefore, when the second-part ablated surface 526 is laser ablated, the different materials defining the second-part ablated surface 526 can be laser ablated in a single, continuous step.

When the first part 502 is the sole insert 110, the first-part surface 520 includes an interior surface 110A of the sole insert 110. Accordingly, the first laser 506 generates the first-part laser beam 508 and directs the first-part laser beam 508 to impact the interior surface 110A of the sole insert 110 within and along a designated first-part bond area 548, at least partially on the interior surface 110A of the crown insert 110, to form a sole-insert ablated surface 110B. The first-part ablated surface 522 includes, at least partially, the sole-insert ablated surface 110B. Accordingly, only a portion (e.g., outer peripheral portion) of the entire interior surface of the sole insert 110 is laser ablated, with the remaining portion of the interior surface of the sole insert 110 being non-ablated. In some examples, the first-part surface 520 also includes a peripheral edge surface of the sole insert 110 and the first laser 506 generates the first-part laser beam 508 and directs the first-part laser beam 508 to impact (e.g., an entirety of) the peripheral edge surface of the sole insert 110 such that a sole-insert-edge ablated surface 110C is formed. Accordingly, the first-part ablated surface 522 can further include the sole-insert-edge ablated surface 110C and the designated first-part bond area 548 can further include the peripheral edge surface of the sole insert 110. The sole-insert ablated surface 110B and the sole-insert-edge ablated surface 110C can have the same ablation pattern in certain examples. In some examples, an orientation of the sole insert 110 relative to the first-part laser 506 is adjusted when laser ablating the peripheral edge surface of the sole insert 110, compared to when laser ablating the interior surface 110A, because of the angle of the peripheral edge surface relative to the interior surface 110A.

Furthermore, when the first part 502 is the sole insert 110, the second-part surface 524 includes the sole-opening recessed ledge 170. Accordingly, the second laser 510 generates the second-part laser beam 512 and directs the second-part laser beam 512 to impact the sole-opening recessed ledge 170 within and along a designated second-part bond area, at least partially on the sole-opening recessed ledge 170, to form a bottom-ledge ablated surface 142A. The second-part ablated surface 526 includes, at least partially, the bottom-ledge ablated surface 142A. In some examples, the second-part surface 524 also includes a bottom recessed-ledge sidewall, circumferentially surrounding and defining a depth of the sole-opening recessed ledge 170, and the second laser 510 generates the second-part laser beam 512 and directs the second-part laser beam 512 to impact (e.g., an entirety of) the bottom recessed-ledge sidewall such that a bottom-sidewall ablated surface 142B is formed. Accordingly, the second-part ablated surface 526 can further include the bottom-sidewall ablated surface 142B and the designated second-part bond area can further include the bottom recessed-ledge sidewall. The bottom-ledge ablated surface 142A and the bottom-sidewall ablated surface 142B can have the same ablation pattern in certain examples. In some examples, an orientation of the body 102 relative to the second-part laser 510 is adjusted when laser ablating the bottom recessed-ledge sidewall, compared to when laser ablating the sole-opening recessed ledge 170, because of the angle of the bottom recessed-ledge sidewall relative to the sole-opening recessed ledge 170.

As disclosed above, in some examples, an orientation of a part being laser ablated can be adjusted relative to the laser that is ablating the part. In one example, as shown by directional arrows, with dashed lines, in FIG. 39, the part is held stationary and the orientation of the laser or the directionality of the laser beam is changed relative to the part. The orientation of the laser can be changed by moving the laser, such as via a numerically-controlled robot, or adjusting the directionality of the laser beam generated by the laser, such as by using electronically controllable optical components.

According to another example, as shown by directional arrows, with solid lines, in FIG. 39, the laser is held stationary (or the directionality of the laser beam is held constant), and the orientation of the part is adjusted or the part is moved relative to the laser beam. The orientation of the part can be adjusted by fixing the part to an adjustable platform, that can be translationally moved or rotated to translationally move or rotate the part relative to the laser beam.

Although in some examples, the methods disclosed herein may be performed manually, in other examples, the methods are automated. As used herein, automated means operated at least partially by automatic equipment, such as computer-numerically-controlled (CNC) machines. The process of controlling the laser, including the directionality and/or characteristics of the laser beam, and/or controlling the orientation/position of the part relative to the laser beam is automated in some examples. For example, an electronic controller can control the laser and part-adjustment components (e.g., motors, cylinders, gears, rails, etc.) that hold and adjust the orientation/position of the part.

Because the golf club head 100 has both a crown insert 108 and a sole insert 110 attached to the body 102, in some examples, the method 550 can be performed to make a golf club head that has more than one first part 502 coupled to the second part 504. In other words, in at least one example, the golf club head 100 includes at least two first parts 502 coupled to the second part 504. Moreover, because the golf club head 100 also includes a strike plate 148 attached to the body 102, in certain examples, the method 550 can be performed to make a golf club head that has at least three first parts 502 coupled to the second part 504.

As described above, the body 102 of the golf club head 100 includes multiple pieces that are attached together to form a multi-piece construction. For example, referring to FIGS. 14 and 15, the body 102 of the golf club head 100 includes the cast cup 104 and the ring 106. Accordingly, in some examples, the method 550 can be performed to make a body of a golf club head that includes the first part 502 and the second part 504. The first part 502 is the ring 106 and the second part 504 is the cast cup 104 in certain examples. As disclosed above, the ring 106 and the cast cup 104 can be made of different materials. For example, the ring 106 can be made of a metallic material or a plastic material having a relatively lower density that the material of the cast cup 104, which can be made of a cast titanium material.

When the first part 502 is the ring 106 and the second part 504 is the cast cup 104, the first-part surface 520 includes the toe cup-engagement surface 152A and the heel cup-engagement surface 152B. Accordingly, the first laser 506 generates the first-part laser beam 508 and directs the first-part laser beam 508 to impact the toe cup-engagement surface 152A and the heel cup-engagement surface 152B within and along a designated first-part bond area, at least partially on the toe cup-engagement surface 152A and the heel cup-engagement surface 152B, to form a toe cup-engagement ablated surface 148C and a heel cup-engagement surface 148D, respectively. The first-part ablated surface 522 includes, at least partially, the toe cup-engagement ablated surface 148C and the heel cup-engagement surface 148D. The toe cup-engagement ablated surface 148C and the heel cup-engagement surface 148D can have the same ablation pattern in certain examples.

Correspondingly, when the first part 502 is the ring 106 and the second part 504 is the cast cup 104, the second-part surface 524 includes the toe ring-engagement surface 150A and the heel ring-engagement surface 150B. Accordingly, the second laser 510 generates the second-part laser beam 512 and directs the second-part laser beam 512 to impact the toe ring-engagement surface 150A and the heel ring-engagement surface 150B within and along a designated second-part bond area, at least partially on the toe ring-engagement surface 150A and the heel ring-engagement surface 150B, to form a toe ring-engagement ablated surface 148A and a heel ring-engagement surface 148B, respectively. The first-part ablated surface 522 includes, at least partially, the toe ring-engagement ablated surface 148A and the heel ring-engagement surface 148B. The toe ring-engagement ablated surface 148A and the heel ring-engagement surface 148B can have the same ablation pattern in certain examples.

After the ring 106 is bonded to the cast cup 104, the ring 106 and the cast cup 104 can collectively define a second part 504 to which a first part 502 is bonded according to the method 550. In other words, the second part 504 can have a multi-piece construction. In fact, with reference to FIG. 18, the cast cup can have a multi-piece construction, such that one piece of the cast cup is the first part 502 and another piece of the cast cup is the second part 504, such that the multiple pieces (e.g., made of the same or different materials) of the cast cup have ablated surfaces bonded together after the manner of the method 550.

As used herein, dashed leader lines are used to indicate features in a prior state. For example, a surface referenced by a dashed leader line indicates that surface prior to being modified into a surface referenced by a solid leader line. This methodology is helpful in understanding the correlation between a surface before and after being ablated.

In some examples, the step of laser ablating the first-part surface 520 or the step of laser ablating the second-part surface 524 is performed to remove alpha case from a corresponding one of the first part 502 or the second part 504. In such examples, the corresponding one of the first part 502 or the second part 504 is made of a titanium alloy that is prone to developing a layer of alpha case on the first-part surface 520 or the second-part surface 524, respectively, during manufacturing (e.g., casting) of the corresponding part (see, e.g., U.S. Pat. No. 10,780,327, issued Sep. 22, 2020, which is incorporated herein by reference). The corresponding one of the first-part surface 520 or the second-part surface 524 is ablated to a depth sufficient to remove the layer of alpha case from the corresponding part. Using the laser ablation method disclosed herein enables the alpha case to be removed with more precision, efficiency, and lower waste materials that conventional methods, such as chemical etching, computer numerically-controlled (CNC) machine, or abrasion techniques.

Figure 43:
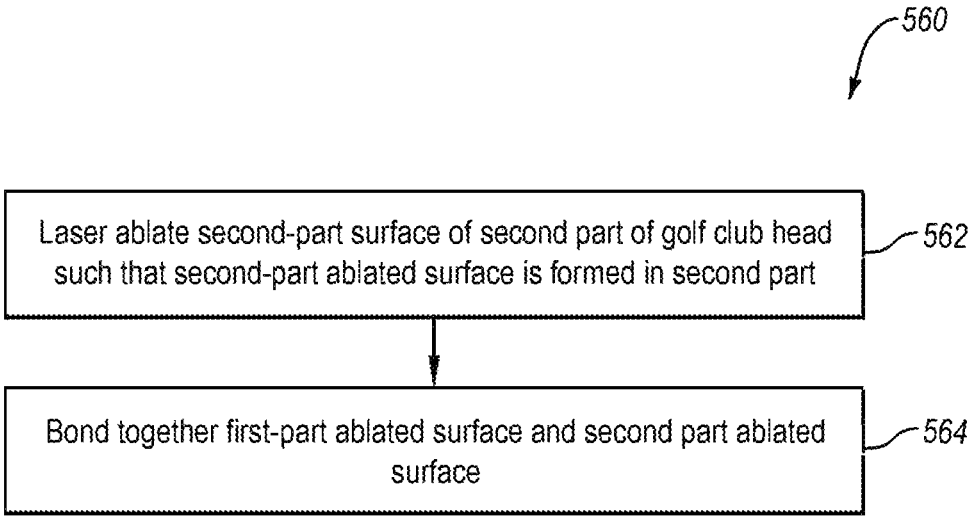
FIG. 43 is a schematic flow diagram of a method of making a golf club head, according to one or more examples of the present disclosure.
Figure 44:
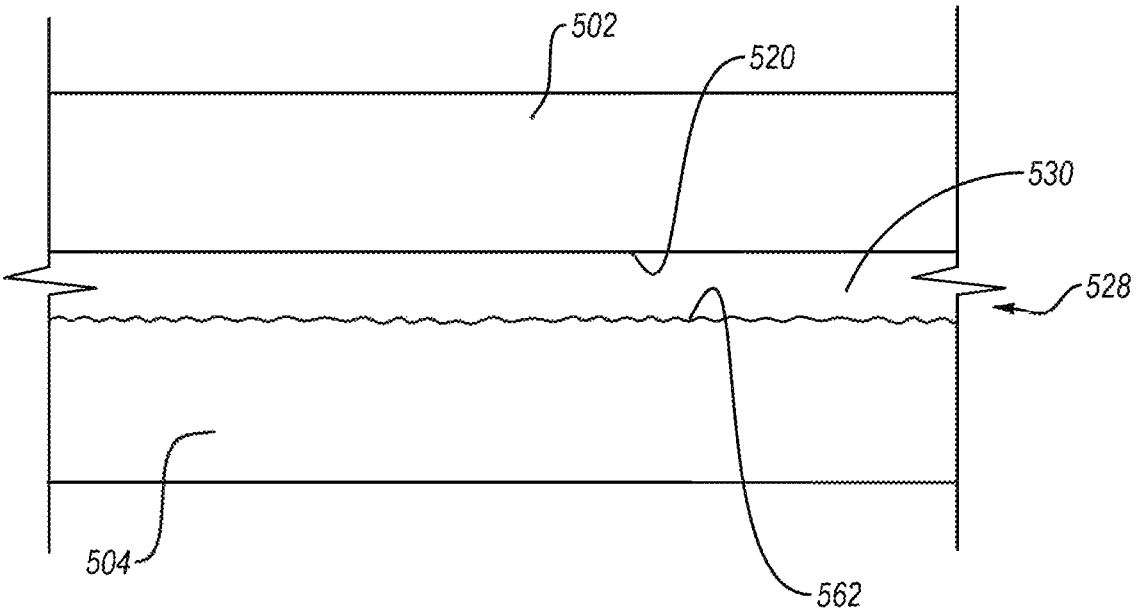
FIG. 44 is a schematic, side elevation view of a first part, of a golf club head, bonded to a second part, of the golf club head, according to one or more examples of the present disclosure.

Referring to FIGS. 43 and 44, in alternative examples, only one of the two surfaces forming the bondline 528 is laser ablated. According to one example, a method 560 of making the golf club heads of the present disclosure, such as the golf club head 100, includes (block 562) laser ablating the second-part surface 524 of the second part 504 of the golf club head 100 such that the second-part ablated surface 526 is formed in the second part 504. The method 560 additionally includes (block 564) bonding together the first-part surface 520, of the first part 502 of the golf club head 100, and the second-part ablated surface 526 of the second part 504. In other words, instead of the second-part ablated surface 526 being bonded to a first-part ablated surface of the first part 502, the second-part ablated surface 526 of the second part 504 is bonded to a non-ablated surface (i.e., the first-part surface 520) of the first part 502.

In certain examples, the second part 504 in the method 560 is made of a titanium alloy, such as a cast alloy, and the first part 502 in the method 560 is made of a fiber-reinforced polymeric material. For example, the first part 502 can be the strike plate 143, the second part 504 can be the body 102, and the second-part ablated surface 526 can define the plate-opening recessed ledge 147 of the body 102. However, unlike the strike plate 143 shown in FIG. 38, the interior surface 166 of the strike plate 143 used in the method 560 is not laser ablated. Instead, the interior surface 166 of the strike plate 143 is untreated or treated using a different type of surface treatment, such as media blasting or chemical etching. According to another example, the first part 502 can be one of the crown insert 108 or the sole insert 110, the second part 504 can be the body 102, and the second-part ablated surface 526 can define one of the top plate-opening recess ledge or the sole-opening recessed ledge.

According to some examples, the method 560 is used to make a golf club head similar to the golf club head 100, except the strike plate 143, the crown insert 108, and/or the sole insert 110 does not have a laser-ablated surface. Instead, in some examples, only the body 102, which can be made of a cast titanium alloy, includes laser-ablated surfaces. According to one example, the body 102 includes the top-ledge ablated surface 141A, the bottom-ledge ablated surface 141A, and the front-ledge ablated surface 179A, but the crown insert 108 does not include the crown-insert ablated surface 108B, the sole insert 110 does not include the sole-insert ablated surface 110B, and the strike plate 143 does not include the strike-plate-interior ablated surface 179C.

Each bonded joint of the golf club head 100 is defined by two bonded surfaces (e.g., faying surfaces). Because a bonded joint has two equal and opposite bonded surfaces, a surface area of each bonded joint (i.e., bond area of each bonded joint) is defined as the surface area of just one of the two bonded surfaces. In other words, as defined herein, the bond area of each bonded joint does not include the surface area of both bonded surfaces of the bonded joint. Accordingly, as used herein, the bond area of a bonded joint, defined between two surfaces of the golf club head disclosed herein, is the surface area of the portion of any one (but just one) of the two surfaces of the bonded joint that is covered by or in direct contact with an adhesive between the two surfaces. In view of this definition, the bond area is equal to the surface area of one of two surfaces of the adhesive (e.g., the bonding tape 174) defining the bonded joint. Accordingly, as used herein, the maximum surface area of a side of the bonding tape 174, bonded to a part to form a bonded joint with the part, is equal to the bond area of the bonded joint, as described in detail below.

In some examples, at least one of the two bonded surfaces of at least one bonded joint of the golf club head 100 is a laser ablated surface. Accordingly, the bond area of a bonded joint defined by a laser ablated surface can be the surface area of the laser ablated surface. Therefore, unless otherwise noted, a surface area of an ablated surface is equal to the bond area of the bonded joint defined by the laser ablated surface. Moreover, the bond area of a bonded joint defined by a non-ablated surface (e.g., the first-part surface 520 of FIG. 44) and an ablated surface is the surface area of the portion of the non-ablated surface that is bonded to the ablated surface or the portion of the non-ablated surface that is covered by or in direct contact with the bonding tape 174. Accordingly, a non-ablated surface can have a total surface area that is larger than the surface area of the portion of the non-ablated surface bonded to the ablated surface of a bonded joint.

As defined herein, the surface area of a laser ablated surface is the area of the portion of the surface covered by the pattern of peaks and valleys formed by the laser beam. Accordingly, the surface area of a laser ablated surface can be calculated as a length times a width of the portion of the surface that includes the pattern of peaks and valleys, or calculated by the combined surface area of the peaks and valleys of the pattern of peaks and valleys. Moreover, because in some examples, the bonded surfaces of a bonded joint are contoured, to provide a more convenient way of calculating the area of the bonded surfaces, as defined herein, the surface area of a surface is a projected surface area, which is the surface area of the surface projected onto a hypothetical plane substantially facing the surface.

Generally, a total bond area of the golf club head 100 is higher than conventional golf club heads. Moreover, a high percentage, such as 50%-100%, of the total bond area of the golf club head 100 is defined by laser ablated surfaces bonded together using the bonding tape 174. According to one example, the second-part ablated surface 526 of the golf club head 100 has a surface area between 800 $mm^2$ and 2,880 $mm^2$. In this, or other examples, the second-part ablated surface 526 of the golf club head 100 has a surface area of at least 1,560 $mm^2$, of at least 1,770 $mm^2$, of at least 2,062 $mm^2$, or of at least 2,600 $mm^2$. As defined previously, the first-part surface 520 or the first-part ablated surface 522 of the golf club head 100 can have corresponding surface areas because they would define the side of a bonded joint opposite the second-part ablated surface 526. Referring to Table 5 below, areas of some features and the bond area (in $mm^2$) of bonded surfaces of bonded joints of several examples of the golf club heads disclosed herein, which can be the same as or different than the examples of Table 4, is shown.

TABLE 5

| | Example 1 | Example 2 | Example 3 |
|---|---|---|---|
| Plate Opening Area | 2266 | 1674 | 1330-2720 |
| Front-Ledge Ablated Surface Area | 1010 | — | 800-1220 |
| Front-Sidewall Ablated Surface Area | 806 | — | 640-970 |
| Strike Face Ablated Surface Area | 1073 | 1073 | 850-1290 |
| Lower Cup Piece Ablated Surface Area | — | 599 | 470-720 |
| Lower Cup Piece Ledge Ablated Surface Area | — | 267 | 210-330 |
| Lower Cup Piece Sidewall Ablated Surface Area | — | 222 | 170-270 |
| Ring-Engagement Ablated Surface Area | 80 | — | 60-100 |
| Cup-Engagement Ablated Surface Area | 112 | — | 80-140 |
| Cup Top-Ledge Ablated Surface Area | 1424 | — | 1130-2000 |
| Cup Bottom-Ledge Ablated Surface Area | 1000 | — | 800-1200 |
| Ring Top-Ledge Ablated Surface Area | 935 | — | 740-1130 |
| Ring Bottom-Ledge Ablated Surface Area | 1420 | — | 1130-1710 |

In some examples, the forward sole-opening recessed ledge 170A (e.g., the cup bottom-ledge ablated surface area of Table 5) defines a bond area of about 1,054 $mm^2$, the forward crown-opening recessed ledge 168A (e.g., the cup top-ledge ablated surface area of Table 5) defines a bond area of about 1,910 $mm^2$, the toe ring-engagement surface 150A and the heel ring-engagement surface 150B (e.g., the ring-engagement ablated surface area of Table 5) or the toe cup-engagement surface 152A and the heel cup-engagement surface 152B (e.g., the cup-engagement ablated surface area of Table 5) are about 98 $mm^2$, the plate-opening recessed ledge 147 and the sidewall 146 (e.g., the front-ledge ablated surface area and the front-sidewall ablated surface area) define a bond area of about 2,240 $mm^2$, a total bond area defined by the cast cup 104 is 5,300 $mm^2$. According to the same or alternative examples, the rearward crown-opening recessed ledge 168B (e.g., the ring top-ledge ablated surface area of Table 5) defines a bond area of about 928 $mm^2$, the rearward sole-opening recessed ledge 170B (e.g., the ring bottom-ledge ablated surface area of Table 5) defines a bond area of about 1,222 $mm^2$, and a total bond area defined by the ring 106 is 2,250 $mm^2$.

In view of the foregoing, in some examples, the golf club head 100 includes a single component or piece (e.g., the ring 106) that is bonded to three other components or pieces of the golf club head 100 where a total bonded area between these four components or pieces of the golf club head 100 is between 1,950 $mm^2$ and 2,500, $mm^2$, or more preferably between 2,100 $mm^2$ and 2,400 $mm^2$. According to some examples, the golf club head 100 includes a single component or piece (e.g., the cast cup 104) that is bonded to three other components or pieces of the golf club head 100 where a total bonded area between these four components or pieces of the golf club head 100 is between 2,250 $mm^2$ and 3,400, $mm^2$, or more preferably between 2,900 $mm^2$ and 3,200 $mm^2$. According to yet some examples, the golf club head 100 includes a single component or piece (e.g., the cast cup 104) that is bonded to four other components or pieces of the golf club head 100 where a total bonded area between these five components or pieces of the golf club head 100 is between 4,750 $mm^2$ and 6,200, $mm^2$, or more preferably between 4,900 $mm^2$ and 5,500 $mm^2$. In certain examples, the golf club head includes a single component or piece (e.g., the upper cup piece 304A) that is bonded to five other components or pieces of the golf club head 100 where a total bonded area between these six components or pieces of the golf club head 100 is between 5,500 $mm^2$ and 7,000, $mm^2$, or more preferably between 5,700 $mm^2$ and 6,300 $mm^2$.

The golf club heads of the present disclosure have a high bond area, between multiple pieces of the golf club heads, relative to a volume of the golf club heads. In other words, for a given size of a golf club head, the amount of bonded area is significantly higher than for conventional golf club heads. According to some examples, the volume of a golf club head, such as the golf club head 100, disclosed herein is between 450 cc and 600 cc, and more preferably between 450 cc and 470 cc. Moreover, in certain examples, a bond-volume ratio, or a ratio of a combined bond area of the plurality of bonded joints of the golf club head to a volume of the golf club head is at least 3.75 $mm^2$/cc and at most 15.5 $mm^2$/cc (e.g., at least 9.1 $mm^2$/cc and at most 14.0 $mm^2$/cc). In some examples, the bond-volume ratio of at least some of the examples of golf club heads disclosed herein is at least 7.9 $mm^2$/cc and at most 13.7 $mm^2$/cc (e.g., at least 8.1 $mm^2$/cc and at most 12.2 $mm^2$/cc). In yet some examples, the bond-volume ratio of at least some of the examples of golf club heads disclosed herein is at least 3.75 $mm^2$/cc and at most 7.5 $mm^2$/cc (e.g., at least 4.8 $mm^2$/cc and at most 7.1 $mm^2$/cc).

According to some alternative examples, a bond-volume ratio, or a ratio of a combined bond area of the plurality of bonded joints of the golf club head to a volume of the golf club head is at least 10 $mm^2$/cc and at most 18.8 $mm^2$/cc (e.g., at least 10 $mm^2$/cc and at most 15.5 $mm^2$/cc or at least 11.6 $mm^2$/cc and at most 17.7 $mm^2$/cc). In some examples, the bond-volume ratio of at least some of the examples of golf club heads disclosed herein is at least 10.5 $mm^2$/cc and at most 15.3 $mm^2$/cc, at least 11.6 $mm^2$/cc and at most 18.8 $mm^2$/cc, or at least 12.1 $mm^2$/cc and at most 17.5 $mm^2$/cc.

The golf club head disclosed herein is made of multiple pieces adhesively bonded together. Accordingly, in some examples, the golf club head disclosed herein includes multiple pieces coupled together via the bonding tape 174 such that no portions or pieces of the golf club head are welded together.

The bond area of a bonded joint is defined by a width ($W_{BA}$) and a length ($L_{BA}$) of the bonded joint (see, e.g., FIG. 15). In other words, the surface area of a side of the boding tape 174 is defined by the width ($W_{BA}$) and the length ($L_{BA}$) of the bonded joint. The width $W_{BA}$ can be variable along the length $L_{BA}$ of a bonded joint. Generally, the length $L_{BA}$ of the bond area of a bonded joint is greater than the width $W_{BA}$ of the bond area of the bonded joint. The bonded joint can be continuous such that a length $L_{BA}$ of the bond area of the bonded joint is continuous. However, in some examples, the bonded joint is non-continuous or intermittent such that the length $L_{BA}$ of the bond area of the bonded joint is a summation of the lengths of the intervals of the bonded joint. Although the width $W_{BA}$ and the length $L_{BA}$ of the bonded area of only two bonded joints (e.g., the bonded area associated with the forward crown-opening recessed ledge 168A and the rearward crown-opening recessed ledge 168B) are shown in FIG. 15, it is recognized that, although not specifically labeled, the bonded area of each one of the bonded joints of the golf club head 100 has a corresponding width $W_{BA}$ and length $L_{BA}$, similar to those shown in FIG. 15, that are not labeled for ease in showing and labeling other features of the golf club head 100. Additionally, regarding the length $L_{BA}$, as defined herein, the length $L_{BA}$ of the bond area of a bonded joint is the maximum length of the bond area. Accordingly, where a bond area can be considered to have two different lengths, such as a maximum length (e.g., along an outer perimeter of the bond area, such as shown in FIG. 15) and a minimum length (e.g., along an inner perimeter of the bond area), the length $L_{BA}$ of the bond area is defined herein to be the largest or maximum length of the bond area.

According to some examples, the bond area of, or the bonding tape 174 forming, at least one bonded joint of the golf club head 100 has a length $L_{BA}$, which can be a continuous or segmented length, of between 174 mm and 405 mm, such as at least 250 mm. For example, the combined bond area defined by the forward crown-opening recessed ledge 168A and the rearward crown-opening recessed ledge 168B has a length $L_{BA}$ of at least 268 mm, of at least 300 mm, at least 316 mm, at least 353 mm, or at least 370 mm. As another example, the combined bond area defined by the forward sole-opening recessed ledge 170A and the rearward sole-opening recessed ledge 170B has a length $L_{BA}$ of at least 281 mm, of at least 314 mm, at least 331 mm, at least 350 mm, or at least 367 mm. According to yet another example, the bond area defined by the plate-opening recessed ledge 147 has a length $L_{BA}$ of at least 174 mm, of at least 194 mm, at least 205 mm, at least 250 mm, or at least 262 mm. According to some examples, a combined length of the plurality of bonded joints is at least 723 mm and at most 1,094 mm, such as between 852 mm and 953 mm.

Unless otherwise noted, the bonding tape 174 has a length and a width the same as, or substantially equal to, the bond length or the bond width of the bonded joint. For example, in some instances, the width of the bonding tape 174 is between, and inclusive or, 1 mm and 9 mm, between, and inclusive of, 2 mm and 7 mm, between, and inclusive of, 2 mm and 5 mm, or between, and inclusive of, 2.5 mm and 3.5 mm. Moreover, like the bond area of the bonded joints of the golf club head 100, the width of the bonding tape 174 can be variable along a length of the bonding tape 174. Additionally, for a given surface of a bonded joint (e.g., a surface of a ledge), the bonding tape 174 can adhere to a certain percentage of the total surface area of that given surface. In some examples, the percentage is less than 100% or less than 99%, is between, and inclusive of, 75% and 99% or between, and inclusive of 85% and 99%. The total surface area of a bonded surface can be equal to the total surface area covered by the part bonded to the bonded surface.

In some examples, a length-area ratio, equal to a ratio of the length $L_{BA}$ to the bond area of a bonded joint of, or the length to the surface area of the bonding tape 174 forming, the bond defined by the forward crown-opening recessed ledge 168A and the rearward crown-opening recessed ledge 168B is between 0.13 and 0.16, such as around 0.15. In yet some examples, the length-area ratio of the bond, defined by the bonding tape 174, between the forward sole-opening recessed ledge 170A and the rearward sole-opening recessed ledge 170B is between 0.13 and 0.16, such as around 0.15.

In yet some examples, the length-area ratio of the bond, defined by the bonding tape 174, between the forward sole-opening recessed ledge 170A and the rearward sole-opening recessed ledge 170B is between 0.13 and 0.16, such as around 0.15.

In yet some examples, the length-area ratio of the bond, defined by the bonding tape 174, between plate-opening recessed ledge 147 is between 0.10 and 0.13, such as around 0.11.

Figure 47:
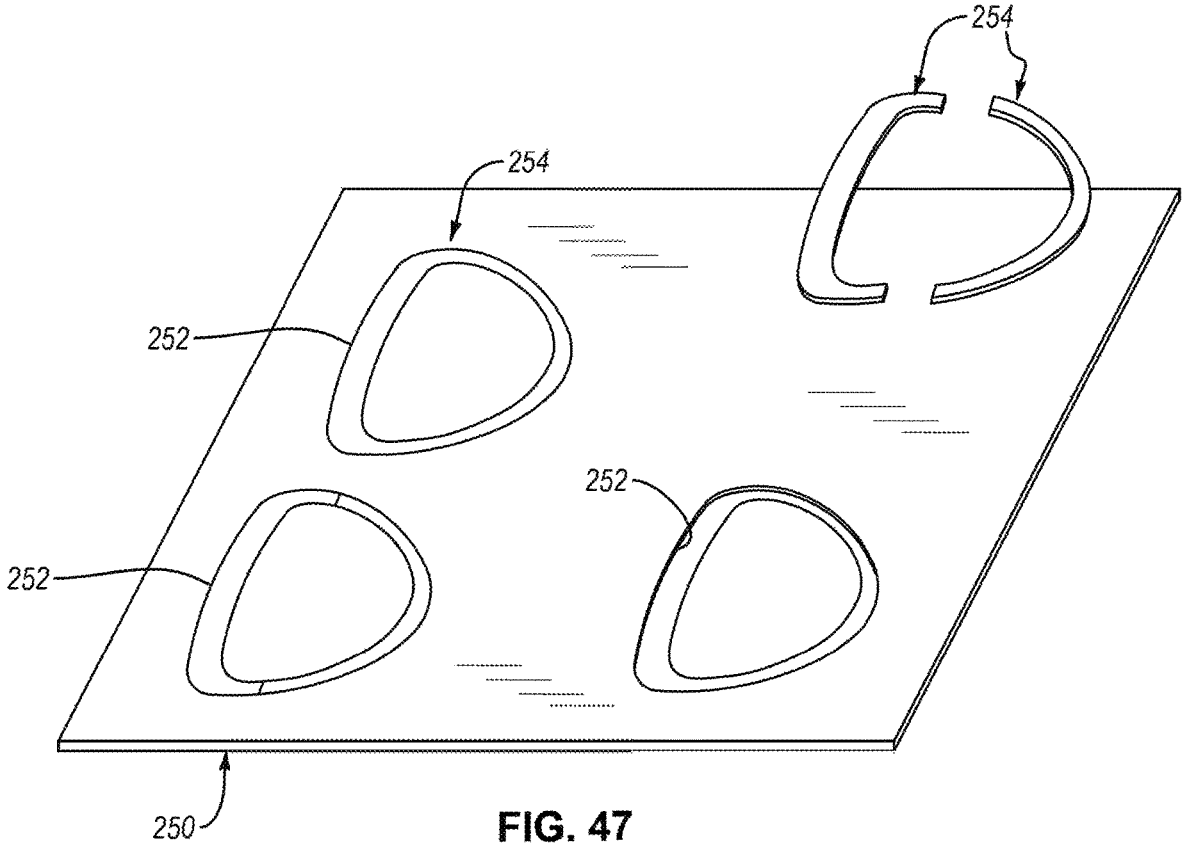
FIG. 47 is a schematic, perspective view of a sheet, including bonding tape, according to one or more examples of the present disclosure.

As previously disclosed, at least one bonded joint of the golf club heads disclosed herein is formed by the bonding tape 174. More specifically, the bonding tape 174 is situated between two parts and adhesively bonds together the two parts. The shape of the bonding tape 174 corresponds with the shape of the bonded surfaces (e.g., ablated surfaces) of the two parts that are bonded together. In some examples, the shape of the bonding tape 174 is substantially identical to the shape of at least one of the bonded surfaces of the two parts bonded together. Moreover, when the shape of the bonding tape 174 is substantially identical to the shape of the at least one of the bonded surfaces, the size of the bonding tape 174 can be identical to or smaller than the size of the at least one of the bonded surfaces. The bonding tape 174 is not flowable in a precured state (i.e., before the bonding tape 174 is cured). In other words, in a precured state, the bonding tape 174 has a fixed shape (e.g., without pressure, does not flow or conform to the outline of a container). In some examples, as shown in FIG. 47, the bonding tape 174 forms part of a bonding tape package 254 that is cut from a sheet 250. The shape of the bonding tape package 254, cut from the sheet 250, corresponds with the shape of the intended bonded surfaces. Where the bonded surfaces are continuous (e.g., form an annulus), the bonding tape package 254 can also form a continuous shape. Alternatively, as shown, to help with handling and manufacturing of the golf club head, the bonding tape package 254 can be cut into segments that collectively form an annulus shape or non-annulus shape as the case may be. Cuts 252, defining the shape of the bonding tape package 254, can be formed in the sheet 250 via any of various techniques, such as laser cutting, die cutting, grinding, water jet cutting, drilling, and the like.

Figure 48:
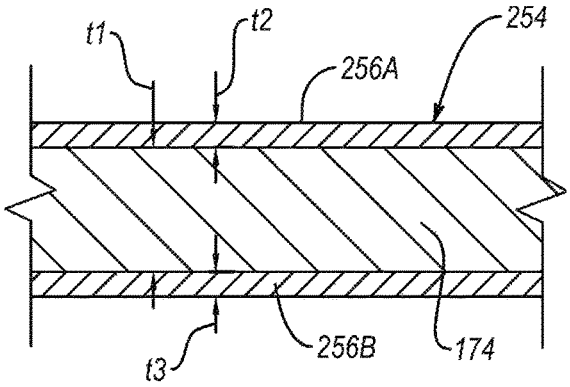
FIG. 48 is a schematic, side elevation, sectional view of a bonding tape package, according to one or more examples of the present disclosure.
Figure 49:
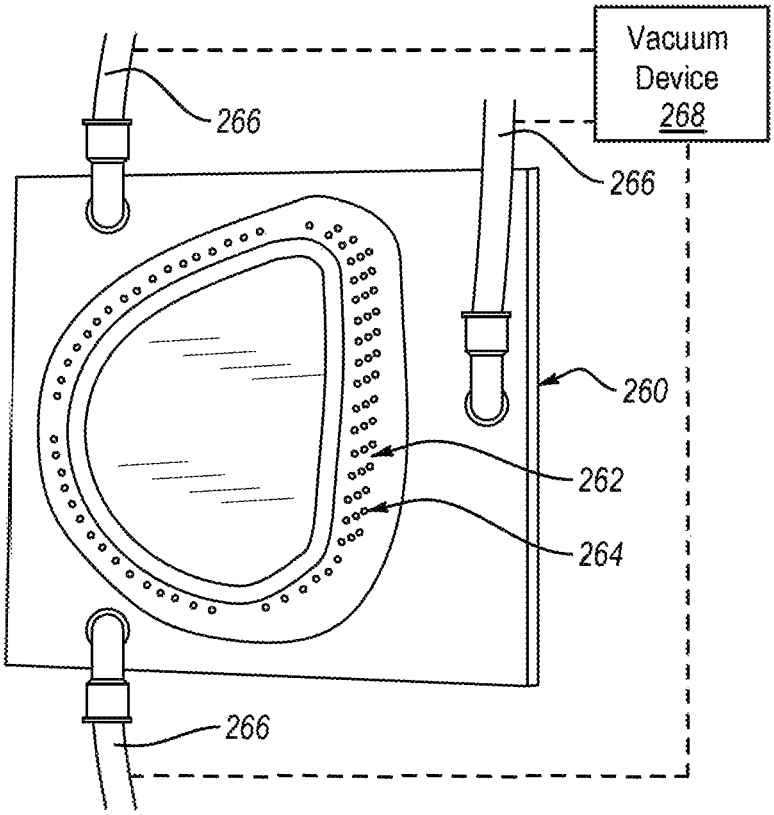
FIG. 49 is a schematic, perspective view of a tape-retention fixture, according to one or more examples of the present disclosure.

Referring to FIG. 48, the bonding tape package 254, and thus the sheet 250, includes a laminated structure having the bonding tape 174 sandwiched between a first release layer 256A and a second release layer 256B. In a pre-cured state, the bonding tape 174 is made of a tacky material. The first release layer 256A and the second release layer 256B help to keep the bonding tape 174 from sticking to itself or other objects, such as during transportation, storage, and handling of the bonding tape 174. Accordingly, the first release layer 256A and the second release layer 256B are made from a low-stick material. In some examples, the first release layer 256A and the second release layer 256B are made from a polymeric material, such as polyethylene or polyethylene terephthalate. In one example, the first release layer 256A is made of a material that is different than the second release layer 256B. According to some instances, the first release layer 256A is made of polyethylene and the second release layer 256B is made of polyethylene terephthalate.

The bonding tape 174 of the bonding tape package 254 has a thickness t1. Additionally, the first release layer 256A has a thickness t2 and the second release layer 256B has a thickness t3. In some examples, the thickness t1 of the bonding tape 174 is greater than the thickness 2 of the first release layer 256A and the thickness t3 of the second release layer 256B. In one example, the thickness t2 of the first release layer 256A is different than the thickness t2 of the second release layer 256B. According to one example, the thickness t1 of the bonding tape 174 is between, and inclusive of, 90 μm and 550 μm (e.g., 100 μm or 150 μm), between, and inclusive of, 250 μm and 330 μm, or between, and inclusive of, 300 μm and 390 μm, the thickness t2 of the first release layer 256A is about 100 μm, and the thickness t2 of the second release layer 256B is about 75 μm.

The bonding tape 174 is made of an adhesive material. According to some examples, the adhesive material of the bonding tape 174 is a thermo-activated adhesive. In other words, the adhesion strength of the bonding tape 174 is maximized after the bonding tape 174 is cured (i.e., heated to a predetermined temperature for a predetermined period of time). The predetermined temperature is associated with a curing temperature and curing period of the adhesive material. In some examples, the bonding tape 174 is made of a thermosetting material, such as a thermosetting acrylic material. According to certain examples, the curing temperature (and associated curing period) of the bonding tape 174 is between, and inclusive of, 90° C. (120 minutes) and 120° C. (20 minutes), or between, and inclusive of, 100° C. (60 minutes) and 115° C. (35 minutes), such as 110° C. (40 minutes). In some other examples, the curing temperature (associated curing period) of the bonding tape 174 is at least 100° C. or at least 120° C. (between, and inclusive of, 60 minutes and 180 minutes), such as between, and inclusive of, 120° C. and 230° C. or between, and inclusive of, 140° C. and 190° C. . . . During curing, the thermosetting material undergoes an irreversible chemical change by producing cross-linked polymer chains. Moreover, after curing, a temperature necessary to reflow the bonding tape 174 is at least 160° C., at least 180° C., at least 200° C., or at least 220° C.

In some examples, the adhesive material of the bonding tape 174 can be left in a pre-cured state, at room temperature, for up to 24 hours without compromising the adhesion properties of the bonding tape 174. Accordingly, the use of the bonding tape 174 enables flexibility in the handling and storage of the bonding tape 174, including parts bonded by the bonding tape 174, and flexibility in the timing of the manufacturing steps of the golf club head. For example, because the bonding tape 174 can be exposed in a pre-cured state at room temperature for periods of time longer than some conventional adhesives, some steps, such as the temporary adhesion of the bonding tape 174 to a part, can be performed well before the bonding tape 174 is actually cured. Additionally, in some examples, the unique properties of the bonding tape 174 allow the bonding tape 174 to be applied to parts at one facility and cured at another facility. Being able to prep parts with bonding tape 174 well in advance of curing the bonding tape 174 can promote speed and efficiency in assembling a golf club head, which can broaden the locations in which the golf club head manufacturing can be finalized (e.g., on-site at a retailer).

After the bonding tape 174 is cured, the shear strength of the bonding tape 174, which is a measure of the ability of the bonding tape 174 to resist separation of parts bonded by the bonding tape 174, is at least 10 Mpa (e.g., between, and inclusive of, 11 MPa and 21 MPa), at least 11 MPa, at least 12 MPa, at least 13 MPa, at least 26 MPa, at least 30 MPa, or at least 35 MPa. To promote adhesion between the bonding tape 174 and parts forming the bond, pressure should be applied to the parts such that, when the bonding tape 174 is being cured, opposing compression forces from the parts are acting on the bonding tape 174. In other words, while the bonding tape 174 is being cured, the parts forming the bond should be compressed against the bonding tape 174. Ideally, the pressure applied to the parts should be uniform to promote a uniform adhesion of the bonding tape 174 along the parts, and thus a uniform adhesion strength along the bond. However, uniformly compressing one part toward another part, particularly when the parts are contoured or have complex shapes, can be difficult. Described herein are examples of systems, apparatuses, and methods that promote uniform compression of bonded parts, while the bonding tape 174 between the bonded parts is being cured, in an accurate, a reliable, a clean, and an efficient manner. Moreover, as described in more detail, the use of the bonding tape 174, as opposed to a flowable adhesive, enables the uniform compression of bonded parts using the systems, apparatuses, and methods described herein.

Referring to FIGS. 49-52, according to one example, a system for manufacturing a golf club head, such as the golf club head 100, includes a tape-retention fixture 260. The system also includes a vacuum device 268 and at least one tube 266 fluidically connected to the vacuum device 268. The vacuum device 268 can be any of various vacuum devices or suction devices that are selectively operable to generate a negative pressure differential or pressure drop. The tape-retention fixture 260 also includes conduits 264 open to a recess 262 formed in the tape-retention fixture 260. The pattern (e.g., the size, spacing, and areal density) of conduits 264 can vary along the recess 262 based on characteristics (e.g., the width) of the bonding tape package 254. From the recess 262, the conduits 264 pass through the tape-retention fixture 260 where they are fluidically coupled to the at least one tube 266. In the illustrated example, the system includes three tubes 266, the conduits 264 are arranged into three sets of conduits 264, and each one of the three sets of conduits are fluidically coupled with a corresponding one of the three tubes 266 (such as via one of three manifolds formed in the tape-retention fixture 260). Fluidic coupling between the conduits 264, the tubes 266 and the vacuum device 268 enables the vacuum device 268 to selectively control the pressure in the conduits 264 and the tubes 266.

Figure 50:
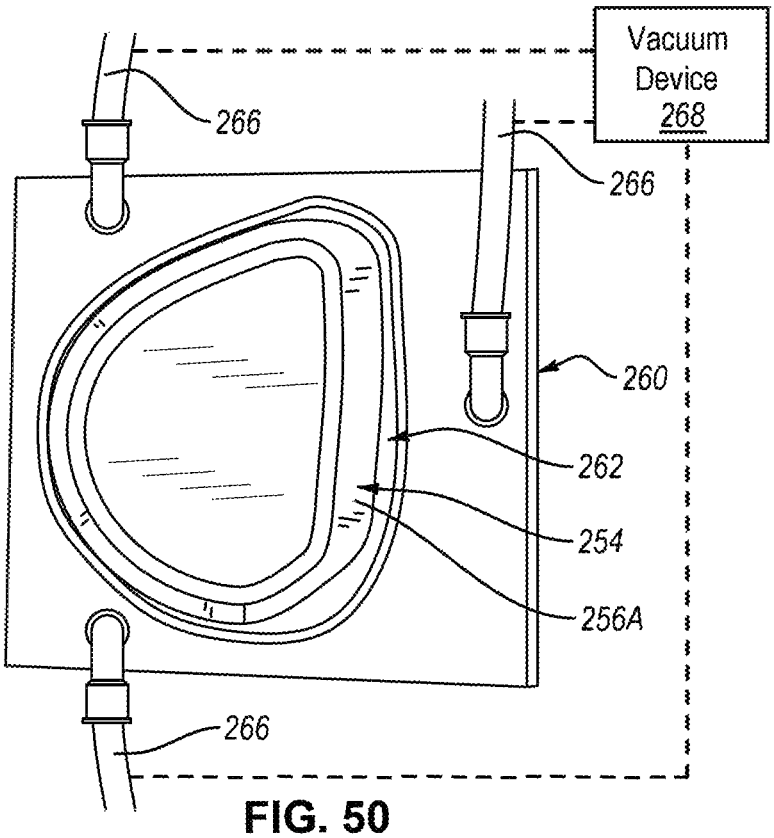
FIG. 50 is a schematic, perspective view of a tape-retention fixture, according to one or more examples of the present disclosure.

The recess 262 has a shape corresponding with the shape of the bonding tape package 254, cut from the sheet 250. In this manner, the bonding tape package 254 can be seated in the recess 262, as shown in FIG. 50. In certain examples, an automated robot can be used to secure and insert the tape package 254 into the recess 262. A depth of the recess 262 is such that a portion of the bonding tape package 254 protrudes from the recess 262 when the bonding tape package 254 is seated in the recess 262. When the bonding tape package 254 is seated in the recess 262, the first release layer 256A and the second release layer 256B are attached to the bonding tape 174. In the illustrated example, the bonding tape package 254 is seated in the recess 262 such that the second release layer 256B is positioned within the recess 262 and the first release layer 256A just outside the recess 262. In this manner, the second release layer 256B faces inwardly toward the recess 262 and contacts a bottom of the recess 262, to directly cover the conduits 264, and the first release layer 256A faces outwardly away from the recess 262.

Figure 51:
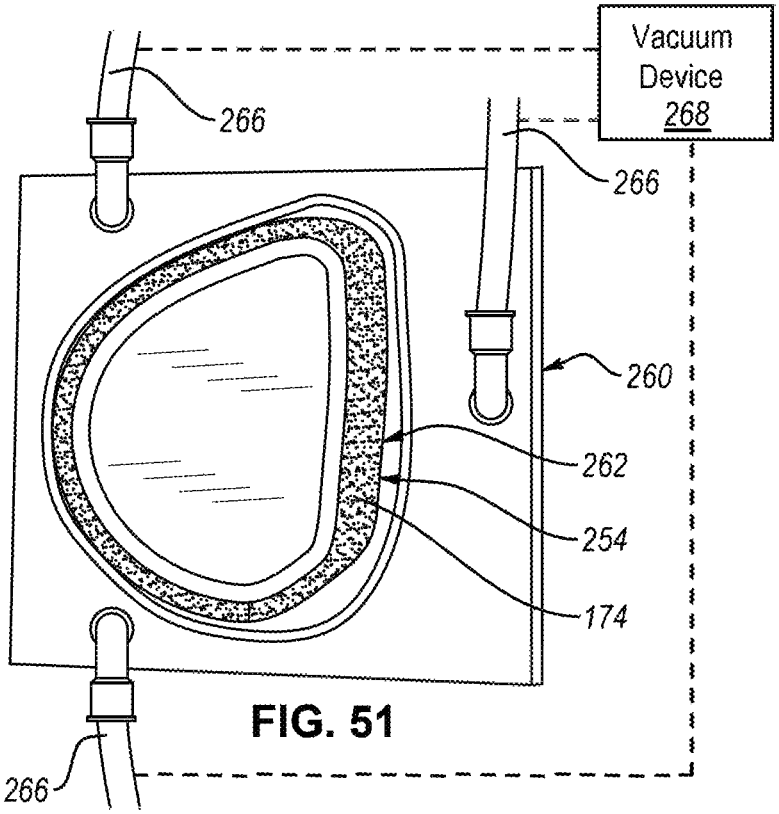
FIG. 51 is a schematic, perspective view of a tape-retention fixture, according to one or more examples of the present disclosure.

With the bonding tape package 254 seated in the recess 262, activation of the vacuum device 268 reduces the pressure in the conduits 264. Because the bonding tape package 254 covers the openings of the conduits 264 in the recess 262, the drop in pressure in the conduits 264 urges the bonding tape package 254 against the bottom of the recess 262, via a suction force, which helps to retain the bonding tape package 254 in the recess 262. When the bonding tape package 254 is urged against the bottom of the recess 262, which is shown in FIG. 50, the first release layer 256A is removed from the bonding tape 174, as shown in FIG. 51. Because the bonding tape package 254 is retained in the recess 262, via the suction force, and the peel off force of the first release layer 256A is less than the suction force, the first release layer 256A can be peeled off the bonding tape 174 without removing the bonding tape package 254 from the recess 262.

Figure 52:
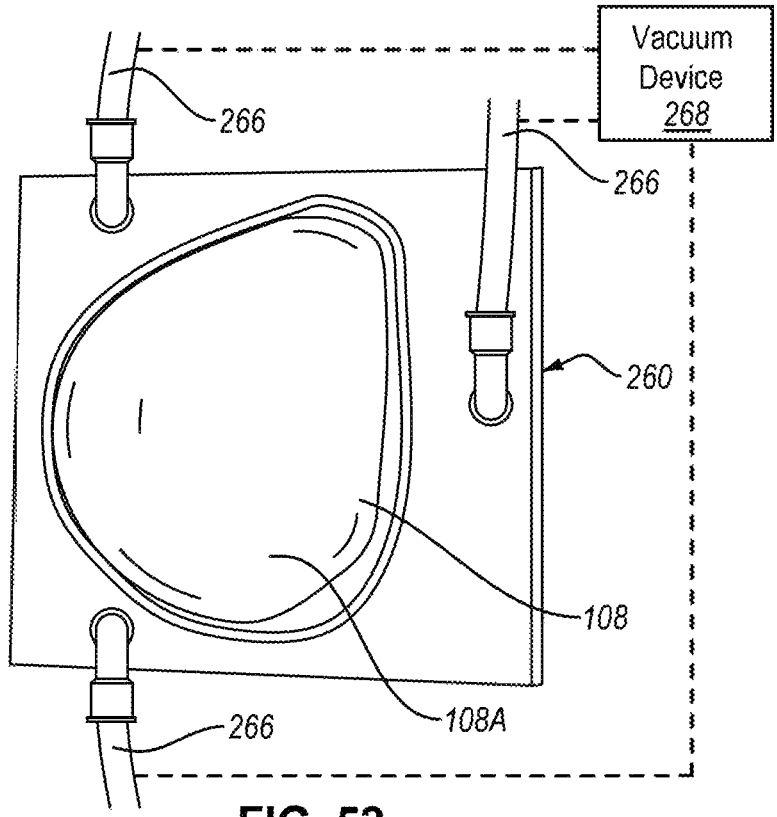
FIG. 52 is a schematic, perspective view of a tape-retention fixture, according to one or more examples of the present disclosure.
Figure 53:
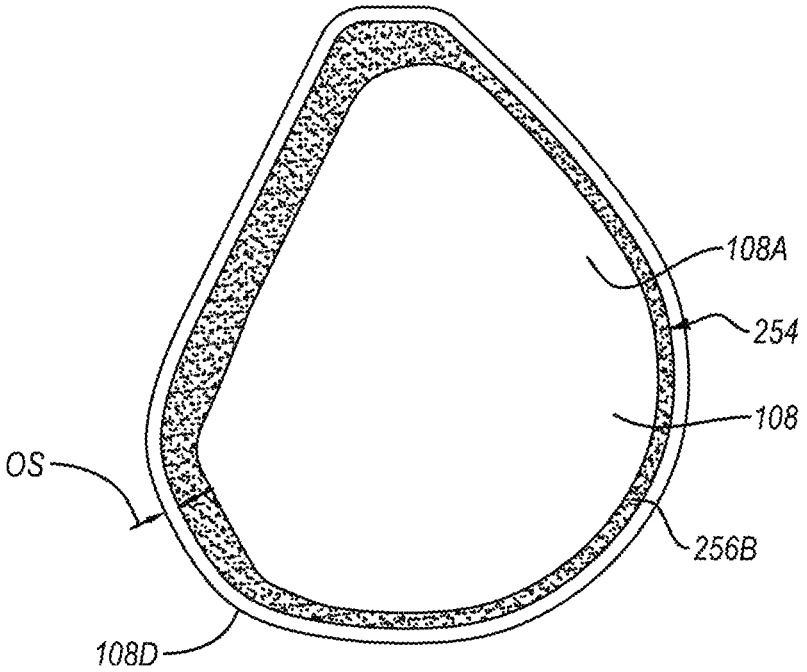
FIG. 53 is a schematic, perspective view of a crown insert of a golf club head, according to one or more examples of the present disclosure.
Figure 56:
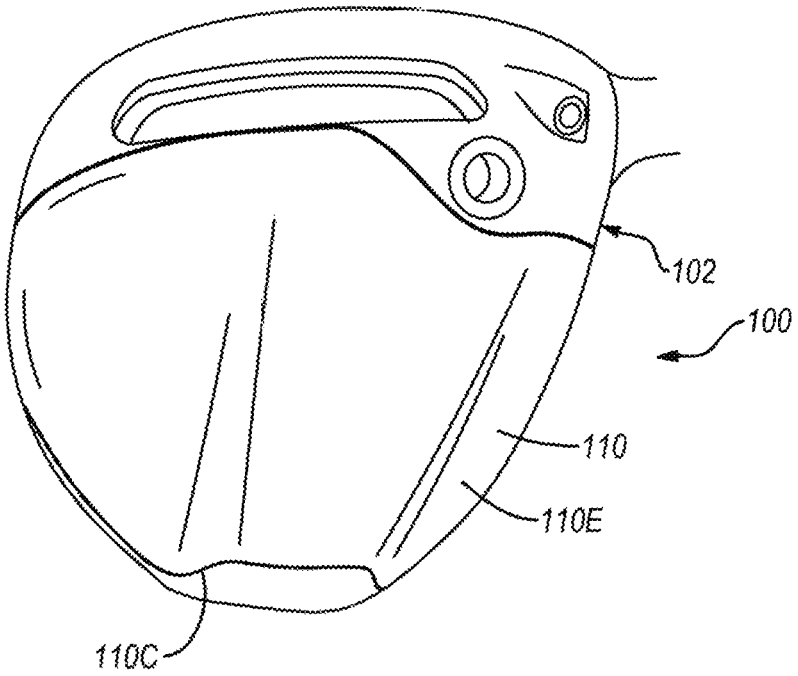
FIG. 56 is a schematic, bottom plan view of a golf club head that includes a sole insert, according to one or more examples of the present disclosure.

After the first release layer 256A is removed, a surface of the bonding tape 174, facing away from the recess, is exposed. While retaining the bonding tape package 254 in the recess 262, via the suction force, a part can be pressed against the exposed surface of the bonding tape 174, as shown in FIG. 52, which temporarily adheres the bonding tape 174 to the part via the tackiness of the bonding tape 174. The recess 262 can be configured to have an outer peripheral shape that matches the outer peripheral shape of the part, such that the recess acts as a guide to align the part relative to the bonding tape 174. When the part is temporarily adhered to the exposed surface of the bonding tape 174, the vacuum device 268 is selectively controlled to release the suction force, which allows the bonding tape package 254 to be removed from the recess 262 by lifting the part away from the recess 262. As shown in FIG. 53, the bonding tape package 254 is temporarily adhered to an interior surface of the part such that the second release layer 256B is accessible. When ready, the second release layer 256B can be removed to expose another surface of the bonding tape 174 in preparation for pressing newly exposed surface of the bonding tape 174 against a second part, which temporarily adheres the bonding tape 174 to the second part via the tackiness of the bonding tape 174, as shown in FIG. 56. In this manner, the bonding tape 174 forms a temporary bond between two parts, which enables the parts to be handled and prepared for permanent bonding without shifting of the parts relative to each other. It is noted that the parts, which are temporarily bonded together, are pre-formed parts (i.e., parts that have been formed into a permanent form or shape in preparation for final assembly).

Figure 55:
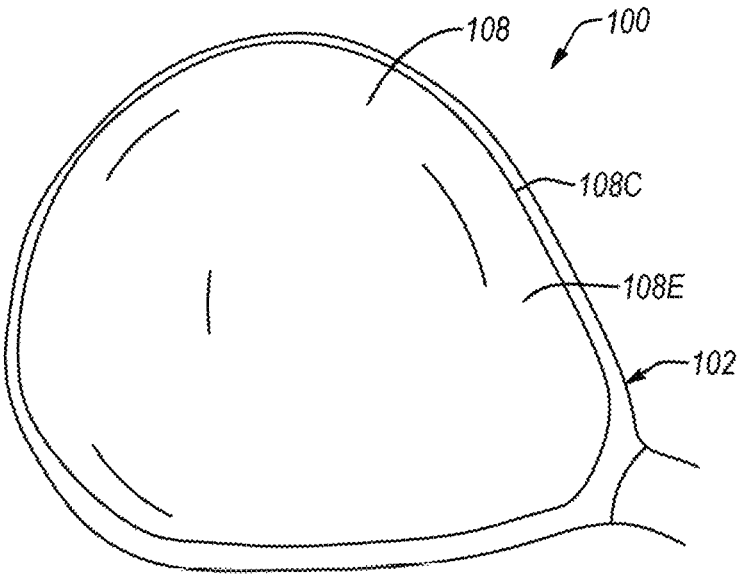
FIG. 55 is a schematic, top plan view of a golf club head that includes a crown insert, according to one or more examples of the present disclosure.
Figure 57A:
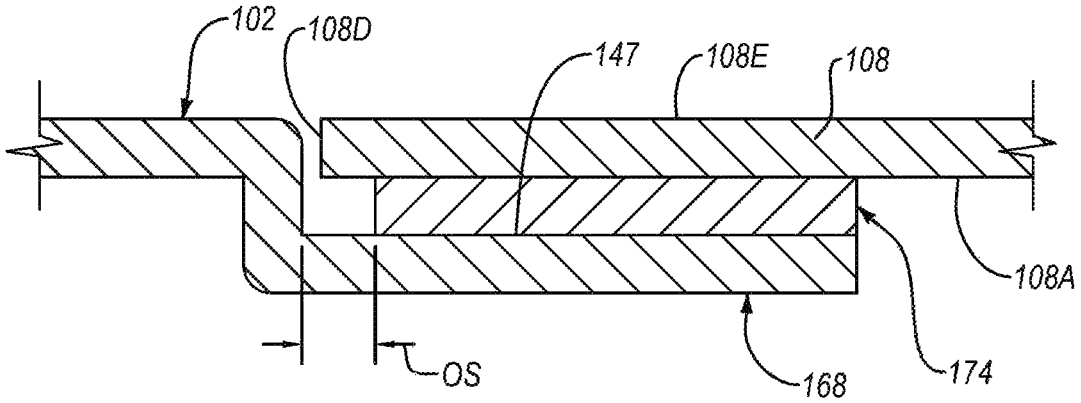
FIG. 57A is a schematic, side elevation, sectional view of a crown insert temporarily bonded, via bonding tape, to a body of a golf club head, according to one or more examples of the present disclosure.

The tape-retention fixture 260, including the conduits 264 and the recess 262, can be configured to accommodate one of many parts of a golf club head. For a golf club head that has multiple bonded joints joining together multiple sets of parts, additional tape-retention fixtures 260 can be employed and configured to accommodate other parts of the golf club head. In the illustrated example of FIGS. 49-52, the tape-retention fixture 260 is specifically configured to temporarily adhere the bonding tape 174 to the crown insert 108 of the golf club head 100. More specifically, as shown in FIG. 53, the bonding tape package 254 is temporarily adhered to an interior surface 108A of the crown insert 108, which, as shown in FIGS. 55 and 57A, is then temporarily adhered to the crown-opening recessed ledge 168 in preparation for permanently bonding the crown insert 108 to the crown-opening recessed ledge 168. The interior surface 108A is opposite an exterior surface 108E of the crown insert 108.

Figure 54:
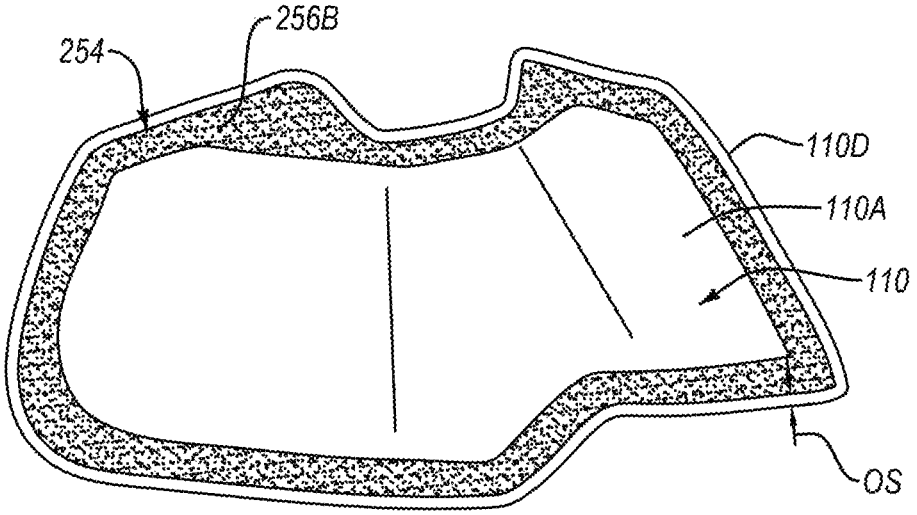
FIG. 54 is a schematic, perspective view of a sole insert of a golf club head, according to one or more examples of the present disclosure.

However, in other examples, with reference to FIGS. 54 and 56, the tape-retention fixture 260 can be specifically configured to temporarily adhere the bonding tape 174 to the sole insert 110 of the golf club head 100. More specifically, as shown in FIG. 54, the bonding tape package 254 is temporarily adhered to an interior surface 110A of the sole insert 110, which, as shown in FIG. 56, is then temporarily adhered to the sole-opening recessed ledge 170 in preparation for permanently bonding the sole insert 110 to the sole-opening recessed ledge 170. The interior surface 110A is opposite an exterior surface 110E of the sole insert 110.

In yet other examples, with reference to FIGS. 40 and 41, the tape-retention fixture 260 can be specifically configured to temporarily adhere the bonding tape 174 to the strike plate 143 of the golf club head 100. More specifically, the bonding tape package 254 is temporarily adhered to the interior surface 166 of the strike plate 143, which is then temporarily adhered to the plate-opening recessed ledge 147 in preparation for permanently bonding the strike plate 143 to the plate-opening recessed ledge 147.

According to some examples, with reference to FIGS. 14 and 15, the tape-retention fixture 260 can be specifically configured to temporarily adhere the bonding tape 174 to the ring 106 of the golf club head 100. More specifically, the bonding tape 174 of respective ones of bonding tape packages 254 are temporarily adhered to the toe cup-engagement surface 152A and the heel cup-engagement surface 152B of the ring 106, which is then temporarily adhered to the toe ring-engagement surface 150A and the heel ring-engagement surface 150B, respectively, of the cast cup 104 in preparation for permanently bonding the ring 106 to the cast cup 104. When permanently bonded, for example, a heel-side ring strip 182A of the bonding tape 174 is between the heel cup-engagement surface 152B and the heel ring-engagement surface 150B, and a toe-side ring strip 182B of the bonding tape 174 is between the toe cup-engagement surface 152A and the toe ring-engagement surface 150A.

Figure 63:
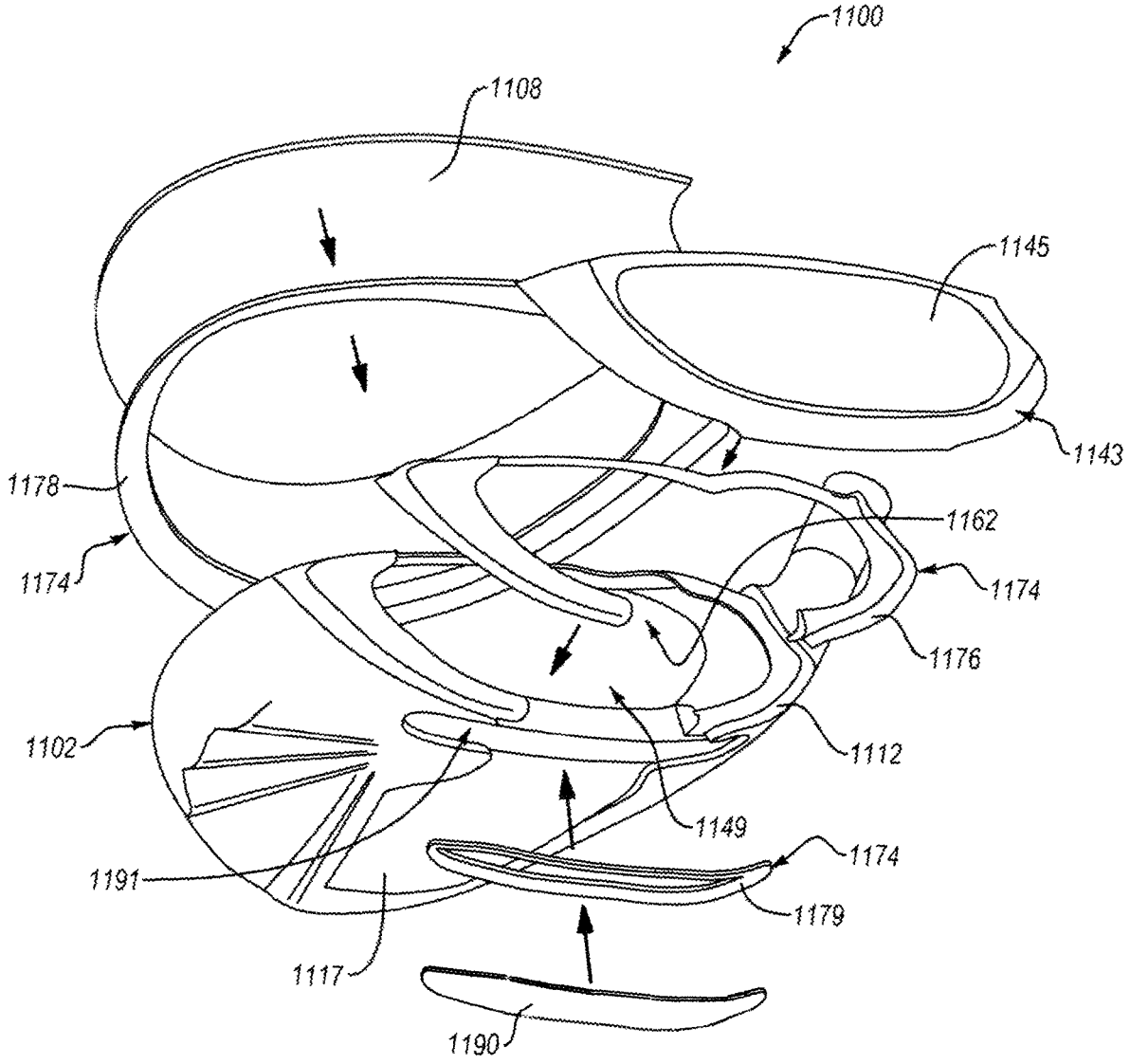
FIG. 63 is a schematic, exploded, perspective view of a fairway-metal type golf club head, according to one or more examples of the present disclosure.

Although in the illustrated examples above, the bonding tape 174 is used to bond together multiple parts of a driver-type golf club head, in other examples, bonding tape can be used to bond together multiple parts of other types of golf club heads in the same or a similar manner as described above. According to one example, as shown in FIG. 63, bonding tape is used to bond together multiple parts of a fairway-metal type golf club head 1100. The golf club head 1100 has a forward portion 1112 and a sole portion 1117. Additionally, the golf club head 1110 includes a body 1102 that defines a crown opening 1162 at a crown portion of the golf club head 1110 and a plate opening 1149 at the forward portion 1112 of the golf club head 1110.

The golf club head 1110 further includes a crown insert 1108 that is attached to the body 1102 over the crown opening 1162 so as to cover the crown opening 1162. The crown insert 1108 is adhered to the body 1102 over the crown opening 1162 by a crown-opening strip 1174 of bonding tape 1174. The crown-opening strip 1174 can be a single continuous strip of bonding tape 1174 or multiple strips of bonding tape 1174. In the illustrated example, the crown-opening strip 1174 is a single continuous strip in the shape of an outer periphery of the crown insert 1108. When attached, the crown-opening strip 1174 is interposed between the crown insert 1108 and the body 1102 to adhere the crown insert 1108 to the body 1102. In some examples, the crown insert 1108 is made of a non-metal material, such as a fiber-reinforced polymeric material as described above.

The golf club head 1110 also includes a strike plate 1143 that is attached to the body 1102 over the plate opening 1149 so as to cover the plate opening 1149. In some examples, the strike plate 1143 includes a wrap-around portion that effectively wraps around a strike face 1145, thus forming part of the crown portion, a toe portion, a heel portion, and the sole portion 1117 of the golf club head 1100. The strike plate 1143 is adhered to the body 1102 over the plate opening 1149 by a plate-opening strip 1176 of bonding tape 1174. The plate-opening strip 1176 can be a single continuous or non-continuous strip of bonding tape 1174 or multiple strips of bonding tape 1174. In the illustrated example, the plate-opening strip 1176 is a single, non-continuous strip in the shape of an outer periphery of the strike plate 1143. When attached, the plate-opening strip 1176 is interposed between the strike plate 1143 and the body 1102 to adhere the strike plate 1143 to the body 1102.

According to certain examples, the strike plate 1145 is made of a non-metal material, such as a fiber-reinforced polymeric material as described above, and the body 1102 is made of a metallic material. In some examples, the strike plate 1145 is made of a first metallic material and the body 1102 is made of a second metallic material. In one example, the strike plate 1145 is made of a titanium alloy and the body 1102 is made of a steel alloy. According to another example, the strike plate 1145 is made of a steel alloy and the body 1102 is made of a titanium alloy. Typically, when a strike plate and a body are made of a metallic material, the metallic materials are welded together and when one of the metallic materials is heat treated, the other of the metallic materials experiences a less than ideal heat treatment (such as a second heat treatment, an overtreatment, or an undertreatment). However, the bonding tape 1174 eliminates the need for a weldment, and thus the body 1102 and the strike plate 1145 can be heat treated separately, under different individualized heat treatment conditions conducive to the particular types of metallic materials of the body 1102 and the strike plate 1145. Although the metal-to-metal adhesive bond facilitated by the bonding tape 1174 is shown associated with a fairway-metal type golf club head, in other examples, the bonding tape 1174 can facilitate a metal-to-metal adhesive bond between a strike plate and a body, and/or between individual body components, of other types of golf club heads, such as driver-type golf club heads, iron-type golf club heads (e.g., having an interior volume of at least 5 cubic centimeters (such as between, and inclusive of, 5 cc and 20 cc), hybrid-type golf club heads, putter-type golf club heads, and the like. Accordingly, the golf club heads of the present disclosure have an interior volume of at least 5 cc, and up to 600 cc.

In certain examples, the golf club head 1100 also includes a sole slot 1191 and a slot cover 1190 attached to the sole portion 1117 over the sole slot 1191, thus covering the sole slot 1191. The slot cover 1190 is adhered to the body 1102 over the sole slot 1191 by a slot strip 1179 of bonding tape 1174. The slot strip 1179 can be a single continuous or non-continuous strip of bonding tape 1174 or multiple strips of bonding tape 1174. In the illustrated example, the slot strip 1179 is a single, continuous strip in the shape of an outer periphery of the sole slot 1191. When attached, the slot strip 1179 is interposed between the slot cover 1190 and the body 1102 to adhere the slot strip 1179 to the body 1102. In some examples, a portion of the strike plate 1143 defines a portion of the sole slot 1191, and the slot cover 1190 is also adhered to the portion of the strike plate 1143 that defines the sole slot 1191 via the slot strip 1179. The slot cover 1190 is made of a polymeric material (e.g., thermoplastic polyurethane) in some examples. In certain examples, the slot cover 1190 is flat.

Figure 64:
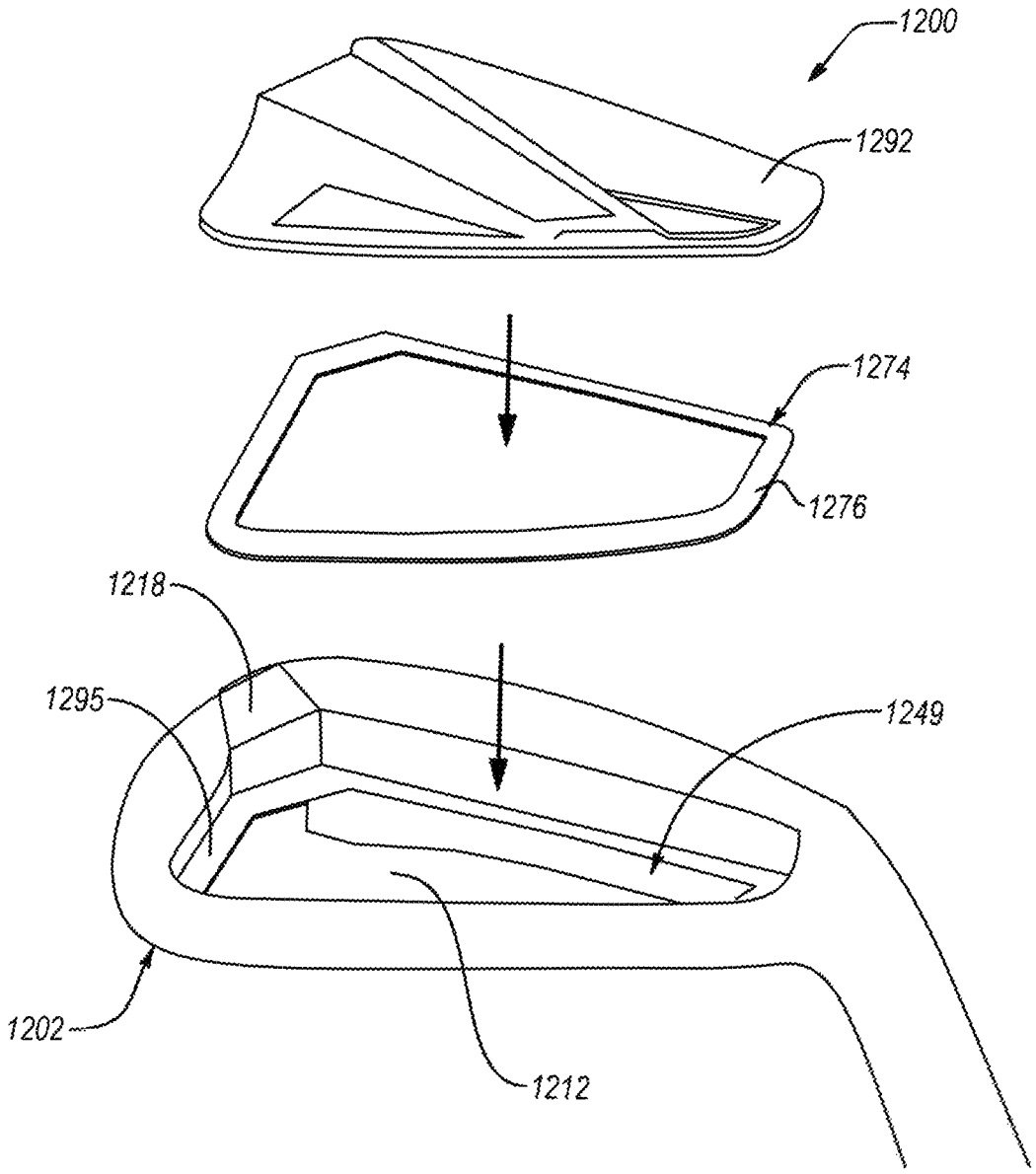
FIG. 64 is a schematic, exploded, perspective view of an iron-type golf club head, according to one or more examples of the present disclosure.

According to another example, as shown in FIG. 64, bonding tape is used to bond together multiple parts of an iron-metal type golf club head 1200. The golf club head 1200 has a forward portion 1212 and a rear portion 1218. Additionally, the golf club head 1210 includes a body 1202 that defines a rear opening 1249 of the rear portion 1218 of the golf club head 1210. The golf club head 1210 also includes a rear badge 1292 (e.g., rear insert, rear cover, rear plate, etc.) that is attached to the body 1202 over the rear opening 1249 so as to cover the rear opening 1249. In certain examples, a rear ledge 1295, formed in the rear portion 1218, defines the rear opening 1249. The rear badge 1292 is adhered to the body 1202 over the rear opening 1249 by a rear-opening strip 1276 of bonding tape 1274. The rear-opening strip 1276 can be a single continuous or non-continuous strip of bonding tape 1274 or multiple strips of bonding tape 1274. In the illustrated example, the rear-opening strip 1276 is a single, non-continuous strip in the shape of an outer periphery of the rear badge 1292. When attached, the rear-opening strip 1276 is interposed between the rear badge 1292 and the body 1202 to adhere the rear badge 1292 to the body 1202.

In some examples, the body 1202 is made of a metallic material (e.g., steel) and the rear badge 1292 is made of a non-metallic material (e.g., a polymer). In alternative examples, both the body 1202 and the rear badge 1292 are made of a metallic material.

Figure 67:
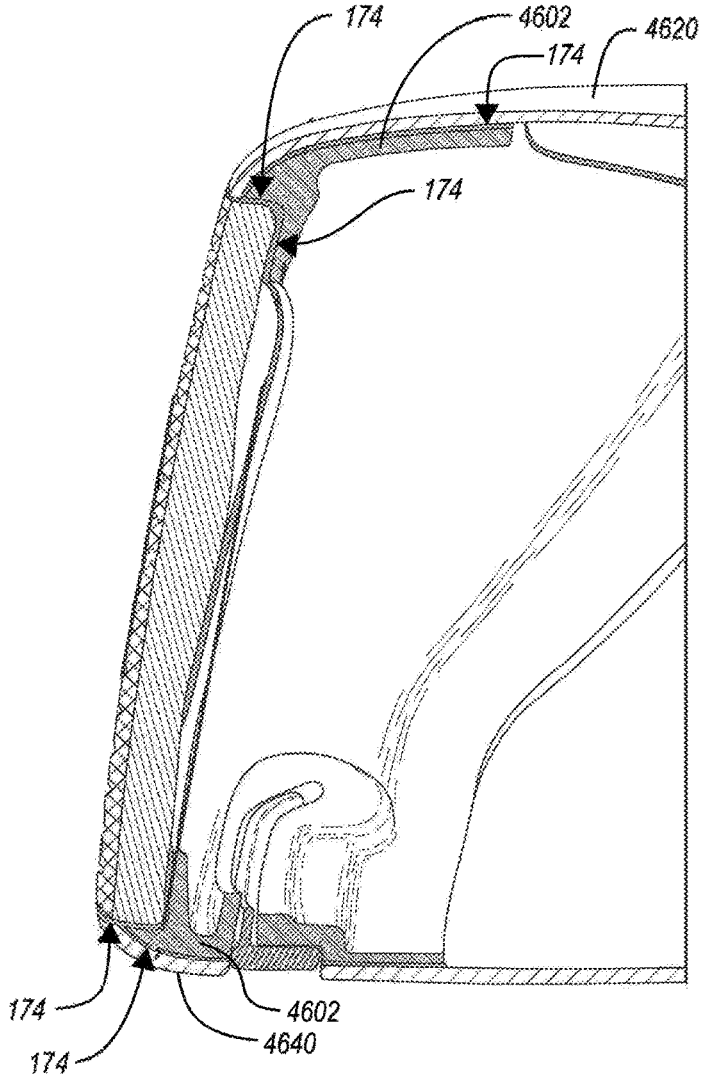
FIG. 67 is a schematic, sectional, side elevation view of a golf club head, according to one or more examples of the present disclosure.
Figure 68:
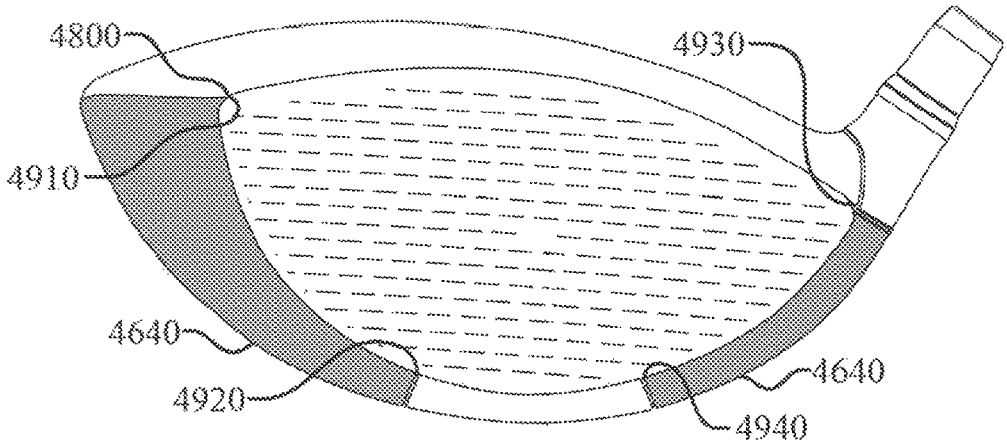
FIG. 68 is a schematic, front elevation view of a golf club head, according to one or more examples of the present disclosure.
Figure 69:
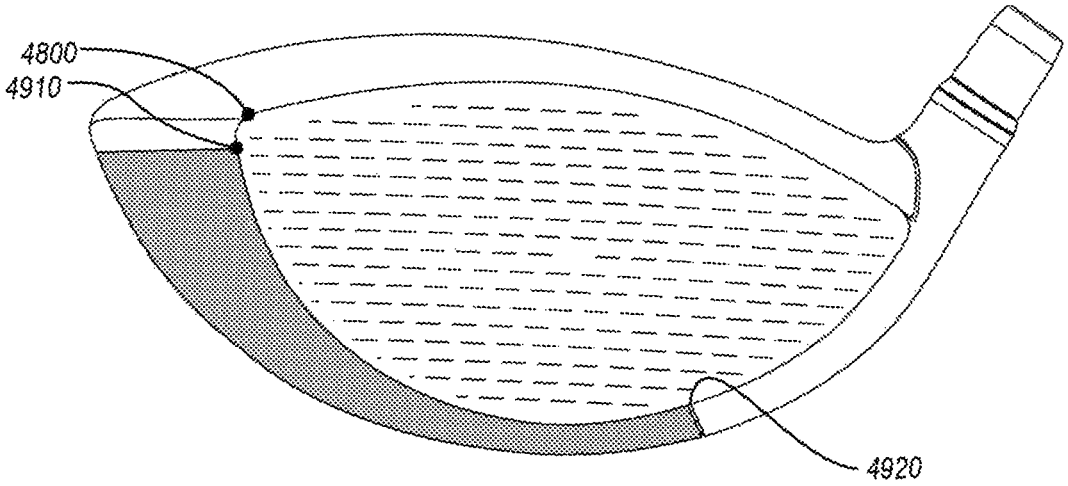
FIG. 69 is a schematic, front elevation view of a golf club head, according to one or more examples of the present disclosure.

Referring to FIGS. 65-69, in some examples, a golf club head includes a crown made of a fiber-reinforced polymeric material that wraps around a transition between the crown and the strike face, such that the fiber-reinforced polymeric material is directly adjacent or abuts the strike face. FIGS. 65-69 illustrate an exemplary golf club head that includes a face plate 4610 and an oversized crown 4620, also referred to as a crown panel, that extends to the front of the club head adjacent to the upper side of the face plate 4610, and in some embodiments forms a topline and/or rear perimeter portion of the club head. The oversized crown 4620 is adhered to the body portion 4602 with bonding tape 174, such as described above, and the face plate 4610 can be adhered to the body portion 4602 with bonding tape 174. The crown 4620 and face plate 4610 can comprise nonmetallic composite materials, in some embodiments, such that the topline is formed where a portion of the composite material of the crown extends to be adjacent to a portion of the face plate. While much of this disclosure is related to relationships of the crown 4620, the face plate 4610, and the associated support structure, it is important to appreciate at the outset that the disclosure and relationships also apply to a sole plate 4640 having a portion wrapping around the front of the club head to be adjacent the face plate 4610 (see, e.g., FIGS. 67-69), which may occur at the toe of the face plate 4610, as seen in FIGS. 68 and 69, at the heel of the face plate 4610, as seen in FIG. 68, at the lower portion of the face plate 4610, as seen in FIGS. 67 and 69, and any combinations thereof. Similarly, the disclosure and relationships also apply to individual plates that may form only a portion of the skirt, and may be located at the toe or heel, and may not constitute a portion of the sole. The sole plate 4640 can be adhered to the body portion 4602 with bonding tape 174, such as described above.

The club head include a body 4602 that includes a hosel portion and provides a primary structural support for the club head, and various other components are coupled to the body, which may include the face plate 4610 and the crown 4620, and in some embodiments a sole plate 4640, one or more weights, and/or other features. In some embodiments, the body includes a front body portion (labeled as 4602) and a rear ring portion attached together (e.g., welded, bonded, or mechanically attached) at the heel and toe ends, or integrally formed. Whether attached together or integrally formed, the front body portion 4602 and the rear ring portion compose a frame that serves as the supporting structure for the attachment of other components, which may include the crown 4620, the face plate 4610, and/or the sole plate 4640. Further, as disclosed later in detail, the face plate 4610 may be attached to, or integrally formed with the frame and/or front body portion 4602 and therefore the use of the term plate is not to imply a separate component, although it may be a separate component as disclosed in more detail later. Similarly, the sole plate 4640 may be attached to, or integrally formed with the frame, front body portion 4602, and/or rear ring portion, and therefore the use of the term plate is not to imply a separate component, although it may be as disclosed in more detail later.

Figure 65:
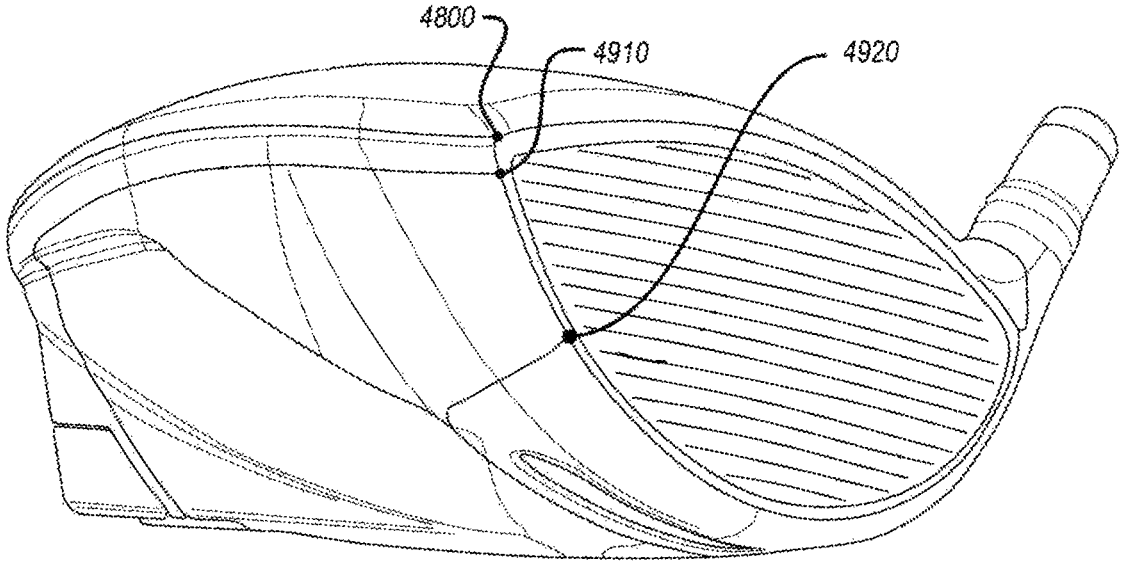
FIG. 65 is a schematic, perspective view of a golf club head, according to one or more examples of the present disclosure.
Figure 66A:
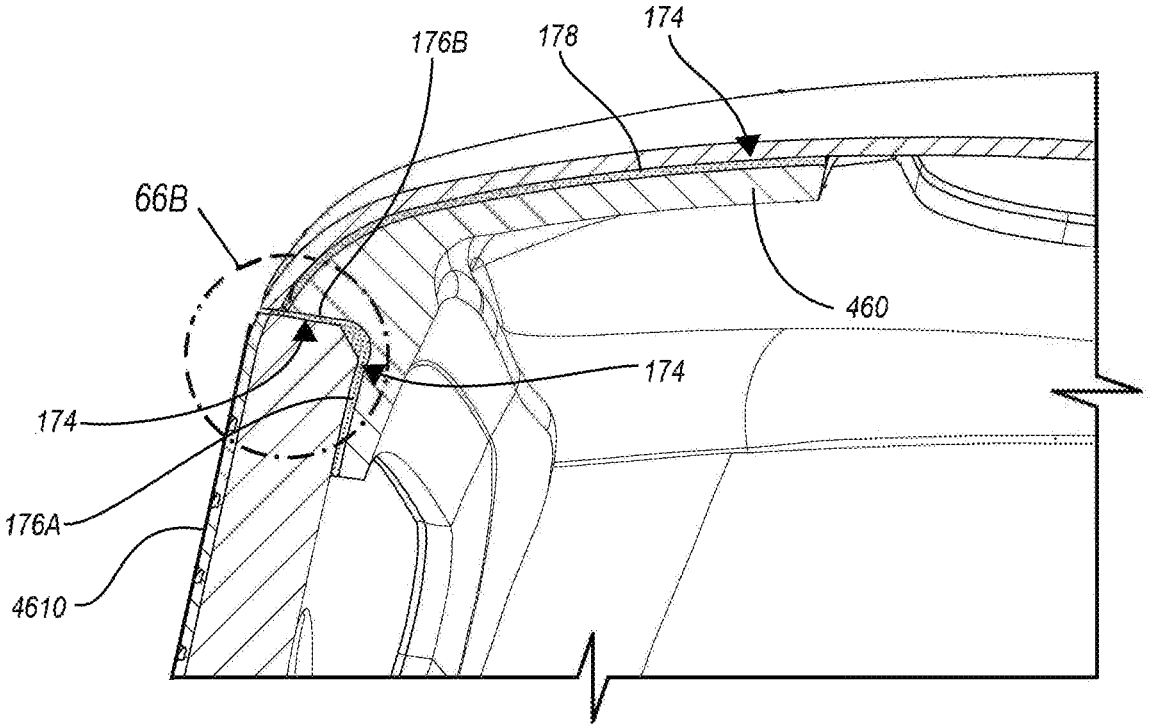
FIG. 66A is a schematic, sectional, side elevation view of a golf club head, according to one or more examples of the present disclosure.
Figure 66B:
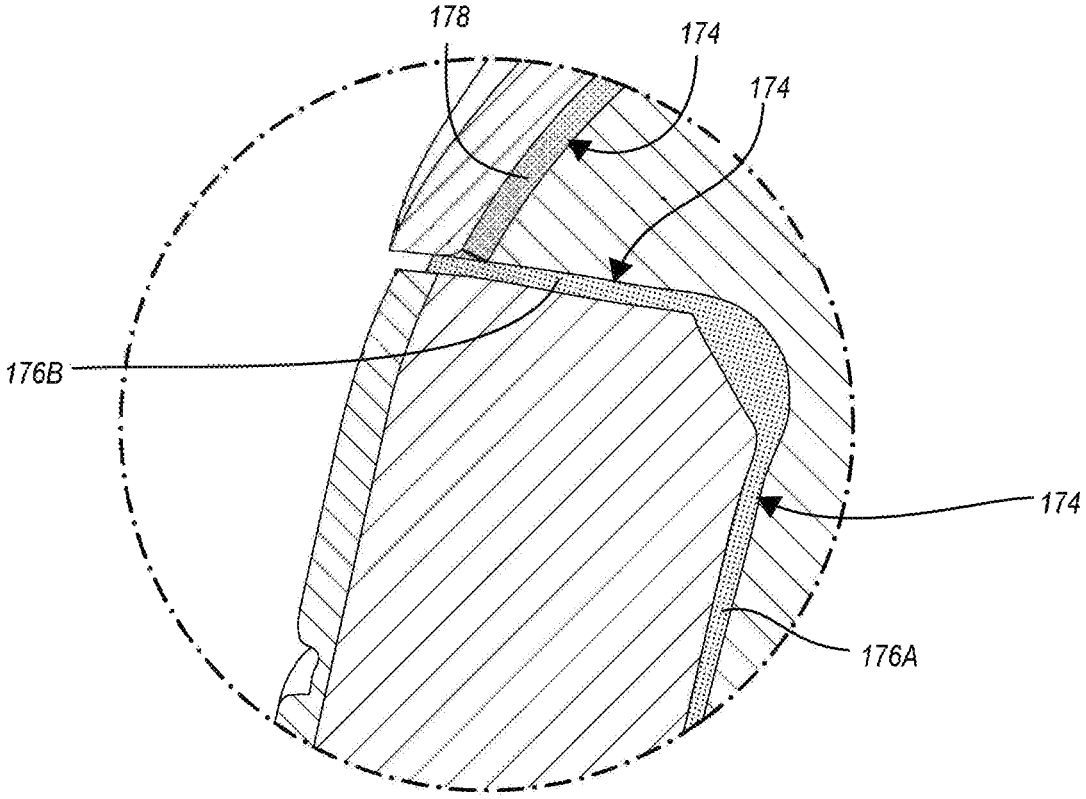
FIG. 66B is a schematic, sectional, close-up, side elevation view of the golf club head of FIG. 66A, according to one or more examples of the present disclosure.

While many of the disclosed embodiments relate to interfaces associated with a crown 4620 bonded to the frame and wrapping toward the face plate 4610, all of the disclosed relationships apply equally to one, or more, sole panels 4640 wrapping toward the face plate 4610, skirt panels wrapping toward the face plate 4610 at the heel and/or toe, and/or the rear ring portion 4630 wrapping toward the face plate 4610. For instance, FIG. 65 illustrates a sole insert 4640 that wraps around the front body portion 4602 to terminate adjacent the face plate 4610 at the toe side of the club head. In this embodiment a toe-side crown-to-face junction point 4800 is illustrated, but now there is also a first sole-to-face junction point 4910 and a second sole-to-face junction point 4920. In this embodiment the first sole-to-face junction point 4910 occurs where the sole insert 4640 is adjacent to the face plate 4610 and the front body portion 4602. Similarly, in this embodiment the second sole-to-face junction point 4920 occurs where the sole insert 4640 is adjacent to the face plate 4610 and the front body portion 4602. Additionally, the sole insert 4640 may wrap around to be adjacent the face plate 4610 in multiple distinct regions, as seen in the shaded regions of FIG. 68. Thus, as seen in FIG. 68, the sole insert 4640 may additionally have a third sole-to-face junction point 4930 and a fourth sole-to-face junction point 4940.

Figure 58:
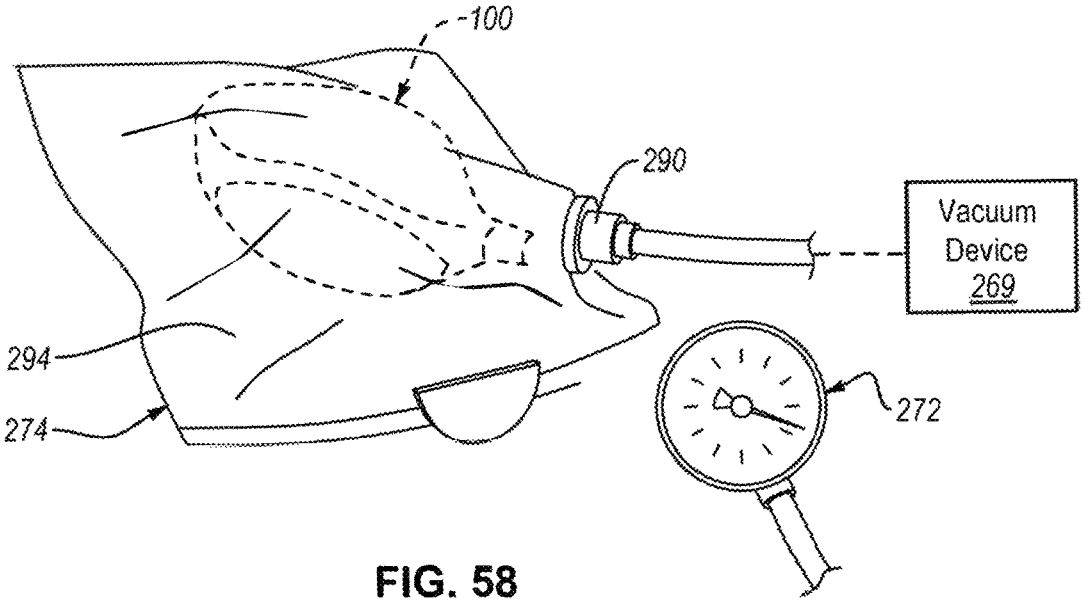
FIG. 58 is a schematic, perspective view of a vacuum bag, in a non-collapsed state, enclosing a golf club head, according to one or more examples of the present disclosure.
Figure 59:
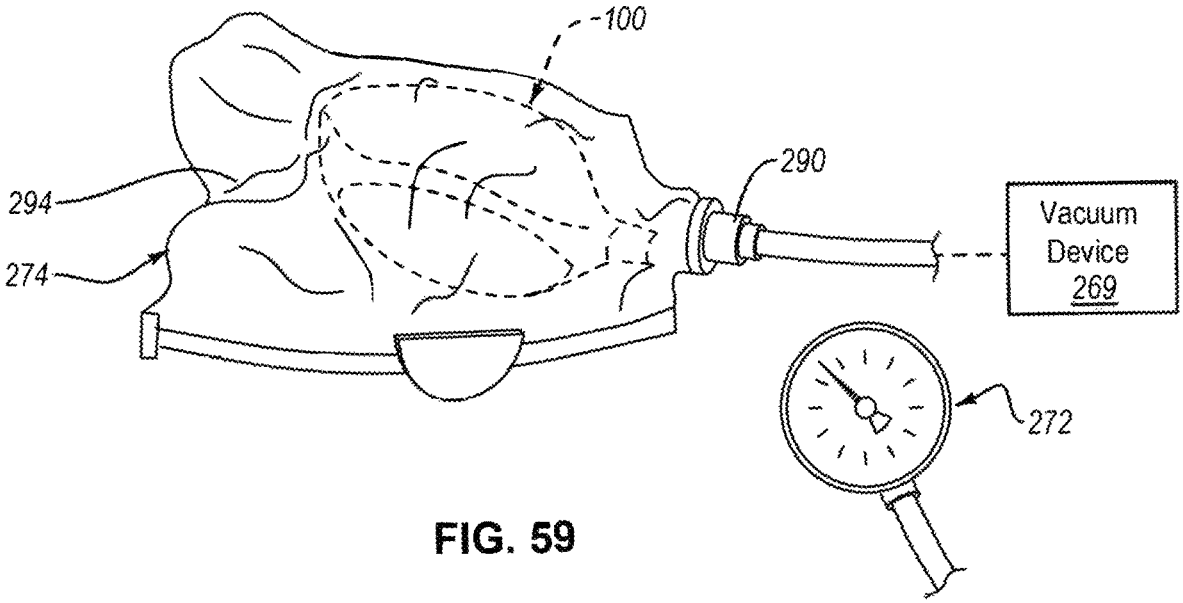
FIG. 59 is a schematic, perspective view of a vacuum bag, in a collapsed state, enclosing a golf club head, according to one or more examples of the present disclosure.
Figure 60:
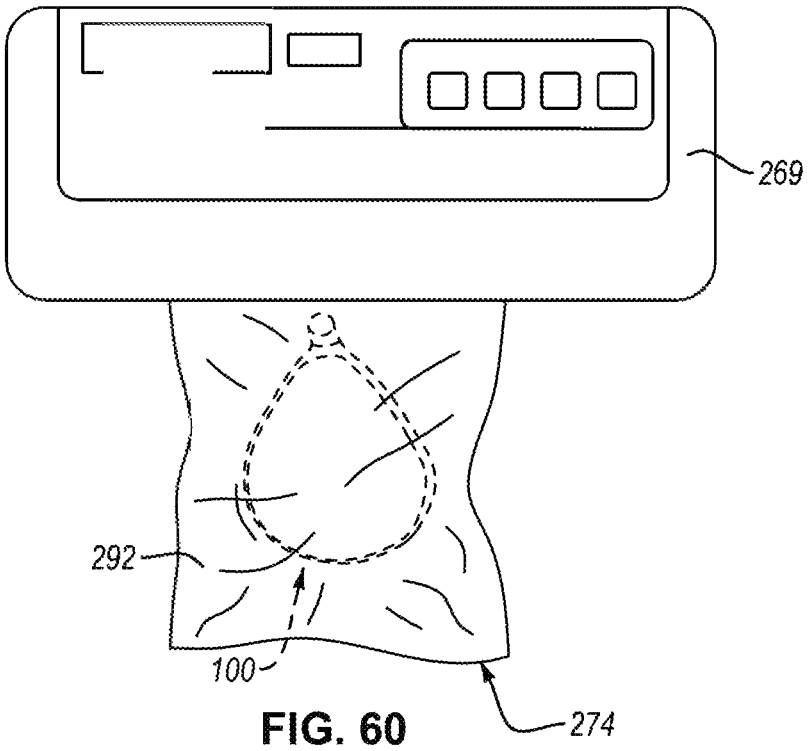
FIG. 60 is a schematic, perspective view of a vacuum bag, in a non-collapsed state, enclosing a golf club head, according to one or more examples of the present disclosure.
Figure 61:
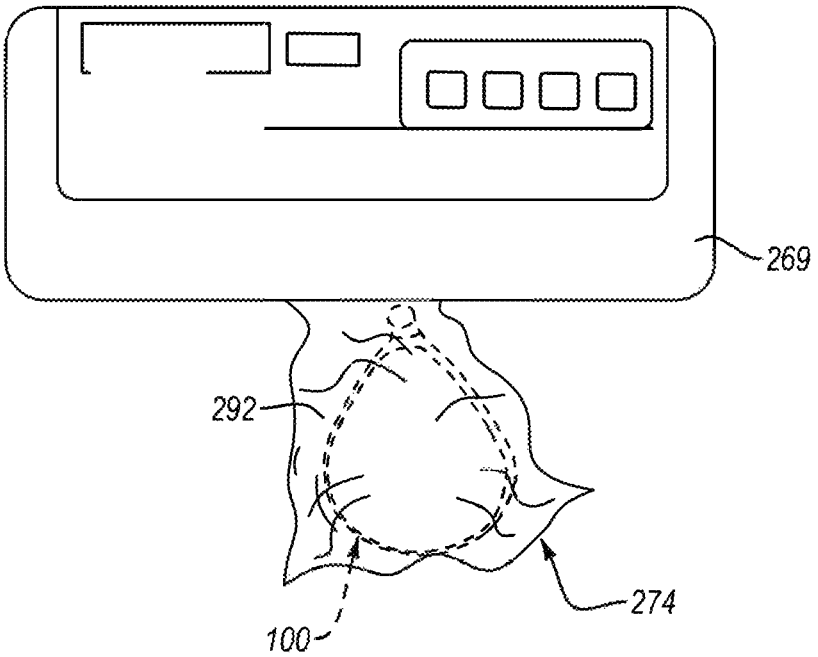
FIG. 61 is a schematic, perspective view of a vacuum bag, in a collapsed state, enclosing a golf club head, according to one or more examples of the present disclosure.

After at least two parts of the golf club head 100 are temporarily bonded together by the bonding tape 174, when in an uncured state, the at least two parts of the golf club head 100 are permanently bonded together, by converting the bonding tape 174 into a cured state, via the application of heat and pressure. Referring to FIGS. 58-62, according to some examples, pressure is applied to the golf club head 100 in a uniform manner with a vacuum bag 274 when the golf club head 100 is sealed within the vacuum bag 274. In some examples, such as shown in FIGS. 58 and 59, the vacuum bag 274 is a reusable vacuum bag 294. However, in alternative examples, as shown in FIGS. 60 and 61, the vacuum bag 274 is a disposable vacuum bag 292. In either case, with the golf club head 100 inside the vacuum bag 274, the vacuum bag 274 is sealable and fluidically coupled to a vacuum device 269, which is configured to reduce the pressure within the vacuum bag 274, to a pressure below ambient or environmental conditions, when the vacuum bag 274 is sealed with the golf club head 100 inside. Reducing the pressure within the vacuum bag 274 creates a pressure differential between air outside the vacuum bag 274 and inside the vacuum bag 274. The pressure differential causes the vacuum bag 274 to collapse onto the golf club head 100 and to apply a pressure onto the golf club head 100 proportional to the pressure differential. Because the pressure differential is uniform about the vacuum bag 274, the pressure applied onto the golf club head 100 is correspondingly uniform. Accordingly, the pressure applied to the bonding tape 174 also is uniform.

It is noted that when the vacuum bag 274 is used to apply a uniform pressure to the golf club head 100, the parts of the golf club head 100 being bonded together are in a fully-formed state (i.e., parts that have been formed into a permanent form or shape in preparation for final assembly). For example, for parts that are made of a fiber-reinforced polymeric material, the fiber-reinforced material has been previously shaped and cured into a final shape. Accordingly, the collapsed vacuum bag 274 is used solely to apply pressure to the bonding tape 174 and, with the parts of the golf club head 100 in a fully-formed state, does not shape or contribute to the formation of the individual parts.

As shown in FIGS. 58 and 59, in some examples, the pressure differential, which can be measured by a pressure gauge 272, is between, and inclusive of, 30 cmHg and 70 cmHg, between, and inclusive of, 40 cmHg and 60 cmHg, or substantially 50 cmHg.

Referring back to FIGS. 58 and 59, the reusable vacuum bag 274 is configured for repeated use. Accordingly, the reusable vacuum bag 274 is made from a material and has a thickness that is suitable for repeated use. In one example, the reusable vacuum bag 274 is made of polyethylene or other similar plastic material. Alternatively, the reusable vacuum bag 274 can be made of a rubber or rubber-like material, such as silicone. Moreover, in certain examples, the reusable vacuum bag 274 has a thickness of between, and inclusive of, 60 microns and 100 microns, between, and inclusive of, 70 microns and 90 microns, or substantially 80 microns. The reusable vacuum bag 274 can have a vacuum port 290 that is built into the vacuum bag 274. The vacuum port 290 is configured to receive a coupling from the vacuum device 269 in a selectively releasable and repeated manner.

As shown in FIGS. 60 and 61, the disposable vacuum bag 274 is configured for single use. Accordingly, the disposable vacuum bag 274 can be made from a material that is less durable than the reusable vacuum bag 274. For example, the disposable vacuum bag 274 can be made of a plastic material that is thinner than the reusable vacuum bag 274. Moreover, in some examples, the vacuum device 269 can be specifically configured for use with the disposable vacuum bag 274. In one example, the vacuum device 269 can be similar to a shrink-wrap machine that creates the pressure differential and seals an opening of the disposable vacuum bag 274 after the pressure differential is met. Accordingly, in some examples, the disposable vacuum bag 274 is a shrink-wrap or a heat-shrink material.

Figure 62:
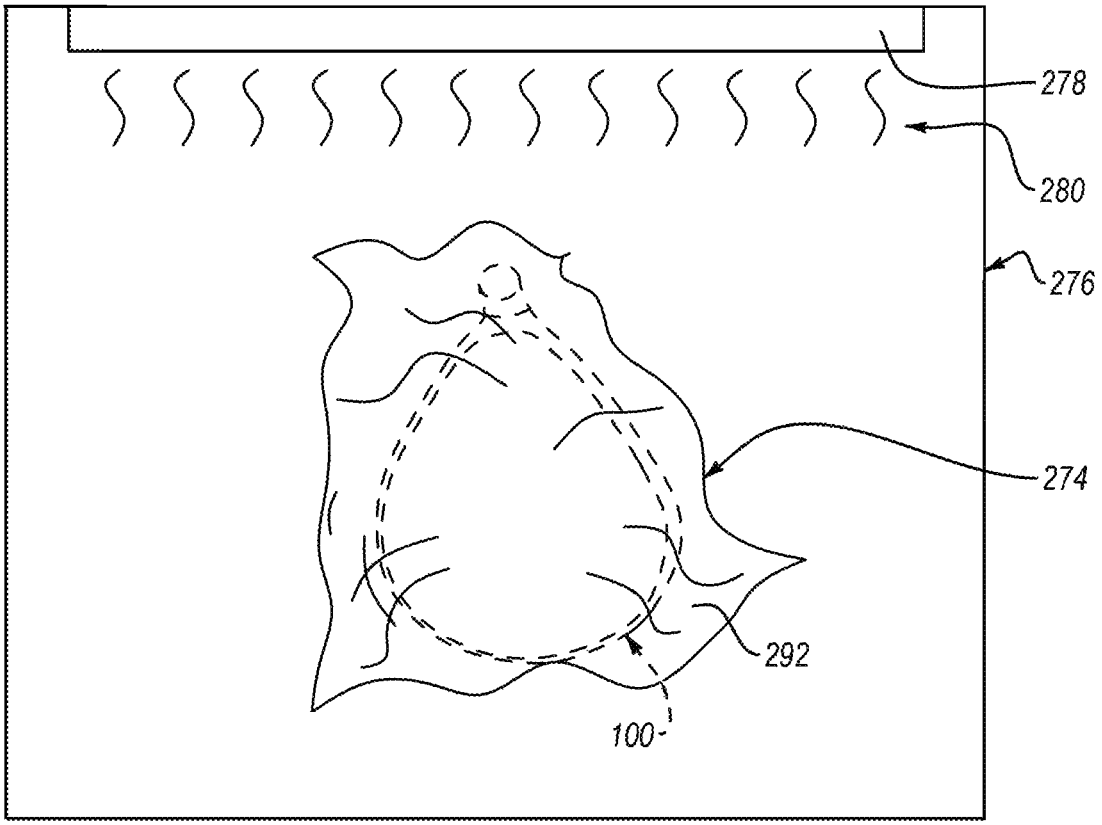
FIG. 62 is a schematic, side elevation, sectional view of an oven, according to one or more examples of the present disclosure.

When the vacuum bag 274 is collapsed against and applies pressure onto the golf club head 100, according to the pressure differential created by the vacuum device 269, the golf club head 100 is heated to at least the curing temperature of the bonding tape 174. As stated above, the concurrent application of the pressure and heat cures the bonding tape 174 between parts to permanently bond the parts together. Referring to FIG. 62, in some examples, with the vacuum bag 274 collapsed against and applying pressure to the golf club head 100, the vacuum bag 274 and golf club head 100 is located in an enclosed cavity 227 of an oven 276. The oven 276 includes a heating element 278 that is configured to heat the enclosed cavity 277 and thus apply heat 280 to the golf club head 100 in the vacuum bag 274 when positioned in the enclosed cavity 227. Although a disposable vacuum bag 274, collapsed against the golf club head 100, is shown in the oven 276, in other examples, a reusable vacuum bag 274, collapsed against the golf club head 100, can be used instead. Moreover, although the oven 276 can be used to apply the heat 280 to the golf club head 100, when pressurized by the vacuum bag 274, in other examples, heat can be applied in ways other than an oven.

In alternative examples, rather than collapse the vacuum bag 274 by reducing the pressure within the vacuum bag 274, the pressure outside the vacuum bag 274 can be increased to create the necessary pressure differential to collapse the vacuum bag 274 onto the golf club head 100. For example, in some examples, the oven 276 is fluidically coupled to a vacuum device, which is selectively operable to increase the pressure within the enclosed cavity 227 when a vacuum bag 274, sealed to enclose the golf club head 100 within the vacuum bag 274, is positioned within the enclosed cavity 227. In this manner, the oven 276, acting as an autoclave, can concurrently apply heat and create the pressure differential necessary to cure the bonding tape 174.

Because of the unique characteristics of the bonding tape 174, compared to flowable adhesives, the bonding tape 174 can be cured, via pressure and heat, with little to no bleeding or flowing of the bonding tape 174 out of the bonded joint during pressurization and heating of the bonding tape 174. Accordingly, the pressure necessary to cure the bonding tape 174 can be applied via the vacuum bag 274. In contrast, with conventional flowable adhesives, the application of pressure by a vacuum bag would cause the adhesives to flow out of the bonded joint and smear against the interior of the vacuum bag and the part. Such a result would create unnecessary delays, expense, and labor associated with removing excess adhesives from the part. Moreover, bleeding of the adhesives onto the vacuum bag would prevent the vacuum bag from being reusable for pressurizing other parts. Additional advantages associated with the use of the bonding tape 174 include a reduction in the complexity of the bonding process and the necessary training required to implement the bonding process, which translates into lower training costs.

In some examples, for golf club heads with multiple parts bonded together via multiple bonded joints, such as the golf club head 100, all the bonded joints are formed concurrently by concurrently pressurizing and heating the bonding tape 174 forming the bonded joints. In other words, the bonding tape 174 of all the bonded joints of the golf club head 100 can be cured (e.g., pressurized and heated) in a single pressurization and heating step using one vacuum bag. For example, the strike plate 143, the crown insert 108, and the sole insert 110 can be bonded to the body 102 by curing the bonding tape 174 between them at the same time. However, in other examples, at least one bonded joint of the golf club head 100 can be formed in a first pressurizing and heating step, using a first vacuum bag, and at least another bonded joint of the golf club head 100 can be formed subsequently in a second pressurizing and heating step, using the first vacuum bag or a second vacuum bag. For example, the crown insert 108 and the sole insert 110 can be bonded to the body, by curing the bonding tape 174 between them at a first time, and the strike plate 143 can be bonded to the body 102, by curing the bonding tape 174 between them at a second time, different (e.g., later or earlier) than the first time. By staggering the curing of the bonding tape 174 in this manner, inspection of one or more bonded joints, from an inside of the golf club head 100, can be performed before the inside of the golf club head 100 is enclosed.

Although the bonding tape 174 does not flow during pressurization and heating of the bonding tape 174, it may expand. Unlike conventional, flowable adhesives, the expansion of bonding tape 174 is predictable and controllable. Accordingly, the size and positioning of the bonding tape 174, between the parts to be bonded, can be selected to accommodate the expansion of the bonding tape 174 and ensure the bonding tape 174 is properly distributed in the bonded joint without bleeding (e.g., squeeze out) from the bonded joint during pressurization and heating. Referring to FIG. 57A, in some examples, the bonding tape 174 is temporarily applied to a first part such that when the first part is temporarily bonded to a second part via the bonding tape 174, an offset OS is defined between an outer peripheral edge of the first part and an outer peripheral edge of the bonding tape 174. In some examples, the offset OS, defined between an outer peripheral edge of the first part and an outer peripheral edge of the bonding tape 174, is at least 0.25 mm, at least 0.5 mm, or at least 1.0 mm. According to these or other examples, the offset OS is no more than 2.5 mm, 3.0 mm, or 5.0 mm. The outer peripheral edge of the first part defines an outermost bondline between the first part and the second part. The amount of offset OS is dependent on at least the amount (e.g., surface area) of the bonding tape 174 forming the bonded joint.

In the example of FIG. 57A, the first part is the crown insert 108 and the second part is the body 102 such that the offset OS is associated with the crown insert 108 and an outer periphery 108D of the crown insert 108 (see also FIG. 53). According to another example, as shown in FIG. 54, the first part is the sole insert 110 and the second part is the body 102 such that the offset OS is associated with the sole insert 110 and an outer periphery 110D of the sole insert 110. The offset OS associated with the crown insert 108 can be different than the offset OS associated with the sole insert 110. In some examples, the offset OS associated with the crown insert 108 is at least double that associated with the sole insert 110. In one example, the offset OS associated with the crown insert 108 is substantially 2 mm and the offset OS associated with the sole insert 110 is substantially 1 mm. Although not shown, the bonding tape 174 used to bond together the ring 106 and the cast cup 104 can be offset relative to one or both of the engagement surfaces of the ring 106 and the cast cup 104.

Figure 57B:
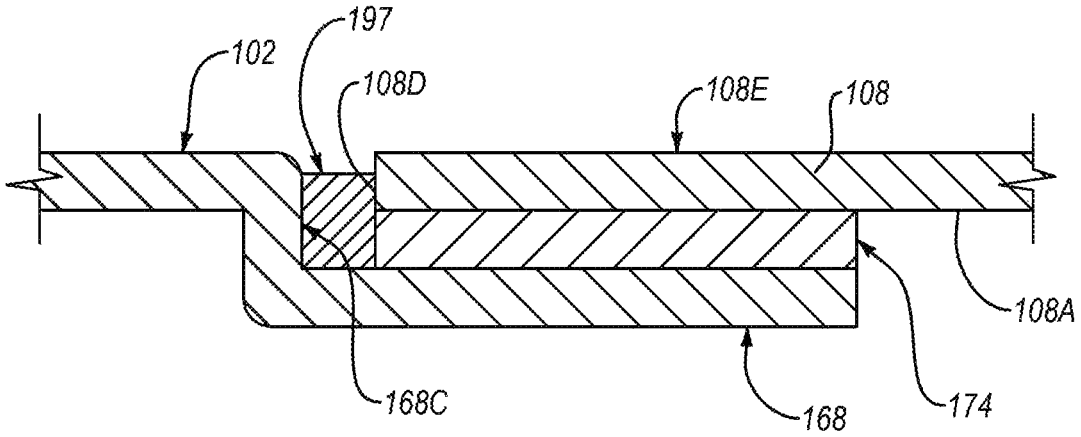
FIG. 57B is a schematic, side elevation, sectional view of a crown insert temporarily bonded, via bonding tape, to a body of a golf club head, according to one or more examples of the present disclosure.

Referring to FIG. 57B, in some alternative examples, the bonding tape 174 is applied onto a part, in preparation for attachment to a second part, without an offset between the outer peripheral edge of the first part and the bonding tape 174. In such examples, a gap filler 197 can function as a physical barrier to prevent bleeding or squeeze out of the bonding tape 174 from the bonded joint during pressurization and heating. The gap filler 197 is positioned in a gap defined between the second part and the outer peripheries of the bonding tape 174 and the first part. In the example of FIG. 57B, the first part is the crown insert 108 and the second part is the body 102. Accordingly, the gap filler 197 is positioned between the outer periphery 108D of the crown insert 108 and a sidewall 168C of the crown-opening recessed ledge 168. With the gap filler 197 in this position, the bonding tape 174 is prevented from expanding or bleeding out of the bonded joint during pressurization and heating of the bonding tape 174.

The gap filler 197 is made from any of various materials capable of keeping its shape (e.g., not flowing or bleeding) when the bonding tape 174 is heating and pressurized during curing of the bonding tape 174. Accordingly, the material of the gap filler 197 is different than that of the bonding tape 174. In some example, the material of the gap filler 197 is also different than that of the first part and the second part. In one example, the gap filler 197 is made of a flowable material that is curable to become non-flowable, and remain relatively non-flowable when the bonding tape 174 is cured. According to some examples, the gap filler 197 is made of an adhesive material, such as an epoxy-based structural adhesive.

According to some examples, the gap filler 197 is injected into the gap between the second part and the outer peripheries of the bonding tape 174 and the first part, after the first part is temporarily adhered to the second part via the bonding tape 174 and before the bonding tape 174 is cured. The gap filler 197 is then cured. The curing conditions of the gap filler 197 are different than those of the bonding tape 174, such that curing of the gap filler 197 does not cure the bonding tape 174. In some examples, the gap filler 197 is cured at approximately room temperature for a predetermined period, such as at least 2 hours. After the gap filler 197 is cured, the bonding tape 174 is then pressurized and heated, as presented above, to cure the bonding tape 174 and form the bonded joint between the first part and the second part.

According to some examples, the golf club heads of the present disclosure are configured to be swung at a swing speed such that each collision with a golf ball imparts a force onto the strike face of the golf club heads in the range of 10,000 g to 20,000 g, where g is equal to the force per unit mass due to gravity. The bonding tape of the golf club heads, as described herein, is configured to withstand (e.g., maintain an adequate adhesive bond between bonded parts of the golf club head to maintain proper performance characteristics of the golf club head after) repeated impacts with a golf ball at swing speeds of at least 70 miles per hour (mph) (e.g., between, and inclusive of, 70 mph and 100 mph).

Although not specifically shown, the golf club head 100 of the present disclosure may include other features to promote the performance characteristics of the golf club head 100. For example, the golf club head 100, in some implementations, includes movable weight features similar to those described in more detail in U.S. Pat. Nos. 6,773,360; 7,166,040; 7,452,285; 7,628,707; 7,186,190; 7,591,738; 7,963,861; 7,621,823; 7,448,963; 7,568,985; 7,578,753; 7,717,804; 7,717,805; 7,530,904; 7,540,811; 7,407,447; 7,632,194; 7,846,041; 7,419,441; 7,713,142; 7,744,484; 7,223,180; 7,410,425; and 7,410,426, the entire contents of each of which are incorporated herein by reference in their entirety.

In certain implementations, for example, the golf club head 100 includes slidable weight features similar to those described in more detail in U.S. Pat. Nos. 7,775,905 and 8,444,505; U.S. patent application Ser. No. 13/898,313, filed on May 20, 2013; U.S. patent application Ser. No. 14/047,880, filed on Oct. 7, 2013; U.S. Patent Application No. 61/702,667, filed on Sep. 18, 2012; U.S. patent application Ser. No. 13/841,325, filed on Mar. 15, 2013; U.S. patent application Ser. No. 13/946,918, filed on Jul. 19, 2013; U.S. patent application Ser. No. 14/789,838, filed on Jul. 1, 2015; U.S. Patent Application No. 62/020,972, filed on Jul. 3, 2014; Patent Application No. 62/065,552, filed on Oct. 17, 2014; and Patent Application No. 62/141,160, filed on Mar. 31, 2015, the entire contents of each of which are hereby incorporated herein by reference in their entirety.

According to some implementations, the golf club head 100 includes aerodynamic shape features similar to those described in more detail in U.S. Patent Application Publication No. 2013/0123040A1, the entire contents of which are incorporated herein by reference in their entirety.

In certain implementations, the golf club head 100 includes removable shaft features similar to those described in more detail in U.S. Pat. No. 8,303,431, the contents of which are incorporated by reference herein in in their entirety.

According to yet some implementations, the golf club head 100 includes adjustable loft/lie features similar to those described in more detail in U.S. Pat. Nos. 8,025,587; 8,235,831; 8,337,319; U.S. Patent Application Publication No. 2011/0312437A1; U.S. Patent Application Publication No. 2012/0258818A1; U.S. Patent Application Publication No. 2012/0122601A1; U.S. Patent Application Publication No. 2012/0071264A1; and U.S. patent application Ser. No.

13/686,677, the entire contents of which are incorporated by reference herein in their entirety.

Additionally, in some implementations, the golf club head 100 includes adjustable sole features similar to those described in more detail in U.S. Pat. No. 8,337,319; U.S. Patent Application Publication Nos. 2011/0152000A1, 2011/0312437, 2012/0122601A1; and U.S. patent application Ser. No. 13/686,677, the entire contents of each of which are incorporated by reference herein in their entirety.

In some implementations, the golf club head 100 includes composite face portion features similar to those described in more detail in U.S. patent application Ser. Nos. 11/998,435; 11/642,310; 11/825,138; 11/823,638; 12/004,386; 12/004,387; 11/960,609; 11/960,610; and U.S. Pat. No. 7,267,620, which are herein incorporated by reference in their entirety.

According to one embodiment, a method of making a golf club head, such as the golf club head 100, includes one or more of the following steps: (1) forming a body having a sole opening, forming a composite laminate sole insert, injection molding a thermoplastic composite head component over the sole insert to create a sole insert unit, and joining the sole insert unit to the body; (2) forming a body having a crown opening, forming a composite laminate crown insert, injection molding a thermoplastic composite head component over the crown insert to create a crown insert unit, and joining the crown insert unit to the body; (3) forming a weight track, capable of supporting one or more slidable weights, in the body; (4) forming the sole insert and/or the crown insert from a thermoplastic composite material having a matrix compatible for bonding with the body; (5) forming the sole insert and/or the crown insert from a continuous fiber composite material having continuous fibers selected from the group consisting of glass fibers, aramide fibers, carbon fibers and any combination thereof, and having a thermoplastic matrix consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; (6) forming both the sole insert and the weight track from thermoplastic composite materials having a compatible matrix; (7) forming the sole insert from a thermosetting material, coating a sole insert with a heat activated adhesive, and forming the weight track from a thermoplastic material capable of being injection molded over the sole insert after the coating step; (8) forming the body from a material selected from the group consisting of titanium, one or more titanium alloys, aluminum, one or more aluminum alloys, steel, one or more steel alloys, polymers, plastics, and any combination thereof; (9) forming the body with a crown opening, forming the crown insert from a composite laminate material, and joining the crown insert to the body such that the crown insert overlies the crown opening; (10) selecting a composite head component from the group consisting of one or more ribs to reinforce the golf club head, one or more ribs to tune acoustic properties of the golf club head, one or more weight ports to receive a fixed weight in a sole portion of the golf club head, one or more weight tracks to receive a slidable weight, and combinations thereof; (11) forming the sole insert and the crown insert from a continuous carbon fiber composite material; (12) forming the sole insert and the crown insert by thermosetting using materials suitable for thermosetting, and coating the sole insert with a heat activated adhesive; and (13) forming the body from titanium, titanium alloy or a combination thereof to have the crown opening, the sole insert, and the weight track from a thermoplastic carbon fiber material having a matrix selected from the group consisting of polyphenylene sulfide (PPS), polyamides, polypropylene, thermoplastic polyurethanes, thermoplastic polyureas, polyamide-amides (PAI), polyether amides (PEI), polyetheretherketones (PEEK), and any combinations thereof; and (13) forming a frame with a crown opening, forming a crown insert from a thermoplastic composite material, and joining the crown insert to the body such that the crown insert overlies the crown opening.

FIGS. 70-110 show example putter head 5100 variations (or more generally, "club head" or "golf club head"), yet the following disclosure applies equally to driver-type golf club heads, iron-type golf club heads, hybrid-type golf club heads, and the like. Any of the putter heads disclosed herein can be coupled to a putter shaft of any type to form a putter, having a grip. The herein disclosed technology can be implemented in any type of putter, such as blade style putters, mallet style putters, long putters, belly putters, toe balance putters, face balanced putters, peripheral weighted putters, face insert putters, heel-shafted putters, center-shafted putters, hosel-offset putters, etc. Although the descriptions and drawings presented herein are mainly associated with putters, any of the technology disclosed herein can analogously be implemented in any other type of golf club, such as a driver, fairway wood, hybrid, rescue, iron (cavity back, muscle back, hollow iron), wedge, or other golf club type, to provide the adjustability and performance benefits disclosed herein. Thus, references to putter head herein may be interchanged with the term club head, driver club head, fairway wood club head, hybrid or rescue club head, iron club head, cavity back iron club head, muscle back iron club head, hollow iron club head, and/or wedge club head. Thus, any of the disclosed club heads can be couple to a shaft of any type to form a golf club, having a grip.

Figure 86:
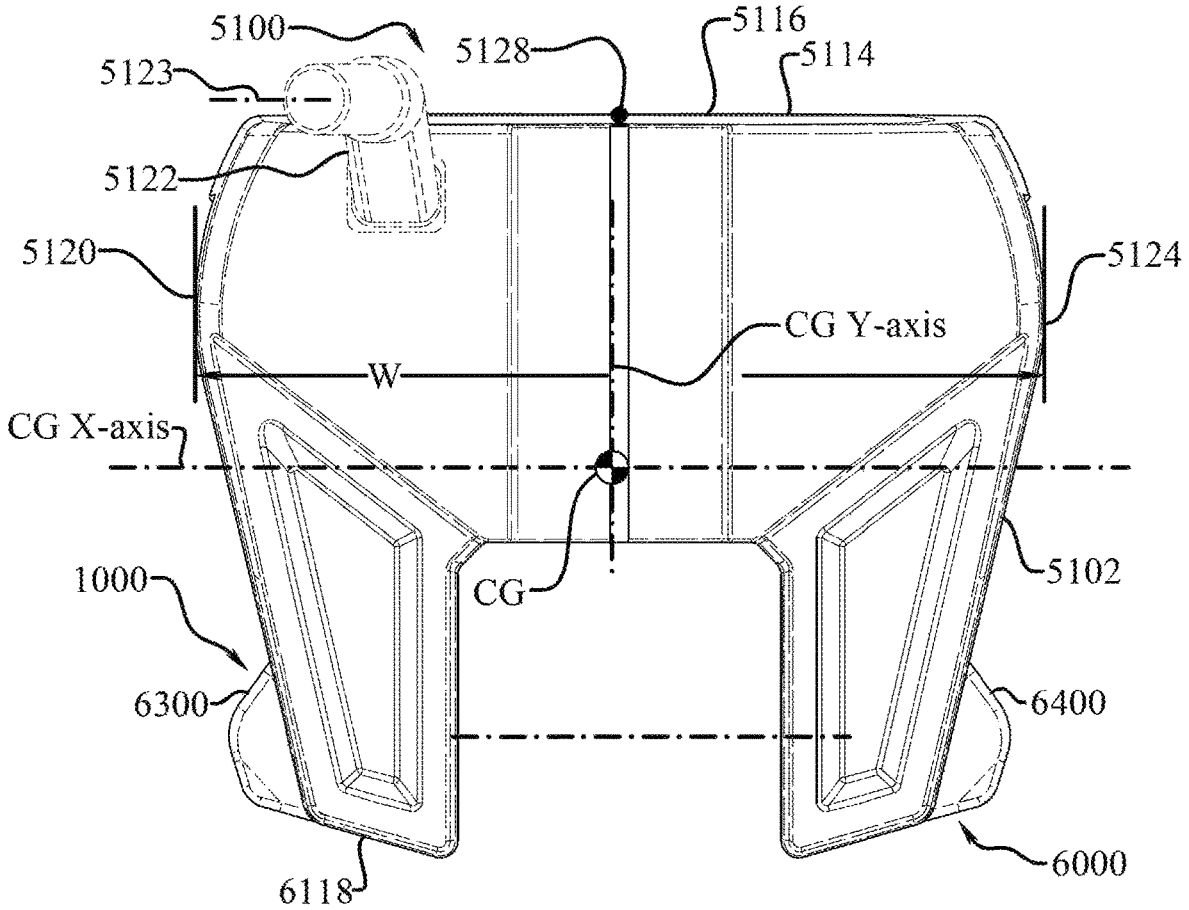
FIG. 86 is a schematic, top plan view of a golf club head, according to one or more examples of the present disclosure.
Figure 87:
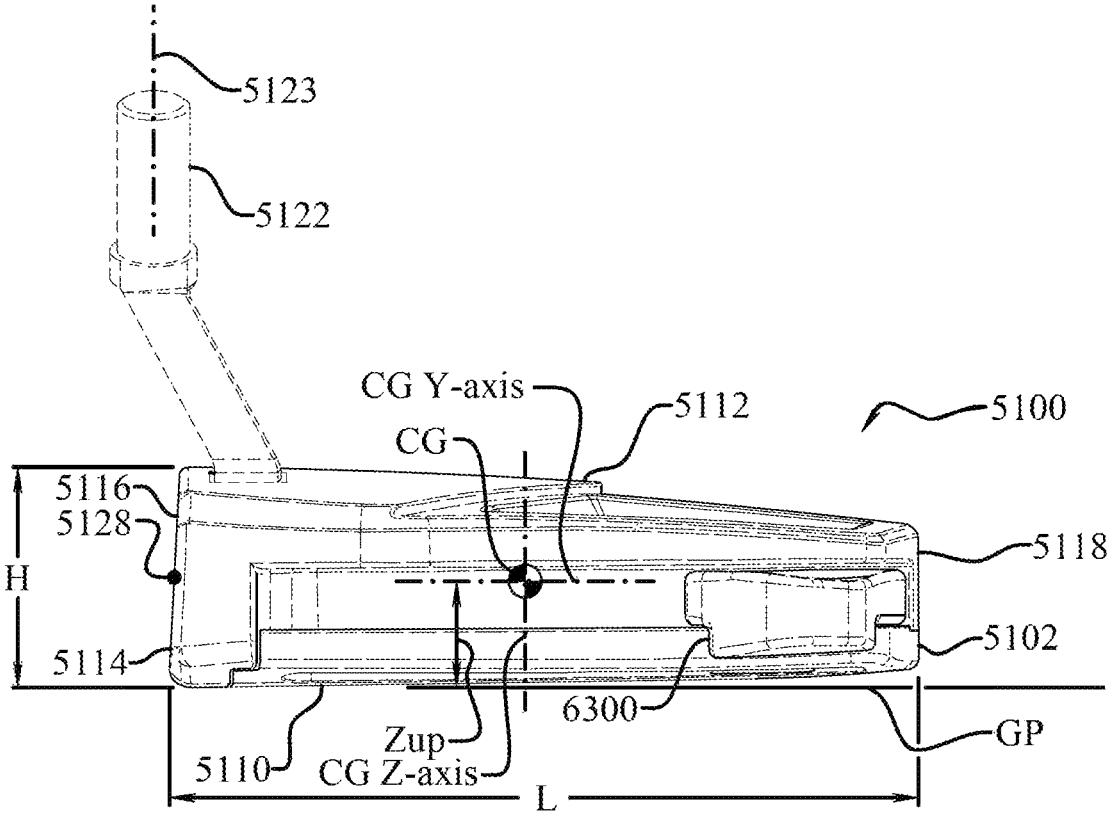
FIG. 87 is a schematic, heel elevation view of a golf club head, according to one or more examples of the present disclosure.

As shown in FIGS. 86-96, the putter head 5100 includes a body 5102, and various views and embodiments of the body 5102. As depicted in FIG. 87, the body 5102 has a sole portion 5110 configured to rest on a ground when the putter head 5100 is at a normal address position, a top portion 5112 opposite to the sole portion 5110, a forward or front portion 5114 comprising a striking face 5116, a rearward portion 5118 opposite to the forward portion 5114, a heel portion 5120 that may include a hosel 5122 configured to receive a golf club shaft (not shown), and a toe portion 5124 opposite to the heel portion 5120. As seen in FIG. 87 the putter head 5100 has a maximum length L measured from the forwardmost point of the striking face 5116, often referred to as the leading edge of the striking face 5116, to a rearwardmost point in a direction parallel to a club head Y-axis, defined below, a maximum height H measured vertically from a ground plane GP to the highest point on the top portion 5112, and a maximum width W, seen in FIG. 87, that is the greatest dimension of the putter head 5100 measured parallel to the club head X-axis, defined below. Unless otherwise indicated, all parameters are specified with the putter head 5100 head in the normal address position, which is the position of the putter head 5100 when (1) supported on a ground plane GP; (2) oriented so that a lie angle of an assembled putter is at a lie angle of 70° relative to the ground plane; and (3) a shaft axis, defined by the upper ⅔ of a putter shaft, lies within a vertical plane that is perpendicular to the ground plane GP. In the embodiment illustrated in FIG. 87 the lie angle of the assembled putter corresponds to the illustrated hosel axis 5123, however this is dependent on the type of hosel incorporated in the putter head 5100 and therefore unless the hosel axis 5123 corresponds with the lie angle of the putter, the normal address position is defined with respect to the assembled putter and the associated lie angle defined by the upper ⅔ of the putter shaft, so as not to be impacted by putter shafts having bends near the connection to the putter head 5100. However, this does not exclude putter heads 5100 designed to be joined to a shaft intended to have a forward, or rearward, lean, and thus a design in which the shaft axis is not intended to be within a vertical plane in the normal address position, and in such situations the normal address position is the position of the putter head when supported on a ground plane GP and oriented at the intended address orientation.

The hosel 5122 may join the body 5102 at a hosel interface, as disclosed in disclosed in U.S. patent application Ser. No. 18/414,128, filed Jan. 16, 2024, all of which is herein incorporated by reference in the entirety, which defines a hosel interface front-back centerline plane, a hosel interface front-back toeward plane, and a hosel interface front-back heelward plane, with each plane being perpendicular to the ground plane GP. The hosel 5122 may be formed with a portion of the putter head 5100, or attached to a portion of the putter head 5100 with adhesive and/or a mechanical fastener, such as a hosel fastener. In a further embodiment the hosel fastener facilitates the interchangeability of at least two different hosels 5122 into a single body 5102, selected from the group of a plumber neck hosel, a L-neck hosel, a flow neck hosel, a slant neck hosel, and/or a truss neck hosel.

The striking face 5116 can have a geometric center defining an origin 5128 of a club head origin coordinate system when the putter head 5100 is at a normal address position. For example, the club head coordinate system can include a club head X-axis being tangent to the striking face 5116 at the origin 5128 and parallel to a ground plane GP. The club head X-axis can extend in a positive direction from the origin 5128 to the heel portion 120 of the putter head. The club head coordinate system can include a club head Y-axis intersecting the origin 5128, being parallel to the ground plane GP and orthogonal to the club head X-axis. The club head Y-axis can extend in a positive direction from the origin 5128 to the rearward portion 5118 of the putter head. The club head coordinate system can include a club head Z-axis intersecting the origin 5128, and being orthogonal to both the club head X-axis and the Y-axis. The club head Z-axis can extend in a positive direction from the origin 5128 vertically toward the top portion 5112 of the putter head. The heel portion 5120 can extend towards, and may include a portion having the hosel 5122. The heel portion 5120 can extend from a club head Y-Z plane passing through the origin 5128 and including the heel portion 5120. The toe half of the club head can be defined as the portion of the club head extending from the club head Y-Z plane in a direction opposite the heel portion 5120 and including the toe portion 5124; and the heel half of the club head can be defined as the portion of the club head extending from the club head Y-Z plane in a direction opposite the toe half and including the heel 5120. In one embodiment the striking face 5116 has a loft of 10 degrees or less, and in further embodiments less than 8, 7, 6, 5, or 4 degrees. In another embodiment the loft is at least 1 degree, and in additional embodiments 2 or 3 degrees.

The putter head 5100 has a center of gravity CG, also referred to as the putter head CG, club head CG, and/or just CG, which includes the influence and location of all of the individual components of the putter head 5100. The club head origin coordinate system can used to define the location of various features of the club head (including a club head center-of-gravity CG. The head origin coordinate system is defined with respect to the origin 5128 and includes three axes just described, namely the club head X-axis, club head Y-axis, and club head Z-axis. Any golf club head features disclosed and/or claimed herein are defined with reference to the club head origin coordinate system, unless specifically stated otherwise. The center of gravity (CG) of a golf club head is the average location of the weight of the golf club head or the point at which the entire weight of the golf club head may be considered as concentrated so that if supported at this point the head would remain in equilibrium in any position.

The putter head CG is shown as a point whose location can also be defined with reference to the club head origin coordinate system. For example, and using millimeters as the unit of measure, a CG that is located 3.2 mm from the head origin 5128 toward the toe of the club head along the club head X-axis, 36.7 mm from the head origin 5128 toward the rear of the club head along the club head Y-axis, and 4.1 mm from the head origin 5128 toward the sole of the club head along the club head Z-axis can be defined as having a CGx, also referred to as a head origin x-axis (CGx) coordinate, of −3.2 mm, a CGy, also referred to as a head origin y-axis (CGy) coordinate, of 36.7 mm, and a CGz, also referred to as a head origin z-axis (CGz) coordinate, of −4.1 mm. Additionally, a Zup dimension is the elevation of the putter head CG vertically above the ground plane GP, as seen in FIG. 87. Thus, Zup is 12 mm if the putter head CG is located 12 mm above the ground plane GP.

The club head CG may be used to define a CG coordinate system having a CG X-axis passing through the club head CG and parallel to the club head X-axis, a CG Y-axis passing through the club head CG and parallel to the club head Y-axis, and a CG Z-axis passing through the club head CG and parallel to the club head Z-axis, as seen in FIGS. 86-87.

The body 5102 can comprise a relatively rigid material, such as stainless steel alloy, carbon steel alloy, aluminum alloy, titanium alloy, other metals/alloys, and/or nonmetallic materials as disclosed herein. The striking face 5116 can be a front surface of the body 5102 or can be a separate piece that is coupled to the front of the body 5102 (e.g., the striking face 5116 can be made of a different material than the body 5102, such as a polymeric material or any of the materials disclosed herein). The putter head 5100 can also include one or more weight members 10810 coupled to the body 5102, such as those illustrated in FIG. 70. In some cases, the weight members 10810 can be detachable and swappable with other weight members of different masses to adjust the mass distribution and inertial properties of the putter head 5100 and/or adjust the total club head mass. Further, in some embodiments the putter head 5100 can also include one or more repositionable weight assemblies 1000, seen in FIG. 86, which may include a heel weight assembly 6300 and/or a toe weight assembly 6400. The weight member 10810 may be secured by a separate weight fastener 10830, in which case the weight member mass is the sum of a mass of the weight member 10810 and a mass of the separate weight fastener 10830. In one embodiment the weight member mass, and/or total sum of multiple weight members 10810, is no more than 35% of the frame mass, and in additional embodiments no more than 30%, 25%, 20%, or 15%.

The location of each distinct component or assembly of the club head may be identified in a manner similar to that of the club head CG. An embodiment illustrated in FIGS. 70-85 will now be referenced, and all of the prior disclosure applies equally to this embodiment, as is true for all figures, disclosures, embodiments, and/or examples, whether the individual elements are labeled with the same element numbers or not.

An embodiment of FIGS. 70-85 illustrates a putter head 5100 that may include individual components such as a frame 10000, a crown damping member 11000, abbreviated CDM, a sidewall damping member 12000, abbreviated SDM), a sole member 13000, abbreviated SM, a striking face 5116, which in some embodiments may include a face insert 5117, a rear badge 14000, a rear damping member 15000, a face insert damping member 16000, a damping cavity 17000, and/or a damper 18000. It is important to note that all of the previous disclosure relating to the body 5102 may also apply to the frame 10000, and all of the disclosure relating to the frame 10000 may also apply to the prior disclosure of the body 5100.

As seen in FIGS. 71A-74, the frame 10000 has a frame length 10002, a frame width 10004, and a frame height 10006. The frame 10000 has a frame perimeter 10010, a frame front 10100, a frame rear 10200, a frame top 10300, a frame bottom 10400, and may have a frame hosel 10008, integrally formed with the frame 10000 or attached to the frame 10000. The present disclosure is directed to a frame 10000 that is of unitary construction unless noted otherwise, however as noted later in some embodiments it comprises multiple individual components joined together.

In one embodiment the unitary construction of the frame 10000 comprises cast metal alloy, while further unitary construction embodiments may be formed by forging, stamping, metal injection molding (MIM), metal additive manufacturing (metal AM), and/or freeform injection molding that combines MIM and metal AM. Metal additive manufacturing (metal AM) includes, but is not limited to, powder bed additive manufacturing, metal binder jetting manufacturing, sheet lamination manufacturing, direct energy deposition manufacturing, and bound powder extrusion. One such embodiment utilizes powder bed fusion (PBF) methods employing the use of either a laser or electron beam to melt and fuse the metal powder into a solid. This technique includes the following metal additive manufacturing methods: electron beam melting (EBM), direct metal laser sintering (DMLS), selective heat sintering (SHS), selective laser melting (SLM), and selective laser sintering (SLS). One such metal binder jetting manufacturing embodiment utilizes metal powders that are jetted onto a build platform to print objects using either a continuous or drop on demand (DOD) approach, followed by application of a liquid binder combine the powder layer by layer, building the desired object, followed by post-processing steps of sintering and/or infiltration to be strengthened. One such sheet lamination process includes the joining of sheets, or strips, of material together layer by layer through bonding, ultrasonic welding or ultrasonic additive manufacturing, or brazing to build an object. Sheet lamination methods are low-temperature processes and can bond different materials together. In a direct energy deposition manufacturing embodiment a focused energy source, such as a laser or electron beam, is directed at the building material to melt it while it is simultaneously being deposited layer by layer, and/or may incorporate use of a heated nozzle to deposit melted material onto the specified surface where it solidifies, which may include powder DED such as laser metal deposition (LMD) and/or laser engineering net shaping (LENS), as well as wire DED techniques such as electron beam additive manufacturing (EBAM).

The frame top 10300 includes a thin wall crown region 10600, abbreviated TWCR, and depicted in FIGS. 71A, 71B, 82, and 83. The thin wall crown region 10600 has a TWCR thickness 10610, a TWCR perimeter 10640, a TWCR length 10620, and a TWCR width 10630. The boundary of the thin wall crown region 10600 is defined by the region, or regions, where the TWCR thickness 10610 is 0.6-1.2 mm, and in further embodiments the thin wall crown region 10600 is defined by the region, or regions, where the TWCR thickness 10610 is no more than 1.1 mm, 1.0 mm, 0.95 mm, or 0.90 mm, while in still further embodiments the thin wall crown region 10600 is defined by the region, or regions, where the TWCR thickness 10610 is at least 0.65 mm, 0.70 mm, 0.75 mm, 0.80 mm, or 0.85 mm.

Figure 90:
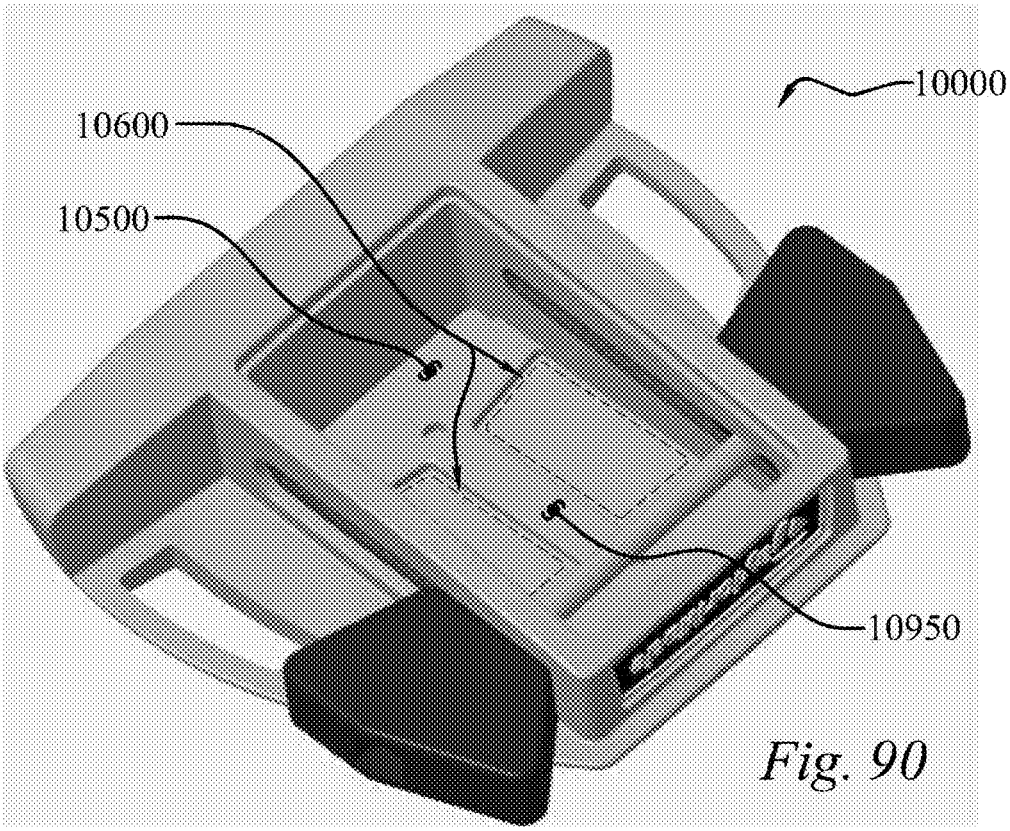
FIG. 90 is a schematic, bottom perspective view of a golf club head, according to one or more examples of the present disclosure.
Figure 91:
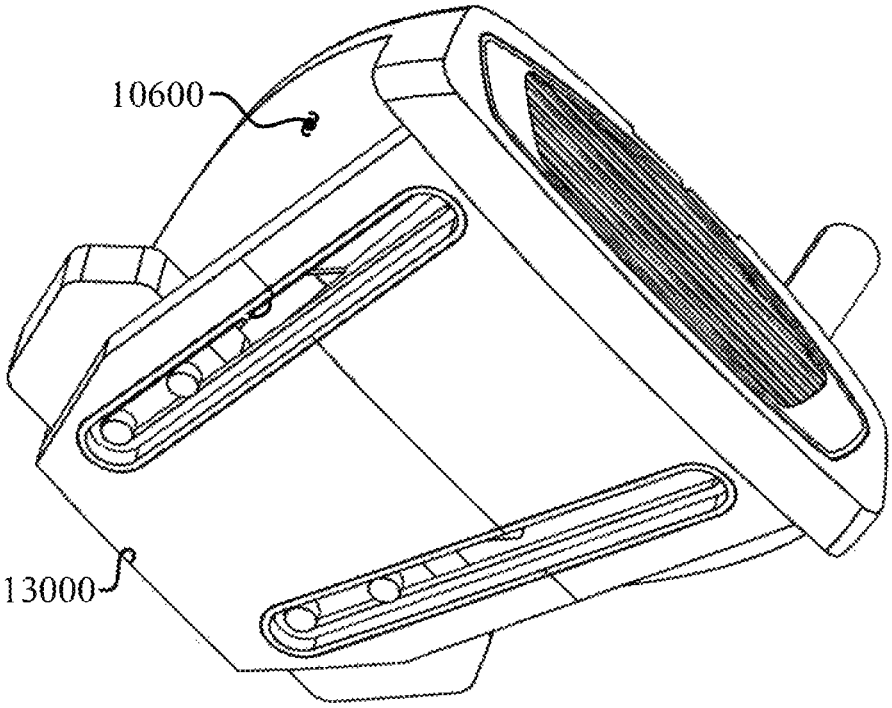
FIG. 91 is a schematic, bottom perspective view of a golf club head, according to one or more examples of the present disclosure.
Figure 97:
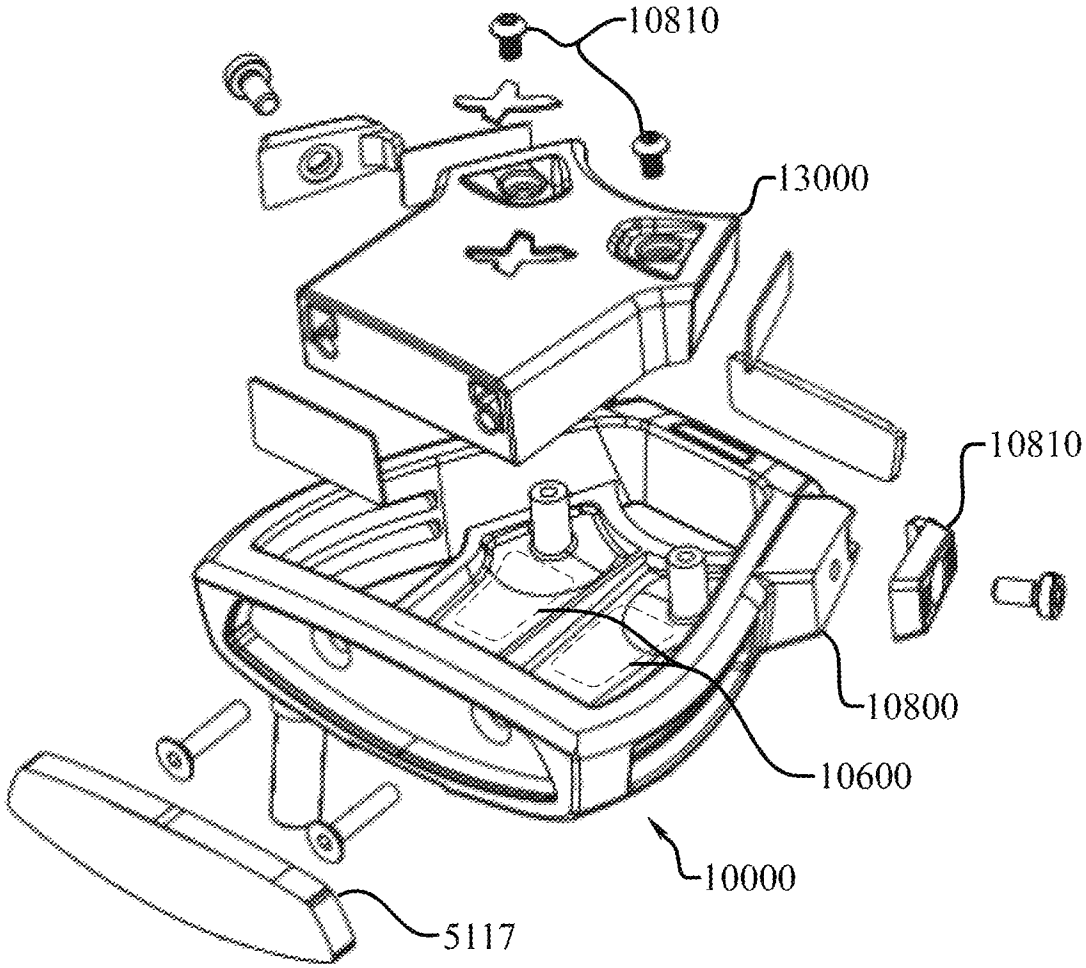
FIG. 97 is a schematic, exploded bottom perspective view of a golf club head, according to one or more examples of the present disclosure.
Figure 98:
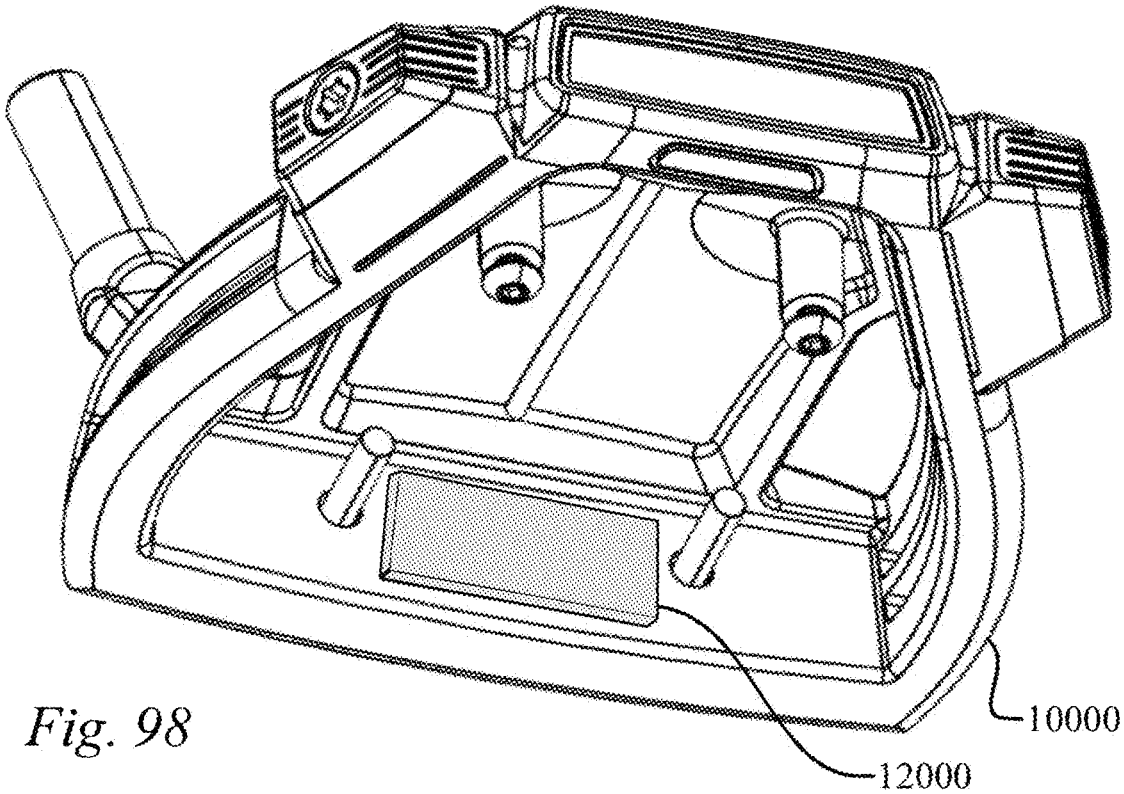
FIG. 98 is a schematic, partial bottom perspective view of a golf club head, according to one or more examples of the present disclosure.
Figure 99:
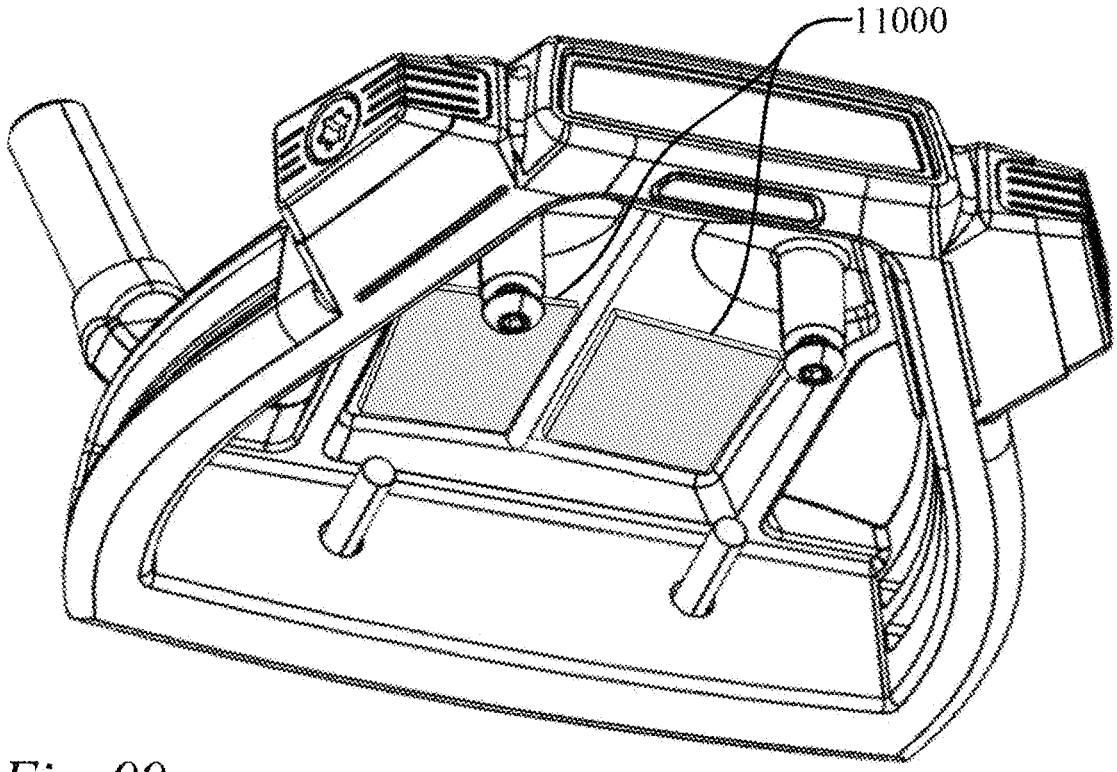
FIG. 99 is a schematic, partial bottom perspective view of a golf club head, according to one or more examples of the present disclosure.

The frame top 10300 may include multiple thin wall crown regions 10600 separated by regions in which the frame top 10300 has a thickness that does not fall within the disclosed TWCR thickness 10610 range, as seen in FIG. 97. Thus, multiple thin wall crown regions 10600 may be separated by regions in which the thickness is greater than 1.2 mm, such as regions separated by a stiffening rib 10950, or multiple stiffening ribs, as seen in FIGS. 103-108, or a stiffening region, such as that seen in FIG. 90 and also labeled 10950. Referring again to FIG. 70A, the surface area on the exterior of the frame top 10300 that lies within the TWCR perimeter 10640 is a TWCR area, which in one embodiment is at least 600 mm^2, which may be the sum of the areas associated with multiple thin wall crown regions 10600, as illustrated in FIGS. 90, 97, 99, or is the area associated with a single thin wall crown region 10600. In a further embodiment the TWCR area is at least 700 mm^2, and is at least 800 mm^2, 900 mm^2, or 1000 mm^2 in additional embodiments. In another series of embodiments the TWCR area is no more than 8000 mm^2, 7000 mm^2, 6000 mm^2, 5000 mm^2, 4000 mm^2, 3500 mm^2, 3000 mm^2, 2500 mm^2, or 2000 mm^2.

Figure 104:
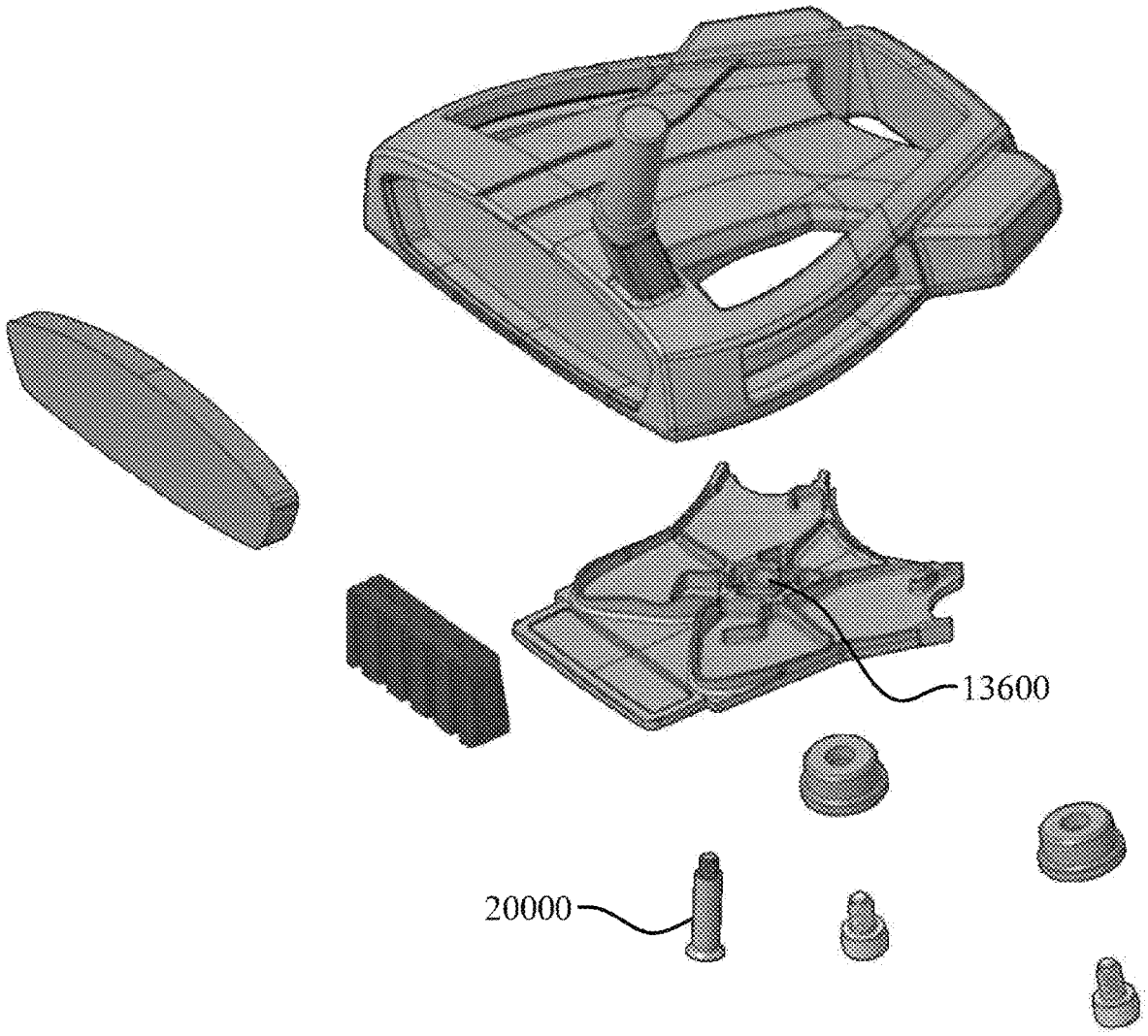
FIG. 104 is a schematic, exploded top perspective view of a golf club head, according to one or more examples of the present disclosure.
Figure 105:
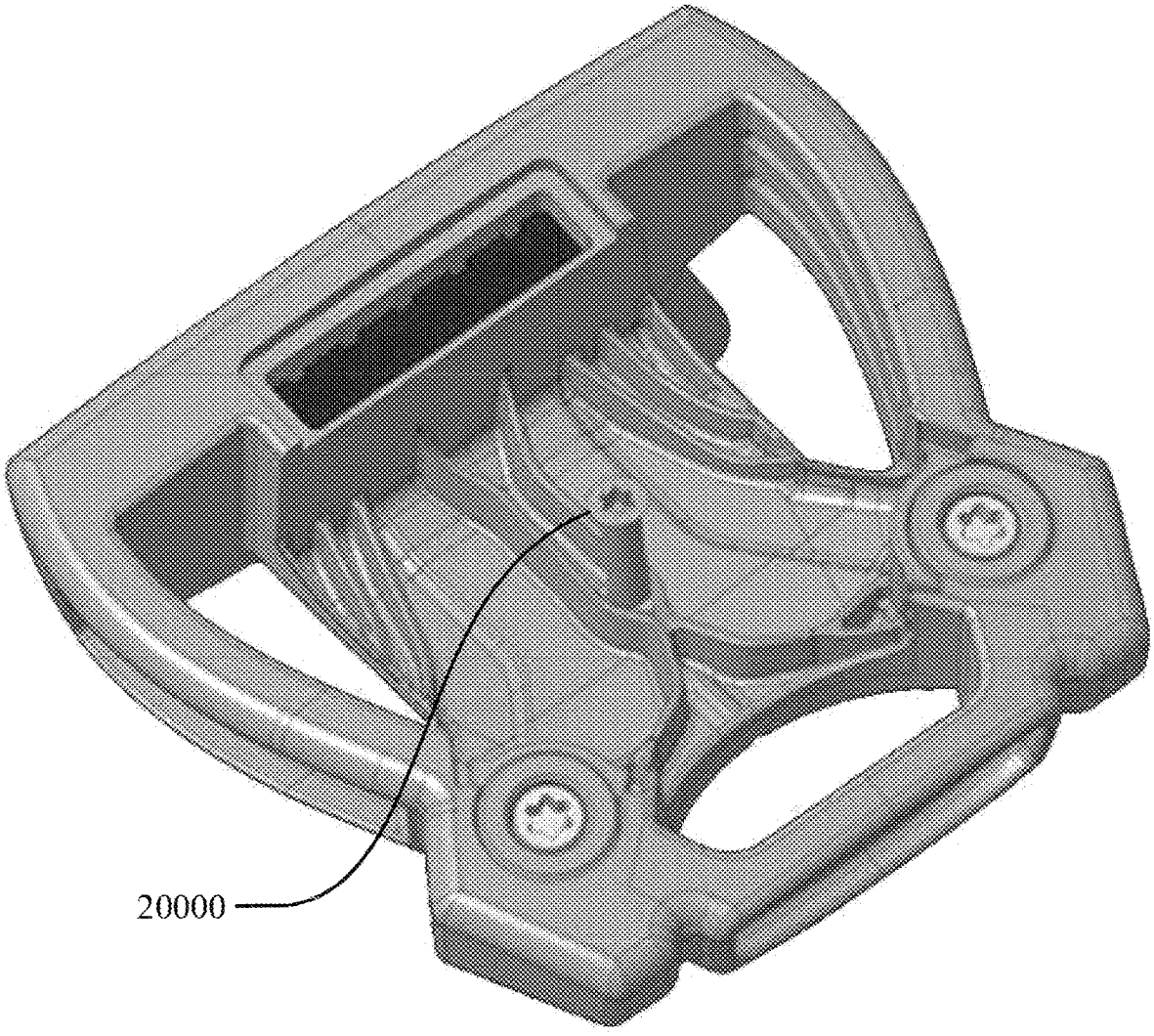
FIG. 105 is a schematic, partial bottom perspective view of a golf club head, according to one or more examples of the present disclosure.

In one embodiment the stiffening rib 10950 has a rib height and a rib thickness. The rib height is the vertical distance that it projects from an internal surface of the frame 10000, and in one embodiment the rib height is at least 2 times the rib thickness, and at least 3, 4, or 5 times in additional embodiments. In another embodiment the rib thickness is no more than 4 mm, and in additional embodiments is no more than 3.5, 3.0, 2.5, or 2.0 mm. In another embodiment the rib height is at least 2 times the maximum TWCR thickness 10610, and in additional embodiments at least 3, 4, or 5 times the maximum TWCR thickness 10610. In another embodiment the rib height is no more than 15 times the maximum TWCR thickness 10610, and no more than 13, 11, 9, or 7 times in additional embodiments. The stiffening rib 10950 also has a rib length, which is the distance that it traverses along a surface of the frame 10000. In one embodiment the rib length is greater than or equal to the Zup distance, while in further embodiments it is at least 150%, 175%, 200%, 225%, 250%, 275%, or 300% of the Zup distance. The frame top 10300 has at least two stiffening ribs 10950 in one embodiment, and at least three or four in further embodiments. In another embodiment at least one stiffening rib 10950 and/or stiffening region separates at least two thin wall crown regions 10600, with each having a TWCR area of at least 100 mm^2, while further embodiments have at least three or four thin wall crown regions 10600. In another embodiment the sole member 13000 may include at least one stiffening rib, as seen in FIG. 104, and all of the disclosure relating to stiffening rib 10950 applies equally to one or more stiffening ribs formed in the sole member 13000.

A stiffening region has a stiffening region thickness, as opposed to a rib height, and the stiffening region thickness is a crown wall thickness that is at least 15% greater than the maximum TWCR thickness 10610 and is separating two distinct thin wall crown regions 10600. In another embodiment the stiffening region thickness is no more than 300% greater than the maximum TWCR thickness 10610, and in further embodiments no more than 275%, 250%, 225%, or 200% of greater than the maximum TWCR thickness 10610. The stiffening region also has a stiffening region length and a stiffening region width, measured with respect to the Y-axis and X-axis as disclosed with respect to other lengths and widths, which are the distance that the region traverses along a surface of the frame 10000. At least one of the stiffening region length and the stiffening region width are at least 2 times the average stiffening region thickness, and in additional embodiments at least 3, 4, or 5 times. In another embodiment at least one of the stiffening region length and the stiffening region width are no more than 20 times the average stiffening region thickness, and in additional embodiments no more than 18, 16, 14, 12, or 10 times.

As seen in FIGS. 103-108, a top-to-sole-member connector 20000 may be incorporated in an embodiment, with the top-to-sole-member connector joining the sole member 13000 to the frame top 10300. In one embodiment the top-to-sole-member connector 20000 is a threaded mechanical fastener, which in another embodiment has a plurality of threads that engage with a receptable 10310 formed in the frame top 10300, although other types of fasteners may be used, including for example non-threaded fasteners and quick-engagement fasteners, such as quarter-turn cam type fasteners, and one skilled in the art will appreciate that the top-to-sole-member connector 20000 may enter from the frame top 10300, as opposed to passing through a SM aperture 13600 in the sole member 13000 as illustrated.

Figure 103:
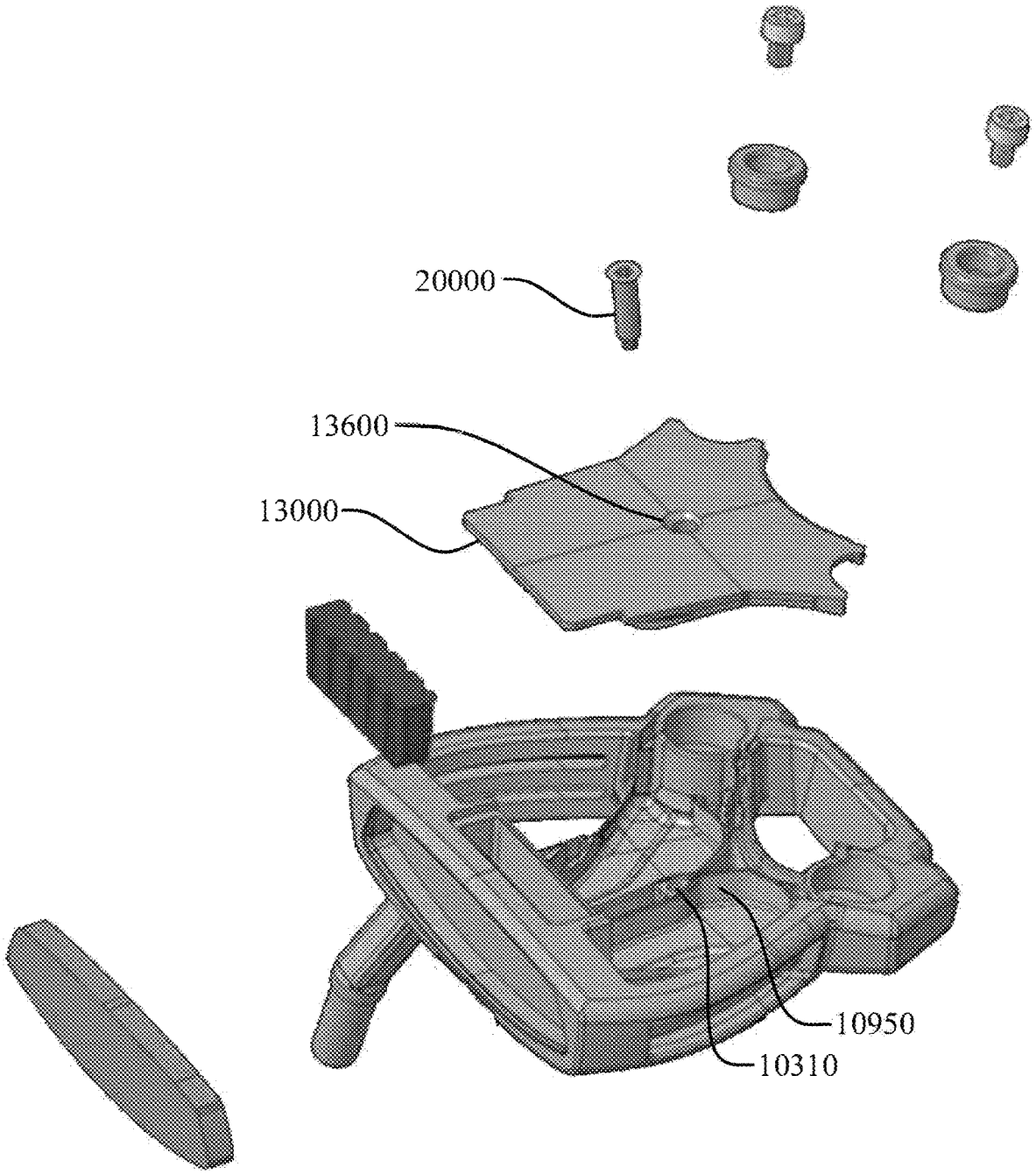
FIG. 103 is a schematic, exploded bottom perspective view of a golf club head, according to one or more examples of the present disclosure.

As seen in FIG. 103, in another embodiment at least one stiffening rib 10950 is in contact with the receptacle 10310, while in another embodiment at least two stiffening ribs 10950 contact the receptable 10310. As seen in FIG. 104, in another embodiment at least one sole member stiffening rib is in contact with the SM aperture 13600, while in another embodiment at least two sole member stiffening ribs contact the SM aperture 13600.

The connector 20000 has a connector center of gravity CGconn, located via a CGx-conn, where the "-conn" component identifies that it is the CGx of the connector 20000 component, and a CGy-conn, where the "-conn" component identifies that it is the CGy of the connector 20000 component, as well as a Zup-conn, which references the height of the connector center of gravity, CGconn, above the ground plane. In one embodiment the CGy-conn is greater than the club head CGy and/or the frame CGy-f. The CGx-conn is greater than −5.0 mm in an embodiment, and in further embodiments greater than −4.0, −3.0, −2.0, or −1.0 mm. While in a further embodiment the CGx-conn is no more than 5.0 mm, and in additional embodiments no more than 4.0, 3.0, 2.0, or 1.0 mm. In one embodiment the CGy-conn is greater than 12 mm, and in further embodiments greater than 16, 20, 24, 26, 28, 30, 32, 34, 36, or 38 mm. While in a further embodiment the CGy-conn is no more than 52 mm, and in additional embodiments is no more than 50, 48, 46, or 44 mm. Additionally, the Zup-conn is no more than 18 mm, and no more than 16, 14, or 12 mm in further embodiments. In another embodiment the Zup-conn is at least 4 mm, and in further embodiments is at least 6 or 8 mm. The top-to-sole-member connector 20000 has a connector mass, which in one embodiment is no more than 200% of the SM mass, and no more than 175%, 175%, 150%, 125%, 100%, or 90% in additional embodiments. In one embodiment an absolute value of a difference between the club head CGy coordinate and the connector CGy-conn coordinate is no more than 7.5 mm, and in further embodiments is no more than 6.5, 5.5, 4.5, 3.5, or 2.5 mm.

Figure 109:
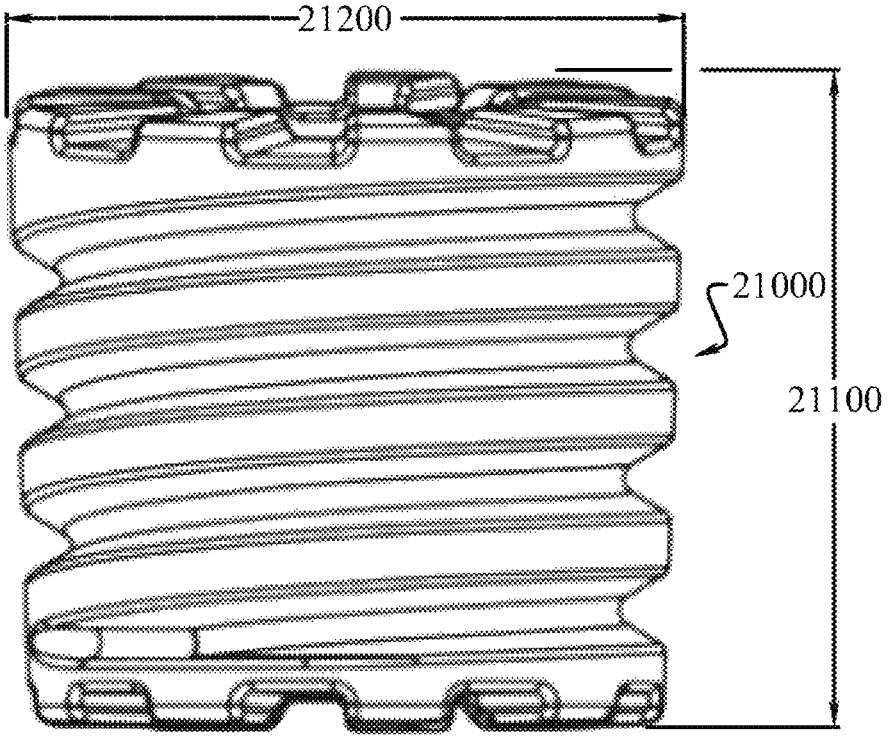
FIG. 109 is a schematic, side elevation view of a damper, according to one or more examples of the present disclosure.
Figure 110:
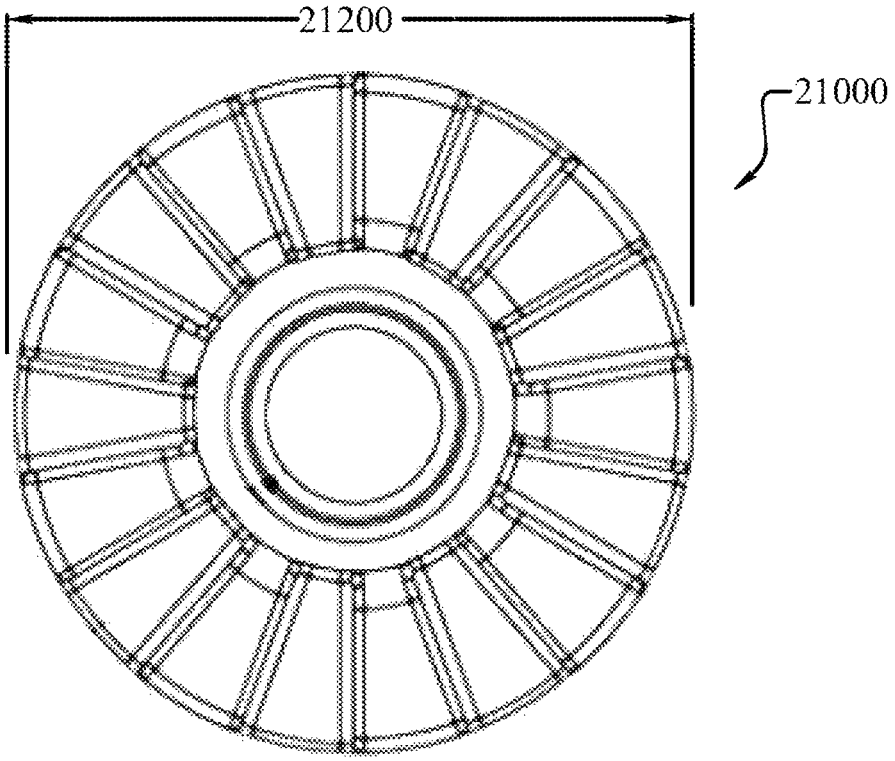
FIG. 110 is a schematic, top plan view of a damper, according to one or more examples of the present disclosure.
Figure 111:
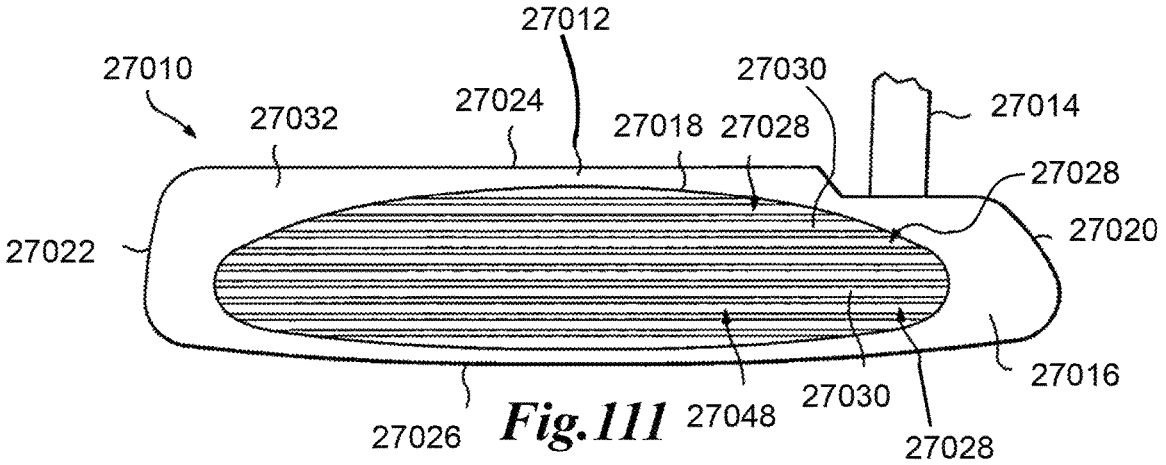
FIG. 111 is a front elevation view of a putter head having an insert mounted to the front surface of the head, according to one embodiment.
Figure 112:
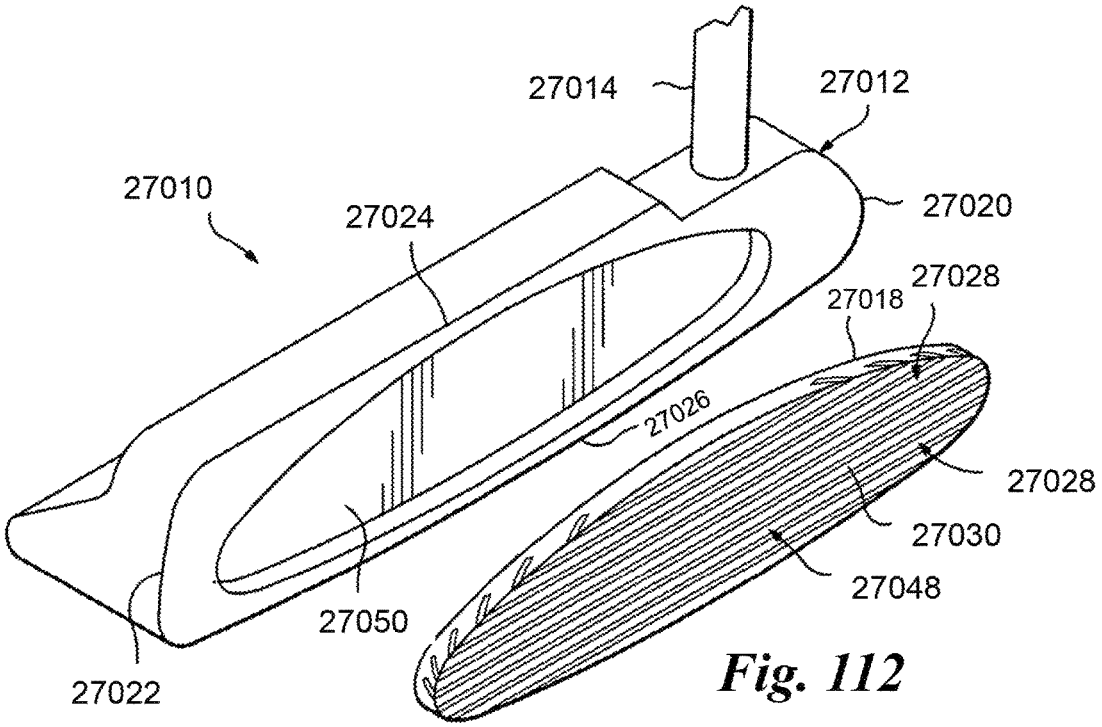
FIG. 112 is a perspective, exploded view of the putter head of FIG. 111.

As seen in FIGS. 109-110, in another embodiment the top-to-sole-member connector 20000 may pass through a top-to-sole-member, abbreviated TTSM, damper 21000 that contacts the frame top 10300 and the sole member 13000. In one embodiment the TTSM damper 21000 has a TTSM damper height 21100 and a TTSM damper width 21200, which is a TTSM damper diameter when the TTSM damper 21000 is cylindrical in shape. The TTSM damper 21000 has a TTSM damper density, a TTSM damper mass, and a TTSM damper volume. In one embodiment the TTSM damper 21000 mass is no more than 10 grams, and in further embodiments no more than 8, 7, 6, 5, or 4 grams. In another embodiment the TTSM damper width 21200 is no more than 32 mm, and in additional embodiments no more than 30, 28, 26, 24, or 22 mm. All of the disclosure relating to damper 18000 applies to the TTSM damper 21000. In a further embodiment the TTSM connector 20000 compresses a TTSM damper 21000 during installation and an installed TTSM damper height 21100 is at least 0.1 mm less than an uninstalled relaxed TTSM damper height 21100, and in further embodiments the 0.1 mm of compression increases to at least 0.15, 0.20, 0.25, 0.30, or 0.35 mm.

Such a thin wall crown region 10600 has traditionally been avoided in golf club heads having a unitary construction metallic frame 10000 because it is characterized by undesirable sound and feel at impact with a golf ball, particularly when combined with one or more of the other disclosed attributes of the frame 10000, however one or more of the other disclosed components, attributes, and/or relationships that are not associated with the frame 10000 overcome these challenges. Large thin wall crown sections in unitary construction metallic frames 10000 are traditionally associated with undesirable ringing, duration, tau time, frequency, amplitude, vibration modes, and/or resonance.

Figure 71A:
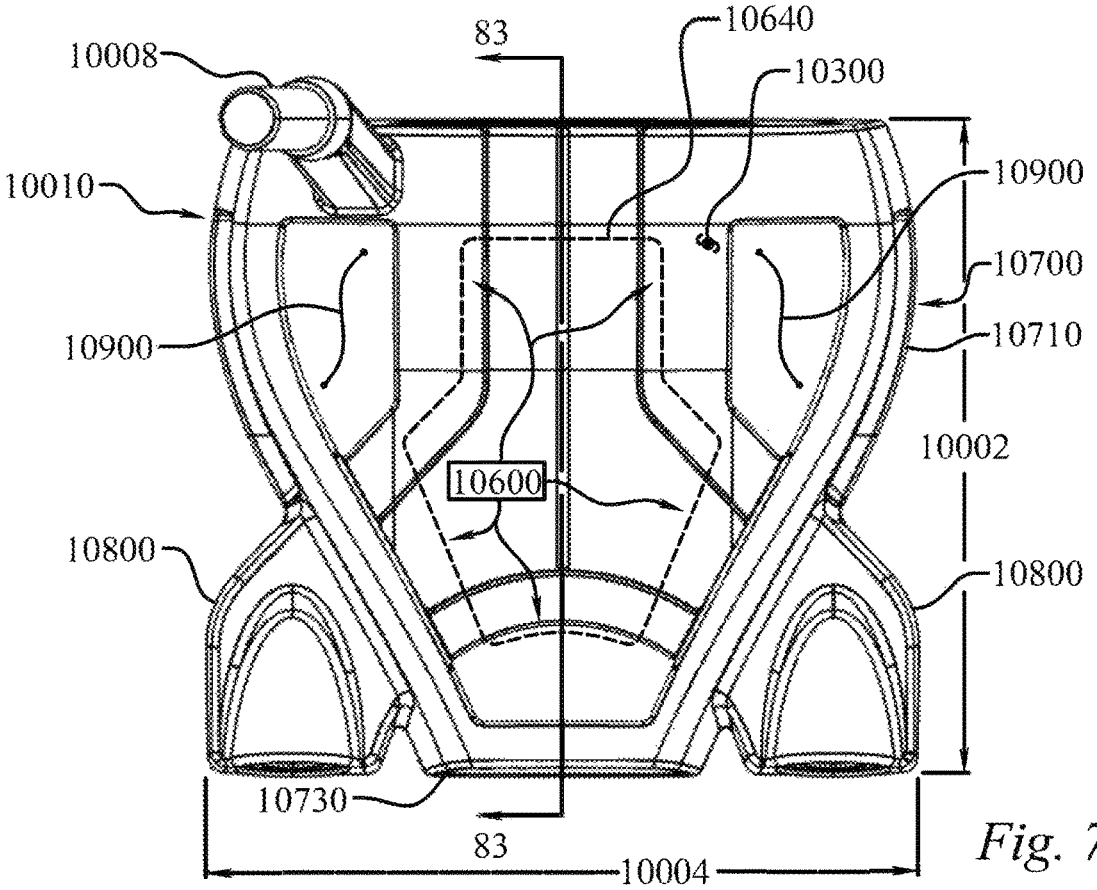
FIG. 71A is a schematic, top plan view of a golf club head, according to one or more examples of the present disclosure.
Figure 71B:
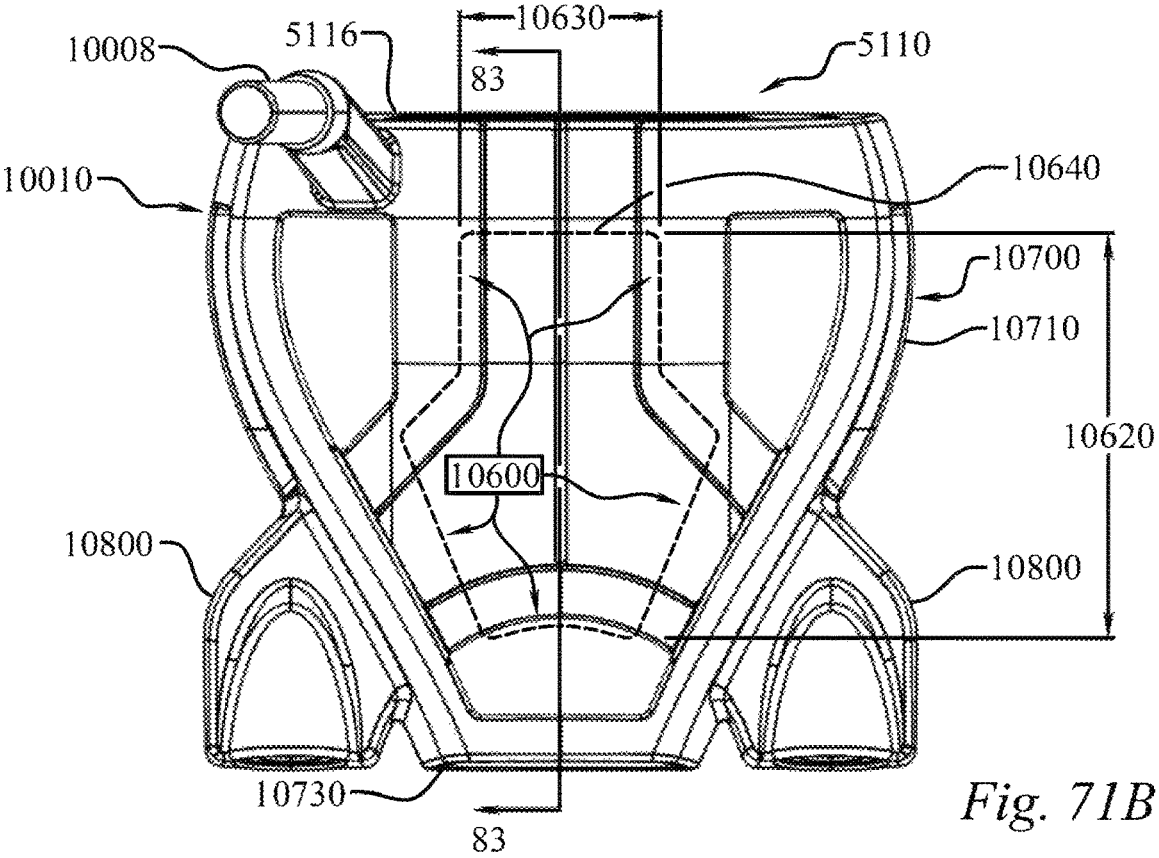
FIG. 71B is a schematic, top plan view of a golf club head, according to one or more examples of the present disclosure.

Referring again to FIGS. 71A, 71B, and 83, in one embodiment TWCR perimeter 10640 defines at least one thin wall crown region 10600 having a maximum TWCR length 10620 that is greater than Zup, and in further embodiments is at least 10%, 20%, 30%, 40%, 50%, 60%, 70%, 80%, 90%, 100%, or 110% greater than Zup. The TWCR length 10620 is measured parallel to the club head Y-axis, as illustrated in FIG. 71B. In another embodiment the maximum TWCR length 10620 is no more than 10 times Zup, and in further embodiments is no more than 9, 8, 7, 6, or 5 times Zup. In one embodiment the maximum TWCR length 10620 of at least 10 mm, and in further embodiments at least 15 mm, 20 mm, 25 mm, 30 mm, 35 mm, or 40 mm. In another embodiment the maximum TWCR length 10620 is no more than 125 mm, and in further embodiments is no more than 115 mm, 105 mm, 95 mm, 85 mm, 80 mm, 75 mm, 70 mm, or 65 mm.

Figure 88:
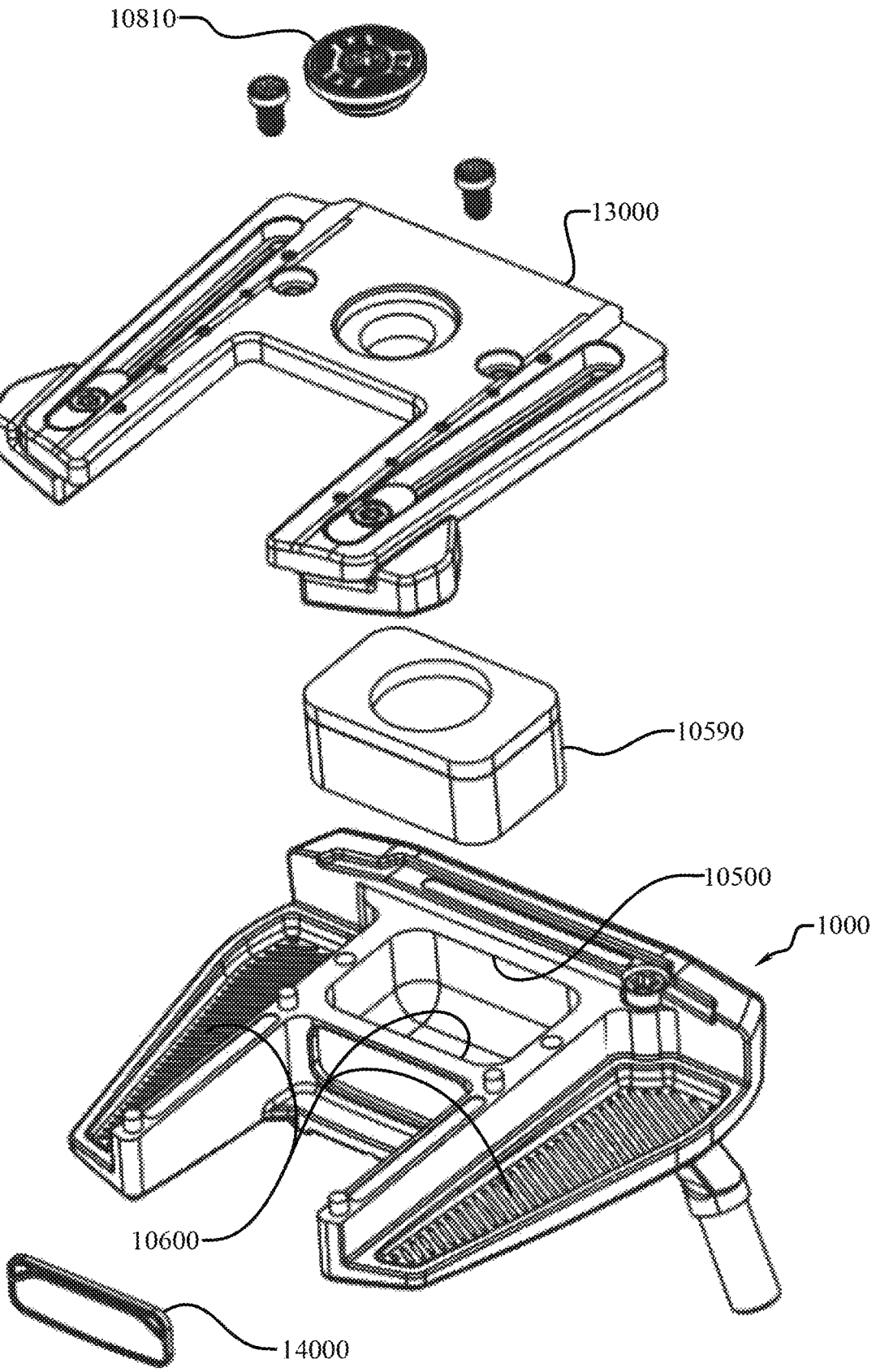
FIG. 88 is a schematic, exploded bottom perspective view of a golf club head, according to one or more examples of the present disclosure.
Figure 89:
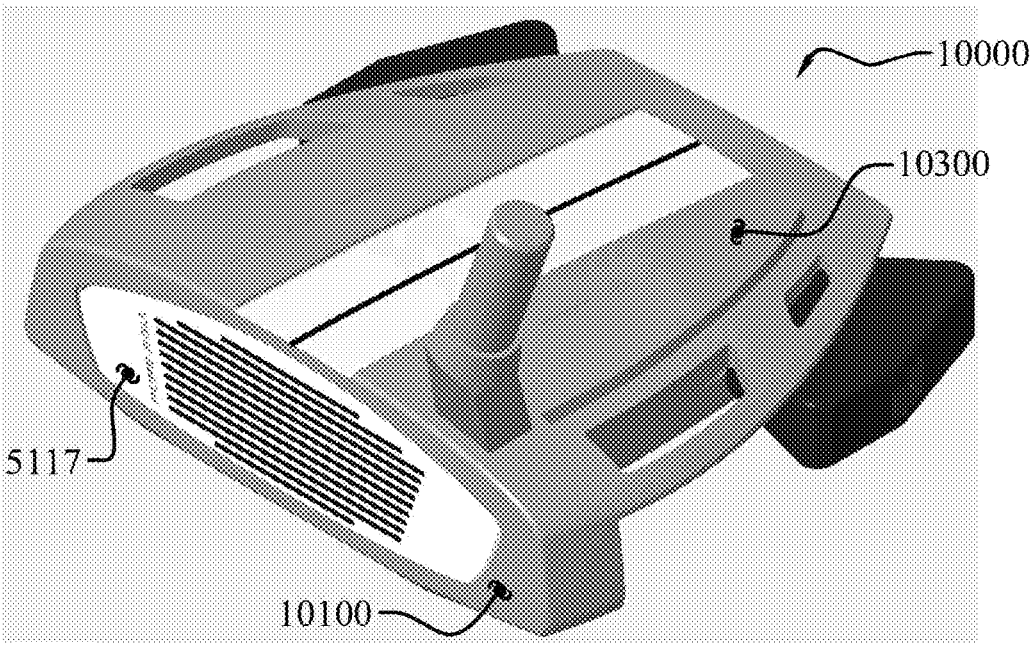
FIG. 89 is a schematic, top perspective view of a golf club head, according to one or more examples of the present disclosure.

In one embodiment TWCR perimeter 10640 defines at least one thin wall crown region 10600 having a maximum TWCR width 10630 that is greater than Zup, and in further embodiments is at least 10%, 20%, 30%, 40%, 50%, 60%, 70%, 80%, 90%, 100%, or 110% greater than Zup. In another embodiment the maximum TWCR width 10630 is no more than 10 times Zup, and in further embodiments is no more than 9, 8, 7, 6, or 5 times Zup. In one embodiment the maximum TWCR width 10630 of at least 10 mm, and in further embodiments at least 15 mm, 20 mm, 25 mm, 30 mm, 35 mm, or 40 mm. The TWCR width 10630 is measured parallel to the club head X-axis, as illustrated in FIG. 71B. In another embodiment the maximum TWCR width 10630 is no more than 125 mm, and in further embodiments is no more than 115 mm, 105 mm, 95 mm, 85 mm, 80 mm, 75 mm, 70 mm, or 65 mm. The location of the thin wall crown region 10600 also significantly influences the performance of the golf club head, and therefore in one embodiment the thin wall crown region 10600 is located a TWCR offset dimension behind the origin 5128, measured parallel to the club head Y-axis; meaning no portion of the thin wall crown region 10600 is located less than the TWCR dimension from the origin 5128. In one embodiment the TWCR offset dimension is at least 50% of Zup, and at least 60%, 70%, 80%, 90%, 100%, or 110% in further embodiments. Yet, locating the thin wall crown region 10600 too far from the origin 5128 may also negatively impact performance. Therefore, in an embodiment at least a portion of the thin wall crown region 10600 is located within a TWCR setback distance behind the origin 5128, measured parallel to the club head Y-axis. In one embodiment the TWCR setback distance is equal to the club head CGy dimension, while in further embodiments the TWCR setback distance is 90%, 80%, 70%, or 60% of the club head CGy dimension. In one embodiment the thin wall crown region 10600 lies in a central region between two vertical planes parallel to the club head Y-axis, with the first vertical plane located 30 mm toeward of the club head Y-axis, and the second vertical plane located 30 mm heelward of the club head Y-axis; while in further embodiments the 30 mm value is reduced to 28, 26, 24, 22, 20, or 18 mm. However, the embodiment of FIG. 88 illustrates that the thin wall crown region 10600 can be located beyond the central region, which does contain a thin wall crown region 10600 within the central region, but also one heelward of the central region and one toeward of the central region. Thus, in one embodiment at least one thin wall crown region 10600 is located at least in part 5 mm outside any of the disclosed central regions, and in further embodiments at least 7.5, 10, 12.5, or 15 mm outside any of the disclosed central regions. The disclosed variations of the thin wall crown region 10600, and relationships with other attributes, improves of the overall mass properties and performance of the club head, as well as the vibrational modes, frequency, and/or amplitude by selectively increasing the rigidity and damping of the golf club head in certain areas.

The frame 10000 has a frame mass and is formed of a frame material, defining a frame material volume, and having a frame density, which in one embodiment it at least 2.5 g/cc, and in a further embodiment is at least 4 g/cc or 7 g/cc. Additionally, in another embodiment the frame mass is at least 250 grams, while in further embodiments is at least 260, 270, 280, 290, 300, or 310 grams. The frame mass is no more than 370 grams in an embodiment, and is no more than 360, 350, 340, 330, or 320 grams in additional embodiments. Further, the frame material volume is at least 32.5 cc in an embodiment, and is at least 35, 37.5, or 40 cc in additional embodiments. The frame material volume is no more than 55 cc in an embodiment, and is no more than 52.5, 50, 47.5, 45, or 42.5 cc in additional embodiments.

Figure 78:
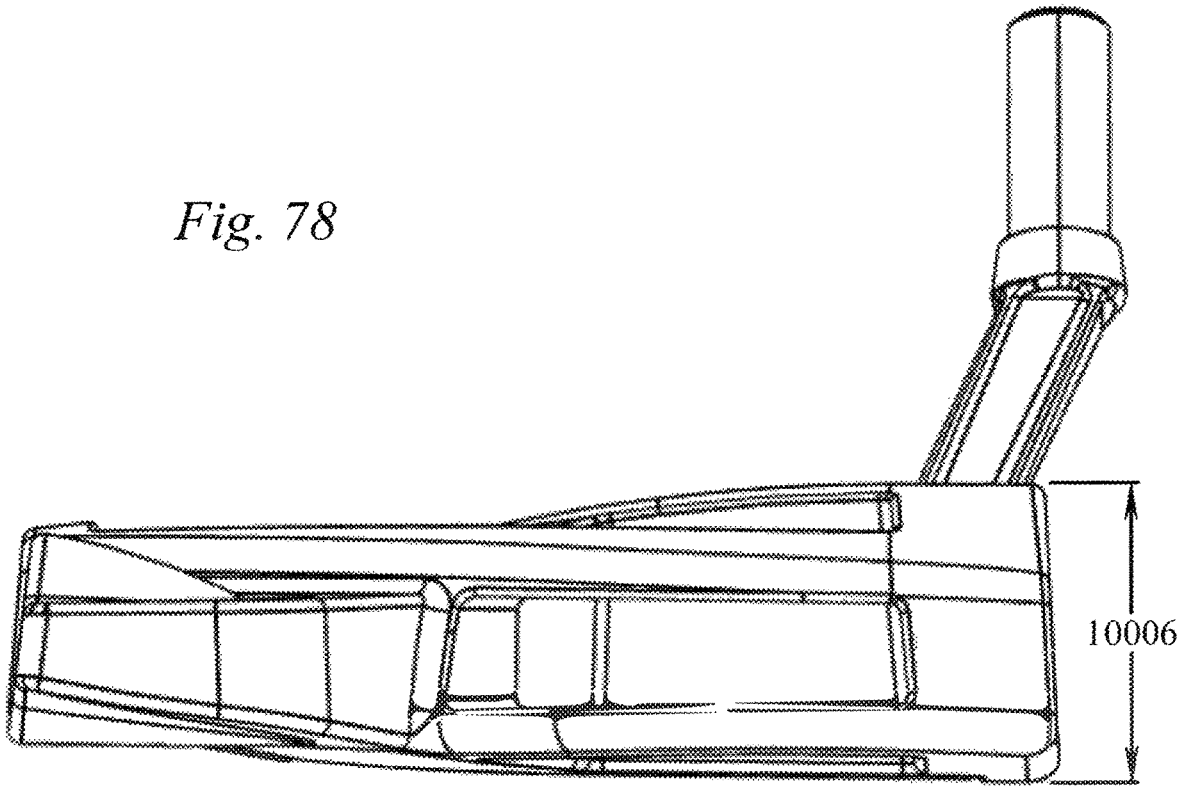
FIG. 78 is a schematic, toe elevation view of a golf club head, according to one or more examples of the present disclosure.
Figure 79:
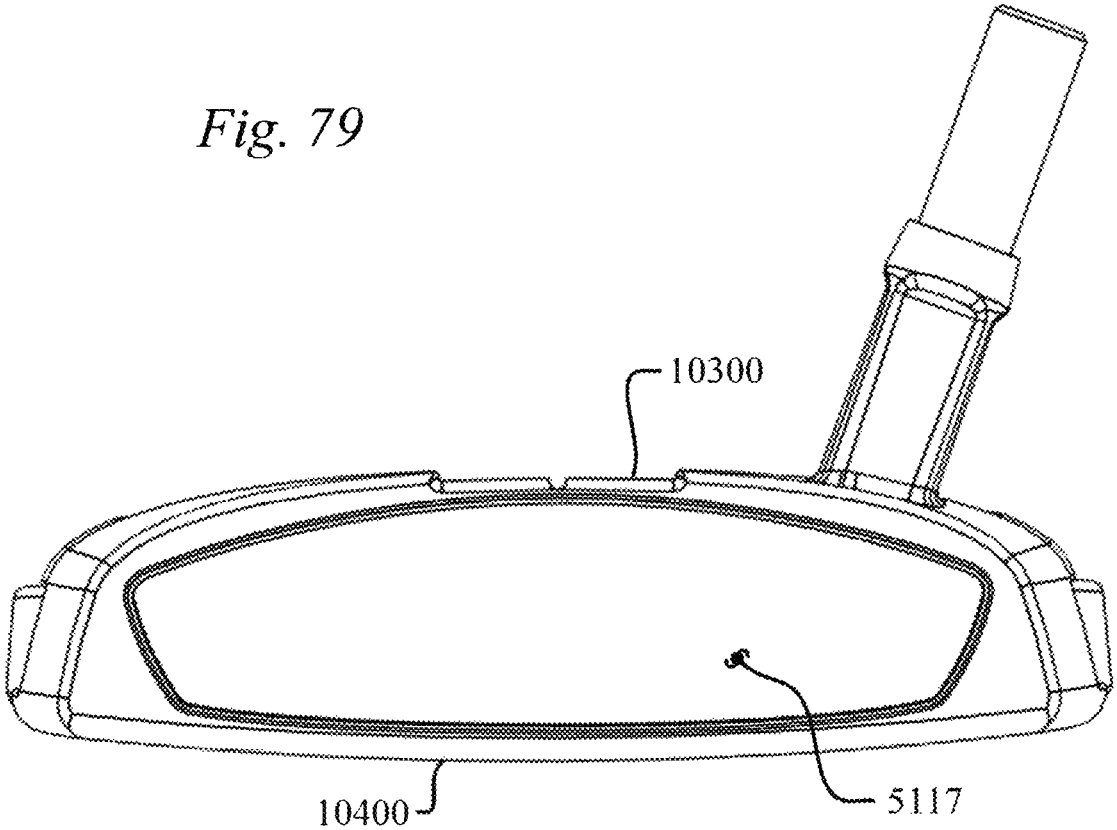
FIG. 79 is a schematic, front elevation view of a golf club head, according to one or more examples of the present disclosure.
Figure 80:
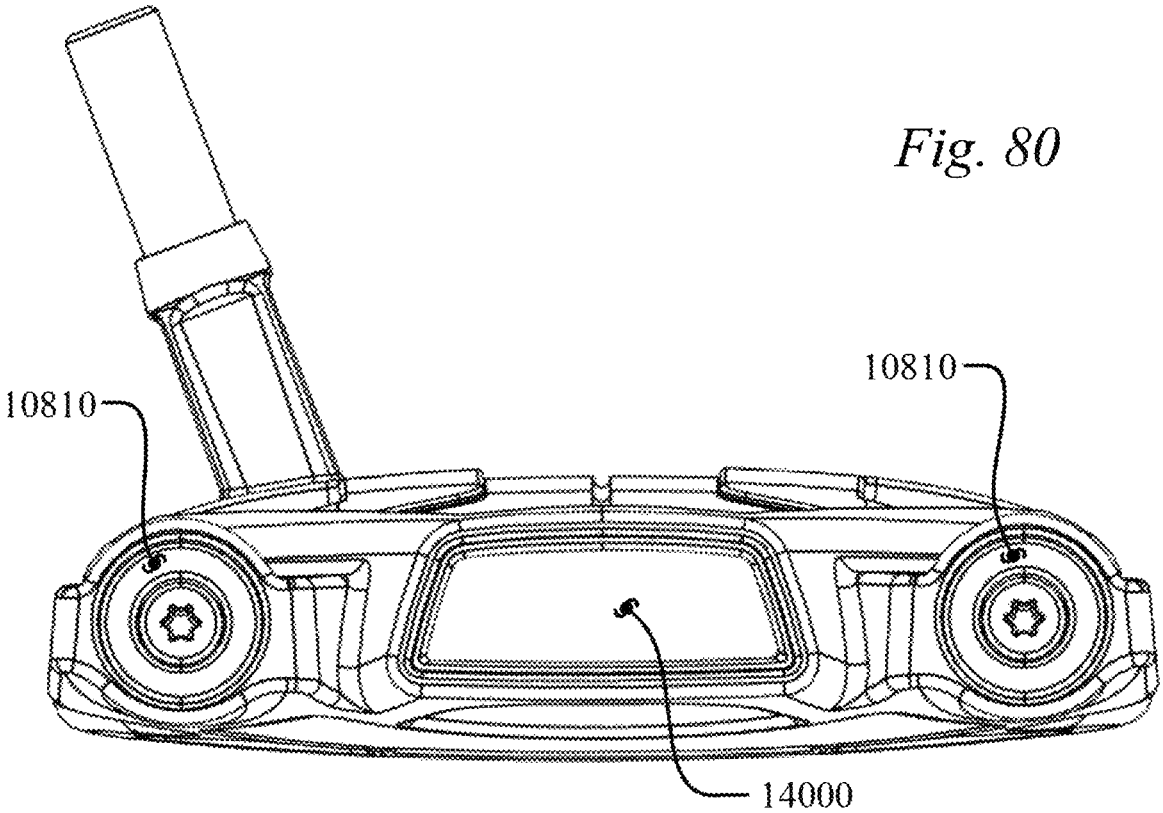
FIG. 80 is a schematic, rear elevation view of a golf club head, according to one or more examples of the present disclosure.

Thus, the frame 10000 is a substantial portion of the overall golf club head, which as disclosed is associated with pros and cons. The frame mass and frame material volume is substantial compared to a total club head mass, and the size of the frame 10000, driven by the disclosed frame length 10002, a frame width 10004, and/or frame height 10006, further compounding the difficulties in achieving desirable sound and feel upon impact with a golf ball. For instance, the total club head mass is no more than 400 grams in one embodiment, and in additional embodiments is no more than 390, 380, 370, or 360 grams. Further, in another embodiment the total club head mass is at least 330 grams, and in additional embodiments is at least 335, 340, 345, or 350 grams. The minimum frame length 10002 is at least 40 mm in one embodiment, and at least 50, 60, 70, or 80 mm in further embodiments. The maximum frame length 10002 is no more than 130 mm in an embodiment, and is not more than 120, 115, 110, 105, 100, or 95 mm in additional embodiments. Further, the minimum frame width 10004 is at least 75 mm in one embodiment, and at least 80, 85, or 90 mm in additional embodiments. The maximum frame width 10004 is no more than 130 mm in one embodiment, and no more than 125, 120, 115, 110, 105, 100, or 95 mm in further embodiments. The maximum frame height 10006 is at least 17 mm in an embodiment, and at least 18, 19, or 20 mm in additional embodiments. The maximum frame height 10006 is no more than 30 mm in one embodiment, and no more than 29, 28, 27, 26, or 25 mm in further embodiments. The frame length 10002 is measured parallel to the club head Y-axis, the frame width 10004 is measured parallel to the club head X-axis, and the frame height 10006 is measured parallel to the club head Z-axis, as illustrated in FIGS. 71A and 78. A frame mass ratio is a ratio of the frame mass to the total club head mass, which in one embodiment is at least 0.650, while in further embodiments is at least 0.700, 0.750, 0.775, 0.800, 0.825, 0.850, or 0.875. The frame mass ratio is no more than 0.975 in one embodiment, and no more than 0.950, 0.925, or 0.900 in additional embodiments.

Figure 74:
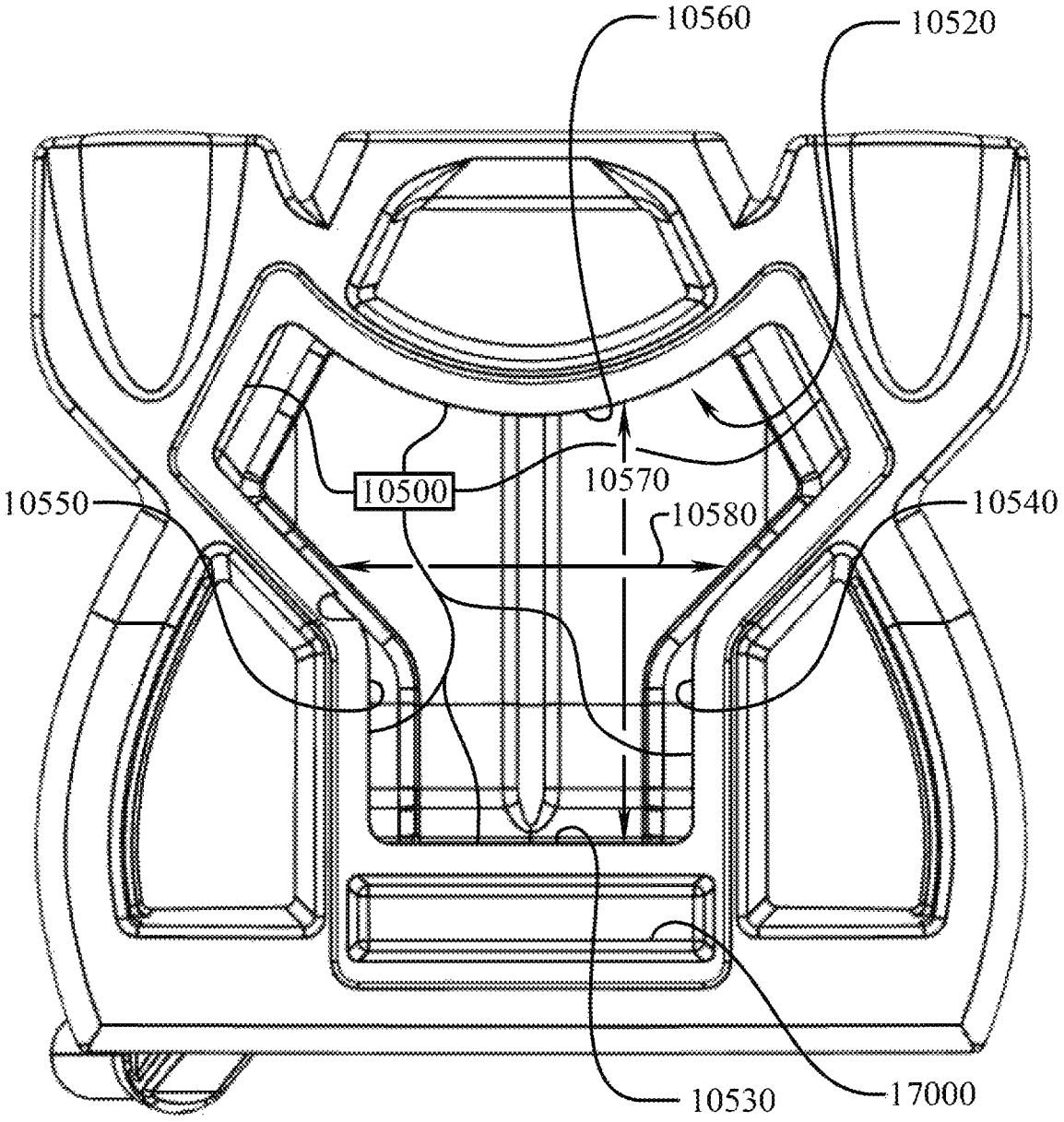
FIG. 74 is a schematic, partial bottom plan view of a golf club head, according to one or more examples of the present disclosure.
Figure 75:
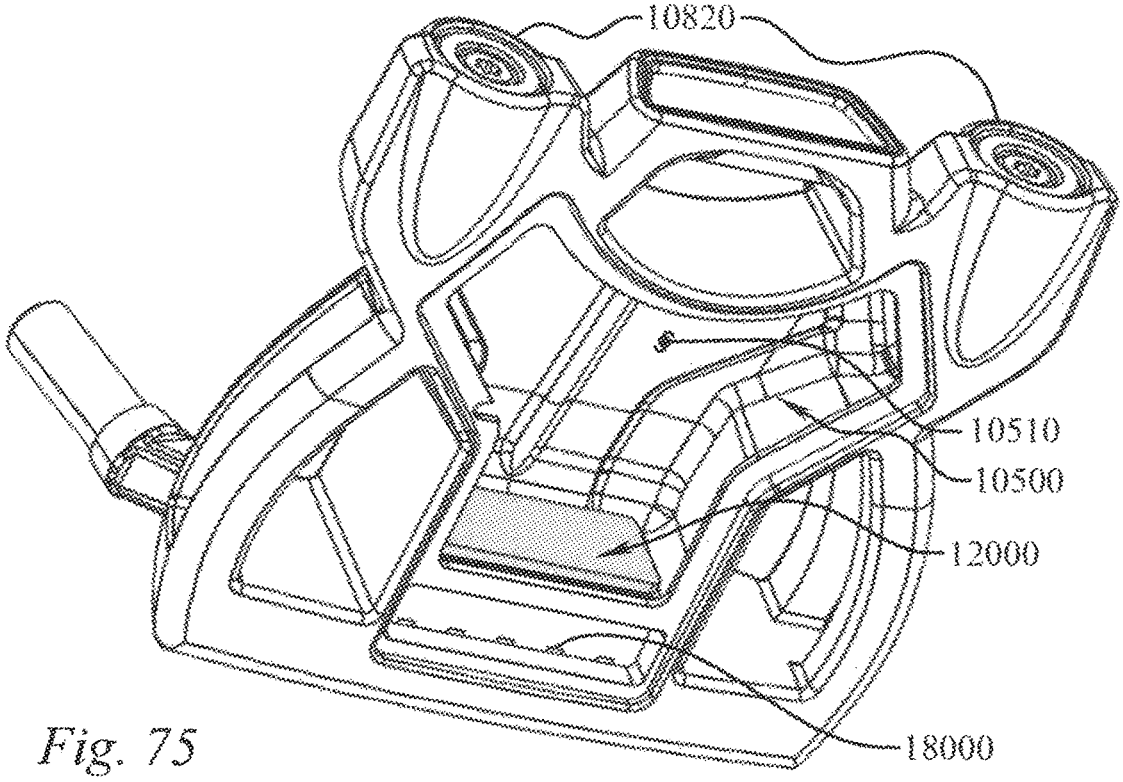
FIG. 75 is a schematic, partial bottom perspective view of a golf club head, according to one or more examples of the present disclosure.
Figure 92:
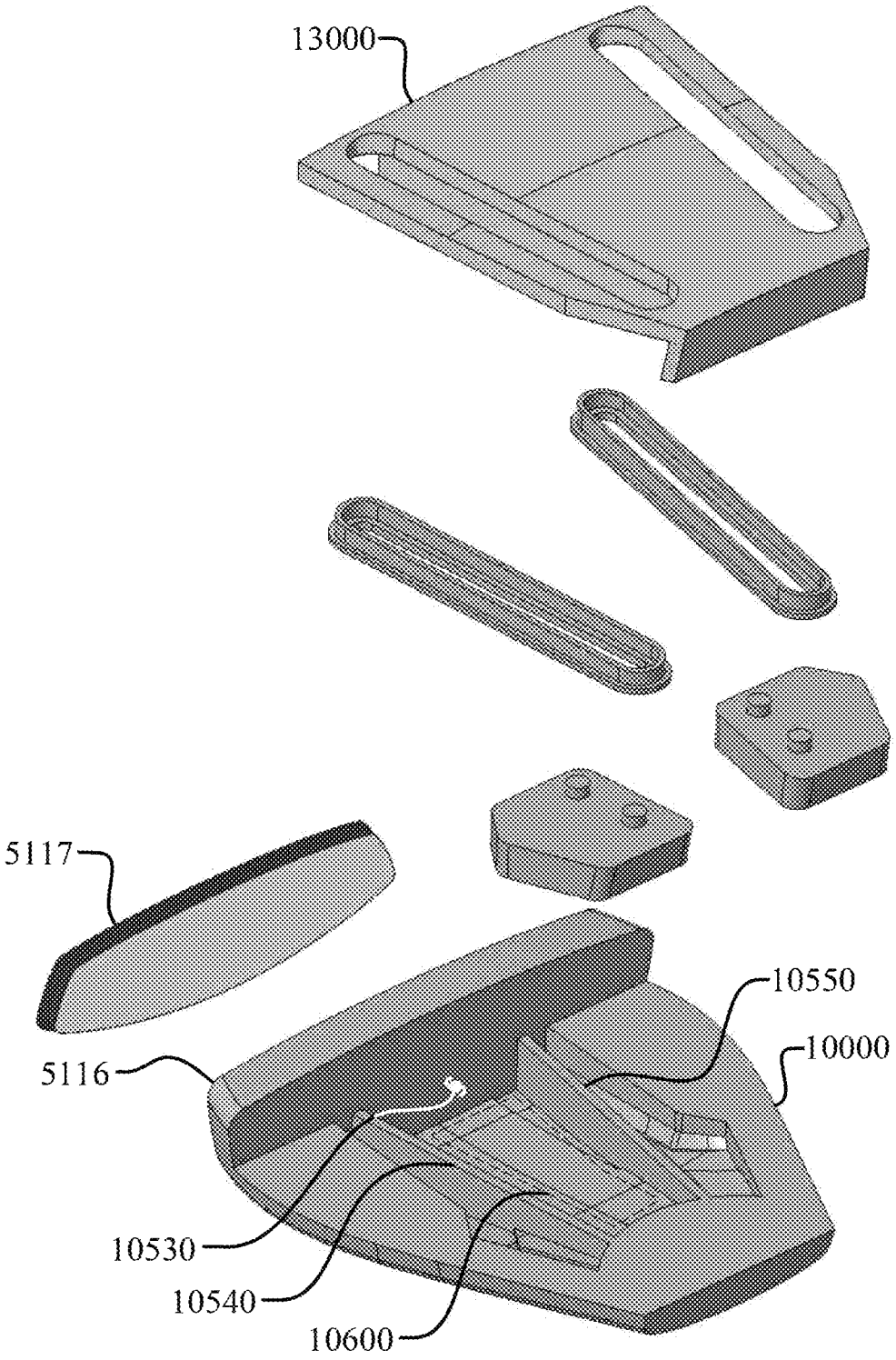
FIG. 92 is a schematic, exploded bottom perspective view of a golf club head, according to one or more examples of the present disclosure.

The frame 10000 may include a primary cavity 10500, abbreviated PC, bound in part by the frame top 10300, including a PC crown wall 10510, which includes at least a portion of the thin wall crown region 10600, the sole member 13000, and at least two sidewalls 10700, which in some embodiments includes at least two PC internal sidewalls 10520. For instance, the bottom plan view of FIG. 72 has the sole member 13000 installed and therefore the primary cavity 10500 cannot be seen. However, the bottom plan view of FIG. 74 does not include the sole member 13000 and therefore the primary cavity 10500 is exposed. In this embodiment the primary cavity 10500 is bound in part by PC internal sidewalls 10520, which may include one or more of a PC internal forward wall 10530, a PC internal toe wall 10540, a PC internal heel wall 10550, and/or a PC internal aft wall 10560, as seen in FIG. 74. However, one skilled in the art will appreciate that the frame sidewalls 10700, which form a portion of the frame perimeter 10010, may create the boundaries of the primary cavity 10500. For example, the embodiment of FIG. 71A illustrates the frame sidewall 10700 including a frame toe sidewall 10710, a frame heel sidewall 10720, and a frame aft sidewall 10730, which together form a substantial portion of the frame perimeter 10010, and these sidewalls 10710, 10720, 10730 may form the boundary of the primary cavity 10500. Similarly, a rear surface of a wall forming the striking face 5116, and/or supporting the face insert 5117, may form a boundary of the primary cavity 10500, such as in embodiments absent of a damping cavity 17000, as seen in FIG. 92.

Figure 83:
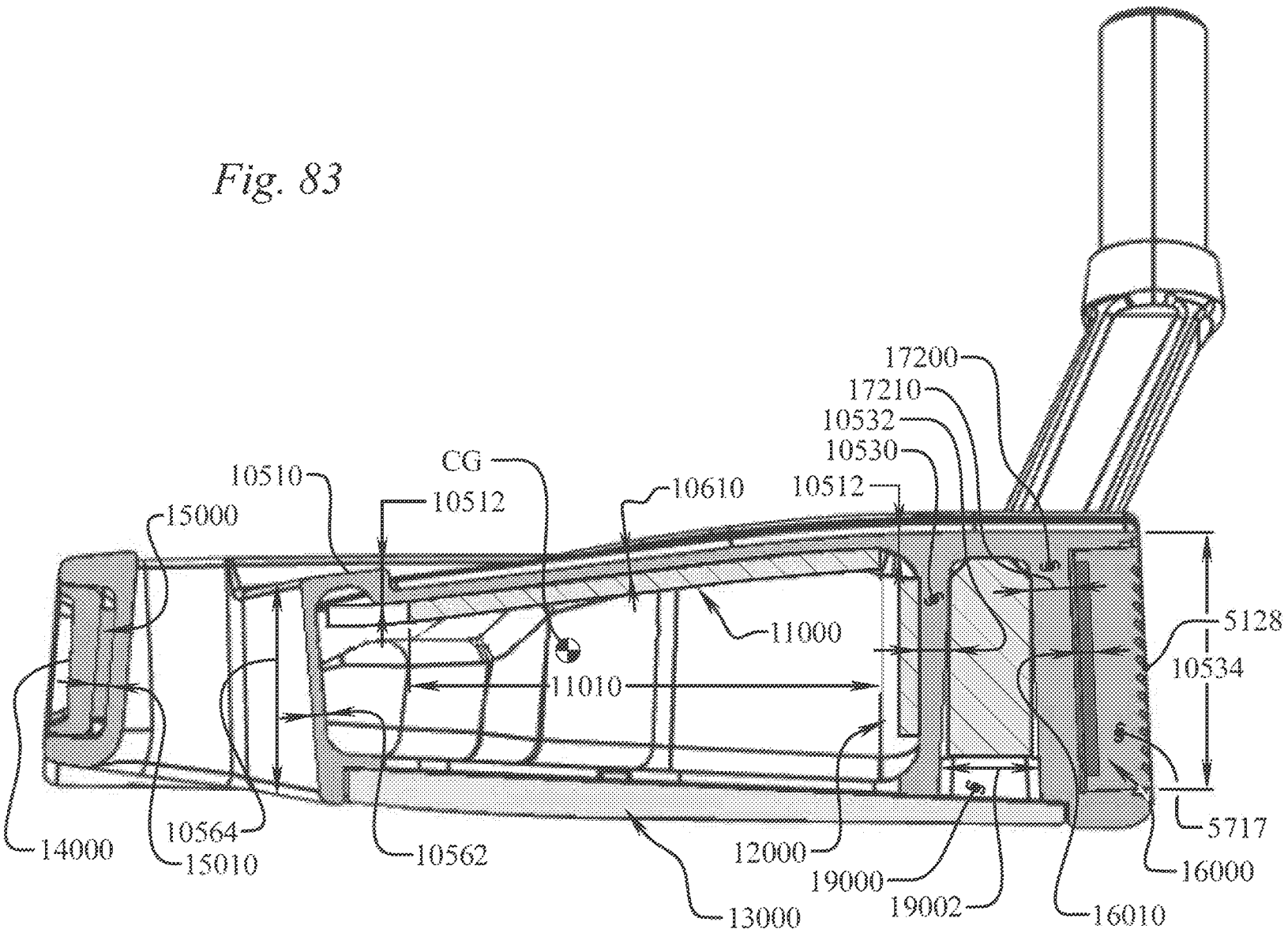
FIG. 83 is a schematic, cross-sectional view of a golf club head, according to one or more examples of the present disclosure.

The PC crown wall 10510 has a PC crown wall thickness 10512, seen in FIG. 83, which may vary. Within the thin wall crown region 10600 the PC crown wall thickness 10512 falls within the previously disclosed ranges of the TWCR thickness 10610. This is illustrated in FIG. 83 by the labeling of the PC crown wall thickness 10512 near the PC internal forward wall 10530 and the PC internal aft wall 10560, where the PC crown wall thickness 10512 increases and falls outside the disclosed ranges of the TWCR thickness 10610, and the labeling the TWCR thickness 10610 in the area of reduced thickness that falls within the previously disclosed ranges of the TWCR thickness 10610.

Figure 82:
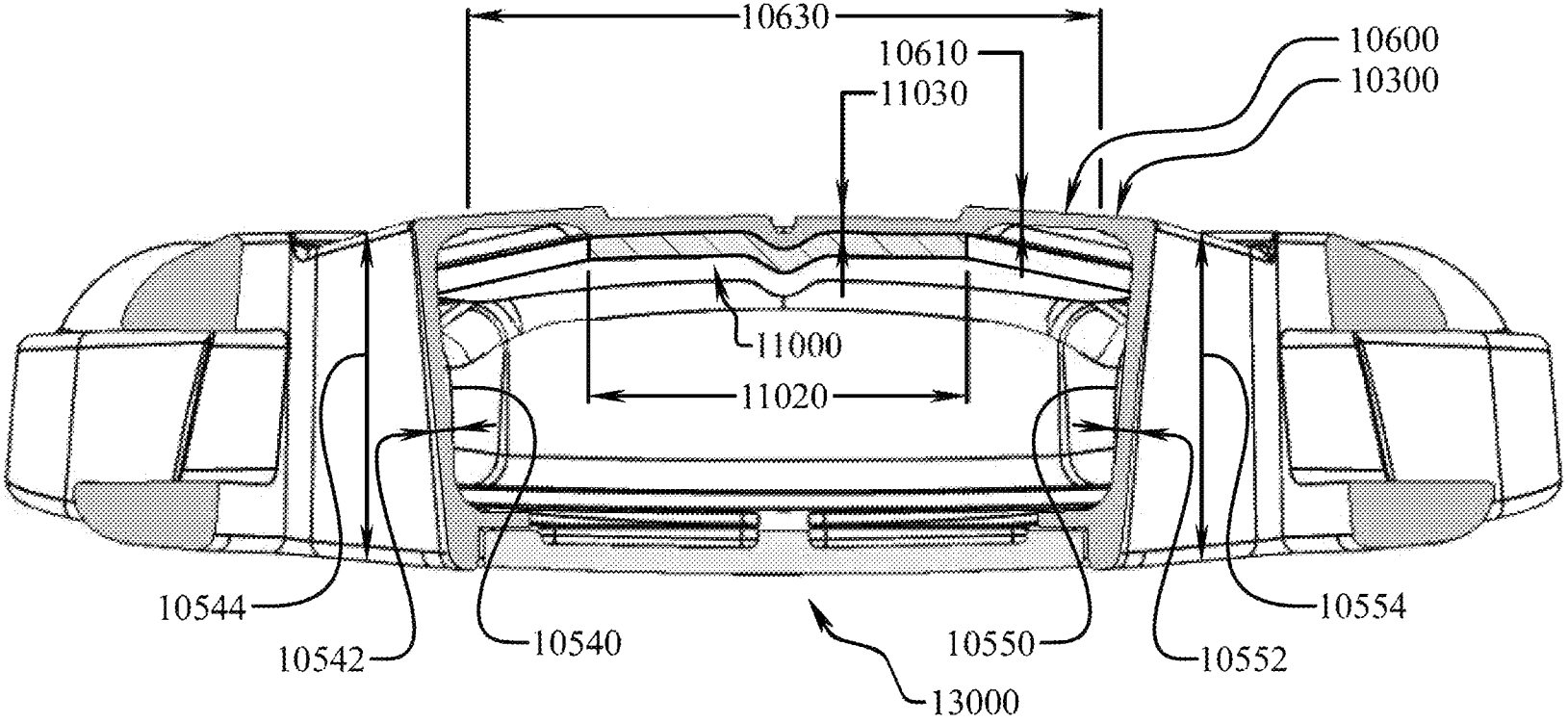
FIG. 82 is a schematic, cross-sectional view of a golf club head, according to one or more examples of the present disclosure.

As illustrated in FIGS. 82 and 83, the PC internal forward wall 10530 has a forward wall thickness 10532 and a forward wall height 10534, which is measured vertically downward from the exterior surface of the frame top 10300 that is directly above the PC internal forward wall 10530 when in the normal address position. Similarly, the PC internal toe wall 10540 has a toe wall thickness 10542 and a toe wall height 10544, which is measured vertically downward from the exterior surface of the frame top 10300 that is directly above the PC internal toe wall 10540 when in the normal address position. Likewise, the PC internal heel wall 10550 has a heel wall thickness 10552 and a heel wall height 10554, which is measured vertically downward from the exterior surface of the frame top 10300 that is directly above the PC internal heel wall 10550 when in the normal address position. Finally, the PC internal aft wall 10560 has an aft wall thickness 10562 and an aft wall height 10564, which is measured vertically downward from the exterior surface of the frame top 10300 that is directly above the PC internal aft wall 10560 when in the normal address position. These internal wall thicknesses and heights play a significant role in producing desirable sound and feel because regional stiffnesses may be increased, or decreased, to overcome undesirable attributes associated with the thin wall crown region 10600, yet the benefits of such a large unitary metallic frame 10000 with the thin wall crown region 10600 still outweigh the additional complexities to achieve desirable sound and feel.

Each of the disclosed PC internal wall thicknesses 10532, 10542, 10552, and/or 10562 need not be constant and may vary. Thus, each may have a minimum thickness and a maximum thickness, where the maximum thickness is not equal to the minimum thickness. In constant thickness embodiments the maximum thickness is equal to the minimum thickness, and therefore reference to maximum or minimum thickness does not infer that the thickness varies. In one embodiment the minimum forward wall thickness 10532 is greater than at least one of: the minimum TWCR thickness 10610, the minimum toe wall thickness 10542, the minimum heel wall thickness 10552, and/or the minimum aft wall thickness 10562; while in further embodiments the relationship is true for at least two of the thicknesses, or at least three of the thicknesses, or all four of the thicknesses. In another embodiment the minimum forward wall thickness 10532 is at least 20% greater than the minimum TWCR thickness 10610, and in further embodiments at least 30%, 40%, 50%, or 60%. In still another embodiment the minimum forward wall thickness 10532 is no more than 250% greater than the minimum TWCR thickness 10610, and no more than 225%, 200%, 150%, or 125% in additional embodiments. In another embodiment the minimum forward wall thickness 10532 is at least 20% greater than the minimum aft wall thickness 10562, and in further embodiments at least 30%, 40%, 50%, or 60%. In still another embodiment the minimum forward wall thickness 10532 is no more than 250% greater than the minimum aft wall thickness 10562, and no more than 225%, 200%, 150%, or 125% in additional embodiments. In another embodiment the minimum forward wall thickness 10532 is at least 20% greater than the minimum toe wall thickness 10542, and in further embodiments at least 30%, 40%, 50%, or 60%. In still another embodiment the minimum forward wall thickness 10532 is no more than 250% greater than the minimum toe wall thickness 10542, and no more than 225%, 200%, 150%, or 125% in additional embodiments. In another embodiment the minimum forward wall thickness 10532 is at least 20% greater than the minimum heel wall thickness 10552, and in further embodiments at least 30%, 40%, 50%, or 60%. In still another embodiment the minimum forward wall thickness 10532 is no more than 250% greater than the minimum heel wall thickness 10552, and no more than 225%, 200%, 150%, or 125% in additional embodiments.

Similarly, each of the disclosed PC internal wall heights 10534, 10544, 10554, and/or 10564 need not be constant and may vary. Thus, each may have a minimum height and a maximum height, where the maximum height is not equal to the minimum height. In constant height embodiments the maximum height is equal to the minimum height, and therefore reference to maximum or minimum height does not infer that the thickness varies. The PC internal wall heights 10534, 10544, 10554, and/or 10564 influence the shape and volume of the primary cavity 10500, the rigidity of the frame 10000, and performance of the overall club head. In one embodiment the minimum forward wall height 10534 is at least 10% greater than the maximum aft wall height 10564, and in further embodiments is at least 15%, 20%, or 25% greater than the maximum aft wall height 10564. In another embodiment the minimum forward wall height 10534 is no more than 80% greater than the maximum aft wall height 10564, and in further embodiments is no more than 70%, 60%, 50%, or 40% greater than the maximum aft wall height 10564. Similarly, in one embodiment the minimum forward wall height 10534 is at least 10% greater than the minimum toe wall height 10544, and in further embodiments is at least 15%, 20%, or 25% greater than the minimum toe wall height 10544. In another embodiment the minimum forward wall height 10534 is no more than 80% greater than the minimum toe wall height 10544, and in further embodiments is no more than 70%, 60%, 50%, or 40% greater than the minimum toe wall height 10544. Likewise, in one embodiment the minimum forward wall height 10534 is at least 10% greater than the minimum heel wall height 10554, and in further embodiments is at least 15%, 20%, or 25% greater than the minimum heel wall height 10554. In another embodiment the minimum forward wall height 10534 is no more than 80% greater than the minimum heel wall height 10554, and in further embodiments is no more than 70%, 60%, 50%, or 40% greater than the minimum heel wall height 10554. The disclosed variations in the walls, their sizes, and locations, and relationships with other attributes of the club head influence primary cavity volume as well as the vibrational modes, frequency, and/or amplitude and may produce preferred sound and feel of the club head.

In the illustrated embodiment of FIGS. 82 and 83, the primary cavity 10500 has a primary cavity volume that is easy to determine because it is bound by portions of the PC crown wall 10510, the sole member 13000, the PC internal forward wall 10530, the PC internal toe wall 10540, the PC internal heel wall 10550, and the PC internal aft wall 10560. Nonetheless, the primary cavity 10500 need not be entirely enclosed to constitute a primary cavity 10500. For instance, one embodiment does not have the PC internal toe wall 10540 and the PC internal heel wall 10550, and thus heel and toe sides may be open, with the primary cavity 10500 bound by portions of the PC crown wall 10510, the sole member 13000, the PC internal forward wall 10530, and the PC internal aft wall 10560.

As illustrated in FIG. 74, the primary cavity 10500 had a PC length 10570 and a PC width 10580. The PC length 10570 is measured parallel to the club head Y-axis, and the PC width 10580 is measured parallel to the club head X-axis. As with all disclosed lengths and widths of any components, the PC length 10570 and the PC width 10580 need not be constant and may vary. Thus, there may be a minimum PC length 10570 and a maximum PC length 10570, where the maximum PC length 10570 is not equal to the minimum PC length 10570. In constant PC length 10570 embodiments the maximum PC length 10570 is equal to the minimum PC length 10570, and therefore reference to maximum or minimum PC length 10570 does not infer that the PC length 10570 varies. Similarly, there may be a minimum PC width 10580 and a maximum PC width 10580, where the maximum PC width 10580 is not equal to the minimum PC width 10580. In constant PC width 10580 embodiments the maximum PC width 10580 is equal to the minimum PC width 10580, and therefore reference to maximum or minimum PC width 10580 does not infer that the PC width 10580 varies.

The minimum PC length 10570 is at least 10 mm in one embodiment, and at least 15, 20, 25, 30, 35, 40, 45, 50, 55, or 60 mm in further embodiments. The maximum PC length 10570 is no more than 120 mm in an embodiment, and is not more than 110, 105, 100, 95, 90, or 85 mm in additional embodiments. Further, the minimum PC width 10580 is at least 10 mm in one embodiment, and at least 15, 20, 25, or 30 mm in additional embodiments. The maximum PC width 10580 is no more than 120 mm in one embodiment, and no more than 110, 105, 100, 95, 90, or 85 mm in further embodiments.

In one embodiment the maximum PC length 10570 is greater than the minimum PC width 10580, while in a further embodiment the maximum PC length 10570 is at least 10% greater than the minimum PC width 10580, and at least 20%, 30%, 40%, or 50% in additional embodiments. In one embodiment the maximum PC width 10580 is greater than the minimum PC length 10570, while in a further embodiment the maximum PC width 10580 is at least 10% greater than the minimum PC length 10570, and at least 20%, 30%, 40%, or 50% in additional embodiments.

The maximum PC length 10570 is within 35% of the minimum PC length 10570 in one embodiment, and within 30%, 25%, 20%, or 15% in additional embodiments. While in another embodiment the maximum PC width 10580 is at least 10% greater than the minimum PC width 10580, and at least 15%, 20%, 25%, 30%, or 35% greater in further embodiments. The maximum PC width 10580 is no more than 120% greater than the minimum PC width 10580 in one embodiment, and no more than 110%, 100%, 90%, or 80% greater in additional embodiments. In one embodiment the difference between the maximum PC length 10570 and the minimum PC length 10570 is no more than 200% of the Zup of the club head, and in further embodiments no more than 180%, 160%, 140%, or 120%. In another embodiment the difference between the maximum PC width 10580 and the minimum PC width 10580 is greater than the Zup of the club head, and in further embodiments at least 10%, 20%, 30%, 40%, 50%, 60%, or 70% greater. The difference between the maximum PC width 10580 and the minimum PC width 10580 is no more than 5 times Zup of the club head in one embodiment, and no more than 4.5, 4.0, or 3.5 times in additional embodiments. In another embodiment the minimum PC width 10580 is at least 10% greater than the frame height 10006, and at least 20%, 30%, or 40% in further embodiments. The minimum PC length 10570 is at least 20% greater than the frame height 10006, and at least 25%, 30%, 35%, 40%, 45%, 50%, or 55% in further embodiments.

The disclosed variations in the PC length 10570, the PC width 10580, and relationships with other attributes of the club head influence primary cavity volume as well as the vibrational modes, frequency, and/or amplitude and may produce preferred sound and feel of the club head.

The primary cavity volume, in mm^3, is at least 10 times the total club head mass, in grams in an embodiment, and is at least 11, 13, 15, 17, or 19 times in additional embodiments. Further, the primary cavity volume, in mm^3, is no more than 80 times the total club head mass, in grams in an embodiment, and no more than 75, 70, 60, 55, or 50 times in other embodiments. In fact, the primary cavity volume is at least 3000 mm^3 in one embodiment, and at least 3500, 4000, 4500, 5000, 5500, 6000, or 6500 mm^3 in additional embodiments. The primary cavity volume is no more than 135000 mm^3 in another embodiment, and no more than 125000, 120000, 115000, 110000, 105000, 100000, 95000, 90000, 85000, 80000, 75000, 70000, 65000, 60000, 55000, 50000, 45000, 40000, 35000, 30000, 25000, or 20000 mm^3 in further embodiments. The primary cavity 10500 need not be void of material, in fact later disclosure will illustrate this via the crown damping member 11000, the sidewall damping member 12000, the damper 18000, and/or other fill material, such as PC fill 10590 seen in FIG. 88.

One skilled in the art will appreciate that disclosed frame 10000 designs may be inverted in the figures so that the frame 10000 creates a large thin sole, as opposed to the frame top 10300, and the alternative design may include a crown member that is analogous to the sole member 13000. Such a design would incorporate a thin wall sole region, abbreviated SWSR region, instead of, or in addition to, the thin wall crown region 10600. Thus, all the disclosure and relationships associated with the thin wall crown region 10600 apply equally to a thin wall sole region, and similarly all the disclosure and relationships associated with the sole member 13000 apply equally to a separate crown insert in such inverted frame designs.

Figure 72:
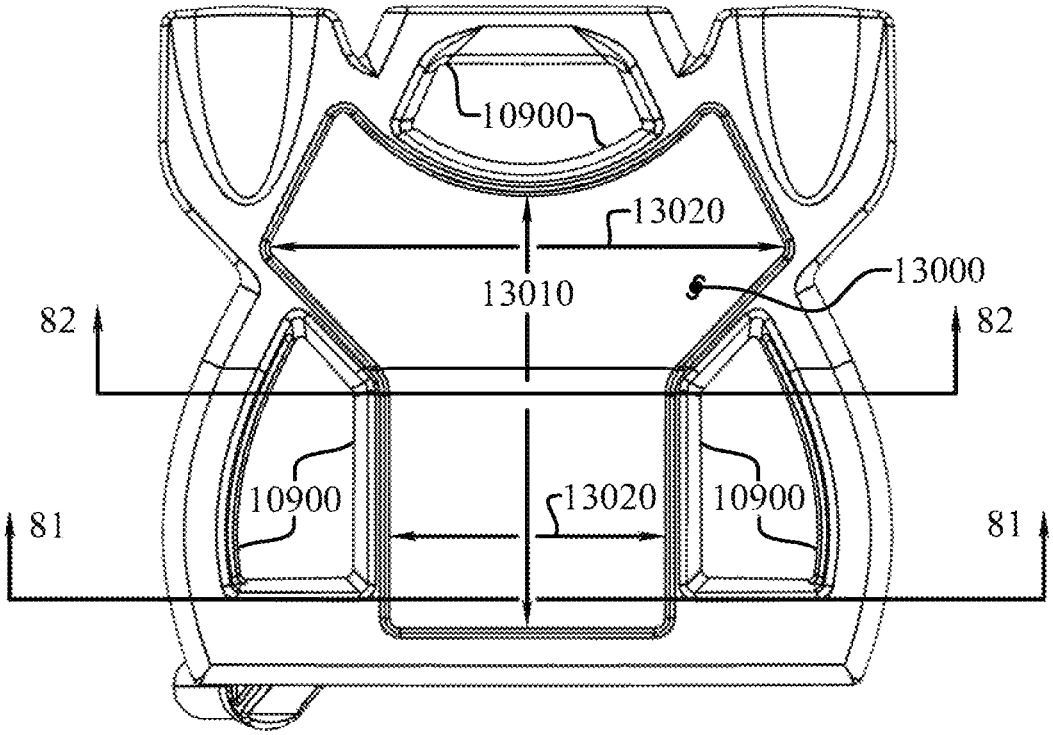
FIG. 72 is a schematic, bottom plan view of a golf club head, according to one or more examples of the present disclosure.
Figure 76:
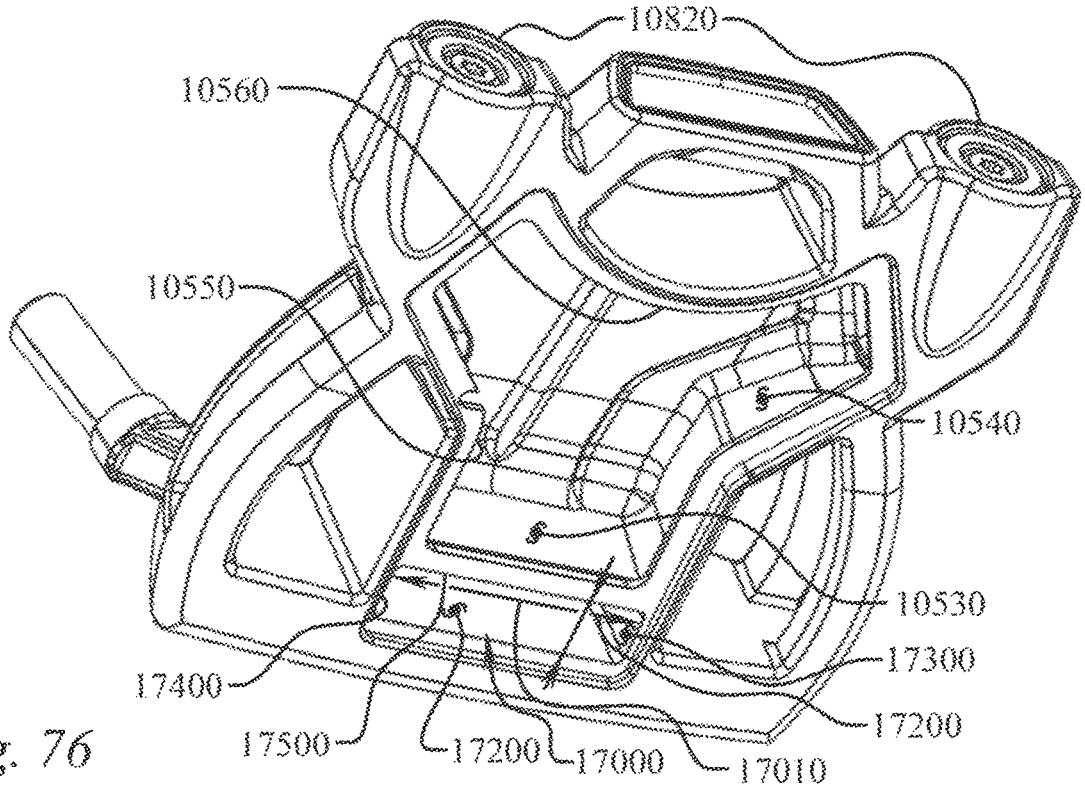
FIG. 76 is a schematic, partial bottom perspective view of a golf club head, according to one or more examples of the present disclosure.
Figure 77:
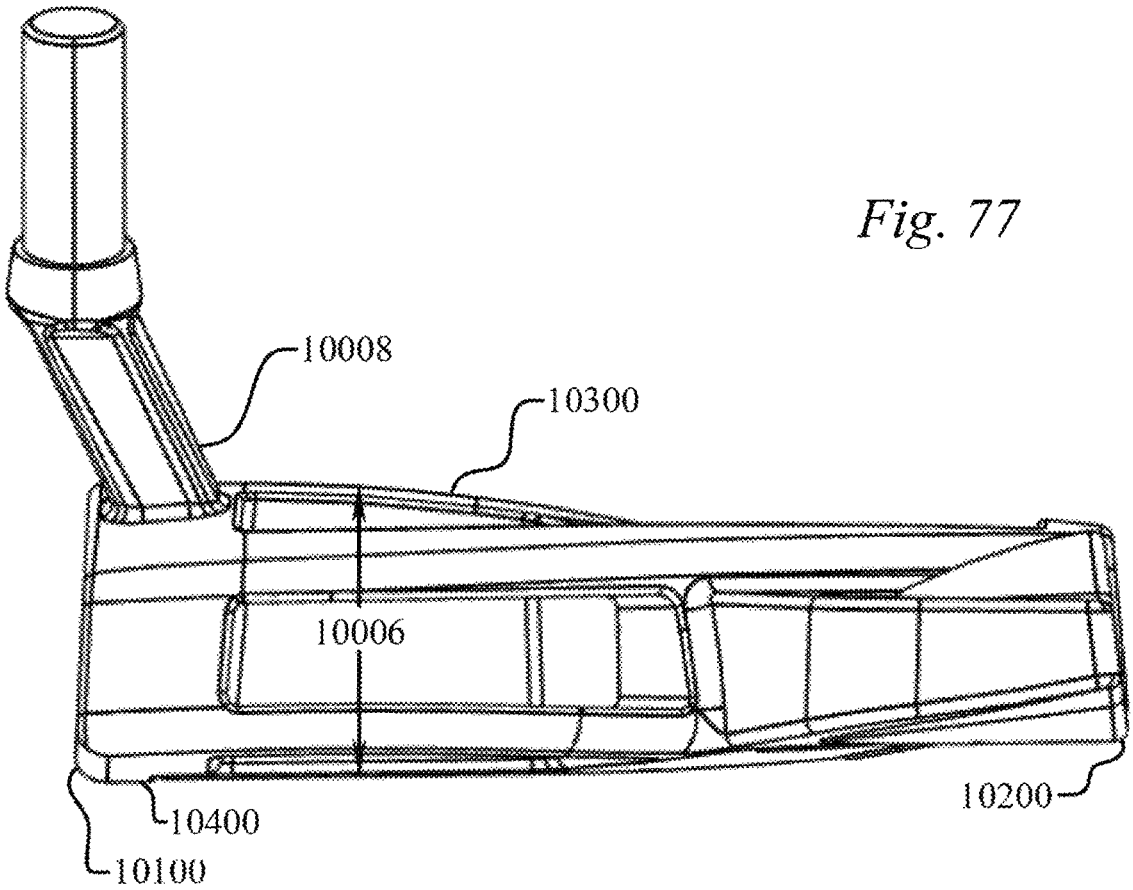
FIG. 77 is a schematic, heel elevation view of a golf club head, according to one or more examples of the present disclosure.
Figure 81:
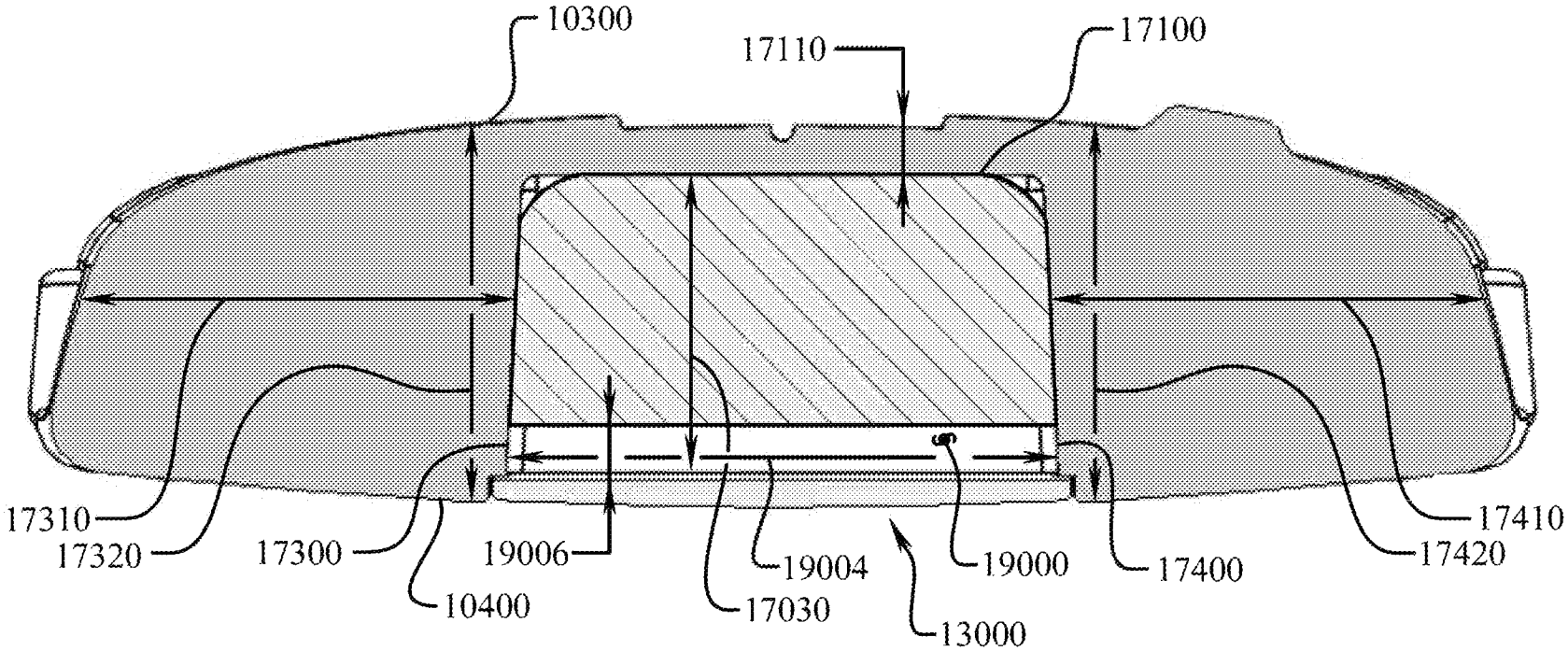
FIG. 81 is a schematic, cross-sectional view of a golf club head, according to one or more examples of the present disclosure.

The frame 10000 may further include a damping cavity 17000, abbreviated DC, as shown in FIG. 76, and having a DC length 17010, a DC width 17020, and a DC depth 17030. The damping cavity 17000 may include a DC crown wall 17100 having a DC crown wall thickness 17110, a DC forward wall 17200 having a DC forward wall thickness 17210 and a DC forward wall height 17220, a DC toe wall 17300 having a DC toe wall thickness 17310 and a DC toe wall height 17320, a DC heel wall 17400 having a DC heel wall thickness 17410 and a DC heel wall height 17420, and/or a DC aft wall 17500, which has the same thickness and height as disclosed with respect to the PC internal forward wall 10530. In the illustrated embodiment the damping cavity 17000 is covered by the sole member 13000, as seen in FIG. 72, however it may be exposed on the exterior of the club head. The DC wall heights 17220, 17320, 17420 are measured in the same manner as the PC wall heights 10534, 10544, 10554, 10564, whereas the DC depth 17030 is measured vertically from the inner surface of the DC crown wall 17100 to the sole member 13000, as seen in FIG. 81, or the adjacent surface of the frame bottom 10400 for embodiments in which the some member 13000 doesn't cover the damping cavity 17000. The DC length 17010 and the DC width 17020 are measured in the same manner as those of the primary cavity 10500. The disclosed variations in the DC length 17010, the DC width 17020, the DC depth 17030, the DC wall thicknesses and DC wall heights, the DC volume, the location of the damping cavity, and relationships with other attributes of the club head influence damping cavity volume as well as the vibrational modes, frequency, and/or amplitude and may produce preferred sound and feel of the club head.

Each of the disclosed DC wall thicknesses 17110, 17210, 17310, and/or 17410 need not be constant and may vary. Thus, each may have a minimum thickness and a maximum thickness, where the maximum thickness is not equal to the minimum thickness. In constant thickness embodiments the maximum thickness is equal to the minimum thickness, and therefore reference to maximum or minimum thickness does not infer that the thickness varies. In one embodiment the minimum DC forward wall thickness 17210 is greater than at least one of: the minimum TWCR thickness 10610, the minimum toe wall thickness 10542, the minimum heel wall thickness 10552, and/or the minimum aft wall thickness 10562; while in further embodiments the relationship is true for at least two of the thicknesses, or at least three of the thicknesses, or all four of the thicknesses. In another embodiment the minimum DC forward wall thickness 17210 is at least 20% greater than the minimum TWCR thickness 10610, and in further embodiments at least 30%, 40%, 50%, or 60%. In still another embodiment the minimum DC forward wall thickness 17210 is no more than 250% greater than the minimum TWCR thickness 10610, and no more than 225%, 200%, 150%, or 125% in additional embodiments. In another embodiment the minimum DC forward wall thickness 17210 is at least 20% greater than the minimum aft wall thickness 10562, and in further embodiments at least 30%, 40%, 50%, or 60%. In still another embodiment the minimum DC forward wall thickness 17210 is no more than 250% greater than the minimum aft wall thickness 10562, and no more than 225%, 200%, 150%, or 125% in additional embodiments. In another embodiment the minimum DC forward wall thickness 17210 is at least 20% greater than the minimum toe wall thickness 10542, and in further embodiments at least 30%, 40%, 50%, or 60%. In still another embodiment the minimum DC forward wall thickness 17210 is no more than 250% greater than the minimum toe wall thickness 10542, and no more than 225%, 200%, 150%, or 125% in additional embodiments. In another embodiment the minimum DC forward wall thickness 17210 is at least 20% greater than the minimum heel wall thickness 10552, and in further embodiments at least 30%, 40%, 50%, or 60%. In still another embodiment the minimum DC forward wall thickness 17210 is no more than 250% greater than the minimum heel wall thickness 10552, and no more than 225%, 200%, 150%, or 125% in additional embodiments.

Similarly, each of the disclosed DC wall heights 17220, 17320, and/or 17420 need not be constant and may vary. Thus, each may have a minimum height and a maximum height, where the maximum height is not equal to the minimum height. In constant height embodiments the maximum height is equal to the minimum height, and therefore reference to maximum or minimum height does not infer that the thickness varies. The DC wall heights 17220, 17320, and/or 17420 influence the shape and volume of the damping cavity 17000, the rigidity of the frame 10000, and performance of the overall club head. In one embodiment the minimum DC forward wall height 17220 is at least 10% greater than the maximum aft wall height 10564, and in further embodiments is at least 15%, 20%, or 25% greater than the maximum aft wall height 10564. In another embodiment the minimum DC forward wall height 17220 is no more than 80% greater than the maximum aft wall height 10564, and in further embodiments is no more than 70%, 60%, 50%, or 40% greater than the maximum aft wall height 10564. Similarly, in one embodiment the minimum DC forward wall height 17220 is at least 10% greater than the minimum toe wall height 10544, and in further embodiments is at least 15%, 20%, or 25% greater than the minimum toe wall height 10544. In another embodiment the minimum DC forward wall height 17220 is no more than 80% greater than the minimum toe wall height 10544, and in further embodiments is no more than 70%, 60%, 50%, or 40% greater than the minimum toe wall height 10544. Likewise, in one embodiment the minimum DC forward wall height 17220 is at least 10% greater than the minimum heel wall height 10554, and in further embodiments is at least 15%, 20%, or 25% greater than the minimum heel wall height 10554. In another embodiment the minimum DC forward wall height 17220 is no more than 80% greater than the minimum heel wall height 10554, and in further embodiments is no more than 70%, 60%, 50%, or 40% greater than the minimum heel wall height 10554.

Figure 93:
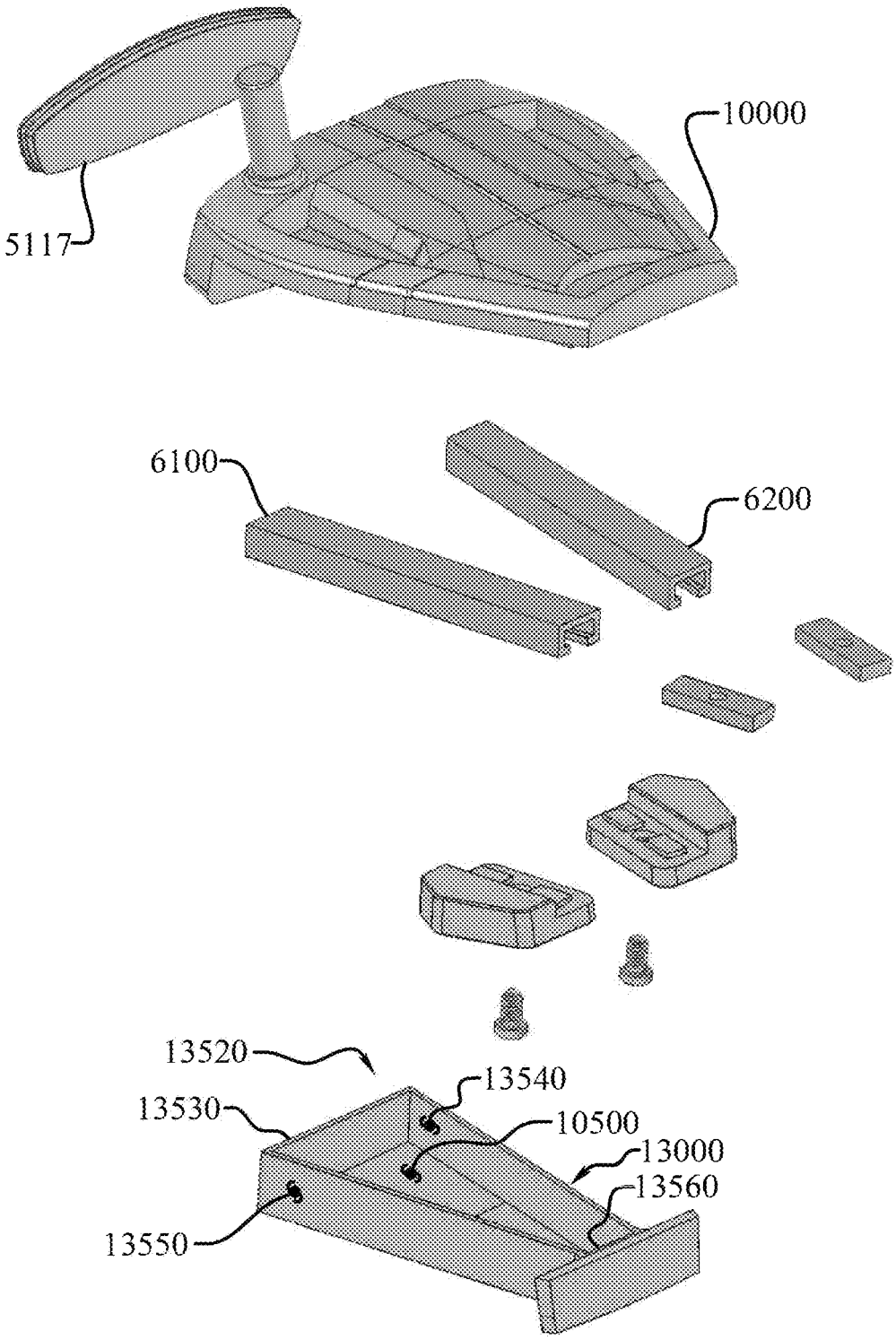
FIG. 93 is a schematic, exploded top perspective view of a golf club head, according to one or more examples of the present disclosure.
Figure 94:
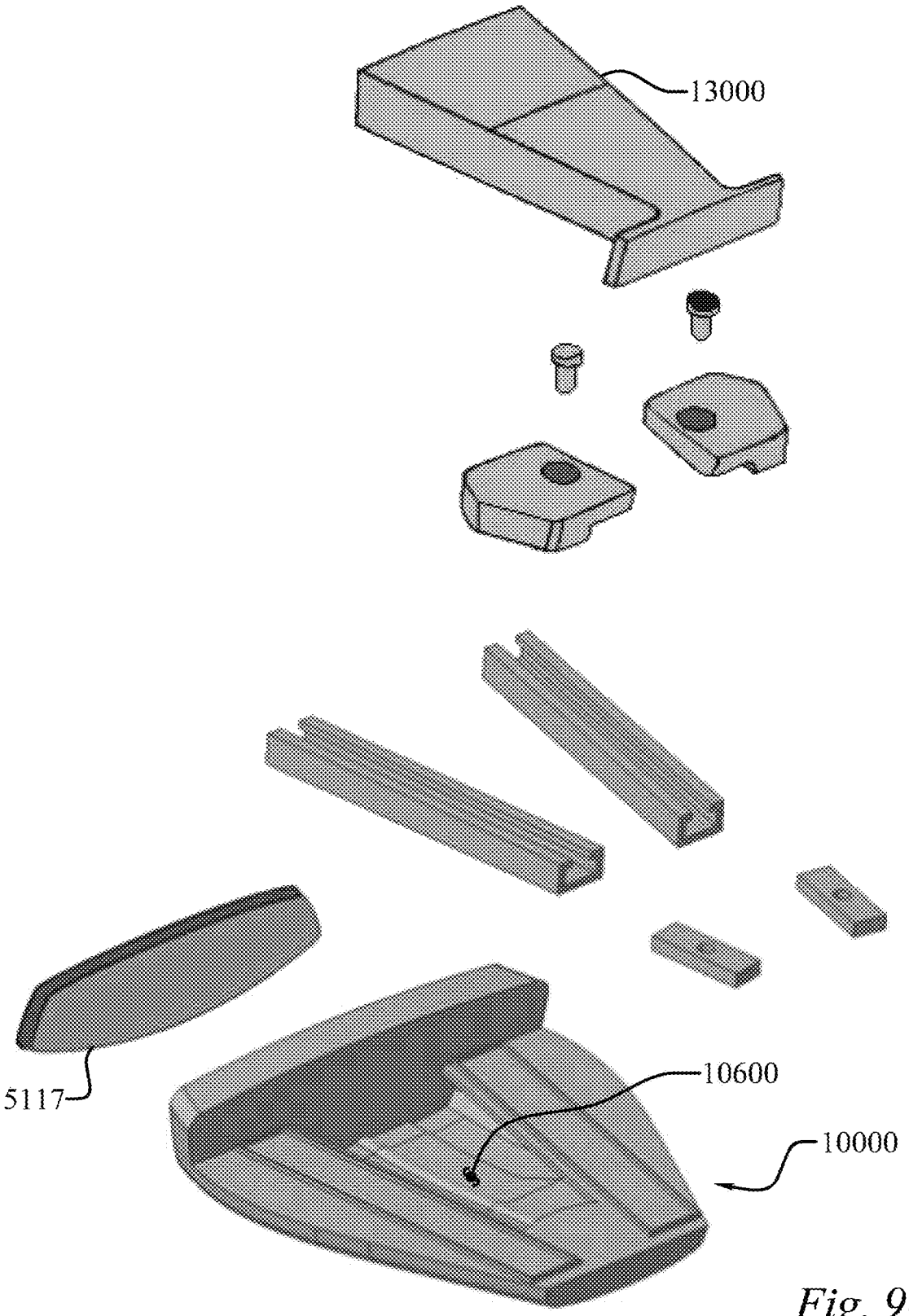
FIG. 94 is a schematic, exploded bottom perspective view of a golf club head, according to one or more examples of the present disclosure.
Figure 95:
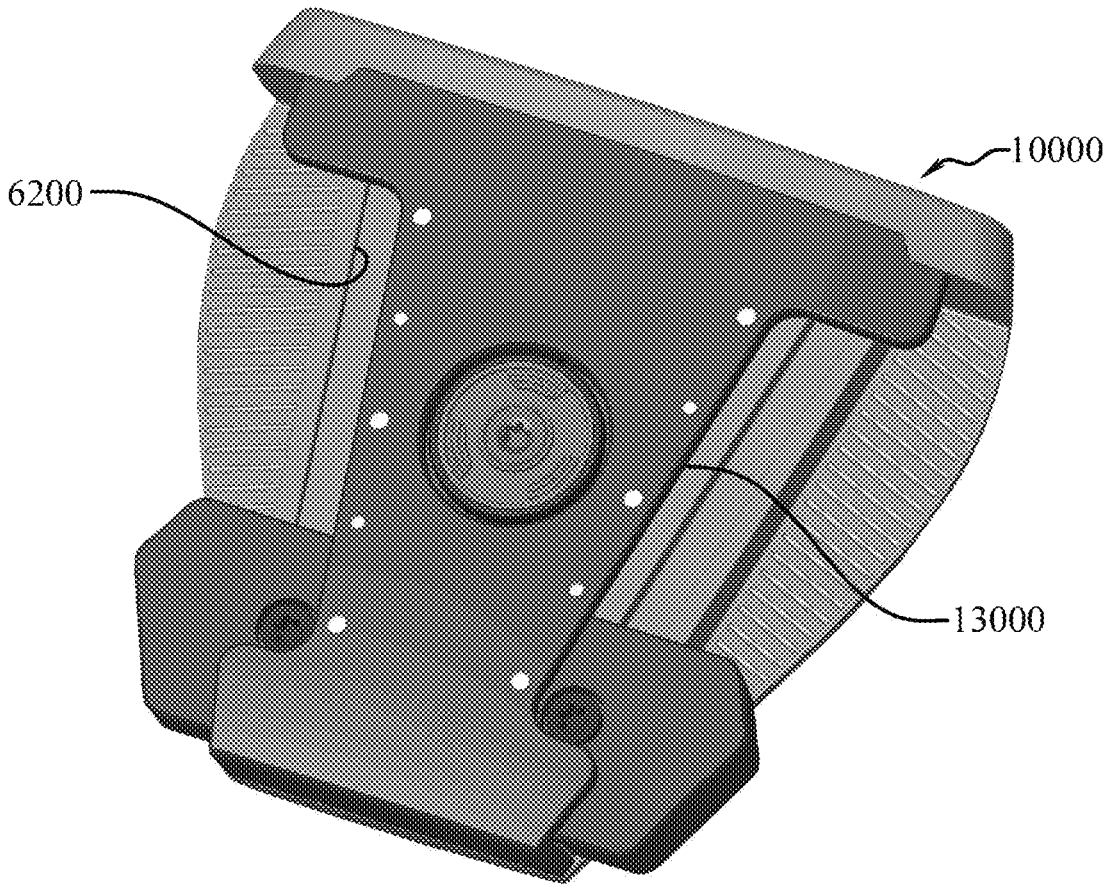
FIG. 95 is a schematic, bottom perspective view of a golf club head, according to one or more examples of the present disclosure.

One skilled in the art will appreciate that the PC internal sidewalls 10520 may be formed in part, or entirely, by analogous sidewalls formed in the sole member 13000, referred to as SM PC sidewalls 13520, as illustrated in FIG. 93. For example, the analogous SM PC sidewalls 13520 may include a SM PC internal forward wall 13530, a SM PC internal toe wall 15340, a SM PC internal heel wall 13550, and/or a SM PC internal aft wall 13560, as seen in FIG. 93. Likewise, any of the disclosure relating to the wall thicknesses and wall heights of the PC internal sidewalls 10520 apply equally to the analogous SM PC internal sidewalls 13520 formed in the sole member 13000.

In the illustrated embodiment of FIGS. 82 and 83, the damping cavity 17000 has a damping cavity volume is easy to determine because it is bound by portions of the DC crown wall 17100, the sole member 13000, the DC forward wall 17200, the DC toe wall 17300, the DC heel wall 117400, and the DC aft wall 17500. Nonetheless, the damping cavity 17000 need not be entirely enclosed to constitute a damping cavity 17000. For instance, in one embodiment the sole member 13000 does not cover the damping cavity 17000.

As illustrated in FIG. 76, the damping cavity 17000 had a DC length 17010 and a DC width 17020. The DC length 17010 is measured parallel to the club head Y-axis, and the DC width 17020 is measured parallel to the club head X-axis. As with all disclosed lengths and widths of any components, the DC length 17010 and the DC width 17020 need not be constant and may vary. Thus, there may be a minimum DC length 17010 and a maximum DC length 17010, where the maximum DC length 17010 is not equal to the minimum DC length 17010. In constant DC length 17010 embodiments the maximum DC length 17010 is equal to the minimum DC length 17010, and therefore reference to maximum or minimum DC length 17010 does not infer that the DC length 17010 varies. Similarly, there may be a minimum DC width 17020 and a maximum DC width 17020, where the maximum DC width 17020 is not equal to the minimum DC width 17020. In constant DC width 17020 embodiments the maximum DC width 17020 is equal to the minimum DC width 17020, and therefore reference to maximum or minimum DC width 17020 does not infer that the DC width 17020 varies.

The minimum DC length 17010 is at least 2 mm in one embodiment, and at least 3, 4, 5, or 6 mm in further embodiments. The maximum DC length 17010 is no more than 25 mm in an embodiment, and is not more than 22.5, 20, 17.5, or 15 mm in additional embodiments. Further, the minimum DC width 17020 is at least 10 mm in one embodiment, and at least 15, 20, 25, or 30 mm in additional embodiments. The maximum DC width 17020 is no more than 120 mm in one embodiment, and no more than 110, 105, 100, 95, 90, or 85 mm in further embodiments.

In one embodiment the maximum DC length 17010 is less than the minimum DC width 17020, while in a further embodiment the maximum DC length 10570 is at least 10% less than the minimum DC width 17020, and at least 20%, 30%, 40%, or 50% less in additional embodiments. In one embodiment the maximum DC length 17010 is less than the Zup, while in another embodiment the maximum DC width 17020 is greater than the Zup, and at least 20%, 40%, 60%, 80%, 100%, 120%, 140%, 160%, or 180% greater than the Zup in additional embodiments. In another embodiment the minimum DC width 17020 is at least 10% greater than the frame height 10006, and at least 20%, 30%, or 40% in further embodiments. The maximum DC length 17010 less than the frame height 10006, and at least 10%, 20%, 30%, or 40% less in further embodiments. The disclosed variations in the DC length 17010, the DC width 17020, and relationships with other attributes of the club head influence damping cavity volume as well as the vibrational modes, frequency, and/or amplitude and may produce preferred sound and feel of the club head.

In one embodiment the damping cavity volume is no more than 50% of the primary cavity volume, and no more than 45%, 40%, 35%, 30%, or 25% in additional embodiments.

In fact, the damping cavity volume is at least 1000 mm^3 in one embodiment, and at least 1500, 2000, 2500, 3000, 3500, 4000, or 4500 mm^3 in additional embodiments. The damping cavity volume is no more than 13500 mm^3 in another embodiment, and no more than 12500, 12000, 11500, 11000, 10500, 10000, 9500, 9000, 8500, 8000, 7500, 7000, 6500, 6000, or 5500 mm^3 in further embodiments. The damping cavity 17000 need not be void of material, in fact later disclosure will illustrate this via the damper 18000, and/or other fill material.

The frame 10000 may include at least one frame through opening 10900, seen in FIG. 71A. The through opening 10900 has a through opening volume by extending a 1 mm thick imaginary top surface across the through opening 10900 so that the imaginary top surface is flush with the adjacent frame top 10300, and therefore indistinguishable, and by extending a 1 mm thick imaginary bottom surface across the through opening 10900 so that the imaginary bottom surface is flush with the adjacent frame bottom 10400, and therefore indistinguishable. The through opening volume may then be easily determined. The one or more through openings 10900 each have a through opening volume that is at least 10% of the primary cavity volume, and at least 20%, or 30% in further embodiments. Further, the one or more through openings 10900 each have a through opening volume that is no more than at least 90% of the primary cavity volume, and no more than 80%, 70%, 60%, or 50% in additional embodiments. A further embodiment includes at least two through openings 10900, and the sum of the through opening volumes is at least 50% of the primary cavity volume, which in additional embodiments is at least 60%, 70%, or 80%.

Figure 96:
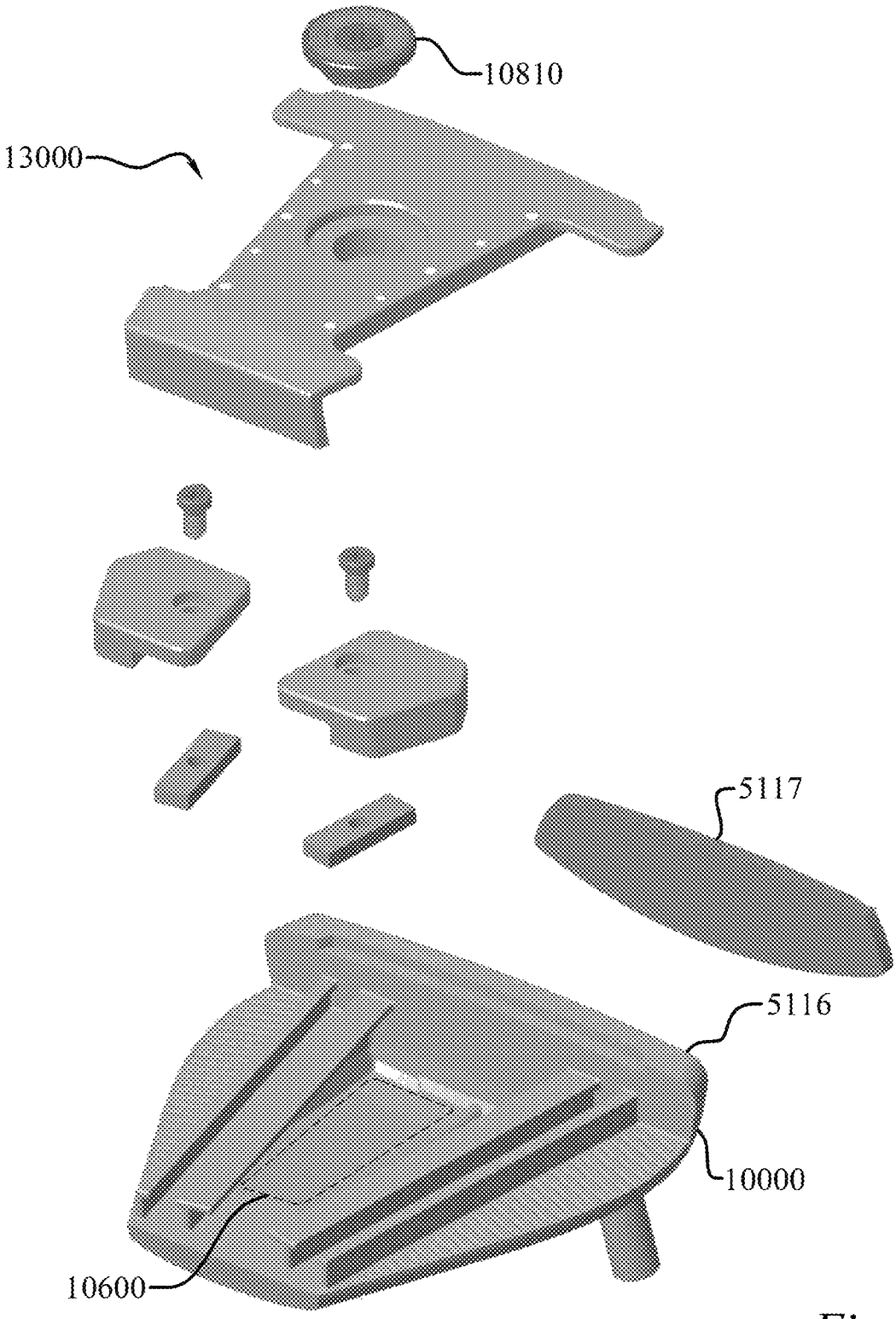
FIG. 96 is a schematic, exploded bottom perspective view of a golf club head, according to one or more examples of the present disclosure.
Figure 100:
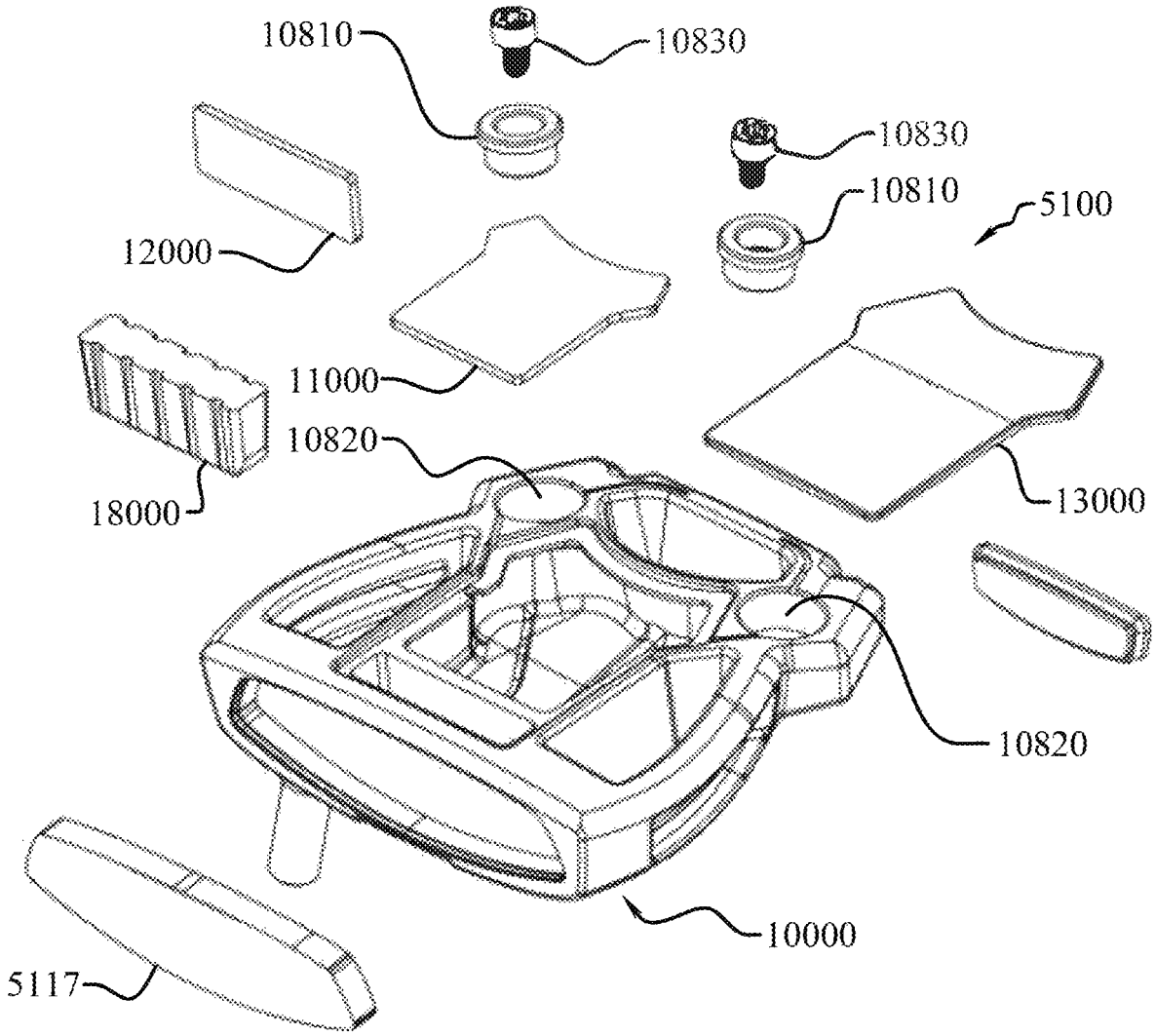
FIG. 100 is a schematic, exploded bottom perspective view of a golf club head, according to one or more examples of the present disclosure.
Figure 101:
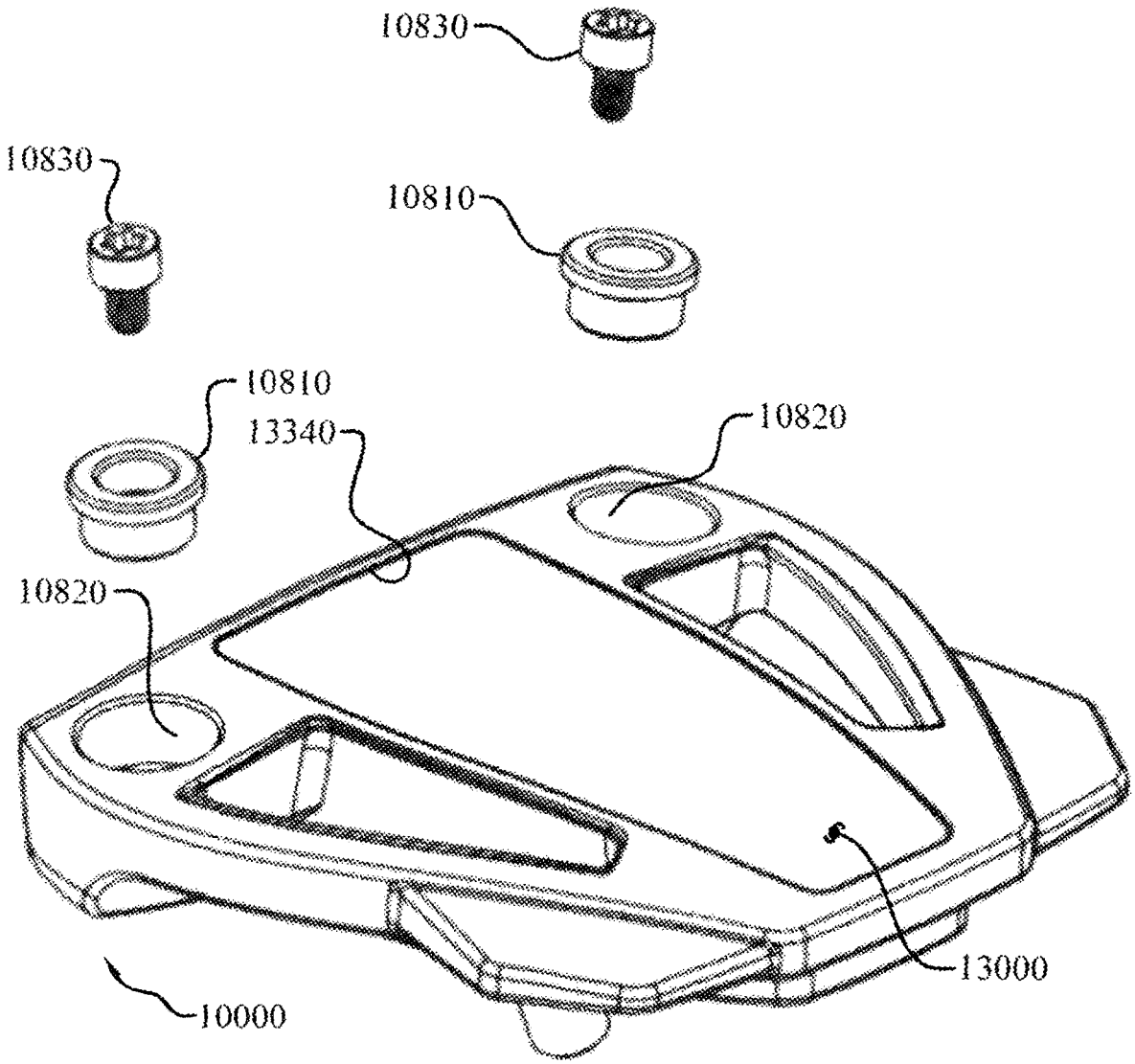
FIG. 101 is a schematic, partial exploded bottom perspective view of a golf club head, according to one or more examples of the present disclosure.
Figure 102:
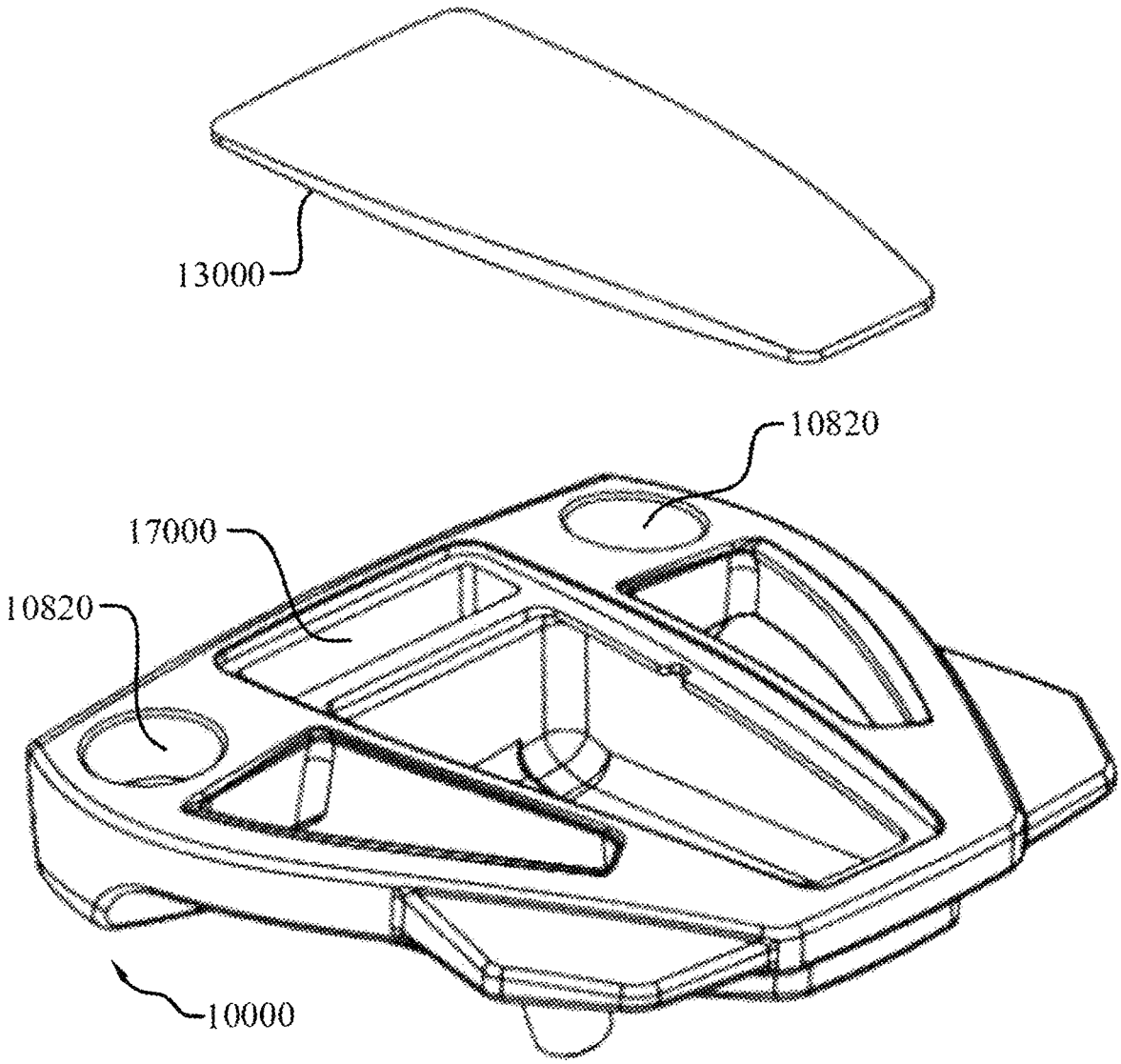
FIG. 102 is a schematic, partial exploded bottom perspective view of a golf club head, according to one or more examples of the present disclosure.

The frame 10000 may include at least one frame mass extension 10800, seen in FIGS. 71A and 97. The illustrated embodiment includes a toe frame mass extension 10800 and a heel frame mass extension, both of which are located rearward of the club head CG in one embodiment. A weight member 10810 may be attached, permanently or releasably, to the frame mass extension 10800 in another embodiment. Further, the frame mass extension 10800 may further include a weight port 10820 to receive at least a portion of the weight member 10810. The weight port 10820 may define a weight port central axis, which in one embodiment extends through the frame front 10100 with the weight member 10810 entering the weight port 10820 from the frame rear 10200, while in another embodiment the weight port central axis extents through the frame top 10300 with the weight member 10810 entering the weight port 10820 from the frame bottom 10400, while in still another embodiment the weight port central axis extents through the frame bottom 10400 with the weight member 10810 entering the weight port 10820 from the frame top 10300. The frame 10000 may include one or more weight ports 10820 and/or weight members 10810 located elsewhere on the frame 10000, such as in between the club head CG and the frame front 10100, as seen in FIG. 101, or between the club head CG and the frame rear 10200, as seen in FIG. 100, and the weight member 10810 may attach to the frame 10000 from the top of the bottom. Further, in other embodiments the weight member 10810 may attach to the sole member 13000, as seen in FIGS. 88, 96, and 97, and likewise with any of the disclosed locations relative to the club head CG. Each weight member 10810 has a weight member center of gravity, or CGwm, and in one embodiment an imaginary line connects the CGwm of a toe side weight member 10810 to the CGwm of a heel side weight member 10810, and a weight connecting vertical plane that is parallel to the club head Z-axis, and also containing the imaginary line, passes through a portion of the damper 18000, as is the case in FIGS. 101-102, a portion of the primary cavity 10500, a portion of the sole member 13000, a portion of the crown damping member 11000, and/or a portion of the thin wall crown region 10600. In another embodiment the weight connecting vertical plane is located behind the primary cavity 10500, as seen in FIG. 100, and/or the sole member 13000. In another embodiment the weight connecting vertical plane is located in front of the primary cavity 10500, as seen in FIGS. 101-102, and/or the sole member 13000.

Figure 106:
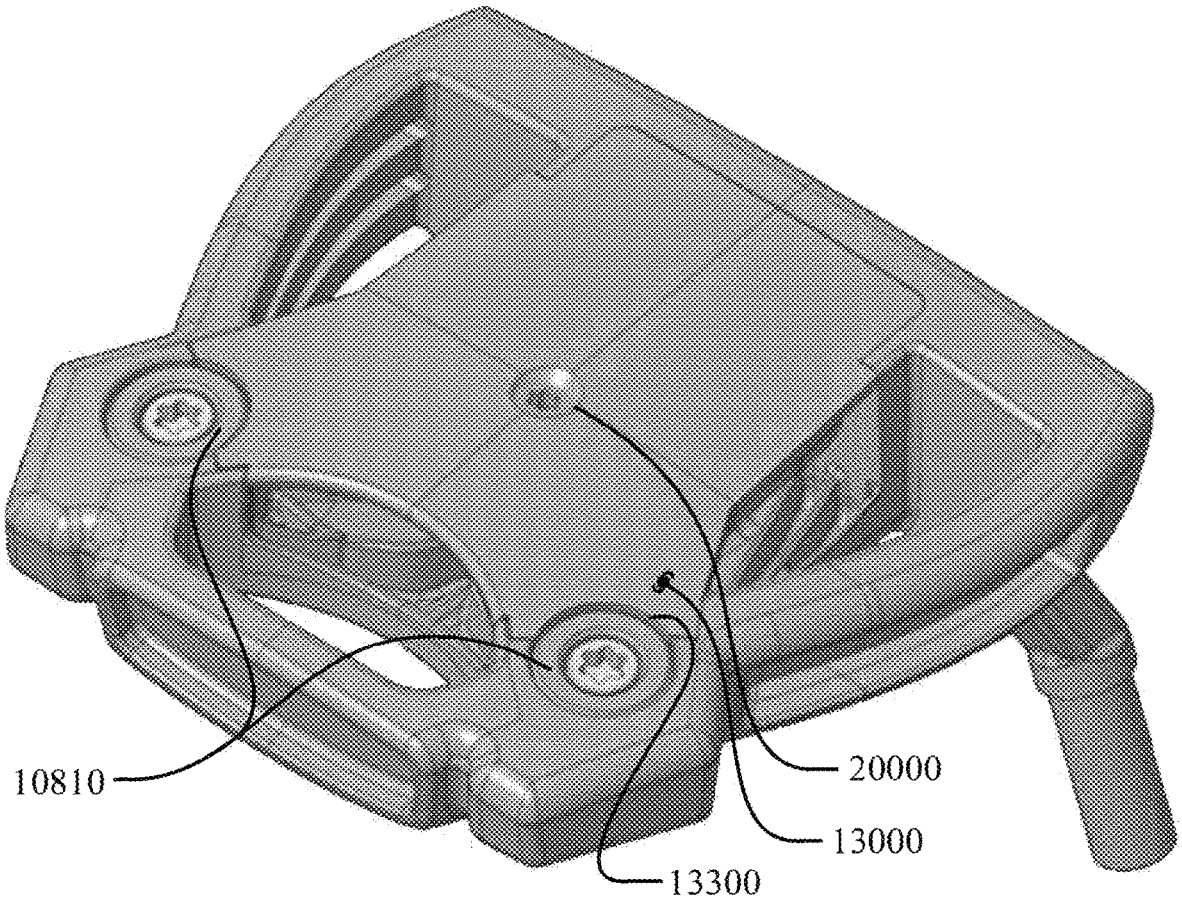
FIG. 106 is a schematic, bottom perspective view of a golf club head, according to one or more examples of the present disclosure.
Figure 107:
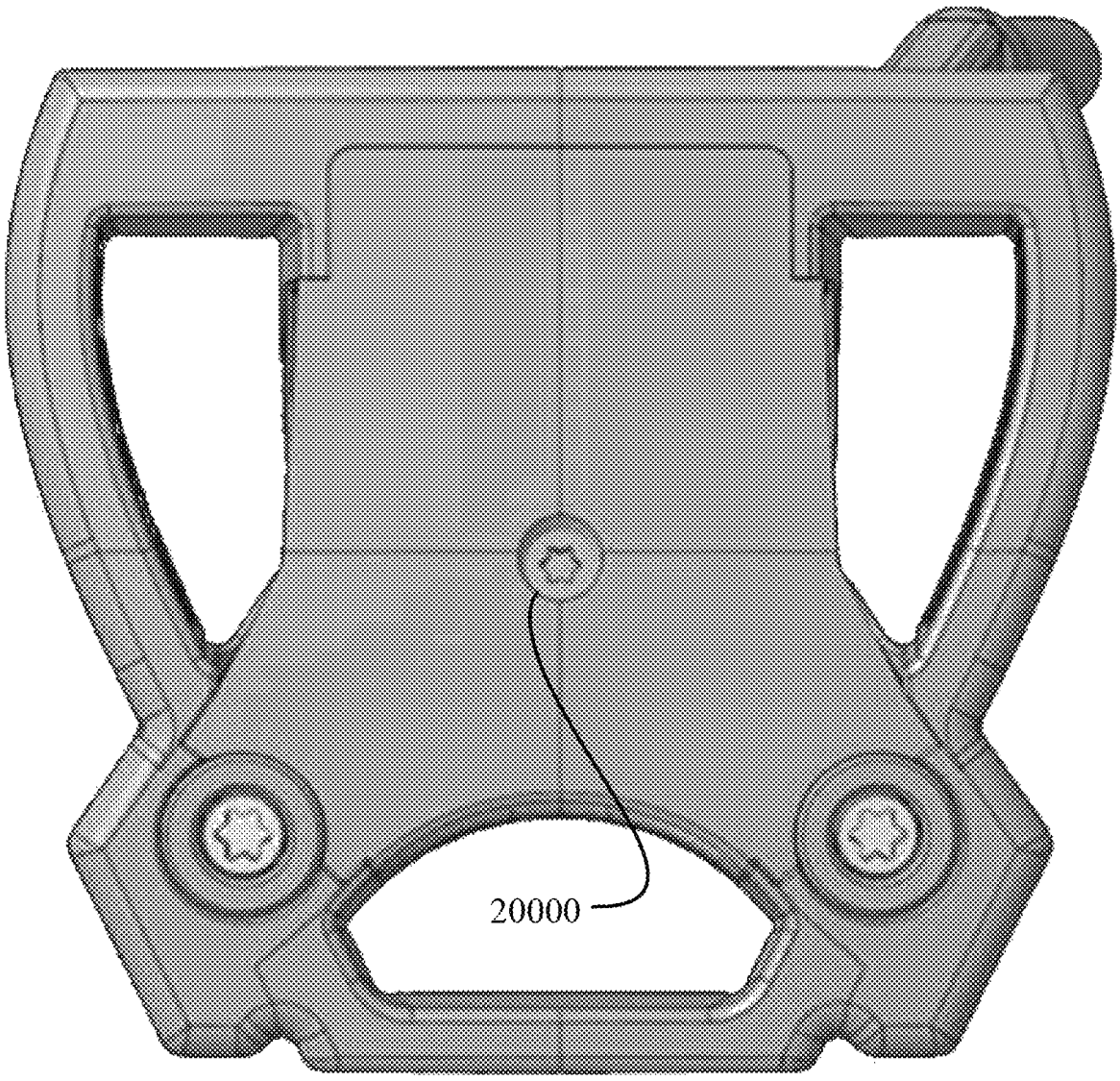
FIG. 107 is a schematic, bottom plan view of a golf club head, according to one or more examples of the present disclosure.
Figure 108:
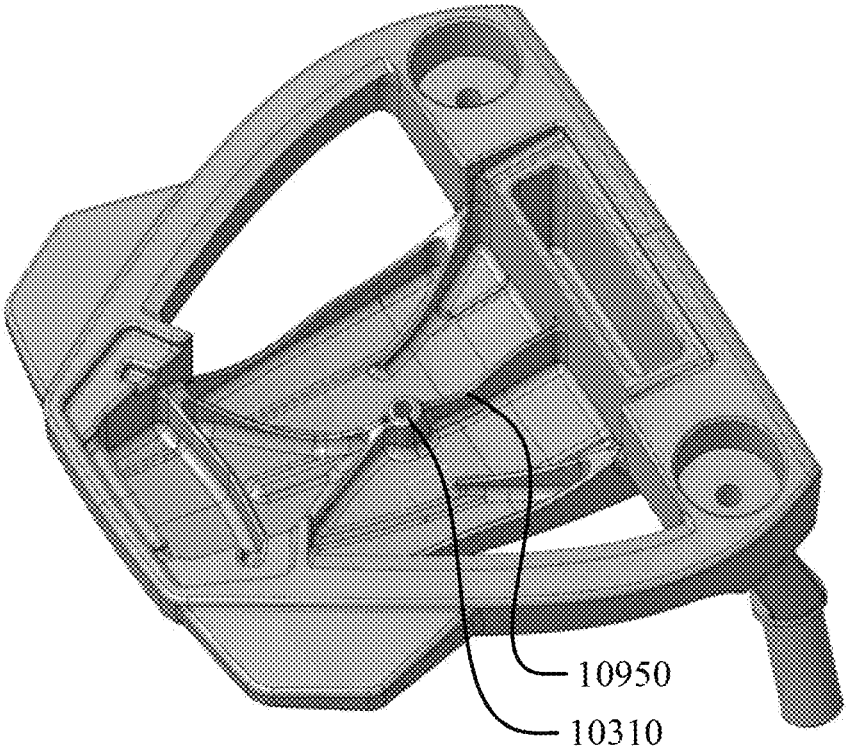
FIG. 108 is a schematic, partial bottom perspective view of a golf club head, according to one or more examples of the present disclosure.

Further, the sole member 13000 may include one or more weight ports 10820 and/or weight members 10810, including between the club head CG and the frame front 10100 or between the club head CG and the frame rear 10200, as seen in FIGS. 88, 96, and 97. The weight member 10810 is at least 2 grams in one embodiment, and at least 4, 6, 8, or 10 grams in further embodiments. In a further embodiment the weight member 10810 is no more than 25 grams, and no more than 22.5, 20, 17.5, 15, or 12.5 grams in additional embodiments. As seen in FIG. 106, in one embodiment the sole member 13000 is adjacent a perimeter of the weight member 10810, and/or weight port 10820, such that the SM perimeter 13300 includes a semicircular region having a radius of curvature that is within 15% of a radius of curvature of the weight member 10810.

The golf club head may further include a crown damping member 11000, abbreviated CDM, attached to at least a portion of the thin wall crown region 10600, seen in FIGS. 70, 73 and 82-85. The crown damping member 11000 has a CDM length 11010, a CDM width 11020, a CDM thickness 11030, a CDM front 11100, a CDM rear 11200, and a CDM perimeter 11300. In some embodiments the CDM perimeter 11300 includes a CDM toe perimeter edge 11310, a CDM heel perimeter edge 11320, a CDM aft perimeter edge 11330, and/or a CDM forward perimeter edge 11340. The crown damping member 11000 also has a crown damping member volume, a crown damping member density, and a crown damping member mass.

The CDM length 11010 is measured parallel to the club head Y-axis, and the CDM width 11020 is measured parallel to the club head X-axis. As with all disclosed lengths and widths of any components, the CDM length 11010 and the CDM width 11020 need not be constant and may vary. Thus, there may be a minimum CDM length 11010 and a maximum CDM length 11010, where the maximum CDM length 11010 is not equal to the minimum CDM length 11010. In constant CDM length 11010 embodiments the maximum CDM length 11010 is equal to the minimum CDM length 11010, and therefore reference to maximum or minimum CDM length 11010 does not infer that the CDM length 11010 varies. Similarly, there may be a minimum CDM width 11020 and a maximum CDM width 11020, where the maximum CDM width 11020 is not equal to the minimum CDM width 11020. In constant CDM width 11020 embodiments the maximum CDM width 11020 is equal to the minimum CDM width 11020, and therefore reference to maximum or minimum CDM width 11020 does not infer that the CDM width 11020 varies.

The minimum CDM length 11010 is at least 50% of the frame height 10006 in one embodiment, and at least 60%, 70%, 80%, 90%, 100%, 110%, 120%, or 130% in additional embodiments. In another embodiment the minimum CDM length 11010 is at least 30% of the club head CGy dimension, and at least 40%, 50%, 60%, 70%, 80%, 90%, or 100% in additional embodiments. The maximum CDM length 11010 is no more than 4 times the frame height 10006 in one embodiment, and no more than 3.75, 3.5, 3.25, 3.0, or 2.75 times the frame height in additional embodiments. Further, maximum CDM length 11010 is no more than 225% of the club head CGy dimension in one embodiment, and no more than 200%, 175%, 150%, or 125% in additional embodiments. Additionally, in one embodiment the crown damping member 11000 completely covers the thin wall crown region 10600, while in another embodiment the club head CG Z-axis passes through the crown damping member 11000, while in yet a further embodiment the entire crown damping member 11000 is located at an elevation above the club head CG.

The minimum CDM width 11020 is at least 50% of the frame height 10006 in one embodiment, and at least 60%, 70%, 80%, 90%, 100%, 110%, 120%, or 130% in additional embodiments. In another embodiment the minimum CDM width 11020 is at least 30% of the club head CGy dimension, and at least 40%, 50%, 60%, 70%, 80%, 90%, or 100% in additional embodiments. The maximum CDM width 11020 is no more than 4 times the frame height 10006 in one embodiment, and no more than 3.75, 3.5, 3.25, 3.0, or 2.75 times the frame height in additional embodiments. Further, maximum CDM width 11020 is no more than 225% of the club head CGy dimension in one embodiment, and no more than 200%, 175%, 150%, or 125% in additional embodiments.

The minimum CDM length 11010 is at least 10 mm in one embodiment, and at least 15, 20, 25, 30, 35, or 40 mm in further embodiments. The maximum CDM length 11010 is no more than 120 mm in an embodiment, and is not more than 110, 105, 100, 95, 90, 85, 80, 75, 70, 65, 60, or 55 mm in additional embodiments. Further, the minimum CDM width 11020 is at least 10 mm in one embodiment, and at least 15, 20, 25, or 30 mm in additional embodiments. The maximum CDM width 11020 is no more than 120 mm in one embodiment, and no more than 110, 105, 100, 95, 90, or 85 mm in further embodiments.

In one embodiment the maximum CDM length 11010 is greater than the minimum CDM width 11020, while in a further embodiment the maximum CDM length 11010 is at least 10% greater than the minimum CDM width 11020, and at least 20%, 30%, 40%, or 50% in additional embodiments. In one embodiment the maximum CDM width 11020 is greater than the minimum CDM length 11010, while in a further embodiment the maximum CDM width 11020 is at least 10% greater than the minimum CDM length 11010, and at least 20%, 30%, 40%, or 50% in additional embodiments.

The maximum CDM length 11010 is within 35% of the minimum CDM length 11010 in one embodiment, and within 30%, 25%, 20%, or 15% in additional embodiments. While in another embodiment the maximum CDM width 11020 is at least 10% greater than the minimum CDM width 11020, and at least 15%, 20%, 25%, 30%, or 35% greater in further embodiments. The maximum CDM width 11020 is no more than 120% greater than the minimum CDM width 11020 in one embodiment, and no more than 110%, 100%, 90%, or 80% greater in additional embodiments. In one embodiment the difference between the maximum CDM length 11010 and the minimum CDM length 11010 is no more than 200% of the Zup of the club head, and in further embodiments no more than 180%, 160%, 140%, or 120%. In another embodiment the difference between the maximum CDM width 11020 and the minimum CDM width 11020 is greater than the Zup of the club head, and in further embodiments at least 10%, 20%, 30%, 40%, 50%, 60%, or 70% greater. The difference between the maximum CDM width 11020 and the minimum CDM width 11020 is no more than 5 times Zup of the club head in one embodiment, and no more than 4.5, 4.0, or 3.5 times in additional embodiments. In another embodiment the minimum CDM width 11020 is at least 10% greater than the frame height 10006, and at least 20%, 30%, or 40% in further embodiments. The minimum CDM length 11010 is at least 20% greater than the frame height 10006, and at least 25%, 30%, 35%, 40%, 45%, 50%, or 55% in further embodiments.

The surface area on the exterior of the frame top 10300 that lies within the CDM perimeter 11300 is a CDM area, which in one embodiment is at least 400 mm^2, which may be the sum of the areas associated with multiple individual crown damping members 11000, as seen in FIG. 99, or is the area associated with a single crown damping member 11000. In a further embodiment the CDM area is at least 500 mm^2, and is at least 600 mm^2, 650 mm^2, 700 mm^2, 750 mm^2, 800 mm^2, 850 mm^2, or 900 mm^2 in additional embodiments. In another series of embodiments the CDM area is no more than 8000 mm^2, 7000 mm^2, 6000 mm^2, 5000 mm^2, 4000 mm^2, 3500 mm^2, 3000 mm^2, 2500 mm^2, 2000 mm^2, 1750 mm^2, 1500 mm^2, or 1250 mm^2. In one embodiment the CDM area is at least 50% of the TWCR area, and at least 60%, 70%, 80%, 90%, 100%, or 110% in additional embodiments.

Figure 73:
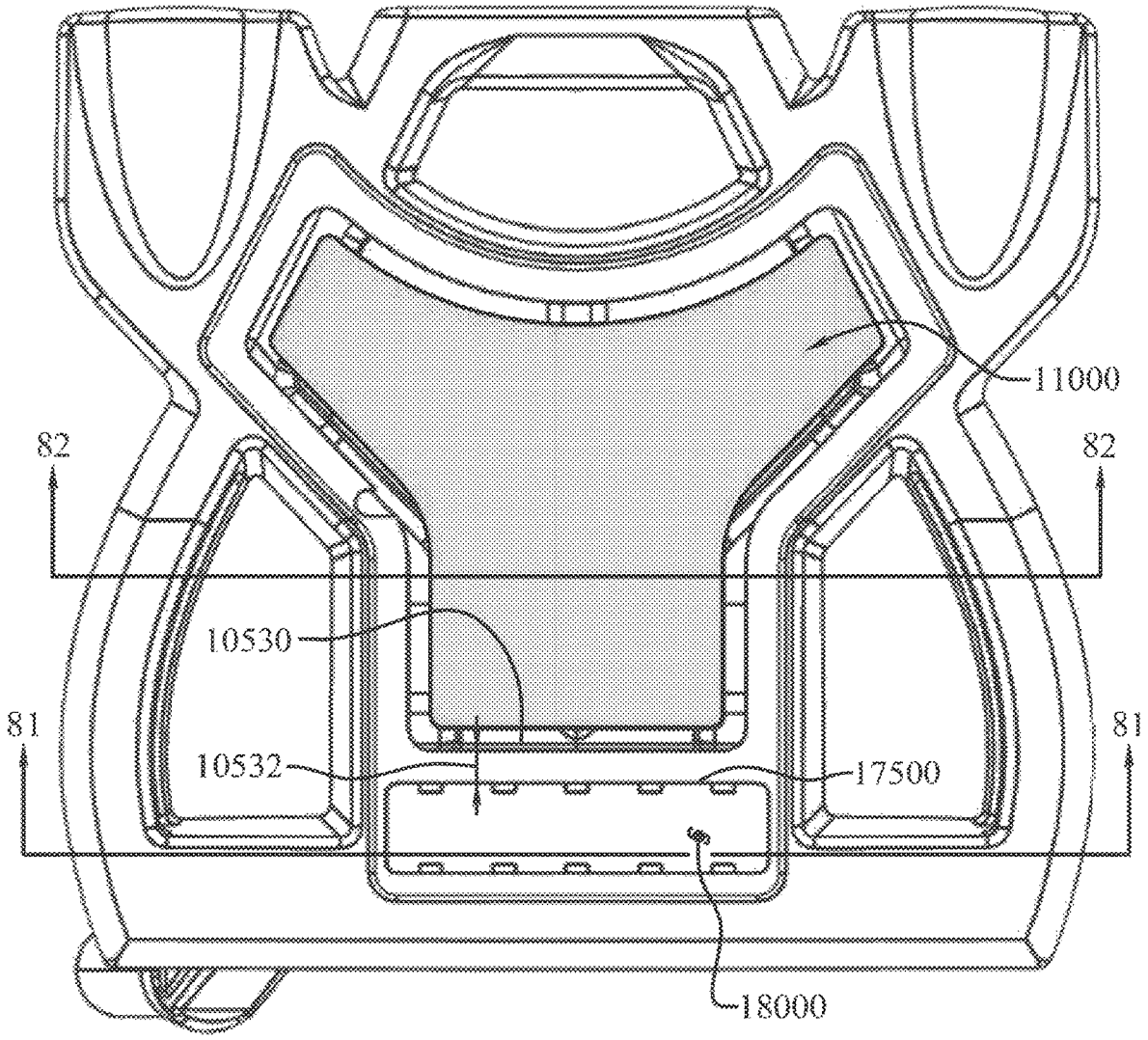
FIG. 73 is a schematic, partial bottom plan view of a golf club head, according to one or more examples of the present disclosure.

As easily appreciated with reference to FIGS. 73, and 82-83, the CDM perimeter 11300 is located a CDM perimeter offset from any adjacent sidewalls. Thus, the shortest distance from any point on the CDM perimeter 11300 to the nearest adjacent sidewall is the CDM perimeter offset for that particular point. In one embodiment at least 50% of the CDM perimeter 11300 has CDM perimeter offset distances that are less than ($\alpha$×Zup), while in additional embodiments at least 60%, 70%, 80%, 90%, or 100% of the CDM perimeter 11300 has CDM perimeter offset distances that are less than Zup. In one embodiment the value of a is 1.5, while in additional embodiments the constant $\alpha$ is 1.4, 1.3, 1.2, 1.1, 1.0, 0.9, 0.8, 0.7, or 0.5. In another embodiment the CDM perimeter offset distances vary by less than $\beta$% throughout at least 50%, of the CDM perimeter 11300, and throughout 60%, 70%, 80%, 90%, or 100% in additional embodiments. In one embodiment the value of β is 50, and in further embodiments is 40, 30, 20, or 10.

The CDM thickness 11030 need not be constant and may vary. Thus, the CDM thickness 11030 may have a minimum CDM thickness 11030 and a maximum CDM thickness 11030, where the maximum CDM thickness 11030 is not equal to the minimum CDM thickness 11030. In constant CDM thickness 11030 embodiments the maximum CDM thickness 11030 is equal to the minimum CDM thickness 11030, and therefore reference to maximum or minimum CDM thickness 11030 does not infer that the CDM thickness 11030 varies.

In one embodiment the minimum CDM thickness 11030 is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum CDM thickness 11030 is at least 10% greater than the minimum TWCR thickness 10610, and at least 15%, 20%, 25%, or 30% greater in additional embodiments. In another embodiment the minimum CDM thickness 11030 is no more than 400% greater than the minimum TWCR thickness 10610, and no more than 375%, 350%, 325%, 300%, 275%, 250%, 225%, 200%, or 175% greater in additional embodiments.

In one embodiment the minimum CDM thickness 11030 is at least 95% of the maximum TWCR thickness 10610, and at least 100%, 105%, 110%, 115%, 120%, or 130% of the maximum TWCR thickness 10610 in additional embodiments. In another embodiment the minimum CDM thickness 11030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the maximum CDM thickness 11030 is at least 10% greater than the minimum TWCR thickness 10610, and at least 15%, 20%, 25%, or 30% greater in additional embodiments. In another embodiment the maximum CDM thickness 11030 is no more than 400% greater than the minimum TWCR thickness 10610, and no more than 375%, 350%, 325%, 300%, 275%, 250%, 225%, 200%, or 175% greater in additional embodiments.

In one embodiment the maximum CDM thickness 11030 is at least 95% of the maximum TWCR thickness 10610, and at least 100%, 105%, 110%, 115%, 120%, or 130% of the maximum TWCR thickness 10610 in additional embodiments. In another embodiment the maximum CDM thickness 11030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment an average CDM thickness 11030 is at least 10% greater than the minimum TWCR thickness 10610, and at least 15%, 20%, 25%, or 30% greater in additional embodiments. In another embodiment the average CDM thickness 11030 is no more than 400% greater than the minimum TWCR thickness 10610, and no more than 375%, 350%, 325%, 300%, 275%, 250%, 225%, 200%, or 175% greater in additional embodiments.

In one embodiment the average CDM thickness 11030 is at least 95% of the maximum TWCR thickness 10610, and at least 100%, 105%, 110%, 115%, 120%, or 130% of the maximum TWCR thickness 10610 in additional embodiments. In another embodiment the average CDM thickness 11030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the average CDM thickness 11030 is at least 1.1 mm, and at least 1.2, 1.3, 1.4, 1.5, or 1.6 mm in additional embodiments. In a further embodiment the average CDM thickness 11030 is no more than 4 mm, and no more than 3.75, 3.5, 3.25, 3.0, 2.75, 2.5, 2.25, 2.0, or 1.75 mm in additional embodiments. In one embodiment the maximum CDM thickness 11030 is at least 1.1 mm, and at least 1.2, 1.3, 1.4, 1.5, or 1.6 mm in additional embodiments. In a further embodiment the maximum CDM thickness 11030 is no more than 4 mm, and no more than 3.75, 3.5, 3.25, 3.0, 2.75, 2.5, 2.25, 2.0, or 1.75 mm in additional embodiments. In one embodiment the minimum CDM thickness 11030 is at least 1.1 mm, and at least 1.2, 1.3, 1.4, 1.5, or 1.6 mm in additional embodiments. In a further embodiment the minimum CDM thickness 11030 is no more than 4 mm, and no more than 3.75, 3.5, 3.25, 3.0, 2.75, 2.5, 2.25, 2.0, or 1.75 mm in additional embodiments.

In one embodiment the crown damping member density, or CDM density, is no more than 25% of the frame density, and the CDM density is at least 45% of the sole member density, and the crown damping member mass, or CDM mass, is less than 7 grams. In another embodiment the crown damping member density, or CDM density, is no more than 45% of the frame density, and the CDM density is at least 45% of the sole member density, and the CDM mass is less than 6 grams. In another embodiment the crown damping member density, or CDM density, is no more than 75% of the frame density, and the CDM density is at least 45% of the sole member density, and the CDM mass is less than 5 grams.

The CDM density is no more than 2 g/cc in an embodiment, and no more than 1.8, 1.6, or 1.5 g/cc in additional embodiments. The CDM density is at least 1 g/cc in an embodiment, and is at least 1.1, 1.2, or 1.3 g/cc in further embodiments. The CDM mass is no more than 6 grams in an embodiment, and no more than 5.5, 5.0, 4.5, 4.0, 3.5, 3.0, or 2.5 grams in additional embodiments. The CDM volume is less than 20% of the primary cavity volume, and less than 17.5%, 15%, or 12.5% in additional embodiments.

The location, size, and construction of the crown damping member 11000, along with the disclosure relationships with other club head attributes, significantly influences the performance of the golf club head, and therefore in one embodiment the crown damping member 11000 is located a CDM offset dimension behind the origin 5128, measured parallel to the club head Y-axis; meaning no portion of the crown damping member 11000 is located less than the CDM dimension from the origin 5128. In one embodiment the CDM offset dimension is at least 50% of Zup, and at least 60%, 70%, 80%, 90%, 100%, or 110% in further embodiments. Yet, locating the crown damping member 11000 too far from the origin 5128 may also negatively impact performance. Therefore, in an embodiment at least a portion of the crown damping member 11000 is located within a CDM setback distance behind the origin 5128, measured parallel to the club head Y-axis. In one embodiment the CDM setback distance is equal to the club head CGy dimension, while in further embodiments the CDM setback distance is 90%, 80%, 70%, or 60% of the club head CGy dimension.

The golf club head may further include a sidewall damping member 12000, abbreviated SDM, attached to a portion of the frame 10000, and in some embodiments attached to at least a portion of the PC internal forward wall 10530 or a rear surface of the frame front 10100, seen in FIGS. 75 and 83-85. The sidewall damping member 12000 has a SDM height 12010, a SDM width 12020, a SDM thickness 12030, a SDM front 12100, a SDM rear 12200, and a SDM perimeter 12300. In some embodiments the SDM perimeter 12300 includes a SDM toe perimeter edge 12310, a SDM heel perimeter edge 12320, a SDM bottom perimeter edge 12330, and/or a SDM top perimeter edge 12340. The sidewall damping member 12000 also has a sidewall damping member volume, a sidewall damping member density, and a sidewall damping member mass.

The SDM height 12010 is measured parallel to the club head Z-axis, and the SDM width 12020 is measured parallel to the club head X-axis. As with all disclosed heights, lengths, widths, and thicknesses of any components, the SDM height 12010 and the SDM width 12020 need not be constant and may vary. Thus, there may be a minimum SDM height 12010 and a maximum SDM height 12010, where the maximum SDM height 12010 is not equal to the minimum SDM height 12010. In constant SDM height 12010 embodiments the maximum SDM height 12010 is equal to the minimum SDM height 12010, and therefore reference to maximum or minimum SDM height 12010 does not infer that the SDM height 12010 varies. Similarly, there may be a minimum SDM width 12020 and a maximum SDM width 12020, where the maximum SDM width 12020 is not equal to the minimum SDM width 12020. In constant SDM width 12020 embodiments the maximum SDM width 12020 is equal to the minimum SDM width 12020, and therefore reference to maximum or minimum SDM width 12020 does not infer that the SDM width 12020 varies.

The minimum SDM height 12010 is at least 25% of the frame height 10006 in one embodiment, and at least 30%, 35%, 40%, 45%, 50%, or 55% in additional embodiments. In another embodiment the minimum SDM height 12010 is at least 50% of the club head Zup dimension, and at least 60%, 70%, 80%, 90%, or 100% in additional embodiments. The maximum SDM height 12010 is no more than 95% of the frame height 10006 in one embodiment, and no more than 90%, 85%, 80%, or 75% in additional embodiments. Further, maximum SDM height 12010 is no more than 125% greater than the club head Zup dimension in one embodiment, and no more than 115%, 105%, 95%, or 85% greater than the club head Zup in additional embodiments. Additionally, in one embodiment the club head CG Y-axis passes through the sidewall damping member 12000, while in yet a further embodiment a portion of the sidewall damping member 12000 is located at an elevation above the club head CG and a portion of the sidewall damping member 12000 is located at an elevation below the club head CG, while in still another embodiment majority of the sidewall damping member 12000 is located at an elevation above the club head CG.

The minimum SDM width 12020 is at least 50% of the frame height 10006 in one embodiment, and at least 60%, 70%, 80%, 90%, 100%, 110%, 120%, or 130% in additional embodiments. In another embodiment the minimum SDM width 12020 is at least 30% of the club head CGy dimension, and at least 40%, 50%, 60%, 70%, 80%, 90%, or 100% in additional embodiments. The maximum SDM width 12020 is no more than 4 times the frame height 10006 in one embodiment, and no more than 3.75, 3.5, 3.25, 3.0, or 2.75 times the frame height in additional embodiments. Further, maximum SDM width 12020 is no more than 225% of the club head CGy dimension in one embodiment, and no more than 200%, 175%, 150%, or 125% in additional embodiments. The maximum SDM width 12020 is at least 5% greater than the maximum SDM height 12010 in one embodiment, and at least 15%, 30%, 45%, 60%, 75%, 90%, 105%, 120%, 150%, or 180% greater in additional embodiments. The maximum SDM width 12020 is no more than 6 times the maximum SDM height 12010 in one embodiment, and no more than 5.5, 5.0, 4.5, 4.0, 3.5, or 3.0 times greater in additional embodiments.

The minimum SDM height 12010 is at least 5 mm in one embodiment, and at least 6, 7, 8, 9, 10, or 11 mm in further embodiments. The maximum SDM height 12010 is no more than 22 mm in an embodiment, and is not more than 20, 18, 16, or 14 mm in additional embodiments. Further, the minimum SDM width 12020 is at least 10 mm in one embodiment, and at least 15, 20, 25, or 30 mm in additional embodiments. The maximum SDM width 12020 is no more than 120 mm in one embodiment, and no more than 110, 105, 100, 95, 90, 85, 80, 75, 70, 65, 60, 55, 50, 45, or 40 mm in further embodiments.

The surface area on the PC internal forward wall 10530 or a rear surface of the frame front 10100 that lies within the SDM perimeter 12300 is a SDM area, which in one embodiment is at least 250 mm^2, which may be the sum of the areas associated with multiple individual sidewall damping member 12000 or is the area associated with a single sidewall damping member 12000. In a further embodiment the SDM area is at least 275 mm^2, and is at least 300 mm^2, 325 mm^2, 350 mm^2, or 375 mm^2 in additional embodiments. In another series of embodiments the SDM area is no more than 3000 mm^2, 2750 mm^2, 2500 mm^2, 2250 mm^2, 2000 mm^2, 1750 mm^2, 1500 mm^2, or 1250 mm^2. In one embodiment the SDM area is at least 20% of the TWCR area, and at least 25%, 30%, 35%, 40%, 45%, or 50% in additional embodiments. In one embodiment the SDM area is at least 20% of the CDM area, and at least 25%, 30%, 35%, 40%, 45%, or 50% in additional embodiments.

The SDM thickness 12030 need not be constant and may vary. Thus, the SDM thickness 12030 may have a minimum SDM thickness 12030 and a maximum SDM thickness 12030, where the maximum SDM thickness 12030 is not equal to the minimum SDM thickness 12030. In constant SDM thickness 12030 embodiments the maximum SDM thickness 12030 is equal to the minimum SDM thickness 12030, and therefore reference to maximum or minimum SDM thickness 12030 does not infer that the SDM thickness 12030 varies.

In one embodiment the minimum SDM thickness 12030 is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum SDM thickness 12030 is at least 10% greater than the minimum TWCR thickness 10610, and at least 15%, 20%, 25%, or 30% greater in additional embodiments. In another embodiment the minimum SDM thickness 12030 is no more than 400% greater than the minimum TWCR thickness 10610, and no more than 375%, 350%, 325%, 300%, 275%, 250%, 225%, 200%, or 175% greater in additional embodiments.

In one embodiment the minimum SDM thickness 12030 is at least 95% of the maximum TWCR thickness 10610, and at least 100%, 105%, 110%, 115%, 120%, or 130% of the maximum TWCR thickness 10610 in additional embodiments. In another embodiment the minimum SDM thickness 12030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the maximum SDM thickness 12030 is at least 10% greater than the minimum TWCR thickness 10610, and at least 15%, 20%, 25%, or 30% greater in additional embodiments. In another embodiment the maximum SDM thickness 12030 is no more than 400% greater than the minimum TWCR thickness 10610, and no more than 375%, 350%, 325%, 300%, 275%, 250%, 225%, 200%, or 175% greater in additional embodiments.

In one embodiment the maximum SDM thickness 12030 is at least 95% of the maximum TWCR thickness 10610, and at least 100%, 105%, 110%, 115%, 120%, or 130% of the maximum TWCR thickness 10610 in additional embodiments. In another embodiment the maximum SDM thickness 12030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment an average SDM thickness 12030 is at least 10% greater than the minimum TWCR thickness 10610, and at least 15%, 20%, 25%, or 30% greater in additional embodiments. In another embodiment the average SDM thickness 12030 is no more than 400% greater than the minimum TWCR thickness 10610, and no more than 375%, 350%, 325%, 300%, 275%, 250%, 225%, 200%, or 175% greater in additional embodiments.

In one embodiment the average SDM thickness 12030 is at least 95% of the maximum TWCR thickness 10610, and at least 100%, 105%, 110%, 115%, 120%, or 130% of the maximum TWCR thickness 10610 in additional embodiments. In another embodiment the average SDM thickness 12030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the average SDM thickness 12030 is at least 1.1 mm, and at least 1.2, 1.3, 1.4, 1.5, or 1.6 mm in additional embodiments. In a further embodiment the average SDM thickness 12030 is no more than 4 mm, and no more than 3.75, 3.5, 3.25, 3.0, 2.75, 2.5, 2.25, 2.0, or 1.75 mm in additional embodiments. In one embodiment the maximum SDM thickness 12030 is at least 1.1 mm, and at least 1.2, 1.3, 1.4, 1.5, or 1.6 mm in additional embodiments. In a further embodiment the maximum SDM thickness 12030 is no more than 4 mm, and no more than 3.75, 3.5, 3.25, 3.0, 2.75, 2.5, 2.25, 2.0, or 1.75 mm in additional embodiments. In one embodiment the minimum SDM thickness 12030 is at least 1.1 mm, and at least 1.2, 1.3, 1.4, 1.5, or 1.6 mm in additional embodiments. In a further embodiment the minimum SDM thickness 12030 is no more than 4 mm, and no more than 3.75, 3.5, 3.25, 3.0, 2.75, 2.5, 2.25, 2.0, or 1.75 mm in additional embodiments.

In one embodiment the sidewall damping member density, or SDM density, is no more than 25% of the frame density, and the SDM density is at least 45% of the sole member density, and the sidewall damping member mass, or SDM mass, is less than 7 grams. In another embodiment the sidewall damping member density, or SDM density, is no more than 45% of the frame density, and the SDM density is at least 45% of the sole member density, and the SDM mass is less than 6 grams. In another embodiment the sidewall damping member density, or SDM density, is no more than 75% of the frame density, and the SDM density is at least 45% of the sole member density, and the SDM mass is less than 5 grams.

The SDM density is no more than 2 g/cc in an embodiment, and no more than 1.8, 1.6, or 1.5 g/cc in additional embodiments. The SDM density is at least 1 g/cc in an embodiment, and is at least 1.1, 1.2, or 1.3 g/cc in further embodiments. The SDM mass is no more than 3 grams in an embodiment, and no more than 2.5, 2.0, 1.5, or 1.0 grams in additional embodiments. The SDM volume is less than 12.5% of the primary cavity volume, and less than 10%, 7.5%, or 5% in additional embodiments. The SDM volume is less than CDM volume, and in additional embodiments the SDM volume is at least 10%, 15%, 20%, 25%, or 30% less than CDM volume.

Figure 84:
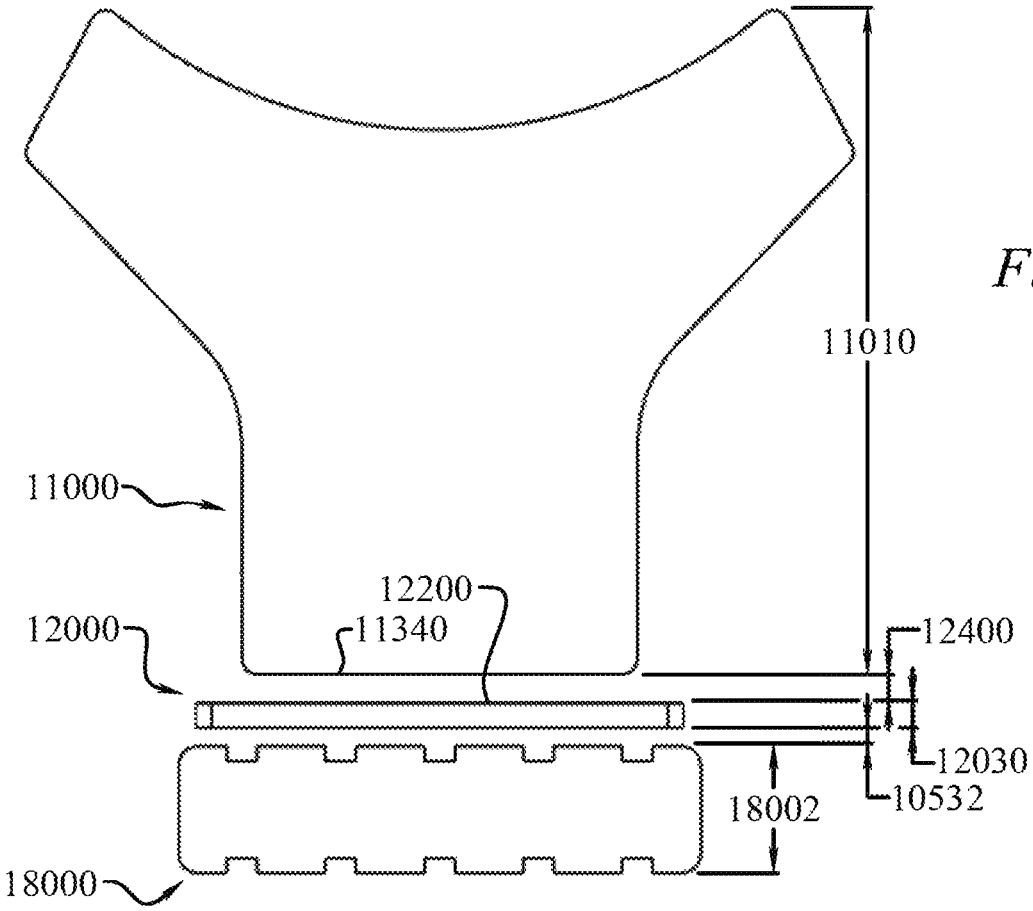
FIG. 84 is a schematic, top plan view of elements of a golf club head, according to one or more examples of the present disclosure.
Figure 85:
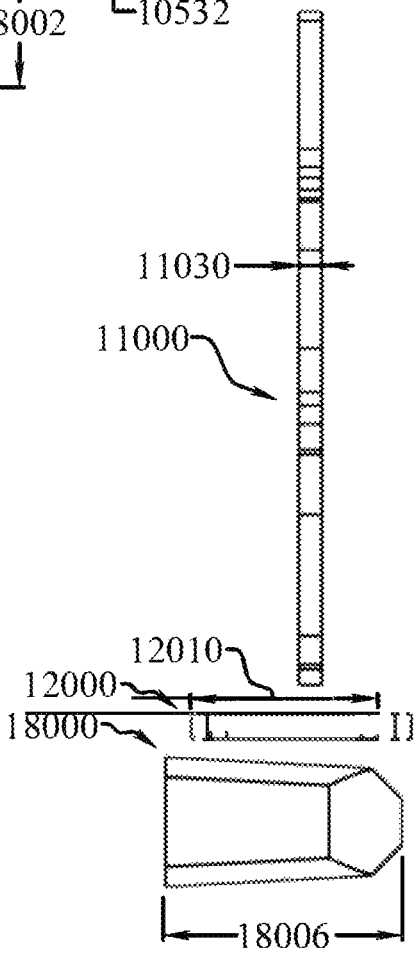
FIG. 85 is a schematic, side elevation view of elements of a golf club head, according to one or more examples of the present disclosure.

The location, size, and construction of the sidewall damping member 12000, along with its relationships with other club head components and attributes, also significantly influences the performance of the golf club head, and therefore in one embodiment the sidewall damping member 12000 is located a SDM offset dimension behind the origin 5128, measured parallel to the club head Y-axis; meaning no portion of the sidewall damping member 12000 is located less than the SDM dimension from the origin 5128. In one embodiment the SDM offset dimension is at least 30% of Zup, and at least 40%, 50%, 60%, 70%, 80%, 90%, 100%, or 110% in further embodiments. Yet, locating the sidewall damping member 12000 too far from the origin 5128 may also negatively impact performance. Therefore, in an embodiment at least a portion of the sidewall damping member 12000 is located within a SDM setback distance behind the origin 5128, measured parallel to the club head Y-axis. In one embodiment the SDM setback distance is equal to 75% of the club head CGy dimension, while in further embodiments the SDM setback distance is 70%, 65%, 60%, or 55% of the club head CGy dimension. FIG. 84 illustrates a damping member separation distance 12400 which is a smallest distance between the CDM forward perimeter edge 11340 and the sidewall damping member 12000, which in one embodiment is less than the Zup dimension, and in further embodiments is no more than 75%, 50%, or 25% of the Zup dimension. In another embodiment the damping member separation distance 12400 is no more than 4 times the SDM thickness 12030, and no more than 3.5, 3.0, 2.5, or 2 times the SDM thickness 12030 in additional embodiments.

In one embodiment the sidewall damping member 12000 is substantially planar. The club head origin X-axis and Z-axis define a vertical X-Z plane, and the substantially planar sidewall damping member orientation may be described with respect to conventional yaw (rotation about the Z-axis) and pitch (rotation about the X-axis). Thus, in one embodiment a SDM yaw of the substantially planar sidewall damping member is no more than ±20 degrees from the vertical X-Z plane, and in additional embodiments no more than ±17.5, ±15, ±12.5, ±10, ±7.5, ±5, or ±2.5 degrees. In another embodiment a SDM pitch of the substantially planar sidewall damping member is no more than ±20 degrees from the vertical X-Z plane, and in additional embodiments no more than ±17.5, ±15, ±12.5, ±10, ±7.5, ±5, or ±2.5 degrees.

In one embodiment the crown damping member 11000 is substantially planar. The club head origin X-axis and Y-axis define a horizontal X-Y plane, and the substantially planar crown damping member orientation may be described with respect to conventional roll (rotation about the Y-axis) and pitch (rotation about the X-axis). Thus, in one embodiment a CDM roll of the substantially planar crown damping member is no more than ±20 degrees from the horizontal X-Y plane, and in additional embodiments no more than ±17.5, ±15, ±12.5, ±10, ±7.5, ±5, or ±2.5 degrees. In another embodiment a CDM pitch of the substantially planar crown damping member is no more than ±20 degrees from the horizontal X-Y plane, and in additional embodiments no more than ±17.5, ±15, ±12.5, ±10, ±7.5, ±5, or ±2.5 degrees.

Figure 70:
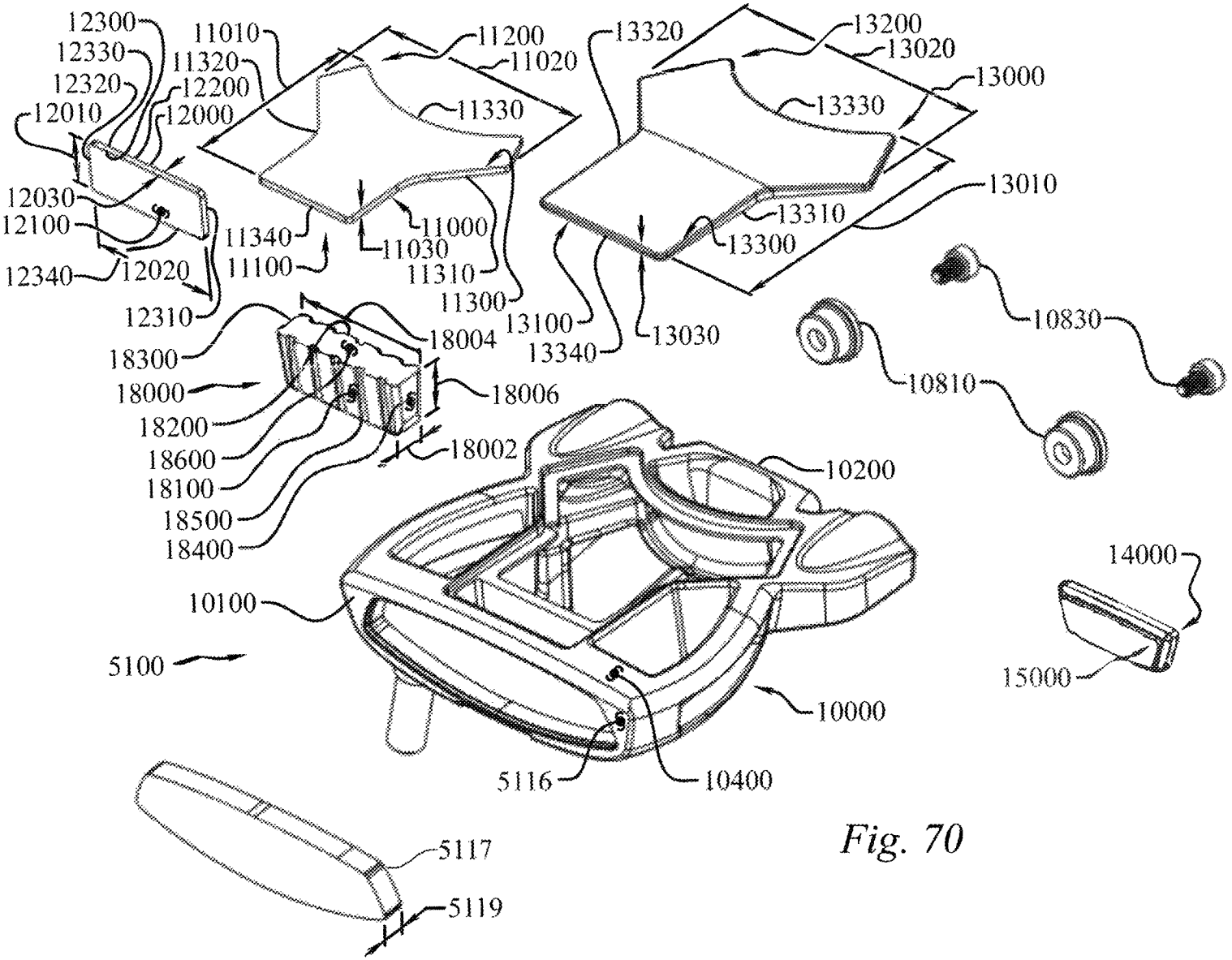
FIG. 70 is a schematic, exploded perspective view of a golf club head, according to one or more examples of the present disclosure.

The golf club head may further include a damper 18000 located within the damping cavity 17000, seen in FIGS. 70, 81, and 83. The damper 18000 has a damper height 18006, a damper width 18004, a damper length 18002, a damper forward wall 18100, a damper rear wall 18200, a damper heel wall 18300, a damper toe wall 18400, a damper top wall 18500, and a damper bottom wall 18600. The damper 18000 also has a damper volume, a damper density, and a damper mass.

The damper height 18006 is measured parallel to the club head Z-axis, the damper width 18004 is measured parallel to the club head X-axis, and the damper length 18002 is measured parallel to the club head Y-axis. As with all disclosed heights, lengths, widths, and thicknesses of any components, the damper height 18006, the damper width 18004, and/or the damper length 18002 need not be constant and may vary; and all disclosed examples with respect to minimum and maximum values apply equally to each, whether or not repeated for each. Thus, there may be a minimum damper height 18006 and a maximum damper height 18006, where the maximum damper height 18006 is not equal to the minimum damper height 18006. In constant damper height 18006 embodiments the maximum damper height 18006 is equal to the minimum damper height 18006, and therefore reference to maximum or minimum damper height 18006 does not infer that the damper height 18006 varies. Similarly, there may be a minimum damper width 18004 and a maximum damper width 18004, where the maximum damper width 18004 is not equal to the minimum damper width 18004. In constant damper width 18004 embodiments the maximum damper width 18004 is equal to the minimum damper width 18004, and therefore reference to maximum or minimum damper width 18004 does not infer that the damper width 18004 varies.

The minimum damper height 18006 is at least 25% of the frame height 10006 in one embodiment, and at least 30%, 35%, 40%, 45%, 50%, 55%, 60%, 65%, or 75% in additional embodiments. In another embodiment the minimum damper height 18006 is at least 65% of the club head Zup dimension, and at least 75%, 85%, 95%, 105%, or 115% in additional embodiments. The maximum damper height 18006 is no more than 95% of the frame height 10006 in one embodiment, and no more than 90% or 85% in additional embodiments. Further, maximum damper height 18006 is no more than 125% greater than the club head Zup dimension in one embodiment, and no more than 115%, 105%, 95%, or 85% greater than the club head Zup in additional embodiments. Additionally, in one embodiment the club head CG Y-axis passes through the damper 18000, while in yet a further embodiment a portion of the damper 18000 is located at an elevation above the club head CG and a portion of the damper 18000 is located at an elevation below the club head CG, while in still another embodiment majority of the damper 18000 is located at an elevation above the club head CG.

The minimum damper width 18004 is at least 50% of the frame height 10006 in one embodiment, and at least 60%, 70%, 80%, 90%, 100%, 110%, 120%, or 130% in additional embodiments. In another embodiment the minimum damper width 18004 is at least 30% of the club head CGy dimension, and at least 40%, 50%, 60%, 70%, 80%, 90%, or 100% in additional embodiments. The maximum damper width 18004 is no more than 6 times the frame height 10006 in one embodiment, and no more than 5.75, 5.5, 5.25, 5.0, 4.75, 4.5, 4.25, 4.0, 3.75, 3.5, 3.25, 3.0, or 2.75 times the frame height in additional embodiments. Further, maximum damper width 18004 is no more than 225% of the club head CGy dimension in one embodiment, and no more than 200%, 175%, 150%, or 125% in additional embodiments. The maximum damper width 18004 is at least 5% greater than the maximum damper height 18006 in one embodiment, and at least 15%, 30%, 45%, 60%, or 75% greater in additional embodiments. The maximum damper width 18004 is no more than 6 times the maximum damper height 18006 in one embodiment, and no more than 5.5, 5.0, 4.5, 4.0, 3.5, or 3.0 times greater in additional embodiments. The minimum damper length 18002 is at least 10% of the frame height 10006 in one embodiment, and at least 15%, 20%, or 25% in additional embodiments. In another embodiment the minimum damper length 18002 is at least 20% of the club head Zup dimension, and at least 25%, 30%, 35%, or 40% in additional embodiments. The maximum damper length 18002 is no more than 105% of the frame height 10006 in one embodiment, and no more than 95%, 85%, 75%, or 65% in additional embodiments. Further, maximum damper length 18002 is no more than 175% of the club head Zup dimension in one embodiment, and no more than 150%, 125%, 100%, or 75% of the club head Zup in additional embodiments.

The minimum damper height 18006 is at least 8 mm in one embodiment, and at least 9, 10, 11, 12, 13, or 14 mm in further embodiments. The maximum damper height 18006 is no more than 22 mm in an embodiment, and is not more than 21, 20, 19, 18, 17, or 16 mm in additional embodiments. Further, the minimum damper width 18004 is at least 10 mm in one embodiment, and at least 15, 20, 25, or 30 mm in additional embodiments. The maximum damper width 18004 is no more than 120 mm in one embodiment, and no more than 110, 105, 100, 95, 90, 85, 80, 75, 70, 65, 60, 55, 50, 45, or 40 mm in further embodiments. Additionally, the maximum damper length 18002 is at least 3 mm in one embodiment, and at least 4, 5, 6, or 7 mm in additional embodiments. The maximum damper length 18002 is no more than 20 mm in one embodiment, and no more than 18, 16, 14, 12, or 10 mm in further embodiments.

The damper length 18002 need not be constant and may vary. Thus, the damper length 18002 may have a minimum damper length 18002 and a maximum damper length 18002, where the maximum damper length 18002 is not equal to the minimum damper length 18002. In constant damper length 18002 embodiments the maximum damper length 18002 is equal to the minimum damper length 18002, and therefore reference to maximum or minimum damper length 18002 does not infer that the damper length 18002 varies.

In one embodiment the maximum damper length 18002 is greater than at least one of: the forward wall thickness 10532 or the face insert thickness 5119; while in a further embodiment the maximum damper length 18002 is greater than both the forward wall thickness 10532 and the face insert thickness 5119. In another embodiment the minimum damper length 18002 is greater than at least one of: the forward wall thickness 10532 or the face insert thickness 5119; while in a further embodiment the minimum damper length 18002 is greater than both the forward wall thickness 10532 and the face insert thickness 5119. In still another embodiment the average damper length 18002 is greater than at least one of: the forward wall thickness 10532 or the face insert thickness 5119; while in a further embodiment the average damper length 18002 is greater than both the forward wall thickness 10532 and the face insert thickness 5119.

In one embodiment the minimum damper length 18002 is at least 200% greater than the minimum TWCR thickness 10610, and at least 225%, 250%, 275%, or 300% greater in additional embodiments. In another embodiment the minimum damper length 18002 is no more than 1200% greater than the minimum TWCR thickness 10610, and no more than 1150%, 1100%, 1050%, 1000%, or 950% greater in additional embodiments.

In one embodiment the damper density is no more than 25% of the frame density, and the damper density is at least 45% of the sole member density, and the damper mass is less than 8 grams. In another embodiment the damper density is no more than 45% of the frame density, and the damper density is at least 45% of the sole member density, and the damper mass is less than 6 grams. In another embodiment the damper density is no more than 75% of the frame density, and the damper density is at least 45% of the sole member density, and the damper mass is less than 4 grams.

The damper density is no more than 2 g/cc in an embodiment, and no more than 1.8, 1.6, or 1.5 g/cc in additional embodiments. The damper density is at least 0.4 g/cc in an embodiment, and is at least 0.5, 0.6, 0.7, 0.8, 0.9, 1.0, 1.1, 1.2, or 1.3 g/cc in further embodiments. The damper mass is no more than 8 grams in an embodiment, and no more than 7, 6, 5, or 4 grams in additional embodiments. The damper volume is less than 50% of the primary cavity volume, and less than 45%, 40%, 35%, 30%, or 25% in additional embodiments. The damper volume is less than sole member volume in an embodiment.

In one embodiment the damper 18000 is formed of a damper material having a damper density of less than 2 g/cc, and in further embodiments less than 1.8 g/cc, 1.6 g/cc, 1.4 g/cc, 1.2 g/cc, 1 g/cc, 0.8 g/cc, 0.6 g/cc, or 0.4 g/cc. The damper 18000 may be formed of any of the filler materials or damper materials disclosed in U.S. patent application Ser. No. 18/506,843, filed Nov. 10, 2023, which is incorporated by reference herein in its entirety. A variety of materials and manufacturing processes may be used in providing the damper 18000. In one or more embodiments, the damper 18000 is a combination of Santoprene and Hybrar. For example, using different ratios of Santoprene to Hybrar, the durometer of the damper 18000 may be manipulated to provide for different damping characteristics, such as interference, dampening, and stiffening properties. In one embodiment, a ratio of about 85% Santoprene to about 15% Hybrar is used. In another embodiment, a ratio of at least about 80% Santoprene to about 10% Hybrar is used. In another embodiment the damper 18000 is at least 60% Santoprene, and no more than 25% Hybrar.

Examples of materials that may be suitable for use as a damper 18000 include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP-105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, the damper 18000 may have a modulus of elasticity ranging from about 0.001 GPa to about 25 GPa, and a durometer ranging from about 5 to about 95 on a Shore D scale. In other examples, gels or liquids can be used, and softer materials which are better characterized on a Shore A or other scale can be used. The Shore D hardness on a polymer is measured in accordance with the ASTM (American Society for Testing and Materials) test D2240.

In some embodiments, the damper 18000 may have a hardness of about 10 to about 70 shore A hardness. In certain embodiments, a shore A hardness of about 40 or less is preferred. In certain embodiments, a shore D hardness of up to about 40 or less is preferred. In some embodiments the damper 18000 may have a hardness range of about 15-85 Shore OO hardness or about 80 Shore OO hardness or less.

In some embodiments, the PC fill 10590 may have a density of at least 0.03 g/cc, and at least 0.06, 0.09, or 0.12 g/cc in additional embodiments. The PC fill density is no more than 0.25 g/cc in one embodiment, and no more than 0.22 or 0.19 g/cc in further embodiments.

In one or more embodiments, the damper 18000 may be provided with different durometers across a length, width, and/or height of the damper 18000. For example, the damper 18000 may be co-molded using different materials with different durometers, masses, densities, colors, and/or other material properties. In one embodiment, the damper 18000 may be provided with a softer durometer adjacent to the ideal striking location of the strike face than adjacent to the heel and toe portions. In another embodiment, the damper 18000 may be provided with a harder durometer adjacent to the ideal striking location of the strike face than adjacent to the heel and toe portions. In these examples, the different material properties used to co-mold the damper 18000 may provide for better performance and appearance.

Additional and different damper materials and manufacturing processes can be used in one or more embodiments. For example, additional damper 18000 and/or PC fill 10590 materials and manufacturing processes are described in U.S. Pat. Nos. 10,427,018, 9,937,395, 9,044,653, 8,920,261, and 8,088,025, which are incorporated by reference herein in their entireties. For example, the damper 18000 may be manufactured at least in part of rubber, silicone, elastomer, another relatively low modulus material, metal, another material, or any combination thereof. For example, a foam, hot melt, epoxy, adhesive, liquified thermoplastic, or another material can be injected into the club head filling or partially filling the damping cavity 17000. In some embodiments, the filler material is heated past melting point and injected into the club head.

In some embodiments, a filler material is used to secure the damper 18000 in place during installation, such as using hot melt, epoxy, adhesive, or another filler material. In some embodiments, a filler material can be injected into the damping cavity 17000 to make minor changes to the weight of the club head, such as to adjust the club head for proper swing weight, to account for manufacturing variances between club heads, and to achieved a desired weight of each head. In some embodiments, the damper 18000 and/or PC fill 10590 is a two-part polyurethane foam that is a thermoset and is flexible after it is cured. In one embodiment, the two-part polyurethane foam is any methylene diphenyl diisocyanate (a class of polyurethane prepolymer) or silicone based flexible or rigid polyurethane foam. In some implementations, the damper 18000 is made from a non-metal, such as a thermoplastic material and/or a thermoset material.

The location, size, and construction of the damper 18000, along with the disclosed relationships with other club head components and attributes, also significantly influences the performance of the golf club head, and therefore in one embodiment the damper 18000 is located a damper offset dimension behind the origin 5128, measured parallel to the club head Y-axis; meaning no portion of the damper 18000 is located less than the damper offset dimension from the origin 5128. In one embodiment the damper offset dimension is at least 20% of Zup, and at least 30%, 40%, 50%, or 60% in further embodiments. Yet, locating the damper 18000 too far from the origin 5128 may also negatively impact performance. Therefore, in an embodiment at least a portion of the damper 18000 is located within a damper setback distance behind the origin 5128, measured parallel to the club head Y-axis. In one embodiment the damper setback distance is equal to 75% of the club head CGy dimension, while in further embodiments the damper setback distance is 70%, 65%, 60%, or 55% of the club head CGy dimension. In one embodiment the damper length 18002 is greater than the damping member separation distance 12400, seen in FIG. 84. In one embodiment the damper 18000 is sized so that it must be compressed to be positioned within the damping cavity 17000, and therefore is in a state of compression.

In an embodiment the damper 18000 and damping cavity 17000 may be sized to create a damper auxiliary space 19000, abbreviated DAS, below the damper 18000 and above the sole member 13000, as seen in FIG. 83. The damper auxiliary space 19000 has a DAS length 19002, a DAS width 19004, a DAS height 19006, and a DAS volume. All of the disclosure relating to the damper length 18002 applies equally to the DAS length 19002; and similarly all the disclosure relating to the damper width 18004 applies equally to the DAS width 19004. The DAS height 19006 is less than the damper height 18006, and in one embodiment the DAS height 19006 is no more than 50% of the damper height 18006, and in additional embodiments is no more than 40%, 30%, or 25%. In another embodiment the DAS volume is less than the damper volume, and in one embodiment the DAS volume is no more than 50% of the damper volume, and in additional embodiments is no more than 40%, 30%, or 25%. The DAS height 19006 is at least 10% of Zup, and in additional embodiments is at least 15%, 20%, or 25%. The DAS height 19006 is less than the DAS length 19002 in an embodiment. The DAS height 19006 is greater than the minimum SM thickness 13030. The damper auxiliary space 19000 is void of material in one embodiment, while in another embodiment it is filled with a DAS material having a DAS density. In one such embodiment the DAS material and DAS density are different than the damper material and damper density, while in another embodiment the DAS density is less than the damper density, while in a further embodiment the DAS density is greater than the damper density.

While the figures illustrate the crown damping member 11000 and the sidewall damping member 12000 as distinct and separate components, they may be one continuous member that wraps from the PC crown wall 10510 to the PC internal forward wall 10530 or a rear surface of the frame front 10100, as easily appreciated with reference to FIG. 83. Further, the sidewall damping member 12000 is illustrated and disclosed with respect to the PC internal forward wall 10530 or a rear surface of the frame front 10100, any of the frame sidewalls 10700 and/or PC internal sidewalls 10520 may also include a sidewall damping member 12000, and all of the disclosure associated with the sidewall damping member 12000 and the PC internal forward wall 10530 will not be repeated for each other sidewall for the sake of brevity, but applies equally to a sidewall damping member 120000 attached to any one or more of the following: the PC internal toe wall 10540, the PC internal heel wall 10550, the PC internal aft wall 10560, the frame toe sidewall 10710, the frame heel sidewall 10720, the frame aft sidewall 10730, or even the sole member 13000. Thus, an extreme embodiment would include an oversized crown damping member 11000 that is large enough to cover the entire PC crown wall 10510 and wrap down each PC internal sidewall 10520, thereby creating a sidewall damping member 12000 on each PC internal sidewall 10520, to completely line the primary cavity 10500, and may further include a sole damping member attached to the sole member 13000, where all, or any, of the disclosure related to the sidewall damping member 12000 applies equally to the sole damping member.

As seen best in FIGS. 70 and 72, the golf club head may further include a sole member 13000, abbreviated SM, attached to at least a portion of the frame 10000, which in some embodiments encloses the primary cavity 10500 and/or the damping cavity 17000. The sole member 13000 has a SM length 13010, a SM width 13020, a SM thickness 13030, a SM front 13100, a SM rear 13200, and a SM perimeter 13300. In some embodiments the SM perimeter 13300 includes a SM toe perimeter edge 13310, a SM heel perimeter edge 13320, a SM aft perimeter edge 13330, and/or a SM forward perimeter edge 13340. The sole member 13000 also has a sole member volume, a sole member density, and a sole member mass.

The SM length 13010 is measured parallel to the club head Y-axis, and the SM width 13020 is measured parallel to the club head X-axis. As with all disclosed lengths and widths of any components, the SM length 13010 and the SM width 13020 need not be constant and may vary. Thus, there may be a minimum SM length 13010 and a maximum SM length 13010, where the maximum SM length 13010 is not equal to the minimum SM length 13010. In constant SM length 13010 embodiments the maximum SM length 13010 is equal to the minimum SM length 13010, and therefore reference to maximum or minimum SM length 13010 does not infer that the SM length 13010 varies. Similarly, there may be a minimum SM width 13020 and a maximum SM width 13020, where the maximum SM width 13020 is not equal to the minimum SM width 13020. In constant SM width 13020 embodiments the maximum SM width 13020 is equal to the minimum SM width 13020, and therefore reference to maximum or minimum SM width 13020 does not infer that the SM width 13020 varies.

The minimum SM length 13010 is at least 50% of the frame height 10006 in one embodiment, and at least 60%, 70%, 80%, 90%, 100%, 110%, 120%, or 130% in additional embodiments. In another embodiment the minimum SM length 13010 is at least 30% of the club head CGy dimension, and at least 40%, 50%, 60%, 70%, 80%, 90%, or 100% in additional embodiments. The maximum SM length 13010 is no more than 4 times the frame height 10006 in one embodiment, and no more than 3.75, 3.5, 3.25, 3.0, or 2.75 times the frame height in additional embodiments. Further, maximum SM length 13010 is no more than 225% of the club head CGy dimension in one embodiment, and no more than 200%, 175%, 150%, or 125% in additional embodiments. Additionally, in one embodiment the sole member 13000 is larger than the thin wall crown region 10600 and a projection of the SM perimeter 13300 onto the frame top 10300 completely encircles the thin wall crown region 10600, while in another embodiment the club head CG Z-axis passes through the sole member 13000, while in yet a further embodiment the entire sole member 13000 is located at an elevation below the club head CG.

The minimum SM width 13020 is at least 50% of the frame height 10006 in one embodiment, and at least 60%, 70%, 80%, 90%, 100%, 110%, 120%, or 130% in additional embodiments. In another embodiment the minimum SM width 13020 is at least 30% of the club head CGy dimension, and at least 40%, 50%, 60%, 70%, 80%, 90%, or 100% in additional embodiments. The maximum SM width 13020 is no more than 4 times the frame height 10006 in one embodiment, and no more than 3.75, 3.5, 3.25, 3.0, or 2.75 times the frame height in additional embodiments. Further, maximum SM width 13020 is no more than 225% of the club head CGy dimension in one embodiment, and no more than 200%, 175%, 150%, or 125% in additional embodiments.

The minimum SM length 13010 is at least 10 mm in one embodiment, and at least 15, 20, 25, 30, 35, or 40 mm in further embodiments. The maximum SM length 13010 is no more than 120 mm in an embodiment, and is not more than 110, 105, 100, 95, 90, 85, 80, 75, 70, 65, 60, or 55 mm in additional embodiments. Further, the minimum SM width 13020 is at least 10 mm in one embodiment, and at least 15, 20, 25, or 30 mm in additional embodiments. The maximum SM width 13020 is no more than 120 mm in one embodiment, and no more than 110, 105, 100, 95, 90, or 85 mm in further embodiments.

In one embodiment the maximum SM length 13010 is greater than the minimum SM width 13020, while in a further embodiment the maximum SM length 13010 is at least 10% greater than the minimum SM width 13020, and at least 20%, 30%, 40%, or 50% in additional embodiments. In one embodiment the maximum SM width 13020 is greater than the minimum SM length 13010, while in a further embodiment the maximum SM width 13020 is at least 10% greater than the minimum SM length 13010, and at least 20%, 30%, 40%, or 50% in additional embodiments.

The maximum SM length 13010 is within 35% of the minimum SM length 13010 in one embodiment, and within 30%, 25%, 20%, or 15% in additional embodiments. While in another embodiment the maximum SM width 13020 is at least 10% greater than the minimum SM width 13020, and at least 15%, 20%, 25%, 30%, or 35% greater in further embodiments. The maximum SM width 13020 is no more than 120% greater than the minimum SM width 13020 in one embodiment, and no more than 110%, 100%, 90%, or 80% greater in additional embodiments. In one embodiment the difference between the maximum SM length 13010 and the minimum SM length 13010 is no more than 200% of the Zup of the club head, and in further embodiments no more than 180%, 160%, 140%, or 120%. In another embodiment the difference between the maximum SM width 13020 and the minimum SM width 13020 is greater than the Zup of the club head, and in further embodiments at least 10%, 20%, 30%, 40%, 50%, 60%, or 70% greater. The difference between the maximum SM width 13020 and the minimum SM width 13020 is no more than 5 times Zup of the club head in one embodiment, and no more than 4.5, 4.0, or 3.5 times in additional embodiments. In another embodiment the minimum SM width 13020 is at least 10% greater than the frame height 10006, and at least 20%, 30%, or 40% in further embodiments. The minimum SM length 13010 is at least 20% greater than the frame height 10006, and at least 25%, 30%, 35%, 40%, 45%, 50%, or 55% in further embodiments.

The externally exposed surface area that lies within the SM perimeter 13300 is a SM area, which in one embodiment is at least 400 mm^2, which may be the sum of the areas associated with multiple individual sole members 13000 or is the area associated with a single sole member 13000. In a further embodiment the SM area is at least 500 mm^2, and is at least 600 mm^2, 650 mm^2, 700 mm^2, 750 mm^2, 800 mm^2, 850 mm^2, or 900 mm^2 in additional embodiments. In another series of embodiments the SM area is no more than 8000 mm^2, 7000 mm^2, 6000 mm^2, 5000 mm^2, 4000 mm^2, 3500 mm^2, 3000 mm^2, 2500 mm^2, 2000 mm^2, 1750 mm^2, 1500 mm^2, or 1250 mm^2. In one embodiment the SM area is at least 50% of the TWCR area, and at least 60%, 70%, 80%, 90%, 100%, or 110% in additional embodiments.

As easily appreciated with reference to FIGS. 72-73, the SM perimeter 13300 is located a SM perimeter offset from any adjacent sidewalls. Thus, the shortest distance from any point on the SM perimeter 13300 to the nearest adjacent sidewall is the SM perimeter offset for that particular point. In one embodiment at least 50% of the SM perimeter 13300 has SM perimeter offset distances that are less than ($\gamma \times$Zup), while in additional embodiments at least 60%, 70%, 80%, 90%, or 100% of the SM perimeter 13300 has SM perimeter offset distances that are less than Zup. In one embodiment the value of $\gamma$ is 1.5, while in additional embodiments the value of $\gamma$ is 1.4, 1.3, 1.2, 1.1, 1.0, 0.9, 0.8, 0.7, or 0.5. In another embodiment the SM perimeter offset distances vary by less than $\delta$ % throughout at least 50%, of the SM perimeter 13300, and throughout 60%, 70%, 80%, 90%, or 100% in additional embodiments. In one embodiment the value of 8 is 50, and in further embodiments is 40, 30, 20, or 10.

The SM thickness 13030 need not be constant and may vary. Thus, the SM thickness 13030 may have a minimum SM thickness 13030 and a maximum SM thickness 13030, where the maximum SM thickness 13030 is not equal to the minimum SM thickness 13030. In constant SM thickness 13030 embodiments the maximum SM thickness 13030 is equal to the minimum SM thickness 13030, and therefore reference to maximum or minimum SM thickness 13030 does not infer that the SM thickness 13030 varies.

In one embodiment the minimum SM thickness 13030 is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum SM thickness 13030 is at least 60% of the minimum TWCR thickness 10610, and at least 70%, 80%, 90%, or 100% in additional embodiments. In another embodiment the minimum SM thickness 13030 is no more than 400% greater than the minimum TWCR thickness 10610, and no more than 375%, 350%, 325%, 300%, 275%, 250%, 225%, 200%, or 175% greater in additional embodiments.

In one embodiment the minimum SM thickness 13030 is at least 70% of the maximum TWCR thickness 10610, and at least 75%, 80%, 85%, or 90% of the maximum TWCR thickness 10610 in additional embodiments. In another embodiment the minimum SM thickness 13030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the maximum SM thickness 13030 is at least 10% greater than the minimum TWCR thickness 10610, and at least 15%, 20%, 25%, or 30% greater in additional embodiments. In another embodiment the maximum SM thickness 13030 is no more than 800% greater than the minimum TWCR thickness 10610, and no more than 775%, 750%, 725%, 700%, 675%, 650%, 625%, 600%, 575%, 550%, 525%, 500%, 475%, 450%, 425%, 400%, or 375% greater in additional embodiments.

In one embodiment the maximum SM thickness 13030 is at least 95% of the maximum TWCR thickness 10610, and at least 100%, 105%, 110%, 115%, 120%, or 130% of the maximum TWCR thickness 10610 in additional embodiments. In another embodiment the maximum SM thickness 13030 is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment an average SM thickness 13030 is at least 10% greater than the minimum TWCR thickness 10610, and at least 15%, 20%, 25%, or 30% greater in additional embodiments. In another embodiment the average SM thickness 13030 is no more than 800% greater than the minimum TWCR thickness 10610, and no more than 775%, 750%, 725%, 700%, 675%, 650%, 625%, 600%, 575%, 550%, 525%, 500%, 475%, 450%, 425%, 400%, or 375% greater in additional embodiments.

In one embodiment the average SM thickness 13030 is at least 95% of the maximum TWCR thickness 10610, and at least 100%, 105%, 110%, 115%, 120%, or 130% of the maximum TWCR thickness 10610 in additional embodiments. In another embodiment the average SM thickness 13030 is no more than 600% of the maximum TWCR thickness 10610, and no more than 575%, 550%, 525%, 500%, 475%, 450%, 425%, 400%, 375%, 350%, or 340% of the maximum TWCR thickness 10610 in additional embodiments.

In one embodiment the average SM thickness 13030 is at least 0.9 mm, and at least 1.0, 1.1, 1.2, 1.3, 1.4, 1.5, or 1.6 mm in additional embodiments. In a further embodiment the average SM thickness 13030 is no more than 6 mm, and no more than 5.75, 5.5, 5.25, 5.0, 4.75, 4.5, 4.25, 4.0, or 3.75 mm in additional embodiments. In one embodiment the maximum SM thickness 13030 is at least 1.4 mm, and at least 1.5, 1.6, 1.7, 1.8, or 1.9 mm in additional embodiments. In a further embodiment the maximum SM thickness 13030 is no more than 9 mm, and no more than 8.75, 8.5, 8.25, 8.0, 7.75, 7.5, 7.25, 7.0, or 6.75 mm in additional embodiments. In one embodiment the minimum SM thickness 13030 is at least 0.6 mm, and at least 0.7, 0.8, 0.9, 1.0, or 1.1 mm in additional embodiments. In a further embodiment the minimum SM thickness 11030 is no more than 5 mm, and no more than 4.75, 4.5, 4.25, 4.0, 3.75, 3.5, 3.25, or 3.0 mm in additional embodiments.

In one embodiment the sole member density, or SM density, is no more than 40% of the frame density, and the SM density is no more than 90% greater than the CDM density, and the sole member mass, or SM mass, is no more than 8% of the frame mass. In additional embodiments the SM mass is no more than 7.5%, 7.0%, 6.5%, or 6% of the frame mass; while in further embodiments the SM mass is at least 1% of the frame mass, and in additional embodiments at least 1.5%, 2.0%, 2.5%, or 3%. The SM mass less than 15 grams in one embodiment. In another embodiment the SM density is no more than 20% of the frame density, and the CDM mass is less than 9 grams. In another embodiment the SM density, is no more than 60% of the frame density, and the SM mass is less than 7 grams.

The SM density is different than the frame density, and no more than 2.9 g/cc in an embodiment, and no more than 2.0, 1.8, 1.6, or 1.5 g/cc in additional embodiments. The SM density is at least 1 g/cc in an embodiment, and is at least 1.1, 1.2, or 1.3 g/cc in further embodiments. The SM mass is no more than 25 grams in an embodiment, and no more than 22.5, 20, 17.5, 15, 12.5, 10, 7.5, or 5 grams in additional embodiments. The SM volume is less than 35% of the primary cavity volume, and less than 30%, 25%, 20%, or 15% in additional embodiments. The SM volume is less than 15 cc in one embodiment, and less than 12.5, 10, 7.5, or 5 cc in additional embodiments. The SM volume is at least 1 cc in one embodiment, and at least 2 or 3 cc in additional embodiments.

The location of the sole member 13000 also significantly influences the performance of the golf club head, and therefore in one embodiment the sole member 13000 is located a SM offset dimension behind the origin 5128, measured parallel to the club head Y-axis; meaning no portion of the sole member 13000 is located less than the SM dimension from the origin 5128. In one embodiment the SM offset dimension is at least 30% of Zup, and at least 40%, 50%, 60%, 70%, 80%, or 90% in further embodiments. Yet, locating the sole member 13000 too far from the origin 5128 may also negatively impact performance. Therefore, in an embodiment at least a portion of the sole member 13000 is located within a SM setback distance behind the origin 5128, measured parallel to the club head Y-axis. In one embodiment the SM setback distance is equal to the club head CGy dimension, while in further embodiments the CDM setback distance is 90%, 80%, 70%, or 60% of the club head CGy dimension.

The sole member 13000 may include a sole damping member SMDM, not illustrated but easily understood in light of the disclosure of the crown damping member 11000. In fact, all of the disclosure made with respect to the crown damping member 11000 applies equally to the sole damping member SMDM, but will not be repeated for the sake of brevity. However, to be explicit, the sole damping member may have a SMDM length, a SMDM width, and a SMDM thickness, all of which are analogous to the CDM length 11010, the CDM width 11020, and the CDM thickness 11030, and all the disclosure and relationships associated with the crown damping member 11000 apply to the sole damping member. Similarly, the sole damping member may have a SMDM front, a SMDM rear, and a SMDM perimeter, which may include a SMDM toe perimeter edge, a SMDM heel perimeter edge, a SMDM aft perimeter edge, and/or a SMDM forward perimeter edge, all of which are analogous to the CDM front 11100, the CDM rear 11200, and the CDM perimeter 11300 and edges thereof, and all the disclosure and relationships associated with the crown damping member 11000 apply to the sole damping member.

The golf club head may further include a rear badge 14000 attached to the frame 10000 via a rear damping member 15000, as seen in FIGS. 70 and 83. The rear badge 14000 has a rear badge height, a rear badge width, and a rear badge thickness, all measured as disclosed with respect to the sidewall damping member 12000.

The rear badge thickness need not be constant and may vary. Thus, the rear badge thickness may have a minimum rear badge thickness and a maximum rear badge thickness, where the maximum rear badge thickness is not equal to the minimum rear badge thickness. In constant rear badge thickness embodiments the maximum rear badge thickness is equal to the minimum rear badge thickness, and therefore reference to maximum or minimum rear badge thickness does not infer that the rear badge thickness varies.

In one embodiment the minimum rear badge thickness is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum rear badge thickness is at least 10% greater than the minimum TWCR thickness 10610, and at least 15%, 20%, 25%, or 30% greater in additional embodiments. In another embodiment the minimum rear badge thickness is no more than 400% greater than the minimum TWCR thickness 10610, and no more than 375%, 350%, 325%, 300%, 275%, 250%, 225%, 200%, or 175% greater in additional embodiments.

In one embodiment the minimum rear badge thickness is at least 95% of the maximum TWCR thickness 10610, and at least 100%, 105%, 110%, 115%, 120%, or 130% of the maximum TWCR thickness 10610 in additional embodiments. In another embodiment the minimum rear badge thickness is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the maximum rear badge thickness is at least 10% greater than the minimum TWCR thickness 10610, and at least 15%, 20%, 25%, or 30% greater in additional embodiments. In another embodiment the maximum rear badge thickness is no more than 400% greater than the minimum TWCR thickness 10610, and no more than 375%, 350%, 325%, 300%, 275%, 250%, 225%, 200%, or 175% greater in additional embodiments.

In one embodiment the maximum rear badge thickness is at least 95% of the maximum TWCR thickness 10610, and at least 100%, 105%, 110%, 115%, 120%, or 130% of the maximum TWCR thickness 10610 in additional embodiments. In another embodiment the maximum rear badge thickness is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment an average rear badge thickness is at least 10% greater than the minimum TWCR thickness 10610, and at least 15%, 20%, 25%, or 30% greater in additional embodiments. In another embodiment the average rear badge thickness is no more than 400% greater than the minimum TWCR thickness 10610, and no more than 375%, 350%, 325%, 300%, 275%, 250%, 225%, 200%, or 175% greater in additional embodiments.

In one embodiment the average rear badge thickness is at least 95% of the maximum TWCR thickness 10610, and at least 100%, 105%, 110%, 115%, 120%, or 130% of the maximum TWCR thickness 10610 in additional embodiments. In another embodiment the average rear badge thickness is no more than 400% of the maximum TWCR thickness 10610, and no more than 375%, 350%, 325%, 300%, 275%, 250%, 225%, 200%, 175%, 150%, or 140% of the maximum TWCR thickness 10610 in additional embodiments.

In one embodiment the average rear badge thickness is at least 1.1 mm, and at least 1.2, 1.3, 1.4, 1.5, or 1.6 mm in additional embodiments. In a further embodiment the average rear badge thickness is no more than 4 mm, and no more than 3.75, 3.5, 3.25, 3.0, 2.75, 2.5, 2.25, 2.0, or 1.75 mm in additional embodiments. In one embodiment the maximum rear badge thickness is at least 1.1 mm, and at least 1.2, 1.3, 1.4, 1.5, or 1.6 mm in additional embodiments. In a further embodiment the maximum rear badge thickness is no more than 4 mm, and no more than 3.75, 3.5, 3.25, 3.0, 2.75, 2.5, 2.25, 2.0, or 1.75 mm in additional embodiments. In one embodiment the minimum rear badge thickness is at least 1.1 mm, and at least 1.2, 1.3, 1.4, 1.5, or 1.6 mm in additional embodiments. In a further embodiment the minimum rear badge thickness is no more than 4 mm, and no more than 3.75, 3.5, 3.25, 3.0, 2.75, 2.5, 2.25, 2.0, or 1.75 mm in additional embodiments.

The rear badge height is measured parallel to the club head Z-axis, and the rear badge width is measured parallel to the club head X-axis. As with all disclosed heights, lengths, widths, and thicknesses of any components, the rear badge height and the rear badge width need not be constant and may vary. Thus, there may be a minimum rear badge height and a maximum rear badge height, where the maximum rear badge height is not equal to the minimum rear badge height. In constant rear badge height embodiments the maximum rear badge height is equal to the minimum rear badge height, and therefore reference to maximum or minimum rear badge height does not infer that the rear badge height varies. Similarly, there may be a minimum rear badge width and a maximum rear badge width, where the maximum rear badge width is not equal to the minimum rear badge width. In constant rear badge width embodiments the maximum rear badge width is equal to the minimum rear badge width, and therefore reference to maximum or minimum rear badge width does not infer that the rear badge width varies.

The minimum rear badge height is at least 25% of the frame height 10006 in one embodiment, and at least 30%, 35%, 40%, 45%, 50%, or 55% in additional embodiments. In another embodiment the minimum rear badge height is at least 50% of the club head Zup dimension, and at least 60%, 70%, 80%, 90%, or 100% in additional embodiments. The maximum rear badge height is no more than 95% of the frame height 10006 in one embodiment, and no more than 90%, 85%, 80%, or 75% in additional embodiments. Further, maximum rear badge height is no more than 125% greater than the club head Zup dimension in one embodiment, and no more than 115%, 105%, 95%, or 85% greater than the club head Zup in additional embodiments. Additionally, in one embodiment the club head CG Y-axis passes through the rear badge, while in yet a further embodiment a portion of the rear badge is located at an elevation above the club head CG and a portion of the rear badge is located at an elevation below the club head CG, while in still another embodiment majority of the rear badge is located at an elevation above the club head CG.

The minimum rear badge width is at least 50% of the frame height 10006 in one embodiment, and at least 60%, 70%, 80%, 90%, 100%, 110%, 120%, or 130% in additional embodiments. In another embodiment the minimum rear badge width is at least 30% of the club head CGy dimension, and at least 40%, 50%, 60%, 70%, 80%, 90%, or 100% in additional embodiments. The maximum rear badge width is no more than 4 times the frame height 10006 in one embodiment, and no more than 3.75, 3.5, 3.25, 3.0, or 2.75 times the frame height in additional embodiments. Further, maximum rear badge width is no more than 225% of the club head CGy dimension in one embodiment, and no more than 200%, 175%, 150%, or 125% in additional embodiments. The maximum rear badge width is at least 5% greater than the maximum rear badge height in one embodiment, and at least 15%, 30%, 45%, 60%, 75%, 90%, 105%, 120%, 150%, or 180% greater in additional embodiments. The maximum rear badge width is no more than 6 times the maximum rear badge height in one embodiment, and no more than 5.5, 5.0, 4.5, 4.0, 3.5, or 3.0 times greater in additional embodiments.

The minimum rear badge height is at least 5 mm in one embodiment, and at least 6, 7, 8, 9, 10, or 11 mm in further embodiments. The maximum rear badge height is no more than 22 mm in an embodiment, and is not more than 20, 18, 16, or 14 mm in additional embodiments. Further, the minimum rear badge width is at least 10 mm in one embodiment, and at least 15, 20, 25, or 30 mm in additional embodiments. The maximum rear badge width is no more than 120 mm in one embodiment, and no more than 110, 105, 100, 95, 90, 85, 80, 75, 70, 65, 60, 55, 50, 45, or 40 mm in further embodiments.

The externally exposed surface area of the rear badge 14000 is a rear badge area, which in one embodiment is at least 250 mm^2. In a further embodiment the rear badge area is at least 275 mm^2, and is at least 300 mm^2, 325 mm^2, 350 mm^2, or 375 mm^2 in additional embodiments. In another series of embodiments the rear badge area is no more than 3000 mm^2, 2750 mm^2, 2500 mm^2, 2250 mm^2, 2000 mm^2, 1750 mm^2, 1500 mm^2, or 1250 mm^2. In one embodiment the rear badge area is at least 20% of the TWCR area, and at least 25%, 30%, 35%, 40%, 45%, or 50% in additional embodiments. In one embodiment the rear badge area is at least 20% of the CDM area, and at least 25%, 30%, 35%, 40%, 45%, or 50% in additional embodiments.

The rear badge 14000 also has a rear badge volume, a rear badge density, and a rear badge mass. In one embodiment the rear badge density is less than 3 g/cc, while in another embodiment the rear badge density is at least 1 g/cc. The rear badge mass is less than 5 grams in one embodiment, and less than 4, 3, or 2 grams in further embodiments. The rear badge volume is less than the CDM volume in an embodiment, and less than 90%, 80%, or 70% of the CDM volume in additional embodiments.

The rear damping member 15000, abbreviated RDM, as seen in FIGS. 70 and 83, has a RDM thickness 15010, RDM volume, RDM density, and a RDM mass. The rear damping member 15000 has a RDM height, a RDM width, and a RDM thickness 15010, all measured as disclosed with respect to the sidewall damping member 12000.

The RDM thickness 15010 need not be constant and may vary. Thus, the RDM thickness 15010 may have a minimum RDM thickness 15010 and a maximum RDM thickness 15010, where the maximum RDM thickness 15010 is not equal to the minimum RDM thickness 15010. In constant RDM thickness 15010 embodiments the maximum RDM thickness 15010 is equal to the minimum RDM thickness 15010, and therefore reference to maximum or minimum RDM thickness 15010 does not infer that the RDM thickness 15010 varies.

In one embodiment the minimum RDM thickness 15010 is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum RDM thickness 15010 is at least 5% greater than the minimum TWCR thickness 10610, and at least 10%, 15%, 20%, or 25% greater in additional embodiments. In another embodiment the minimum RDM thickness 15010 is no more than 300% greater than the minimum TWCR thickness 10610, and no more than 275%, 250%, 225%, 200%, 175%, 150%, 125%, 100%, or 75% greater in additional embodiments.

In one embodiment the minimum RDM thickness 15010 is at least 75% of the maximum TWCR thickness 10610, and at least 80%, 85%, 90%, 95%, 100%, or 105% of the maximum TWCR thickness 10610 in additional embodiments. In another embodiment the minimum RDM thickness 15010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment the maximum RDM thickness 15010 is at least 75% of the minimum TWCR thickness 10610, and at least 80%, 85%, 90%, or 95% in additional embodiments. In another embodiment the maximum RDM thickness 15010 is no more than 300% greater than the minimum TWCR thickness 10610, and no more than 275%, 250%, 225%, 200%, 175%, 150%, 125%, 100%, or 75% greater in additional embodiments.

In one embodiment the maximum RDM thickness 15010 is at least 75% of the maximum TWCR thickness 10610, and at least 80%, 85%, 90%, or 95% of the maximum TWCR thickness 10610 in additional embodiments. In another embodiment the maximum RDM thickness 15010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment an average RDM thickness 15010 is at least 75% of the minimum TWCR thickness 10610, and at least 80%, 85%, 90%, or 95% in additional embodiments. In another embodiment the average RDM thickness 15010 is no more than 300% greater than the minimum TWCR thickness 10610, and no more than 275%, 250%, 225%, 200%, 175%, 150%, 125%, 100%, or 75% greater in additional embodiments.

In one embodiment the average RDM thickness 15010 is at least 65% of the maximum TWCR thickness 10610, and at least 70%, 75%, 80%, 85%, or 90% of the maximum TWCR thickness 10610 in additional embodiments. In another embodiment the average RDM thickness 15010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment the average RDM thickness 15010 is at least 0.7 mm, and at least 0.8, 0.9, 1.0, or 1.1 mm in additional embodiments. In a further embodiment the average RDM thickness 15010 is no more than 2.0 mm, and no more than 1.9, 1.8, 1.7, 1.6, 1.5, 1.4, 1.3, or 1.2 mm in additional embodiments. In one embodiment the maximum RDM thickness 15010 is at least 0.7 mm, and at least 0.8, 0.9, 1.0, or 1.1 mm in additional embodiments. In a further embodiment the maximum RDM thickness 15010 is no more than 4 mm, and no more than 2.0 mm, and no more than 1.9, 1.8, 1.7, 1.6, 1.5, 1.4, 1.3, or 1.2 mm in additional embodiments. In one embodiment the minimum RDM thickness 15010 is at least 0.7 mm, and at least 0.8, 0.9, 1.0, or 1.1 mm in additional embodiments. In a further embodiment the minimum RDM thickness 15010 is no more than 2.0 mm, and no more than 1.9, 1.8, 1.7, 1.6, 1.5, 1.4, 1.3, or 1.2 mm in additional embodiments.

The RDM height is measured parallel to the club head Z-axis, and the RDM width is measured parallel to the club head X-axis. As with all disclosed heights, lengths, widths, and thicknesses of any components, the RDM height and the RDM width need not be constant and may vary. Thus, there may be a minimum RDM height and a maximum RDM height, where the maximum RDM height is not equal to the minimum RDM height. In constant RDM height embodiments the maximum RDM height is equal to the minimum RDM height, and therefore reference to maximum or minimum RDM height does not infer that the RDM height varies. Similarly, there may be a minimum RDM width and a maximum RDM width, where the maximum RDM width is not equal to the minimum RDM width. In constant RDM width embodiments the maximum RDM width is equal to the minimum RDM width, and therefore reference to maximum or minimum RDM width does not infer that the RDM width varies.

The minimum RDM height is at least 25% of the frame height 10006 in one embodiment, and at least 30%, 35%, 40%, 45%, 50%, or 55% in additional embodiments. In another embodiment the minimum RDM height is at least 50% of the club head Zup dimension, and at least 60%, 70%, 80%, 90%, or 100% in additional embodiments. The maximum RDM height is no more than 95% of the frame height 10006 in one embodiment, and no more than 90%, 85%, 80%, or 75% in additional embodiments. Further, maximum RDM height is no more than 125% greater than the club head Zup dimension in one embodiment, and no more than 115%, 105%, 95%, or 85% greater than the club head Zup in additional embodiments. Additionally, in one embodiment the club head CG Y-axis passes through the rear damping member 15000, while in yet a further embodiment a portion of the rear damping member is located at an elevation above the club head CG and a portion of the rear damping member is located at an elevation below the club head CG, while in still another embodiment majority of the rear damping member is located at an elevation above the club head CG.

The minimum RDM width is at least 50% of the frame height 10006 in one embodiment, and at least 60%, 70%, 80%, 90%, 100%, 110%, 120%, or 130% in additional embodiments. In another embodiment the minimum RDM width is at least 30% of the club head CGy dimension, and at least 40%, 50%, 60%, 70%, 80%, 90%, or 100% in additional embodiments. The maximum RDM width is no more than 4 times the frame height 10006 in one embodiment, and no more than 3.75, 3.5, 3.25, 3.0, or 2.75 times the frame height in additional embodiments. Further, maximum RDM width is no more than 225% of the club head CGy dimension in one embodiment, and no more than 200%, 175%, 150%, or 125% in additional embodiments. The maximum RDM width is at least 5% greater than the maximum RDM height in one embodiment, and at least 15%, 30%, 45%, 60%, 75%, 90%, 105%, 120%, 150%, or 180% greater in additional embodiments. The maximum RDM width is no more than 8 times the maximum RDM height in one embodiment, and no more than 7.5, 7.0, 6.5, 6.0, 5.5, or 5.0 times greater in additional embodiments.

The minimum RDM height is at least 3 mm in one embodiment, and at least 4, 5, 6, or 7 mm in further embodiments. The maximum RDM height is no more than 22 mm in an embodiment, and is not more than 20, 18, 16, 14, 12, or 10 mm in additional embodiments. Further, the minimum RDM width is at least 10 mm in one embodiment, and at least 15, 20, 25, or 30 mm in additional embodiments. The maximum RDM width is no more than 120 mm in one embodiment, and no more than 110, 105, 100, 95, 90, 85, 80, 75, 70, 65, 60, 55, 50, 45, or 40 mm in further embodiments.

The rear damping member 15000 has a RDM contact area that is the surface area of the read damping member 15000 that is in contact with the rear badge 14000, which in one embodiment is at least 150 mm^2. In a further embodiment the rear badge area is at least 175 mm^2, and is at least 200 mm^2 or 225 mm^2 in additional embodiments. In another series of embodiments the RDM contact area is no more than 2000 mm^2, 1750 mm^2, 1500 mm^2, 1250 mm^2, 1000 mm^2, 750 mm^2, or 500 mm^2. In one embodiment the RDM contact area is at least 20% of the TWCR area, and at least 25%, 30%, 35%, 40%, 45%, or 50% in additional embodiments. In one embodiment the RDM contact area is at least 10% of the CDM area, and at least 15%, 20%, or 25% in additional embodiments. In another embodiment the RDM contact area is at least 20% of the SDM area, and at least 25%, 30%, 35%, 40%, 45%, or 50% in additional embodiments.

The rear damping member 15000 also has a RMD volume, a RDM density, and a RDM mass. In one embodiment the RDM density is less than 3 g/cc, while in another embodiment the rear badge density is at least 1 g/cc. In one embodiment the RDM density is no more than 25% of the frame density, and the RDM density is at least 45% of the sole member density, and the RDM mass, is less than 1 grams. In another embodiment the RDM density is no more than 45% of the frame density, and the RDM density is at least 45% of the sole member density, and the RDM mass is less than 0.75 grams. In another embodiment the RDM density is no more than 75% of the frame density, and the RDM density is at least 45% of the sole member density, and the RDM mass is less than 0.5 grams. The RDM density is no more than 2 g/cc in an embodiment, and no more than 1.8, 1.6, or 1.5 g/cc in additional embodiments. The RDM density is at least 1 g/cc in an embodiment, and is at least 1.1, 1.2, or 1.3 g/cc in further embodiments. The RDM mass is no more than 3 grams in an embodiment, and no more than 2.5, 2.0, 1.5, 1.0, 0.75, 0.5, or 0.25 grams in additional embodiments. The RDM volume is less than 7.5% of the primary cavity volume, and less than 6.5%, 5.5%, 4.5%, or 3.5% in additional embodiments. The RDM volume is less than SDM volume, and in additional embodiments the RDM volume is at least 10%, 15%, 20%, 25%, or 30% less than SDM volume.

Some embodiments include a face insert 5117, which may be bonded to the frame 10000 or attached to the frame 10000 via a face insert damping member 16000, abbreviated FIDM, as seen in FIGS. 70 and 83, which has a FIDM thickness 16010. The face insert damping member 16000 has a FIDM volume, FIDM density, and a FIDM mass. The face insert damping member 16000 has a FIDM height, a FIDM width, and a FIDM thickness 16010, all measured as disclosed with respect to the sidewall damping member 12000.

The FIDM thickness 16010 need not be constant and may vary. Thus, the FIDM thickness 16010 may have a minimum FIDM thickness 16010 and a maximum FIDM thickness 16010, where the maximum FIDM thickness 16010 is not equal to the minimum FIDM thickness 16010. In constant FIDM thickness 16010 embodiments the maximum FIDM thickness 16010 is equal to the minimum FIDM thickness 16010, and therefore reference to maximum or minimum FIDM thickness 16010 does not infer that the FIDM thickness 16010 varies.

In one embodiment the minimum FIDM thickness 16010 is greater than at least one of: the maximum TWCR thickness 10610, the minimum toe wall thickness 10542, the minimum heel wall thickness 10552, the minimum aft wall thickness 10562, and/or the minimum DC forward wall thickness 17210; while in further embodiments the relationship is true for at least two of the thicknesses, or at least three of the thicknesses, or at least four of the thicknesses, or all five of the thicknesses.

In one embodiment the minimum FIDM thickness 16010 is at least 5% greater than the minimum TWCR thickness 10610, and at least 10%, 15%, 20%, or 25% greater in additional embodiments. In another embodiment the minimum FIDM thickness 16010 is no more than 300% greater than the minimum TWCR thickness 10610, and no more than 275%, 250%, 225%, 200%, 175%, 150%, 125%, 100%, or 75% greater in additional embodiments.

In one embodiment the minimum FIDM thickness 16010 is at least 75% of the maximum TWCR thickness 10610, and at least 80%, 85%, 90%, 95%, 100%, or 105% of the maximum TWCR thickness 10610 in additional embodiments. In another embodiment the minimum FIDM thickness 16010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment the maximum FIDM thickness 16010 is at least 75% of the minimum TWCR thickness 10610, and at least 80%, 85%, 90%, or 95% in additional embodiments. In another embodiment the maximum FIDM thickness 16010 is no more than 300% greater than the minimum TWCR thickness 10610, and no more than 275%, 250%, 225%, 200%, 175%, 150%, 125%, 100%, or 75% greater in additional embodiments.

In one embodiment the maximum FIDM thickness 16010 is at least 75% of the maximum TWCR thickness 10610, and at least 80%, 85%, 90%, or 95% of the maximum TWCR thickness 10610 in additional embodiments. In another embodiment the maximum FIDM thickness 16010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment an average FIDM thickness 16010 is at least 75% of the minimum TWCR thickness 10610, and at least 80%, 85%, 90%, or 95% in additional embodiments. In another embodiment the average FIDM thickness 16010 is no more than 300% greater than the minimum TWCR thickness 10610, and no more than 275%, 250%, 225%, 200%, 175%, 150%, 125%, 100%, or 75% greater in additional embodiments.

In one embodiment the average FIDM thickness 16010 is at least 65% of the maximum TWCR thickness 10610, and at least 70%, 75%, 80%, 85%, or 90% of the maximum TWCR thickness 10610 in additional embodiments. In another embodiment the average FIDM thickness 16010 is no more than 300% of the maximum TWCR thickness 10610, and no more than 275%, 250%, 225%, 200%, 175%, 150%, 125%, 100%, 75%, 50%, or 40% of the maximum TWCR thickness 10610 in additional embodiments.

In one embodiment the average FIDM thickness 16010 is at least 0.7 mm, and at least 0.8, 0.9, 1.0, or 1.1 mm in additional embodiments. In a further embodiment the average FIDM thickness 16010 is no more than 2.0 mm, and no more than 1.9, 1.8, 1.7, 1.6, 1.5, 1.4, 1.3, or 1.2 mm in additional embodiments. In one embodiment the maximum FIDM thickness 16010 is at least 0.7 mm, and at least 0.8, 0.9, 1.0, or 1.1 mm in additional embodiments. In a further embodiment the maximum FIDM thickness 16010 is no more than 4 mm, and no more than 2.0 mm, and no more than 1.9, 1.8, 1.7, 1.6, 1.5, 1.4, 1.3, or 1.2 mm in additional embodiments. In one embodiment the minimum FIDM thickness 16010 is at least 0.7 mm, and at least 0.8, 0.9, 1.0, or 1.1 mm in additional embodiments. In a further embodiment the minimum FIDM thickness 16010 is no more than 2.0 mm, and no more than 1.9, 1.8, 1.7, 1.6, 1.5, 1.4, 1.3, or 1.2 mm in additional embodiments.

The FIDM height is measured parallel to the club head Z-axis, and the FIDM width is measured parallel to the club head X-axis. As with all disclosed heights, lengths, widths, and thicknesses of any components, the FIDM height and the FIDM width need not be constant and may vary. Thus, there may be a minimum FIDM height and a maximum FIDM height, where the maximum FIDM height is not equal to the minimum FIDM height. In constant FIDM height embodiments the maximum FIDM height is equal to the minimum FIDM height, and therefore reference to maximum or minimum FIDM height does not infer that the FIDM height varies. Similarly, there may be a minimum FIDM width and a maximum FIDM width, where the maximum FIDM width is not equal to the minimum FIDM width. In constant FIDM width embodiments the maximum FIDM width is equal to the minimum FIDM width, and therefore reference to maximum or minimum FIDM width does not infer that the FIDM width varies.

The minimum FIDM height is at least 25% of the frame height 10006 in one embodiment, and at least 30%, 35%, 40%, 45%, 50%, or 55% in additional embodiments. In another embodiment the minimum FIDM height is at least 50% of the club head Zup dimension, and at least 60%, 70%, 80%, 90%, or 100% in additional embodiments. The maximum FIDM height is no more than 95% of the frame height 10006 in one embodiment, and no more than 90%, 85%, 80%, or 75% in additional embodiments. Further, maximum FIDM height is no more than 125% greater than the club head Zup dimension in one embodiment, and no more than 115%, 105%, 95%, or 85% greater than the club head Zup in additional embodiments. Additionally, in one embodiment the club head CG Y-axis passes through the face insert damping member 16000, while in yet a further embodiment a portion of the face insert damping member 16000 is located at an elevation above the club head CG and a portion of the face insert damping member 16000 is located at an elevation below the club head CG, while in still another embodiment majority of the face insert damping member 16000 is located at an elevation above the club head CG.

The minimum FIDM width is at least 50% of the frame height 10006 in one embodiment, and at least 60%, 70%, 80%, 90%, 100%, 110%, 120%, or 130% in additional embodiments. In another embodiment the minimum FIDM width is at least 30% of the club head CGy dimension, and at least 40%, 50%, 60%, 70%, 80%, 90%, or 100% in additional embodiments. The maximum FIDM width is no more than 4 times the frame height 10006 in one embodiment, and no more than 3.75, 3.5, 3.25, 3.0, or 2.75 times the frame height in additional embodiments. Further, maximum FIDM width is no more than 225% of the club head CGy dimension in one embodiment, and no more than 200%, 175%, 150%, or 125% in additional embodiments. The maximum FIDM width is at least 5% greater than the maximum FIDM height in one embodiment, and at least 15%, 30%, 45%, 60%, 75%, 90%, 105%, 120%, 150%, or 180% greater in additional embodiments. The maximum FIDM width is no more than 8 times the maximum FIDM height in one embodiment, and no more than 7.5, 7.0, 6.5, 6.0, 5.5, or 5.0 times greater in additional embodiments.

The minimum FIDM height is at least 3 mm in one embodiment, and at least 4, 5, 6, or 7 mm in further embodiments. The maximum FIDM height is no more than 22 mm in an embodiment, and is not more than 20, 18, 16, 14, 12, or 10 mm in additional embodiments. Further, the minimum FIDM width is at least 10 mm in one embodiment, and at least 15, 20, 25, or 30 mm in additional embodiments. The maximum FIDM width is no more than 120 mm in one embodiment, and no more than 110, 105, 100, 95, 90, 85, 80, 75, 70, 65, 60, 55, 50, 45, or 40 mm in further embodiments.

The face insert damping member 16000 has a FIDM contact area that is the surface area of the face insert damping member 16000 that is in contact with the face insert 5117, which in one embodiment is at least 200 mm^2. In a further embodiment the rear badge area is at least 250 mm^2, and is at least 300 mm^2 or 350 mm^2 in additional embodiments. In another series of embodiments the FIDM contact area is no more than 3000 mm^2, 2750 mm^2, 2500 mm^2, 2250 mm^2, or 2000 mm^2. In one embodiment the FIDM contact area is at least 35% of the TWCR area, and at least 40%, 45%, 50%, 55%, 60%, or 65% in additional embodiments. In one embodiment the FIDM contact area is at least 20% of the CDM area, and at least 25%, 30%, or 35% in additional embodiments. In another embodiment the FIDM contact area is at least 75% of the SDM area, and at least 100%, 125%, 150%, or 175% in additional embodiments.

The face insert damping member 16000 also has a FIDM volume, a FIDM density, and a FIDM mass. In one embodiment the FIDM density is less than 3 g/cc, while in another embodiment the rear badge density is at least 1 g/cc. In one embodiment the FIDM density is no more than 25% of the frame density, and the FIDM density is at least 45% of the sole member density, and the FIDM mass is less than 3 grams. In another embodiment the FIDM density is no more than 45% of the frame density, and the FIDM density is at least 45% of the sole member density, and the FIDM mass is less than 2 grams. In another embodiment the FIDM density is no more than 75% of the frame density, and the FIDM density is at least 45% of the sole member density, and the FIDM mass is less than 1 gram. The FIDM density is no more than 2 g/cc in an embodiment, and no more than 1.8, 1.6, or 1.5 g/cc in additional embodiments. The FIDM density is at least 1 g/cc in an embodiment, and is at least 1.1, 1.2, or 1.3 g/cc in further embodiments. The FIDM mass is no more than 3 grams in an embodiment, and no more than 2.75, 2.5, 2.25, 2.0, 1.75, or 1.5 grams in additional embodiments. The FIDM volume is less than 7.5% of the primary cavity volume, and less than 6.5%, 5.5%, 4.5%, or 3.5% in additional embodiments. The FIDM volume is less than 200% of SDM volume, and in additional embodiments the FIDM volume is at least 75%, 80%, 85%, 90%, 95%, 100%, or 105% of the SDM volume.

The crown damping member 11000 and/or the sidewall damping member 12000 comprise a viscoelastic polymer layer having a polymer layer thickness in an embodiment, which in a further embodiment is a multilayer crown damping member 11000 and/or a multilayer sidewall damping member 12000 comprising a viscoelastic polymer layer, having a polymer layer thickness, and a facing layer, having a facing layer thickness that is different than the polymer layer thickness. In a further embodiment the facing layer is bendable and can be bent around a 25 mm mandrel at −30° C. without any cracking.

The crown damping member 11000 and/or the sidewall damping member 12000 has a composite loss factor, per SAE J1637, 0.8 mm test beam) of at least 0.06 when the CDM thickness is 1.5 mm, and/or when the SDM thickness is 1.5 mm, while in further embodiments the composite loss factor, per SAE J1637, 0.8 mm test beam) is at least 0.07, 0.08, or 0.09 when the CDM thickness is 1.5 mm, and/or when the SDM thickness is 1.5 mm. In another embodiment the crown damping member 11000 and/or the sidewall damping member 12000 has a composite loss factor, per SAE J1637, 0.8 mm test beam) of no more than 0.40 when the CDM thickness is 1.5 mm, and/or when the SDM thickness is 1.5 mm, while in further embodiments the composite loss factor, per SAE J1637, 0.8 mm test beam) is no more than 0.39, 0.38, or 0.37, 0.08, or 0.09 when the CDM thickness is 1.5 mm, and/or when the SDM thickness is 1.5 mm.

The crown damping member 11000 and/or the sidewall damping member 12000 has a loss factor, per ISO 6721-3, of at least 0.06 at −10° C., at least 0.25 at 20° C., and/or at least 0.07 at 50° C., when the CDM thickness is 1.5 mm, and/or when the SDM thickness is 1.5 mm, while in further embodiments the crown damping member 11000 and/or the sidewall damping member 12000 has a loss factor, per ISO 6721-3, of at least 0.07, 0.08, or 0.09 at −10° C., at least 0.26, 0.29, 0.31, or 0.33 at 20° C., and/or at least 0.07 or 0.08 at 50° C., when the CDM thickness is 1.5 mm, and/or when the SDM thickness is 1.5 mm. The crown damping member 11000 and/or the sidewall damping member 12000 has a loss factor, per ISO 6721-3, of no more than 0.12 at −10° C., no more than 0.45 at 20° C., and/or no more than 0.15 at 50° C., when the CDM thickness is 1.5 mm, and/or when the SDM thickness is 1.5 mm.

The crown damping member 11000 and/or the sidewall damping member 12000 has an areal weight, per ISO 845, of no more than 3000 g/m^2 in one embodiment, and no more than 2900, 2800, 2700, or 2600 g/m^2 in additional embodiments. The crown damping member 11000 and/or the sidewall damping member 12000 has an areal weight, per ISO 845, of at least 1700 g/m^2 in one embodiment, and at least 1900, 2000, 2100, or 2200 g/m^2 in additional embodiments.

In one embodiment the facing layer comprises at least one of aluminum alloy, copper alloy, titanium alloy, steel alloy, or glass cloth. In another embodiment the facing layer thickness is no more than 25% of the polymer layer thickness, and no more than 22.5%, 20%, 17.5%, 15%, 12.5, or 10% in further embodiments. The facing layer thickness is at least 2.5% of the polymer layer thickness in another embodiment, and at least 3.5%, 4.5%, 5.5%, 6.5%, 7.5%, or 8.5% in further embodiments. The facing layer thickness is no more than 0.250 mm in an embodiment, and no more than 0.225, 0.200, 0.180, 0.160, 0.140, or 0.130 mm in additional embodiments. The facing layer thickness is at least 0.075 mm in one embodiment, and at least 0.095, 0.105, 0.115, or 0.125 mm in further embodiments. The face insert thickness 5119 need not be constant and may vary. Thus, the face insert thickness 5119 may have a minimum face insert thickness 5119 and a maximum face insert thickness 5119, where the maximum face insert thickness 5119 is not equal to the minimum face insert thickness 5119. In constant face insert thickness 5119 embodiments the maximum face insert thickness 5119 is equal to the minimum face insert thickness 5119, and therefore reference to maximum or minimum face insert thickness 5119 does not infer that the face insert thickness 5119 varies.

In one embodiment the minimum face insert thickness 5119 is greater than at least one of: the maximum TWCR thickness 10610, the minimum toe wall thickness 10542, the minimum heel wall thickness 10552, the minimum aft wall thickness 10562, the average CDM thickness 11030, and/or the minimum DC forward wall thickness 17210; while in further embodiments the relationship is true for at least two of the thicknesses, or at least three of the thicknesses, or at least four of the thicknesses, or all five of the thicknesses. In one embodiment the minimum face insert thickness 5119 is at least 10% greater than the minimum TWCR thickness 10610, and at least 15%, 20%, 25%, or 30% greater in additional embodiments. In another embodiment the minimum face insert thickness 5119 is no more than 700% greater than the minimum TWCR thickness 10610, and no more than 675%, 650%, 625%, 600%, 575%, 550%, 525%, 500%, or 475% greater in additional embodiments. In a further embodiment the minimum face insert thickness 5119 is at least 95% of the maximum TWCR thickness 10610, and at least 100%, 105%, 110%, 115%, 120%, or 130% of the maximum TWCR thickness 10610 in additional embodiments. In another embodiment the minimum face insert thickness 5119 is no more than 650% of the maximum TWCR thickness 10610, and no more than 625%, 600%, 575%, 550%, 525%, 500%, or 475% of the maximum TWCR thickness 10610 in additional embodiments.

In one embodiment the face insert 5117 has a maximum face insert thickness 5119 is at least 50% greater than the minimum TWCR thickness 10610, and at least 60%, 70%, 80%, 90%, 110% or 120% greater in additional embodiments. In another embodiment the maximum face insert thickness 5119 is no more than 800% greater than the minimum TWCR thickness 10610, and no more than 775%, 750%, 725%, 700%, 675%, 650%, 625%, 600%, or 575% greater in additional embodiments. In one embodiment the maximum face insert thickness 5119 is at least 200% of the maximum TWCR thickness 10610, and at least 210%, 220%, 230%, 240%, 250%, or 260% of the maximum TWCR thickness 10610 in additional embodiments. In another embodiment the maximum face insert thickness 5119 is no more than 600% of the maximum TWCR thickness 10610, and no more than 575%, 550%, 525%, 500%, 475%, 450%, 425%, or 400% of the maximum TWCR thickness 10610 in additional embodiments.

In one embodiment an average face insert thickness 5119 is at least 10% greater than the minimum TWCR thickness 10610, and at least 15%, 20%, 25%, or 30% greater in additional embodiments. In another embodiment the average face insert thickness 5119 is no more than 900% greater than the minimum TWCR thickness 10610, and no more than 850%, 800%, 775%, 750%, 725%, 700%, 675%, 650%, or 625% greater in additional embodiments.

In one embodiment the average face insert thickness 5119 is at least 110% of the maximum TWCR thickness 10610, and at least 125%, 140%, 155%, 170%, 185%, or 200% of the maximum TWCR thickness 10610 in additional embodiments. In another embodiment the average face insert thickness 5119 is no more than 700% of the maximum TWCR thickness 10610, and no more than 675%, 650%, 625%, 600%, 575%, 550%, 525%, 500%, 475%, 450%, or 425% of the maximum TWCR thickness 10610 in additional embodiments.

In one embodiment the average face insert thickness 5119 is at least 1.1 mm, and at least 1.3, 1.5, 1.7, 1.9, 2.1, 2.3, 2.5, 2.7, 2.9, or 3.1 mm in additional embodiments. In a further embodiment the average face insert thickness 5119 is no more than 8 mm, and no more than 7.5, 7.0, 6.5, 6.0, or 5.5 mm in additional embodiments. In one embodiment the maximum face insert thickness 5119 is at least 1.7 mm, and at least 2.0, 2.3, 2.6, 2.9, or 3.2 mm in additional embodiments. In a further embodiment the maximum face insert thickness 5119 is no more than 10 mm, and no more than 9, 8, 7, or 6 mm in additional embodiments. In one embodiment the minimum face insert thickness 5119 is at least 0.8 mm, and at least 1.1, 1.4, 1.7, 2.1, or 2.4 mm in additional embodiments. In a further embodiment the minimum face insert thickness 5119 is no more than 8 mm, and no more than 7.5, 7.0, 6.5, 6.0, or 5.5 mm in additional embodiments.

In one embodiment the face insert density, or FI density, is no more than 25% of the frame density, and the FI density is at least 45% of the sole member density, and the face insert mass, or FI mass, is less than 9 grams. In another embodiment the FI density is no more than 45% of the frame density, and the FI density is at least 45% of the sole member density, and the FI mass is less than 8 grams. In another embodiment the FI density is no more than 75% of the frame density, and the FI density is at least 45% of the sole member density, and the FI mass is less than 7 grams.

The FI density is no more than 2 g/cc in an embodiment, and no more than 1.8, 1.6, 1.4, 1.2, 1.0, or 0.95 g/cc in additional embodiments. The FI density is at least 0.5 g/cc in an embodiment, and is at least 0.6, 0.7, 0.8, or 0.9 g/cc in further embodiments. The FI mass is no more than 9 grams in an embodiment, and no more than 8.5, 8.0, 7.5, 7.0, 6.5, 6.0, or 5.5 grams in additional embodiments. The FI mass is at least 2.5 grams in an embodiment, and at least 3.0, 3.5, 4.0, or 4.5 grams in additional embodiments. In one embodiment the FI volume is greater than at least one of the following: the CDM volume, the SDM volume, the damper volume, and/or the SM volume.

The face insert 5117 has a FI height measured parallel to the club head Z-axis, and a FI width measured parallel to the club head X-axis. As with all disclosed heights, lengths, widths, and thicknesses of any components, the FI height and the FI width need not be constant and may vary. Thus, there may be a minimum FI height and a maximum FI height, where the maximum FI height is not equal to the minimum FI height. In constant FI height embodiments the maximum FI height is equal to the minimum FI height, and therefore reference to maximum or minimum FI height does not infer that the FI height varies. Similarly, there may be a minimum FI width and a maximum FI width, where the maximum FI width is not equal to the minimum FI width. In constant FI width embodiments the maximum FI width is equal to the minimum FI width, and therefore reference to maximum or minimum FI width does not infer that the FI width varies. However, in an embodiment both the FI height and FI width vary, as seen in FIG. 70, and in a further embodiment the maximum FI width is located at an elevation greater than the Zup dimension. In another embodiment the maximum FI width is at least 5% greater than the minimum FI width; and in a further embodiment the maximum FI height is at least 5% greater than the minimum FI height. The club head CG Y-axis passes through the face insert 5117. The minimum rear badge width is at least 50% of the frame width 10004 in one embodiment, and at least 60%, 70%, or 80% in additional embodiments. In one embodiment the face insert 5117 comprises both nonmetallic material and metallic material. The disclosed variations in the size and location of the rear damping member 15000, the face insert damping member 16000, the face insert 5117, and the associated relationships with other club head components and attributes, significantly influence the vibrational modes, frequency, and/or amplitude and may produce preferred sound and feel of the club head. The disclosed attributes and relationships are a delicate trade-off of pros and cons to achieve desirable sound and feel, but also mass properties that produce performance. For instance, in one embodiment the club head CGx is greater than −5.0 mm, and in further embodiments greater than −4.0, −3.0, −2.0, or −1.0 mm. While in a further embodiment the club head CGx is no more than 5.0 mm, and in additional embodiments no more than 4.0, 3.0, 2.0, or 1.0 mm. In one embodiment the club head CGy is greater than 18 mm, and in further embodiments greater than 20, 22, 24, 26, 28, 30, 32, or 34 mm. While in a further embodiment the club head CGy is no more than 48 mm, and in additional embodiments is no more than 46, 44, 42, 40, or 38 mm. Additionally, the club head Zup is no more than 16 mm, and no more than 15 or 14 mm in further embodiments. In another embodiment the club head Zup is at least 8 mm, and in further embodiments is at least 9, 10, or 11 mm.

As one skilled in the art will appreciate, a club head has a moment of inertia about the vertical CG Z-axis ("Izz"), a moment of inertia about the heel/toe CG X-axis ("Ixx"), and a moment of inertia about the front/back CG Y-axis ("Iyy"). A moment of inertia about the golf club head CG X-axis (Ixx) is calculated by the following equation:

$$Ixx=\int(y^2+z^2)dm$$

where y is the distance from a golf club head CG xz-plane to an infinitesimal mass dm and z is the distance from a golf club head CG xy-plane to the infinitesimal mass dm. The golf club head CG xz-plane is a plane defined by the golf club head CG x-axis and the golf club head CG z-axis. The CG xy-plane is a plane defined by the golf club head CG X-axis and the golf club head CG Y-axis. Similarly, a moment of inertia about the golf club head CG Z-axis (Izz) is calculated by the following equation:

$$Izz=\int(x^2+y^2)dm$$

where x is the distance from a golf club head CG yz-plane to an infinitesimal mass dm and y is the distance from the golf club head CG xz-plane to the infinitesimal mass dm. The golf club head CG yz-plane is a plane defined by the golf club head CG Y-axis and the golf club head CG Z-axis. Similarly, a moment of inertia about the golf club head CG Y-axis (Iyy) is calculated by the following equation:

$$Iyy=\int(x^2+z^2)dm$$

where x is the distance from a golf club head CG yz-plane to an infinitesimal mass dm and z is the distance from the golf club head CG xy-plane to the infinitesimal mass dm. The golf club head CG xy-plane is a plane defined by the golf club head CG X-axis and the golf club head CG Y-axis. A further description of the coordinate systems for determining CG positions and MOI can be found in U.S. Pat. No. 9,358,430, the entire contents of which are incorporated by reference herein.

In one embodiment the club head Ixx is at least 245 kg·mm$^2$, and is at least 250, 255, 260, 265, 270, 275, 280, 285, 290, 295, 300, 305, 310, or 315 kg·mm$^2$ in further embodiments. In another embodiment the club head Ixx is no more than 370 kg·mm$^2$, and no more than 360, 350, 340, or 330 kg·mm$^2$ in further embodiments. Similarly, in another embodiment the club head Iyy is no more than 330 kg·mm$^2$, and no more than 320, 310, 300, or 290 kg·mm$^2$ in further embodiments. In yet another embodiment the club head Iyy is at least 220 kg·mm$^2$, and is at least 225, 230, 235, 240, 245, 250, 255, 260, or 270 kg·mm$^2$ in further embodiments. Similarly, in another embodiment the club head Izz is at least 460 kg·mm$^2$, and is at least 465, 470, 475, 480, 485, 490, 495, 500, 510, 520, 530, 540, 550, or 560 kg·mm$^2$ in further embodiments. In another embodiment the club head Izz is no more than 900 kg·mm$^2$, and no more than 850, 800, 750, 700, 650, or 600 kg·mm$^2$ in further embodiments.

One skilled in the art will appreciate that each individual component of the club head has a component center of gravity, and the coordinates of the component center of gravity can be referenced with respect to the origin or the ground plane. For example, the individual frame 10000 component, absent any attachments, has a frame center of gravity, CGf, located via a CGx-f, where the "-f" component identifies that it is the CGx of the individual frame 10000 component, and a CGy-f, where the "-f" component identifies that it is the CGy of the individual frame 10000 component, as well as a Zup-f, which references the height of the frame center of gravity, CGf, above the ground plane.

In one embodiment the frame CGx-f is greater than −5.0 mm, and in further embodiments greater than −4.0, −3.0, −2.0, or −1.0 mm. While in a further embodiment the frame CGx-f is no more than 5.0 mm, and in additional embodiments no more than 4.0, 3.0, 2.0, or 1.0 mm. In one embodiment the frame CGy-f is greater than 26 mm, and in further embodiments greater than 28, 30, 32, or 34 mm. While in a further embodiment the frame CGy-f is no more than 48 mm, and in additional embodiments is no more than 46, 44, 42, 40, or 38 mm. Additionally, the frame Zup-f is no more than 16 mm, and no more than 15 or 14 mm in further embodiments. In another embodiment the club head Zup-f is at least 8 mm, and in further embodiments is at least 9, 10, or 11 mm.

A Δx value is the absolute value of the difference between the club head CGx and the frame CGx-f, a Δy value is the absolute value of the difference between the club head CGy and the frame CGy-f, and a Δz value is the absolute value of the difference between the club head Zup and the frame Zup-f. In one embodiment the Δx value is no more than 3 mm, and in further embodiments is no more than 2.5, 2.0, 1.5, 1.0, or 0.5 mm. In another embodiment the Δy value is no more than 7.5 mm, and in further embodiments is no more than 5.0, 4.0, 3.0, 2.5, 2.0, 1.5, 1.0, or 0.5 mm. In still a further embodiment the Δz value is no more than 5.0 mm, and in further embodiments is no more than 4.0, 3.0, 2.5, 2.0, 1.5, 1.0, or 0.5 mm.

One skilled in the art will also appreciate that each individual component of the club head has component specific moments of inertia relative to the club head CG location. For example, the frame 10000 has a Ixx-f, which is a moment of inertia of the frame 10000 about the heel/toe CG X-axis, a Iyy-f, which is a moment of inertia of the frame 10000 about the front/back CG Y-axis, and a Izz-f, which is a moment of inertia of the frame 10000 about the vertical CG Z-axis.

In one embodiment a frame Ixx ratio of the Ixx-f to the club head Ixx is at least 0.75, a frame Iyy ratio of the Iyy-f to the club head Iyy is no more than 0.97, and a frame Izz ratio of the Izz-f to the club head Izz is at least 0.75. In another embodiment the frame Ixx ratio is no more than 0.975, and no more than 0.965, 0.955, 0.945, 0.935, or 0.925 in additional embodiments. Further, the frame Ixx ratio is at least 0.775 in an embodiment, and at least 0.800, 0.825, 0.850, 0.875, or 0.900 in additional embodiments. The frame Iyy ratio is at least 0.800 in one embodiment, and at least 0.825, 0.850, 0.875, or 0.900 in additional embodiments. The frame Iyy ratio is no more than 0.960, 0.950, 0.940, or 0.930 in further embodiments. The frame Izz ratio is no more than 0.950 in an embodiment, and no more than 0.940, 0.930, or 0.920 in further embodiments. The frame Izz ratio is at least 0.775 in another embodiment, and at least 0.800, 0.825, 0.850, or 0.875 in further embodiments. In one embodiment the frame Ixx-f is at least 220 $kg \cdot mm^2$, and is at least 225, 230, 235, 240, or 245 $kg \cdot mm^2$ in further embodiments. In another embodiment the frame Ixx-f is no more than 350 $kg \cdot mm^2$, and no more than 340, 330, 320, 310, 300, or 290 $kg \cdot mm^2$ in further embodiments. Similarly, in another embodiment the frame Iyy-f is no more than 310 $kg \cdot mm^2$, and no more than 300, 290, 280, or 270 $kg \cdot mm^2$ in further embodiments. In yet another embodiment the frame Iyy-f is at least 200 $kg \cdot mm^2$, and is at least 205, 210, 215, 220, 225, 230, or 235 $kg \cdot mm^2$ in further embodiments. Similarly, in another embodiment the frame Izz-f is at least 400 $kg \cdot mm^2$, and is at least 410, 420, 430, 440, 450, 460, 470, 480, 490, or 500 $kg \cdot mm^2$ in further embodiments. In another embodiment the frame Izz-f is no more than 850 $kg \cdot mm^2$, and no more than 800, 750, 700, 650, 600, or 550 $kg \cdot mm^2$ in further embodiments.

The crown damping member 11000 component has a CDM center of gravity, CGcdm, located via a CGx-cdm, where the "-cdm" component identifies that it is the CGx of the crown damping member 11000 component, and a CGy-cdm, where the "-cdm" component identifies that it is the CGy of the crown damping member 11000 component, as well as a Zup-cdm, which references the height of the CDM center of gravity, CGcdm, above the ground plane.

In one embodiment the CGy-cdm is greater than the club head CGy and/or the frame CGy-f. The CGx-cdm is greater than −5.0 mm in an embodiment, and in further embodiments greater than −4.0, −3.0, −2.0, or −1.0 mm. While in a further embodiment the CGx-cdm is no more than 5.0 mm, and in additional embodiments no more than 4.0, 3.0, 2.0, or 1.0 mm. In one embodiment the CGy-cdm is greater than 12 mm, and in further embodiments greater than 16, 20, 24, 26, 28, 30, 32, 34, 36, or 38 mm. While in a further embodiment the CGy-cdm is no more than 52 mm, and in additional embodiments is no more than 50, 48, 46, or 44 mm. Additionally, the Zup-cdm is no more than 26 mm, and no more than 24, 22, 20, or 18 mm in further embodiments. In another embodiment the Zup-cdm is at least 10 mm, and in further embodiments is at least 12 or 14 mm. In one embodiment the entire crown damping member 11000 is located above the elevation of the club head Zup, while in further embodiments every portion of the crown damping member 11000 is located at an elevation at least 1, 2, or 3 mm above the club head Zup.

The sidewall damping member 12000 component has a SDM center of gravity, CGsdm, located via a CGx-sdm, where the "-sdm" component identifies that it is the CGx of the sidewall damping member 12000 component, and a CGy-sdm, where the "-sdm" component identifies that it is the CGy of the sidewall damping member 12000 component, as well as a Zup-sdm, which references the height of the SDM center of gravity, CGsdm, above the ground plane.

In one embodiment the CGx-sdm is greater than −5.0 mm, and in further embodiments greater than −4.0, −3.0, −2.0, or −1.0 mm. While in a further embodiment the CGx-sdm is no more than 5.0 mm, and in additional embodiments no more than 4.0, 3.0, 2.0, or 1.0 mm. In one embodiment the CGy-sdm is greater than 2 mm, and in further embodiments greater than 4, 6, 8, 10, 12, 14, or 16 mm. While in a further embodiment the CGy-sdm is no more than 30 mm, and in additional embodiments is no more than 28, 26, 24, 22, or 20 mm. Additionally, the Zup-sdm is no more than 20 mm, and no more than 18, 16, or 14 mm in further embodiments. In another embodiment the Zup-sdm is at least 4 mm, and in further embodiments is at least 6, 8, or 10 mm. In one embodiment Zup-cdm is at least 1 mm greater than Zup-sdm, and is at least 1.25, 1.5, 1.75, or 2 mm greater in additional embodiments.

The damper 18000 component has a damper center of gravity, CGd, located via a CGx-d, where the "-d" component identifies that it is the CGx of the damper 18000 component, and a CGy-d, where the "-d" component identifies that it is the CGy of the damper 18000 component, as well as a Zup-d, which references the height of the damper center of gravity, CGd, above the ground plane.

In one embodiment the CGx-d is greater than −5.0 mm, and in further embodiments greater than −4.0, −3.0, −2.0, or −1.0 mm. While in a further embodiment the CGx-d is no more than 5.0 mm, and in additional embodiments no more than 4.0, 3.0, 2.0, or 1.0 mm. In one embodiment the CGy-d is greater than 6 mm, and in further embodiments greater than 8, 10, or 12 mm. While in a further embodiment the CGy-d is no more than 28 mm, and in additional embodiments is no more than 26, 24, 22, or 20 mm. Additionally, the Zup-d is no more than 20 mm, and no more than 18, 16, or 14 mm in further embodiments. In another embodiment the Zup-d is at least 4 mm, and in further embodiments is at least 6, 8, or 10 mm. In one embodiment Zup-d is at least 0.5 mm greater than the club head Zup, and is at least 0.75, 1.0, 1.25, 1.5, 1.75, or 2 mm greater in additional embodiments.

The sole member 13000 component has a SM center of gravity, CGsm, located via a CGx-sm, where the "-sm" component identifies that it is the CGx of the sole member 13000 component, and a CGy-sm, where the "-sm" component identifies that it is the CGy of the sole member 13000 component, as well as a Zup-sm, which references the height of the SM center of gravity, CGsm, above the ground plane.

In one embodiment the CGx-sm is greater than −5.0 mm, and in further embodiments greater than −4.0, −3.0, −2.0, or −1.0 mm. While in a further embodiment the CGx-sm is no more than 5.0 mm, and in additional embodiments no more than 4.0, 3.0, 2.0, or 1.0 mm. In one embodiment the CGy-sm is greater than 20 mm, and in further embodiments greater than 22, 24, 26, 28, 30, 32, 34, 36, 38, or 40 mm. While in a further embodiment the CGy-sm is no more than 52 mm, and in additional embodiments is no more than 50, 48, 46, 44, or 42 mm. Additionally, the Zup-sm is no more than 10 mm, and no more than 8, 6, 4, or 2 mm in further embodiments. In one embodiment the entire sole member 13000 is located below the elevation of the club head Zup, while in further embodiments every portion of the sole member 13000 is located at an elevation at least 1, 2, or 3 mm below the club head Zup.

The sole member 13000 has a Ixx-sm, which is a moment of inertia of the sole member 13000 about the heel/toe CG X-axis, a Iyy-sm, which is a moment of inertia of the sole member 13000 about the front/back CG Y-axis, and a Izz-sm, which is a moment of inertia of the sole member 13000 about the vertical CG Z-axis.

In one embodiment the sole member Ixx-sm is no more than 12 $kg \cdot mm^2$, and is no more than 10, 8, 6, or 4 $kg \cdot mm^2$ in further embodiments. In another embodiment the sole member Ixx-sm is at least 1 $kg \cdot mm^2$. Similarly, in another embodiment the sole member Iyy-sm is no more than 12 $kg \cdot mm^2$, and is no more than 10, 8, 6, or 4 $kg \cdot mm^2$ in further embodiments. In another embodiment the sole member Iyy-sm is at least 1 $kg \cdot mm^2$. Similarly, in another embodiment the sole member Izz-sm is no more than 20 $kg \cdot mm^2$, and is no more than 18, 16, 14, 12, 10, 8, or 6 $kg \cdot mm^2$ in further embodiments. In another embodiment the sole member Izz-sm is at least 1 $kg \cdot mm^2$, and at least 2 or 3 $kg \cdot mm^2$ in further embodiments.

The mass allocation of the overall club head can further be defined by dividing the club head into three distinct regions, namely a forward 25% region, a middle 50% region, and a rear 25% region, which are easily understood with reference to FIG. 87. An imaginary vertical plane containing the club head CG Z-axis and the club head CG X-axis is moved forward, or rearward, to divide the club head into these three distinct regions. First the imaginary vertical plane is located at a first plane location that is a distance equal to 25% of the club head length L from a leading edge of the striking face, and the forward 25% region includes everything from the imaginary plane at the first plane location, and forward. A forward 25% region mass is the mass of the club head located from the imaginary plane at the first plane location, and forward. Next the imaginary vertical plane is located at a second plane location that is a distance equal to 75% of the club head length L from the leading edge of the striking face, and the middle 50% region includes everything between the imaginary plane at the second plane location and the imaginary plane at the first plane location. A middle 50% region mass is the mass of the club head located between the imaginary plane at the second plane location and the imaginary plane at the first plane location. Finally, the rear 25% region includes everything from the imaginary plane at the second plane location, and rearward. A rear 25% region mass is the mass of the club head located from the imaginary plane at the second plane location, and rearward.

In one embodiment the forward 25% region mass is at least 30% of the total club head mass, the middle 50% region mass is no more than 45% of the total club head mass, and the rear 25% region mass is at least 17.5% of the total club head mass. In further embodiments the forward 25% region mass is at least 32.5%, 35%, 37.5%, or 40% of the total club head mass, the middle 50% region mass is no more than 42.5%, 40%, 37.5%, or 35% of the total club head mass, and the rear 25% region mass is at least 20%, 22.5%, or 25% of the total club head mass. In another embodiment the forward 25% region mass is no more than 60% of the total club head mass, the middle 50% region mass is at least 15% of the total club head mass, and the rear 25% region mass is no more than 45% of the total club head mass. In further embodiments the forward 25% region mass is no more than 55%, 50%, 47.5%, or 45% of the total club head mass, the middle 50% region mass is at least 17.5%, 20%, 22.5%, 25%, 27.5%, or 30% of the total club head mass, and the rear 25% region mass is no more than 42.5%, 40%, 37.5%, 35%, 32.5%, or 30% of the total club head mass.

In one embodiment the forward 25% region mass is no more than 180 grams, and in additional embodiments no more than 175, 170, or 165 grams. While in another embodiment the forward 25% region mass is at least 125 grams, and at least 130, 135, 140, 145, 150, or 155 grams in additional embodiments. The middle 50% region mass is at least 60 grams in an embodiment, and is at least 65, 70, 75, 80, 85, 90, or 95 grams in further embodiments. While in another embodiment the middle 50% region mass is no more than 135 grams, and in additional embodiments is no more than 130, 125, 120, 115, or 110 grams. The rear 25% region mass is no more than 125 grams in an embodiment, and no more than 120, 115, 110, 105, 100, or 95 grams in additional embodiments. While in another embodiment the rear 25% region mass is at least 70 grams, and at least 75, 80, 85, or 90 grams in further embodiments.

The same procedure for determine the inertias of the individual components is used to determine the inertias associated with the forward 25% region, the middle 50% region, and the rear 25% region. The forward 25% region has a Ixx-fr, which is a moment of inertia of the forward 25% region about the heel/toe CG X-axis, a Iyy-fr, which is a moment of inertia of the forward 25% region about the front/back CG Y-axis, and a Izz-fr, which is a moment of inertia of the forward 25% region about the vertical CG Z-axis. Similarly, the middle 50% region has a Ixx-mr, which is a moment of inertia of the middle 50% region about the heel/toe CG X-axis, a Iyy-mr, which is a moment of inertia of the middle 50% region about the front/back CG Y-axis, and a Izz-mr, which is a moment of inertia of the middle 50% region about the vertical CG Z-axis. Likewise, the rear 25% region has a Ixx-rr, which is a moment of inertia of the rear 25% region about the heel/toe CG X-axis, a Iyy-rr, which is a moment of inertia of the rear 25% region about the front/back CG Y-axis, and a Izz-rr, which is a moment of inertia of the rear 25% region about the vertical CG Z-axis.

A forward region Izz ratio is a ratio of the Izz-fr to the club head Izz, a middle region Izz ratio is a ratio of the Izz-mr to the club head Izz, and a rear region Izz ratio is a ratio of the Izz-rr to the club head Izz. The forward region Izz ratio is at least 0.39 in one embodiment, and at least 0.40, 0.41, 0.42, 0.43, or 0.44 in additional embodiments. While in another embodiment the forward region Izz ratio is no more than 0.600, and no more than 0.575, 0.550, 0.525, 0.500, or 0.475 in further embodiments. The middle region Izz ratio is no more than 0.350 in one embodiment, and no more than 0.325, 0.300, 0.275, 0.250, 0.225, 0.200, 0.175, or 0.150 in additional embodiments. While in another embodiment the middle region Izz ratio is at least 0.075, and in further embodiments is at least 0.100 or 0.125. The rear region Izz ratio is at least 0.275 in one embodiment, and at least 0.300, 0.325, 0.350, 0.375, 0.400, or 0.425 in additional embodiments. While in another embodiment the rear region Izz ratio is no more than 0.600, and no more than 0.575, 0.550, 0.525, 0.500, 0.475, or 0.450 in further embodiments.

The disclosed construction and relationships facilitates the use of few components in the creation of the club head, while obtaining a high club head Izz without the need for an exceedingly large club head CGy dimension. For instance, in one embodiment the club head Izz is at least 475 $kg \cdot mm^2$, and a CG efficiency value, defined as the club head Izz divided by the CGy value, is at least 13.5, while in further embodiments the CG efficiency value is at least 13.75, 14.00, 14.25, 14.5, or 14.75. In another embodiment the CG efficiency value is no more than 19.5, and no more than 19.0, 18.5, 18.0, 17.5, 17.0, 16.5, 16.00, 15.75, or 15.5 in additional embodiments. In a further embodiment any of these CG efficiency values are obtained with a club head Izz of at least 485, 495, 505, 515, 525, 535, 545, 555, or 565 kg·mm$^2$, and in certain embodiments a total club head mass of less than 370 grams, and less than 365, 360, or 355 grams in additional embodiments. The assembled club head has an average density, which is calculated by dividing a sum of each component's mass divided by a sum of each component's material volume. In one embodiment the assembled club head average density is at least 5 g/cc, and in additional embodiments is at least 5.25, 5.50, 5.75, or 6.00 g/cc. In another embodiment the assembled club head average density is no more than 8.0 g/cc, and no more than 7.75, 7.50, 7.25, 7.00, 6.75, 6.50, or 6.25 g/cc in additional embodiments. These relationships are particularly unusual for club heads having the disclosed large unitary construction metallic frame 10000 volume, mass, and mass property relationships.

In a further embodiment at least one of the following are asymmetric about the CG X-axis: the primary cavity 10500, the thin wall crown region 10600, the crown damping member 11000, or the sole member 13000; while in further embodiments at least two, three, or all four are asymmetric about the CG X-axis. In a further embodiment at least one of the following are asymmetric about the club head Y-axis: the primary cavity 10500, the thin wall crown region 10600, the crown damping member 11000, the sidewall damping member 12000, the sole member 13000, the rear badge 15000, the rear damping member 16000, the face insert damping member 16000, the damping cavity 17000, or the damper 18000; while in further embodiments at least two, three, four, five, six, or seven are asymmetric about the club head Y-axis. In another embodiment the combined CDM mass and the SMD mass is less than the SM mass.

Now with the key components, attributes, and relationships disclosed, one skilled in the art will appreciate the disclosed relationships involve significantly more than merely optimizing, or maximizing, a single design variable, or even a few design variables, but rather represent a complex balancing of positive and negative tradeoffs to obtain the disclosed and desirable performance attributes that are not inherently associated with the disclosed construction. For instance, traditional large unitary construction metallic frames are often associated with reduced cost, but are traditionally associated with poor performance attributable both undesirable mass properties, as well as the sound and feel of the club head upon impact with a golf ball. Undesirable sound and feel generally leads designers to further thicken the walls of traditional large unitary construction metallic frame putter heads, which often makes mass properties worse or involves creating aesthetic designs that are unappealing to modern golfers and the preferred look of a modern putter head. Thus, creating the disclosed large thin wall crown sections in a unitary construction metallic frame aides in improving the mass properties of an eye pleasing large unitary construction metallic frame putter head, but is accompanied by undesirable ringing, often measured in terms of duration and/or tau time, frequency, amplitude, vibration modes, and/or resonance upon impact with the golf ball. The disclosed attributes and relationships seek to overcome these undesirable sound and feel aspects, while doing so in a manner that is appealing to the modern golfer and achieves mass properties thought to be unachievable in a large unitary construction metallic frame putter head. For instance, introduction of each additional club head component increases the cost and offsets some of the savings associated with large unitary construction metallic frames, and introduction of frame sidewalls to improve the sound and feel often comes at the expense of mass properties and additional manufacturing difficulties and costs. Therefore, the placement and size of attributes of the large unitary construction metallic frame, as well as the placement, size, and materials of the non-frame related components, and the disclosed relationships, have overcome the undesirable aspects and have achieved desirable mass properties in a club head that has improved manufacturability and reduced costs.

The putter head is attached to a putter shaft having a golf grip, thereby creating a putter having a putter length as defined by "The Equipment Rules" by The R&A and USGA, First Edition, Effective Jan. 1, 2019. In one embodiment the putter length is at least 32", and in further embodiments at least 33", 34", or 35". In a further embodiment the putter length is no more than 37", and in further embodiments no more than 36.5", 36", or 35.5". In a further embodiment the putter is counter balanced with a grip weight, shaft weight, weighted grip, and/or weighted shaft, adding a counter balance mass to the putter, and in such embodiments an additional 50-70 grams may be added to the disclosed overall club head masses. In one embodiment the counter balance mass is at least 25 grams, and in further embodiments at least 40 grams, 55 grams, or 70 grams. In another embodiment the counter balance mass is no more than 150 grams, and in further embodiments no more than 130 grams, 110 grams, or 80 grams.

In one embodiment the face insert 5117 comprises non-metallic material, composite material, hard plastic, resilient elastomeric material, and/or carbon-fiber reinforced thermoplastic with short or long fibers, and/or any other materials and coatings disclosed herein, and any method of formation and attachment disclosed herein. In another embodiment the face insert 5117 can comprise a thermoplastic material, such as fiber-reinforced thermoplastic. In certain embodiments, the face insert 5117 comprise a polyamide material such as nylon. Particular examples include polyphthalamide (PPA) resin, polycarbonate resin, etc., reinforced with carbon fibers (e.g., chopped fibers). The composite material can include 20% to 60% fiber by mass, or by volume. Particular examples include 20% to 50% fiber, 30% to 40% fiber, 60% fiber or less, 50% fiber or less, 40% fiber or less, 30% fiber or less, etc., by mass or by volume. In certain embodiments, the face insert 5117 can be injection molded. The face insert 5117 may include a metal film deposited on its surface. The face insert 5117 can comprise PPA or similar resins compatible with primer materials for metal film deposition. The face insert 117 may comprise a composite material, such as a fiber-reinforced plastic or a chopped-fiber compound (e.g., bulk molded compound or sheet molded compound), or an injection-molded polymer either alone or in combination with prepreg plies. In one embodiment the face insert 5117 achieve desirable strain relationships by being formed of a polyamide resin, while in a further embodiment the polyamide resin includes fiber reinforcement, and in yet another embodiment the polyamide resin includes at least 35% fiber reinforcement. In one such embodiment the fiber reinforcement includes long-glass fibers having a length of at least 10 millimeters pre-molding and produce a finished component having fiber lengths of at least 3 millimeters, while another embodiment includes fiber reinforcement having short-glass fibers with a length of at least 0.5-2.0 millimeters pre-molding. Incorporation of the fiber reinforcement increases the tensile strength of the component, however it may also reduce the elongation to break therefore a careful balance must be struck to maintain sufficient elongation. Therefore, one embodiment includes 35-55% long fiber reinforcement, while in an even further embodiment has 40-50% long fiber reinforcement. One specific example is a long-glass fiber reinforced polyamide 66 compound with 40% carbon fiber reinforcement, such as the XuanWu XW5801 resin having a tensile strength of 245 megapascal and 7% elongation at break. Long fiber reinforced polyamides, and the resulting melt properties, produce a more isotropic material than that of short fiber reinforced polyamides, primarily due to the three-dimensional network formed by the long fibers developed during injection molding. Another advantage of long-fiber material is the almost linear behavior through to fracture resulting in less deformation at higher stresses. In one particular embodiment the face insert 5117 is formed of a polycaprolactam, a polyhexamethylene adipinamide, or a copolymer of hexamethylene diamine adipic acid and caprolactam, however other embodiments may include polypropylene (PP), nylon 6 (polyamide 6), polybutylene terephthalates (PBT), thermoplastic polyurethane (TPU), PC/ABS alloy, PPS, PEEK, and semi-crystalline engineering resin systems that meet the claimed mechanical properties. In one embodiment the face insert 5117 includes at least two layers that are separately formed of thermoplastic material having compatible resins and are subsequently joined via heat and/or pressure, and without the use of a bonding agent. In another embodiment the face insert 5117 comprises an injection molded component and over-molded component to joint the first component and the second component. In another embodiment the face insert 5117 is joined to the club head via through the use of a thermoset adhesive tape or a thermoset gasket located between a portion of the two components, and application of heat and/or pressure bonds the two components together.

In addition to those noted above, some examples of nonmetallic composites that can be used to form the face insert 5117 include, without limitation, glass fiber reinforced polymers (GFRP), carbon fiber reinforced polymers (CFRP), metal matrix composites (MMC), ceramic matrix composites (CMC), and natural composites (e.g., wood composites). Further, some examples of polymers that can be used to form the components include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®)

In other embodiments, the face insert 5117 is formed as a multi-layered structure comprising an injection molded inner layer and an outer layer comprising a thermoplastic composite laminate. The injection molded inner layer may be prepared from the thermoplastic polymers, with preferred materials including a polyamide (PA), or thermoplastic urethane (TPU) or a polyphenylene sulfide (PPS). Typically the thermoplastic composite laminate structures used to prepare the outer layer are continuous fiber reinforced thermoplastic resins. The continuous fibers may include glass fibers (both roving glass and filament glass) as well as aramid fibers and carbon fibers. The thermoplastic resins may be impregnated into these fibers to make the laminate materials include polyamides (including but not limited to PA, PA6, PA12 and PA6), polypropylene (PP), thermoplastic polyurethane or polyureas (TPU) and polyphenylene sulfide (PPS).

In some embodiments the face insert 5117 comprises multiple laminates that may be formed in a continuous process in which the thermoplastic matrix polymer and the individual fiber structure layers are fused together under high pressure into a single consolidated laminate, which can vary in both the number of layers fused to form the final laminate and the thickness of the final laminate. Typically the laminate sheets are consolidated in a double-belt laminating press, resulting in products with less than 2 percent void content and fiber volumes ranging anywhere between 35 and 55 percent, in thicknesses as thin as 0.5 mm to as thick as 6.0 mm, and may include up to 20 layers. Further information on the structure and method of preparation of such laminate structures is disclosed in European patent No. EP1923420B1 issued on Feb. 25, 2009 to Bond Laminates GMBH, the entire contents of which are incorporated by reference herein. The composite laminates structure of the outer layer may also be formed from the TEPEX® family of resin laminates available from Bond Laminates which preferred examples are TEPEX® dynalite 201, a PA66 polyamide formulation with reinforcing carbon fiber, which has a density of 1.4 g/cm$^3$, a fiber content of 45 vol %, a Tensile Strength of 785 mPa as measured by ASTM D 638; a Tensile Modulus of 53 gPa as measured by ASTM D 638; a Flexural Strength of 760 mPa as measured by ASTM D 790; and a Flexural Modulus of 45 GPa) as measured by ASTM D 790. Another preferred example is TEPEX® dynalite 208, a thermoplastic polyurethane (TPU)-based formulation with reinforcing carbon fiber, which has a density of 1.5 g/cc, a fiber content of, 45 vol %, a Tensile Strength of 710 mPa as measured by ASTM D 638; a Tensile Modulus of 48 gPa as measured by ASTM D 638; a Flexural Strength of 745 mPa as measured by ASTM D 790; and a Flexural Modulus of 41 gPa as measured by ASTM D 790.

Another preferred example is TEPEX® dynalite 207, a polyphenylene sulfide (PPS)-based formulation with reinforcing carbon fiber, which has a density of 1.6 g/cc, a fiber content of 45 vol %, a Tensile Strength of 710 mPa as measured by ASTM D 638; a Tensile Modulus of 55 gPa as measured by ASTM D 638; a Flexural Strength of 650 mPa as measured by ASTM D 790; and a Flexural Modulus of 40 gPa as measured by ASTM D 790.

There are various ways in which the multilayered face insert 5117 may be formed. In some embodiments the outer layer, is formed separately and discretely from the forming of the injection molded inner layer. The outer layer may be formed using known techniques for shaping thermoplastic composite laminates into parts including but not limited to compression molding or rubber and matched metal press forming or diaphragm forming. The inner layer may be injection molded using conventional techniques and secured to the outer layer by bonding methods known in the art including but not limited to adhesive bonding, including gluing, welding (preferable welding processes are ultrasonic welding, hot element welding, vibration welding, rotary friction welding or high frequency welding. Before the inner layer is secured to the outer layer, the outer surface of the inner layer and/or the inner of the outer layer may be pretreated by means of one or more of the following processes: mechanical treatment, such as by brushing or grinding; cleaning with liquids, preferably with aqueous solutions or organics solvents for removal of surface deposits; flame treatment, such as with propane gas, natural gas, town gas or butane; corona treatment (potential-loaded atmospheric pressure plasma); potential-free atmospheric pressure plasma treatment; low pressure plasma treatment (air and O2 atmosphere); UV light treatment; chemical pretreatment, e.g. by wet chemistry by gas phase pretreatment; and/or primers and coupling agents.

In another method of preparation a so called hybrid molding process may be used in which the composite laminate outer layer is insert molded to the injection molded inner layer to provide additional strength. Typically the composite laminate structure is introduced into an injection mold as a heated flat sheet or, preferably, as a preformed part. During injection molding, the thermoplastic material of the inner layer is then molded to the inner surface of the composite laminate structure the materials fuse together to form the face insert 5117 as a highly integrated part. Typically the injection molded inner layer is prepared from the same polymer family as the matrix material used in the formation of the composite laminate structures used to form the outer layer so as to ensure a good weld bond.

A further embodiment includes a polymer layer on the striking surface of the face insert 5117. The polymer layer can be provided on the outer surface of the face insert 5117 to provide for better performance of the face insert 5117, such as in wet conditions. Exemplary polymer layers are described in U.S. patent application Ser. No. 13/330,486 (patented as U.S. Pat. No. 8,979,669), which is incorporated by reference. The polymer layer may include polyurethane and/or other polymer materials. The polymer layer may have a polymer thickness of at least 0.05 mm, and in further embodiments at least 0.1 mm, 0.15 mm, 0.2 mm, 0.25 mm, or 0.3 mm. In another embodiment the polymer thickness is no more than 1 mm, and in further embodiments no more than 0.9 mm, 0.8 mm, 0.6 mm, or 0.5 mm. The polymer layer can be configured with alternating maximum thicknesses and minimum thicknesses to create score lines on the face insert 5117. Further, in some embodiments, teeth and/or another texture may be provided on the thicker areas of the polymer layer between the score lines, such as those disclosed in U.S. Ser. No. 18/109,760, filed Feb. 14, 2023, which is incorporated herein by reference in its entirety.

The size and shape of the insert recess corresponds with the size and shape of the face insert 5117. For example, the insert recess has the same peripheral shape as the face insert 5117. Moreover, the size of the outer periphery of and the depth of the insert recess is just larger than the outer periphery and thickness of the face insert 5117, respectively. In some examples, the outer periphery of the insert recess is sized so that the edge of the recess contacts the edge of the face insert 5117. Unless otherwise noted, the term "substantially" or "about" means within 5% of a defined characteristic. According to certain examples, a depth of the insert recess is substantially equal to a thickness of the face insert 5117, which can be a constant or variable thickness. The depth of the insert recess and the thickness of the face insert 5117 are selected so that when the face insert 5117 is seated in the insert recess, the face insert 5117 is between, and inclusive of, 0.15 mm proud and 0.1 mm recessed, between, and inclusive of, 0.1 mm proud and 0.05 mm recessed, or between, and inclusive of, 0.05 mm proud and 0.05 mm recessed relative to the portion of the striking face that surrounds the insert recess. In some examples, the depth of the insert recess is between, and inclusive of, 3 mm and 5 mm. The face insert 5117 may further include any of the materials and variations disclosed in U.S. Pat. No. 7,465,240, issued Dec. 16, 2008, U.S. Pat. No. 6,089,993 issued Jul. 18, 2000, which are incorporated by reference herein in their entirety. Further, the striking face 5116 may include a plurality of grooves, include any of those disclosed in U.S. Pat. No. 5,637,044, issued Jun. 10, 1997, which is incorporated by reference herein in the entirety.

Referring first to FIGS. 111-122, there is shown a putter head 27010, according to one embodiment, which is used to putt a ball (not shown) toward a hole (not shown). The putter head 27010 generally comprises an elongated main body 27012 having an upwardly extending neck 27014. The neck 27014 allows the putter head 27010 to be connected to a golf club shaft (not shown) in a conventional manner.

Figure 121:
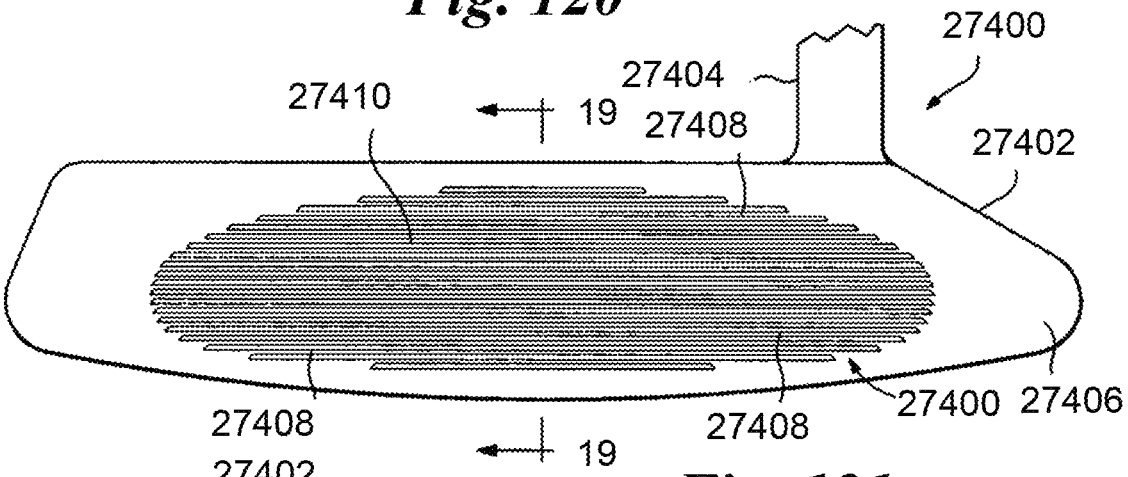
Figure 122:
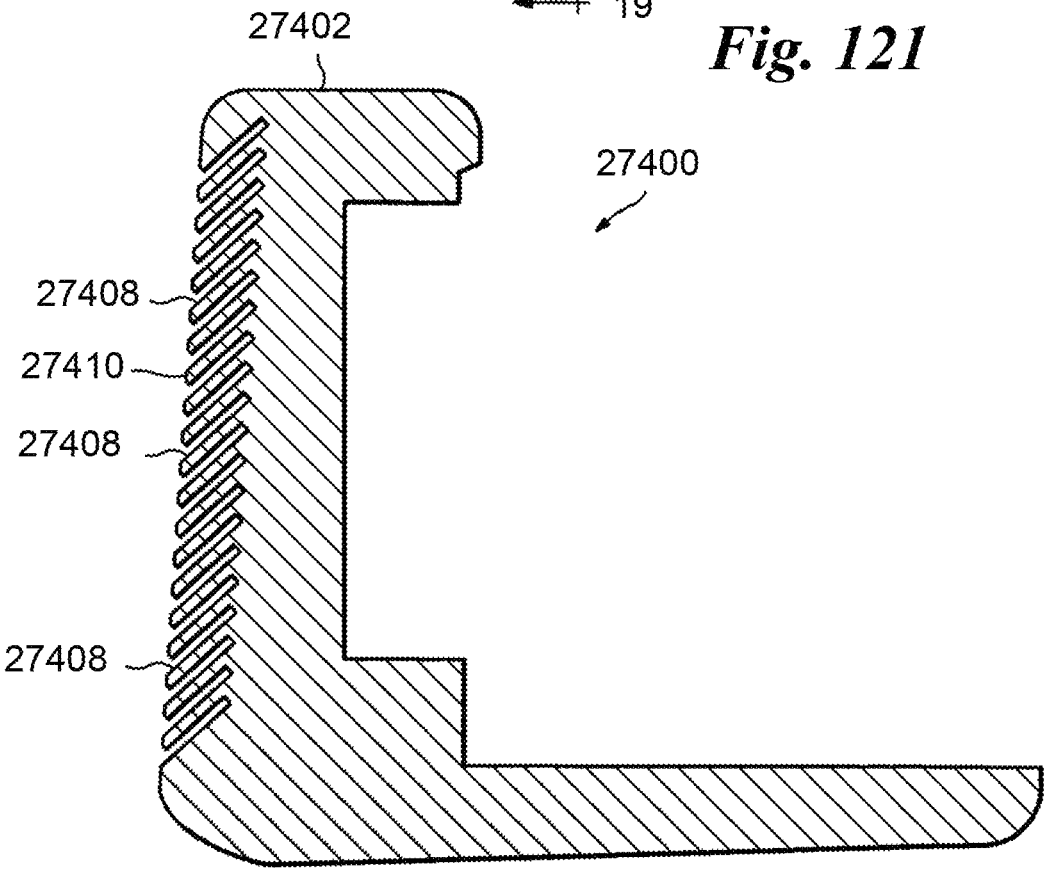

The main body 27012 in the illustrated configuration has a front surface 27016 that defines a heel 27020, a toe 27022, a top edge 27024, and a bottom edge 27026. An insert 27018 desirably is sized and shaped to fit within a recess 27050 (FIG. 112) in the front surface 27016. The illustrated insert 27018 comprises a plate-like structure defining a plurality of generally parallel, vertically spaced, deflectable beams, or projections, 27028 extending horizontally across the front surface 27016 between the heel 27020 and the toe 27022. The end surfaces 27030 of the beams 27028 collectively define a compliant striking face 27048 for contacting the ball. In an alternative embodiment, the beams 27028 can be formed directly in the main body 27012 (such as shown in FIGS. 121 and 122), rather than in the insert 27018. Upon impact with the ball, the beams 27028 deflect and rebound to impart topspin and provide an initial lift to the ball, as further described below.

The insert 27018 desirably is sized such that the end surfaces 27030 of the beams 27028 are substantially flush with and parallel to a peripheral portion 27032 of the front surface 27016 surrounding the insert 27018. In alternative embodiments, however, the beams 27028 can be raised with respect to the peripheral portion 27032, or alternatively, the beams 27028 can be recessed inwardly from the peripheral portion 27032. The insert 27018 can be attached to the main body 27012 using any suitable techniques or mechanisms, such as mechanical bonding, adhesive bonding, welding, brazing, mechanical fasteners, etc.

Alternatively, the insert 27018 can be removably mounted to the main body 27012, such as with screws or via a frictional fit between the insert 27018 and the surrounding recess. Thus, in this alternative embodiment, the putter can be adapted to accept different inserts for different golfers and/or different course conditions.

The insert 27018 desirably has a shape that conforms to the desired general strike location of a ball with the front surface 27016 of the putter head 27010. In the illustrated embodiment, the insert 27018 is generally elliptical, but can also comprise any other geometric shape, such as a rectangle (as shown in FIG. 116), square, circle, trapezoid, or combinations thereof. Also, although the peripheral portion 27032 of the front surface 27016 is shown as completely surrounding the insert 27018, this is not a requirement. For example, in one embodiment, the insert 27018 can extend from the top edge 27024 to the bottom edge 27026 of the front surface 27016. In another embodiment, the insert can extend from the heel 27020 to the toe 27022 across the entire width of the front surface 27016.

The insert 27018 and the main body 27012 may be formed either from a metal/metal alloy, polymer, composite, ceramic, or various combinations thereof. Generally, an insert 27018 formed from a metallic material provides the putter head 27010 with a more solid feel during impact with a golf ball, whereas an insert 27018 formed from a polymeric material, such as plastic, provides a softer feel than a metallic insert. The insert 27018 may be manufactured of the same material as the main body 27012 or it may be manufactured of a different material.

Some examples of metals and metal alloys that can be used to form the insert 27018 or the main body 27012 include, without limitation, carbon steels (e.g., 1020 or 8620 carbon steel), stainless steels (e.g., 304 or 410 stainless steel), PH (precipitation-hardenable) alloys (e.g., 17-4, C450, or C455 alloys), titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

Some examples of composites that can be used to form the insert 27018 or the main body 27012 include, without limitation, glass fiber reinforced polymers (GFRP), carbon fiber reinforced polymers (CFRP), metal matrix composites (MMC), ceramic matrix composites (CMC), and natural composites (e.g., wood composites).

Some examples of polymers that can be used to form the insert 27018 or the main body 27012 include, without limitation, thermoplastic materials (e.g., polyethylene, polypropylene, polystyrene, acrylic, PVC, ABS, polycarbonate, polyurethane, polyphenylene oxide (PPO), polyphenylene sulfide (PPS), polyether block amides, nylon, and engineered thermoplastics), thermosetting materials (e.g., polyurethane, epoxy, and polyester), copolymers, and elastomers (e.g., natural or synthetic rubber, EPDM, and Teflon®).

Some examples of ceramics that can be used to form the insert 27018 or the main body 27012 include, without limitation, oxides (e.g., titanium oxide, aluminum oxide, magnesium oxide, and silicon oxide), carbides (e.g., titanium carbide, tungsten carbide, silicon carbide, and boron carbide), and nitrides (e.g., silicon nitride).

The insert 27018 can be formed using conventional manufacturing techniques, such as, for example, die casting, injection molding, extrusion, forging, saw cutting, EDM (electrical discharge machining), milling, etching, etc. Any of the foregoing manufacturing techniques also can be used if the beams are formed directly in the front face 27016 of the main body 27012, rather than in an insert. The insert 27018 and/or the main body 27012 can be subjected to various surface treatment and/or coating processes, such as, for example, anodizing, nitriding, ion plating, PVD (physical vapor deposition), CVD (chemical vapor deposition), painting, powdercoating, electroplating, electroless plating, etc. to improve corrosion resistance, abrasion resistance, hardness, or other characteristics of the components.

Figure 115:
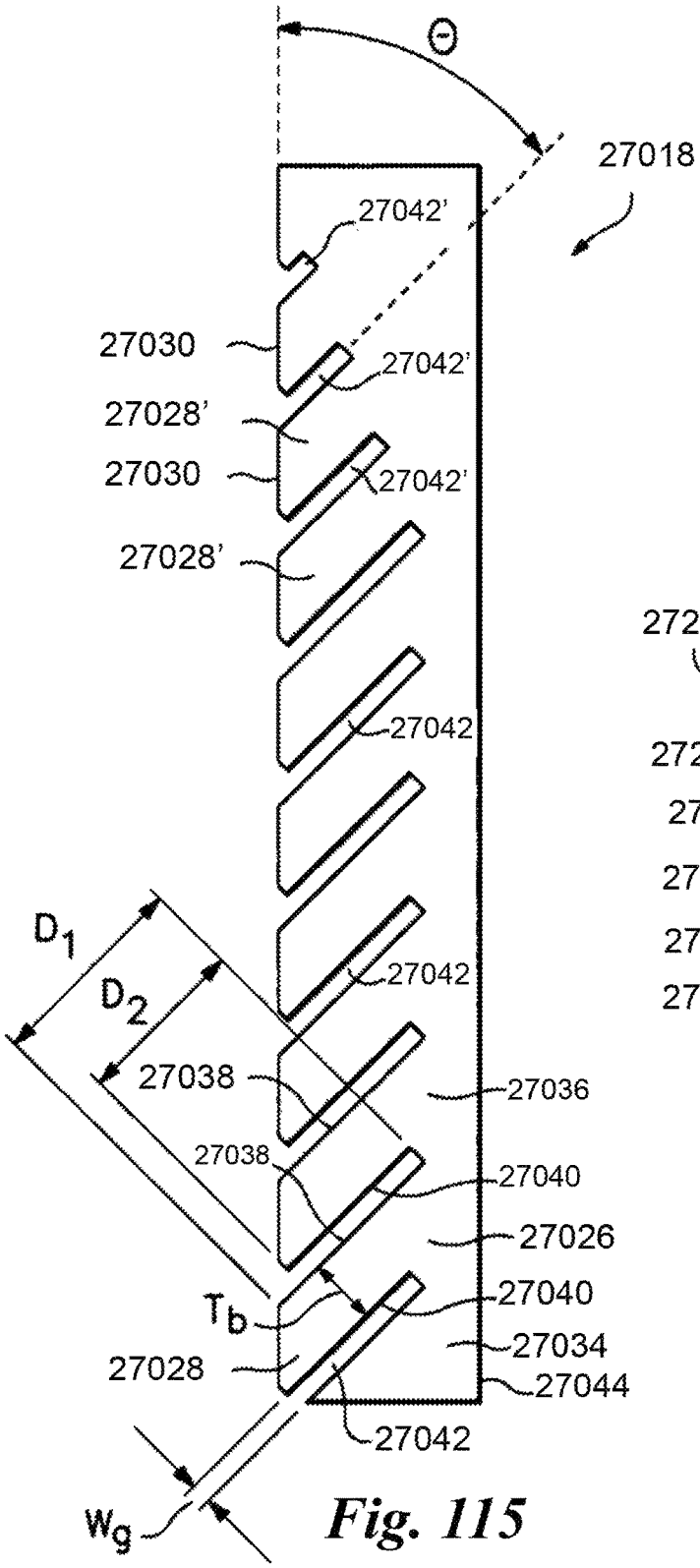

As best shown in FIG. 115, the beams 27028 extend outwardly and downwardly from a base 27034 of the insert 27018. The end surfaces 27030 of the beams 27028 desirably are flat and co-planar with the peripheral portion 27032 of the front surface 27016. Each beam 27028 has a fixed end 27036 that is desirably integrally formed with the base 27034. Each beam 27028 in the illustrated configuration has a cross-sectional profile generally in the form of a parallelogram. Each beam 27028 has an upper surface 27038 spaced from a substantially parallel lower surface 27040 defining a substantially constant beam thickness Tb measured between the upper and lower surfaces 27038, 27040. The beams 27028 can extend continuously between opposing points on the periphery of the insert 27018, as shown in FIG. 113. In alternative embodiments, however, the insert 27018 can be formed with one or more rows of horizontally spaced beams (e.g., beams 27106 shown in FIGS. 116-118).

The upper surface 27038 has a depth D1 that preferably is slightly greater than the depth D2 of the lower surface 27040. A gap 27042 is defined between the upper and lower surfaces 27038, 27040 of adjacent beams 27028. Each gap 27042 defines a substantially constant gap width Wg measured between the upper and lower surfaces 27038, 27040 of adjacent beams 27028. The depths D1 and D2 for each beam 27028 in the illustrated embodiment are the same, except for the top three beams 27028', which have depths that decrease progressively in the upward direction. This provides greater rigidity to the top three beams 27028'. In some embodiments, the gap width Wg of one or more gaps 27042 may be varied depending on the orientation of the gaps 27042 with respect to the center of the insert 27018. For example, a gap 27042 disposed at the center of the insert 27018 may have a larger gap width Wg than a gap 27042 disposed towards the top and/or bottom of the insert 27018.

In certain embodiments, one or more gaps 27042 between adjacent beams 27028 may extend to the rear surface 27044 of insert 27018, thereby forming one or more vertically spaced slots extending through the entire thickness Ti of the insert 27018. Such slots may extend across all or a portion of the width Wi of the insert 27018 and provide a maximum beam depth D1 and/or D2 for a particular insert thickness.

In certain embodiments, the beam upper surfaces 27038 have a depth D1 that is between approximately 1 and 3 mm; the beam lower surfaces 27040 have a depth D2 that is between approximately 0.8 and 2.8 mm; the beams 27028 have a thickness Tb that is between approximately 0.3 and 1.0 mm; and the gaps 27042 have a gap width Wg that is between approximately 0.1 and 0.4 mm. Of course, these specific dimensions (as well as other dimensions provided in the present specification) are given to illustrate the invention and not to limit it. The dimensions provided herein can be modified as needed in different applications or situations.

As shown in FIG. 113, the gaps 27042 between adjacent beams 27028 can extend across the entire width Wi of the insert 27018. In an alternative embodiment, the gaps 27042 between adjacent beams 27028 can extend less than the entire width Wi of the insert 27018, such that one or both toe/heel end portions of the beams 27028 are fixed relative to a peripheral portion of the insert (such as insert 27300 shown in FIG. 120 and further described below).

The insert 27018 in the illustrated embodiment has nine beams 27028, although in other embodiments the insert 27018 can have greater or fewer number of beams 27028. In certain embodiments, for example, the insert 27018 can have eight to fifteen beams.

As shown in FIG. 115, when the putter head 27010 is at address position, beams 27028 project downwards toward a bottom portion of the main body 27012 (FIG. 111) such that beams 27028 define an acute angle θ extending between the beams 27028 and a vertical axis (relative to a putting surface ground plane). In one embodiment, angle θ may be defined as the angle extending between an upper surface 27038 of a beam 27028 and a vertical axis. In an alternative embodiment, angle θ may be defined as the angle extending between a lower surface 27040 of a beam 27028 and a vertical axis.

In particular embodiments, the sum of angle θ and the loft angle of the putter is in the range of about 10 to 80 degrees, and more desirably about 30 to 60 degrees, and most desirably about 40 to 50 degrees, with 45 degrees being a specific example. In typical embodiments where the putter loft angle ranges from 3 to 5 degrees, angle θ is in the range of about 6 to 76 degrees, and more desirably about 26 to 56 degrees, and most desirably about 36 to 46 degrees, with 41 degrees being a specific example.

In an alternative embodiment where the insert rear surface 27044 is substantially parallel to a striking face 27048 collectively defined by the end surfaces 27030 of the beams 27028, each beam may define an acute angle extending between a beam and the rear surface 27044 of the insert 27018. In such an embodiment, the acute angle may be of the same magnitude as angle θ as defined above.

Upon contact with a ball, the beams 27028 deflect inwardly and downwardly, and then recoil outwardly and upwardly, thereby imparting topspin and a launch angle to the ball. The frequency of oscillation (f) of a beam 1028 can be estimated by the following equation:

$$f = \sqrt{\frac{E \cdot T_b^2 \cdot \lambda^4}{48 \cdot \pi^2 \cdot \rho \cdot D_2^4}}$$

where E is the Young's modulus of the beam material, A is equal to 1.8751 for the fundamental mode of vibration, and p is the density of the beam material. In certain embodiments, the beams 27028 have a frequency of oscillation in the range of about 3 kHz to about 300 kHz, and more desirably in the range of about 8 kHz to about 150 kHz, and most desirably in the range of about 12 kHz to about 95 kHz.

The beams 27028 in certain embodiments are sufficiently resilient to deflect upon impact, but yet are stiff enough to be self-supporting; that is, the stiffness of the beams prevent a beam from contacting an adjacent beam upon deflection. In other embodiments, however, the beams 27028 can be configured to contact each other upon deflection.

Additionally, the dimensions of the beams 27028 can be varied to achieve different performance characteristics for different levels of play or different course conditions. For example, the effective spring constant of the beams 27028 (i.e., the stiffness of the beams) can be decreased to increase the amount of forward roll imparted on the ball by increasing the depth of the beams, decreasing the beam thickness, and/or forming the beams 27028 from a material having a lower modulus of elasticity.

In alternative embodiments, the cross-sectional profile of the beams 27028 can define any of various geometric shapes. In one implementation, for example, the beams 27028 can be tapered from their fixed ends 27036 to their end surfaces 27030. Alternatively, the beams 27028 can be tapered from their end surfaces 27030 to their fixed ends 27036. Rather than having flat end surfaces 27030, the beams 27028 can have a generally V-shaped cross-sectional profile such that the beams 27028 taper to a sharp outer edge for contacting the ball. In still another implementation, the beams 27028 can have curved end surfaces for contacting the ball.

The thickness Tb of one or more beams 27028 can vary across the width of the beams. For example, the thickness Tb of a beam 27028 can be greatest at the heel 27020 and toe 27022 ends of the insert 27018 and decrease moving toward the center, or alternatively, the thickness Tb of a beam 27028 can be greatest at the center of the insert 27018 and decrease moving toward the heel 27020 and toe 27022 ends of the insert 27018. Also, the thickness Tb of one or more beams 27028 can vary across the height H of the insert 27018. For example, the thickness Tb of beams 27028 disposed at either or both of the top and bottom of the insert 27018 may be greater than the thickness Tb of beams 27028 disposed at the center of the insert 27018. Conversely, the thickness Tb of beams 27028 disposed at the center of the insert 27018 may be greater than the thickness Tb of beams 27028 disposed at either or both of the top and bottom of the insert 27018.

In alternative embodiments, the end surfaces 27030 of the beams 27028 and/or the peripheral portion 27032 of the front surface 27016 can have various surface textures for aesthetics, to increase the coefficient of friction of the striking face, or for other reasons. For example, a series of straight or arcuate parallel grooves can be formed in the end surfaces 27030 and the peripheral portion 27032.

In particular embodiments, the gaps 27042 between the beams 27028 can be filled with a compliant filler material to prevent debris, such as grass or dirt, from collecting in the gaps. The filler material desirably is compliant enough to allow for sufficient deflection of the beams.

Examples of suitable filler materials that can be used include, without limitation, viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available filler materials include resilient polymeric materials such as Scotchdamp™ from 3M, Sorbothane® from Sorbothane, Inc., DYAD® and GP® from Soundcoat Company Inc., Dynamat® from Dynamat Control of North America, Inc., No ViFlex™ Sylomer® from Pole Star Maritime Group, LLC, Isoplast® from The Dow Chemical Company, and Legetolex™ from Piqua Technologies, Inc.

Another group of suitable filler materials is low-density granular materials such as, without limitation, perlite; vermiculite; polyethylene beads; glass microspheres; expanded polystyrene; nylon flock; ceramics; polymeric elastomers; rubbers; dendritic particles; and mixtures thereof.

The putter head 27010 is used to propel a golf ball toward a hole by striking the golf ball with the striking face 27048 that is collectively formed by the end surfaces 27030 of the beams 27028. Desirably, the golfer aligns the putter head 27010 such that the end surfaces 27030 of the beams 27028 are the only portion of the putter head 27010 to contact the ball during the putting stroke. Upon impact with a ball, the beams 27028 deflect downwardly and inwardly and then rebound upwardly and outwardly, thereby pushing on the ball periphery in the same direction. The rebound of the beams 27028 applies a forward moment on the ball so as to cause forward rotation of the ball immediately or shortly after impact with the striking face 27048. The early forward rotation of the ball helps to minimize or eliminate the adverse effects of backspin induced skipping and sliding, such as the tendency of the ball to follow the grain of the putting green or to be knocked off line by other surface irregularities in the putting green. Moreover, because the beams 27028 deflect and rebound in a predictable fashion, the beams 27028 improve the feel of the putter head 27010 when striking a golf ball. Also, unlike typical conventional putter heads having projections to improve the feel of the putter head, control of the golf ball is not adversely affected. As discussed above, control of the ball actually is improved due the tendency of the beams to impart topspin and a launch angle to the ball.

Figure 118:
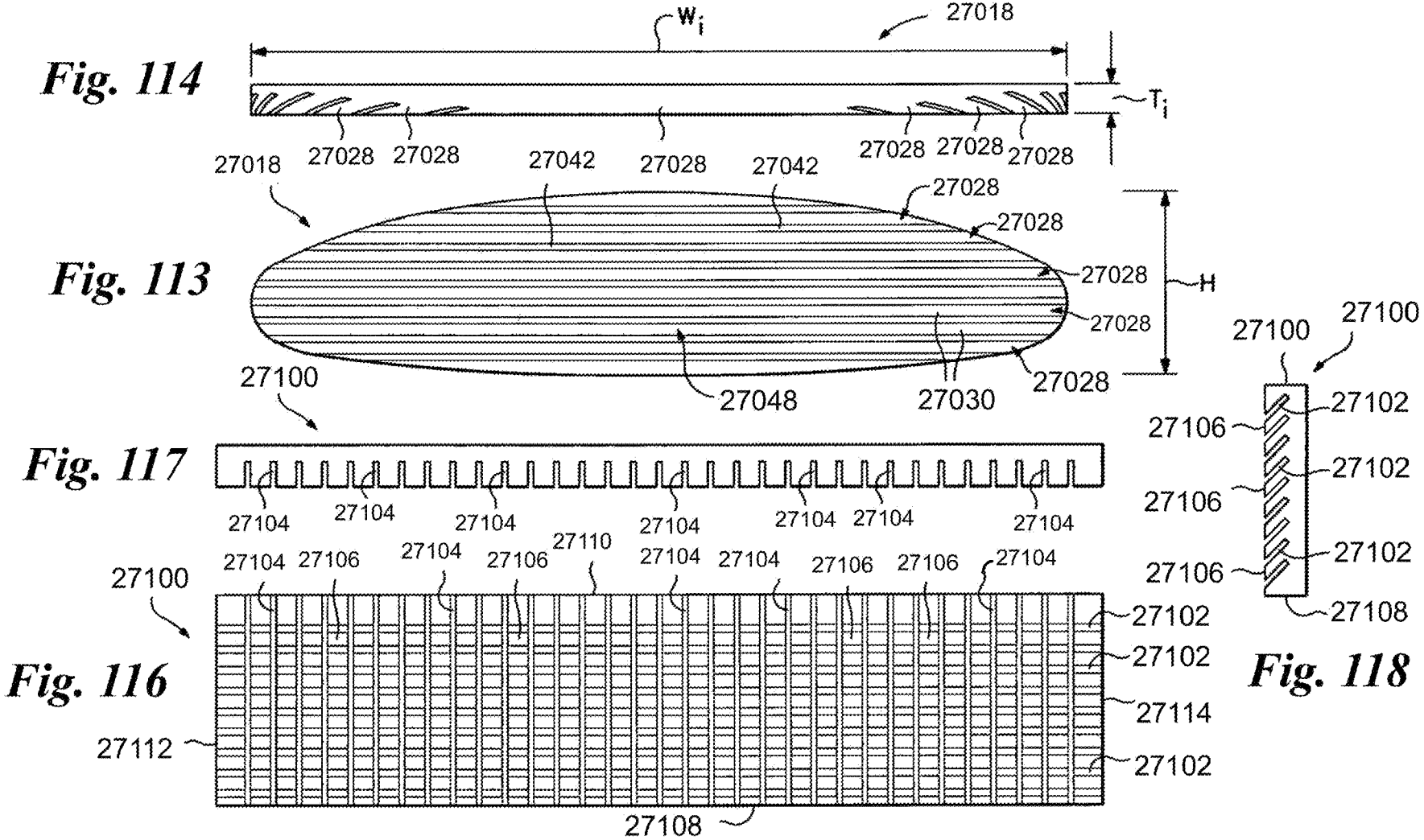

FIGS. 116-118 show an insert 27100 for a putter head, according to another embodiment. The insert 27100 is generally rectangular, although it can have other geometric shapes. The insert 27100 can be attached to a putter head, such as by mounting the insert in a recessed portion in the front face of the putter head, as described above. The insert 27100 is formed with a plurality of horizontally extending, vertically spaced gaps, or cuts, 27102 and a plurality of vertically extending, horizontally spaced gaps, or cuts, 27104, which form a plurality of downwardly extending beams, or projections, 27106.

While the horizontal gaps 27102 are spaced uniformly moving from the bottom edge 27108 to the top edge 27110 of the insert 27100 and the vertical gaps 27102 are spaced uniformly moving from the toe edge 27112 (the left edge in FIG. 116) to the heel edge 27114 (the right edge in FIG. 116), this is not a requirement. Accordingly, the spacing of the horizontal gaps 27102 and/or the vertical gaps 27104 can be varied across the face of the insert 27100, so as to achieve different beam stiffness at different sections of the insert 27100. In addition, the insert 27100 can be formed with vertical gaps 27104 that extend only partially between the top and bottom edges 27110, 27108 of the insert.

Figure 119:
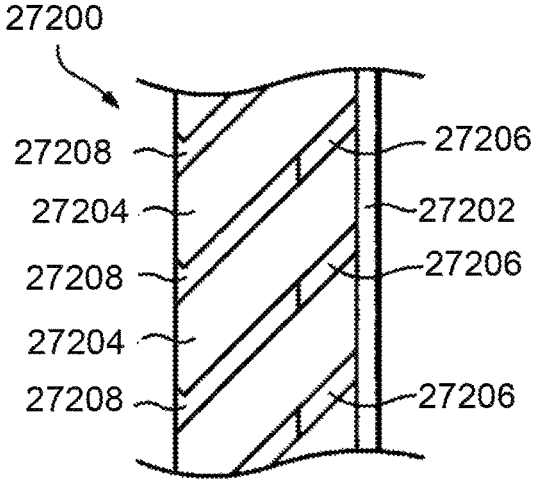

FIG. 119 shows an insert 27200, according to another embodiment. The illustrated insert 27200 comprises a support 27202 that can comprise a plate-like member and a plurality of beams 27204 extending downwardly from the support 27202. In particular embodiments, the beams 27204 are separately formed and subsequently attached to the support 27202 using suitable techniques or mechanisms, such as mechanical bonding, adhesive bonding, welding, brazing, mechanical fasteners, etc.

As shown, spacers 27206 can be positioned between adjacent beams 27204. The depth of the spacers 27206 can be varied to alter the effective depth of the beams 27204 (i.e., the portion of a beam 27204 that is cantilevered with respect to an adjacent spacer 27206). For example, increasing the depth of the spacers 27206 decreases the effective depth of the beams 27204 and therefore increases the stiffness of the beams. Similarly, the thickness of the spacers 27206 can be varied to alter the gap width between adjacent beams 27204. For example, increasing the thickness of the spacers 27206 increases the gap width between adjacent beams 27204. The support 27202, the beams 27204, and the spacers 27206 can be made of any of various suitable materials, such as any of the metals, metal alloys, composites, polymers, or ceramics described above for the insert 27018.

Additionally, the insert 27200 can include optional compliant filler material 27208 disposed between adjacent beams 27204 to prevent debris from collecting in the gaps between adjacent beams. The filler material 27208 can comprise any of the suitable filler materials described above for the insert 27018.

Figure 120:
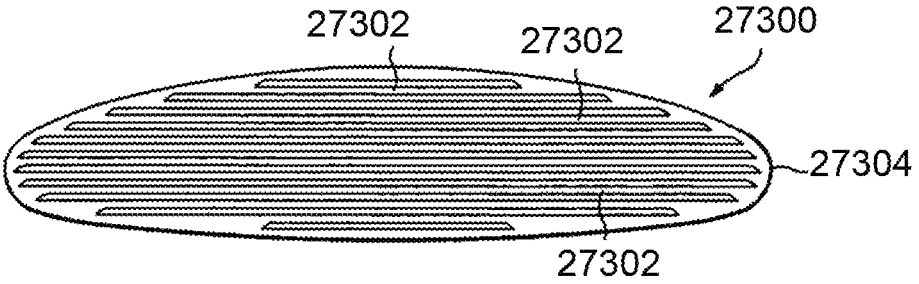

FIG. 120 shows an insert 27300, according to yet another embodiment, that includes a plurality of beams 27302. The insert 27300 is similar to the insert 27018 shown in FIGS. 111-115, with the exception that the beams 27302 of the insert 27300 do not extend across the entire width $W_1$ of the insert 27300 and instead terminate at a peripheral portion 27304 that surrounds the beams 27302. In a modification of the insert 27300, the peripheral portion 27304 extends only partially around the beams 27302.

FIGS. 121 and 122 show a putter head 27400, according to another embodiment, that comprises a main body 27402 having an upwardly extending neck 27404. Unlike the putter head 27010 shown in FIGS. 111 and 112, the putter head 27400 includes a plurality of beams 27408 formed directly in the front surface 27406 of the main body 27402. The end surfaces of the beams 27408 collectively define a striking face 27410 for contacting a ball. The overall shape of striking face 27410 in the illustrated embodiment is similar to the shape of the insert 27018 shown in FIGS. 111-115. However, this is not a requirement. Accordingly, the striking face 27410 can have any of various shapes and can cover any portion of the front surface 27406. Similarly, the beams 27408 can have any of the various shapes or configurations described above for the beams 27028.

EXAMPLES

Example 1

An insert 27018 was constructed of ABS plastic with an overall width Wi (FIG. 114), height H (FIG. 113), and thickness Ti (FIG. 114) of about 85.16 mm, 18.59 mm, and 3.05 mm, respectively. The insert included ten beams 27028. The beams had a depth D1 of about 3.10 mm, a depth D2 of about 2.62 mm, a thickness Tb of about 0.89 mm, a gap width Wg of about 0.30 mm, and were oriented at approximately a 45 degree angle with respect to a vertical axis relative to a putting surface ground plane.

Example 2

An insert 27018 was constructed of 6061 anodized aluminum with an overall width Wi (FIG. 114), height H (FIG. 113), and thickness Ti (FIG. 114) of about 85.16 mm, 18.59 mm, and 3.05 mm, respectively. The insert included fifteen beams 27028. The beams had a depth D1 of about 3.10 mm, a depth D2 of about 2.62 mm, a thickness Tb of about 0.40 mm, a gap width Wg of about 0.30 mm, and were oriented at approximately a 45 degree angle with respect to a vertical axis relative to a putting surface ground plane.

Example 3

An insert 27018 was constructed of 6061 anodized aluminum with an overall width Wi (FIG. 114), height H (FIG. 113), and thickness Ti (FIG. 114) of about 85.16 mm, 18.59 mm, and 3.05 mm, respectively. The insert included twelve beams 27028. The beams 27028 had a depth D1 of about 3.10 mm, a depth D2 of about 2.62 mm, a thickness Tb of about 0.68 mm, a gap width Wg of about 0.30 mm, and were oriented at approximately a 45 degree angle with respect to a vertical axis relative to a putting surface ground plane.

Example 4

An insert 27018 was constructed of 6061 anodized aluminum with an overall width Wi (FIG. 114), height H (FIG. 113), and thickness Ti (FIG. 114) of about 85.16 mm, 18.59 mm, and 3.05 mm, respectively. The insert included eleven beams 27028. The beams 27028 had a depth D1 of about 3.10 mm, a depth D2 of about 2.62 mm, a thickness Tb of about 0.78 mm, a gap width Wg of about 0.30 mm, and were oriented at approximately a 45 degree angle with respect to a vertical axis relative to a putting surface ground plane.

Example 5

An insert 27018 was constructed of 6061 anodized aluminum with an overall width Wi (FIG. 114), height H (FIG. 113), and thickness Ti (FIG. 114) of about 85.16 mm, 18.59 mm, and 3.05 mm, respectively. The insert included ten beams 27028. The beams had a depth D1 of about 3.10 mm, a depth D2 of about 2.62 mm, a thickness Tb of about 0.89 mm, a gap width Wg of about 0.30 mm, and were oriented at approximately a 45 degree angle with respect to a vertical axis relative to a putting surface ground plane.

Example 6

An insert 27018 was constructed of 6061 anodized aluminum with an overall width Wi (FIG. 114), height H (FIG. 113), and thickness Ti (FIG. 114 of about 85.16 mm, 18.59 mm, and 3.05 mm, respectively. The insert included nine beams 27028. The beams 27028 had a depth D1 of about 3.10 mm, a depth D2 of about 2.62 mm, a thickness Tb of about 1.03 mm, a gap width Wg of about 0.30 mm, and were oriented at approximately a 45 degree angle with respect to a vertical axis relative to a putting surface ground plane.

Example 7

An insert 27018 was constructed of 6061 anodized aluminum with an overall width Wi (FIG. 114, height H (FIG. 113), and thickness Ti (FIG. 114) of about 85.16 mm, 18.59 mm, and 3.05 mm, respectively. The insert included eight beams 27028. The beams 27028 had a depth D1 of about 3.10 mm, a depth D2 of about 2.62 mm, a thickness Tb of about 1.18 mm, a gap width Wg of about 0.30 mm, and were oriented at approximately a 45 degree angle with respect to a vertical axis relative to a putting surface ground plane.

Example 8

An insert 27100 was constructed of 6061 anodized aluminum with an overall width Wi, height H, and thickness $T_1$ of about 86 mm, 20 mm, and 4 mm, respectively. The width of the horizontal gaps 27102 (i.e., the spacing between beams 27106 in the vertical direction) and the width of the vertical gaps 27104 (i.e., the spacing between beams 27106 in the horizontal direction) was about 0.5 mm. The beams 27106 had a depth of about 4.2 mm, a thickness measured between the upper and lower surfaces of each beam 27106 of about 1.4 mm, a width measured between the vertical sides of each beam 27106 of about 2.0 mm, and were oriented at approximately a 45 degree angle with respect to a vertical axis relative to a putting surface ground plane.

Example 9

A putter head 27400 was constructed of steel and included nineteen beams 27408 formed in the front surface 27406 of the putter head. The beams 27408 had a depth D1 of about 3.1 mm, a depth D2 of about 2.62 mm, a thickness Tb of about 0.40 mm, a gap width Wg of about 0.30 mm, and were oriented at approximately a 45 degree angle with respect to a vertical axis relative to a putting surface ground plane.

The inserts and putter described above in examples 1, 2, 5, and 9 were used to putt a golf ball. The physical characteristics and the "net shift" forward spin (measured in rpm) and frequency of beam oscillation for each example are shown in Table 1 below. The "net shift" forward spin is the difference between the forward spin of a golf ball struck with a putter having a substantially planar steel striking surface and the forward spin of an identical golf ball struck with a similarly shaped putter having deflectable beams, as measured shortly after impact. The testing method included six golfers, ten putts per putter per golfer, and 14-foot putts on a level and substantially planar putting surface. An indoor artificial putting surface was used primarily for consistency and to eliminate environmental variances. The spin of the ball was measured using a video camera system, as known in the art.

TABLE 1

| Example | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| Example 1 | ABS plastic | 45° | 2.62 | 0.89 | 0.30 | 80 ± 15 | 12.1 |
| Example 2 | 6061 anodized aluminum | 45° | 2.62 | 0.40 | 0.30 | 60 ± 15 | 43.9 |
| Example 5 | 6061 anodized aluminum | 45° | 2.62 | 0.89 | 0.30 | 30 ± 15 | 93.8 |
| Example 9 | 1018 steel | 45° | 2.62 | 0.40 | 0.30 | 40 ± 15 | 44.7 |

Computer simulations were performed on four different insert designs A, B, C, and D to predict the net shift forward spin compared to a standard steel putter head without any beams. The physical characteristics and the calculated net shift forward spin for each insert are reported below in Table 2.

TABLE 2

| Insert Design | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| A | 6061 anodized aluminum | 45° | 2.62 | 0.50 | 0.30 | 50 | 54.8 |
| B | 6061 anodized aluminum | 45° | 2.62 | 0.70 | 0.30 | 40 | 75.4 |

TABLE 2-continued

| Insert Design | Material | Beam angle (θ) | Beam depth, mm ($D_2$) | Beam thickness, mm ($T_b$) | Gap width, mm ($W_g$) | Net shift forward spin, rpm | Frequency (kHz) |
|---|---|---|---|---|---|---|---|
| C | Urethane | 55° | 2.62 | 0.70 | 0.30 | 200 | 6.1 |
| D | 6061 aluminum | 45° | 10.7 | 0.30 | 0.30 | 110 | 2.2 |

While any of the embodiments described herein can be used, a golf club head having an insert 27018 constructed of aluminum, the insert having beams 27028 oriented at an angle in the range of about 36 to 46 degrees, the beams having substantially flat end surfaces, a beam thickness of about 0.7 mm, a gap width between adjacent beams of about 0.3 mm, a frequency of oscillation in the range of about 12 kHz to about 95 kHz, and a compliant filler material at least partially filling the gaps has been found to be a suitable implementation of the present technology.

As previously disclosed, a number of variations of the hosel may be incorporated in the present putter head 100, and likewise for the frame hosel 10008 of the frame 10000. In fact, U.S. Provisional Patent Application No. 63/436,330, titled "PUTTER-TYPE GOLF CLUB HEAD, filed Dec. 30, 2022, is incorporated by reference herein in its entirety.

The opening(s), recess(es), alignment feature(s), and overall club head shapes may include any of those disclosed in U.S. application Ser. No. 18/140,184 filed Apr. 27, 2023, U.S. Pat. No. 9,050,510 issued Jun. 9, 2015, U.S. Pat. No. 7,815,520 issued Oct. 19, 2010, U.S. Pat. No. 7,648,425 issued Jan. 19, 2010, D966449 issued Oct. 11, 2022, D865885 issued Sep. 5, 2019, D859545 issued Sep. 10, 2019, D837911 issued Jan. 8, 2019, D645923 issued Sep. 27, 2011, D607952 issued Jan. 12, 2010, D569460 issued May 20, 2008, D587326 issued Feb. 24, 2009, D584780 issued Jan. 13, 2009, which are all incorporated by reference herein in their entirety.

Any embodiments of the club head may include an electronic display, as disclosed in U.S. Ser. No. 17/878,734, filed Aug. 1, 2022, U.S. application Ser. No. 16/352,537, filed Mar. 13, 2019, and U.S. application Ser. No. 17/695,194, filed Mar. 15, 2022, which are all incorporated by reference herein in their entirety. In one such embodiment an electronic display is located on the frame top 10300 and at least partially on the thin wall crown region 10600. In addition to the various features described herein, any of the features of the golf club heads disclosed herein may also incorporate additional features, which can include any of the following features found in the following, which are all incorporated by reference herein in their entirety: U.S. Pat. Nos. 11,179,608; 10,874,928; 10,391,369; 10,052,530; 9,827,479; 9,522,313; 9,468,817; 9,375,619; 9,220,960; 8,328,654; 8,066,581; 7,648,425; 7,594,865; 7,465,240; 7,438,648; 7,396,295; 7,278,926; 6,929,564; U.S. Ser. No. 18/534,512, filed Dec. 8, 2023; U.S. Ser. No. 17/878,734, filed Aug. 1, 2022; U.S. Ser. No. 17/645,033, filed Dec. 17, 2021; U.S. Ser. No. 17/974,279, filed Oct. 26, 2022; U.S. Ser. No. 17/566,263, filed Mar. 16, 2022; U.S. Ser. No. 18/068,347, filed Dec. 19, 2022; U.S. Ser. No. 17/722,632, filed Apr. 18, 2022; U.S. Ser. No. 17/691,649, filed Mar. 10, 2022; U.S. Ser. No. 17/577,943, filed Jan. 18, 2022; U.S. Ser. No. 17/107,490, filed Nov. 30, 2020; U.S. Ser. No. 17/505,511, filed Oct. 19, 2021; U.S. Ser. No. 17/736,766, filed May 4, 2022; U.S. Ser. No. 17/963,491, filed Oct. 11, 2022; U.S. Pat. No. 9,468,817, issued Oct. 18, 2016; U.S. Pat. No. 9,375,619, issued Jun. 28, 2016; U.S. Pat. No. 9,522,313, issued Dec. 20, 2016; U.S. Pat. No. 8,758,155, issued Jun. 24, 2014; U.S. Pat. No. 9,375,619, issued Jun. 28, 2016; U.S. Pat. No. 9,220,960, issued Dec. 29, 2015; U.S. Pat. No. 7,465,240, issued Dec. 16, 2008; U.S. Provisional Patent Application No. 63/436,330, filed Dec. 30, 2022; U.S. Provisional Patent Application No. 63/433,380, filed Dec. 27, 2022; U.S. Pat. No. D925,677, issued Jul. 20, 2021; U.S. Pat. No. D924,991, issued Jul. 13, 2021; and U.S. Pat. No. D924992, issued Jul. 13, 2021.

In addition to the various features described herein, any of the golf club heads disclosed herein may also incorporate additional features, which can include any of the following features:

- movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
- slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
- aerodynamic shape features including those described in more detail in U.S. Patent Publication No. 2013/0123040A1, the entire contents of which are incorporated by reference herein in their entirety;
- removable shaft features including those described in more detail in U.S. Pat. No. 8,303,431, the contents of which are incorporated by reference herein in in their entirety;
- adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
- adjustable sole features including those described in more detail in U.S. Pat. No. 8,337,319, U.S. Patent Publication Nos. US2011/0152000A1, US2011/0312437, US2012/0122601A1, and U.S. patent application Ser. No. 13/686,677, the entire contents of each of which are incorporated by reference herein in their entirety.

The technology described herein may also be combined with other features and technologies for golf clubs, such as:

- variable thickness face features described in more detail in U.S. patent application Ser. No. 12/006,060, U.S.

Pat. Nos. 6,997,820, 6,800,038, and 6,824,475, which are incorporated herein by reference in their entirety;

composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety.

The above-described embodiments are just examples of possible implementations of the disclosed technologies, and are set forth for a clear understanding of the principles of the present disclosure. Any process descriptions or blocks in flow diagrams should be understood as representing modules, segments, or portions of processes for implementing specific functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure.

Many variations and modifications may be made to the above-described embodiment(s) without departing substantially from the spirit and principles of the present disclosure. Further, the scope of the present disclosure includes any and all combinations and sub-combinations of all elements, features, and aspects disclosed herein and in the documents that are incorporated by reference. All such combinations, modifications, and variations are included herein within the scope of the present disclosure, and all possible claims to individual aspects or combinations of elements or steps are intended to be supported by the present disclosure.

Reference throughout this specification to "one example," "an example," "one embodiment," "an embodiment," or similar language means that a particular feature, structure, or characteristic described in connection with the example or embodiment is included in at least one example or embodiment of the present disclosure. Appearances of the phrases "in one example," "in an example," "in one embodiment," "in an embodiment," and similar language throughout this specification may, but do not necessarily, all refer to the same example or embodiment. Similarly, the use of the term "implementation" means an implementation having a particular feature, structure, or characteristic described in connection with one or more examples or embodiments of the present disclosure, however, absent an express correlation to indicate otherwise, an implementation may be associated with one or more examples or embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, is defined to mean within +/−5% of a given value, however in additional embodiments any disclosure of "about" may be further narrowed and claimed to mean within +/−4% of a given value, within +/−3% of a given value, within +/−2% of a given value, within +/−1% of a given value, or the exact given value. Further, when at least two values of a variable are disclosed, such disclosure is specifically intended to include the range between the two values regardless of whether they are disclosed with respect to separate embodiments or examples, and specifically intended to include the range of at least the smaller of the two values and/or no more than the larger of the two values. Additionally, when at least three values of a variable are disclosed, such disclosure is specifically intended to include the range between any two of the values regardless of whether they are disclosed with respect to separate embodiments or examples, and specifically intended to include the range of at least the A value and/or no more than the B value, where A may be any of the disclosed values other than the largest disclosed value, and B may be any of the disclosed values other than the smallest disclosed value. Any tables and/or examples and/or embodiments disclosed herein that give exact values, are to be interpreted as also disclosing an embodiment where each of the values is +10% of the value indicated, and in further embodiments each of the values is +7.5%, +5%, or +2.5%, thereby disclosing distinct upper values for each, distinct lower values for each, as well as closed ranges having upper and lower limiting values.

Throughout the disclosure embodiments are described often with one embodiment setting a minimum value for variable or relationship, followed by an embodiment setting a maximum value for a variable or relationship. For example, in one sentence the disclosure states: "in another embodiment the frame mass is at least 250 grams, while in further embodiments is at least 260, 270, 280, 290, 300, or 310 grams." In another sentence the disclosure states: "The frame mass is no more than 370 grams in an embodiment, and is no more than 360, 350, 340, 330, or 320 grams in additional embodiments." In any such disclosure, any integer value meeting these limitations is enabled and may be claimed, such as ≥255, ≥265, ≥275, ≥285, ≥295, ≥305, etc., and likewise for the disclosed upper end boundary values, and likewise for any disclosed variable. Further, any discreet value within the disclosed ranges is fully enabled and may be claimed either as a value or as a boundary to a range, which applies to all the disclosure herein. Further, any discreet value within the disclosed ranges is fully enabled and may be claimed either as a value or as a boundary to a range. These principles apply to each variable and/or relationship disclosed, and the contents of each table.

Additionally, instances in this specification where one element is "coupled" or "attached" to another element can include direct and indirect coupling or attachment. Direct coupling or attachment can be defined as one element coupled, or attached, to and in some contact with another element. Indirect coupling or attachment can be defined as coupling, or attachment, between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the examples below are to be embraced within their scope. In view of the many possible embodiments to which the principles of the disclosure may be applied, it should be recognized that the illustrated embodiments are only preferred examples and should not be taken as limiting the scope of the disclosure. Various modifications may be made thereto without departing from the broader spirit and scope of the disclosure as set forth. The specification and drawings are, accordingly, to be regarded in an illustrative sense rather than a restrictive sense. Accordingly, the scope of the disclosure is at least as broad as the full scope of the following exemplary claims and their equivalents.

Additionally, in addition to the various features described herein, any of the golf club heads disclosed herein may also incorporate additional features, which can include any of the features disclosed in U.S. patent application Ser. No. 18/414,128, filed Jan. 16, 2024, Ser. No. 17/505,511, filed Oct. 19, 2021, Ser. No. 17/560,054, filed Dec. 22, 2021, Ser. No. 17/389,167, filed Jul. 19, 2021, Ser. No. 17/321,315, filed May 14, 2021, Ser. No. 18/179,848, filed Mar. 7, 2023, Ser. No. 17/124,134, filed Dec. 16, 2020, Ser. No. 17/137,151, filed Dec. 29, 2020, Ser. No. 17/691,649, filed Mar. 10, 2022, Ser. No. 18/510,476, filed Nov. 15, 2023, Ser. No. 17/228,511, filed Apr. 12, 2021, Ser. No. 17/224,026, filed Apr. 6, 2021, Ser. No. 17/564,077, filed Dec. 28, 2021, 63/292,708, filed Dec. 22, 2021, 63/478,107, filed Dec. 30, 2022, 63/433,380, filed Dec. 16, 2022, Ser. No. 14/694,998, filed Apr. 23, 2015, Ser. No. 18/068,347, filed Dec. 19, 2022, Ser. No. 17/547,519, filed Dec. 10, 2021, Ser. No. 17/360,179, filed Jun. 28, 2021, Ser. No. 17/531,979, filed Nov. 22, 2021, Ser. No. 17/722,748, filed Apr. 18, 2022, Ser. No. 17/006,561, filed Aug. 28, 2020, Ser. No. 16/806,254, filed Mar. 2, 2020, Ser. No. 17/696,664, filed Mar. 16, 2022, Ser. No. 17/565,580, filed Dec. 30, 2021, Ser. No. 17/727,963, filed Apr. 25, 2022, Ser. No. 16/288,499, filed Feb. 28, 2019, Ser. No. 17/530,331, filed Nov. 18, 2021, Ser. No. 17/586,960, filed Jan. 28, 2022, Ser. No. 17/884,027, filed Aug. 9, 2022, Ser. No. 13/842,011, filed Mar. 15, 2013, Ser. No. 16/817,311, filed Mar. 12, 2020, Ser. No. 17/355,642, filed Jun. 23, 2021, Ser. No. 17/132,645, filed Dec. 23, 2020, Ser. No. 17/390,615, filed Jul. 30, 2021, Ser. No. 17/164,033, filed Feb. 1, 2021, Ser. No. 17/107,474, filed Nov. 30, 2020, Ser. No. 17/526,981, filed Nov. 15, 2021, Ser. No. 16/352,537, filed Mar. 13, 2019, Ser. No. 17/156,205, filed Jan. 22, 2021, Ser. No. 17/132,541, filed Dec. 23, 2020, Ser. No. 17/824,727, filed May 25, 2022, Ser. No. 17/722,632, filed Apr. 18, 2022, Ser. No. 17/712,041, filed Apr. 1, 2022, Ser. No. 17/695,194, filed Mar. 15, 2022, Ser. No. 17/686,181, filed Mar. 3, 2022, 63/305,777, filed Feb. 2, 2022, Ser. No. 17/577,943, filed Jan. 18, 2022, Ser. No. 17/570,613, filed Jan. 7, 2022, Ser. No. 17/569,810, filed Jan. 6, 2022, Ser. No. 17/566,833, filed Dec. 31, 2021, Ser. No. 17/566,131, filed Dec. 30, 2021, Ser. No. 17/566,263, filed Dec. 30, 2021, Ser. No. 17/557,759, filed Dec. 21, 2021, Ser. No. 17/558,387, filed Dec. 21, 2021, Ser. No. 17/645,033, filed Dec. 17, 2021, Ser. No. 17/541,107, filed Dec. 2, 2021, Ser. No. 17/526,855, filed Nov. 15, 2021, Ser. No. 17/524,056, filed Nov. 11, 2021, Ser. No. 17/522,560, filed Nov. 9, 2021, Ser. No. 17/515,112, filed Oct. 29, 2021, Ser. No. 17/513,716, filed Oct. 28, 2021, Ser. No. 17/504,335, filed Oct. 18, 2021, Ser. No. 17/504,327, filed Oct. 18, 2021, Ser. No. 17/494,416, filed Oct. 5, 2021, Ser. No. 17/493,604, filed Oct. 4, 2021, 63/261,457, filed Sep. 21, 2021, Ser. No. 17/479,785, filed Sep. 20, 2021, Ser. No. 17/476,839, filed Sep. 16, 2021, Ser. No. 17/477,258, filed Sep. 16, 2021, Ser. No. 17/476,025, filed Sep. 15, 2021, Ser. No. 17/467,709, filed Sep. 7, 2021, Ser. No. 17/403,516, filed Aug. 16,2021, Ser. No. 17/399,823, filed Aug. 11, 2021, 63/227,889, filed Jul. 30, 2021, Ser. No. 17/387,181, filed Jul. 28, 2021, Ser. No. 17/378,407, filed Jul. 16, 2021, Ser. No. 17/368,520, filed Jul. 6, 2021, Ser. No. 17/330,033, filed May 25, 2021, Ser. No. 17/235,533, filed Apr. 20, 2021, Ser. No. 17/233,201, filed Apr. 16, 2021, Ser. No. 17/216,185, filed Mar. 29, 2021, Ser. No. 17/198,030, filed Mar. 10, 2021, Ser. No. 17/191,617, filed Mar. 3, 2021, Ser. No. 17/190,864, filed Mar. 3, 2021, Ser. No. 17/183,905, filed Feb. 24, 2021, Ser. No. 17/183,057, filed Feb. 23, 2021, Ser. No. 17/181,923, filed Feb. 22, 2021, Ser. No. 17/171,678, filed Feb. 9, 2021, Ser. No. 17/171,656, filed Feb. 9, 2021, Ser. No. 17/107,447, filed Nov. 30, 2020, and 63/338,818, filed May 5, 2022, all of which are herein incorporated by reference in their entirety. Additionally, in addition to the various features described herein, any of the golf club heads disclosed herein may also incorporate additional features, which can include any of the features disclosed in U.S. Pat. No. 9,610,479, issued Apr. 4, 2017, U.S. Pat. No. 11,213,726, issued Jan. 4, 2022, U.S. Pat. No. 8,777,776, issued Jul. 15, 2014, U.S. Pat. No. 7,278,928, issued Oct. 9, 2007, U.S. Pat. No. 7,445,561, issued Nov. 4, 2008, U.S. Pat. No. 9,409,066, issued Aug. 9, 2016, U.S. Pat. No. 8,303,435, issued Nov. 6, 2012, U.S. Pat. No. 7,874,937, issued Jan. 25, 2011, U.S. Pat. No. 8,628, 434, issued Jan. 14, 2014, U.S. Pat. No. 8,608,591, issued Dec. 17, 2013, U.S. Pat. No. 8,740,719, issued Jun. 3, 2014, U.S. Pat. No. 9,694,253, issued Jul. 4, 2017, U.S. Pat. No. 9,683,301, issued Jun. 20, 2017, U.S. Pat. No. 9,468,816, issued Oct. 18, 2016, U.S. Pat. No. 8,262,509, issued Sep. 11, 2012, U.S. Pat. No. 7,901,299, issued Mar. 8, 2011, U.S. Pat. No. 8,119,714, issued Feb. 21, 2012, U.S. Pat. No. 8,764,586, issued Jul. 1, 2014, U.S. Pat. No. 8,227,545, issued Jul. 24, 2012, U.S. Pat. No. 8,066,581, issued Nov. 29, 2011, 10052530, issued Aug. 21, 2018, 10195497, issued Feb. 5, 2019, 10086240, issued Oct. 2, 2018, U.S. Pat. No. 9,914,027, issued Mar. 13, 2018, U.S. Pat. No. 9,174,099, issued Nov. 3, 2015, and U.S. Pat. No. 11,219,803, issued Jan. 11, 2022, all of which are herein incorporated by reference in their entirety.

The above-described embodiments are just examples of possible implementations of the disclosed technologies, and are set forth for a clear understanding of the principles of the present disclosure. Any process descriptions or blocks in flow diagrams should be understood as representing modules, segments, or portions of processes for implementing specific functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure.

Many variations and modifications may be made to the above-described embodiment(s) without departing substantially from the spirit and principles of the present disclosure. Further, the scope of the present disclosure includes any and all combinations and sub-combinations of all elements, features, and aspects disclosed herein and in the documents that are incorporated by reference. All such combinations, modifications, and variations are included herein within the scope of the present disclosure, and all possible claims to individual aspects or combinations of elements or steps are intended to be supported by the present disclosure.

Reference throughout this specification to "one embodiment," "an embodiment," or similar language means that a particular feature, structure, or characteristic described in connection with the embodiment is included in at least one embodiment of the present disclosure. Appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

In the above description, certain terms may be used such as "up," "down," "upper," "lower," "horizontal," "vertical," "left," "right," "over," "under" and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two." The term "about" in some embodiments, can be defined to mean within +/−5% of a given value.

Additionally, examples in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

As used herein, a system, apparatus, structure, article, element, component, or hardware "configured to" perform a specified function is indeed capable of performing the specified function without any alteration, rather than merely having potential to perform the specified function after further modification. In other words, the system, apparatus, structure, article, element, component, or hardware "configured to" perform a specified function is specifically selected, created, implemented, utilized, programmed, and/or designed for the purpose of performing the specified function. As used herein, "configured to" denotes existing characteristics of a system, apparatus, structure, article, element, component, or hardware which enable the system, apparatus, structure, article, element, component, or hardware to perform the specified function without further modification. For purposes of this disclosure, a system, apparatus, structure, article, element, component, or hardware described as being "configured to" perform a particular function may additionally or alternatively be described as being "adapted to" and/or as being "operative to" perform that function.

The present subject matter may be embodied in other specific forms without departing from its spirit or essential characteristics. The described embodiments are to be considered in all respects only as illustrative and not restrictive. All changes which come within the meaning and range of equivalency of the claims are to be embraced within their scope.

We claim:

1. A putter-type golf club head comprising:

a unitary construction metallic frame having a frame mass of 250-370 grams, a frame length of 40-130 mm, a frame width of 75-130 mm, a frame top, a frame bottom, a frame rear, a frame front forming a portion of a striking face, and formed of a frame material having a frame density;

a sole member attached to the unitary construction metallic frame and having a SM density, a SM mass of 1-8% of the frame mass, and an externally exposed sole member area of at least 400 $mm^2$;

a top-to-sole-member damper contacting the sole member and an internal surface of the frame top, the top-to-sole-member damper having a TTSM damper mass, a TTSM damper density of at least 45% of the SM density, an uninstalled relaxed TTSM damper height, an installed TTSM damper height of at least 0.1 mm less than the uninstalled relaxed TTSM damper height, and a TTSM damper width;

wherein:

the putter-type golf club head has a total club head mass;

a frame mass ratio of the frame mass to the total club head mass is 0.650-0.975;

the striking face has a geometric center defining an origin for a club head origin X-axis, a club head origin Y-axis, and a club head origin Z-axis;

the putter-type golf club head has a club head center of gravity CG located at a head origin x-axis CGx coordinate, a head origin y-axis CGy coordinate, a Zup distance above a ground plane, and defining a head center-of-gravity coordinate system having a CG X-axis, a CG Y-axis, and a CG Z-axis;

the putter-type golf club head has a Ixx moment of inertia about the CG X-axis, a Iyy moment of inertia about the CG Y-axis, and a Izz moment of inertia about the CG Z-axis;

the unitary construction metallic frame has a frame center of gravity CGf located at a head origin x-axis CGx-f coordinate and a head origin y-axis CGy-f coordinate, and a Zup-f distance above the ground plane; and the sole member has a SM center of gravity CGsm located at a head origin x-axis CGx-sm coordinate and a head origin y-axis CGy-sm coordinate, where the head origin y-axis CGy-sm coordinate is greater than 20 mm.

2. The putter-type golf club head of claim 1, wherein the externally exposed sole member area of at least 600 $mm^2$, and the frame mass is no more than 360 grams.

3. The putter-type golf club head of claim 2, wherein a Δy value is an absolute value of a difference between the head origin y-axis CGy coordinate and the head origin y-axis CGy-f coordinate, and the Δy value is no more than 7.5 mm.

4. The putter-type golf club head of claim 2, wherein the putter-type golf club head has a forward 25% region, a middle 50% region, and a rear 25% region, wherein the forward 25% region has a forward 25% region mass of at least 30% of the total club head mass, the middle 50% region has a middle 50% region mass of no more than 45% of the total club head mass, and the rear 25% region has a rear 25% region mass of at least 17.5% of the total club head mass.

5. The putter-type golf club head of claim 2, wherein:

the unitary construction metallic frame has a Ixx-f moment of inertia about the CG X-axis, a Iyy-f moment of inertia about the CG Y-axis, and a Izz-f moment of inertia about the CG Z-axis;

a frame Ixx ratio of the Ixx-f to the Ixx is 0.750-0.975;

a frame Iyy ratio of the Iyy-f to the Iyy is 0.800-0.970; and a frame Izz ratio of the Izz-f to the Izz is 0.750-0.950.

6. The putter-type golf club head of claim 5, wherein the frame mass ratio is 0.700-0.950, the frame mass is at least 260 grams, and the unitary construction metallic frame is a metal injection molded unitary construction metallic frame.

7. The putter-type golf club head of claim 6, wherein the SM density is no more than 40% of the frame density, the TTSM damper density is no more than 25% of the frame density, the frame mass ratio is no more than 0.925, the head origin y-axis CGy coordinate is 30-40 mm, the frame Ixx ratio is 0.825-0.925, the frame Iyy ratio is at least 0.875, and the frame Izz ratio is at least 0.850.

8. The putter-type golf club head of claim 2, wherein the TTSM damper mass is no more than 10 grams, and the striking face includes a face insert comprising at least a first face insert material different than the frame material.

9. The putter-type golf club head of claim 8, wherein the TTSM damper width is no more than 32 mm, the face insert includes a plurality of grooves, the face insert has a face insert contact surface, a face insert rear surface, and a face insert thickness measured from the face insert contact surface to the face insert rear surface, and the face insert comprises (a) a plurality of beams with each beam having an exterior beam surface at the face insert contact surface, a first-side surface extending from the face insert contact surface toward the face insert rear surface, a second-side surface extending from the face insert contact surface toward the face insert rear surface, and a beam thickness measured orthogonally from the first-side surface to the second-side surface, and (b) the plurality of grooves comprises a plurality of beam gaps with each beam gap having a beam gap width between two adjacent beams.

10. The putter-type golf club head of claim 9, wherein the TTSM damper density is at least 0.4 g/cc, and each beam has a maximum beam depth measured from the exterior beam surface to a deepest portion of an adjacent beam gap, and at least one beam has a first maximum beam depth of at least 1 mm, and at least one beam has an acute beam angle measured relative to the face insert rear surface.

11. The putter-type golf club head of claim 10, wherein the TTSM damper mass is no more than 8 grams, the acute beam angle is 6-76 degrees, and the first face insert material is a polymeric material.

12. The putter-type golf club head of claim 2, wherein the frame mass ratio is 0.700-0.950, the striking face includes a face insert comprising a polymeric material, the face insert includes a plurality of horizontal grooves, and at least one of the plurality of horizontal grooves has a groove surface angled downward at a 6-76 degree angle measured from a vertical axis.

13. The putter-type golf club head of claim 2, wherein the TTSM damper mass is no more than 10 grams, the TTSM damper width is no more than 32 mm, and a top-to-sole-member connector joins the sole member and the frame top, and having a connector mass of no more than 200% of the SM mass.

14. The putter-type golf club head of claim 13, wherein the top-to-sole-member connector has a connector center of gravity CGconn located at a head origin x-axis CGx-conn coordinate and a head origin y-axis CGy-conn coordinate, where the head origin y-axis CGy-conn coordinate is greater than the head origin y-axis CGy-f coordinate.

15. The putter-type golf club head of claim 14, wherein the head origin y-axis CGy-conn coordinate is greater than the head origin y-axis CGy coordinate.

16. The putter-type golf club head of claim 14, wherein the top-to-sole-member connector passes through the top-to-sole-member damper.

17. A putter-type golf club head comprising:

a unitary construction metallic frame having a frame mass, a frame length of 40-130 mm, a frame width of 75-130 mm, a frame top, a frame bottom, a frame rear, a frame front forming a portion of a striking face, and formed of a frame material having a frame density;

a sole member attached to the frame and having a SM density, a SM mass of no more than 8% of the frame mass, and an externally exposed sole member area of at least 400 $mm^2$;

a top-to-sole-member damper extending from the sole member to an internal surface of the frame top, the top-to-sole-member damper having a TTSM damper mass, a TTSM damper density, and a TTSM damper width;

wherein:

the putter-type golf club head has a total club head mass;

a frame mass ratio of the frame mass to the total club head mass is 0.700-0.950;

the striking face has a geometric center defining an origin for a club head origin X-axis, a club head origin Y-axis, and a club head origin Z-axis;

the putter-type golf club head has a club head center of gravity CG located at a head origin x-axis CGx coordinate, a head origin y-axis CGy coordinate, a Zup distance above a ground plane, and defining a head center-of-gravity coordinate system having a CG X-axis, a CG Y-axis, and a CG Z-axis;

the putter-type golf club head has a Ixx moment of inertia about the CG X-axis, a Iyy moment of inertia about the CG Y-axis, and a Izz moment of inertia about the CG Z-axis;

the unitary construction metallic frame has a frame center of gravity CGf located at a head origin x-axis CGx-f coordinate and a head origin y-axis CGy-f coordinate of no more than 48 mm, and a Zup-f distance above the ground plane; and the sole member has a SM center of gravity CGsm located at a head origin x-axis CGx-sm coordinate and a head origin y-axis CGy-sm coordinate, where the head origin y-axis CGy-sm coordinate is greater than 20 mm.

18. The putter-type golf club head of claim 17, wherein the frame mass ratio is no more than 0.925, and the TTSM damper mass is no more than 10 grams.

19. The putter-type golf club head of claim 18, further including a top-to-sole-member connector joins the sole member and the frame top, and having a connector mass of no more than 200% of the SM mass, wherein the top-to-sole-member connector has a connector center of gravity CGconn located at a head origin x-axis CGx-conn coordinate and a head origin y-axis CGy-conn coordinate, where the head origin y-axis CGy-conn coordinate is greater than 20 mm.

20. The putter-type golf club head of claim 19, wherein the head origin y-axis CGy-conn coordinate is greater than the head origin y-axis CGy-f coordinate.

21. The putter-type golf club head of claim 19, wherein the top-to-sole-member connector passes through the top-to-sole-member damper.

22. The putter-type golf club head of claim 17, wherein:

the frame mass ratio is at least 0.750, the frame mass is at least 260 grams, and the unitary construction metallic frame is a metal injection molded unitary construction metallic frame;

the SM density is no more than 40% of the frame density; and the TTSM damper density is no more than 25% of the frame density.

23. A putter-type golf club head comprising:

a unitary construction metallic frame having a frame mass, a frame length of 40-130 mm, a frame width of 75-130 mm, a frame top, a frame bottom, a frame rear, a frame front forming a portion of a striking face, and formed of a frame material having a frame density;

a sole member attached to the frame and having a SM density, a SM mass of no more than 8% of the frame mass, and an externally exposed sole member area of at least 400 $mm^2$;

wherein:

the putter-type golf club head has a total club head mass;

a frame mass ratio of the frame mass to the total club head mass is 0.700-0.950;

the striking face has a geometric center defining an origin for a club head origin X-axis, a club head origin Y-axis, and a club head origin Z-axis;

the putter-type golf club head has a club head center of gravity CG located at a head origin x-axis CGx coordinate, a head origin y-axis CGy coordinate, a Zup distance above a ground plane, and defining a head center-of-gravity coordinate system having a CG X-axis, a CG Y-axis, and a CG Z-axis;

the putter-type golf club head has a Ixx moment of inertia about the CG X-axis, a Iyy moment of inertia about the CG Y-axis, and a Izz moment of inertia about the CG Z-axis;

the unitary construction metallic frame has a frame center of gravity CGf located at a head origin x-axis CGx-f coordinate and a head origin y-axis CGy-f coordinate of no more than 48 mm, and a Zup-f distance above the ground plane;

the sole member has a SM center of gravity CGsm located at a head origin x-axis CGx-sm coordinate and a head origin y-axis CGy-sm coordinate, where the head origin y-axis CGy-sm coordinate is 20-52 mm; and the striking face includes a face insert comprising a polymeric material, the face insert includes a plurality of horizontal grooves, and at least one of the plurality of horizontal grooves has a groove surface angled downward at a 6-76 degree angle measured from a vertical axis.

* * * * *